US008187074B2

(12) United States Patent
Fujimori et al.

(10) Patent No.: US 8,187,074 B2
(45) Date of Patent: May 29, 2012

(54) GAMING MACHINE AND GAMING SYSTEM, TICKET ISSUING SYSTEM THAT ENABLE PARTICIPATION IN GAME BY INSERTING TICKET

(75) Inventors: Kenichi Fujimori, Koto-ku (JP); Yuji Miyagawa, Koto-ku (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 260 days.

(21) Appl. No.: 12/603,933

(22) Filed: Oct. 22, 2009

(65) Prior Publication Data

US 2010/0113121 A1 May 6, 2010

Related U.S. Application Data

(60) Provisional application No. 61/109,794, filed on Oct. 30, 2008, provisional application No. 61/109,786, filed on Oct. 30, 2008, provisional application No. 61/109,766, filed on Oct. 30, 2008, provisional application No. 61/109,740, filed on Oct. 30, 2008, provisional application No. 61/109,725, filed on Oct. 30, 2008, provisional application No. 61/109,724, filed on Oct. 30, 2008.

(51) Int. Cl.
*G06Q 17/00* (2006.01)

(52) U.S. Cl. ..... 463/16

(58) Field of Classification Search ..... 463/16–25, 463/43

See application file for complete search history.

(56) References Cited

U.S. PATENT DOCUMENTS

| | | | | |
|---|---|---|---|---|
| 4,880,237 | A | 11/1989 | Kishishita et al. | |
| 6,012,832 | A | 1/2000 | Saunders et al. | |
| 6,048,269 | A | 4/2000 | Burns et al. | |
| 6,578,735 | B1 * | 6/2003 | Mothwurf | 221/255 |
| 6,729,958 | B2 * | 5/2004 | Burns et al. | 463/25 |
| 7,016,861 | B2 * | 3/2006 | Mothwurf | 705/14.14 |
| 2004/0009816 | A1 | 1/2004 | Miller | |
| 2004/0204215 | A1 | 10/2004 | Meehan et al. | |
| 2004/0204231 | A1 | 10/2004 | Martin et al. | |
| 2004/0229677 | A1 * | 11/2004 | Gray et al. | 463/17 |
| 2005/0003883 | A1 | 1/2005 | Muir et al. | |
| 2008/0132336 | A1 | 6/2008 | Kobayashi et al. | |
| 2008/0214310 | A1 | 9/2008 | Brunet De Courssou et al. | |
| 2009/0082082 | A1 * | 3/2009 | Carr-Gregg et al. | 463/20 |

FOREIGN PATENT DOCUMENTS

| | | | |
|---|---|---|---|
| AU | 6027394 | A | 8/1994 |
| AU | 8158198 | A | 1/1999 |
| AU | 7890400 | A | 7/2001 |
| AU | 2002258628 | B2 | 10/2002 |
| AU | 2006202695 | A1 | 1/2007 |

* cited by examiner

*Primary Examiner* — Ronald Laneau
(74) *Attorney, Agent, or Firm* — Edwards Wildman Palmer LLP

(57) ABSTRACT

A gaming machine of the present invention comprises: a ticket reader; and a controller, the controller programmed to execute the processing of (a) executing a game played against an other gaming machine, when the ticket reader has read a ticket issued from a ticket issuing terminal.

13 Claims, 177 Drawing Sheets

FIG. 24

| Symbol | Number of rearranged symbols | | | |
|---|---|---|---|---|
| | 3 symbols | 4 symbols | 5 symbols | 6 or more symbols |
| RIBBON | 2 | 4 | 6 | m×(n-2) (※) |
| HEART | 3 | 6 | 9 | |
| STAR | 5 | 10 | 15 | |
| MOON | 8 | 16 | 24 | |
| SUN | 10 | 20 | 30 | |
| JEWEL | 15 | 30 | 45 | |
| CROWN | 20 | 40 | 60 | |
| SMILE | 30 | 60 | 90 | |

※ "m" represents the amount of payout when 3 symbols are rearranged.
"n" represents the number of rearranged symbols.

FIG. 53

| Symbol | Number of rearranged symbols | | | |
|---|---|---|---|---|
| | 3 symbols | 4 symbols | 5 symbols | 6 or more symbols |
| RIBBON | 2 | 4 | 6 | m×(n−2) (※) |
| HEART | 3 | 6 | 9 | |
| STAR | 5 | 10 | 15 | |
| MOON | 8 | 16 | 24 | |
| SUN | 10 | 20 | 30 | |
| JEWEL | 15 | 30 | 45 | |
| CROWN | 20 | 40 | 60 | |
| SMILE | 30 | 60 | 90 | |

※ "m" represents the amount of payout when 3 symbols are rearranged.
"n" represents the number of rearranged symbols.

FIG. 82

| Symbol | Number of rearranged symbols | | | |
|---|---|---|---|---|
| | 3 symbols | 4 symbols | 5 symbols | 6 or more symbols |
| RIBBON | 2 | 4 | 6 | m×(n-2) (※) |
| HEART | 3 | 6 | 9 | |
| STAR | 5 | 10 | 15 | |
| MOON | 8 | 16 | 24 | |
| SUN | 10 | 20 | 30 | |
| JEWEL | 15 | 30 | 45 | |
| CROWN | 20 | 40 | 60 | |
| SMILE | 30 | 60 | 90 | |

※ "m" represents the amount of payout when 3 symbols are rearranged.
"n" represents the number of rearranged symbols.

FIG. 94

| Player identification information | Total number of games | Highest rank in preliminary tournament |
|---|---|---|
| KEN. F | 120 | 1 |
| MILE | 150 | 4 |
| SIMONE | 15 | — |
| CAMERON | 75 | — |
| SUZUKI | 180 | 6 |
| ⋮ | ⋮ | ⋮ |

FIG. 103

| Symbol | Number of rearranged symbols | | | |
|---|---|---|---|---|
| | 3 symbols | 4 symbols | 5 symbols | 6 or more symbols |
| RIBBON | 2 | 4 | 6 | m×(n−2) (※) |
| HEART | 3 | 6 | 9 | |
| STAR | 5 | 10 | 15 | |
| MOON | 8 | 16 | 24 | |
| SUN | 10 | 20 | 30 | |
| JEWEL | 15 | 30 | 45 | |
| CROWN | 20 | 40 | 60 | |
| SMILE | 30 | 60 | 90 | |

※ "m" represents the amount of payout when 3 symbols are rearranged.
"n" represents the number of rearranged symbols.

FIG. 119

| Symbol | Number of rearranged symbols | | | |
|---|---|---|---|---|
| | 3 symbols | 4 symbols | 5 symbols | 6 or more symbols |
| RIBBON | 2 | 4 | 6 | m×(n−2) (※) |
| HEART | 3 | 6 | 9 | |
| STAR | 5 | 10 | 15 | |
| MOON | 8 | 16 | 24 | |
| SUN | 10 | 20 | 30 | |
| JEWEL | 15 | 30 | 45 | |
| CROWN | 20 | 40 | 60 | |
| SMILE | 30 | 60 | 90 | |

※ "m" represents the amount of payout when 3 symbols are rearranged.
"n" represents the number of rearranged symbols.

FIG. 135

| Player identification information | Total number of games | Highest rank in tournament |
|---|---|---|
| KEN. F | 120 | 1 |
| MILE | 150 | 4 |
| SIMONE | 15 | — |
| CAMERON | 75 | — |
| SUZUKI | 180 | 6 |
| ⋮ | ⋮ | ⋮ |

FIG. 143

| Symbol | Number of rearranged symbols | | | |
|---|---|---|---|---|
| | 3 symbols | 4 symbols | 5 symbols | 6 or more symbols |
| RIBBON | 2 | 4 | 6 | m×(n−2) (※) |
| HEART | 3 | 6 | 9 | |
| STAR | 5 | 10 | 15 | |
| MOON | 8 | 16 | 24 | |
| SUN | 10 | 20 | 30 | |
| JEWEL | 15 | 30 | 45 | |
| CROWN | 20 | 40 | 60 | |
| SMILE | 30 | 60 | 90 | |

※ "m" represents the amount of payout when 3 symbols are rearranged.
"n" represents the number of rearranged symbols.

GAMING MACHINE AND GAMING SYSTEM, TICKET ISSUING SYSTEM THAT ENABLE PARTICIPATION IN GAME BY INSERTING TICKET

CROSS-REFERENCE TO RELATED APPLICATIONS

This application claims benefit of priority based on U.S. Provisional Patent Application No. 61/109,786 filed on Oct. 30, 2008, U.S. Provisional Patent Application No. 61/109,725 filed on Oct. 30, 2008, U.S. Provisional Patent Application No. 61/109,740 filed on Oct. 30, 2008, U.S. Provisional Patent Application No. 61/109,794 filed on Oct. 30, 2008, U.S. Provisional Patent Application No. 61/109,724 filed on Oct. 30, 2008, and U.S. Provisional Patent Application No. 61/109,766 filed on Oct. 30, 2008. The contents of this application are incorporated herein by reference in their entirety.

BACKGROUND OF THE INVENTION

1. Field of the Invention

The present invention relates to a gaming machine and a gaming system, a ticket issuing system that enables participation in a game through insertion of a ticket.

2. Discussion of the Background

Up until now, gaming machines have been known for which tokens or coins are not used, as disclosed in: U.S. Pat. Nos. 4,880,237, 6,012,832, 6,048,269, US 2004/0009816-A1, US 2004/0204215-A1, US 2004/0204231-A1, US 2005/0003883-A1, US 2008/0132336-A1, US 2008/0214310-A1, AU Patent No. 6027394, AU Patent No. 8158198, AU 2000/78904-A, AU 2002/258628-A, AU 2004/0204215-A, and AU 2006/202695-A. Among such gaming machines, gaming machines exist which can execute a game by reading a ticket that can store identification information for identifying the number of credits or a player.

Gaming systems also exist which can have a special game (e.g. a tournament-type game in which players compete against each other) executed in a plurality of gaming machines. Such a gaming system permits a player who has entry to the special game to participate in the special game. That means that a player is required to input in advance the name and the like via an entry terminal installed in a casino in order to participate in the special game. However, this requirement has sometimes led to a situation in which players queue up in front of the entry terminal to gain entry to the special game.

The present invention was made in view of the aforementioned problem, and an object thereof is to provide; a gaming machine and a gaming system, a ticket issuing system with each of which a player wishing to gain entry to the special game can play a game comfortably, and control methods thereof.

Further, the present invention was made in view of the aforementioned problem, and an object thereof is to provide a gaming machine and a gaming system, a ticket issuing system that can prevent players wishing to gain entry to the special game from queuing up; and a control method thereof.

The contents of U.S. Pat. Nos. 4,880,237, 6,012,832, 6,048,269, US 2004/0009816-A1, US 2004/0204215-A1, US 2004/0204231-A1, US 2005/0003883-A1, US 2008/0132336-A1, US 2008/0214310-A1, AU Patent No. 6027394, AU Patent No. 8158198, AU 2000/78904-A, AU 2002/258628-A, AU 2004/0204215-A, and AU 2006/202695-A are incorporated herein by reference in their entirety.

SUMMARY OF THE INVENTION

The present invention provides a ticket issuing system that has the following configuration.

That is, the ticket issuing system comprises: a plurality of ticket issuing devices each including an input device, a ticket issuing terminal from which a ticket can be issued, and a processor; and a plurality of gaming machines, the processor executing the processing of: (A) receiving from the input device a participation input signal that indicates participation in a game played against an other gaming machine; and (B) issuing from the ticket issuing terminal a ticket that enables participation in the game upon being put into any of the gaming machines, when the processor has received the participation input signal in the processing (A).

According to the ticket issuing system, each ticket issuing device issues from the ticket issuing terminal a ticket that enables participation in a game played against another gaming machine upon being put into a gaming machine, when the ticket issuing device has received a participation input signal from the input device.

The ticket issuing system having the plurality of ticket issuing devices can prevent players wishing to obtain a ticket from queuing up. Hence, the system can issue tickets without irritating the players who wish to participate in a game played against another gaming machine.

It is desirable that the ticket issuing system further have the following configuration.

The input device is operable by an operator, and the processing (A) includes receiving from the input device a participation input signal that includes player identification information for identifying a player, the information having been inputted by the operator via the input device.

According to the ticket issuing system, each ticket issuing device issues from the ticket issuing terminal a ticket that enables participation in a game played against another gaming machine upon being put into a gaming machine, when the ticket issuing device has received from the input device a participation input signal that includes player identification information for identifying a player.

A participation input signal including player identification information for identifying a player makes it possible for the ticket issuing device to identify the player to whom the ticket has been issued. For example, storing player identification information makes it possible to manage each player's record, thereby allowing the game parlor to use the information as data for developing business strategies.

It is desirable that the ticket issuing system further have the following configuration.

The input device is a card reader, and the processing (A) includes receiving from the card reader a participation input signal that includes player identification information for identifying a player, the information having been read by the card reader from a card owned by the player.

According to the ticket issuing system, the card reader reads player identification information from a card owned by a player. This makes it possible to issue a ticket quickly without causing discomfort for players.

It is desirable that the ticket issuing system further have the following configuration.

The ticket has printed thereon code information that represents encoded game identification information for identifying a game for which participation is enabled by the ticket.

According to the ticket issuing system, a ticket has printed thereon code information representing encoded game identification information for identifying a game for which participation is enabled by the ticket. Accordingly, for example, a ticket, when being put into a gaming machine, enables participation in a game played against another gaming machine. Such a configuration realizes not only smooth issuance of a ticket but also smooth participation in a game that is played against another gaming machine. As a result, it is possible to let a player play a game in comfort.

The present invention also provides a ticket issuing system that has the following configuration.

That is, the ticket issuing system comprises: a plurality of ticket issuing devices each including an input device, a ticket issuing terminal from which a ticket can be issued, and a processor; and a plurality of gaming machines, the processor executing the processing of: (A) receiving from the input device a participation input signal that indicates participation in a game played against an other gaming machine; and (B) issuing from the ticket issuing terminal a ticket that enables participation in the game upon being put into any of the gaming machines, when the processor has received the participation input signal in the processing (A) and the number of participation-accepted players does not exceed a number-of-players upper limit value, the number of participation-accepted players indicating the number of players who have been accepted to participate in the game, the number-of-players upper limit value indicating an upper limit value of the number of players who can be accepted to participate in the game.

According to the ticket issuing system, each ticket issuing device issues from the ticket issuing terminal a ticket that enables participation in a game played against another gaming machine upon being put into a gaming machine, when the ticket issuing device has received a participation input signal from the input device.

The ticket issuing system having the plurality of ticket issuing devices can prevent players wishing to obtain a ticket from queuing up. Hence, the system can issue tickets without irritating the players who wish to participate in a game played against another gaming machine.

Further, a ticket is issued only when the number of participation-accepted players, which indicates the number of players who have been accepted to participate in the game, does not exceed the number-of-players upper limit value, which indicates the upper limit value of the number of players who can be accepted to participate in the game. This makes it possible to prevent issuance of tickets in number more than the number of players who can be accepted to participate in the game even when the plurality of ticket issuing devices are provided.

The present invention also provides a ticket issuing system that has the following configuration.

That is, the ticket issuing system comprises: a plurality of ticket issuing devices each including an input device, a ticket issuing terminal from which a ticket can be issued, and a processor; a plurality of gaming machines; a server including a control portion and a memory that can store a number-of-players upper limit value and the number of participation-accepted players, the number-of-players upper limit value indicating an upper limit value of the number of players who can be accepted to participate in a game that is played against an other gaming machine, the number of participation-accepted players indicating the number of players who have been accepted to participate in the game; and a network enabling communication between the plurality of ticket issuing devices and the server, wherein the processor executes the processing of: (A) receiving from the input device a participation input signal that indicates participation in the game; and (B) transmitting a participation request signal to the server, when the processor has received the participation input signal in the processing (A), the control portion executes the processing of: (I) determining whether or not the number of participation-accepted players in the memory exceeds the number-of-players upper limit value in the memory, when the control portion has received the participation request signal; and (II) storing into the memory a numeric value obtained by adding 1 to the number of participation-accepted players in the memory as an updated number of participation-accepted players, and also transmitting a ticket issuance permission signal to the ticket issuing device as the transmission source of the received participation request signal, when the control portion has determined in the processing (I) that the number of participation-accepted players does not exceed the number-of-players upper limit value, and the processor executes the processing of (C) issuing from the ticket issuing terminal a ticket that enables participation in the game upon being put into any of the gaming machines, when the processor has received the ticket issuance permission signal.

According to the ticket issuing system, each ticket issuing device transmits to the server a participation request signal, when the ticket issuing device has received a participation input signal from the input device. When the server upon reception of the participation request signal determines that the number of participation-accepted players stored in the memory does not exceed the number-of-players upper limit value in the memory, the server stores into the memory a numeric value obtained by adding 1 to the number of participation-accepted players in the memory as an updated number of participation-accepted players and also transmits a ticket issuance permission signal to the ticket issuing device as the transmission source of the received participation request signal. When the ticket issuing device receives the ticket issuance permission signal, the ticket issuing device issues from the ticket issuing terminal a ticket that enables participation in the game upon being put into a gaming machine.

The ticket issuing system having the plurality of ticket issuing devices can prevent players wishing to obtain a ticket from queuing up. Hence, the system can issue tickets without irritating the players who wish to participate in a game played against another gaming machine.

Further, a ticket is issued only when the number of participation-accepted players, which indicates the number of players who have been accepted to participate in the game, does not exceed the number-of-players upper limit value, which indicates the upper limit value of the number of players who can be accepted to participate in the game. This makes it possible to prevent issuance of tickets in number more than the number of players who can be accepted to participate in the game even when the plurality of ticket issuing devices are provided.

It is desirable that the ticket issuing system further have the following configuration.

The network further enables communication between the plurality of gaming machines and the server, and the control portion executes the processing of: (III) determining the number of the gaming machines on which a game is played, out of the gaming machines connected to the network; and (IIII) determining the number-of-players upper limit value based on the number of the gaming machines determined in the processing (III), and then storing the number-of-players upper limit value into the memory.

According to the ticket issuing system, the number-of-players upper limit value is determined based on the number of gaming machines on which a game is played out of the gaming machines connected to the network. That is, the maximum number of to-be issued tickets changes in accordance with the operational status of the gaming machines. For example, a large number of tickets are issued when the operational status is low, and only a small number of tickets are issued when the operational status is high. This can avoid a situation in which there are players who cannot participate in the game because of existence of no gaming machine on which no game is played even though the players have a ticket.

The present invention further provides a control method of a ticket issuing system which has the following configuration.

That is, the ticket issuing system comprises: a plurality of ticket issuing devices each including an input device, a ticket issuing terminal from which a ticket can be issued, and a processor; and a plurality of gaming machines. Further, the control method comprises the steps of: (A) the processor receiving from the input device a participation input signal that indicates participation in a game played against an other gaming machine; and (B) the processor issuing from the ticket issuing terminal a ticket that enables participation in the game upon being put into any of the gaming machines, when the processor has received the participation input signal in the step (A).

According to the control method of a ticket issuing system, each ticket issuing device issues from the ticket issuing terminal a ticket that enables participation in a game played against another gaming machine upon being put into a gaming machine, when the ticket issuing device has received a participation input signal from the input device.

The ticket issuing system having the plurality of ticket issuing devices can prevent players wishing to obtain a ticket from queuing up. Hence, the system can issue tickets without irritating the players who wish to participate in a game played against another gaming machine.

The present invention further provides a control method of a ticket issuing system which has the following configuration.

That is, the ticket issuing system comprises: a plurality of ticket issuing devices each including an input device, a ticket issuing terminal from which a ticket can be issued, and a processor; and a plurality of gaming machines. Further, the control method comprises the steps of: (A) the processor receiving from the input device a participation input signal that indicates participation in a game played against an other gaming machine; and (B) the processor issuing from the ticket issuing terminal a ticket that enables participation in the game upon being put into any of the gaming machines, when the processor has received the participation input signal in the step (A) and the number of participation-accepted players does not exceed a number-of-players upper limit value, the number of participation-accepted players indicating the number of players who have been accepted to participate in the game, the number-of-players upper limit value indicating an upper limit value of the number of players who can be accepted to participate in the game.

According to the control method of a ticket issuing system, each ticket issuing device issues from the ticket issuing terminal a ticket that enables participation in a game played against another gaming machine upon being put into a gaming machine, when the ticket issuing device has received a participation input signal from the input device.

The ticket issuing system having the plurality of ticket issuing devices can prevent players wishing to obtain a ticket from queuing up. Hence, the system can issue tickets without irritating the players who wish to participate in a game played against another gaming machine.

Further, a ticket is issued only when the number of participation-accepted players, which indicates the number of players who have been accepted to participate in the game, does not exceed the number-of-players upper limit value, which indicates the upper limit value of the number of players who can be accepted to participate in the game. This makes it possible to prevent issuance of tickets in number more than the number of players who can be accepted to participate in the game even when the plurality of ticket issuing devices are provided.

The present invention further provides a control method of a ticket issuing system which has the following configuration.

That is, the ticket issuing system comprises: a plurality of ticket issuing devices each including an input device, a ticket issuing terminal from which a ticket can be issued, and a processor; a plurality of gaming machines; a server including a control portion and a memory that can store a number-of-players upper limit value and the number of participation-accepted players, the number-of-players upper limit value indicating the upper limit value of the number of players who can be accepted to participate in a game played against another gaming machine, the number of participation-accepted players indicating the number of players who have been accepted to participate in the game; and a network enabling communication between the plurality of ticket issuing devices and the server. Further, the control method comprises the steps of: (A) the processor receiving from the input device a participation input signal that indicates participation in the game; (B) the processor transmitting a participation request signal to the server, when the processor has received the participation input signal in the step (A); (I) the control portion determining whether or not the number of participation-accepted players in the memory exceeds the number-of-players upper limit value in the memory, when the control portion has received the participation request signal; (II) the control portion storing into the memory a numeric value obtained by adding 1 to the number of participation-accepted players in the memory as an updated number of participation-accepted players, and also transmitting a ticket issuance permission signal to the ticket issuing device as the transmission source of the received participation request signal, when the control portion has determined in the step (I) that the number of participation-accepted players does not exceed the number-of-players upper limit value; and (C) the processor issuing from the ticket issuing terminal a ticket that enables participation in the game upon being put into any of the gaming machines, when the processor has received the ticket issuance permission signal.

According to the control method of a ticket issuing system, each ticket issuing device transmits to the server a participation request signal, when the ticket issuing device has received a participation input signal from the input device. When the server upon reception of the participation request signal determines that the number of participation-accepted players stored in the memory does not exceed the number-of-players upper limit value in the memory, the server stores into the memory a numeric value obtained by adding 1 to the number of participation-accepted players in the memory as an updated number of participation-accepted players and also transmits a ticket issuance permission signal to the ticket issuing device as the transmission source of the received participation request signal. When the ticket issuing device receives the ticket issuance permission signal, the ticket issuing device issues from the ticket issuing terminal a ticket that enables participation in the game upon being put into a gaming machine.

The ticket issuing system having the plurality of ticket issuing devices can prevent players wishing to obtain a ticket from queuing up. Hence, the system can issue tickets without irritating the players who wish to participate in a game played against another gaming machine.

Further, a ticket is issued only when the number of participation-accepted players, which indicates the number of players who have been accepted to participate in the game, does not exceed the number-of-players upper limit value, which indicates the upper limit value of the number of players who can be accepted to participate in the game. This makes it possible to prevent issuance of tickets in number more than the number of players who can be accepted to participate in the game even when the plurality of ticket issuing devices are provided.

The present invention provides a ticket issuing system that has the following configuration.

That is, the gaming machine comprises: a ticket reader; and a controller, the controller programmed to execute the processing of (a) executing a game played against an other gaming machine, when the ticket reader has read a ticket issued from a ticket issuing terminal.

According to the gaming machine, a game played against another gaming machine is executed, when the ticket reader has read a ticket issued from the ticket issuing terminal.

A player having received a ticket therefore can participate in a game played against another gaming machine smoothly by having the ticket read by the ticket reader provided in the gaming machine. As a result, the player is allowed to play games comfortably.

In a case where a plurality of ticket issuing terminal are provided, issuance of a ticket is conducted also smoothly, and therefore, the player is allowed to play games more comfortably.

The present invention provides a gaming system that has the following configuration.

That is, the gaming system comprises: a ticket issuing device provided with a ticket issuing terminal from which a ticket can be issued, and a processor; and a plurality of gaming machines each provided with a ticket reader and a controller; the processor programmed to execute the processing of (A) issuing from the ticket issuing terminal a ticket to be read by the ticket reader provided in the gaming machine so as to enable participation in a game played against an other gaming machine, and the controller programmed to execute the processing of (a) executing the game played against an other gaming machine participating in that game, when the ticket reader has read the ticket issued in the processing (A).

According to the gaming system, the ticket issuing device issues from the ticket issuing terminal a ticket to be read by the ticket reader provided in the gaming machine so as to enable participation in a game played against another gaming machine. Each gaming machine executes a game played against another gaming machine participating in that game, when the ticket reader has read the ticket issued by the ticket issuing terminal.

Accordingly, a player having received a ticket therefore can participate in a game played against another gaming machine smoothly by having the ticket read by the ticket reader provided in the gaming machine. As a result, the player is allowed to play games comfortably.

In a case where a plurality of ticket issuing terminals are provided, issuance of a ticket is conducted also smoothly, and therefore, the player is allowed to play games more comfortably.

It is desirable that the gaming system further have the following configuration.

That is, according to the gaming system, the game comprises a plurality of unit games respectively played by a plurality of game groups each comprising two or more gaming machines, and the processing (a) includes: (a-1) identifying a game group to which the gaming machine is belonging, when the ticket reader has read the ticket issued in the processing (A); and (a-2) executing a unit game played against an other gaming machine included in the game group which has been identified in the processing (a-1).

A game played against another gaming machine comprises a plurality of unit games respectively palyed by a plurality of game groups each including two or more gaming machines. When the ticket reader has read a ticket issued from the ticket issuing device, the game group to which the gaming machine is belonging is identified and a unit game played against another gaming machine included in the identified game group is executed.

The game played against another gaming machine is executed for a plurality of game groups respectively. Therefore, the player is more likely to see clearly the competing gaming machine, which may stir up the player's fighting spirit.

The present invention provides a gaming system that has the following configuration.

The gaming system comprises a plurality of gaming machines each provided with a ticket reader and a controller, the controller programmed to execute the processing of: (a) identifying a game in which the gaming machine is to participate, out of a plurality of games, when the ticket reader has read a ticket issued from a ticket issuing terminal; and (b) executing the game identified in the processing (a), which is played against an other gaming machine participating in that game.

According to the gaming system, when the ticket reader has read a ticket issued from the ticket issuing terminal, the gaming machine identifies a game in which the gaming machine is to participate, out of a plurality of games. Then, the gaming machine executes the game played against another gaming machine participating in that game.

Since the game in which the gaming machine is to participate is identified out of a plurality of games, it is possible to excite the player about knowing which gaming machine is going to participate in the same game.

The present invention also provides a gaming system that has the following configuration.

That is, the gaming system comprises: a plurality of gaming machines each provided with a ticket reader and a controller; and a server provided with a control portion, the controller programmed to execute the processing of (a) transmitting a game participation signal to the server, when the ticket reader has read a ticket issued from a ticket issuing terminal, the control portion programmed to execute the processing of: (I) determining, when the game participation signal has been received, a game in which the gaming machine as the transmission source of that game participation signal is to participate, out of a plurality of games; and (II) transmitting participation determined game information for identifying the game determined in the processing (I), to the gaming machine as the transmission source of the game participation signal, and the controller programmed to execute the processing of (b) executing the game which is played against an other gaming machine participating in that game identified by the participation determined game information having been received.

According to the gaming system, when the ticket reader has read a ticket issued from the ticket issuing terminal, the gaming machine transmits a game participation signal to the server. When the game participation signal has been received, the server determines a game in which the gaming machine as the transmission source of the game participation signal is to participate, out of a plurality of games. The server then transmits participation determined game information for identifying the determined game, to the gaming machine as the transmission source of the game participation signal. Then, the gaming machine executes the game played against another gaming machine participating in that game identified by the participation determined game information having been received.

Since the server identifies the game in which the gaming machine is to participate out of a plurality of gaming machines, it is possible to excite the player about knowing which gaming machine is going to participate in the same game.

It is desirable that the gaming system further have the following configuration.

According to the gaming system, the processing (I) includes determining, when receiving the game participation signal, a game in which the gaming machine as the transmission source of that game participation signal is to participate, out of a plurality of games, based on the number of the game participation signals received during predetermined time.

According to the gaming system, when a game participation signal has been received, a game in which the gaming machine as the transmission source of the game participation signal is to participate is determined out of a plurality of games, based on the number of game participation signals received during predetermined time.

Accordingly, it is possible to unbalance or balance the number of participants in respective games so as to vary the number of participants according to the game. As a result, the player is less likely to get bored.

The present invention also provides a control method of a gaming machine, the control method which has the following configuration.

That is, the gaming machine comprises a ticket reader and a controller, and the control method comprises the step of (a) executing a game played against an other gaming machine, when the ticket reader has read a ticket issued from a ticket issuing terminal.

According to the control method of a gaming machine, when the ticket reader has read a ticket issued from the ticket issuing terminal, a game played against another gaming machine is executed. Accordingly, a player having received a ticket can participate in a game played against another gaming machine smoothly by having the ticket read by the ticket reader provided in the gaming machine. As a result, the player is allowed to play games comfortably.

In a case where a plurality of ticket issuing terminals are provided, issuance of a ticket is conducted also smoothly, and therefore, the player is allowed to play games more comfortably.

The present invention further provides a control method of a gaming system which has the following configuration.

That is, the gaming system comprises: a ticket issuing device provided with a ticket issuing terminal from which a ticket can be issued, and a processor; and a plurality of gaming machines each provided with a ticket reader and a controller, and the control method comprises the steps of: (A) the processor issuing from the ticket issuing terminal a ticket to be read by the ticket reader provided in the gaming machine so as to enable participation in a game played against an other gaming machine; and (a) the controller executing a game played against an other gaming machine participating in that game, when the ticket reader has read the ticket issued in the step (A).

According to the control method of a gaming machine, the ticket issuing device issues from the ticket issuing terminal a ticket to be read by the ticket reader so as to enable participation in a game played against another gaming machine. Each gaming machine executes a game played against another gaming machine participating in that game, when the ticket reader has read a ticket issued from the ticket issuing terminal.

Accordingly, a player having received a ticket can participate in a game played against another gaming machine smoothly by having the ticket read by the ticket reader provided in the gaming machine. As a result, the player is allowed to play games comfortably.

In a case where a plurality of ticket issuing terminals are provided, issuance of a ticket is conducted also smoothly, and therefore, the player is allowed to play games more comfortably.

The present invention further provides a control method of a gaming system which has the following configuration.

That is, the gaming system comprises a plurality of gaming machines each provided with a ticket reader and a controller, and the control method comprises the steps of: (a) the controller identifying a game in which the gaming machine is to participate, out of a plurality of games, when the ticket reader has read a ticket issued from a ticket issuing terminal; and (b) the controller executing the game identified in the step (a), which is played against an other gaming machine participating in that game.

According to the control method of a gaming system, the gaming machine identifies a game in which the gaming machine is to participate, out of a plurality of games, when the ticket reader has read a ticket issued from the ticket issuing terminal. Then, the gaming machine executes the identified game, which is played against another gaming machine participating in that game.

Since the server identifies the game in which the gaming machine is to participate out of a plurality of gaming machines, it is possible to excite the player about knowing which gaming machine is going to participate in the same game.

The present invention further provides a control method of a ticket issuing system which has the following configuration.

That is, the gaming system comprises: a plurality of gaming machines each provided with a ticket reader and a controller; and a server provided with a control portion, and the control method comprising the steps of: (a) the controller transmitting a game participation signal to the server, when the ticket reader has read a ticket issued from a ticket issuing terminal; (I) the control portion determining, when the game participation signal has been received, a game in which the gaming machine as the transmission source of that game participation signal is to participate, out of a plurality of games; (II) the control portion transmitting participation determined game information for identifying the game determined in the step (I), to the gaming machine as the transmission source of the game participation signal; and (b) the controller executing the game played against an other gaming machine participating in that game identified by the participation determined game information having been received.

According to the control method of a gaming system, the gaming machine transmits a game participation signal to the server, when the ticket reader has read a ticket issued from the ticket issuing terminal. Upon receipt of the game participation signal, the server determines a game in which the gaming machine as the transmission source of the game participation signal is to participate, out of a plurality of games, and transmits participation determined game information for identifying the determined game, to the gaming machine as the transmission source of the game participation signal. Then, the gaming machine executes the game played against another gaming machine participating in that game identified by the participation determined game information having been received.

Since the server identifies the game in which the gaming machine is to participate out of a plurality of gaming machines, it is possible to excite the player about knowing which gaming machine is going to participate in the same game.

The present invention provides a gaming machine that has the following configuration.

That is, the gaming machine comprises: a ticket reader; a recording medium issuing device from which a recording medium can be issued; and a controller, the controller programmed to execute the processing of: (a) executing a game played against an other gaming machine, when the ticket reader has read a ticket issued from a ticket issuing terminal provided in a place other than an inside of the gaming machine; and (b) issuing from the recording medium issuing device a recording medium on which a result of the game executed in the processing (a) is printed.

The gaming machine executes a game played against another gaming machine, when the ticket reader has read a ticket issued from the ticket issuing terminal. Accordingly, a player having received a ticket can participate in the game played against another gaming machine smoothly by having the ticket read by the ticket reader provided in the gaming machine. As a result, the player is allowed to play games comfortably.

In a case where a plurality of ticket issuing terminals are provided, issuance of a ticket is conducted also smoothly, and therefore, the player is allowed to play games more comfortably.

A recording medium on which the result of the game is printed is issued from the recording medium issuing device.

Accordingly, the player can take out the recording medium on which the result of the game is printed.

The unfavorable result printed thereon may motivate the player to achieve the better result in the game.

On the other hand, the favorable result printed thereon may have the player wish to participate in the game again.

It is desirable that the gaming machine further have the following configuration.

The processing (a) includes executing a game played against an other gaming machine, when the ticket reader has read a ticket issued from the ticket issuing terminal provided in a place other than the inside of the gaming machine or a recording medium issued from the recording medium issuing device.

The game played against another gaming machine is executed, not only in a case where the ticket reader has read a ticket issued from the ticket issuing terminal provided in a place other than the inside of the gaming machine, but also in a case where the ticket reader has read a recording medium issued from the recording medium issuing device.

That is, a ticket (recording medium) can be issued not only from the ticket issuing terminal, but also from the gaming machine, and therefore, issuance of a ticket can be conducted more smoothly.

In a case where a ticket (recording medium) is issued from the gaming machine, the player can participate in the game played against another gaming machine on the gaming machine from which the ticket (recording medium) has been issued, without moving. Accordingly, the player is not required to move to the ticket issuing terminal and is allowed to participate in the game played against another gaming machine more smoothly. As a result, the player is allowed to play games comfortably.

It is desirable that the gaming machine further have the following configuration.

The processing (b) includes issuing from the recording medium issuing device a recording medium on which a score obtained by a player playing a game on that gaming machine in the game executed in the processing (a) is printed.

A recording medium on which the score obtained in the game is printed is issued from the recording medium issuing device. Accordingly, the player can take out the recording medium on which the score obtained in the game is printed.

Since the score, the absolute evaluation, is printed thereon, the player can see their improvement in the game by comparing the score with the previous one.

It is desirable that the gaming machine further have the following configuration.

The processing (b) includes issuing from the recording medium issuing device a recording medium on which a rank of a player playing a game on that gaming machine in the game executed in the processing (a) is printed.

A recording medium on which a rank in the game is printed is issued from the recording medium issuing device. Accordingly, the player can take out the recording medium on which the rank in the game is printed.

Since the rank, the relative evaluation, is printed thereon, the player can see the change in the level of the players participating in the game by comparing the rank with the previous one.

It is desirable that the gaming machine further have the following configuration.

The gaming machine further comprises a selection input device with which a selection can be made from a plurality of choices, the controller is further programmed to execute the processing of (c) prompting, after executing the processing (a), a selection of whether or not to issue from the recording medium issuing device a recording medium on which the result of the game executed in the processing (a) is printed, and the processing (b) includes issuing from the recording medium issuing device a recording medium on which the result of the game executed in the processing (a) is printed, on receiving from the selection input device a selection input signal indicating that the recording medium is to be issued from the recording medium issuing device.

After executing the game, the gaming machine prompts a selection of whether or not to issue from the recording medium issuing device a recording medium on which the result of the game is printed. When receiving from the selection input device a selection input signal indicating that the recording medium is to be issued from the recording medium issuing device, the gaming machine issues from the recording medium issuing device the recording medium on which the result of the game is printed.

That is, the player is allowed to select whether or not to print out the result of the game.

Accordingly, the result of the game is not printed out to the player who does not wish to have it, and therefore, it is possible to prevent the player from feeling uncomfortable.

The present invention also provides a gaming machine that has the following configuration.

That is, the gaming machine comprises a ticket reader; a recording medium issuing device from which a recording medium can be issued; a selection input device with which a selection can be made from a plurality of choices; and a controller, the controller programmed to execute the processing of: (a) executing a game played against an other gaming machine, when the ticket reader has read a ticket issued from a ticket issuing terminal provided in a place other than an inside of the gaming machine; (b) prompting, after executing the processing (a), a selection of whether or not to print on a recording medium information based on a past game result; and (c) issuing from the recording medium issuing device a recording medium on which the information based on the past game result is printed, on receiving from the selection input device a print selection input signal indicating that the information based on the past game result is to be printed on a recording medium.

The gaming machine prompts a selection of whether or not to print information based on the past game result on the recording medium, after executing the game. On receiving from the selection input device a print selection input signal indicating that the information based on the past game result is to be printed on the recording medium, the gaming machine issues from the recording medium issuing device the recording medium on which the information based on the past game result is printed.

That is, a player is allowed to select whether or not to print out the information based on the past game result. Accordingly, the information based on the past game result is not printed out to the player who does not wish to have it, and therefore, it is possible to prevent the player from feeling uncomfortable.

Since the information based on the past game result is printed out, the player can easily see their improvement in the game.

It is desirable that the gaming machine further have the following configuration.

The gaming machine further comprises an image display to which an image can be displayed, the processing (a) includes: (a-1) reading identification information of a player from a ticket, when the ticket read by the ticket reader is a ticket issued from a ticket issuing terminal provided in a place other than the inside of the gaming machine; and (a-2) executing a game played against an other gaming machine after executing the processing (a-1), the controller further programmed to execute the processing of (d) displaying to the image display an image prompting a selection of a single or plurality of game histories from a plurality of game histories associated with identification information same as the identification information read in the processing (a-1), on receiving from the selection input device a print selection input signal indicating that the information based on the past game result is to be printed on a recording medium, and the processing (c) includes issuing from the recording medium issuing device a recording medium on which information based on the game history specified by a game history selection input signal for specifying the game history is printed, on receiving from the selection input device the game history selection signal.

When the ticket reader has read a ticket issued from the ticket issuing terminal provided in a place other than the inside of the gaming machine, the gaming machine reads out identification information of the player from that ticket. On receiving from the selection input device a print selection input signal indicating that the information based on the past game result is to be printed on the recording medium, the gaming machine displays to the image display an image prompting a selection of a single or plurality of game histories from a plurality of game histories associated with the identification information same as the read identification information. On receiving from the selection input device a game history selection input signal specifying the game history, the gaming machine issues from the recording medium issuing device the recording medium on which information based on the game history specified by the game history selection input signal is printed. That is, it is possible to select a single or plurality of game histories to be printed on the recording medium, from game histories associated with the identification information same as the identification information of the player playing a game on the gaming machine. Accordingly, for example, it is possible to print on the recording medium information based only on the good game histories in the past, which enables printing of information in a manner that meets the player' s various needs on the recording medium.

The present invention further provides a gaming machine that has the following configuration.

That is, the gaming system comprises: a ticket issuing device provided with a ticket issuing terminal from which a ticket can be issued, and a processor; and a plurality of gaming machines each provided with a ticket reader, a recording medium issuing device from which a recording medium can be issued, and a controller, the processor programmed to execute the processing of (A) issuing from the ticket issuing terminal a ticket to be read by any of the ticket reader provided in the respective gaming machines so as to enable participation in a game played against an other gaming machine, and the controller programmed to execute the processing of: (a) executing the game played against an other gaming machine, when the ticket reader has read the ticket issued in the processing (A); and (b) issuing from the recording medium issuing device a recording medium on which a result of the game executed in the processing (a) is printed.

According to the gaming system, the gaming machine executes a game played against another gaming machine, when the ticket reader has read a ticket issued from the ticket issuing terminal. Accordingly, a player having received a ticket can participate in the game played against another gaming machine smoothly by having the ticket read by the ticket reader provided in the gaming machine. As a result, the player is allowed to play games comfortably.

In a case where a plurality of ticket issuing terminals are provided, issuance of a ticket is conducted also smoothly, and therefore, the player is allowed to play games more comfortably.

A recording medium on which the result of the game is printed is issued from the recording medium issuing device.

Accordingly, the player can take out the recording medium on which the result of the game is printed.

The unfavorable result printed thereon may motivate the player to achieve the better result in the game.

On the other hand, the favorable result printed thereon may have the player wish to participate in the game again.

The present invention further provides a gaming system that has the following configuration.

That is, the gaming system comprises: a ticket issuing device provided with a ticket issuing terminal from which a ticket can be issued, and a processor; and a plurality of gaming machines each provided with a ticket reader, a recording medium issuing device from which a recording medium can be issued, a selection input device with which a selection can be made from a plurality of choices, and a controller, the processor programmed to execute the processing of (A) issuing from the ticket issuing terminal a ticket to be read by the ticket reader provided in the gaming machine so as to enable participation in a game played against an other gaming machine, and the controller programmed to execute the processing of: (a) executing the game played against an other gaming machine, when the ticket reader has read the ticket issued in the processing (A); (b) prompting, after executing the processing (a), a selection of whether or not to print information based on a past game result on a recording medium; and (c) issuing from the recording medium issuing device a recording medium on which the information based on the past game result is printed, on receiving from the selection input device a print selection input signal indicating that the information based on the past game result is to be printed on a recording medium.

The gaming machine prompts a selection of whether or not to print information based on the past game result on the recording medium, after executing the game. On receiving from the selection input device a print selection input signal indicating that the information based on the past game result is to be printed on the recording medium, the gaming machine issues from the recording medium issuing device the recording medium on which the information based on the past game result is printed.

That is, a player is allowed to select whether or not to print out the information based on the past game result. Accordingly, the information based on the past game result is not printed out to the player who does not wish to have it, and therefore, it is possible to prevent the player from feeling uncomfortable.

Since the information based on the past game result is printed out, the player can easily see their improvement in the game.

The present invention further provides a control method of a gaming machine which has the following configuration.

That is, the gaming machine comprises: a ticket reader, a recording medium issuing device from which a recording medium can be issued, and a controller, the control method comprising the steps of: (a) executing a game played against an other gaming machine, when the ticket reader has read a ticket issued from a ticket issuing terminal provided in a place other than an inside of the gaming machine; and (b) issuing from the recording medium issuing device a recording medium on which a result of the game executed in the step (a) is printed.

According to the control method of a gaming machine, a game played against another gaming machine is executed, when the ticket reader has read a ticket issued from the ticket issuing terminal. Accordingly, a player having received a ticket can participate in the game played against another gaming machine smoothly by having the ticket read by the ticket reader provided in the gaming machine. As a result, the player is allowed to play games comfortably.

In a case where a plurality of ticket issuing terminals are provided, issuance of a ticket is conducted also smoothly, and therefore, the player is allowed to play games more comfortably.

A recording medium on which the result of the game is printed is issued from the recording medium issuing device.

Accordingly, the player can take out the recording medium on which the result of the game is printed.

The unfavorable result printed thereon may motivate the player to achieve the better result in the game.

On the other hand, the favorable result printed thereon may have the player wish to participate in the game again.

The present invention further provides a control method of a gaming machine which has the following configuration.

That is, the gaming machine comprises: a ticket reader, a recording medium issuing device from which a recording medium can be issued, a selection input device with which a selection can be made from a plurality of choices, and a controller, the control method comprising the steps of: (a) executing a game played against an other gaming machine, when the ticket reader has read a ticket issued from a ticket issuing terminal provided in a place other than an inside of the gaming machine; (b) prompting, after executing the step (a), a selection of whether or not to print information based on a past game result on a recording medium; and (c) issuing from the recording medium issuing device a recording medium on which the information based on the past game result is printed, on receiving from the selection input device a print selection input signal indicating that the information based on the past game result is to be printed on a recording medium.

According to the control method of a gaming machine, the gaming machine prompts a selection of whether or not to print information based on the past game result on the recording medium, after executing the game. On receiving from the selection input device a print selection input signal indicating that the information based on the past game result is to be printed on the recording medium, the gaming machine issues from the recording medium issuing device the recording medium on which the information based on the past game result is printed.

That is, a player is allowed to select whether or not to print out the information based on the past game result. Accordingly, the information based on the past game result is not printed out to the player who does not wish to have it, and therefore, it is possible to prevent the player from feeling uncomfortable.

Since the information based on the past game result is printed out, the player can easily see their improvement in the game.

The present invention further provides a control method of a gaming system which has the following configuration.

That is, the gaming system comprises: a ticket issuing device provided with a ticket issuing terminal from which a ticket can be issued, and a processor; and a plurality of gaming machines each provided with a ticket reader, a recording medium issuing device from which a recording medium can be issued, and a controller, the control method comprising the steps of: (A) the processor issuing from the ticket issuing terminal a ticket to be read by any of the ticket reader provided in the respective gaming machines so as to enable participation in a game played against an other gaming machine; (a) the controller executing the game played against an other gaming machine, when the ticket reader has read the ticket issued in the step (A); and (b) the controller issuing from the recording medium issuing device a recording medium on which a result of the game executed in the step (a) is printed.

According to the control method of a gaming system, the gaming machine executes a game played against another gaming machine, when the ticket reader has read a ticket issued from the ticket issuing terminal. Accordingly, a player having received a ticket can participate in the game played against another gaming machine smoothly by having the ticket read by the ticket reader provided in the gaming machine. As a result, the player is allowed to play games comfortably.

In a case where a plurality of ticket issuing terminals are provided, issuance of a ticket is conducted also smoothly, and therefore, the player is allowed to play games more comfortably.

A recording medium on which the result of the game is printed is issued from the recording medium issuing device.

Accordingly, the player can take out the recording medium on which the result of the game is printed.

The unfavorable result printed thereon may motivate the player to achieve the better result in the game.

On the other hand, the favorable result printed thereon may have the player wish to participate in the game again.

The present invention further provides a control method of a gaming system which has the following configuration.

That is, the gaming system comprises: a ticket issuing device provided with a ticket issuing terminal from which a ticket can be issued, and a processor; and a plurality of gaming machines each provided with a ticket reader, a recording medium issuing device from which a recording medium can be issued, a selection input device with which a selection can be made from a plurality of choices, and a controller, the control method comprising the steps of: (A) the processor issuing from the ticket issuing terminal a ticket to be read by any of the ticket reader provided in the respective gaming machines so as to enable participation in a game played against an other gaming machine; (a) the controller executing the game played against an other gaming machine when the ticket reader has read the ticket issued in the step (A); (b) the controller prompting, after executing the step (a), a selection of whether or not to print information based on a past game result on a recording medium; and (c) the controller issuing from the recording medium issuing device a recording medium on which the information based on the past game result is printed, on receiving from the selection input device a print selection input signal indicating that the information based on the past game result is to be printed on a recording medium.

According to the control method of a gaming system, the gaming machine prompts a selection of whether or not to print information based on the past game result on the recording medium, after executing the game. On receiving from the selection input device a print selection input signal indicating that the information based on the past game result is to be printed on the recording medium, the gaming machine issues from the recording medium issuing device the recording medium on which the information based on the past game result is printed.

That is, a player is allowed to select whether or not to print out the information based on the past game result. Accordingly, the information based on the past game result is not printed out to the player who does not wish to have it, and therefore, it is possible to prevent the player from feeling uncomfortable.

Since the information based on the past game result is printed out, the player can easily see their improvement in the game.

The present invention provides a ticket issuing system that has the following configuration.

That is, the ticket issuing system comprises: a plurality of ticket issuing devices each including a processor, an input device with which an operator can input a command, and a ticket issuing terminal from which a ticket can be issued; a plurality of gaming machines connected by a network; and a storage device storing game result information that shows a result of a game played on any of the gaming machines, in association with player identification information for identifying a player. The processor executes the processing of: (A) identifying one piece of the player identification information out of pieces of the player identification information stored in the storage device, based on an input from the input device; (B) determining whether or not a piece of the game result information associated with the one piece of the player identification information identified in the processing (A) satisfies a given condition; and (C) issuing from the ticket issuing terminal a participation ticket that enables participation in a special game upon being put into any of the gaming machines, when the processor determines in the processing (B) that the piece of the game result information satisfies the given condition, the special game being a game in which winning or losing is determined based on a result of a game played on the plurality of gaming machines.

According to the ticket issuing system, the storage device stores the game result information (e.g. a ranking of a preliminary round of a tournament-type game) that shows the result of a game played on a gaming machine, in association with the player identification information (e.g. the name of a player) for identifying the player. The processor provided in each ticket issuing device identifies one piece of the player identification information out of the pieces of the player identification information stored in the storage device, based on an input from the input device (e.g. keyboard) that is provided in the ticket issuing device. The processor also determines whether or not a piece of the game result information associated with the identified one piece of the player identification information satisfies a given condition (e.g. taking the first place). When determining that the piece of the game result information satisfies the given condition, the processor issues from the ticket issuing terminal a participation ticket that enables participation in a special game (e.g. the final round of the tournament-type game) upon being put into a gaming machine. In the special game, winning or losing is determined based on the result of a game played on the plurality of gaming machines.

A participation ticket is not issued to every player, but is issued only to a player whose game result information (the result of a game played on a gaming machine in the past) stored in the storage device satisfies the given condition. Accordingly, it is possible to give a player a sense of superiority when a participation ticket is issued to the player, and further entertain the player with the game. In addition, with regard to a player whose game result information does not satisfy the given condition, it is possible to motivate the player for issuance of a participation ticket, that is, for getting a game result that satisfies the given condition, and thereby it is possible to get the player engrossed in the game.

Further, since being provided with the plurality of ticket issuing devices, the ticket issuing system can simultaneously execute issuance of participation tickets from the plurality of devices. Therefore, it is possible to avoid a situation in which issuance of a participation ticket takes long time, and thus to smoothly start the special game.

The present invention further provides a ticket issuing system having the following configuration.

That is, the ticket issuing system comprises: a plurality of ticket issuing devices each including a processor, an input device with which an operator can input a command, and a ticket issuing terminal from which a ticket can be issued; a plurality of gaming machines connected by a network; and a storage device storing number-of-games data that shows the number of times a normal game has been played on any of the gaming machines, in association with player identification information for identifying a player. The processor executes the processing of: (A) identifying one piece of the player identification information out of pieces of the player identification information stored in the storage device, based on an input from the input device; (B) determining whether or not the number of games shown by a piece of the number-of-games data associated with the one piece of the player identification information identified in the processing (A) is equal to or larger than a predetermined number of times; and (C) issuing from the ticket issuing terminal a participation ticket that enables participation in a special game upon being put into any of the gaming machines, when the processor determines in the processing (B) that the number of games is equal to or larger than the predetermined number of times, the special game being a game in which winning or losing is determined based on a result of a game played on the plurality of gaming machines.

According to the ticket issuing system, the storage device stores the number-of-games data that shows the number of times the normal game has been played on a gaming machine, in association with the player identification information for identifying the player. The processor provided in each ticket issuing device identifies one piece of the player identification information out of the pieces of the player identification information stored in the storage device, based on an input from the input device that is provided in the ticket issuing device. The processor also determines whether or not the number of games shown by a piece of the number-of-games data associated with the identified one piece of the player identification information is equal to or larger than the predetermined number of times (e.g. 100 times). When determining that the number of games is equal to or larger than the predetermined number of times, the processor issues from the ticket issuing terminal a participation ticket that enables participation in a special game (e.g. the final round of the tournament-type game) in which winning or losing is determined based on the result of a game played on the plurality of gaming machines.

A participation ticket is not issued to every player, but is issued only to a player whose number of games shown by the piece of number-of-games data is equal to or larger than the predetermined number of times. Accordingly, it is possible to give a player a sense of superiority when a participation ticket is issued to the player, and further entertain the player with the game. In addition, with regard to a player whose game result information does not satisfy the given condition, it is possible to motivate the player for issuance of a participation ticket, that is, for making the number of games be equal to or larger than the predetermined number of times, and thereby it is possible to get the player engrossed in the game.

Further, since being provided with the plurality of ticket issuing devices, the ticket issuing system can simultaneously execute issuance of participation tickets from the plurality of devices. Therefore, it is possible to avoid a situation in which issuance of a participation ticket takes long time, and thus to smoothly start the special game.

The present invention further provides a control method of a ticket issuing system which has the following configuration.

That is, the ticket issuing system controlled by the control method of a ticket issuing system comprises: a plurality of ticket issuing devices each including a processor, an input device with which an operator can input a command, and a ticket issuing terminal from which a ticket can be issued; a plurality of gaming machines; and a storage device storing game result information that shows a result of a game played on any of the gaming machines, in association with player identification information for identifying a player. The control method comprises the steps of: (A) the processor identifying one piece of the player identification information out of pieces of the player identification information stored in the storage device, based on an input from the input device; (B) the processor determining whether or not a piece of the game result information associated with the one piece of the player identification information identified in the step (A) satisfies a given condition; and (C) the processor issuing from the ticket issuing terminal a participation ticket that enables participation in a special game upon being put into any of the gaming machines, when the processor determines in the step (B) that the piece of the game result information satisfies the given condition, the special game being a game in which winning or losing is determined based on a result of a game played on the plurality of gaming machines.

According to the control method of a ticket issuing system, the storage device stores the game result information (e.g. a ranking of a preliminary round of a tournament-type game) that shows the result of a game played on a gaming machine, in association with the player identification information (e.g. the name of a player) for identifying the player. The processor provided in each ticket issuing device identifies one piece of the player identification information out of the pieces of the player identification information stored in the storage device, based on an input from the input device (e.g. keyboard) that is provided in the ticket issuing device. The processor also determines whether or not a piece of the game result information associated with the identified one piece of the player identification information satisfies a given condition (e.g. taking the first place). When determining that the piece of the game result information satisfies the given condition, the processor issues from the ticket issuing terminal a participation ticket that enables participation in a special game (e.g. the final round of the tournament-type game) upon being put into a gaming machine. In the special game, winning or losing is determined based on the result of a game played on the plurality of gaming machines.

A participation ticket is not issued to every player, but is issued only to a player whose game result information (the result of a game played on a gaming machine in the past) stored in the storage device satisfies the given condition. Accordingly, it is possible to give a player a sense of superiority when a participation ticket is issued to the player, and further entertain the player with the game. In addition, with regard to a player whose game result information does not satisfy the given condition, it is possible to motivate the player for issuance of a participation ticket, that is, for getting a game result that satisfies the given condition, and thereby it is possible to get the player engrossed in the game.

Further, since the control method of a ticket issuing system is a control method for a ticket issuing system that is provided with the plurality of ticket issuing devices, it is possible to simultaneously execute issuance of participation tickets from the plurality of devices. Therefore, it is possible to avoid a situation in which issuance of a participation ticket takes longtime, and thus to smoothly start the special game.

The present invention further provides a control method of a ticket issuing system which has the following configuration.

That is, the ticket issuing system controlled by the control method of a ticket issuing system comprises: a plurality of ticket issuing devices each including a processor, an input device with which an operator can input a command, and a ticket issuing terminal from which a ticket can be issued; a plurality of gaming machines; and a storage device storing number-of-games data that shows the number of times a normal game has been played on any of the gaming machines, in association with player identification information for identifying a player. The control method comprises the steps of: (A) the processor identifying one piece of the player identification information out of pieces of the player identification information stored in the storage device, based on an input from the input device; (B) the processor determining whether or not the number of games shown by a piece of the number-of-games data associated with the one piece of the player identification information identified in the step (A) is equal to or larger than a predetermined number of times; and (C) the processor issuing from the ticket issuing terminal a participation ticket that enables participation in a special game upon being put into any of the gaming machines, when the processor determines in the step (B) that the number of games is equal to or larger than the predetermined number of times, the special game being a game in which winning or losing is determined based on a result of a game played on the plurality of gaming machines.

According to the control method of a ticket issuing system, the storage device stores the number-of-games data that shows the number of times the normal game has been played on a gaming machine, in association with the player identification information for identifying the player. The processor provided in each ticket issuing device identifies one piece of the player identification information out of the pieces of the player identification information stored in the storage device, based on an input from the input device that is provided in the ticket issuing device. The processor also determines whether or not the number of games shown by a piece of the number-of-games data associated with the identified one piece of the player identification information is equal to or larger than the predetermined number of times (e.g. 100 times). When determining that the number of games is equal to or larger than the predetermined number of times, the processor issues from the ticket issuing terminal a participation ticket that enables participation in a special game (e.g. the final round of the tournament-type game) in which winning or losing is determined based on the result of a game played on the plurality of gaming machines.

A participation ticket is not issued to every player, but is issued only to a player whose number of games shown by the piece of number-of-games data is equal to or larger than the predetermined number of times. Accordingly, it is possible to give a player a sense of superiority when a participation ticket is issued to the player, and further entertain the player with the game. In addition, with regard to a player whose game result information does not satisfy the given condition, it is possible to motivate the player for issuance of a participation ticket, that is, for making the number of games be equal to or larger than the predetermined number of times, and thereby it is possible to get the player engrossed in the game.

Further, since the control method of a ticket issuing system is a control method for a ticket issuing system that is provided with the plurality of ticket issuing devices, it is possible to simultaneously execute issuance of participation tickets from the plurality of devices. Therefore, it is possible to avoid a situation in which issuance of a participation ticket takes long time, and thus to smoothly start the special game.

The present invention provides a gaming machine that has the following configuration.

That is, the gaming machine comprises: a ticket reader; a ticket printer; and a controller. The controller is programmed to execute the processing of: (a) executing a normal game; (b) providing from the ticket printer a game-result ticket on which a game result of the normal game is recorded; (c) determining whether or not the game result recorded on the game-result ticket satisfies a given condition, when the game-result ticket provided in the processing (b) is put into the ticket reader; and (d) executing a special game in which winning or losing is determined based on the result of a game that is executed in a plurality of the gaming machines, when the controller determines in the processing (c) that the game result satisfies the given condition.

According to the gaming machine, a normal game (e.g. a preliminary round of a tournament-type game) is executed and then a game-result ticket is provided on which the game result of the normal game is recorded. Thereafter, when the game-result ticket is put, it is determined whether or not the game result recorded on the gaming-result ticket satisfies a given condition (e.g. taking the first place). When it is determined that the game result satisfies the given condition, a special game (e.g. a final round of the tournament-type game) is executed in which winning or losing is determined based on the result of a game played on a plurality of gaming machines.

Not everyone, but only a player whose game result recorded on the game-result ticket satisfies the given condition can participate in the special game. Accordingly, it is possible to give a sense of superiority to a player who has achieved a result sufficient enough for participation in the special game (a player who has received a game-result ticket having recorded thereon the result of a game which satisfies the given condition), and to further entertain the player with the game. In addition, with regard to a player who has not received a game-result ticket having recorded thereon the result of a game which satisfies the given condition, it is possible to motivate the player for getting a game result that satisfies the given condition in a normal game, and thereby it is possible to get the player engrossed in the game.

Further, since a game-result ticket provided from a gaming machine enables participation in a special game, a new ticket for gaining entry to the special game needs not to be issued. Therefore, it is possible to smoothly start the special game.

The present invention further provides a gaming system having the following configuration.

That is, the gaming system comprises: a plurality of gaming machines each including a ticket reader, a ticket printer, and a controller; and a plurality of ticket issuing devices each including a processor, an input device with which an operator can perform an input operation, a ticket issuing terminal from which a ticket can be issued, and a ticket reading terminal that can read information recorded on a ticket. The controller executes the processing of: (a) executing a normal game; and (b) providing from the ticket printer a game-result ticket on which the game result of the normal game is recorded. The processor executes the processing of: (A) determining whether or not the game result recorded on the game-result ticket satisfies a given condition, when the game-result ticket provided from the gaming machine is put into the ticket reading terminal; and (B) issuing a participation ticket from the ticket issuing terminal, when the processor determines in the processing (A) that the game result satisfies the given condition. The controller further executes the processing of (c) executing a special game in which winning or losing is determined based on the result of a game that is executed in the plurality of gaming machines, when the participation ticket issued from the ticket issuing device is put into the ticket reader.

According to the gaming system, in each gaming machine, a normal game (e.g. a preliminary round of a tournament-type game) is executed and then a game-result ticket is provided on which the game result of the normal game is recorded. Thereafter, when the game-result ticket that has been provided from the gaming machine is put into a ticket issuing device, it is determined whether or not the game result recorded on the gaming-result ticket satisfies a given condition (e.g. taking the first place). When it is determined that the game result satisfies the given condition, a participation ticket is provided. When the participation ticket is put into a gaming machine, a special game (e.g. a final round of the tournament-type game) is executed in which winning or losing is determined based on the result of a game played on a plurality of gaming machines.

Not everyone, but only a player to whom a participation ticket has been issued, that is, a player whose normal game result satisfies the given condition can participate in the special game. Accordingly, it is possible to give a sense of superiority to a player who has achieved a result sufficient enough for participation in the special game (a player who has received a game-result ticket having recorded thereon the result of a game which satisfies the given condition), and to further entertain the player with the game. In addition, with regard to a player who has not received a game-result ticket having recorded thereon the result of a game which satisfies the given condition, it is possible to motivate the player for getting a game result that satisfies the given condition in a normal game, and thereby it is possible to get the player engrossed in the game.

Further, since being provided with the plurality of ticket issuing devices, the gaming system can simultaneously execute issuance of participation tickets from the plurality of devices. Therefore, it is possible to avoid a situation in which issuance of a participation ticket takes long time, and thus to smoothly start the special game.

The present invention further provides a control method of a gaming machine which has the following configuration.

That is, the control method of a gaming machine comprises the steps of: (a) executing a normal game; (b) providing from the ticket printer a game-result ticket on which a game result of the normal game is recorded; (c) determining whether or not the game result recorded on the game-result ticket satisfies a given condition, when the game-result ticket provided in the step (b) is put into the ticket reader; and (d) executing a special game in which winning or losing is determined based on the result of a game that is executed in a plurality of the gaming machines, when it is determined in the step (c) that the game result satisfies the given condition.

According to the control method of a gaming machine, a normal game (e.g. a preliminary round of a tournament-type game) is executed and then a game-result ticket is provided on which the game result of the normal game is recorded. Thereafter, when the game-result ticket is put, it is determined whether or not the game result recorded on the gaming-result ticket satisfies a given condition (e.g. taking the first place). When it is determined that the game result satisfies the given condition, a special game (e.g. a final round of the tournament-type game) is executed in which winning or losing is determined based on the result of a game played on a plurality of gaming machines.

Not everyone, but only a player whose game result recorded on the game-result ticket satisfies the given condition can participate in the special game. Accordingly, it is possible to give a sense of superiority to a player who has achieved a result sufficient enough for participation in the special game (a player who has received a game-result ticket having recorded thereon the result of a game which satisfies the given condition), and to further entertain the player with the game. In addition, with regard to a player who has not received a game-result ticket having recorded thereon the result of a game which satisfies the given condition, it is possible to motivate the player for getting a game result that satisfies the given condition in a normal game, and thereby it is possible to get the player engrossed in the game.

Further, since a game-result ticket provided from a gaming machine enables participation in a special game, a new ticket for gaining entry to the special game needs not to be issued. Therefore, it is possible to smoothly start the special game.

The present invention further provides a control method of a gaming system which has the following configuration.

That is, the gaming system controlled by the control method of a gaming system comprises: a plurality of gaming machines each including a ticket reader, a ticket printer, and a controller; and a plurality of ticket issuing devices each including a processor, an input device with which an operator can perform an input operation, a ticket issuing terminal from which a ticket can be issued, and a ticket reading terminal that can read information recorded on a ticket. The control method comprises the steps of: (a) the controller executing a normal game; (b) the controller providing from the ticket printer a game-result ticket on which the game result of the normal game is recorded; (A) the processor determining whether or not the game result recorded on the game-result ticket satisfies a given condition, when the game-result ticket provided from the gaming machine is put into the ticket reading terminal; (B) the processor issuing a participation ticket from the ticket issuing terminal, when the processor determines in the step (A) that the game result satisfies the given condition; and (c) the controller executing a special game in which winning or losing is determined based on the result of a game that is executed in the plurality of gaming machines, when the participation ticket issued from the ticket issuing device is put into the ticket reader.

According to the control method of a gaming system, in each gaming machine, a normal game (e.g. a preliminary round of a tournament-type game) is executed and then a game-result ticket is provided on which the game result of the normal game is recorded. Thereafter, when the game-result ticket that has been provided from the gaming machine is put into a ticket issuing device, it is determined whether or not the game result recorded on the gaming-result ticket satisfies a given condition (e.g. taking the first place). When it is determined that the game result satisfies the given condition, a participation ticket is provided. When the participation ticket is put into a gaming machine, a special game (e.g. a final round of the tournament-type game) is executed in which winning or losing is determined based on the result of a game played on a plurality of gaming machines.

Not everyone, but only a player to whom a participation ticket has been issued, that is, a player whose normal game result satisfies the given condition can participate in the special game. Accordingly, it is possible to give a sense of superiority to a player who has achieved a result sufficient enough for participation in the special game (a player who has received a game-result ticket having recorded thereon the result of a game which satisfies the given condition), and to further entertain the player with the game. In addition, with regard to a player who has not received a game-result ticket having recorded thereon the result of a game which satisfies the given condition, it is possible to motivate the player for getting a game result that satisfies the given condition in a normal game, and thereby it is possible to get the player engrossed in the game.

Further, since the control method of a gaming system is a control method for a gaming system that is provided with the plurality of ticket issuing devices, it is possible to simultaneously execute issuance of participation tickets from the plurality of devices. Therefore, it is possible to avoid a situation in which issuance of a participation ticket takes long time, and thus to smoothly start the special game.

The present invention provides a gaming machine that has the following configuration.

That is, the gaming machine comprises: a ticket reader; and a controller. The controller is programmed to execute the processing of: (a) determining whether or not the time at which the ticket reader has received a participation ticket with a start time recorded thereon is within an acceptance period for the start time recorded on the participation ticket; (b) making a participation registration in a special game in which winning or losing is determined based on the result of a game executed in a plurality of the gaming machines, when the controller determines in the processing (a) that the time at which the ticket reader has received the participation ticket is within the acceptance period for the start time recorded on the participation ticket; and (c) executing the special game after the start time, when the controller has made a participation registration in the special game.

According to the gaming machine, when it is determined that the time at which the ticket reader has received a participation ticket with a start time recorded thereon is within the acceptance period for the start time recorded on the participation ticket, a participation registration in a special game is made, the special game being a game in which winning or losing is determined based on the result of a game that is executed in the plurality of gaming machines. Then, a special game is executed after the start time, when a participation registration in the special game has been made.

A participation ticket with a start time recorded thereon allows a player to know the start time of the special game. Therefore, the player can wait to put the participation ticket in a gaming machine until a few minutes before the start time. It is thus possible to prevent players from having to wait in front of gaming machines until the special game starts, and thereby players are allowed to smoothly participate in the special game. Further, it is possible to prevent players from not being able to participate in the special game because of reasons such as that the player has got the start time wrong and cannot put his or her participation ticket in a gaming machine before the start time.

The present invention further provides a gaming system having the following configuration.

That is, the gaming machine comprises: a plurality of ticket issuing devices each including an input device, a ticket issuing terminal from which a ticket can be issued, and a processor; and a plurality of gaming machines each including a ticket reader and a controller. The processor executes the processing of: (A) issuing from the ticket issuing terminal a participation ticket with a start time recorded thereon, based on an input from the input device, until the number of issued participation tickets reaches a predetermined upper limit value; and (B) issuing from the ticket issuing terminal a standby ticket, when a command to issue a participation ticket is inputted from the input device after the number of issued participation tickets has reached the predetermined upper limit value. The controller executes the processing of: (a) making a participation registration in a special game in which winning or losing is determined based on the result of a game executed in the plurality of gaming machines, when the time at which the ticket reader has received the participation ticket is within an acceptance period for a start time that is recorded on the participation ticket; (b) accepting a standby ticket during a predetermined period from after the end of the acceptance period to the start time, when the controller has not made a participation registration in the special game in the processing (a); (c) making a participation registration in the special game, when the ticket reader has received a standby ticket during the predetermined period during which a standby ticket is accepted in the processing (b); and (d) executing the special game after the start time, when the controller has made a participation registration in the special game.

According to the gaming system, in each ticket issuing device, a participation ticket with a start time recorded thereon is issued from the ticket issuing terminal (e.g. printer) based on an input from the input device (e.g. keyboard) until the number of issued participation tickets reaches the predetermined upper limit value. Also, in each ticket issuing device, a standby ticket is issued from the ticket issuing terminal when a command to issue a participation ticket is inputted from the input device after the number of issued participation tickets has reached the upper limit value. In each gaming machine, when it is determined that the time at which the ticket reader has received a participation ticket with a start time recorded thereon is within the acceptance period for the start time recorded on the participation ticket, a participation registration in the special game is made, the special game being a game in which winning or losing is determined based on the result of a game executed in the plurality of gaming machines. Further, in each gaming machine, when a participation registration in the special game has not been made, a standby ticket is accepted during a predetermined period from after the end of the acceptance period to the start time. Then, in each gaming machine, the special game is executed after the start time when a participation registration in the special game has been made.

A participation ticket with a start time recorded thereon allows a player to know the start time of the special game. Therefore, the player can wait to put the participation ticket in a gaming machine until a few minutes before the start time. It is thus possible to prevent players from having to wait in front of gaming machines until the special game starts, and thereby players are allowed to smoothly participate in the special game. Further, it is possible to prevent players from not being able to participate in the special game because of reasons such as that the player has got the start time wrong and cannot put his or her participation ticket in a gaming machine before the start time.

Further, when a participation registration in the special game has not been made, a standby ticket is accepted during the predetermined period from after the end of the acceptance period to the start time. A standby ticket being put into a gaming machine during the predetermined period enables a player to participate in the special game. Therefore, it is possible to give more players the chance to participate in the special game when there are players who do not participate in the special game even though they have a participation ticket.

Furthermore, since being provided with the plurality of ticket issuing devices, the gaming system can simultaneously execute issuance of participation tickets or standby tickets from the plurality of devices. Therefore, it is possible to avoid a situation in which issuance of a participation ticket or a standby ticket takes long time, and thus to smoothly start the special game.

The present invention further provides a control method of a gaming machine which has the following configuration.

That is, the control method of a gaming machine comprises the steps of: (a) determining whether or not the time at which the ticket reader has received a participation ticket with a start time recorded thereon is within an acceptance period for the start time recorded on the participation ticket; (b) making a participation registration in a special game in which winning or losing is determined based on the result of a game executed in a plurality of the gaming machines, when it is determined in the step (a) that the time at which the ticket reader has received the participation ticket is within the acceptance period for the start time recorded on the participation ticket; and (c) executing the special game after the start time, when a participation registration in the special game has been made.

According to the control method of a gaming machine, when it is determined that the time at which the ticket reader has received a participation ticket with a start time recorded thereon is within the acceptance period for the start time recorded on the participation ticket, a participation registration in a special game is made, the special game being a game in which winning or losing is determined based on the result of a game that is executed in the plurality of gaming machines. Then, a special game is executed after the start time, when a participation registration in the special game has been made.

A participation ticket with a start time recorded thereon allows a player to know the start time of the special game. Therefore, the player can wait to put the participation ticket in a gaming machine until a few minutes before the start time. It is thus possible to prevent players from having to wait in front of gaming machines until the special game starts, and thereby players are allowed to smoothly participate in the special game. Further, it is possible to prevent players from not being able to participate in the special game because of reasons such as that the player has got the start time wrong and cannot put his or her participation ticket in a gaming machine before the start time.

The present invention further provides a control method of a gaming system which has the following configuration.

That is, the gaming system controlled by the control method of a gaming system comprises: a plurality of ticket issuing devices each including an input device, a ticket issuing terminal from which a ticket can be issued, and a processor; and a plurality of gaming machines each including a ticket reader and a controller.

The control method comprises the steps of: (A) the processor issuing from the ticket issuing terminal a participation ticket with a start time recorded thereon, based on an input from the input device, until the number of issued participation tickets reaches a predetermined upper limit value; (B) the processor issuing from the ticket issuing terminal a standby ticket, when a command to issue a participation ticket is inputted from the input device after the number of issued participation tickets has reached the predetermined upper limit value; (a) the controller making a participation registration in a special game in which winning or losing is determined based on the result of a game executed in the plurality of gaming machines, when the time at which the ticket reader has received the participation ticket is within an acceptance period for a start time that is recorded on the participation ticket; (b) the controller accepting a standby ticket during a predetermined period from after the end of the acceptance period to the start time, when the controller has not made a participation registration in the special game in the step (a); (c) the controller making a participation registration in the special game, when the ticket reader has received a standby ticket during the predetermined period during which a standby ticket is accepted in the step (b); and (d) the controller executing the special game after the start time, when the controller has made a participation registration in the special game.

According to the control method of a gaming system, in each ticket issuing device, a participation ticket with a start time recorded thereon is issued from the ticket issuing terminal (e.g. printer) based on an input from the input device (e.g. keyboard) until the number of issued participation tickets reaches the predetermined upper limit value. Also, in each ticket issuing device, a standby ticket is issued from the ticket issuing terminal when a command to issue a participation ticket is inputted from the input device after the number of issued participation tickets has reached the upper limit value. In each gaming machine, when it is determined that the time at which the ticket reader has received a participation ticket with a start time recorded thereon is within the acceptance period for the start time recorded on the participation ticket, a participation registration in the special game is made, the special game being a game in which winning or losing is determined based on the result of a game executed in the plurality of gaming machines. Further, in each gaming machine, when a participation registration in the special game has not been made, a standby ticket is accepted during a predetermined period from after the end of the acceptance period to the start time. Then, in each gaming machine, the special game is executed after the start time when a participation registration in the special game has been made.

A participation ticket with a start time recorded thereon allows a player to know the start time of the special game. Therefore, the player can wait to put the participation ticket in a gaming machine until a few minutes before the start time. It is thus possible to prevent players from having to wait in front of gaming machines until the special game starts, and thereby players are allowed to smoothly participate in the special game. Further, it is possible to prevent players from not being able to participate in the special game because of reasons such as that the player has got the start time wrong and cannot put his or her participation ticket in a gaming machine before the start time.

Further, when a participation registration in the special game has not been made, a standby ticket is accepted during the predetermined period from after the end of the acceptance period to the start time. A standby ticket being put into a gaming machine during the predetermined period enables a player to participate in the special game. Therefore, it is possible to give more players the chance to participate in the special game when there are players who do not participate in the special game even though they have a participation ticket.

Furthermore, since being provided with the plurality of ticket issuing devices, the gaming system can simultaneously execute issuance of participation tickets or standby tickets from the plurality of devices. Therefore, it is possible to avoid a situation in which issuance of a participation ticket or a standby ticket takes long time, and thus to smoothly start the special game.

BRIEF DESCRIPTION OF THE DRAWINGS

FIG. 24 is a view illustrating correspondence relationship between a type and the number of rearranged symbols and an amount of payout.

FIG. 53 is a view illustrating correspondence relationship between a type and the number of rearranged symbols and an amount of payout.

FIG. 82 is a view illustrating correspondence relationship between a type and the number of rearranged symbols and an amount of payout.

FIG. 90 is a perspective view illustrating an external view of a slot machine according to the fourth embodiment of the present invention.

FIG. 91 is a block diagram illustrating an internal configuration of the slot machine shown in FIG. 90.

FIG. 92 is a block diagram illustrating an internal configuration of a ticket issuing device constituting a ticket issuing system according to the fourth embodiment of the present invention.

FIG. 93 is a block diagram illustrating an internal configuration of a server constituting the ticket issuing system according to the fourth embodiment of the present invention.

FIG. 94 is a view illustrating exemplary game-history data stored in a hard disk that is provided in the server.

FIG. 95 is a flowchart illustrating main processing that is executed in the server.

FIG. 96 is a flowchart illustrating a subroutine of number-of-participants determination processing.

FIG. 97 is a flowchart illustrating a subroutine of game participation signal reception processing.

FIG. 98A is a flowchart illustrating a subroutine of winning/losing determination processing.

FIG. 98B is another flowchart illustrating the subroutine of the winning/losing determination processing.

FIG. 99 is a flowchart illustrating slot machine processing that is executed in each slot machine.

FIG. 100 is a flowchart illustrating game execution processing executed in each slot machine.

Figure 101:
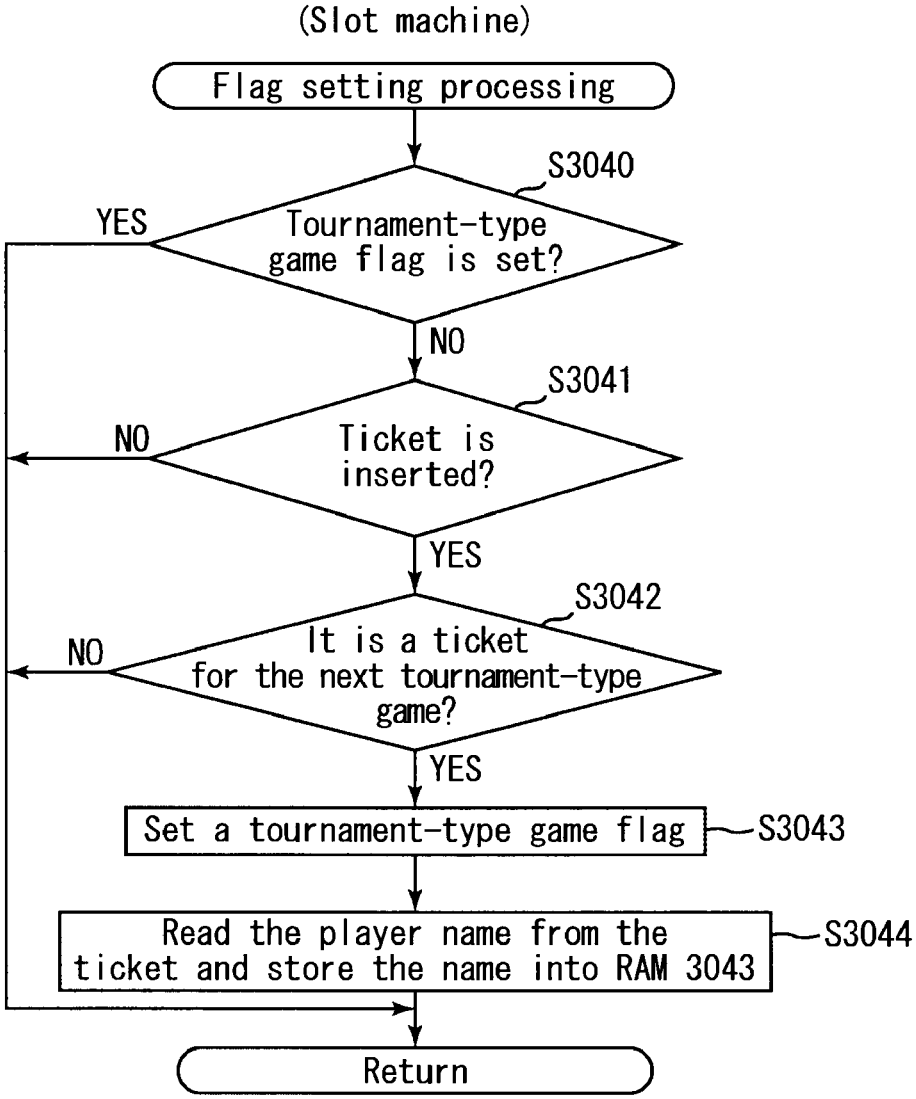

FIG. 101 is a flowchart illustrating a subroutine of flag setting processing.

Figure 102:
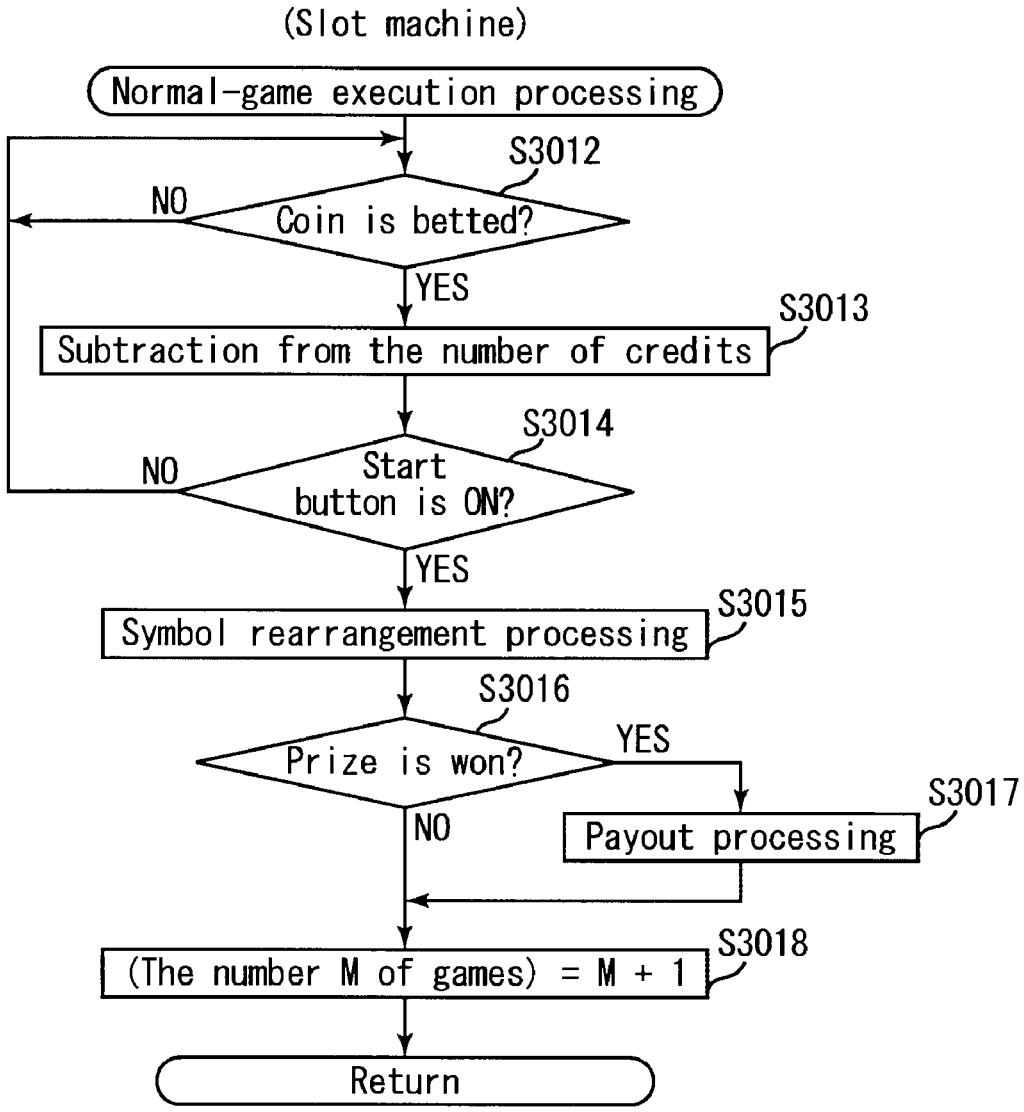

FIG. 102 is a flowchart illustrating a subroutine of normal-game execution processing.

FIG. 103 is a view illustrating correspondence relationship between a type and the number of rearranged symbols and an amount of payout.

Figure 104A:
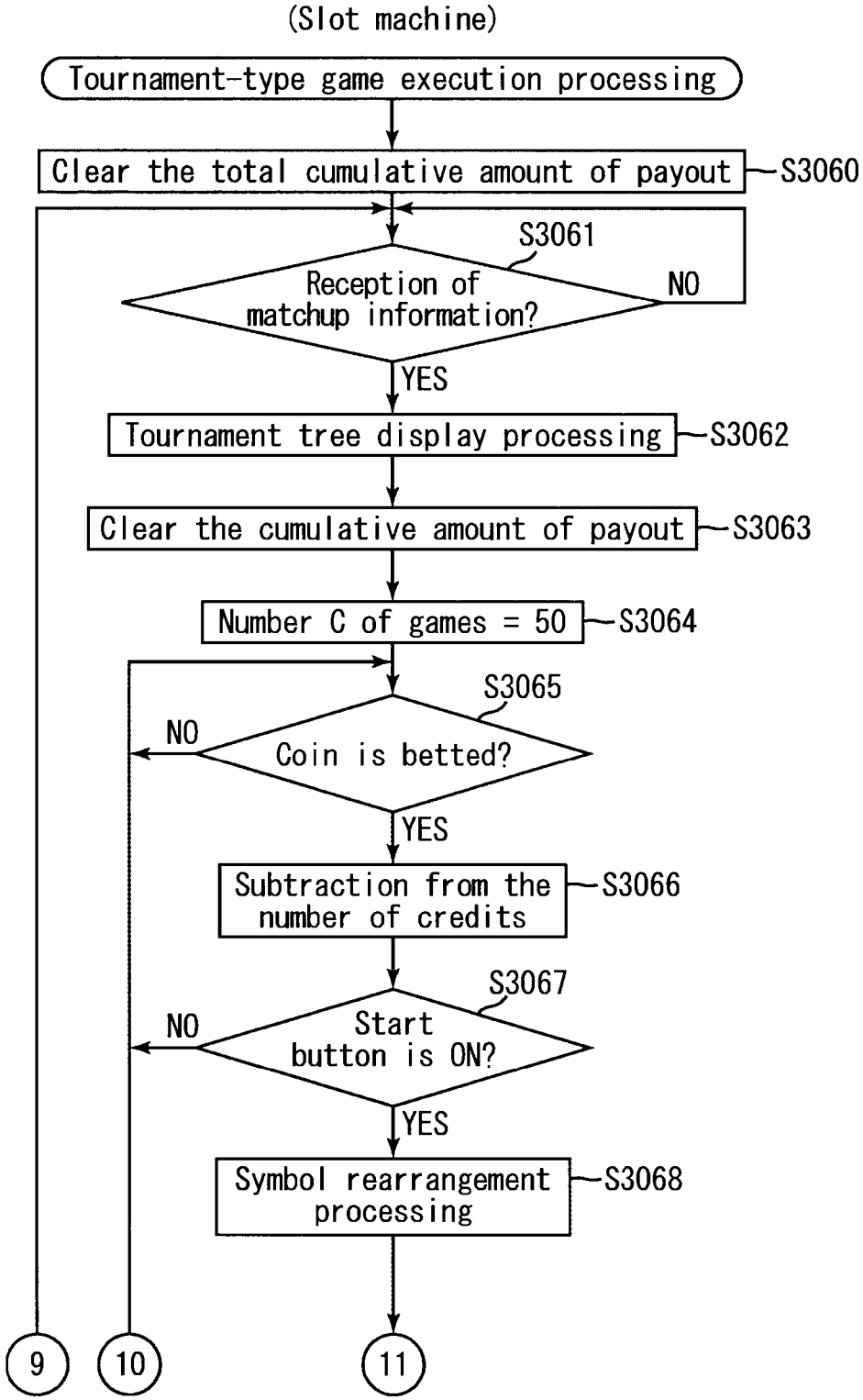

FIG. 104A is a flowchart illustrating a subroutine of tournament-type game execution processing.

Figure 104B:
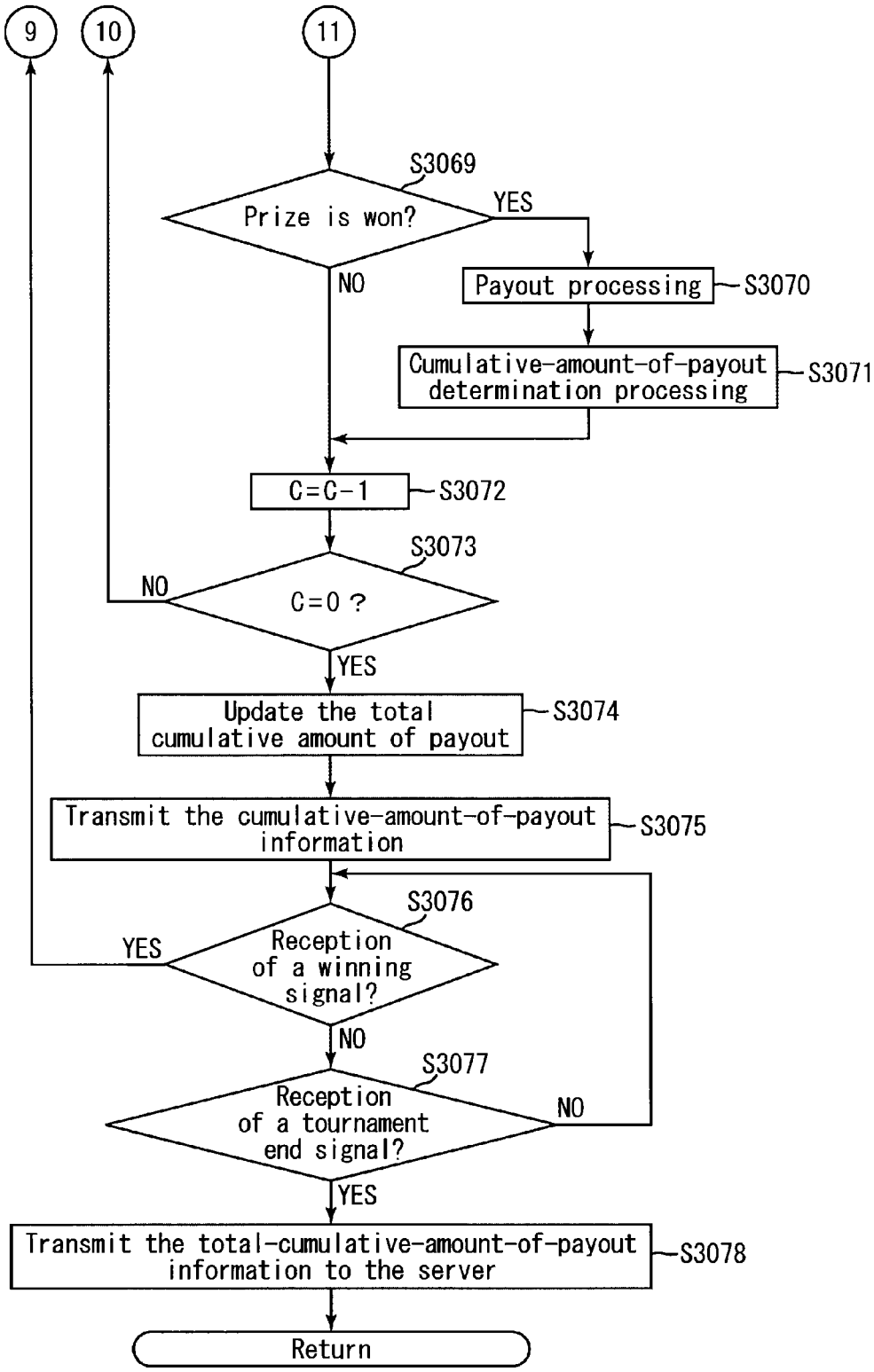

FIG. 104B is another flowchart illustrating the subroutine of the tournament-type game execution processing.

Figure 105:
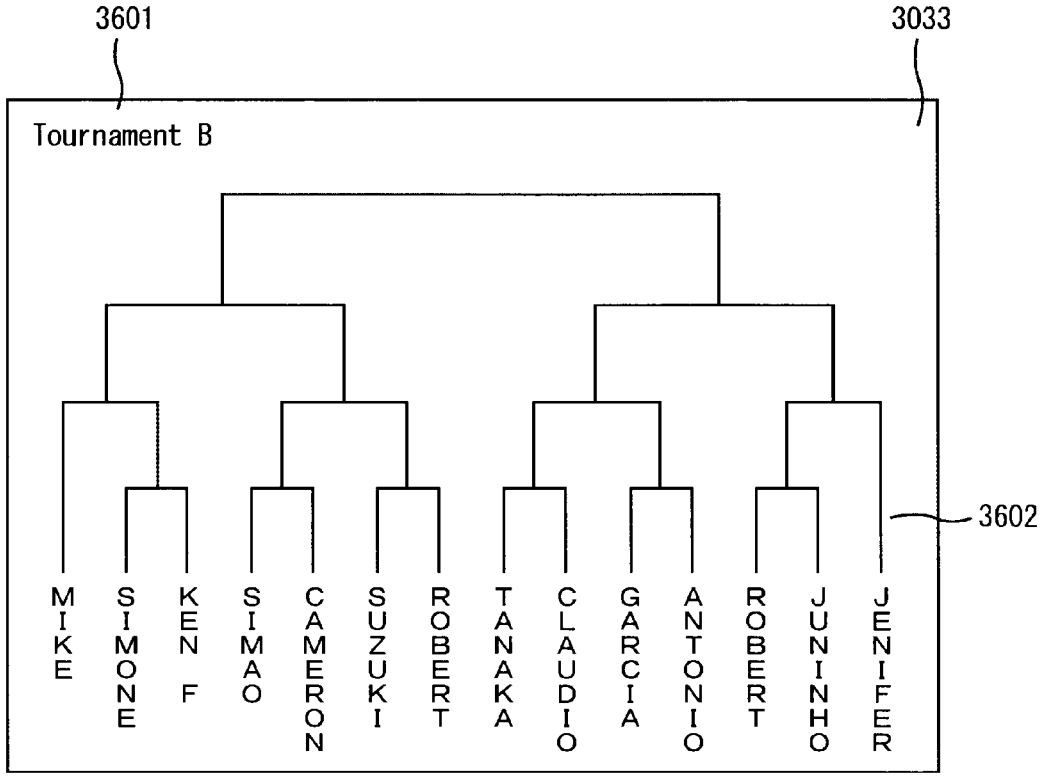

FIG. 105 is a view illustrating an exemplary image that is displayed to an upper image display panel provided in each slot machine constituting the ticket issuing system according to the fourth embodiment of the present invention.

Figure 106A:
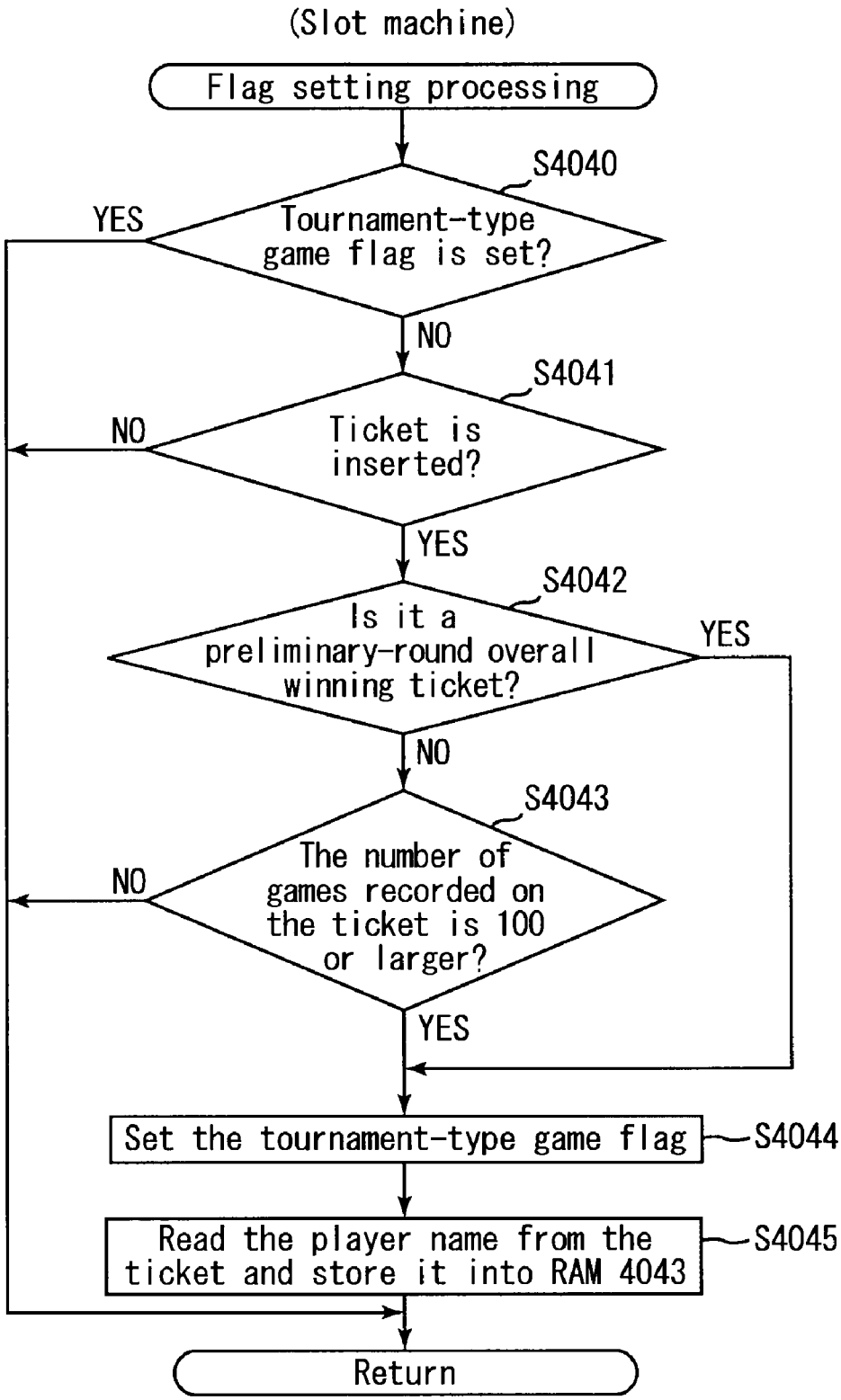

FIG. 106A is a flowchart illustrating a subroutine of flag setting processing that is executed in each slot machine according to a fifth embodiment of the present invention.

Figure 106B:
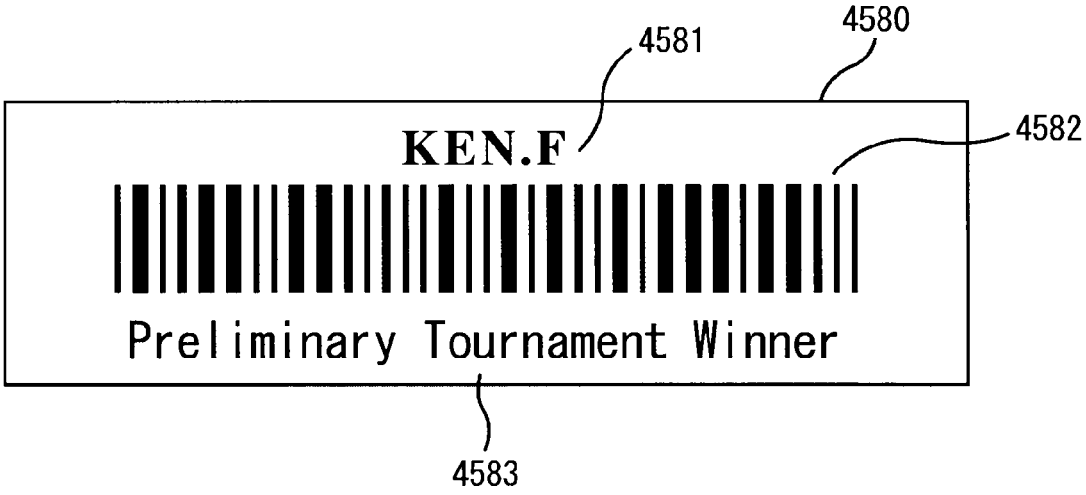

FIG. 106B is a view illustrating an exemplary preliminary-round overall winning ticket according to the fifth embodiment of the present invention.

Figure 107:
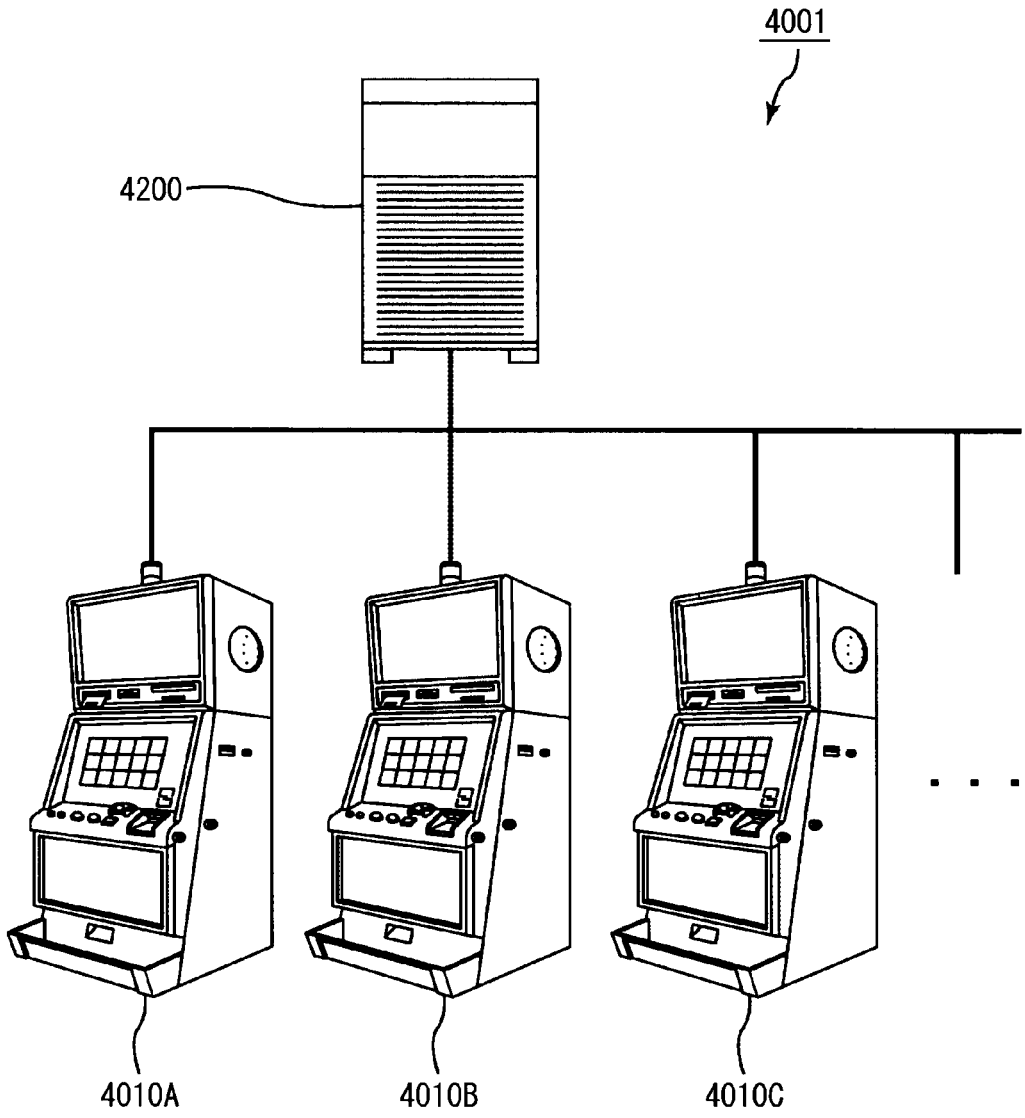

FIG. 107 is a schematic view illustrating an entire configuration of a gaming system according to the fifth embodiment of the present invention.

Figure 108:
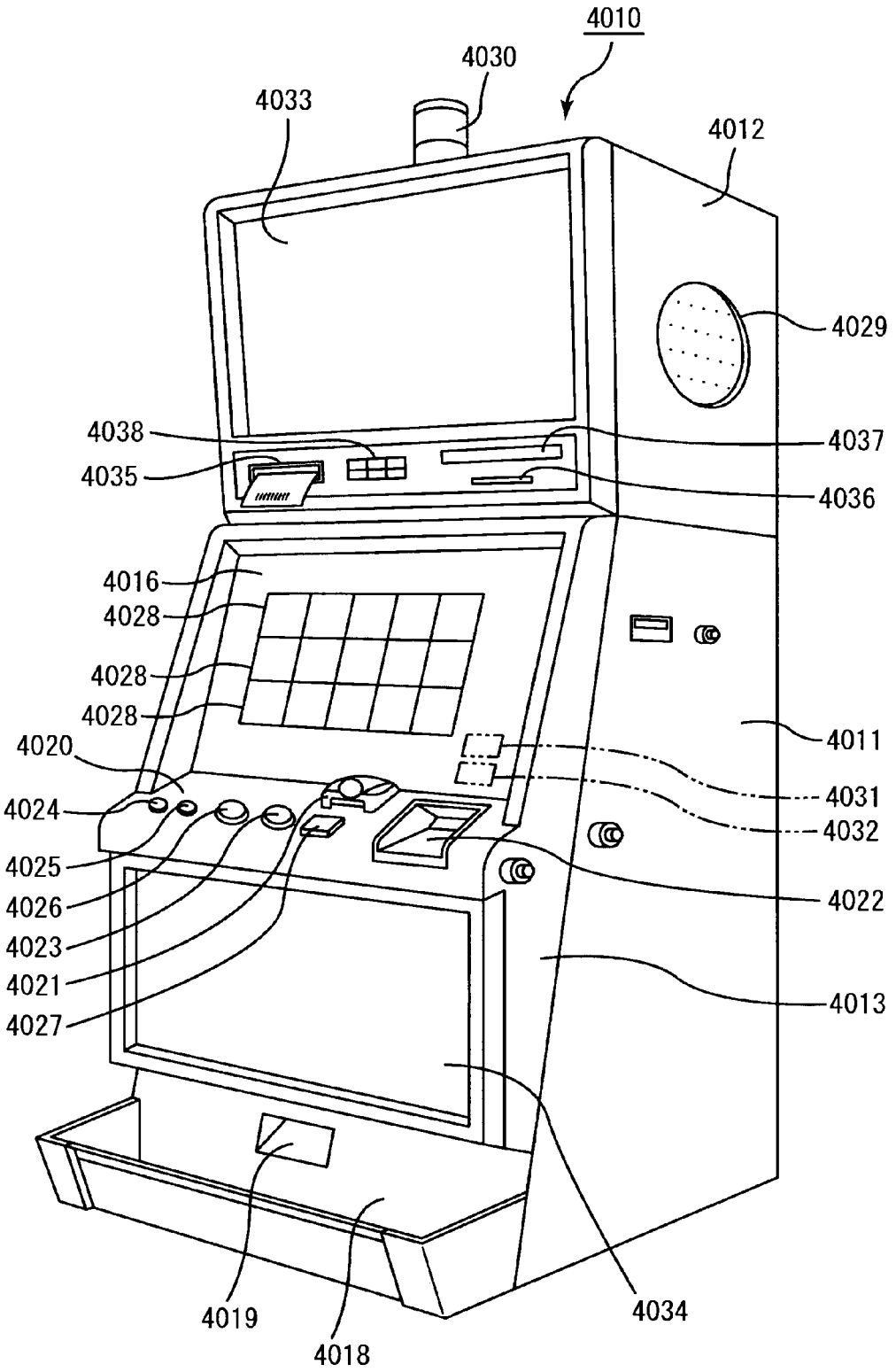

FIG. 108 is a perspective view illustrating an external view of a slot machine according to the fifth embodiment of the present invention.

Figure 109:
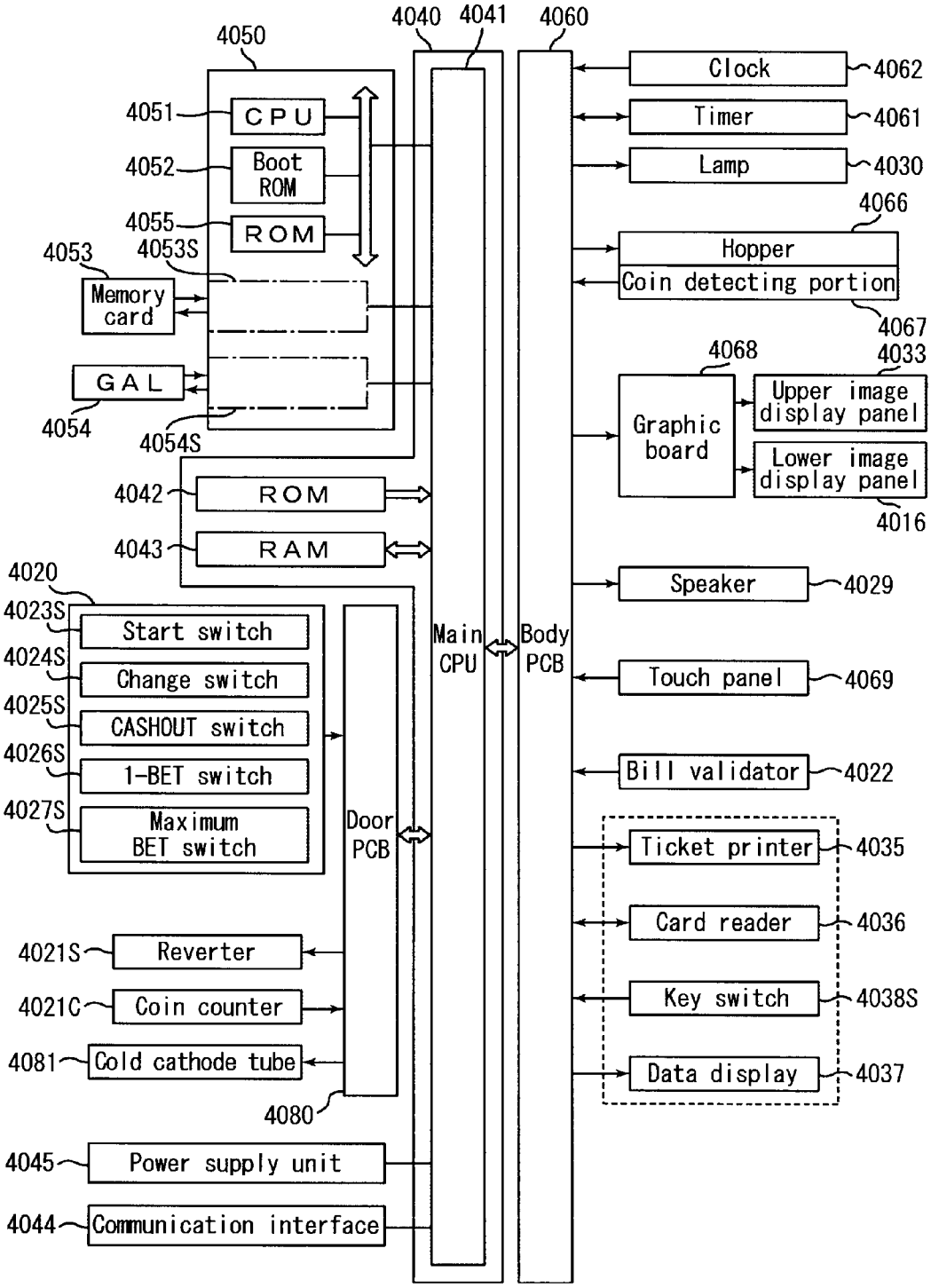

FIG. 109 is a block diagram illustrating an internal configuration of the slot machine shown in FIG. 108.

Figure 110:
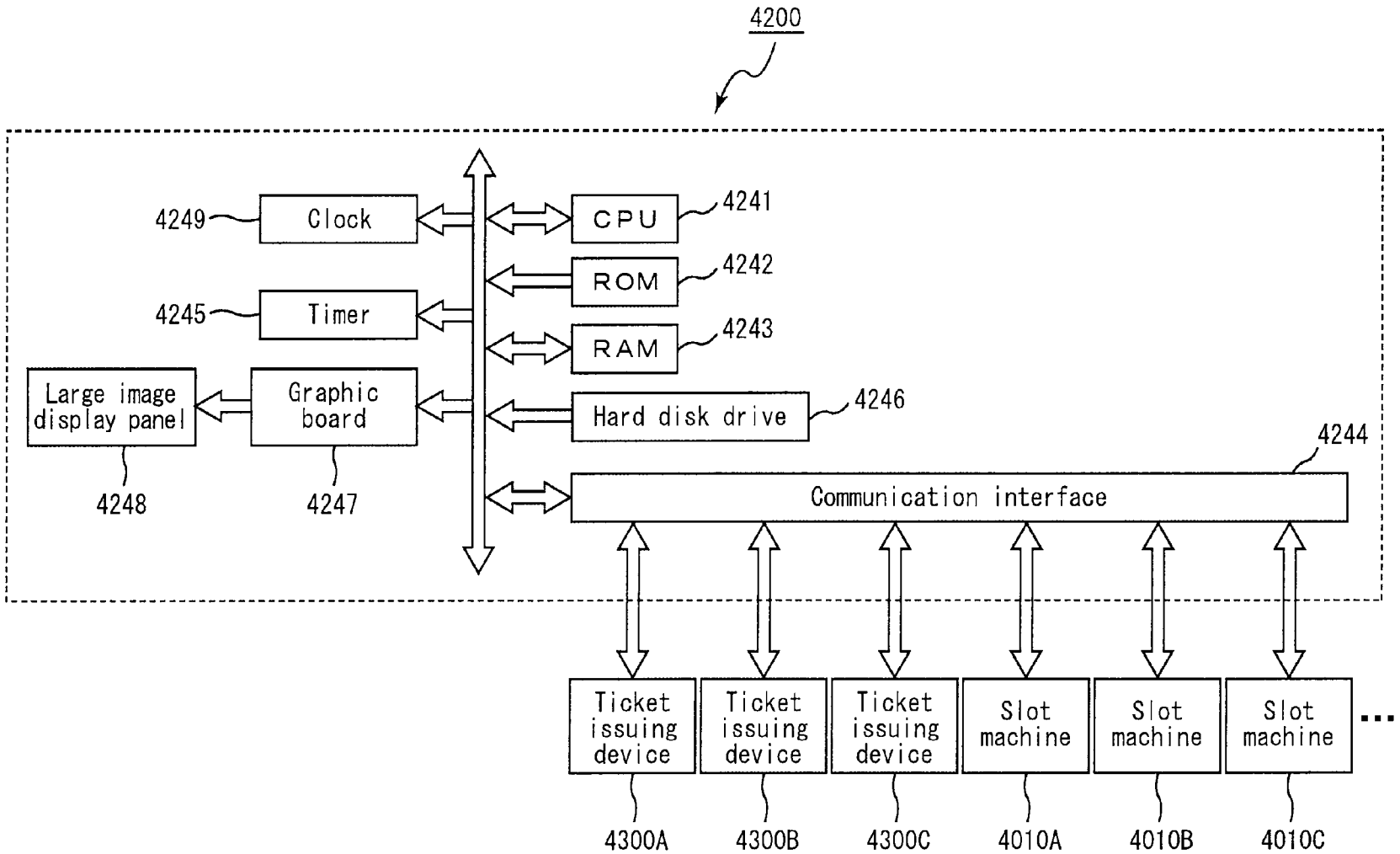

FIG. 110 is a block diagram illustrating an internal configuration of a server constituting the ticket issuing system according to the fifth embodiment of the present invention.

Figure 111:
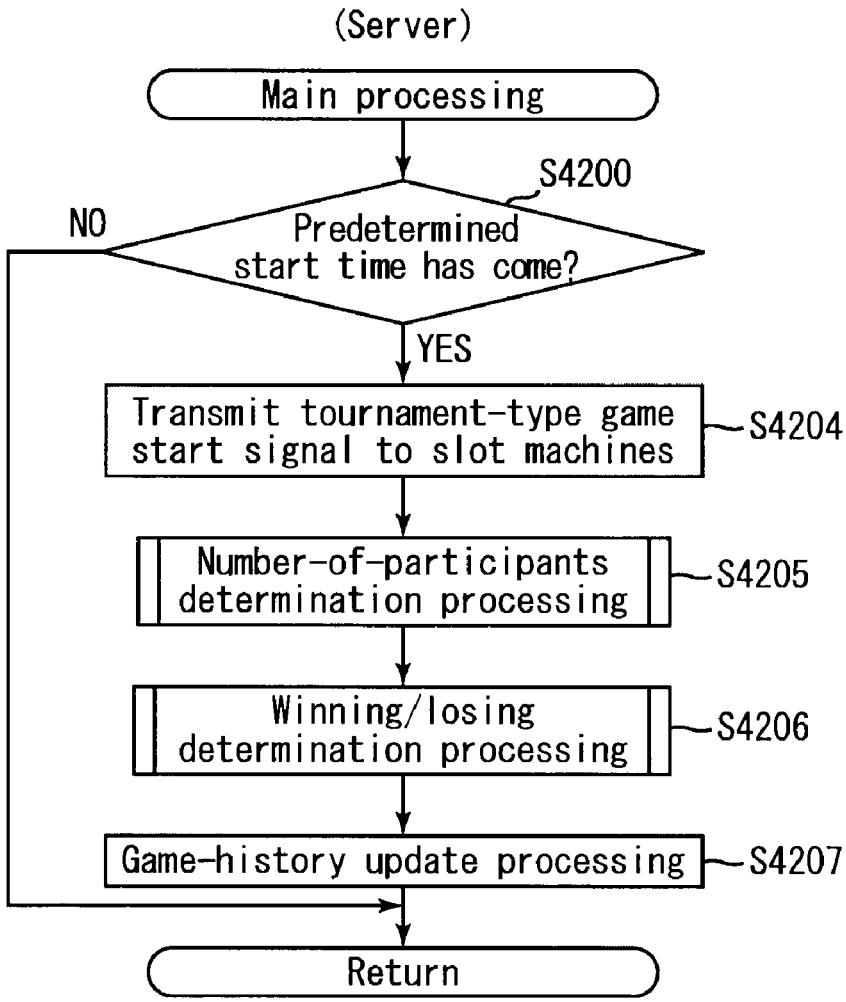

FIG. 111 is a flowchart illustrating main processing that is executed in the server.

Figure 112:
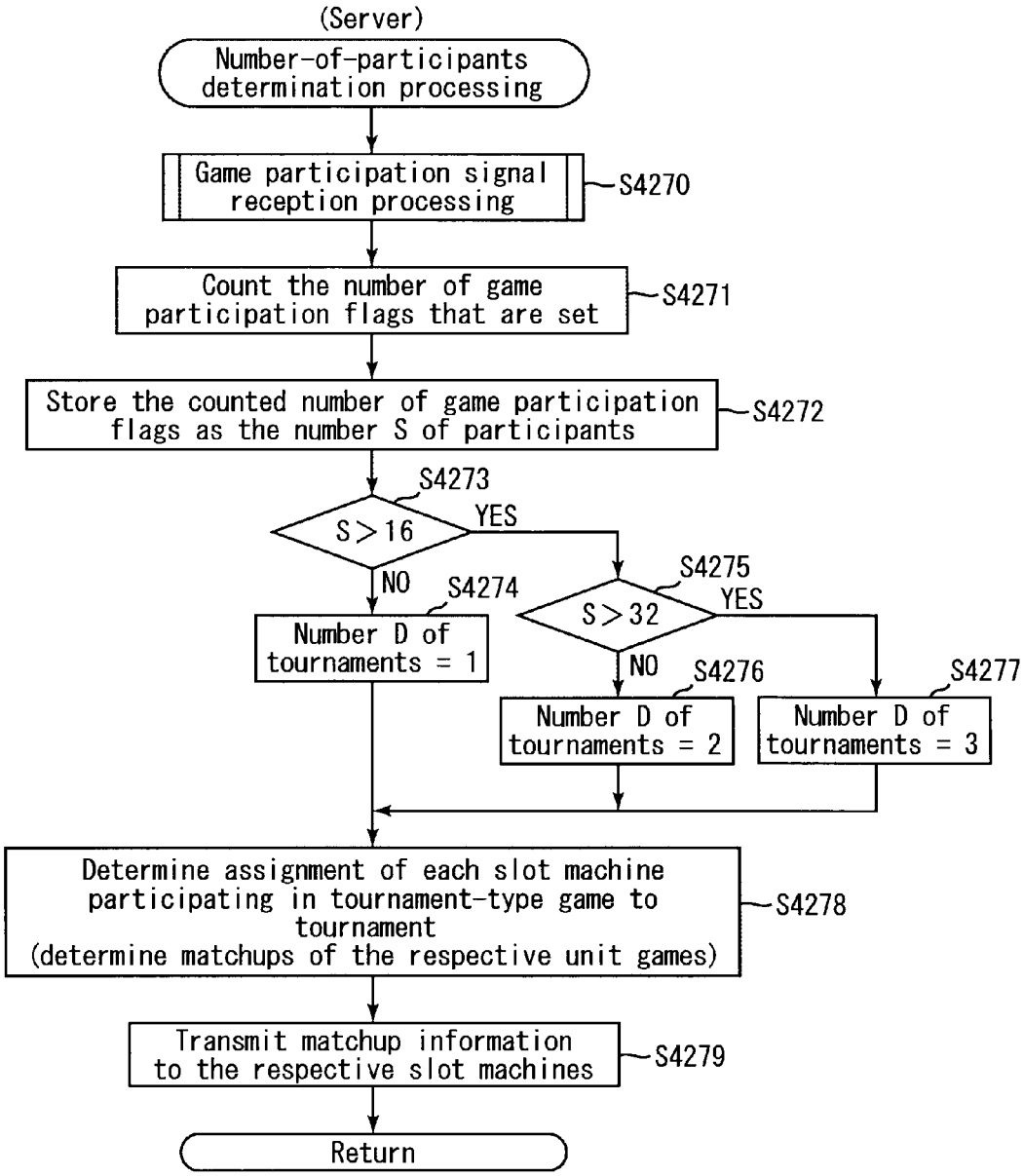

FIG. 112 is a flowchart illustrating a subroutine of number-of-participants determination processing.

Figure 113:
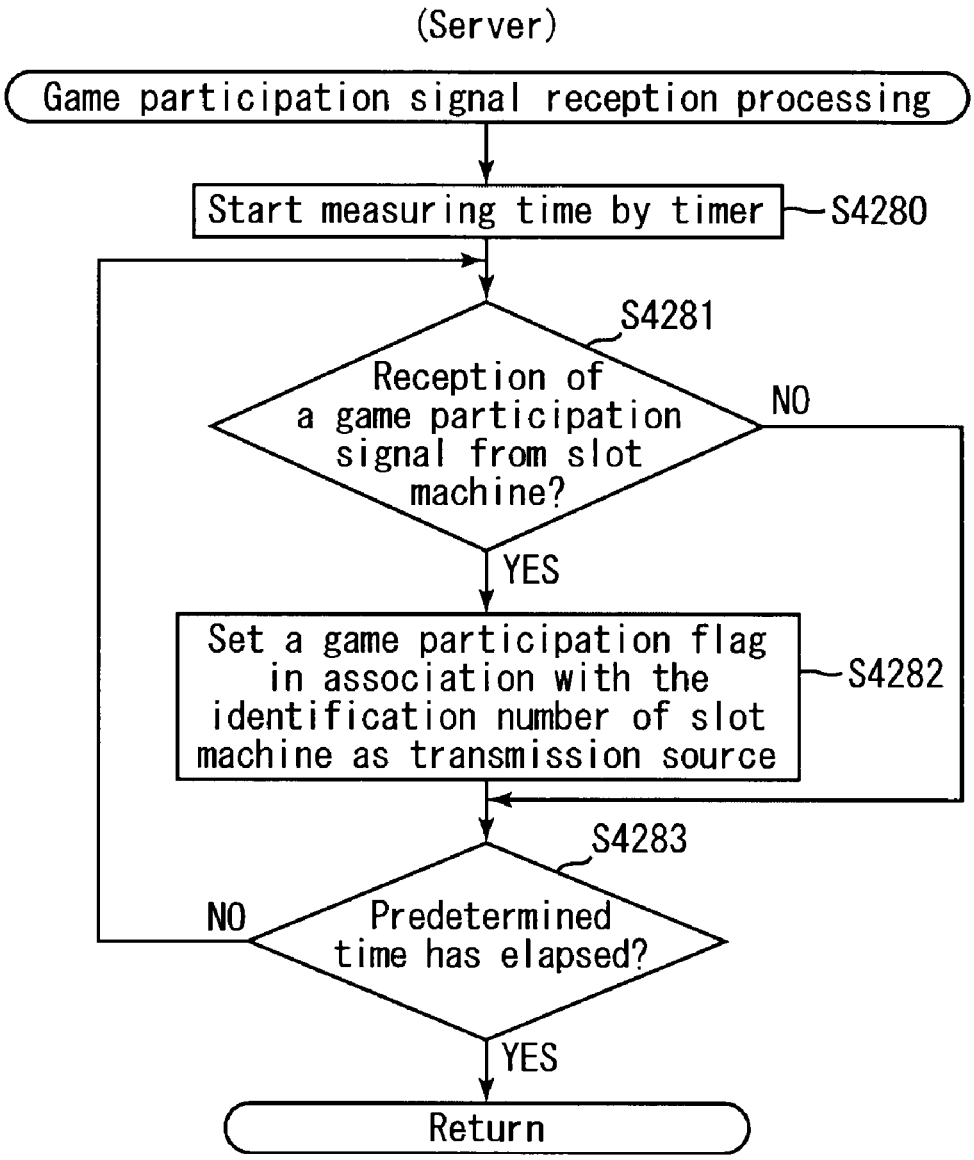

FIG. 113 is a flowchart illustrating a subroutine of game participation signal reception processing.

Figure 114A:
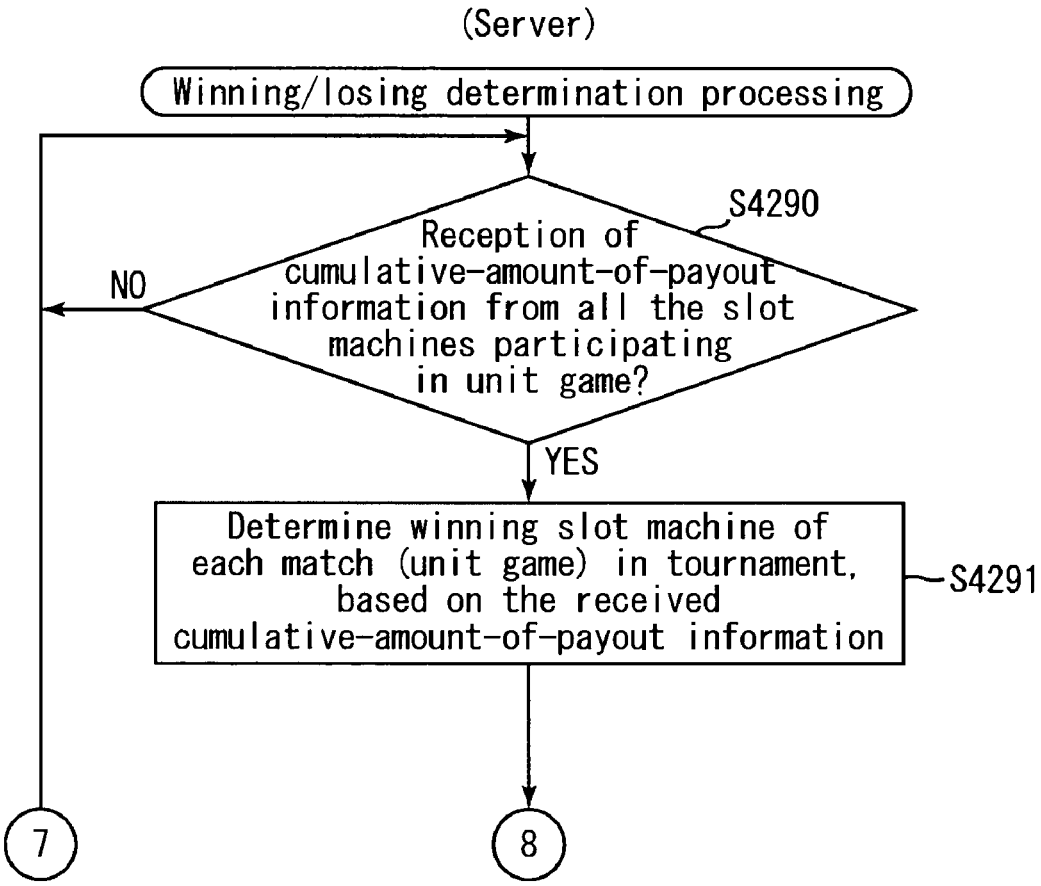

FIG. 114A is a flowchart illustrating a subroutine of winning/losing determination processing.

Figure 114B:
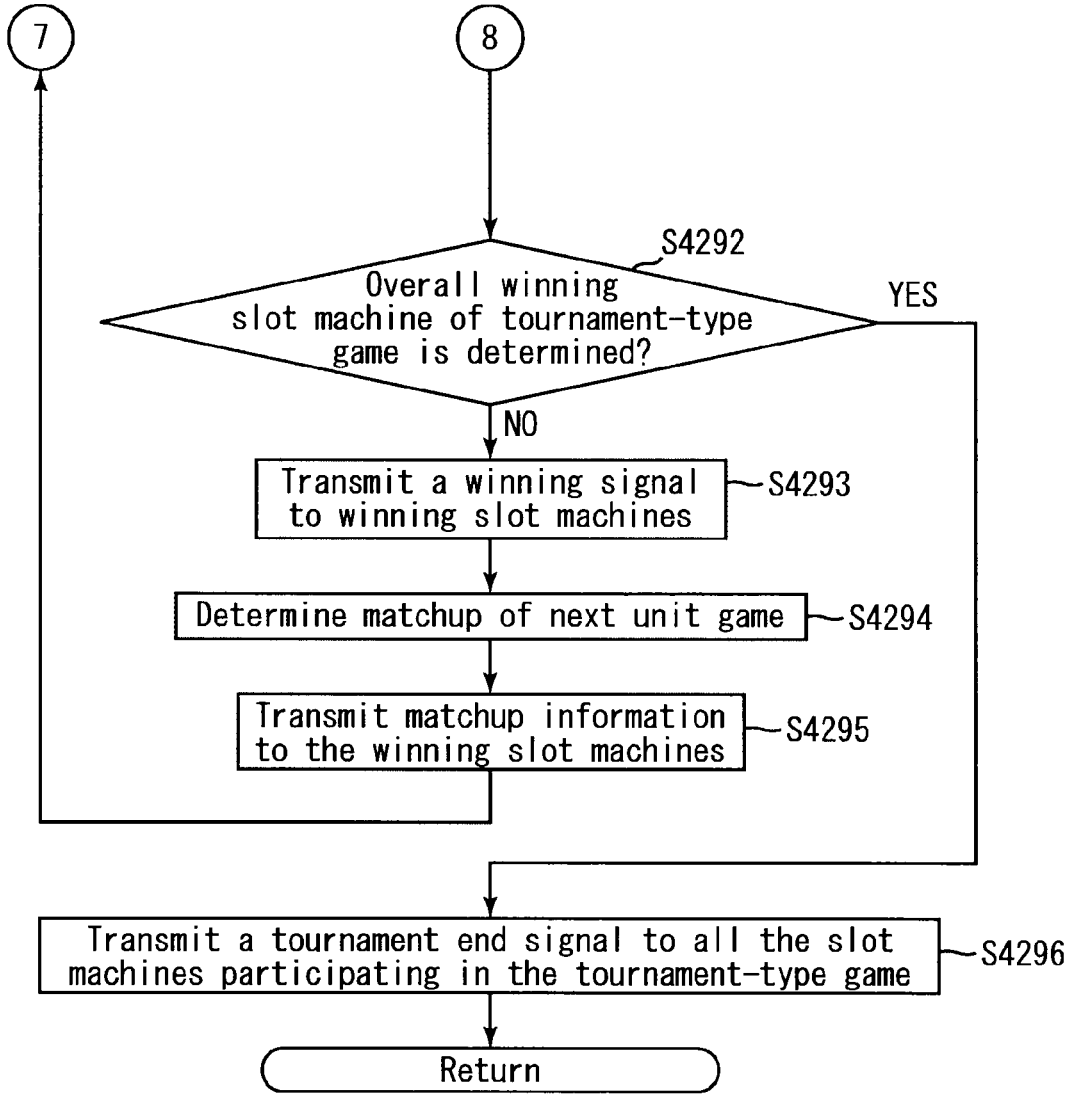

FIG. 114B is another flowchart illustrating the subroutine of the winning/losing determination processing.

Figure 115:
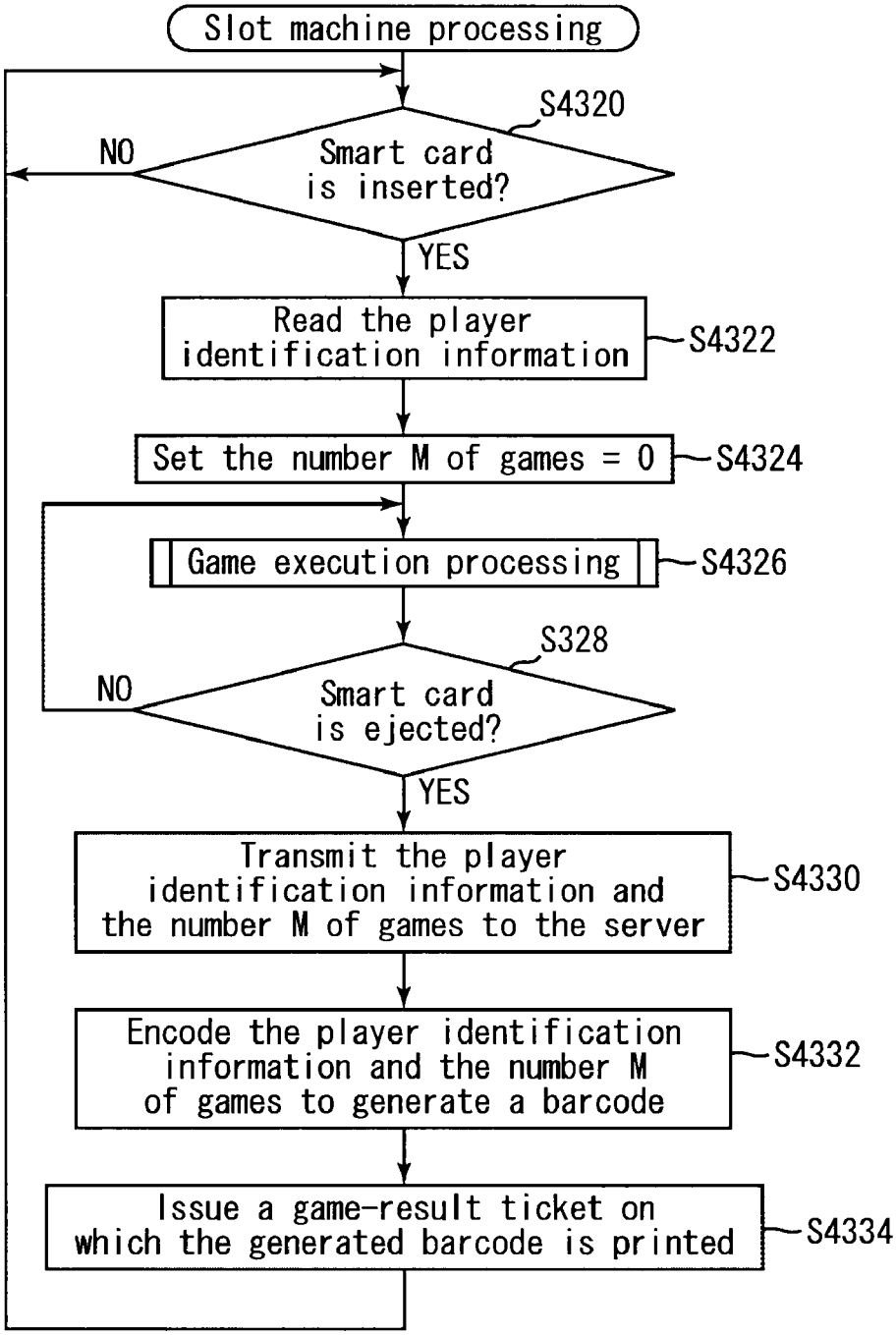

FIG. 115 is a flowchart illustrating slot machine processing that is executed in each slot machine.

Figure 116:
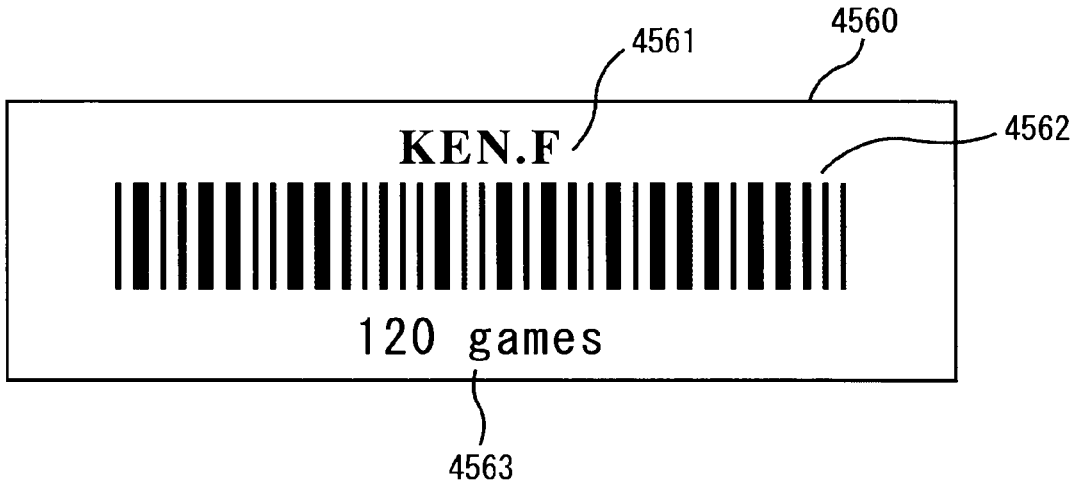

FIG. 116 is a view illustrating an exemplary game-result ticket that is issued from a slot machine.

Figure 117:
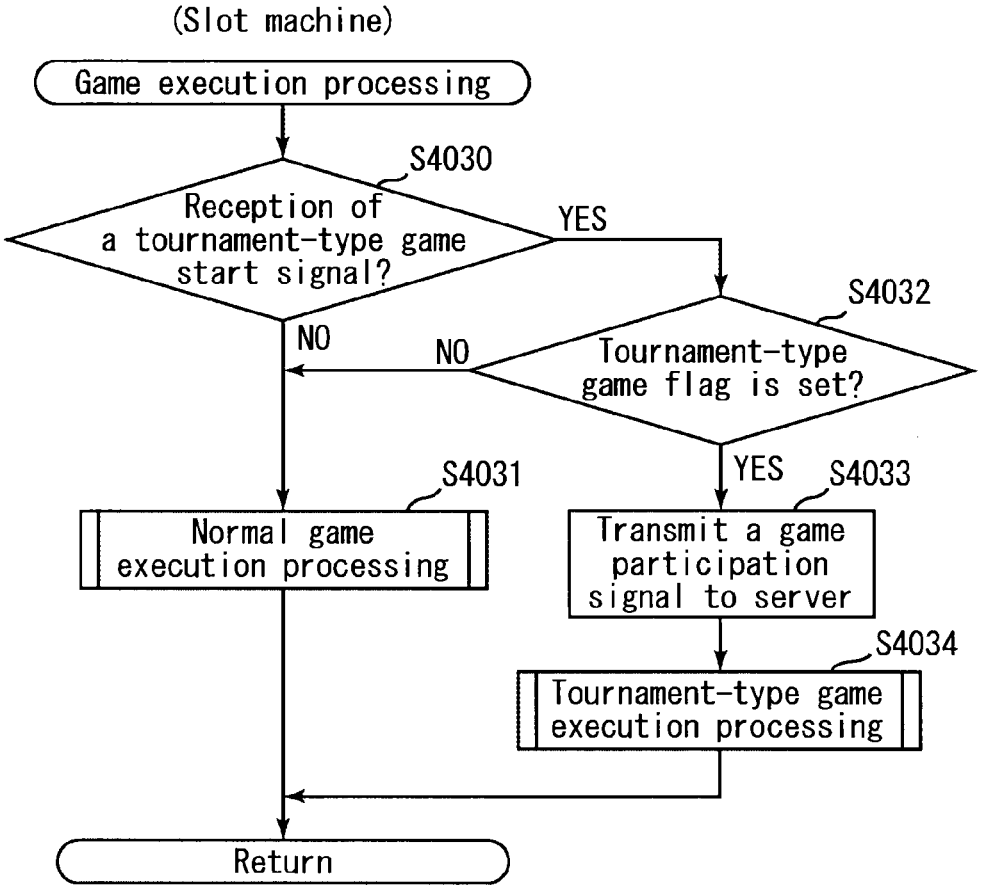

FIG. 117 is a flowchart illustrating game execution processing executed in each slot machine.

Figure 118:
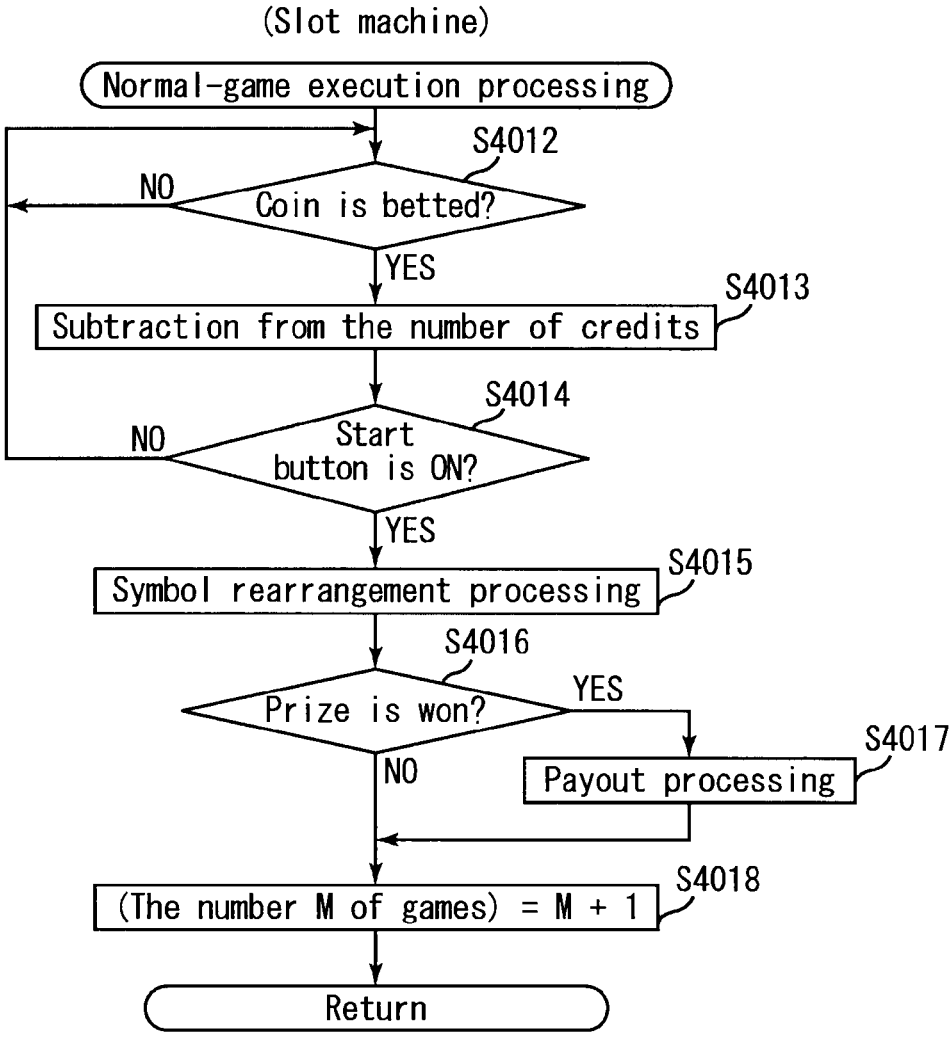

FIG. 118 is a flowchart illustrating a subroutine of normal-game execution processing.

FIG. 119 is a view illustrating correspondence relationship between a type and the number of rearranged symbols and an amount of payout.

Figure 120A:
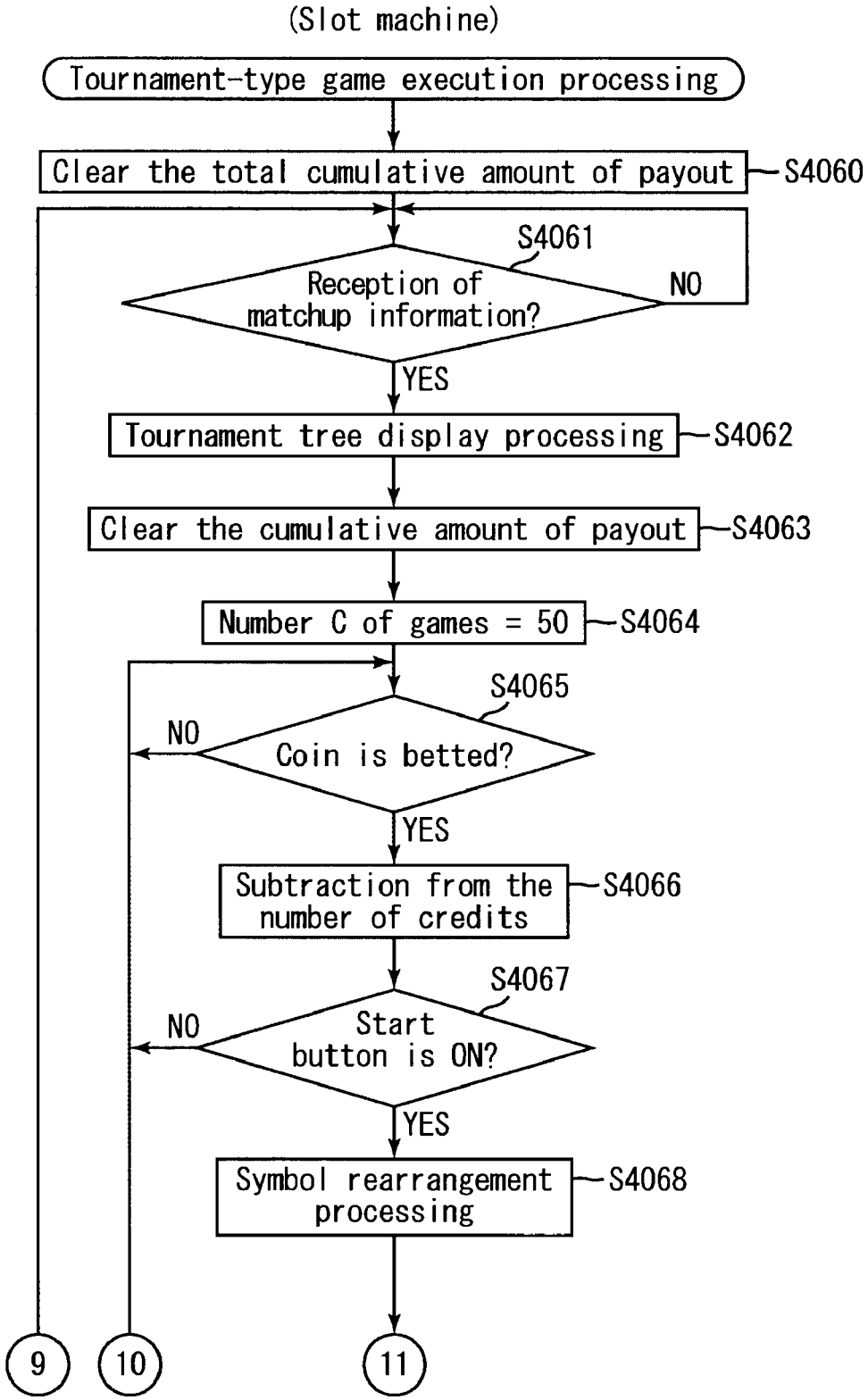

FIG. 120A is a flowchart illustrating a subroutine of tournament-type game execution processing.

Figure 120B:
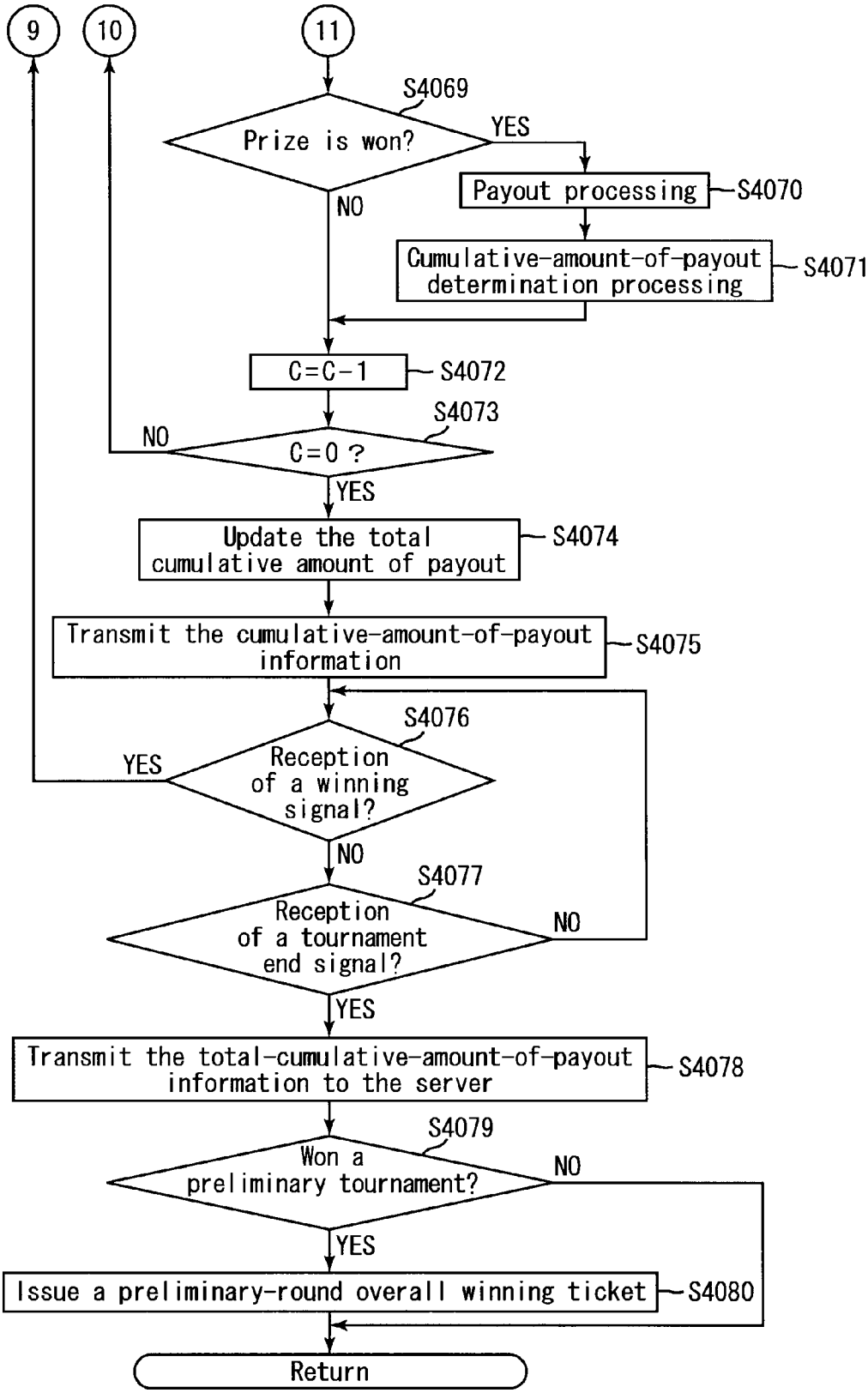

FIG. 120B is another flowchart illustrating the subroutine of the tournament-type game execution processing.

Figure 121:
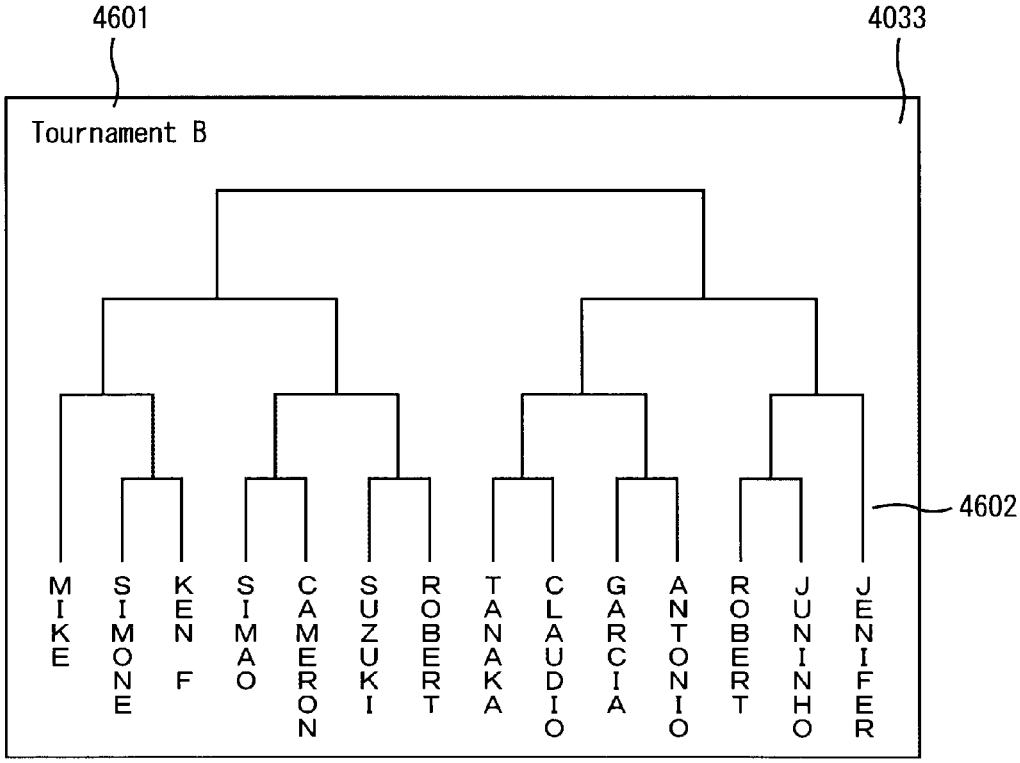

FIG. 121 is a view illustrating an exemplary image that is displayed to an upper image display panel provided in each slot machine constituting the ticket issuing system according to the fifth embodiment of the present invention.

Figure 122:
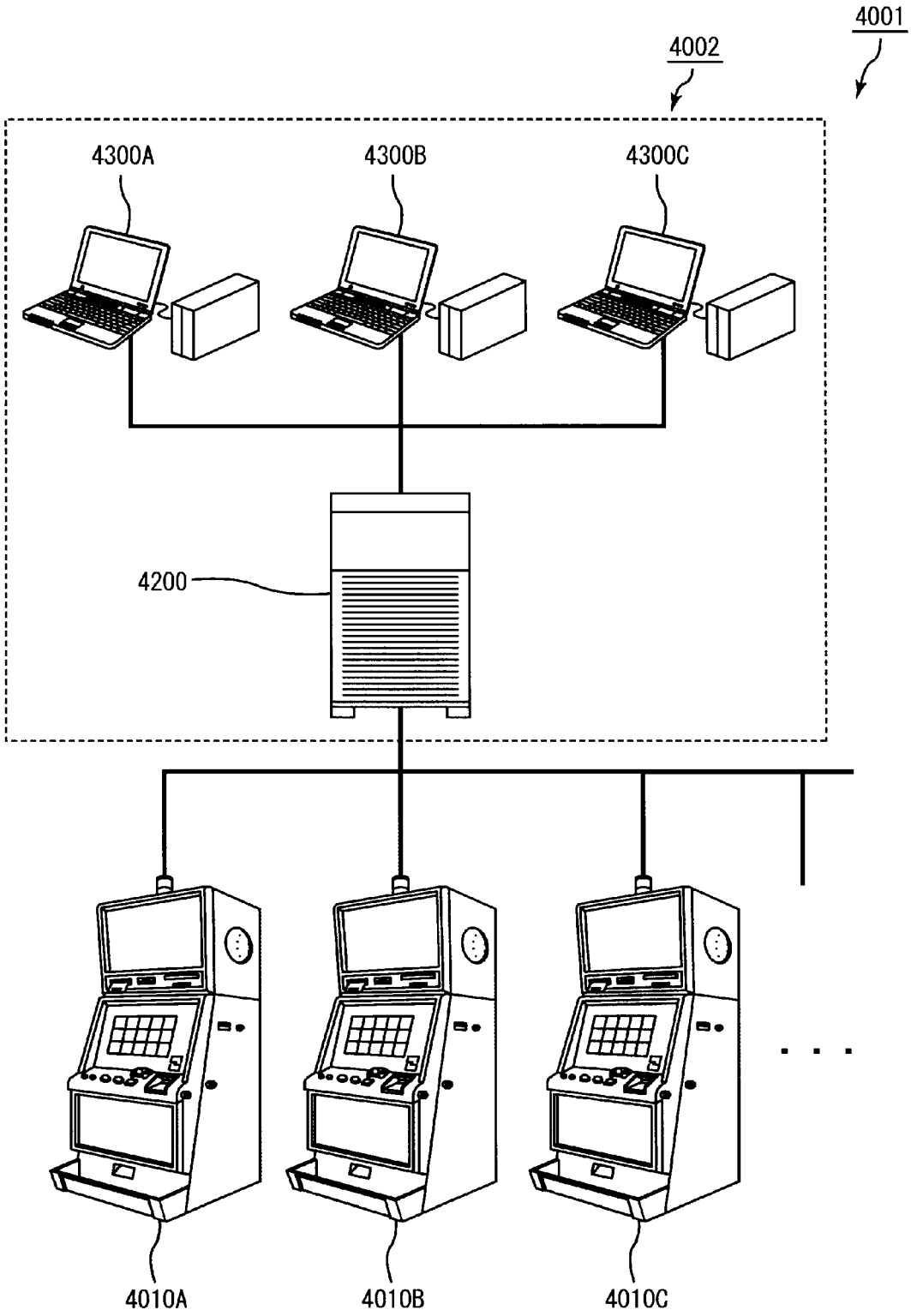

FIG. 122 is a schematic view illustrating an entire configuration of a gaming system according to a sixth embodiment of the present invention.

Figure 123:
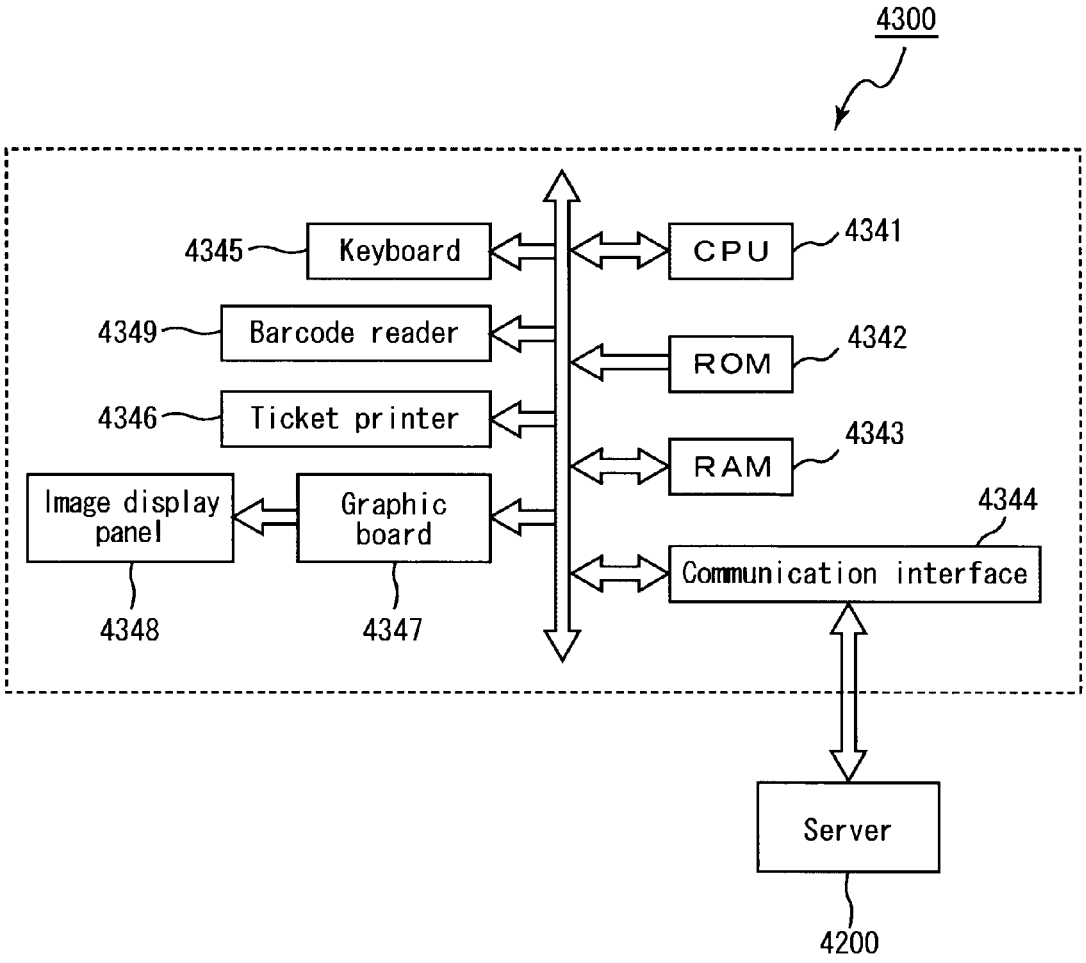

FIG. 123 is a block diagram illustrating an internal configuration of a ticket issuing device constituting a ticket issuing system according to the sixth embodiment of the present invention.

Figure 124:
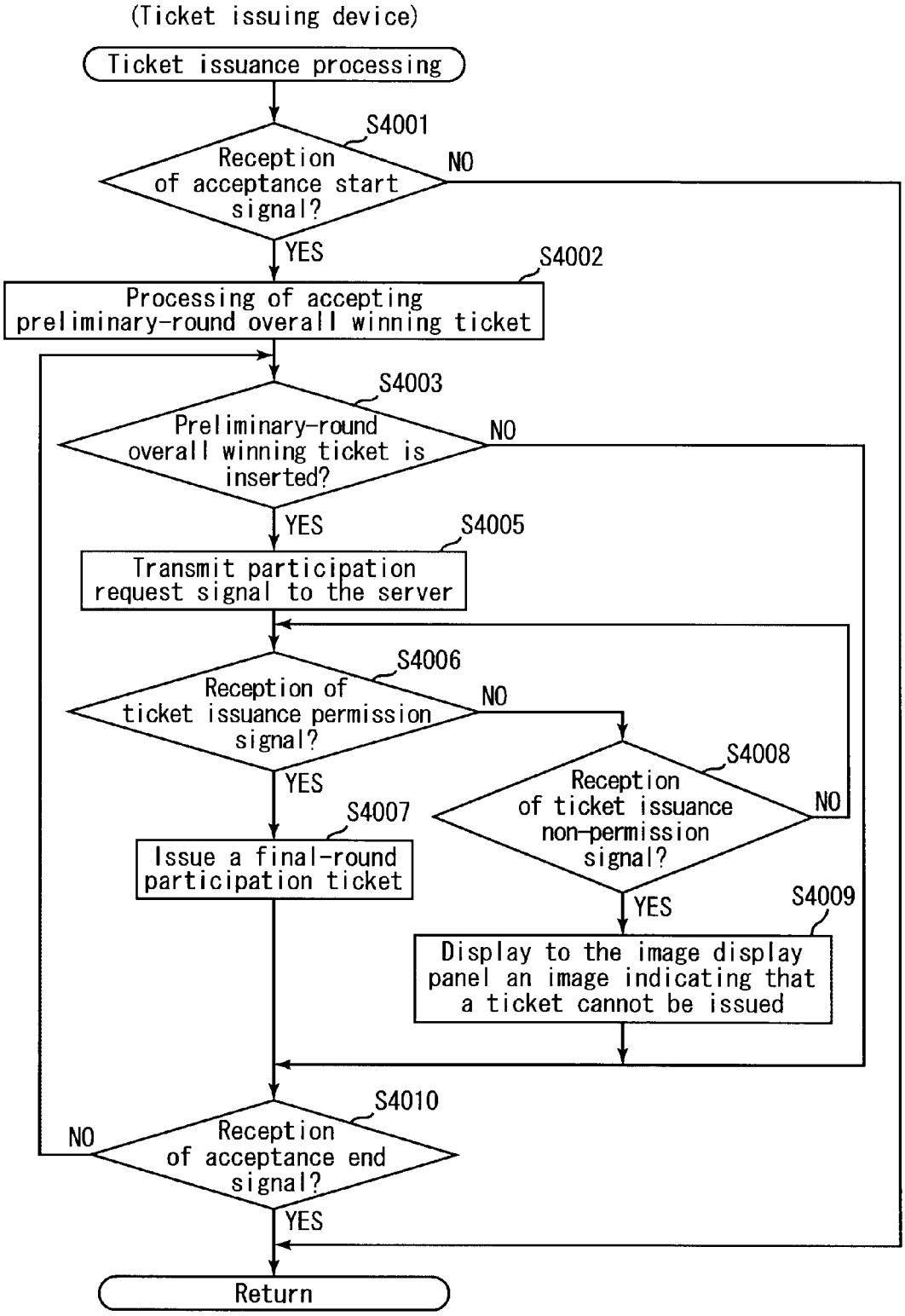

FIG. 124 is a flowchart illustrating ticket issuing processing that is executed in each ticket issuing device according to the sixth embodiment of the present invention.

Figure 125:
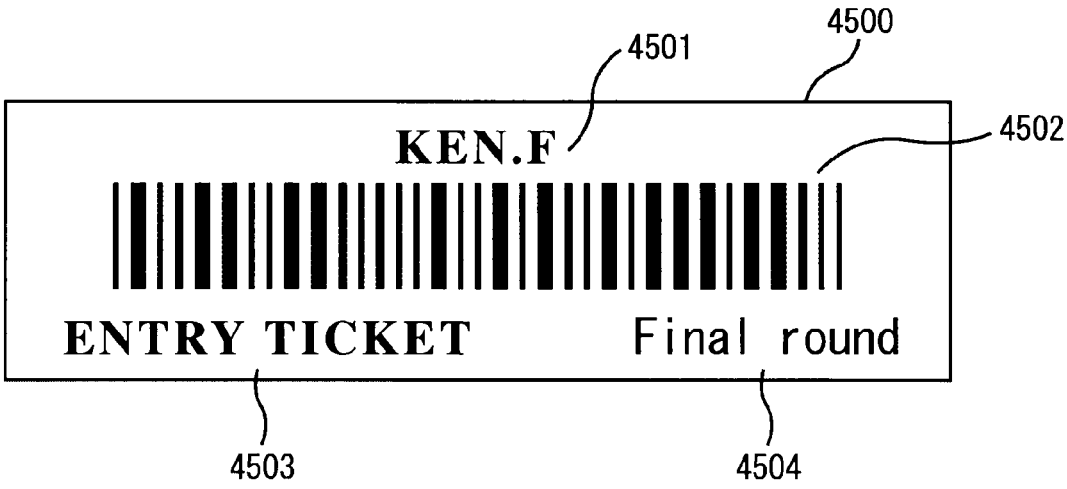

FIG. 125 is a view illustrating an exemplary participation ticket issued from a ticket issuing device according to the sixth embodiment of the present invention.

Figure 126:
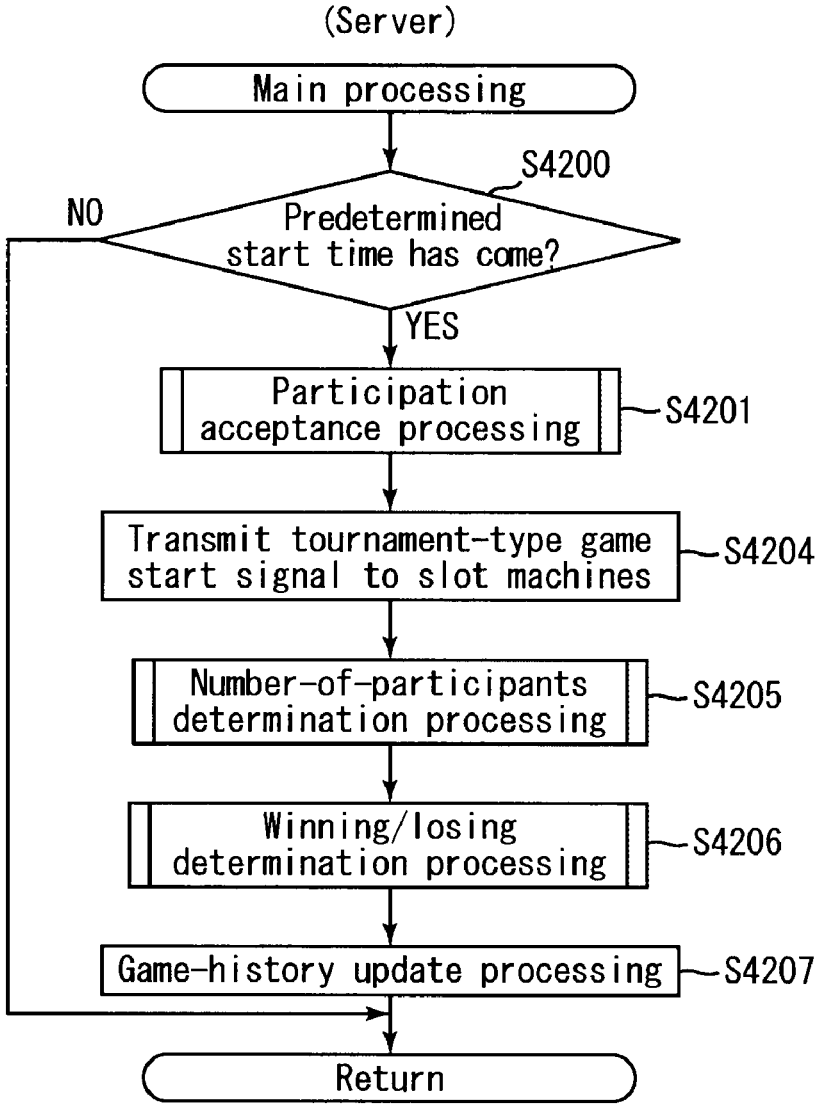

FIG. 126 is a flowchart illustrating main processing executed in a server according to the sixth embodiment of the present invention.

Figure 127:
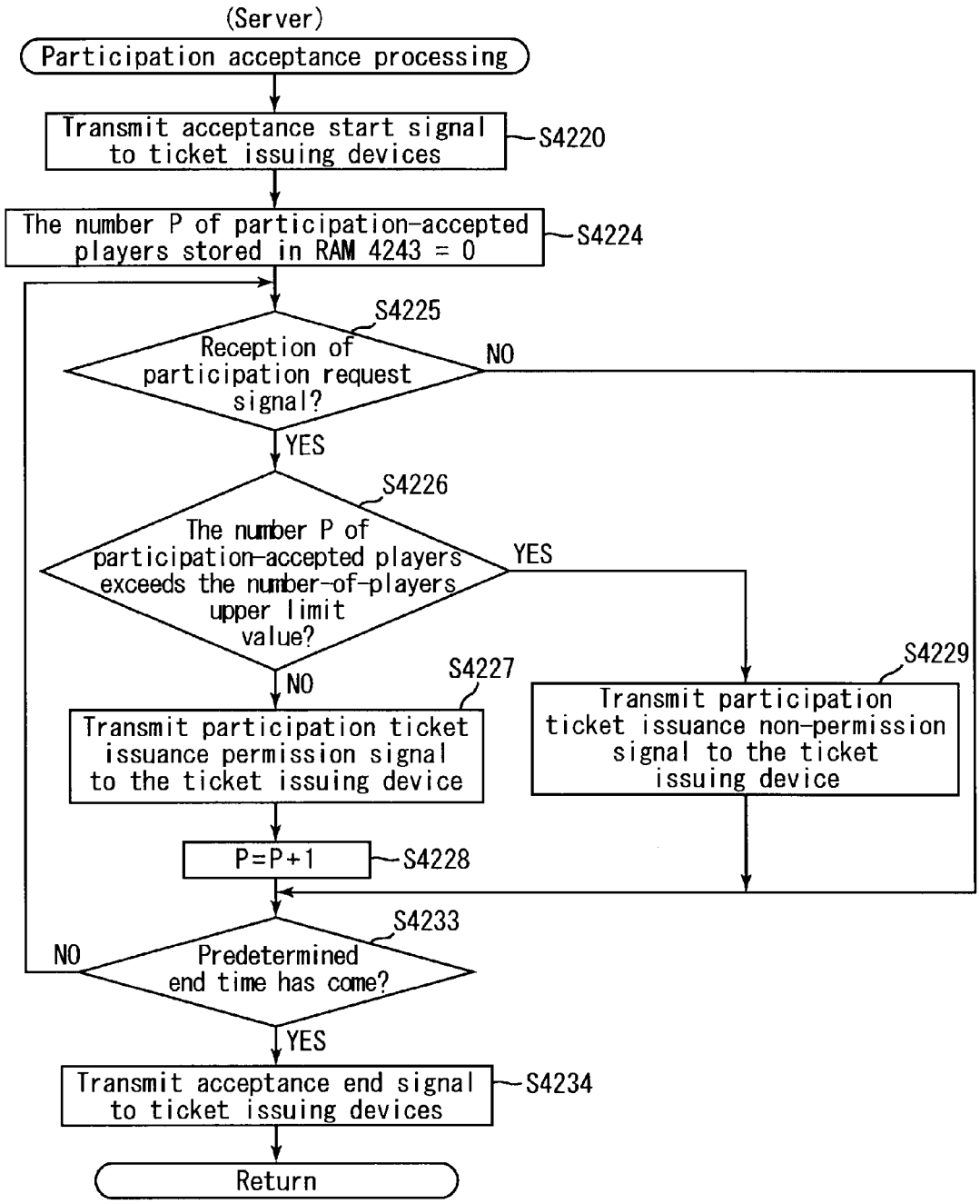

FIG. 127 is a flowchart illustrating participation acceptance processing that is executed in the server according to the sixth embodiment of the present invention.

Figure 128:
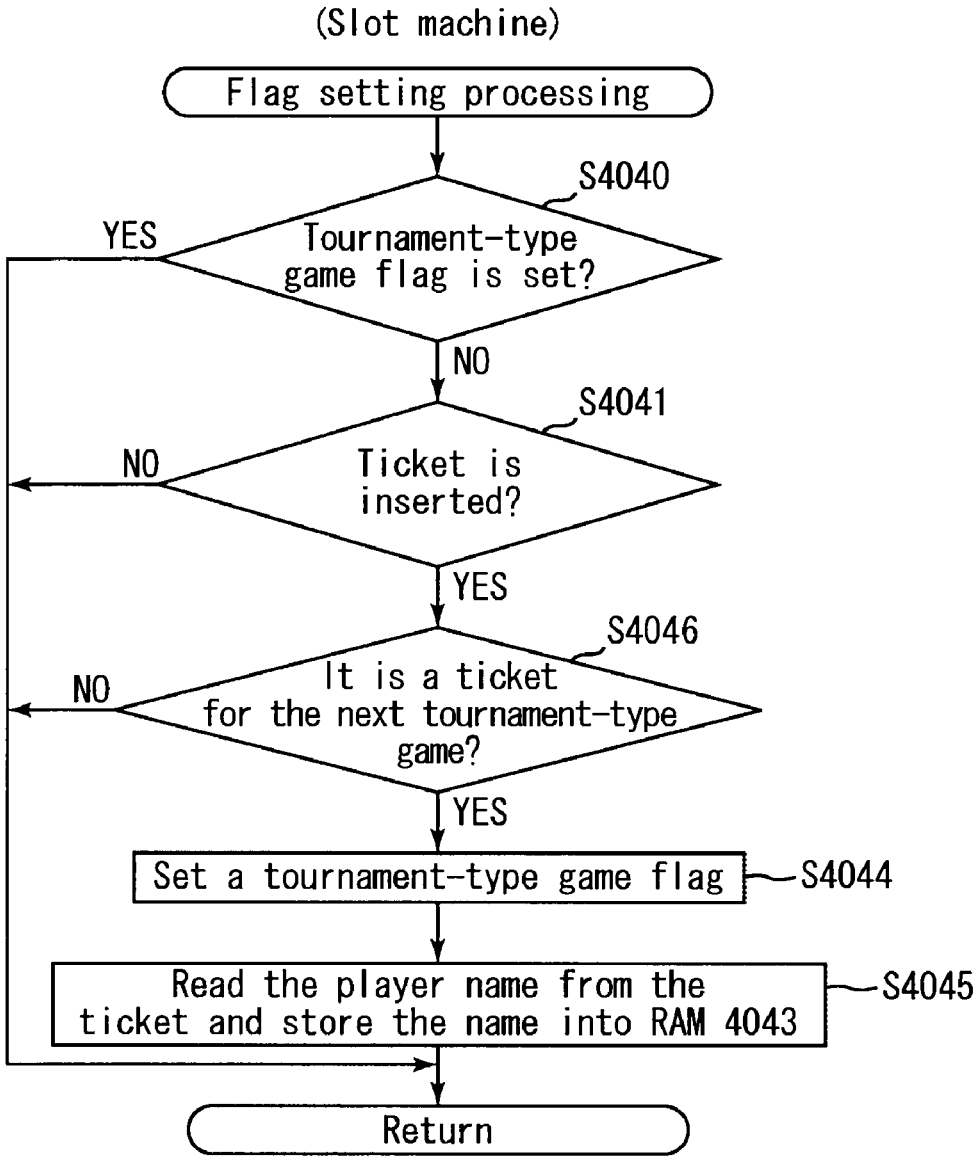

FIG. 128 is a flowchart illustrating a subroutine of flag setting processing that is executed in a slot machine according to the sixth embodiment of the present invention.

Figure 129A:
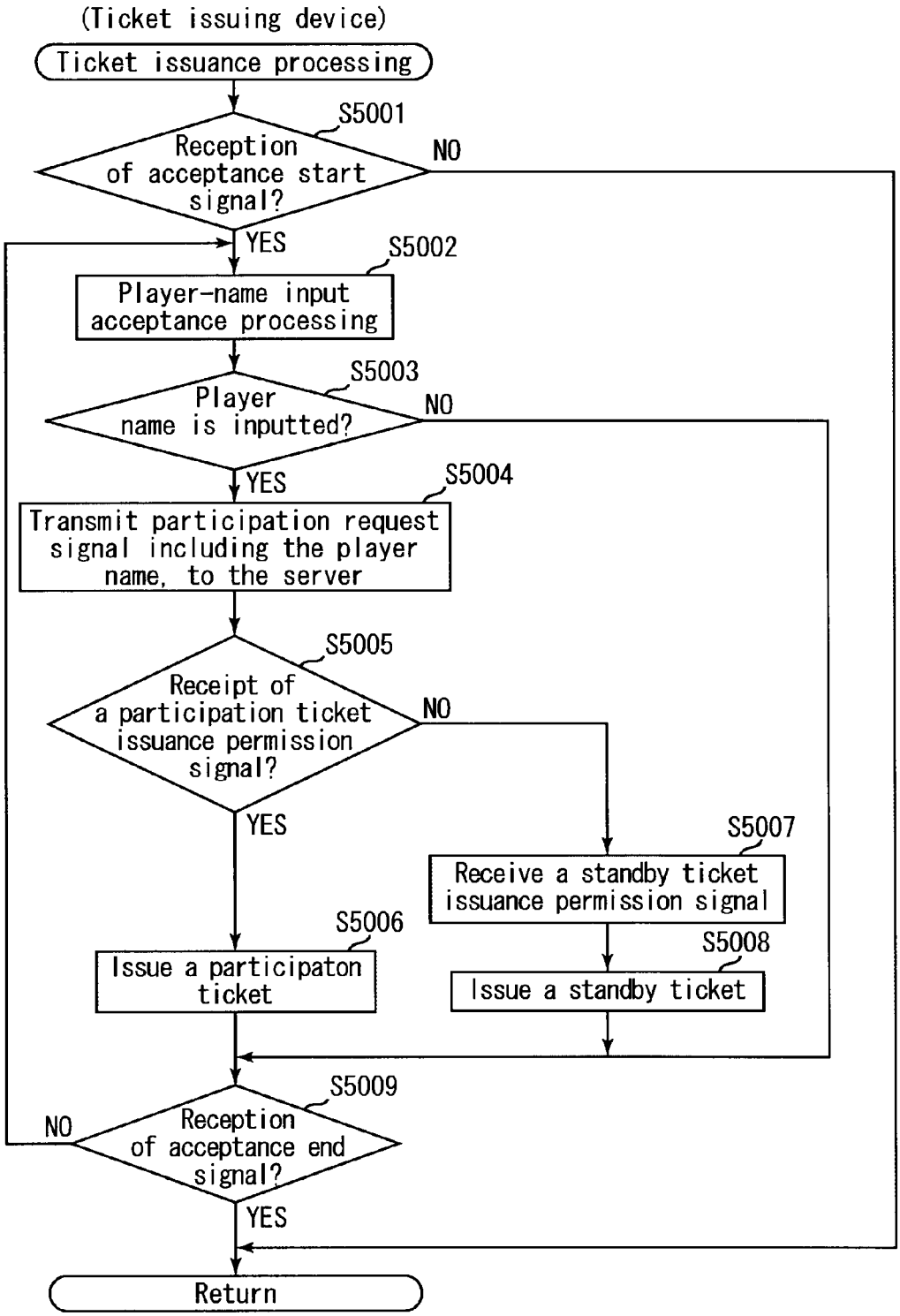

FIG. 129A is a flowchart illustrating ticket issuance processing executed in each ticket issuing device according to a seventh embodiment of the present embodiment.

Figure 129B:
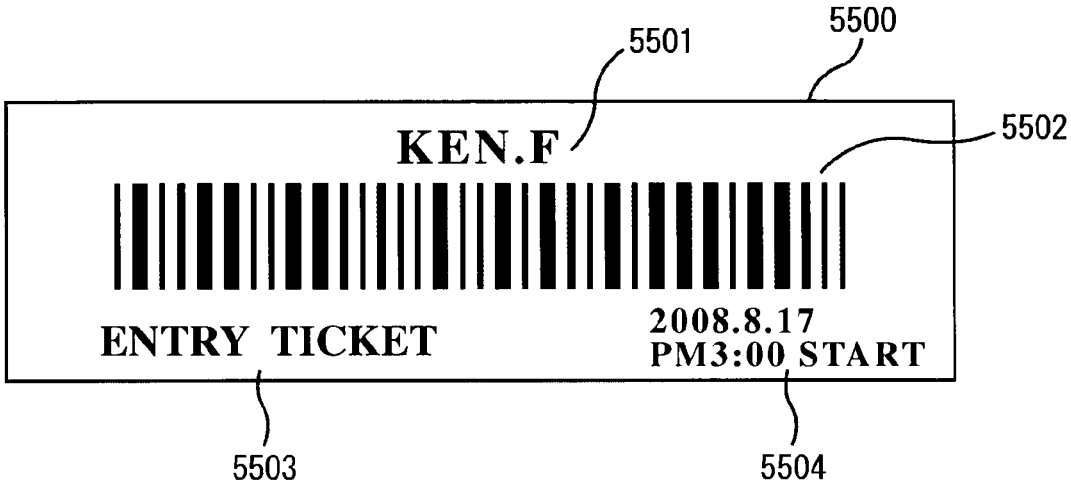

FIG. 129B is a view illustrating an exemplary participation ticket which is issued from a ticket issuing device according to the seventh embodiment of the present embodiment.

Figure 129C:
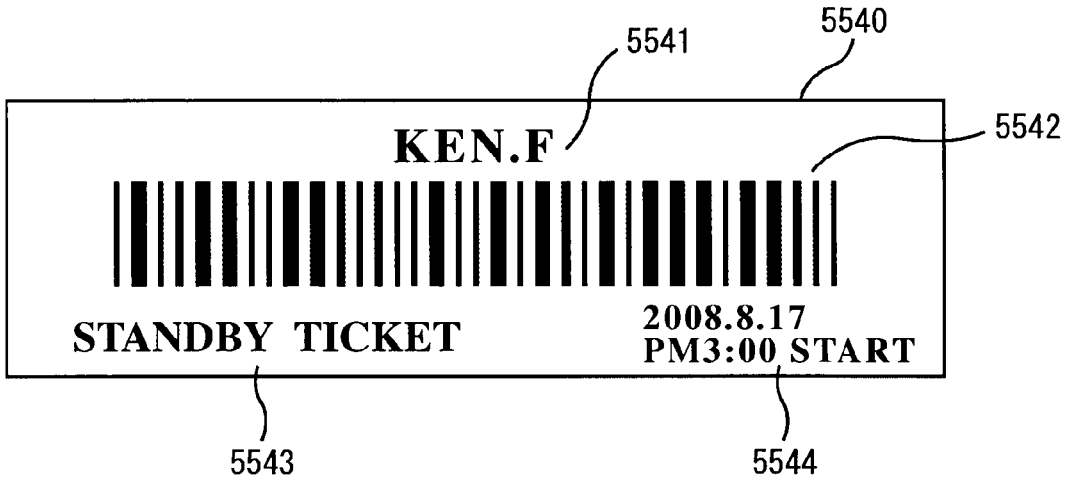

FIG. 129C is a view illustrating an exemplary standby ticket which is issued from a ticket issuing device according to the seventh embodiment of the present invention.

Figure 129D:
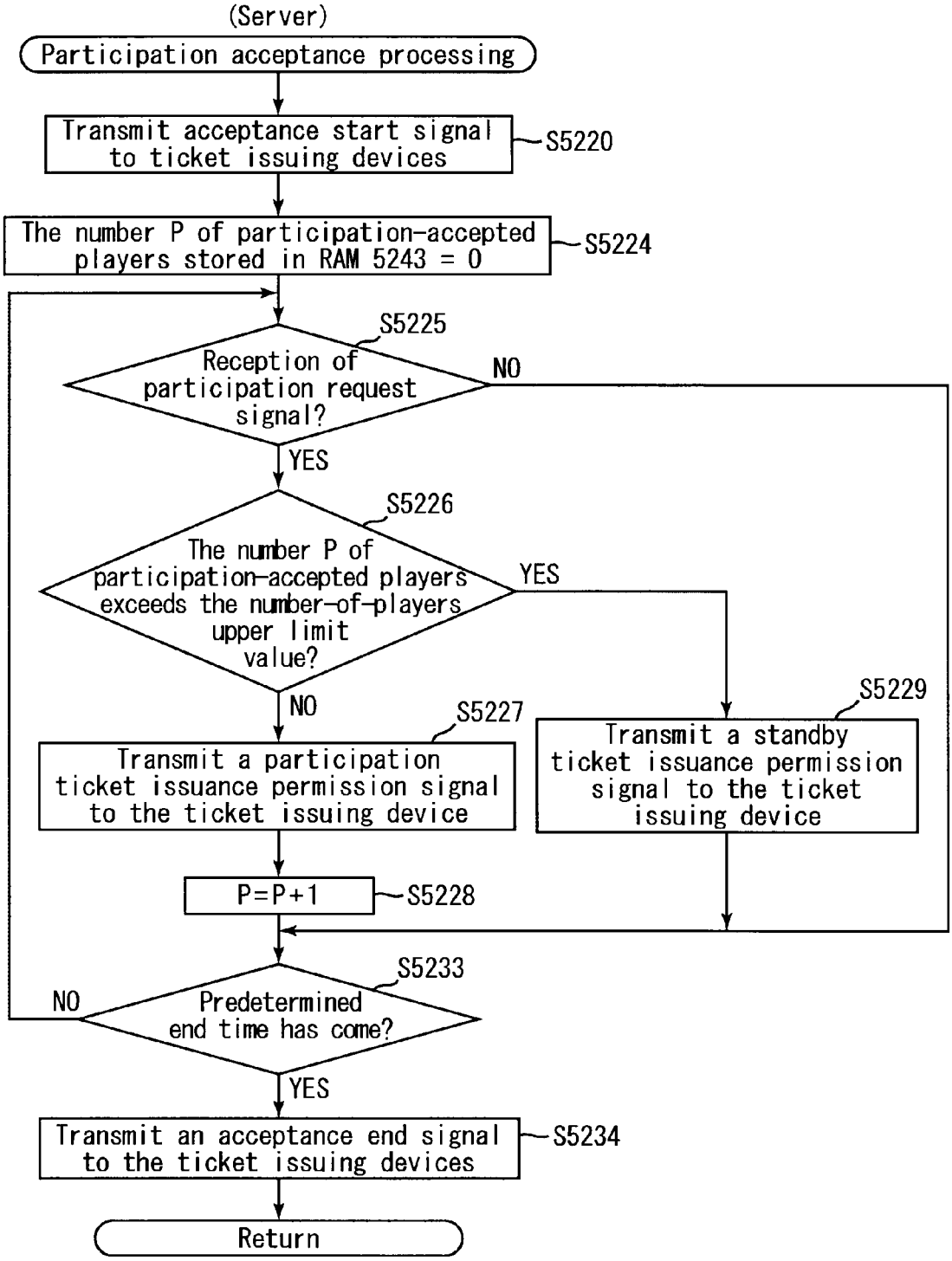

FIG. 129D is a flowchart illustrating participation acceptance processing executed in a server according to the seventh embodiment of the present invention.

Figure 129E:
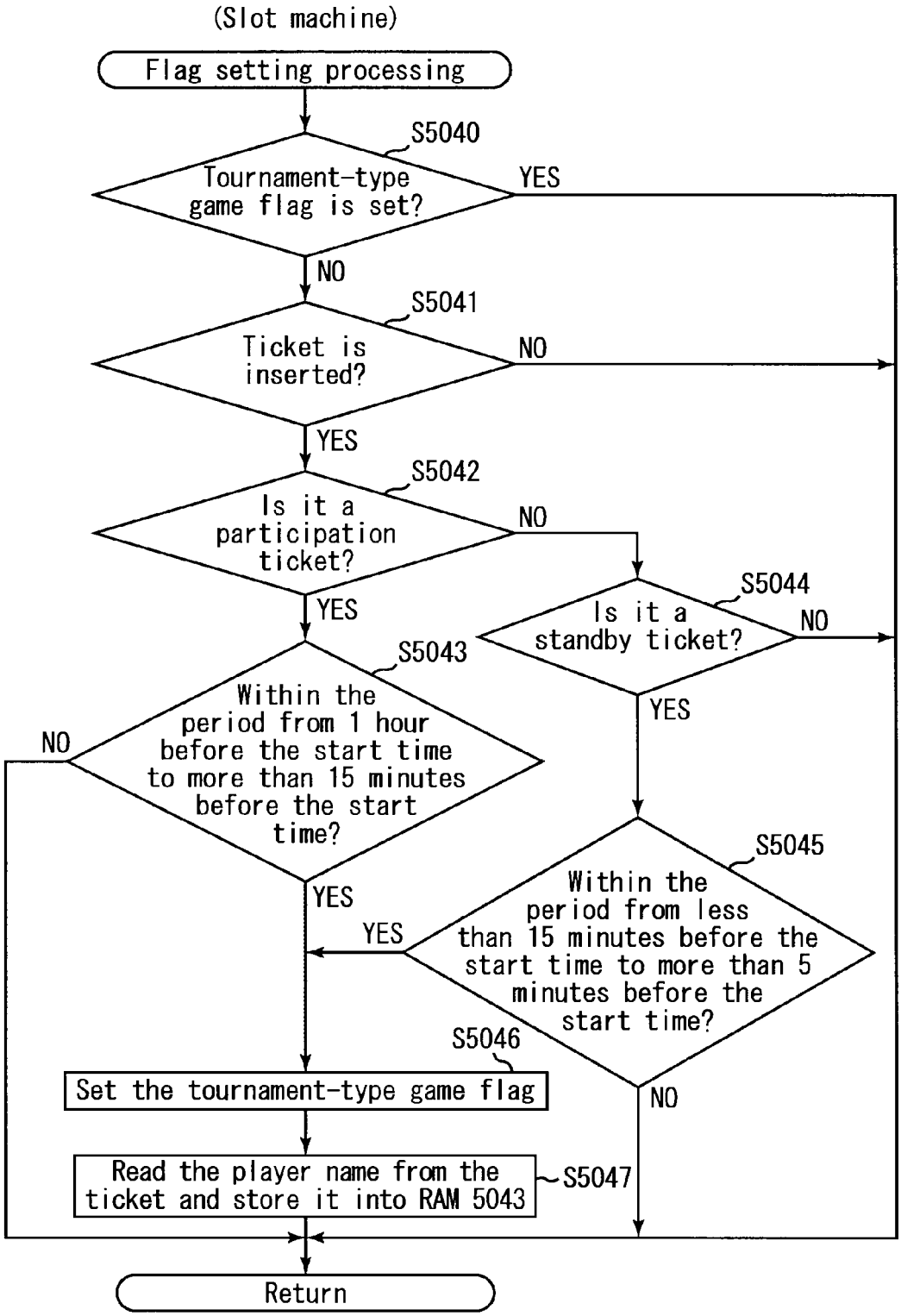

FIG. 129E is a flowchart illustrating a subroutine of flag setting processing that is executed in each slot machine according to the seventh embodiment of the present invention.

Figure 130:
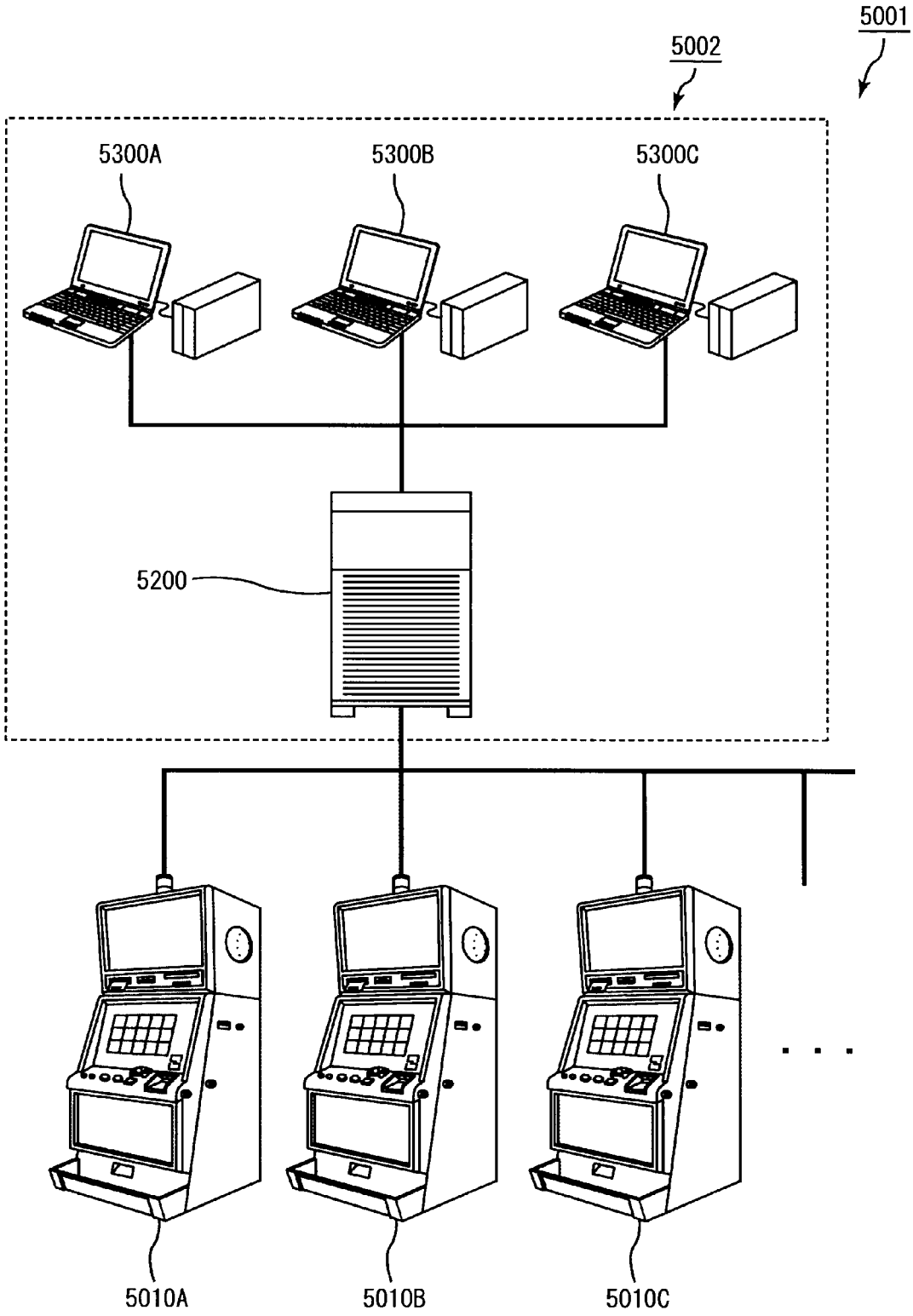

FIG. 130 is a schematic view illustrating an entire configuration of a gaming system according to the seventh embodiment of the present invention.

Figure 131:
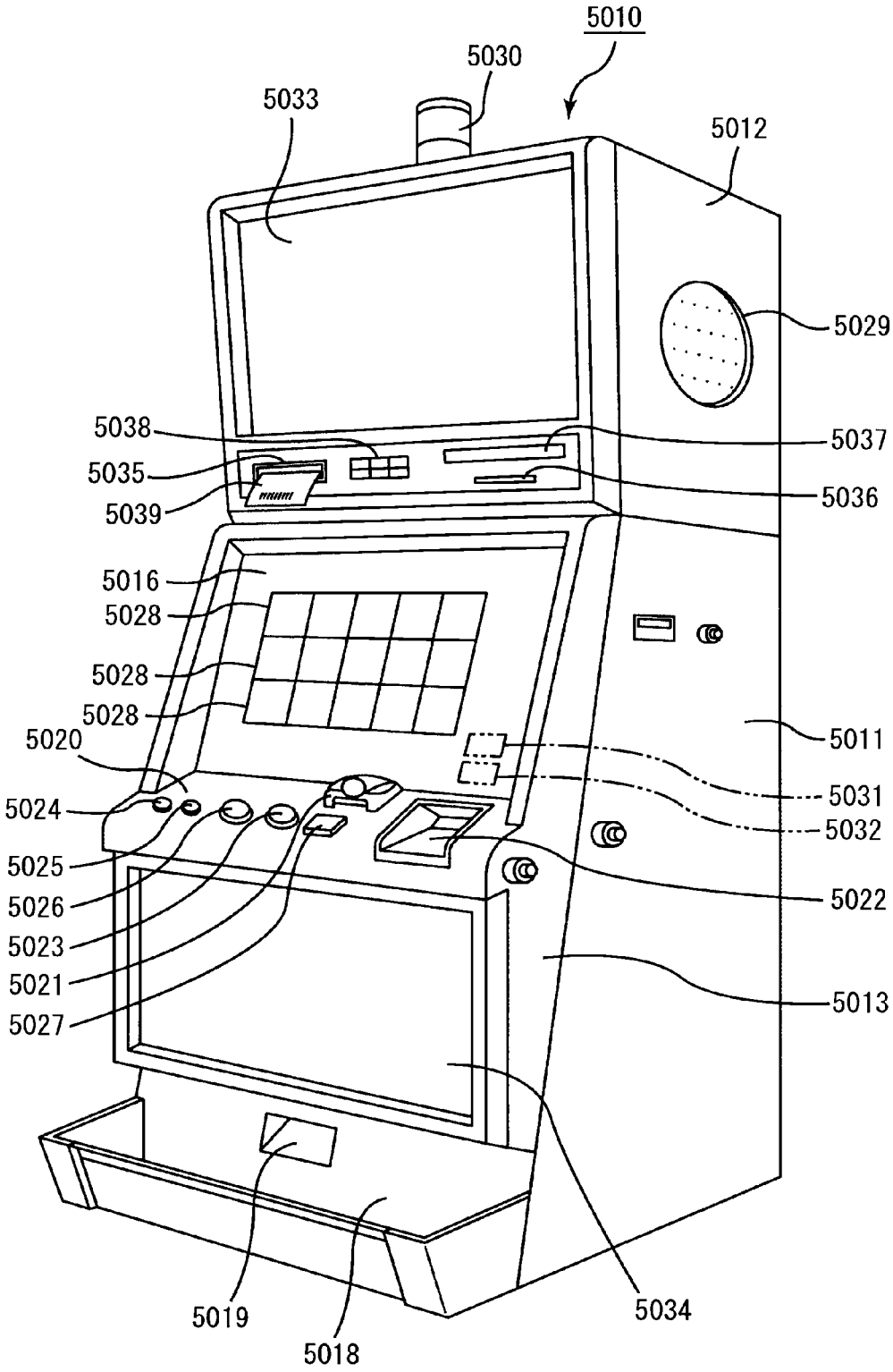

FIG. 131 is a perspective view illustrating an external view of a slot machine according to the seventh embodiment of the present invention.

Figure 132:
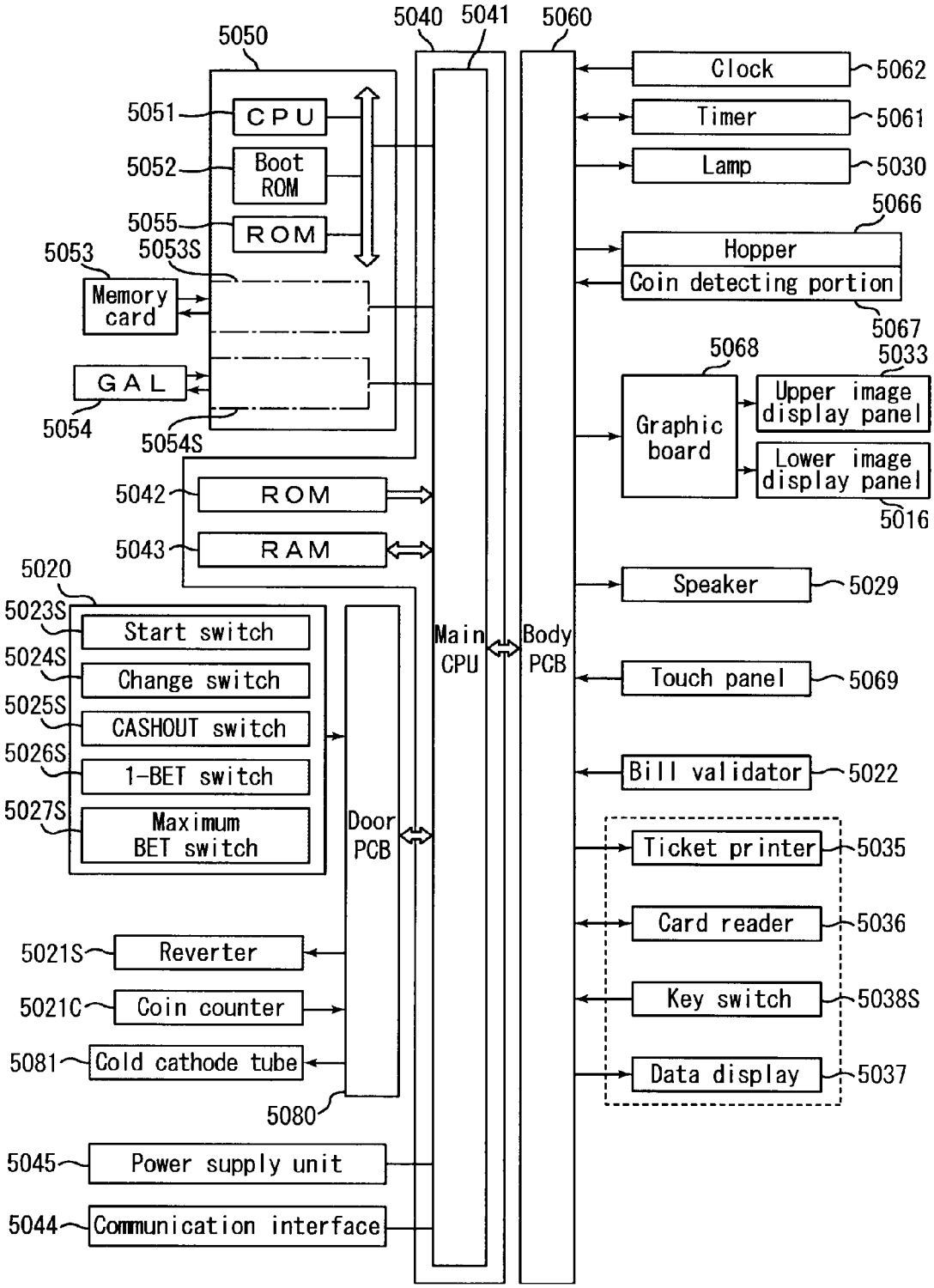

FIG. 132 is a block diagram illustrating an internal configuration of the slot machine shown in FIG. 131.

Figure 133:
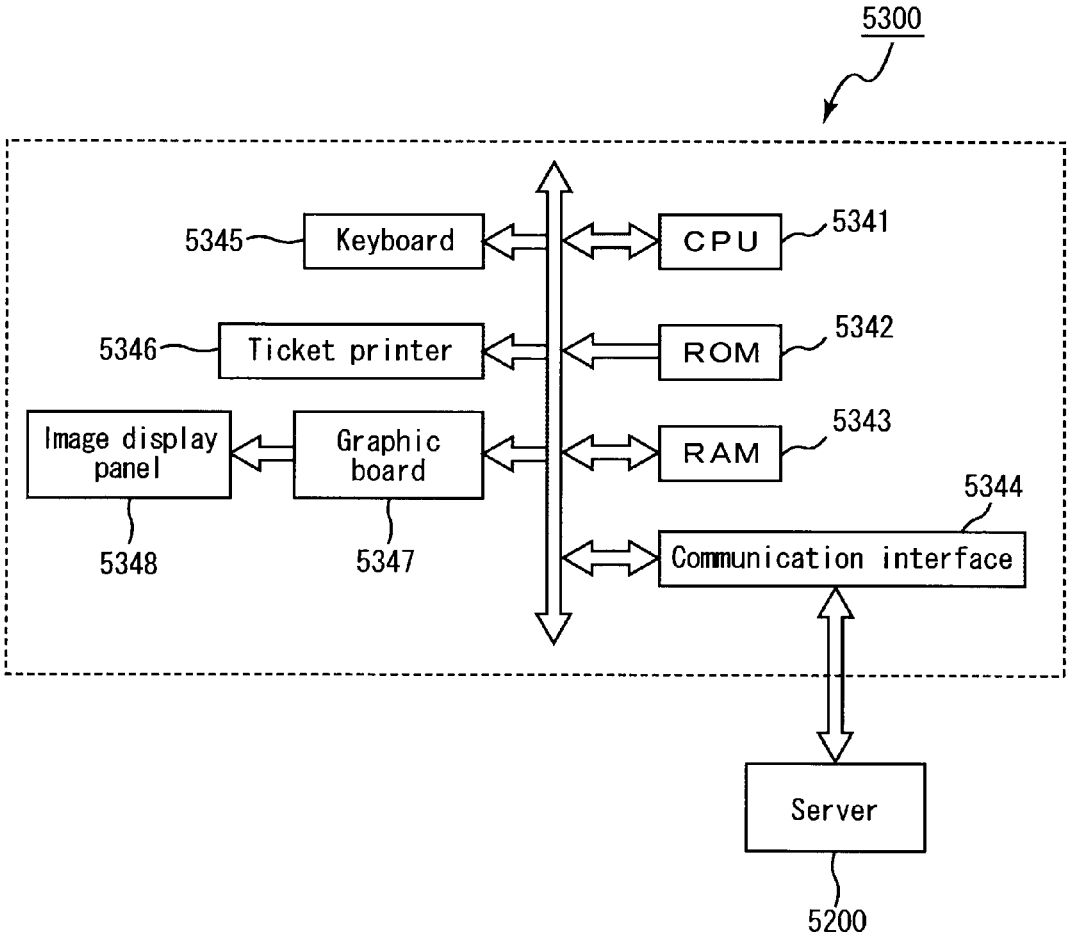
FIG. 133 is another flowchart illustrating the subroutine of the third participation acceptance processing.

FIG. 133 is a block diagram illustrating an internal configuration of a ticket issuing device constituting a ticket issuing system according to the seventh embodiment of the present invention.

Figure 134:
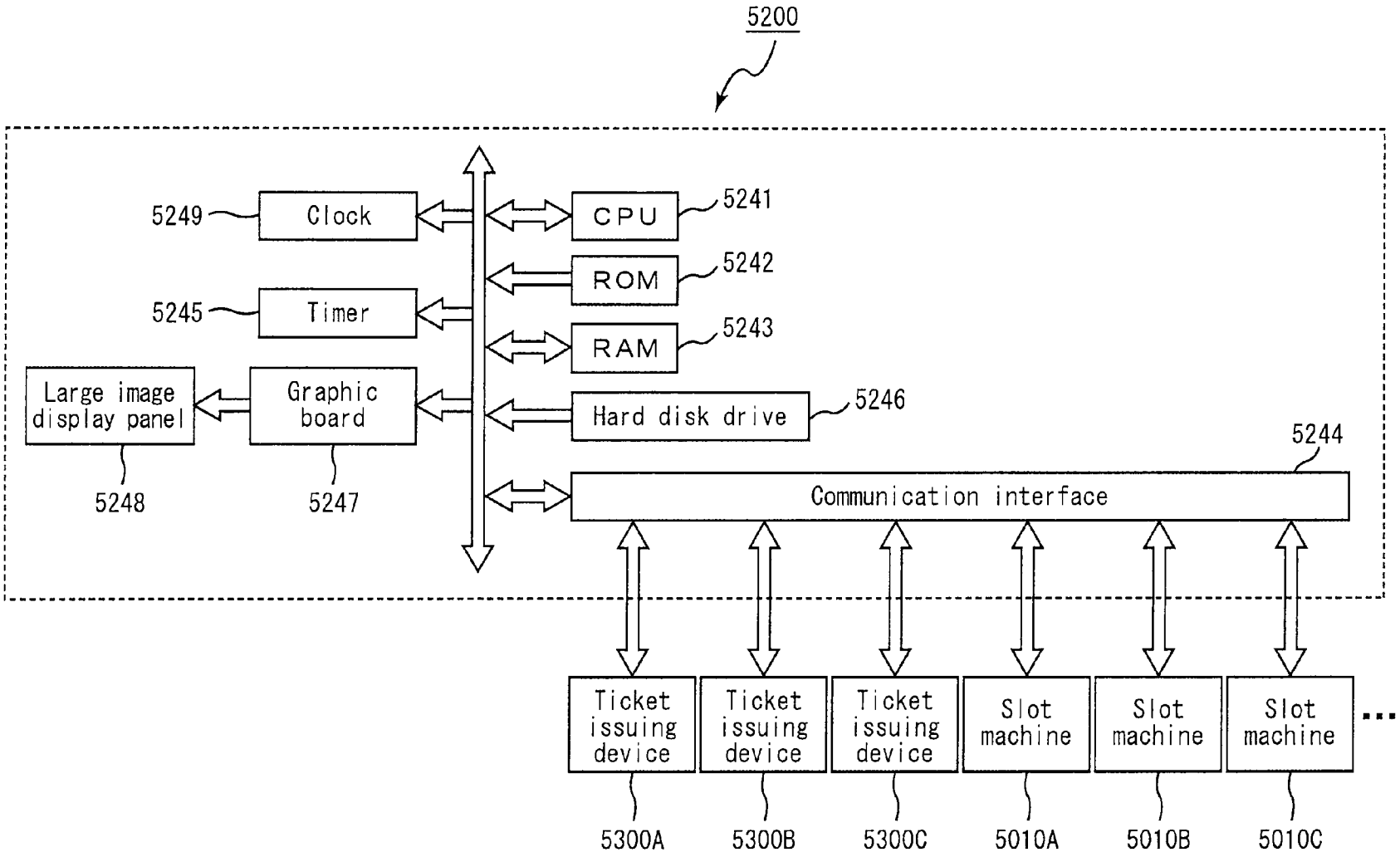

FIG. 134 is a block diagram illustrating an internal configuration of a server constituting the ticket issuing system according to the seventh embodiment of the present invention.

FIG. 135 is a view illustrating exemplary game-history data stored in a hard disk that is provided in the server.

Figure 136:
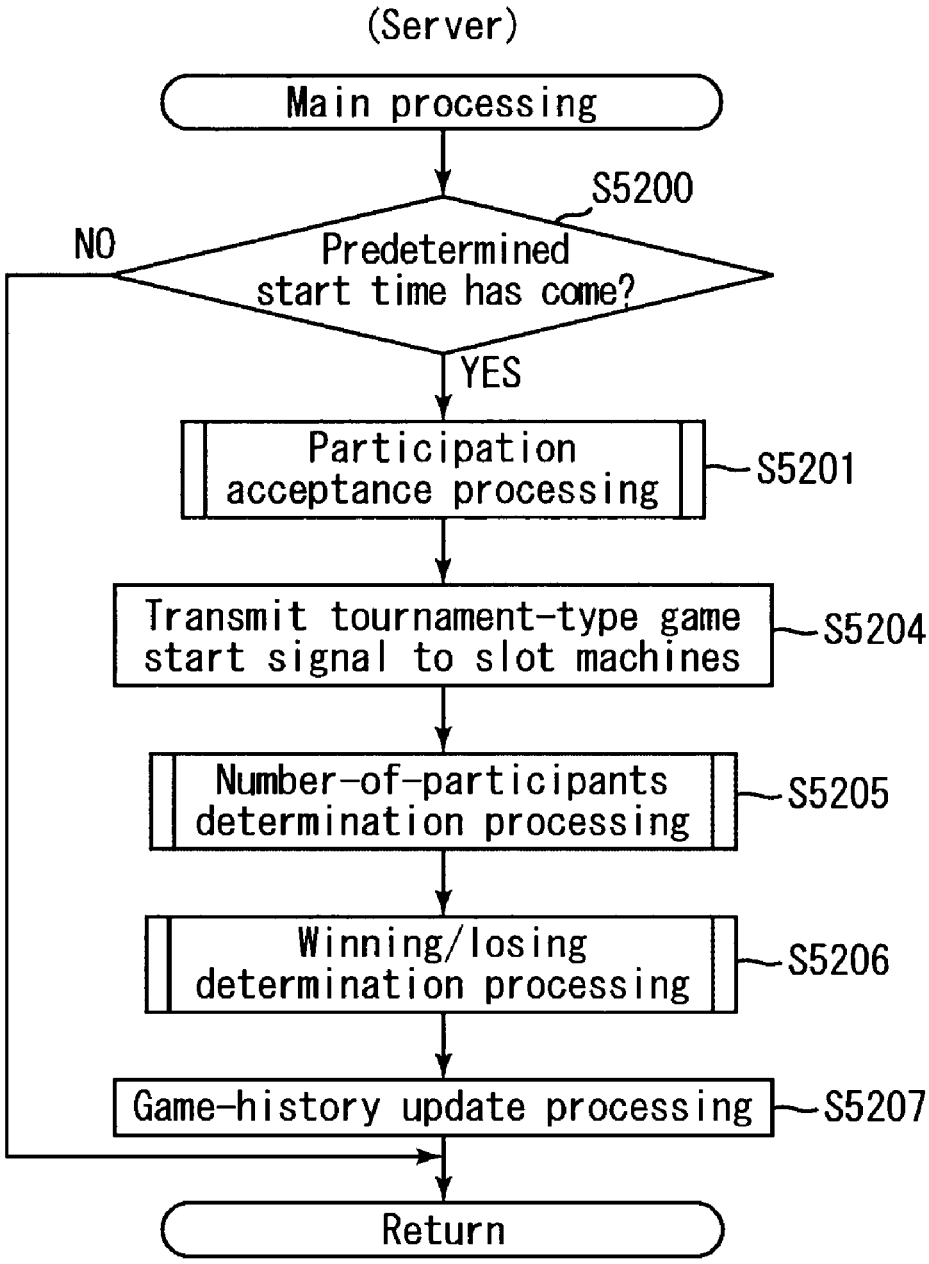

FIG. 136 is a flowchart illustrating main processing that is executed in the server.

Figure 137:
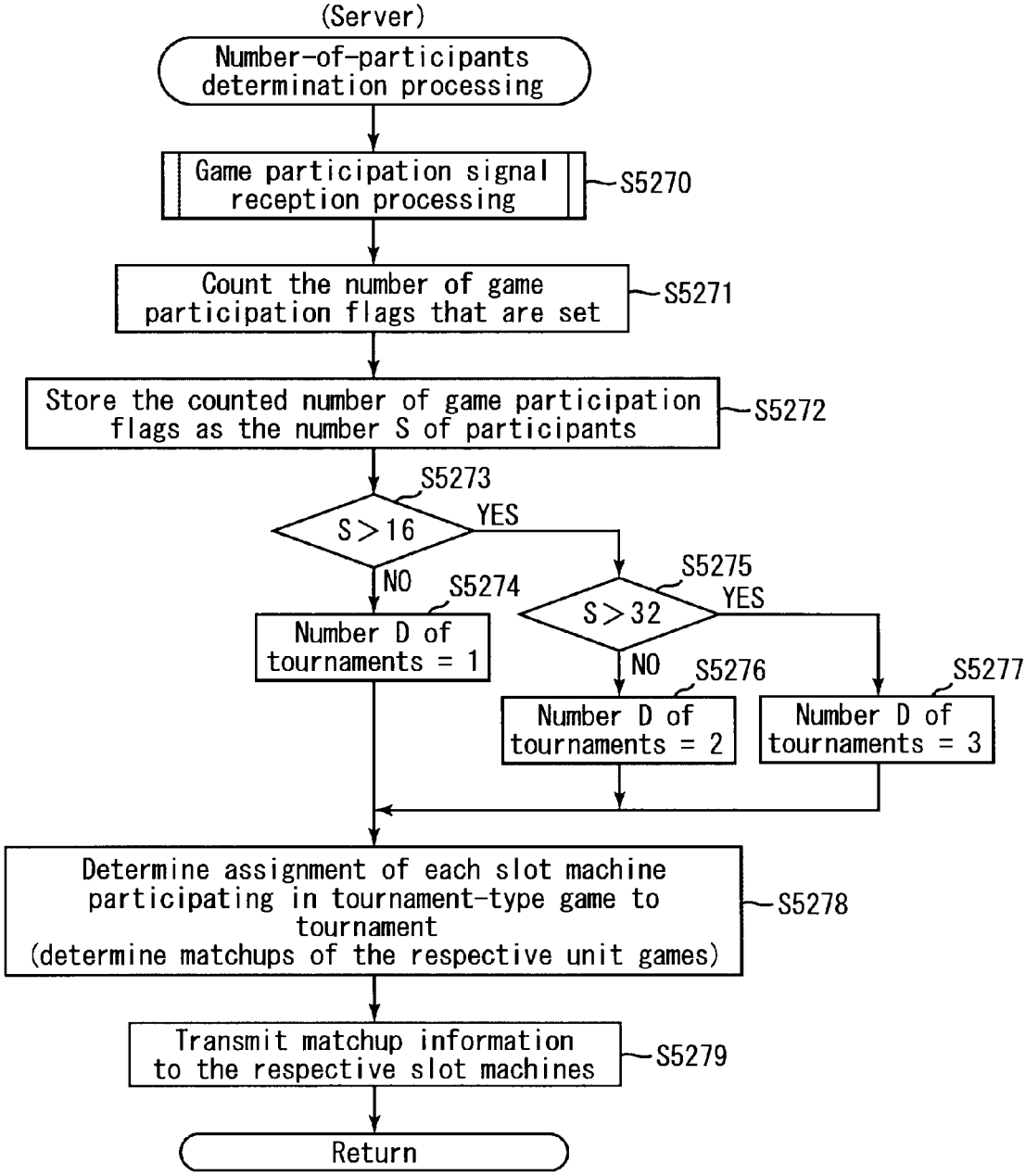

FIG. 137 is a flowchart illustrating a subroutine of number-of-participants determination processing.

Figure 138:
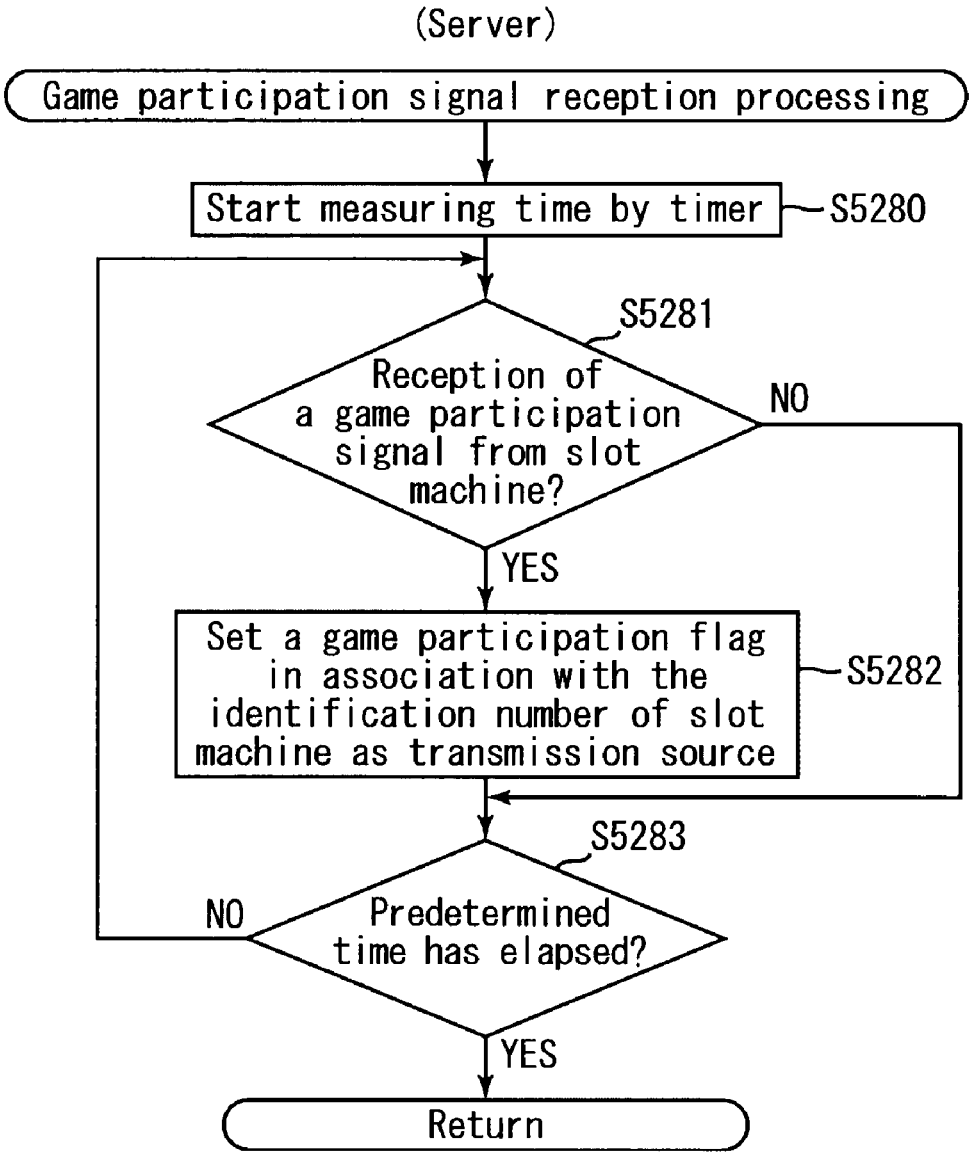

FIG. 138 is a flowchart illustrating a subroutine of game participation signal reception processing.

Figure 139A:
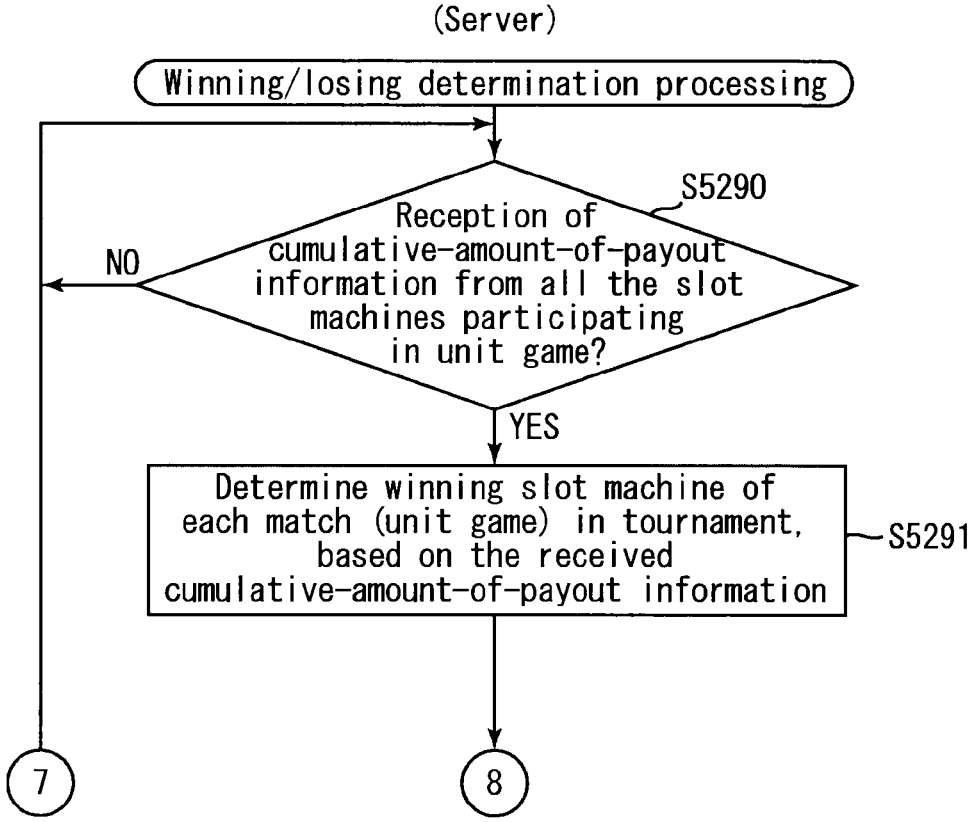

FIG. 139A is a flowchart illustrating a subroutine of winning/losing determination processing.

Figure 139B:
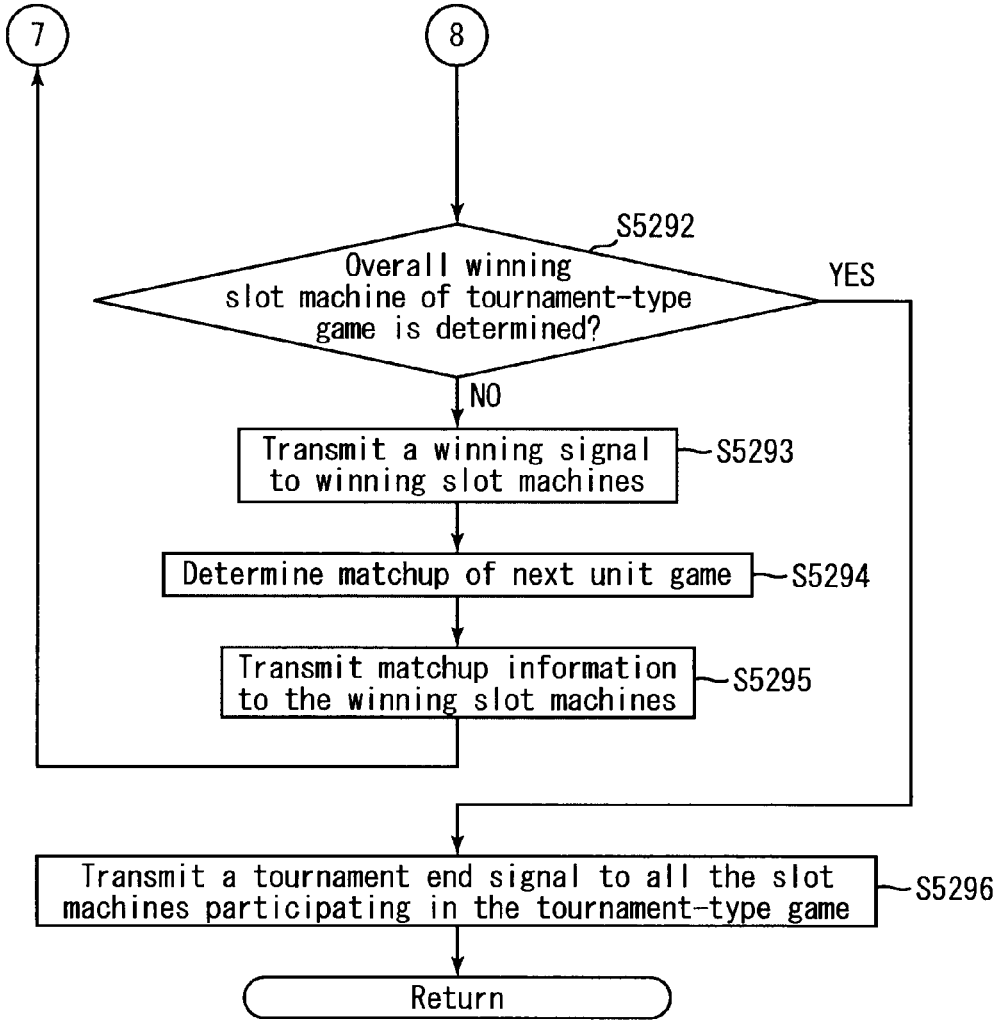

FIG. 139B is another flowchart illustrating the subroutine of the winning/losing determination processing.

Figure 140:
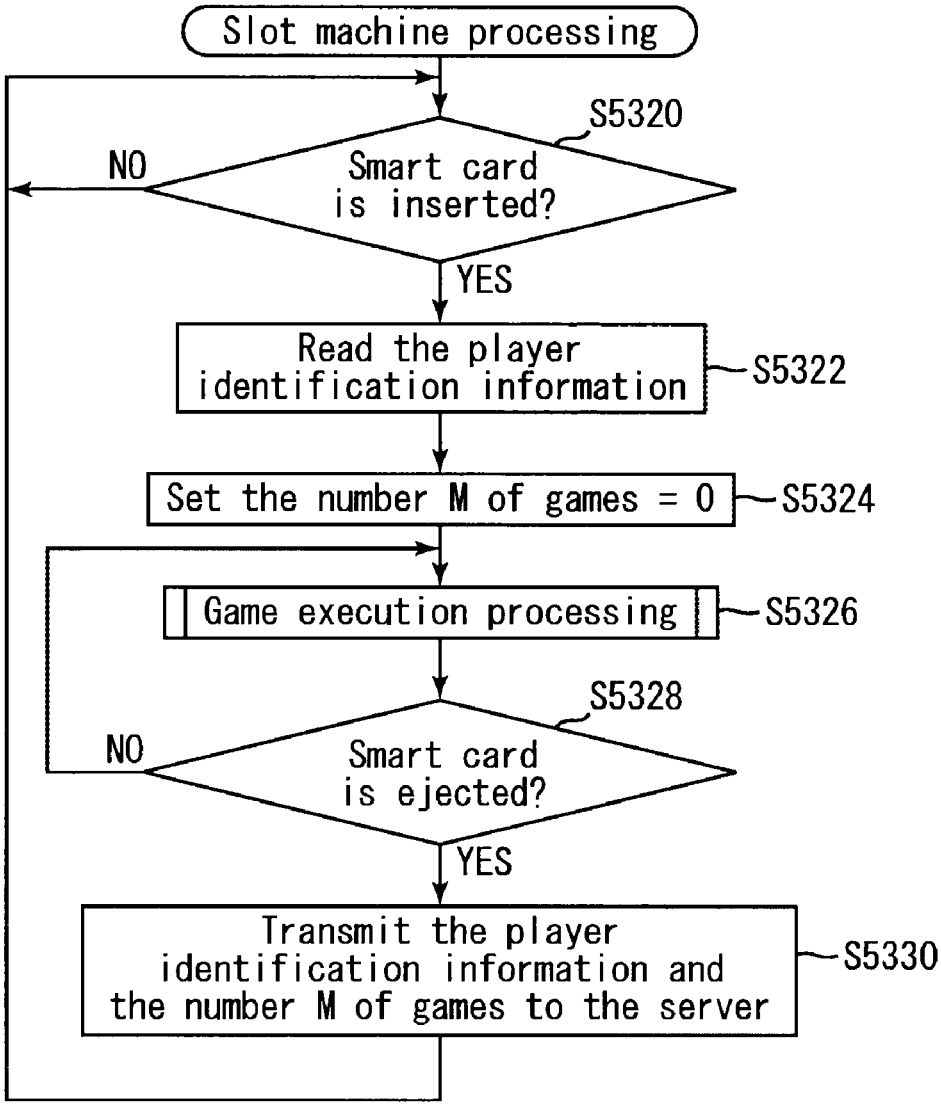

FIG. 140 is a flowchart illustrating slot machine processing that is executed in each slot machine.

Figure 141:
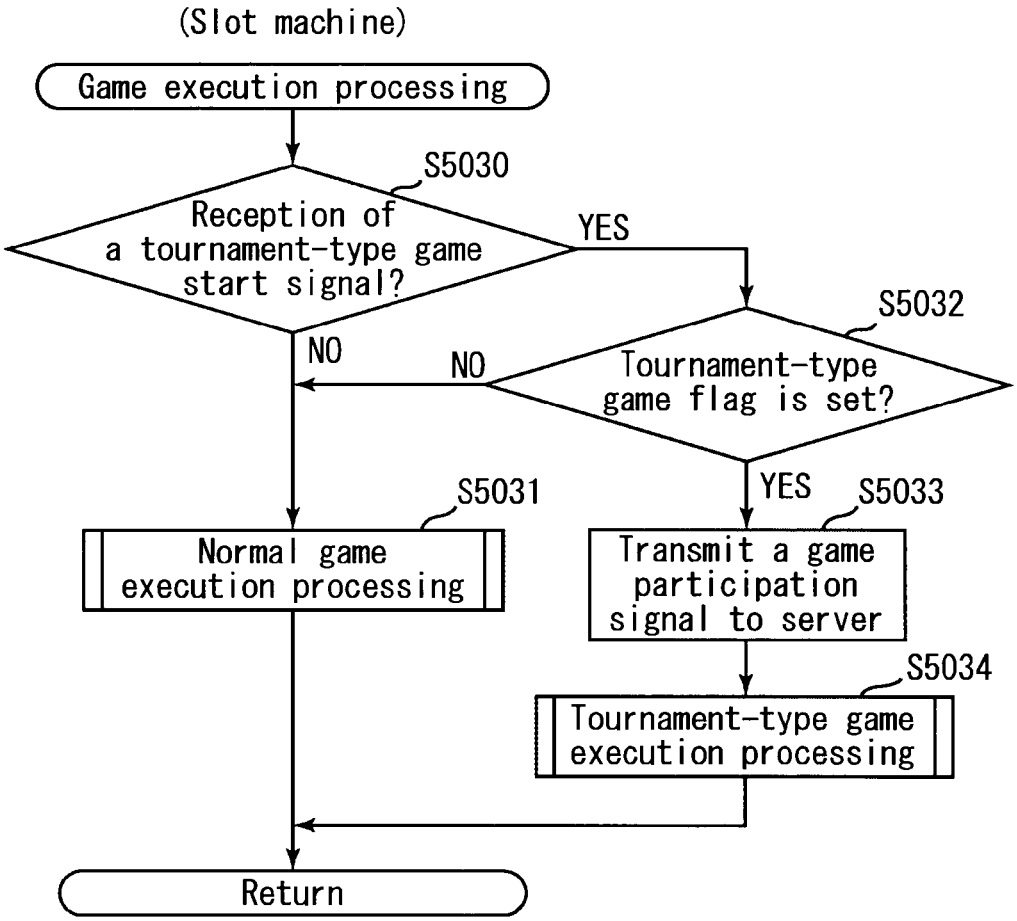

FIG. 141 is a flowchart illustrating game execution processing executed in each slot machine.

Figure 142:
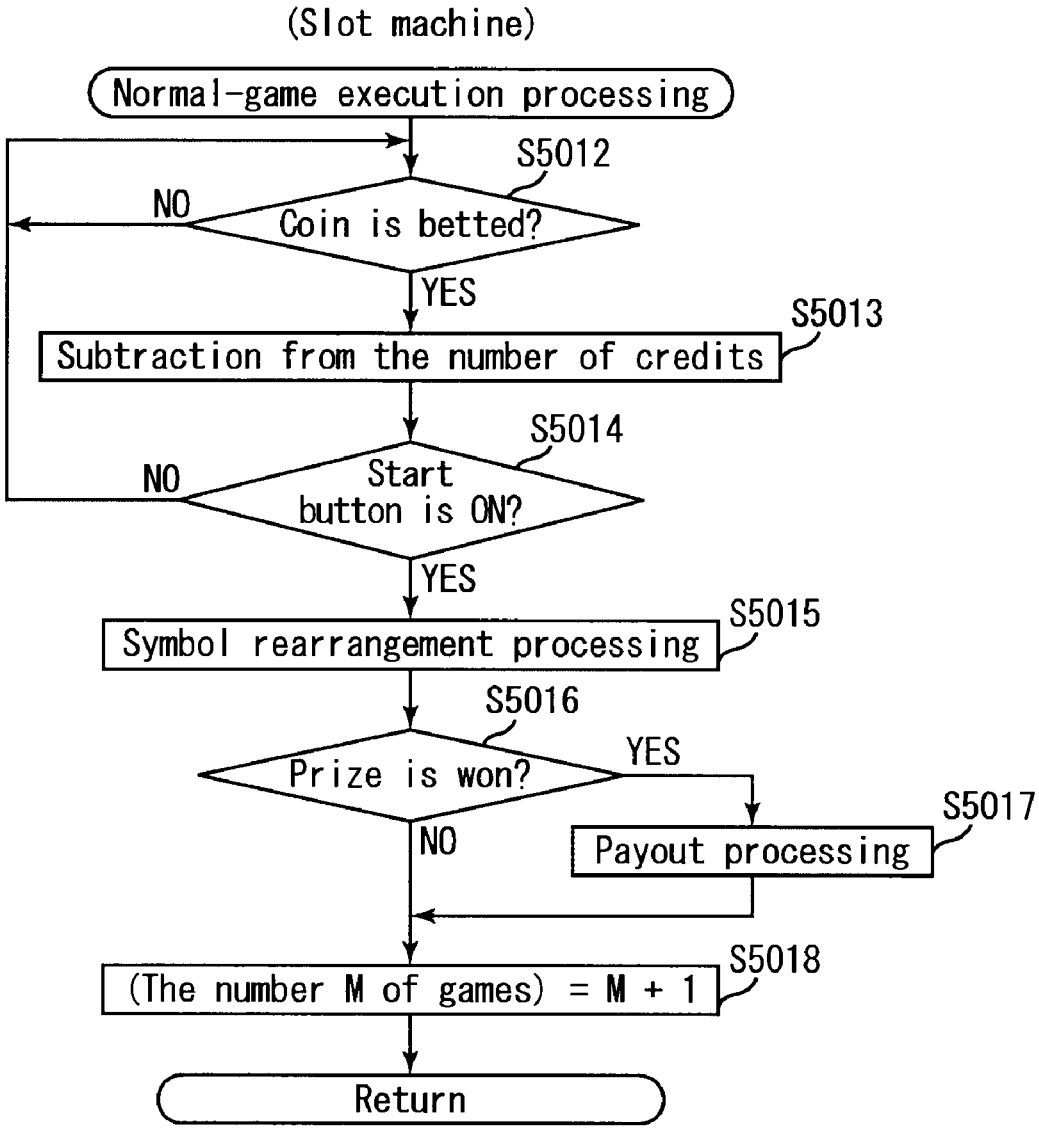

FIG. 142 is a flowchart illustrating a subroutine of normal-game execution processing.

FIG. 143 is a view illustrating correspondence relationship between a type and the number of rearranged symbols and an amount of payout.

Figure 144A:
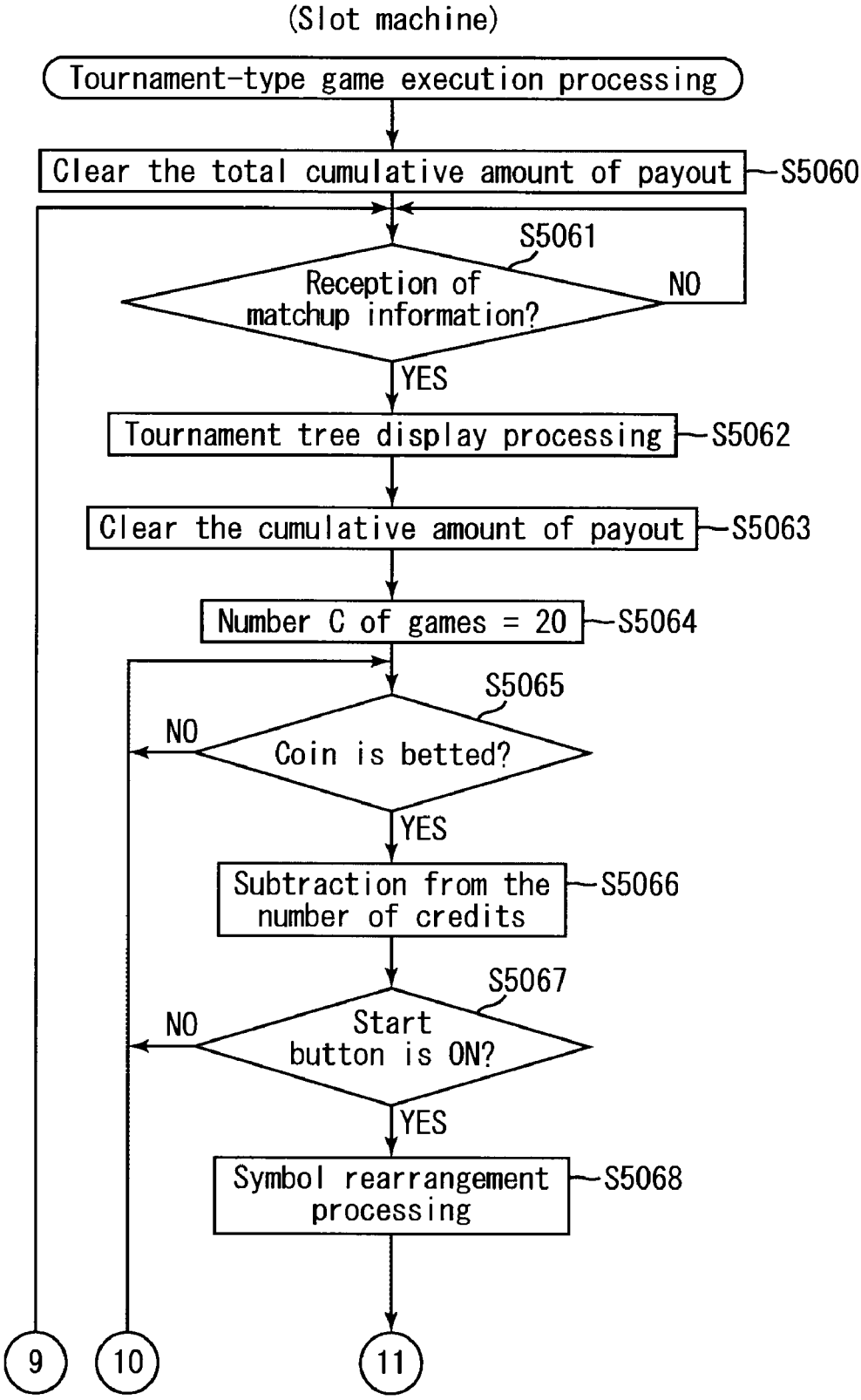

FIG. 144A is a flowchart illustrating a subroutine of tournament-type game execution processing.

Figure 144B:
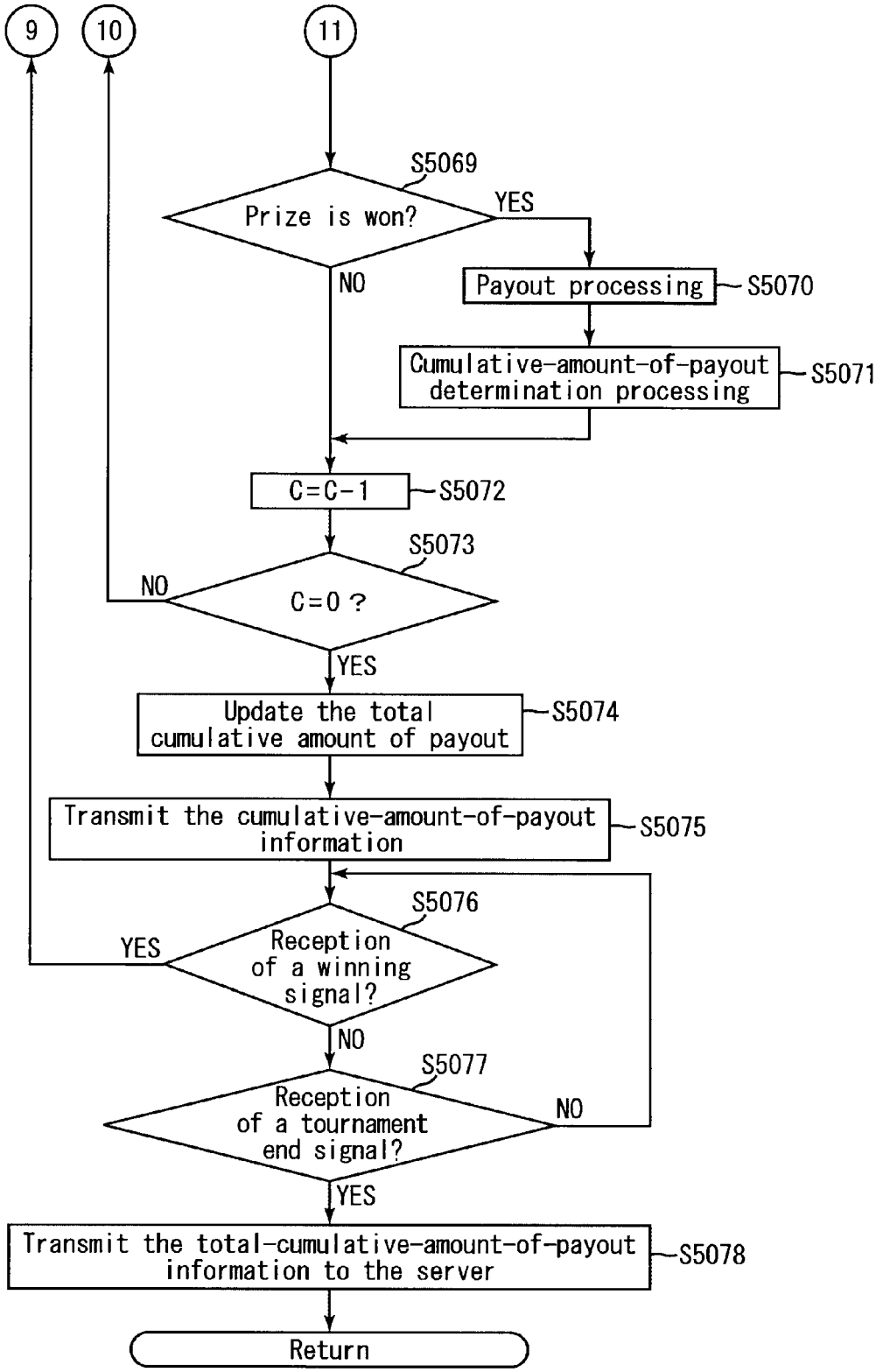

FIG. 144B is another flowchart illustrating the subroutine of the tournament-type game execution processing.

Figure 145:
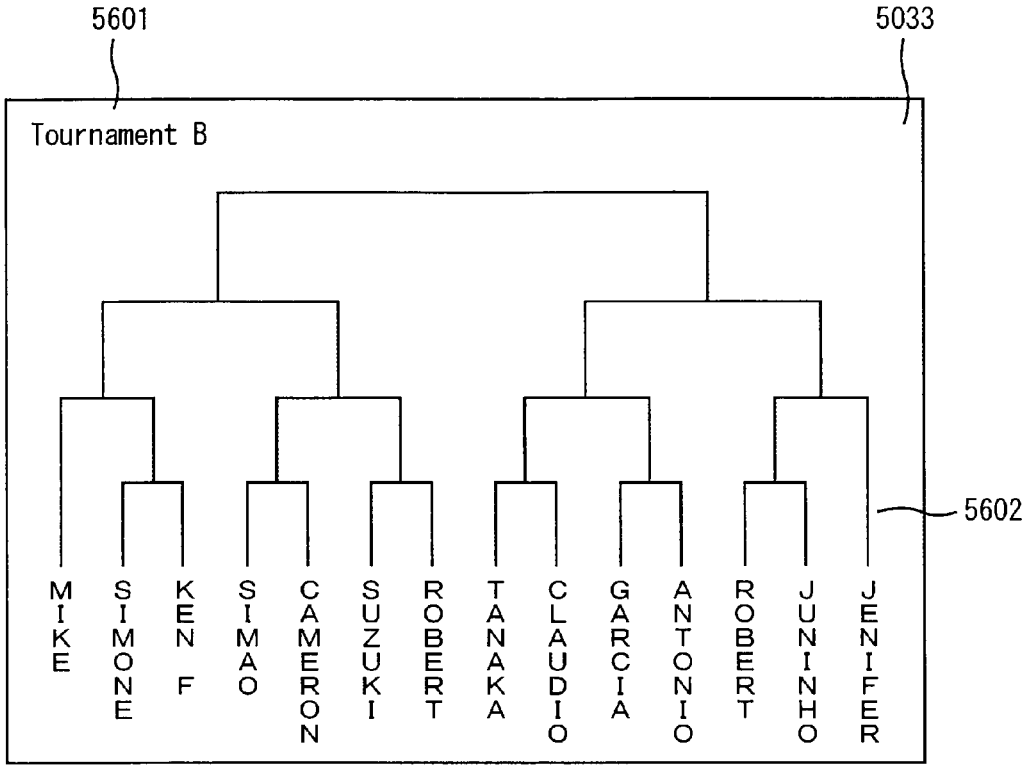

FIG. 145 is a view illustrating an exemplary image that is displayed to an upper image display panel provided in each slot machine constituting the ticket issuing system according to the seventh embodiment of the present invention.

DESCRIPTION OF THE EMBODIMENTS

[First Embodiment]

An embodiment of the present invention is described based on the drawings.

The following embodiment describes a case where a gaming machine is a slot machine.

First, a general description of the first embodiment will be given with reference to FIG. 1.

Figure 1:
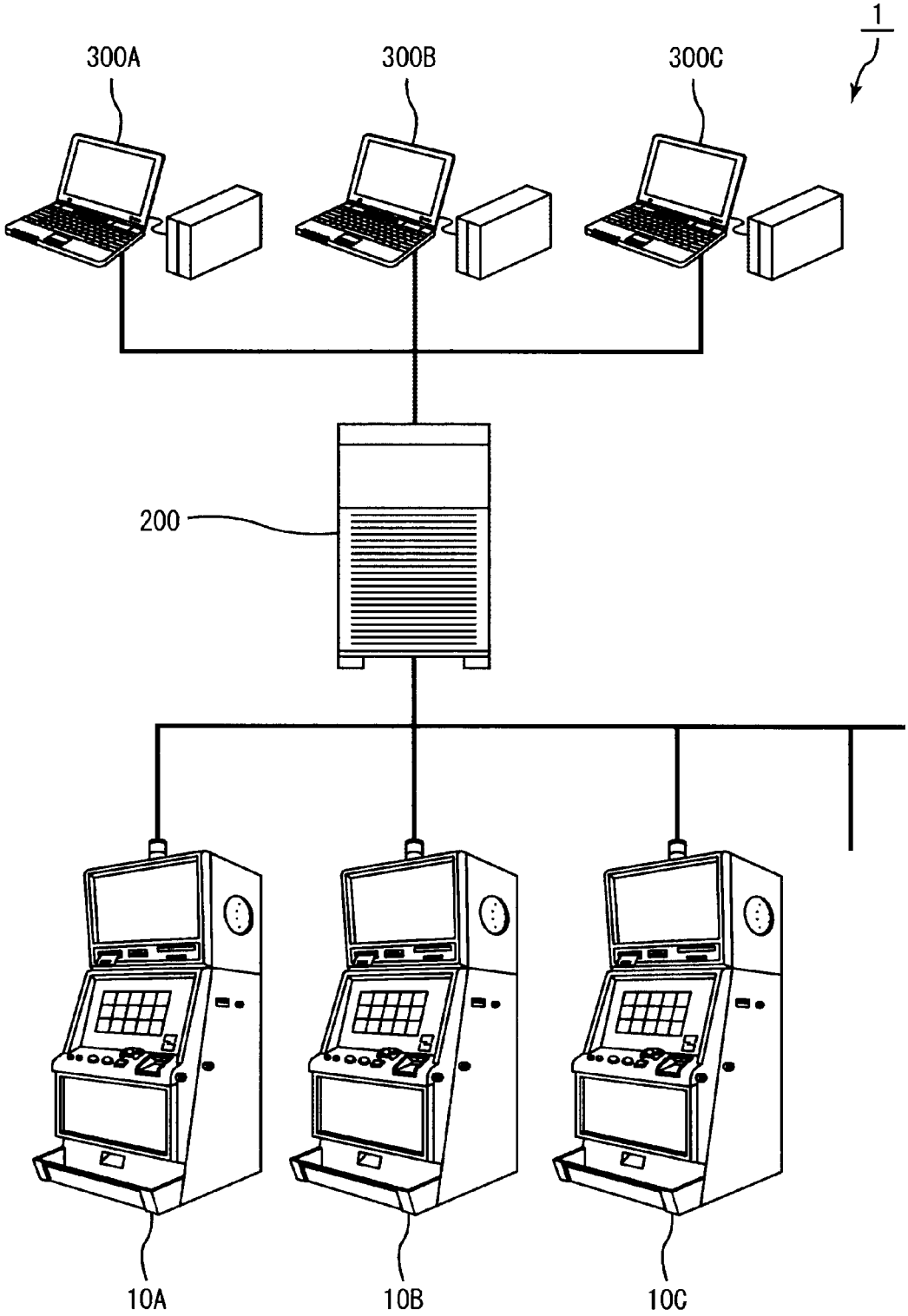
FIG. 1 is a schematic view illustrating an entire configuration of a ticket issuing system according to a first embodiment.

FIG. 1 is a schematic view illustrating an entire configuration of a ticket issuing system according to a first embodiment.

A ticket issuing system 1 is provided with a plurality of (3 in the first embodiment) ticket issuing devices 300 (ticket issuing device 300A, ticket issuing device 300B, ticket issuing device 300C); a server 200; and a plurality of (50 in the first embodiment) slot machines 10. These devices in the system are connected to one another by a network.

Each ticket issuing device 300 transmits a participation request signal to the server 200 when receiving a participation input signal from a keyboard 345 thereof. When the server 200 upon reception of the participation request signal determines that the number P of participation-accepted players, which is stored in a RAM 243 (see FIG. 5), does not exceed a number-of-players upper limit value stored in the RAM 243, the server 200 stores into the RAM 243 a numeric value obtained by adding 1 to the number P of participation-accepted players in the RAM 243 as an updated number P of participation-accepted players and also transmits a ticket issuance permission signal to the ticket issuing device 300 as the transmission source of the received participation request signal. When receiving the ticket issuance permission signal, the ticket issuing device 300 issues from a ticket printer 346 a ticket 500 with a barcode (see FIG. 7) that enables participation in a tournament-type game upon being inserted into a bill validator 22 (see FIG. 3) that is provided in each slot machine 10.

A player participates in a tournament-type game by inserting a ticket 500 with a barcode into the bill validator 22 (see FIG. 3) that is provided in each slot machine 10.

In a tournament-type game, each player competes with another player based on the number of coins obtained after playing a predetermined number of (50 in the first embodiment) games on each slot machine 10. More specifically, matches each involving two slot machines 10 are held, and one of the two slot machines 10 with a larger number of obtained coins in each match becomes a winning slot machine of the match. The matches are held until the overall winning slot machine is determined based on a tournament tree (see FIG. 26).

When a tournament-type game is over, each slot machine 10 displays an image (see FIG. 28A) that asks a player whether or not the player wishes to print the number of coins that the player has obtained in the tournament-type game, on a ticket to be issued from a ticket printer 35 of the slot machine 10. When the player makes an input that indicates the player's wish to print, the slot machine 10 issues from the ticket printer 35 a ticket that has printed thereon the number of coins obtained by the player in the tournament-type game. A tournament-type game corresponds to the game played against an other gaming machine in the present invention.

As above, the first embodiment has been briefly described based on FIG. 1.

Hereinafter, the first embodiment is described in more detail.

Next, a configuration of each slot machine 10 is described.

Figure 2:
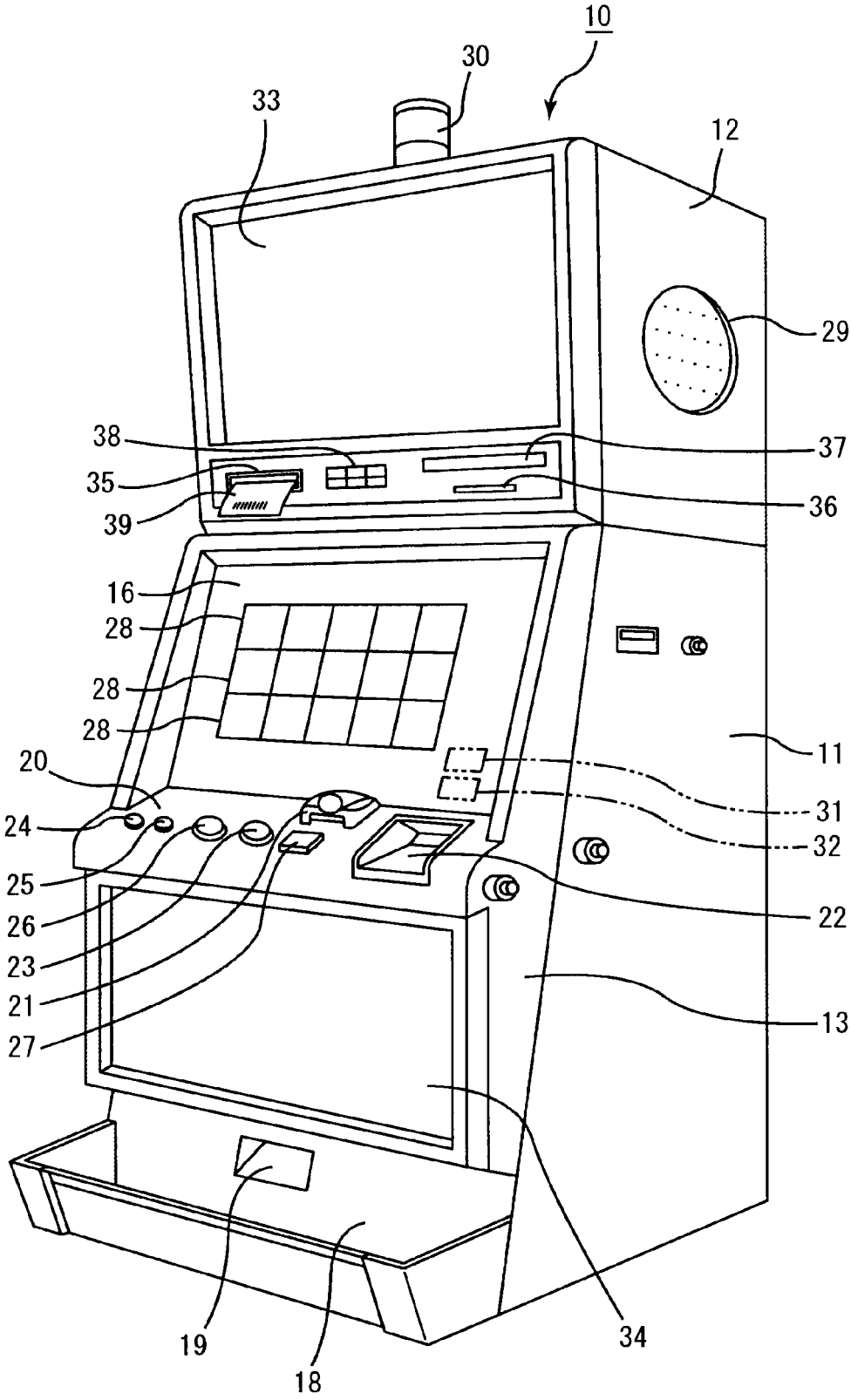
FIG. 2 is a perspective view illustrating an external view of a slot machine constituting a ticket issuing system according to the first embodiment.

FIG. 2 is a perspective view illustrating an external view of a slot machine constituting the ticket issuing system according to the first embodiment.

In the slot machine 10, a coin, a bill, or electronic valuable information corresponding to those is used as a game medium. However, in the present invention, the game medium is not particularly limited. Examples of the game medium may include a medal, a token, electronic money and a ticket.

The slot machine 10 comprises a cabinet 11, a top box 12 installed on the upper side of the cabinet 11, and a main door 13 provided at the front face of the cabinet 11.

On the main door 13, there is provided a lower image display panel 16 as a display. The lower image display panel 16 includes a transparent liquid crystal panel which displays fifteen display blocks 28 along five columns and three rows. A single symbol is displayed in each display block 28. Further, although not illustrated, various types of images relating to an effect, as well as the aforementioned images, are displayed to the lower image display panel 16.

Further, a number-of-credits display portion 31 and a number-of-payouts display portion 32 are provided on the lower image display panel 16. The number-of-credits display portion 31 displays an image indicative of the number of credited coins. The number-of-payouts display portion 32 displays an image indicative of the number of coins to be paid out.

Moreover, although not shown, a touch panel 69 is provided at the front face of the lower image display panel 16. A player can operate the touch panel 69 to input a variety of commands.

Below the lower image display panel 16, there are provided a control panel 20 including a plurality of buttons 23 to 27 with each of which a command according to game progress is inputted by the player, a coin receiving slot 21 through which a coin is accepted into the cabinet 11, and a bill validator 22.

The control panel 20 is provided with a start button 23, a change button 24, a CASHOUT button 25, a 1-BET button 26 and a maximum BET button 27. The start button 23 is for inputting a command to start scrolling of symbols. The change button 24 is used for making a request of staff in the recreation facility for exchange. The CASHOUT button 25 is used for inputting a command to pay out credited coins to a coin tray 18.

The 1-BET button 26 is used for inputting a command to bet one coin on a game out of credited coins. The maximum BET button 27 is used for inputting a command to bet the maximum number of coins that can be bet on one game (50 coins in the first embodiment) out of credited coins.

The bill validator 22 not only discriminates a regular bill from a false bill, but also accepts the regular bill into the cabinet 11. It is to be noted that the bill validator 22 can read information from a barcode printed on a ticket 500 with a barcode. At the lower front of the main door 13, namely, below the control panel 20, there is provided a belly glass 34 on which a character or the like of the slot machine 10 is drawn.

On the front surface of the top box 12, there is provided an upper image display panel 33. The upper image display panel 33 includes a liquid crystal panel, which displays, for example, images indicative of introductions of the contents of a game, explanations about the rules of the game, and a later-described tournament tree (see FIG. 26).

Further, a speaker 29 is provided in the top box 12. Under the upper image display panel 33, there are provided a ticket printer 35, a card reader 36, a data display 37, and a key pad 38. The ticket printer 35 prints on a ticket a barcode that represents encoded data of the player name, tournament-type game start time, and the like; the number of coins obtained by the player in the tournament-type game; and the like. The ticket is produced as a ticket 500 with a barcode. A player can participate in a tournament-type game by making a slot machine read the ticket 500 with a barcode.

The card reader 36 reads data from a smart card and writes data into the smart card. The smart card is a card owned by the player, and for example, data for identifying the player and data on a history of games played by the player are stored therein. Data corresponding to a coin, a bill or a credit may be stored in the smart card. Further, a magnetic stripe card may be adopted in place of the smart card. The data display 37 includes a fluorescent display and the like, and displays, for example, data read by the card reader 36 or data inputted by the player via the key pad 38. The key pad 38 is used for inputting a command and data concerning issuing of a ticket, and the like.

Figure 3:
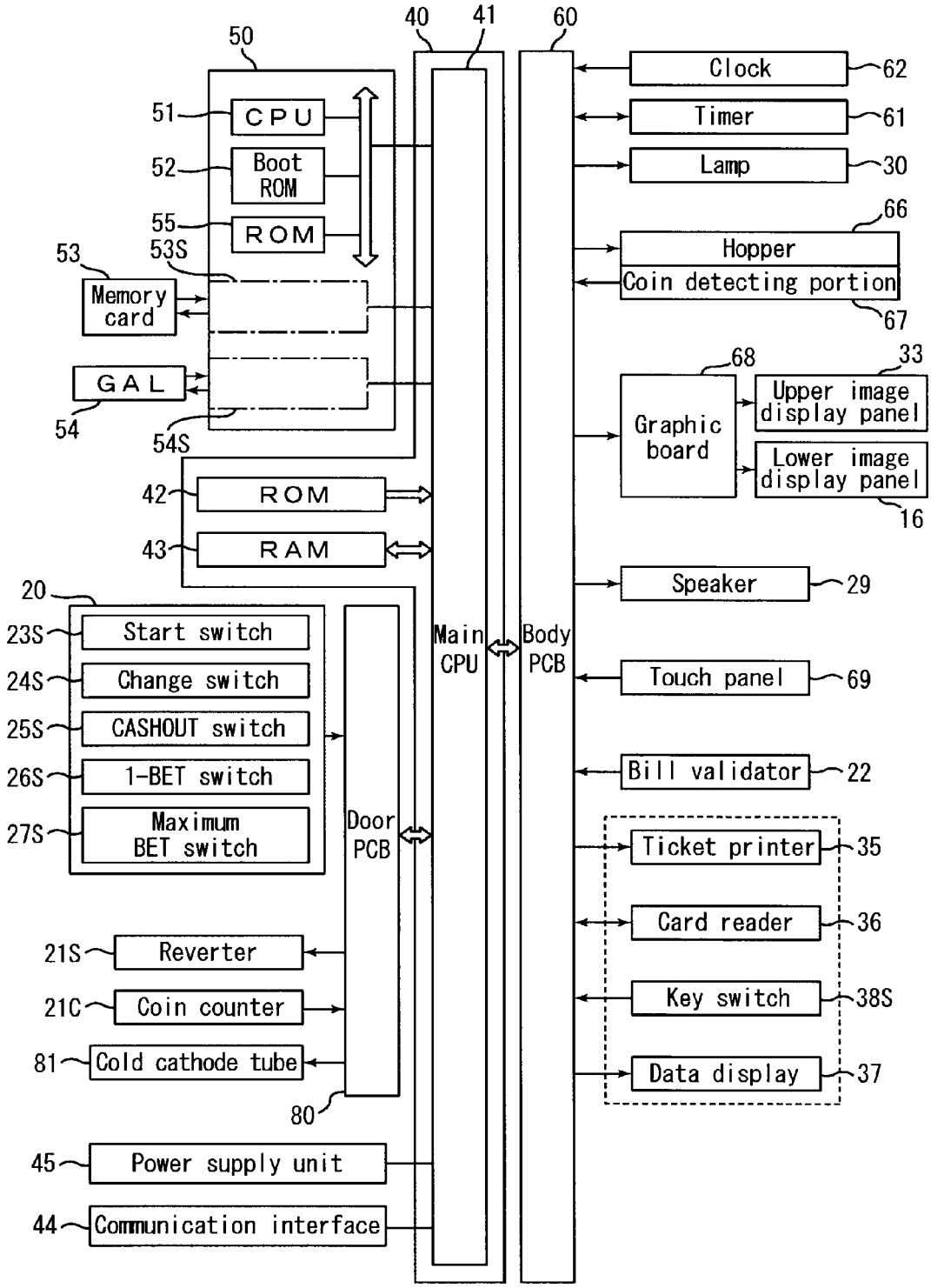
FIG. 3 is a block diagram illustrating an internal configuration of the slot machine shown in FIG. 2.

FIG. 3 is a block diagram illustrating an internal configuration of the slot machine shown in FIG. 2.

A gaming board 50 is provided with a CPU (Central Processing Unit) 51, a ROM 55, and a boot ROM 52 which are interconnected to one another by an internal bus, a card slot 53S corresponding to a memory card 53, and an IC socket 54S corresponding to a GAL (Generic Array Logic) 54.

The memory card 53 includes a nonvolatile memory such as CompactFlash (registered trade mark), and stores a game program. The game program includes a symbol determination program. The symbol determination program is a program for determining symbols to be rearranged in the display blocks 28.

The symbols to be determined by the symbol determination program include 8 types of symbols including "RIBBON", "HEART", "STAR", "MOON", "SUN", "JEWEL", "CROWN", and "SMILE".

Further, the card slot 53S is configured so as to allow the memory card 53 to be inserted thereinto or removed therefrom, and is connected to the mother board 40 by an IDE bus. Therefore, the type and contents of a game played on the slot machine 10 can be changed by removing the memory card 53 from the card slot 53S, writing another game program into the memory card 53, and inserting the memory card 53 into the card slot 53S. The game program includes a program relating to progress of the game. Further, the game program includes image data and sound data to be outputted during the game. The game program also includes odds data showing a correspondence relationship between a type and the number of rearranged symbols and an amount of payout (see FIG. 24), and the like. In addition, the game program includes data showing predetermined time T.

The CPU 51, the ROM 55 and the boot ROM 52 interconnected to one another by an internal bus are connected to the mother board 40 through a PCI bus. The PCI bus not only conducts signal transmission between the mother board 40 and the gaming board 50, but also supplies power from the mother board 40 to the gaming board 50.

The mother board 40 is configured using a commercially available general-purpose mother board (a print wiring board on which fundamental components of a personal computer are mounted), and provided with a main CPU 41, a ROM (Read Only Memory) 42, a RAM (Random Access Memory) 43, and a communication interface 44. The mother board 40 corresponds to a controller of the present invention.

The ROM 42 comprises a memory device such as a flash memory, and stores a program such as a BIOS (Basic Input/Output System) executed by the main CPU 41, and permanent data. When the BIOS is executed by the main CPU 41, processing for initializing a predetermined peripheral device is conducted, concurrently with start of processing for loading the game program stored in the memory card 53 via the gaming board 50. It is to be noted that, in the present invention, the ROM 42 may or may not be data rewritable one.

The RAM 43 stores data and a program to be used at the time of operation of the main CPU 41. Further, the RAM 43 is capable of storing a game program.

Moreover, the RAM 43 stores data of the number of credits, the numbers of coin-ins and coin-outs in one game, and the like.

The mother board 40 is connected with a later-described body PCB (Printed Circuit Board) 60 and a door PCB 80 through respective USBs. Further, the mother board 40 is connected with a power supply unit 45 and the communication interface 44.

The body PCB 60 and the door PCB 80 are connected with an instrument and a device that generate an input signal to be inputted into the main CPU 41 and an instrument and a device operations of which are controlled by a control signal outputted from the main CPU 41. The main CPU 41 executes the game program stored in the RAM 43 based on the input signal inputted into the main CPU 41, and thereby executes the predetermined arithmetic processing, stores the result thereof into the RAM 43, or transmits a control signal to each instrument and device as processing for controlling each instrument and device.

The body PCB 60 is connected with a lamp 30, a hopper 66, a coin detecting portion 67, a graphic board 68, the speaker 29, the touch panel 69, the bill validator 22, the ticket printer 35, the card reader 36, a key switch 38S, the data display 37, a timer 61, and a clock 62. The lamp 30 is lighted in a predetermined pattern based on control signals outputted from the main CPU 41.

The hopper 66 is installed inside the cabinet 11, and pays out a predetermined number of coins based on a control signal outputted from the main CPU 41, from a coin payout exit 19 to the coin tray 18. The coin detecting portion 67 is provided inside the coin payout exit 19, and outputs an input signal to the main CPU 41 in the case of detecting payout of the predetermined number of coins from the coin payout exit 19.

The timer 61 is used for measuring the time.

The clock 62 is used for timekeeping.

The clock 62 sets its time every time a predetermined period elapses. The clock 62 sets its time by getting time data from a clock 249 (see FIG. 5) that is provided in the server 200.

The graphic board 68 controls image display to the upper image display panel 33 and the lower image display panel 16 based on a control signal outputted from the main CPU 41. In the respective display blocks 28 on the lower image display panel 16, symbols are displayed in a scrolling manner or in a stopped state. The number of credits stored in the RAM 43 is displayed to the number-of-credits display portion 31 of the lower image display panel 16. Further, the number of coin-outs is displayed to the number-of-payouts display portion 32 of the lower image display panel 16.

The graphic board 68 comprises a VDP (Video Display Processor) for generating image data based on a control signal outputted from the main CPU 41, a video RAM for temporarily storing image data generated by the VDP, and the like. It is to be noted that image data used in generation of the image data by the VDP is included in the game program read from the memory card 53 and stored into the RAM 43.

The bill validator 22 not only discriminates a regular bill from a false bill, but also accepts the regular bill into the cabinet 11. Upon acceptance of the regular bill, the bill validator 22 outputs an input signal to the main CPU 41 based on a face amount of the bill. The main CPU 41 stores in the RAM 43 the number of credits corresponding to the face amount of the bill transmitted with the input signal.

Further, when receiving a ticket 500 with a barcode, the bill validator 22 reads the data of the player name, the tournament-type game start time, and the like from the barcode printed on the ticket 500 with a barcode, and then outputs the read information to the main CPU 41.

The ticket printer 35 is for printing on a ticket a barcode that represents encoded data of the player name, the tournament-type game start time, and the like; the number of coins obtained by the player in the tournament-type game; and the like. Then, the ticket printer 35 produces the ticket as a ticket 500 with a barcode.

The card reader 36 reads data from the smart card and transmits the read data to the main CPU 41, and writes data onto the smart card based on a control signal from the main CPU 41. The key switch 38S is provided on the key pad 38, and outputs a predetermined input signal to the main CPU 41 when the key pad 38 is operated by the player. The data display 37 displays data read by the card reader 36 and data inputted by the player via the key pad 38, based on a control signal outputted from the main CPU 41.

The door PCB 80 is connected with the control panel 20, a reverter 21S, a coin counter 21C, and a cold cathode tube 81. The control panel 20 is provided with a start switch 23S corresponding to the start button 23, a change switch 24S corresponding to the change button 24, a CASHOUT switch 25S corresponding to the CASHOUT button 25, a 1-BET switch 26S corresponding to the 1-BET button 26, and a maximum BET switch 27S corresponding to the maximum BET button 27. Each of the switches 23S to 27S outputs an input signal to the main CPU 41 when each of the buttons 23 to 27 corresponding thereto is operated by the player.

The coin counter 21C is provided inside the coin receiving slot 21, and discriminates a regular coin from a false coin when a coin is inserted into the coin receiving slot 21 by the player. Coins other than the regular coin are discharged from the coin payout exit 19. Further, the coin counter 21C outputs an input signal to the main CPU 41 in detection of the regular coin.

The reverter 21S operates based on the control signal outputted from the main CPU 41, and distributes a coin recognized by the coin counter 21C as the regular coin into a cash box (not shown) or the hopper 66, which are disposed in the slot machine 10. Namely, when the hopper 66 is filled with coins, the regular coin is distributed into the cash box by the reverter 21S. On the other hand, when the hopper 66 is not filled with coins, the regular coin is distributed into the hopper 66. The cold cathode tube 81 functions as a back light installed on the rear face side of the lower image display panel 16 and the upper image display panel 33, and lighted up based on the control signal outputted from the main CPU 41.

Figure 4:
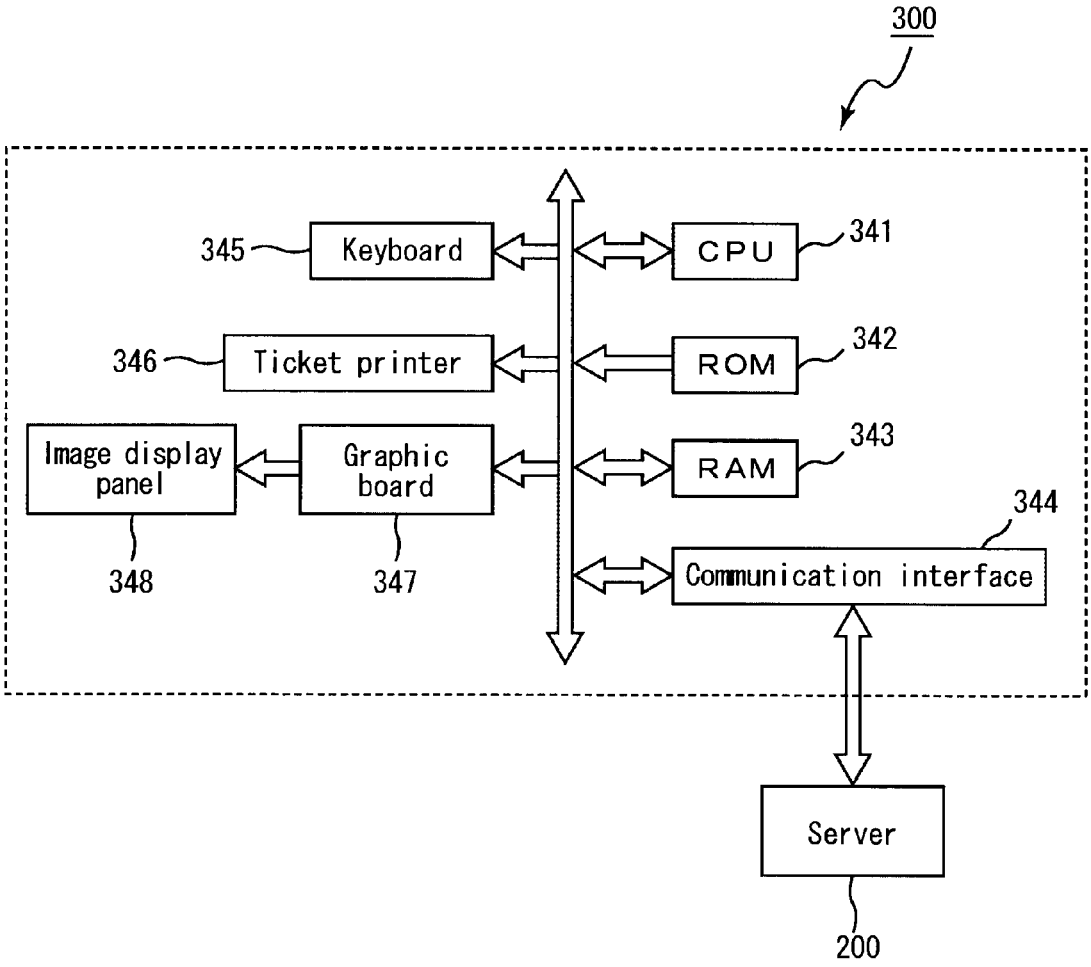
FIG. 4 is a block diagram illustrating an internal configuration of a ticket issuing device constituting the ticket issuing system according to the first embodiment of the present invention.

FIG. 4 is a block diagram illustrating an internal configuration of a ticket issuing device that constitutes the ticket issuing system according to the first embodiment of the present invention.

Each ticket issuing device 300 is provided with a CPU 341, a ROM 342, a RAM 343, a communication interface 344, a keyboard 345, a ticket printer 346, a graphic board 347, and an image display panel 348.

The keyboard 345 is used for inputting letters and numerals. The ticket printer 346 is for printing on a ticket a barcode that represents encoded data of the player name, the tournament-type game start time, and the like, and then producing the ticket as a ticket 500 with a barcode. The graphic board 347 controls image display on the image display panel 348 based on a control signal outputted from the CPU 341. The image display panel 348 displays an input screen (not shown) for the player name, and the like.

The communication interface 344 is connected through a communication line to a communication interface 244 that is provided in the server 200. The ROM 342 stores a system program for controlling operation of the processor, permanent data, and the like. The RAM 343 temporarily stores data received from the server 200, and the like.

The keyboard 345 corresponds to the input device in the present invention.

The ticket printer 346 corresponds to the ticket issuing terminal in the present invention.

The CPU 341 corresponds to the processor in the present invention.

Figure 5:
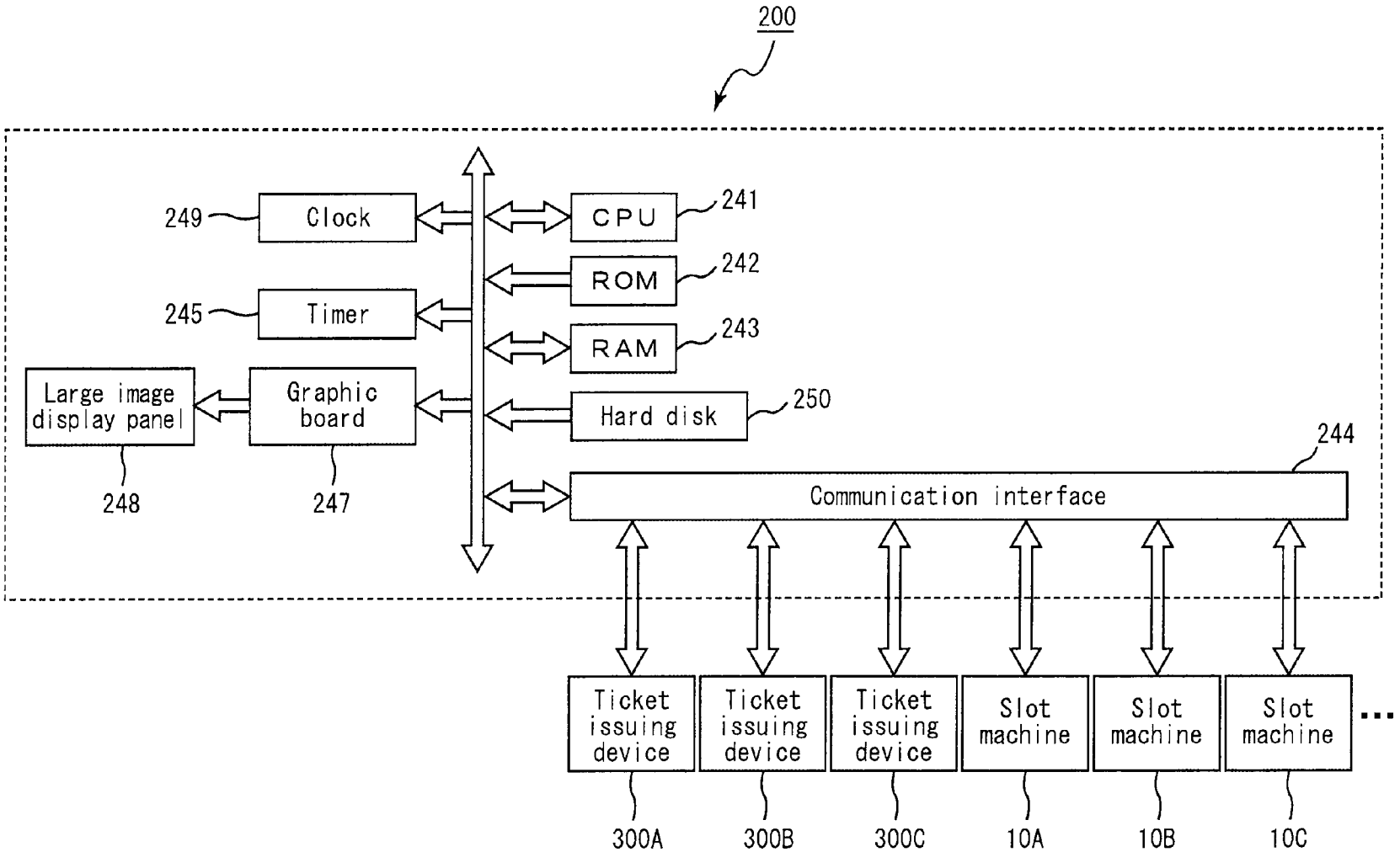
FIG. 5 is a block diagram illustrating an internal configuration of a server constituting the ticket issuing system according to one embodiment of the present invention.

FIG. 5 is a block diagram illustrating an internal configuration of the server that constitutes the ticket issuing system according to the first embodiment of the present invention.

The server 200 is provided with a CPU 241, a ROM 242, a RAM 243, the communication interface 244, a timer 245, a graphic board 247, a large image display panel 248, the clock 249, and a hard disk 250.

The graphic board 247 controls image display on the large image display panel 248 based on a control signal outputted from the CPU 241. The large image display panel 248 displays a result (ranking) of a tournament-type game, and the like. The timer 245 is used for measuring time. The clock 249 is used for time keeping.

The communication interface 244 is connected through each communication line to the communication interface 344 of each ticket issuing device 300 and to a communication interface 44 of each slot machine 10. The ROM 242 stores a system program for controlling operation of the CPU 241, permanent data, and the like. The ROM 242 also stores data showing predetermined start time, predetermined first end time, predetermined second end time, and predetermined time. The RAM 243 temporarily stores data received from the slot machines 10 and the ticket issuing devices 300, and the like. The hard disk 250 stores a total cumulative amount of payout in association with the player name and the date.

The RAM 243 corresponds to the memory in the present invention.

The CPU 241 corresponds to the control portion in the present invention.

Figure 6:
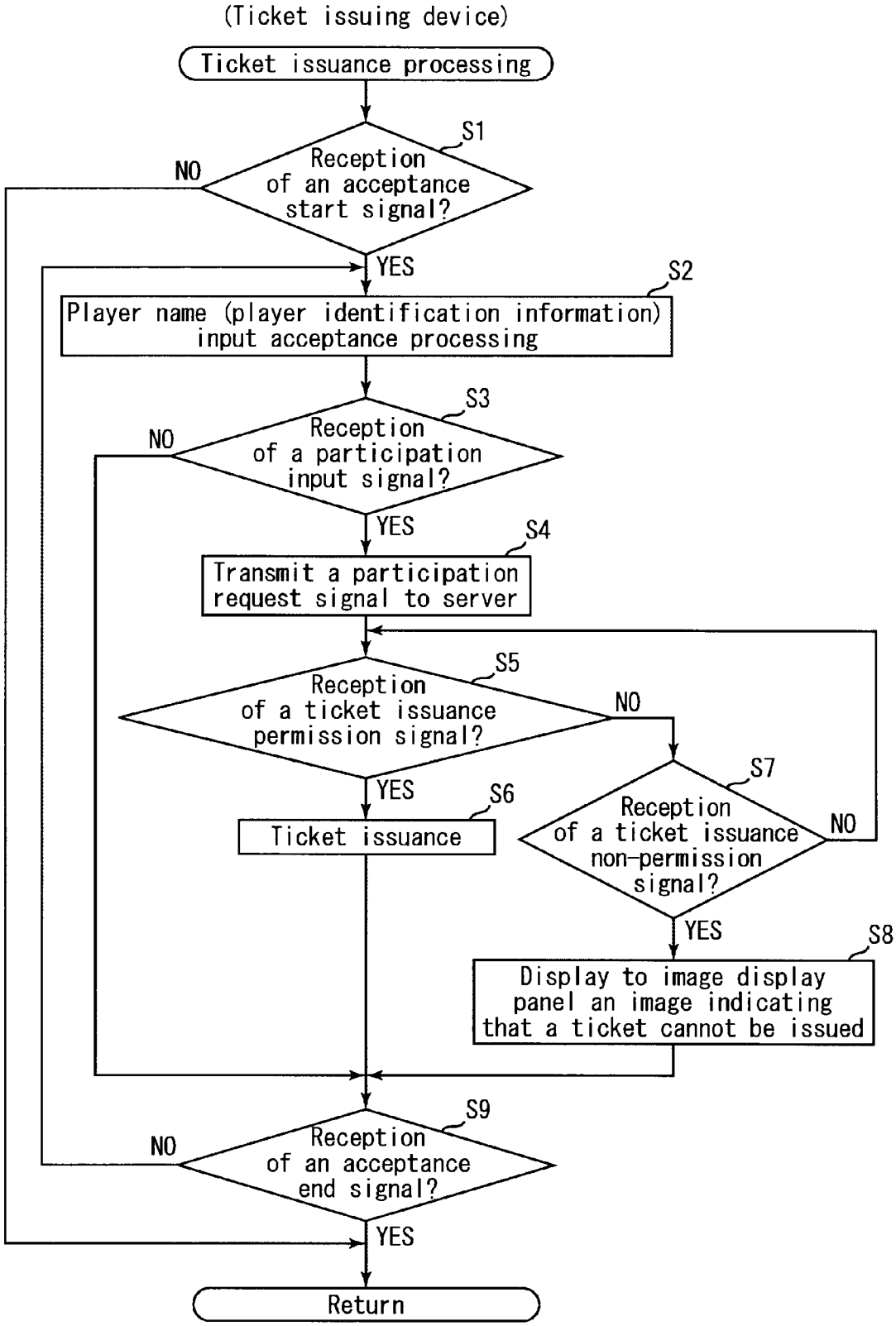
FIG. 6 is a flowchart illustrating ticket issuance processing executed in each ticket issuing device.

FIG. 6 is a flowchart illustrating ticket issuance processing executed in each ticket issuing device.

First, the CPU 341 determines whether or not the CPU 341 has received acceptance start signal from the server 200 at a predetermined timing (step S1). When the CPU 341 determines that the CPU 341 has not received the acceptance start signal, the CPU 341 ends the ticket issuance processing.

On the other hand, when the CPU 341 determines that the CPU 341 has received the acceptance start signal, the CPU 341 executes player-name input acceptance processing (step S2). In the player-name input acceptance processing, the CPU 341 accepts input of a player name through the keyboard 345. In the first embodiment, the keyboard 345 is operated by an operator, not a player. The operator inputs a player name of the player who wishes to participate in a tournament-type game. Completion of input of the player name leads to display of a confirmation screen for checking if the inputted player name is correct, to the image display panel 348 (not shown). The operator inputs "Y" via the keyboard 345 when there is no error. Input of "Y" via the keyboard 345 at the time of display of the confirmation screen to the image display panel 348 leads to transmission of a participation input signal from the keyboard 345 to the CPU 341. The participation input signal includes the player name that has been inputted via the keyboard 345. On the other hand, when the operator inputs "N" via the keyboard 345, input of a player name is enabled again.

The player name inputted via the keyboard 345 corresponds to the player identification information in the present invention.

In the first embodiment, a description has been given in which the operator who operates the keyboard 345 is not a player. However, in the present invention, a player may be an operator. If this is the case, the player operates the input device.

Next, the CPU 341 determines whether or not the CPU 341 has received the participation input signal from the keyboard 345 (step S3). When the CPU 341 determines that the CPU 341 has not received the participation input signal, the CPU 341 shifts the processing to step S9.

On the other hand, when the CPU 341 determines that the CPU 341 has received the participation input signal, the CPU 341 transmits a participation request signal to the server 200 (step S4). The participation request signal includes the identification number of the ticket issuing device 300.

Now, the CPU 341 determines whether or not the CPU 341 has received a ticket issuance permission signal from the server 200 (step S5). When the CPU 341 determines that the CPU 341 has received the ticket issuance permission signal, the CPU 341 issues a ticket 500 with a barcode (step S6). In the processing, the CPU 341 prints on a ticket a barcode that represents encoded data of the player name and the next tournament-type game start time, and then issues the ticket as a ticket 500 with a barcode.

Figure 7:
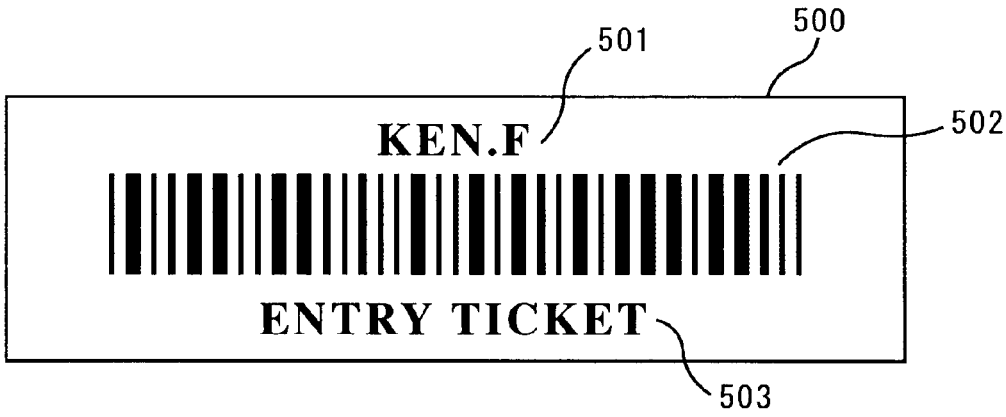
FIG. 7 is a view illustrating an exemplary ticket with a barcode which is issued from a ticket issuing device of the first embodiment.

FIG. 7 is a view illustrating an exemplary ticket with a barcode issued from a ticket issuing device of the first embodiment.

At the upper portion of the ticket 500 with a barcode, a player name 501 is printed.

At the central portion of the ticket 500 with a barcode, a barcode 502 is printed which represents encoded data of the player name and the tournament-type game start time.

At the lower portion of the ticket 500 with a barcode, text 503 is printed which indicates that the ticket is used for participation in a tournament-type game.

The data showing the tournament-type game start time corresponds to the game identification information in the present invention.

The barcode 502 corresponds to the code information in the present invention.

Referring back to FIG. 6, when the CPU 341 determines in step S5 that the CPU 341 has not received a ticket issuance permission signal, the CPU 341 determines whether or not the CPU 341 has received a ticket issuance non-permission signal from the server 200 (step S7). When the CPU 341 determines that the CPU 341 has not received the ticket issuance non-permission signal, the CPU 341 returns the processing to step S5. On the other hand, when the CPU 341 determines that the CPU 341 has received the ticket issuance non-permission signal, the CPU 341 displays to the image display panel 348 an image that indicates that a ticket cannot be issued (not shown). When the image display panel 348 displays the image that indicates that a ticket cannot be issued, the operator tells the player, who wishes to participate in a tournament-type game, that the player cannot participate in the tournament-type game.

When the CPU 341 determines in step S3 that the CPU 341 has not received a participation input signal or when the CPU 341 has executed the processing of step S6 or step S8, the CPU 341 determines whether or not the CPU 341 has received an acceptance end signal from the server 200 (step S9). When the CPU 341 determines that the CPU 341 has not received the acceptance end signal, the CPU 341 returns the processing to step S2. On the other hand, when the CPU 341 determines that the CPU 341 has received the acceptance end signal, the CPU 341 ends the ticket issuance processing.

Figure 8:
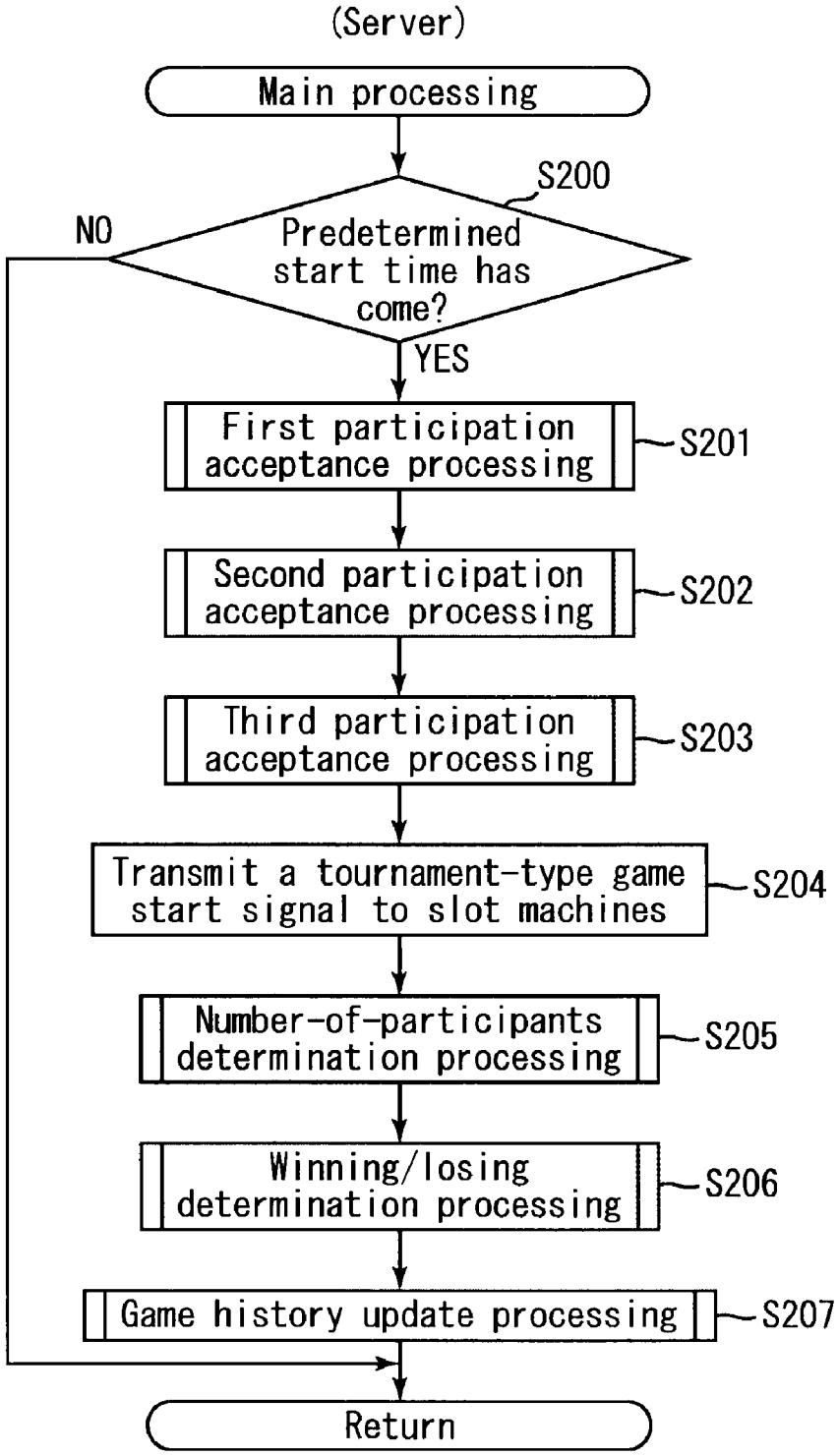
FIG. 8 is a flowchart illustrating main processing that is executed in the server.

FIG. 8 is a flowchart illustrating main processing executed in the server.

First, the CPU 241 determines whether or not the predetermined start time has come, at a predetermined timing (step S200). In the processing, the CPU 241 determines whether or not the time shown by the clock 249 is the predetermined start time. When determining that the predetermined start time has not come yet, the CPU 241 ends the main processing.

On the other hand, when determining in step S200 that the predetermined start time has come, the CPU 241 executes first participation acceptance processing (step S201). In the processing, the CPU 241 controls issuance of tickets 500 with a barcode to players who wish to participate in the tournament-type game. The first participation acceptance processing will be described later with reference to drawings.

The CPU 241 executes second participation acceptance processing (step S202). In the processing, the CPU 241 checks whether or not the players who are currently playing a game wish to participate in the next game to be held. The second participation acceptance processing will be described later with reference to a drawing.

The CPU 241 executes third participation acceptance processing (step S203). In the processing, the CPU 241 controls issuance of tickets 500 with a barcode to players who wish to participate in the tournament-type game. The third participation acceptance processing will be described later with reference to drawings.

The CPU 241 transmits a tournament-type game start signal to the slot machines 10 (step S204).

The CPU 241 executes number-of-participants determination processing (step S205). In the processing, the CPU 241 determines the number of players who participate in the tournament-type game; the number of tournaments; and assignment of the slot machines 10 participating in the tournament-type game to the tournaments. The number-of-participants determination processing will be described later with reference to a drawing.

The CPU 241 executes winning/losing determination processing (step S206). In the processing, the CPU 241 determines the winning slot machine of each match in each tournament. The winning/losing determination processing will be described later with reference to drawings.

The CPU 241 executes game-history update processing (step S207). In the processing, the CPU 241 stores the number of coins obtained by each player in the tournament-type game. The game-history update processing will be described later with reference to a drawing.

After executing the processing of step S207, the CPU 241 ends the main processing.

Figure 9:
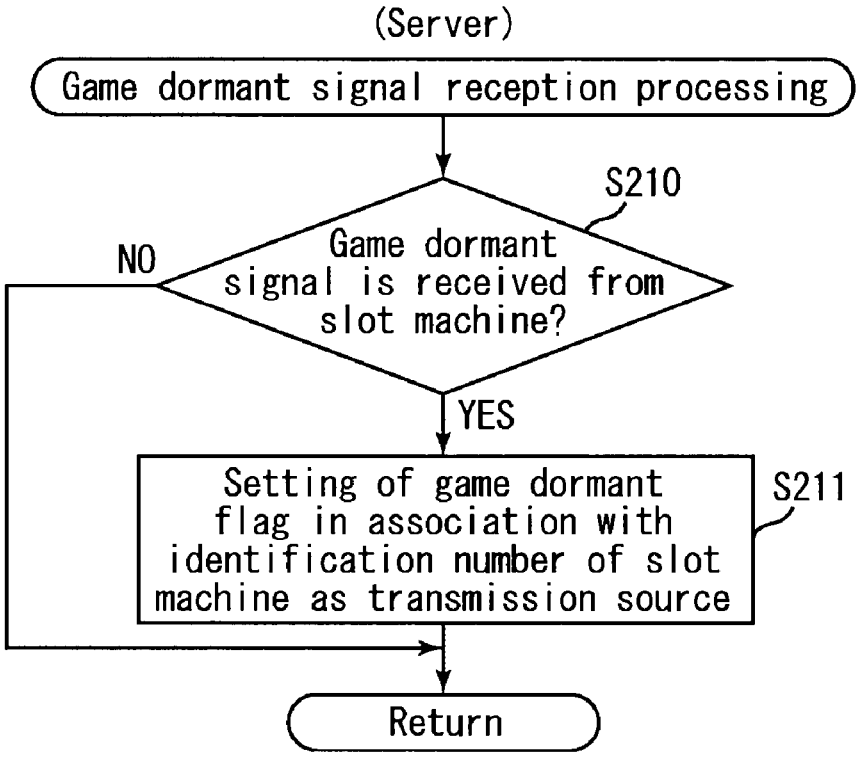
FIG. 9 is a flowchart illustrating a subroutine of game dormant signal reception processing.

FIG. 9 is a flowchart illustrating a subroutine of game dormant signal reception processing.

First, the CPU 241 determines whether or not the CPU 241 has received a game dormant signal from any of the slot machines 10, at a predetermined timing (step S210).

When the CPU 241 determines that the CPU 241 has not received a game dormant signal, the CPU 241 ends the present subroutine. On the other hand, when the CPU 241 determines that the CPU 241 has received a game dormant signal, the CPU 241 sets a game dormant flag in association with the identification number of the slot machine 10 which is included in the received game dormant signal (step S211).

After executing the processing of step S211, the CPU 241 ends the present subroutine.

Figure 10A:
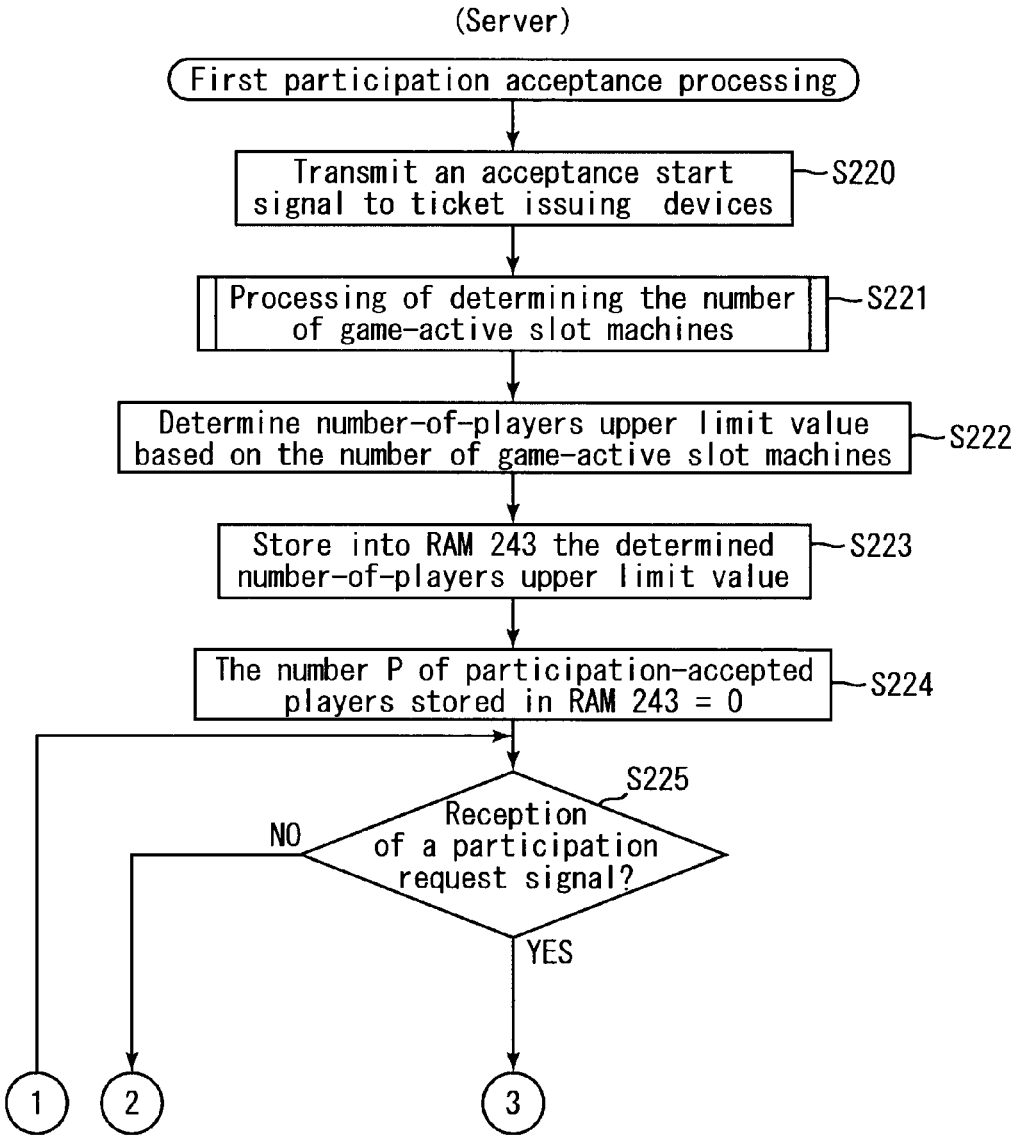
FIG. 10A is a flowchart illustrating a subroutine of first participation acceptance processing.

FIG. 10A is a flowchart illustrating a subroutine of the first participation acceptance processing.

Figure 10B:
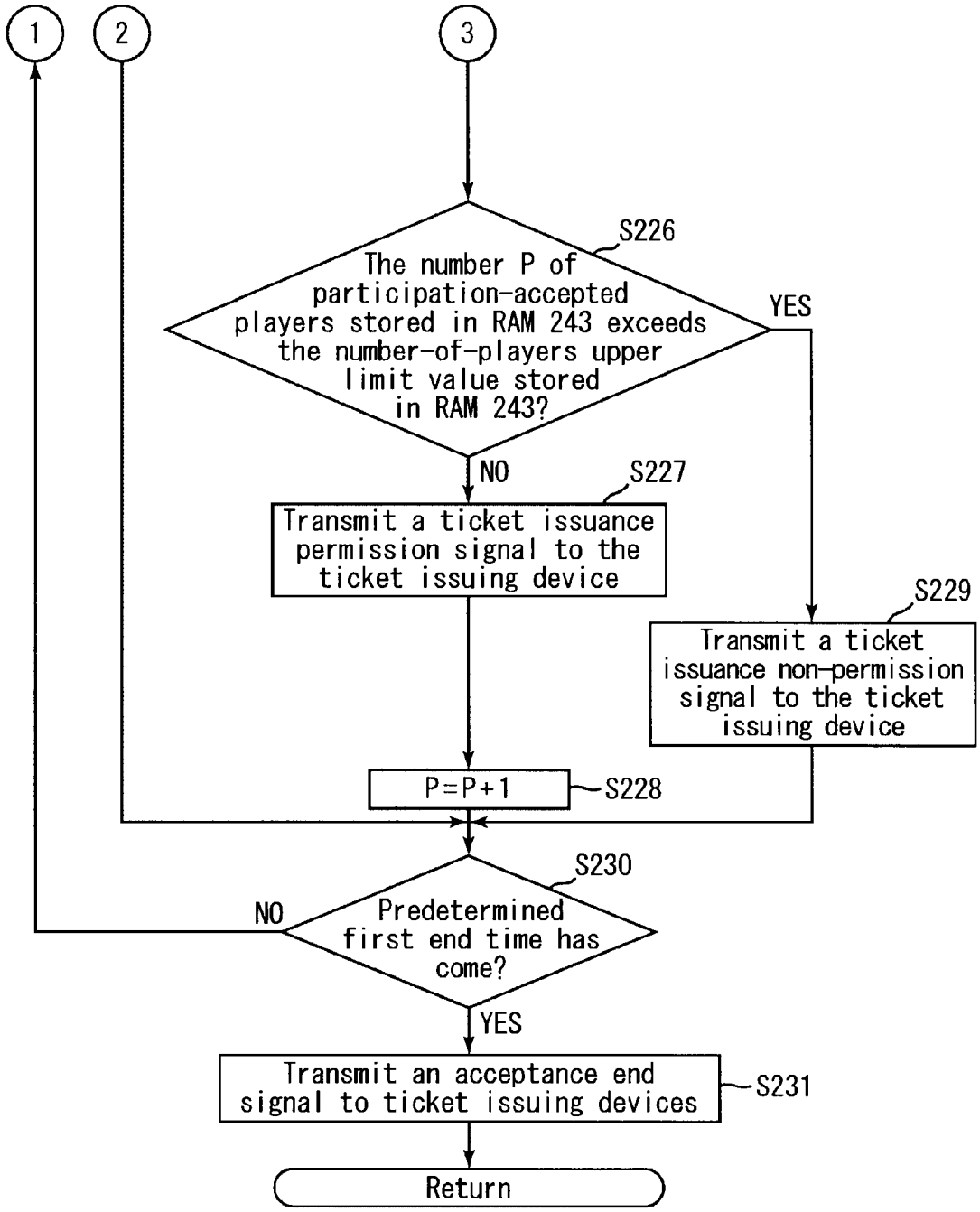
FIG. 10B is another flowchart illustrating the subroutine of the first participation acceptance processing.

FIG. 10B is another flowchart illustrating the subroutine of the first participation acceptance processing.

First, the CPU 241 transmits a participation start signal to the ticket issuing devices 300 (step S220).

The CPU 241 then executes processing of determining the number of game-active slot machines (step S221). In the processing, the CPU 241 determines the number of game-active slot machines which indicates the number of slot machines where a game is played. The processing of determining the number of game-active slot machines will be described later with reference to a drawing.

The CPU 241 then determines a number-of-players upper limit value, based on the number of game-active slot machines which has been determined in step S221 (step S222). In the first embodiment, the CPU 241 first subtracts the number of game-active slot machines from 50, which is the total number of the slot machines 10. That is, the CPU 241 determines the number of slot machines 10 on which no game is played. Next, the CPU 241 obtains a numeric value by multiplying the number of slot machines 10 on which no game is played by 0.7 and truncating the digits after the decimal point, and then determines the obtained value as the number-of-players upper limit value. The number-of-players upper limit value indicates the maximum number of tickets 500 with a barcode to be issued. That is, tickets 500 with a barcode only in number not more than the number-of-players upper limit value can be issued.

In the first embodiment, the number of slot machine 10 on which no game is played is multiplied by 0.7. The number of slot machines 10 on which no game is played is multiplied by 0.7 so as to prevent a situation where a player cannot participate in a tournament-type game because there is no slot machine 10 on which a game is played even though the player has a ticket 500 with a barcode.

Further, multiplying the number of slot machines 10 on which no game is played by 0.7 makes it possible to offer a chance for players, who do not participate in a tournament-type game, to play a game in a slot machine.

Next, the CPU 241 stores the number-of-players upper limit value determined in step S222 into the RAM 243 (step S223). The CPU 241 further stores 0 into the RAM 243 as an updated number P of participation-accepted players (step S224).

The CPU 241 determines whether or not the CPU 241 has received a participation request signal from any of the ticket issuing devices 300 (step S225). When the CPU 241 determines that the CPU 241 has not received a participation request signal, the CPU 241 shifts the processing to step S230.

On the other hand, when the CPU 241 determines in step S225 that the CPU 241 has received a participation request signal, the CPU 241 determines whether or not the number P of participation-accepted players stored in the RAM 243 exceeds the number-of-players upper limit value stored in the RAM 243 (step S226). When determining that the number P of participation-accepted players does not exceed the number-of-players upper limit value, the CPU 241 transmits a ticket issuance permission signal to the ticket issuing device 300 as the transmission source of the participation request signal (step S227). Then, the CPU 241 stores into the RAM 243 a value obtained by adding 1 to the number P of participation-accepted players stored in the RAM 243 as an updated number P of participation-accepted players (step S228).

On the other hand, when the CPU 241 determines in step S226 that the number P of participation-accepted players exceeds the number-of-players upper limit value, the CPU 241 transmits a ticket issuance non-permission signal to the ticket issuing device 300 as the transmission source of the participation request signal (step S229).

When the CPU 241 determines in step S225 that the CPU 241 has not received a participation request signal, or when the CPU 241 has executed the processing of step S228 or step S229, the CPU 241 determines whether or not predetermined first end time has come (step S230). In the processing, the CPU 241 determines whether or not the time shown by the clock 249 is the predetermined first end time. When determining that the predetermined first end time has not come yet, the CPU 241 returns the processing to step S225.

On the other hand, when determining in step S230 that the predetermined first end time has come, the CPU 241 transmits an acceptance end signal to the ticket issuing devices 300 (step S231).

After executing the processing of step S231, the CPU 241 ends the present subroutine.

Figure 11:
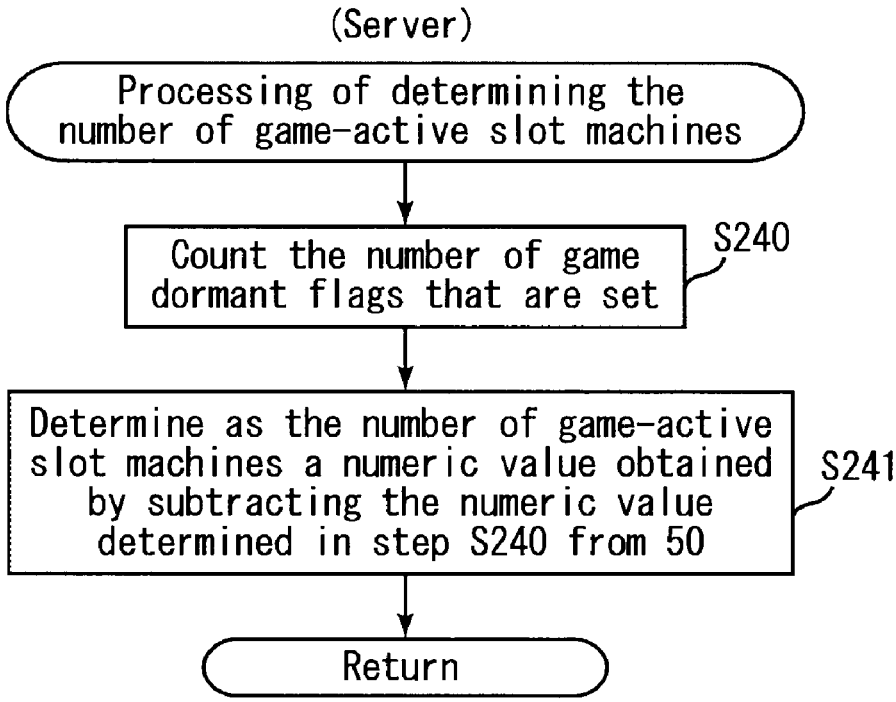
FIG. 11 is a flowchart illustrating a subroutine of processing of determining the number of game-active slot machines.

FIG. 11 is a flowchart illustrating a subroutine of the processing of determining the number of game-active slot machines.

First, the CPU 241 counts the number of game dormant flags that are set, at a predetermined timing (step S240).

The CPU 241 subtracts the numeric value counted in step S240 from 50, and determines the obtained numeric value as the number of game-active slot machines (step S241). The CPU 241 then stores the determined number of game-active slot machines into the RAM 243.

After executing the processing of step S241, the CPU 241 ends the present subroutine.

Figure 12:
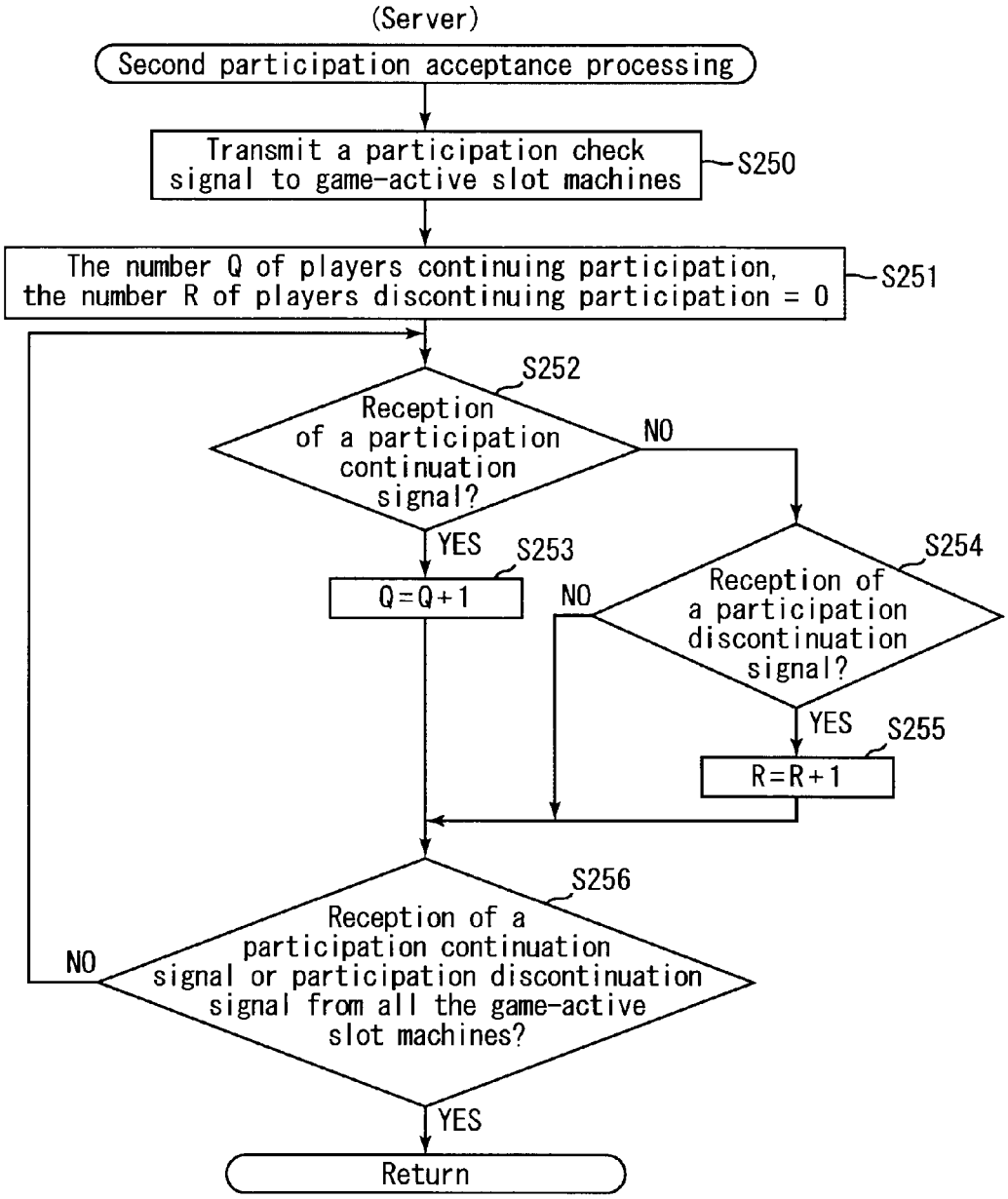
FIG. 12 is a flowchart illustrating a subroutine of second participation acceptance processing.

FIG. 12 is a flowchart illustrating a subroutine of the second participation acceptance processing.

First, the CPU 241 transmits a participation check signal to the slot machines 10 on which a game is played (step S250). In the processing, the CPU 241 transmits the participation check signal to each slot machine 10 for which a game dormant flag is not set in association with the identification number.

The CPU 241 stores 0 into the RAM 243 as an updated number Q of players continuing participation, and stores 0 into the RAM 243 as an updated number R of players discontinuing participation (step S251).

The CPU 241 determines whether or not the CPU 241 has received a participation continuation signal from each slot machine 10 (step S252). When the CPU 241 determines that the CPU 241 has received a participation continuation signal, the CPU 241 stores into the RAM 243 a numeric value obtained by adding 1 to the number Q of players continuing participation in the RAM 243 as an updated number Q of players continuing participation (step S253).

On the other hand, when the CPU 241 determines in step S252 that the CPU 241 has not received a participation continuation signal, the CPU 241 determines whether or not a participation discontinuation signal from each slot machine 10 (step S254). When the CPU 241 determines that the CPU 241 has received a participation discontinuation signal, the CPU 241 stores into the RAM 243 a numeric value obtained by adding 1 to the number R of players discontinuing participation in the RAM 243 as an updated number R of players discontinuing participation (step S255).

When the CPU 241 determines in step S254 that the CPU 241 has not received a participation discontinuation signal, or when the CPU 241 has executed the processing of step S253 or step S255, the CPU 241 determines whether or not the CPU 241 has received either a participation continuation signal or a participation discontinuation signal from every slot machine on which a game is played (step S256). In the processing, the CPU 241 determines whether or not the total number of the number Q of players continuing participation stored in the RAM 243 and the number R of players discontinuing participation stored in the RAM 243 matches the number of participation check signals transmitted in the processing of step S250. When the CPU 241 determines that the CPU 241 has not received either a participation continuation signal or a participation discontinuation signal from every slot machine on which a game is played, the CPU 241 returns the processing to step S252. On the other hand, when the CPU 241 determines that the CPU 241 has received either a participation continuation signal or a participation discontinuation signal from every slot machine on which a game is played, the CPU 241 ends the present subroutine.

Figure 13A:
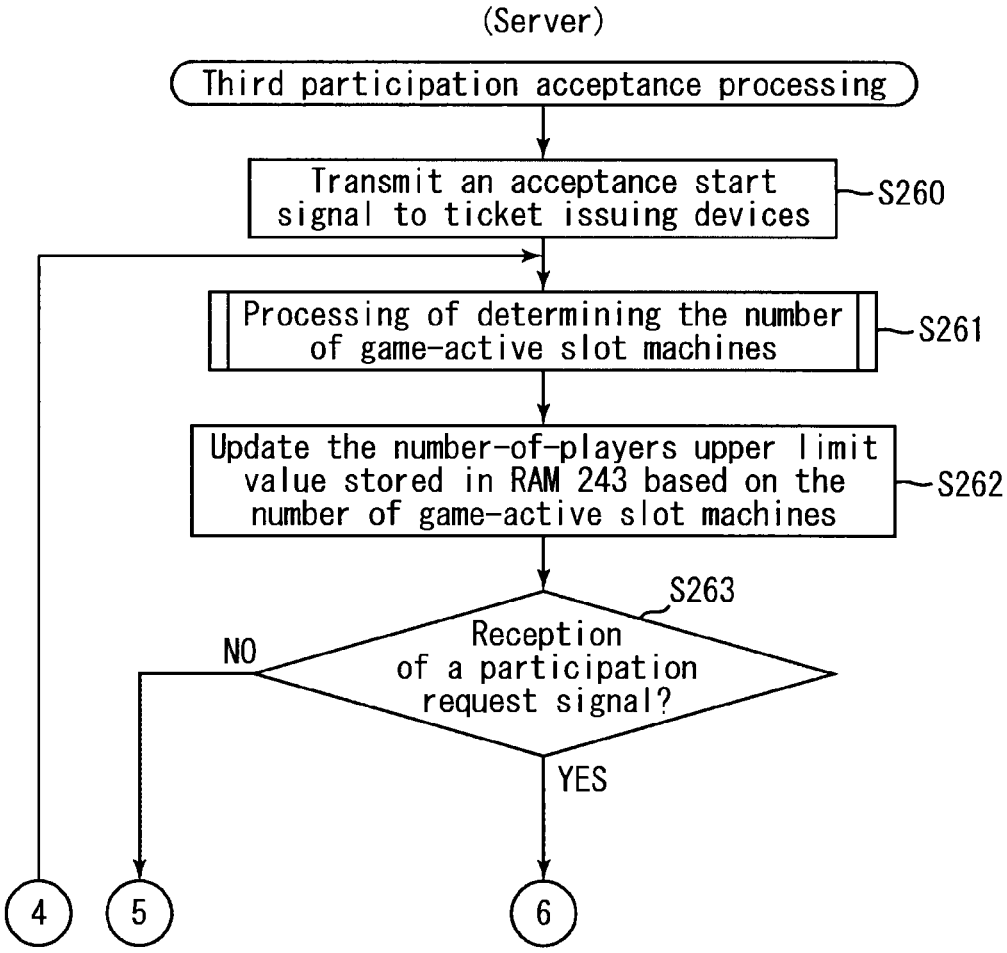
FIG. 13A is a flowchart illustrating a subroutine of third participation acceptance processing.

FIG. 13A is a flowchart illustrating a subroutine of the third participation acceptance processing.

Figure 13B:
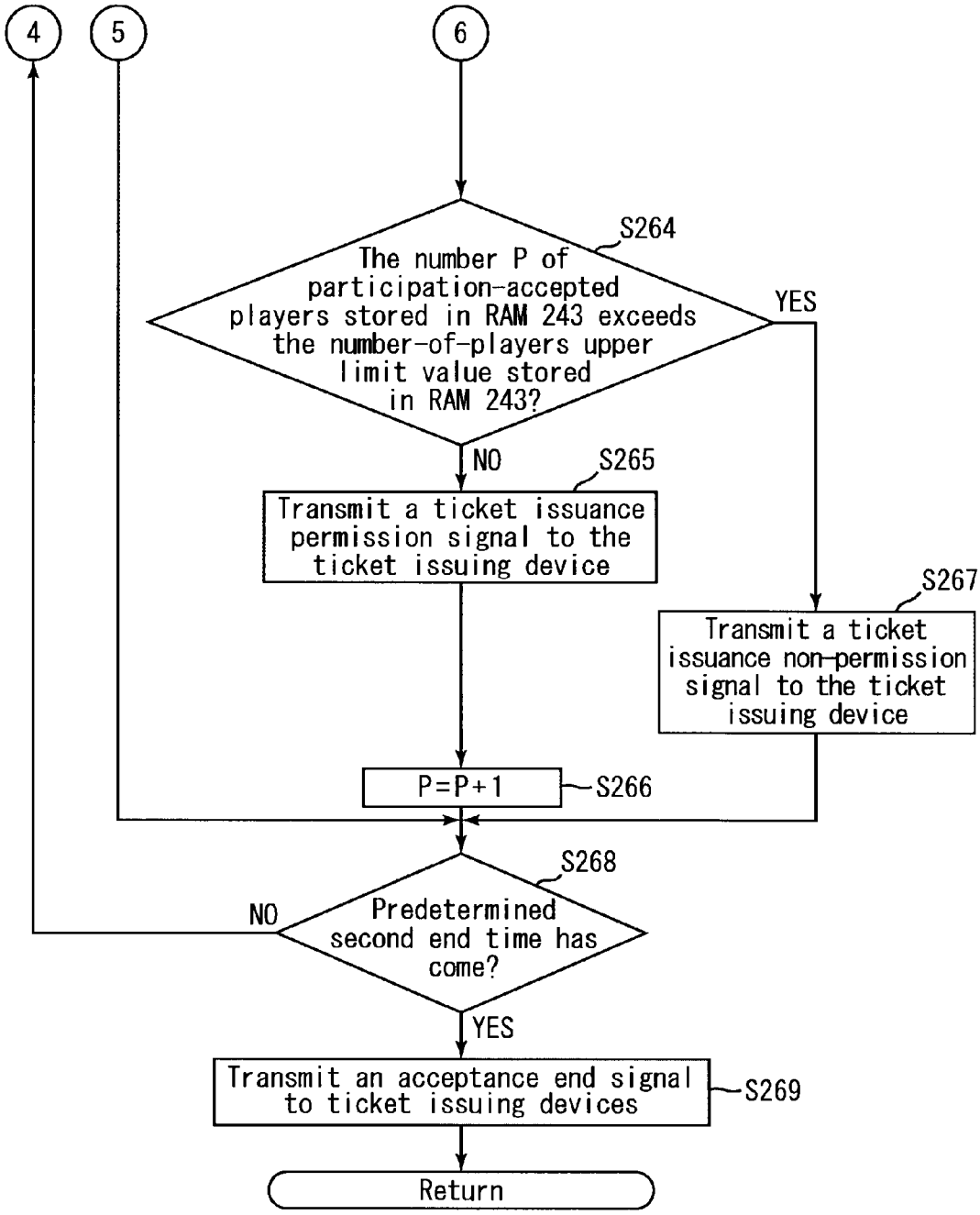

FIG. 13B is another flowchart illustrating the subroutine of the third participation acceptance processing.

First, the CPU 241 transmits an acceptance start signal to the ticket issuing devices 300 (step S260).

The CPU 241 then executes the processing of determining the number of game-active slot machines (step S261). In the processing, the CPU 241 determines the number of game-active slot machines which indicates the number of slot machines where a game is played. The processing of determining the number of game-active slot machines will be described later with reference to a drawing.

The CPU 241 updates the number-of-players upper limit value stored in the RAM 243, based on the number of game-active slot machines determined in step S261 (step S262). In the first embodiment, as described above, the CPU 241 subtracts the number of game-active slot machines from 50, which is the total number of the slot machines 10. That is, the CPU 241 determines the number of slot machines 10 on which no game is played. Thereafter, the CPU 241 obtains a numeric value by multiplying the number of slot machines 10 on which no game is played by 0.7 and truncating the digits after the decimal point, and then determines the obtained value as the number-of-players upper limit value. After that, the CPU 241 stores into the RAM 243 the determined number-of-players upper limit value as an updated number-of-players upper limit value.

The CPU 241 determines whether or not the CPU 241 has received a participation request signal from any of the ticket issuing devices 300 (step S263). When the CPU 241 determines that the CPU 241 has not received a participation request signal, the CPU 241 shifts the processing to step S268.

On the other hand, when the CPU 241 determines in step S263 that the CPU 241 has received a participation request signal, the CPU 241 determines whether or not the number P of participation-accepted players in the RAM 243 exceeds the number-of-players upper limit value in the RAM 243 (step S264). When determining that the number P of participation-accepted players does not exceed the number-of-players upper limit value, the CPU 241 transmits a ticket issuance permission signal to the ticket issuing device 300 as the transmission source of the participation request signal (step S265). Then, the CPU 241 stores into the RAM 243 a numeric value obtained by adding 1 to the number P of participation-accepted players in the RAM 243 as an updated number P of participation-accepted players (step S266).

On the other hand, when determining in step S264 that the number P of participation-accepted players exceeds the number-of-players upper limit value, the CPU 241 transmits a ticket issuance non-permission signal to the ticket issuing device 300 as the transmission source of the participation request signal (step S267).

When the CPU 241 determines in step S263 that the CPU 241 has not received a participation request signal, or when the CPU 241 has executed the processing of step S266 or step S267, the CPU 241 determines whether or not the predetermined second end time has come (step S268). In the processing, the CPU 241 determines whether or not the time shown by the clock 249 is the predetermined second end time. When determining that the predetermined second end time has not come yet, the CPU 241 returns the processing to step S261.

On the other hand, when determining in step S268 that the predetermined second end time has come, the CPU 241 transmits an acceptance end signal to the ticket issuing devices 300 (step S269).

After executing the processing of step S269, the CPU 241 ends the present subroutine.

Execution of the third participation acceptance processing makes it possible to issue a ticket 500 with a barcode based on the operational status of the gaming machines, until just before the tournament-type game starts.

Figure 14:
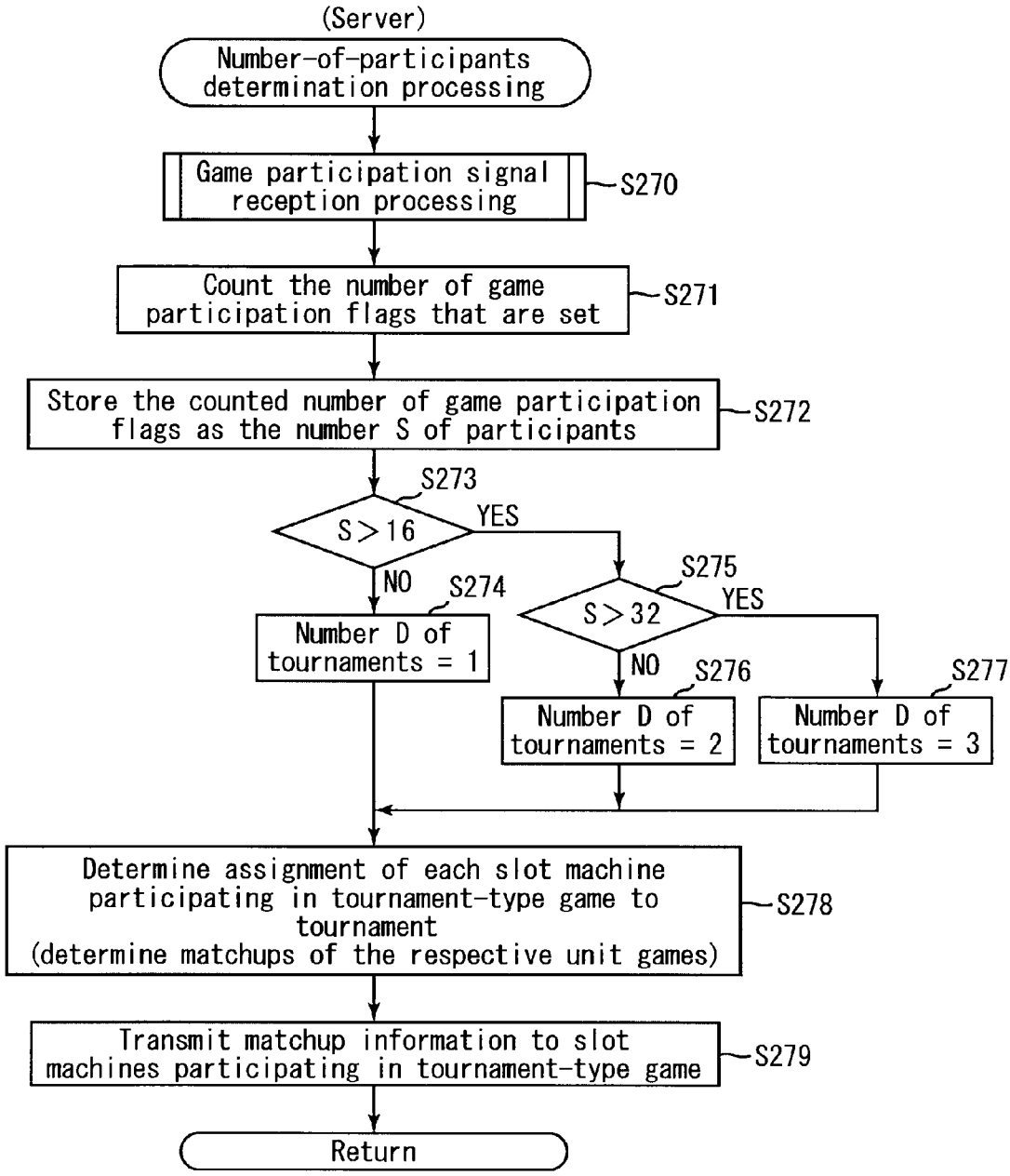
FIG. 14 is a flowchart illustrating a subroutine of number-of-participants determination processing.

FIG. 14 is a flowchart illustrating a subroutine of the number-of-participants determination processing.

First, the CPU 241 executes game participation signal reception processing (step S270). In the processing, when receiving a game participation signal, the CPU 241 sets a game participation flag in association with the identification number of the slot machine 10 as the transmission source. The game participation signal reception processing will be described later with reference to a drawing.

The CPU 241 counts the number of game participation flags that are set (step S271). Then, the CPU 241 stores the counted number of game participation flags into the RAM 243 as the number S of participants (step S272).

The CPU 241 determines whether or not the number S of participants in the RAM 243 is more than 16 (step S273). When determining that the number S of participants is not more than 16, the CPU 241 determines 1 as the number D of tournaments which indicates the number of tournaments in a tournament-type game (step S274). The CPU 241 then stores 1 into the RAM 243 as the number D of tournaments.

On the other hand, when determining in step S273 that the number S of participants is more than 16, the CPU 241 determines whether or not the number S of participants in the RAM 243 is more than 32 (step S275). When determining that the number S of participants is not more than 32, the CPU 241 determines 2 as the number D of tournaments which indicates the number of tournaments in a tournament-type game (step S276). The CPU 241 then stores 2 into the RAM 243 as the number D of tournaments.

On the other hand, when determining in step S275 that the number S of participants is more than 32, the CPU 241 determines 3 as the number D of tournaments which indicates the number of tournaments in a tournament-type game (step S277). The CPU 241 then stores 3 into the RAM 243 as the number D of tournaments.

In the first embodiment, the number of tournaments in a tournament-type game is changed in accordance with the number S of participants. This will avoid a situation in which the time it takes from beginning to end of a tournament-type game is long because one tournament includes too many participating players; as a result, it is possible to prevent players from getting tired of the game.

Further, when a tournament-type game starts, matches are held in respective tournaments. That is, matches in the respective tournaments are simultaneously held. In the first embodiment, the maximum number of tournaments is 3. Increasing the number of tournaments makes it possible to increase the number of players who can be accepted to participate in the tournament-type game.

When executing the processing of step S274, step S276, or step S277, the CPU 241 determines assignment of the slot machines 10 participating in the tournament-type game to the tournaments (step S278). In the processing, the CPU 241 first identifies the number D of tournaments which has been determined in the processing of step S274, step S276, or step S277. Next, the CPU 241 determines the number of tournament participants which indicates the number of players who participate in one tournament, based on the identified number D of tournaments and the number S of participants. For example, when the number D of tournaments is 2 and the number S of participants is 30, the number of tournament participants is 15.

Then, the CPU 241 assigns the slot machines 10 to a tournament tree from the left in the ascending order of the identification numbers of the slot machines 10 such that a slot machine 10 with the smallest identification number among the participating slot machines 10 is assigned to the leftmost position. When the CPU 241 has filled the tournament tree (when assignment of the slot machines 10 in number equal to the number of tournament participants has been completed), the CPU 241 starts assigning the slot machines 10 to the next tournament tree in the same way.

In a tournament, matches each involving two slot machines are held. A group consisting of two slot machines competing with each other in a match corresponds to a game group in the present invention.

A match held for each two slot machines (a game executed in each slot machine 10 by executing the processing of step S64 to step S75 (see FIG. 25A and FIG. 25B)) corresponds to a unit game in the present invention.

In the processing of step S278, matchups for the respective unit games (matches) in the respective tournaments are determined.

The CPU 241 transmits as matchup information the assignment of the slot machines 10 participating in the tournament-type game to the tournaments (the assignments determined in step S278) to the slot machines 10 participating in the tournament-type game (step S279).

After executing the processing of step S279, the CPU 241 ends the present subroutine.

Figure 15:
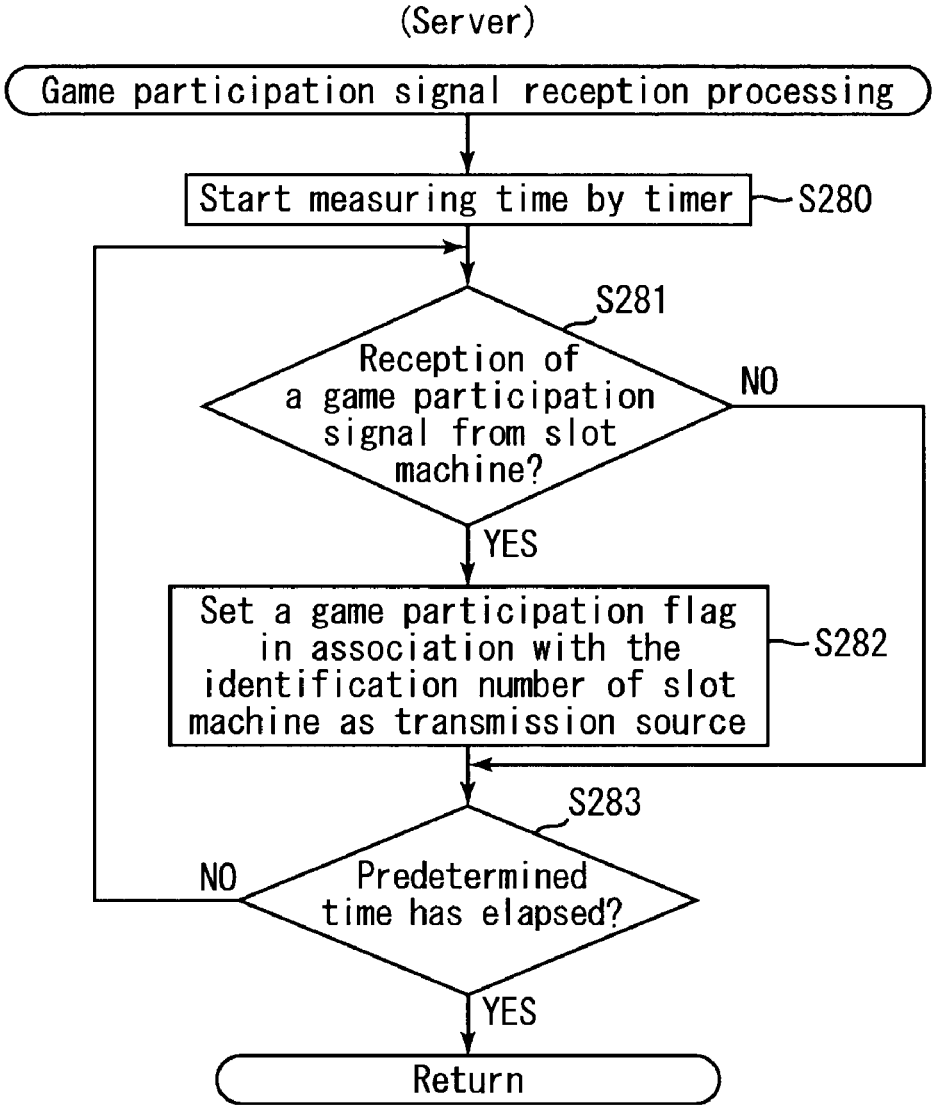
FIG. 15 is a flowchart illustrating a subroutine of game participation signal reception processing.

FIG. 15 is a flowchart illustrating a subroutine of game participation signal reception processing.

First, the CPU 241 starts measuring time with the timer 245, at a predetermined timing (step S280).

Next, the CPU 241 determines whether or not the CPU 241 has received a game participation signal from any of the slot machines 10 (step S281). When the CPU 241 determines that the CPU 241 has received a game participation signal, the CPU 241 sets a game participation flag in association with the identification number of the slot machine 10 as the transmission source of the game participation signal (step S282).

When the CPU 241 determines in step S281 that the CPU 241 has not received a game participation signal, or after the CPU 241 has executed the processing of step S282, the CPU 241 determines whether or not the predetermined time has elapsed (step S283). In the processing, the CPU 241 determines whether or not the time measured with the timer 245 has reached the predetermined time. When determining that the predetermined time has not elapsed, the CPU 241 returns the processing to step S281.

On the other hand, when determining in step S283 that the predetermined time has elapsed, the CPU 241 ends the present subroutine.

Figure 16A:
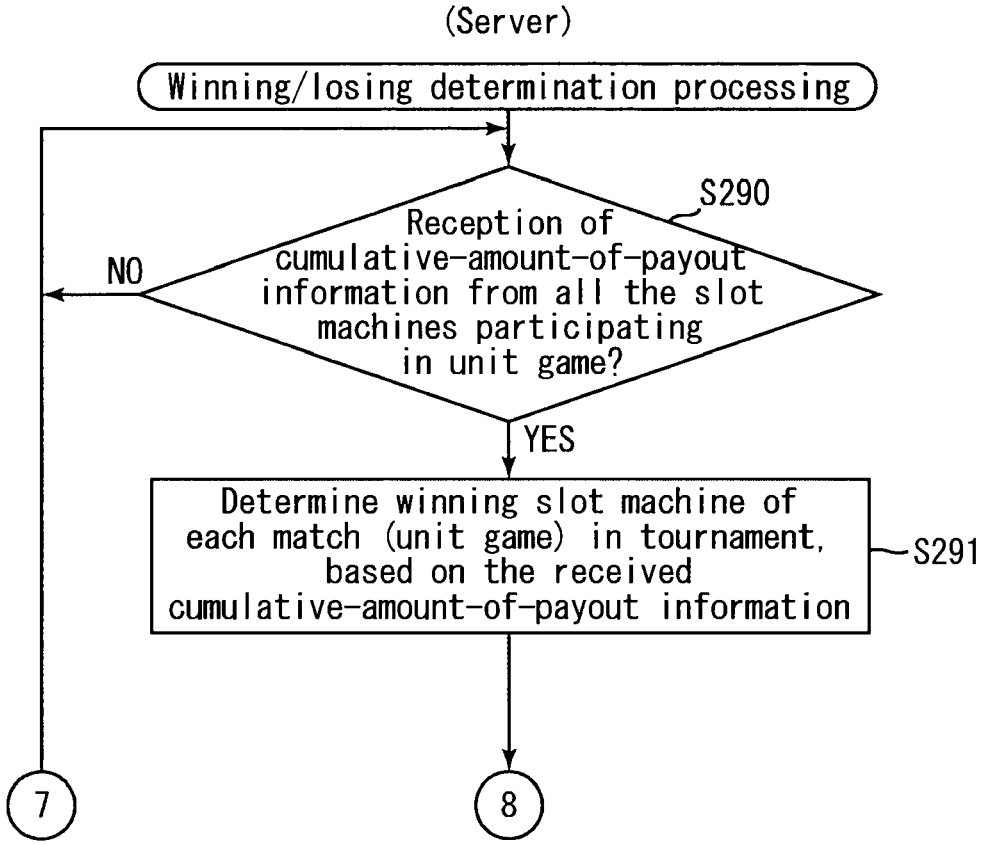
FIG. 16A is a flowchart illustrating a subroutine of winning/losing determination processing.

FIG. 16A is a flowchart illustrating a subroutine of the winning/losing determination processing.

Figure 16B:
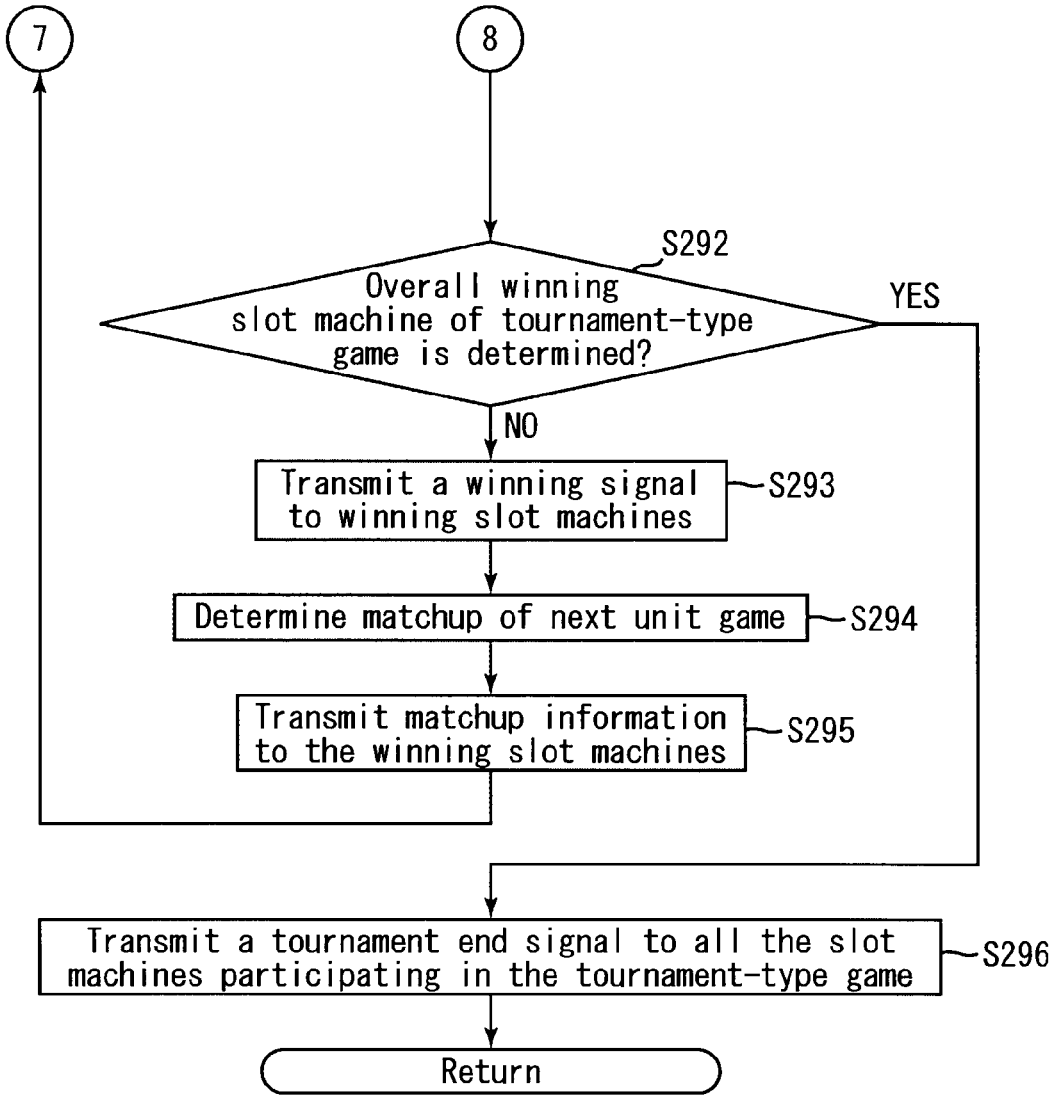
FIG. 16B is another flowchart illustrating the subroutine of the winning/losing determination processing.

FIG. 16B is another flowchart illustrating the subroutine of the winning/losing determination processing.

First, the CPU 241 determines whether or not the CPU 241 has received cumulative-amount-of-payout information from every slot machine participating in a unit game (step S290). When the CPU 241 determines that the CPU 241 has not received cumulative-amount-of-payout information from every slot machine participating in a unit game, the CPU 241 returns the processing to step S290.

On the other hand, when the CPU 241 determines that the CPU 241 has received cumulative-amount-of-payout information from every slot machine participating in a unit game, the CPU 241 determines the winning slot machine of each match (unit game) in the tournaments based on the received pieces of cumulative-amount-of-payout information (step S291). In the processing, the CPU 241 determines for each match the slot machine 10 with the cumulative-amount-of-payout information which shows a cumulative amount of payout larger than that of the cumulative-amount-of-payout information of the other slot machine 10 as the winning slot machine of the match. The determination is made based on the received pieces of cumulative-amount-of-payout information; the identification number of the slot machine 10 included in each piece of cumulative-amount-of-payout information; and the matchups of the respective unit games (matches) in the respective tournaments which have been determined in step S278.

The CPU 241 then determines whether or not the overall winning slot machine of the tournament-type game has been determined (step S292). In the processing, the CPU 241 determines whether or not only one slot machine 10 has been determined as the winning slot machine in every tournament. That is, in step S292, whether or not the overall winning slot machine 10 in every tournament is determined.

When the CPU 241 determines in step S292 that the overall winning slot machine of the tournament-type game has not been determined, the CPU 241 transmits a winning signal to the slot machines 10 that have been determined as the winning slot machines (step S293). It should be noted that when only one slot machine 10 has been determined as the winning slot machine in a tournament, the CPU 241 does not transmit the winning signal to the slot machine that has been determined as the winning slot machine in this tournament. That is, the CPU 241 does not transmit the winning signal to the slot machine 10 that has been determined as the overall winner.

The CPU 241 determines matchups for the next unit games (matches) (step S294). In the processing, the CPU 241 determines the matchups of the next unit games (matches), based on the winning slot machines determined in step S291 and assignment of the slot machines 10 to the tournaments which has been determined in step S278.

The CPU 241 transmits as matchup information the matchups of the unit games (matches) determined in step S294 to the slot machines 10 that have been determined as the winning slot machines (step S295).

After executing the processing of step S295, the CPU 241 returns the processing to step S290.

When determining in step S292 that the overall winning slot machine of the tournament-type game has been determined, the CPU 241 transmits a tournament end signal to all the slot machines 10 that participate in the tournament-type game (step S296). In the processing, the CPU 241 transmits the tournament end signal to the slot machines 10 for each of which a game participation flag is set in association with the identification number. The tournament end signal includes information on the ranking for each tournament in the executed tournament-type game. That is, the ranking of the respective slot machines is determined before the tournament end signal is transmitted. The slot machine 10 that has been determined as the overall winner takes first place, and the ranks of the respective other slot machines 10 are determined in order.

Figure 17:
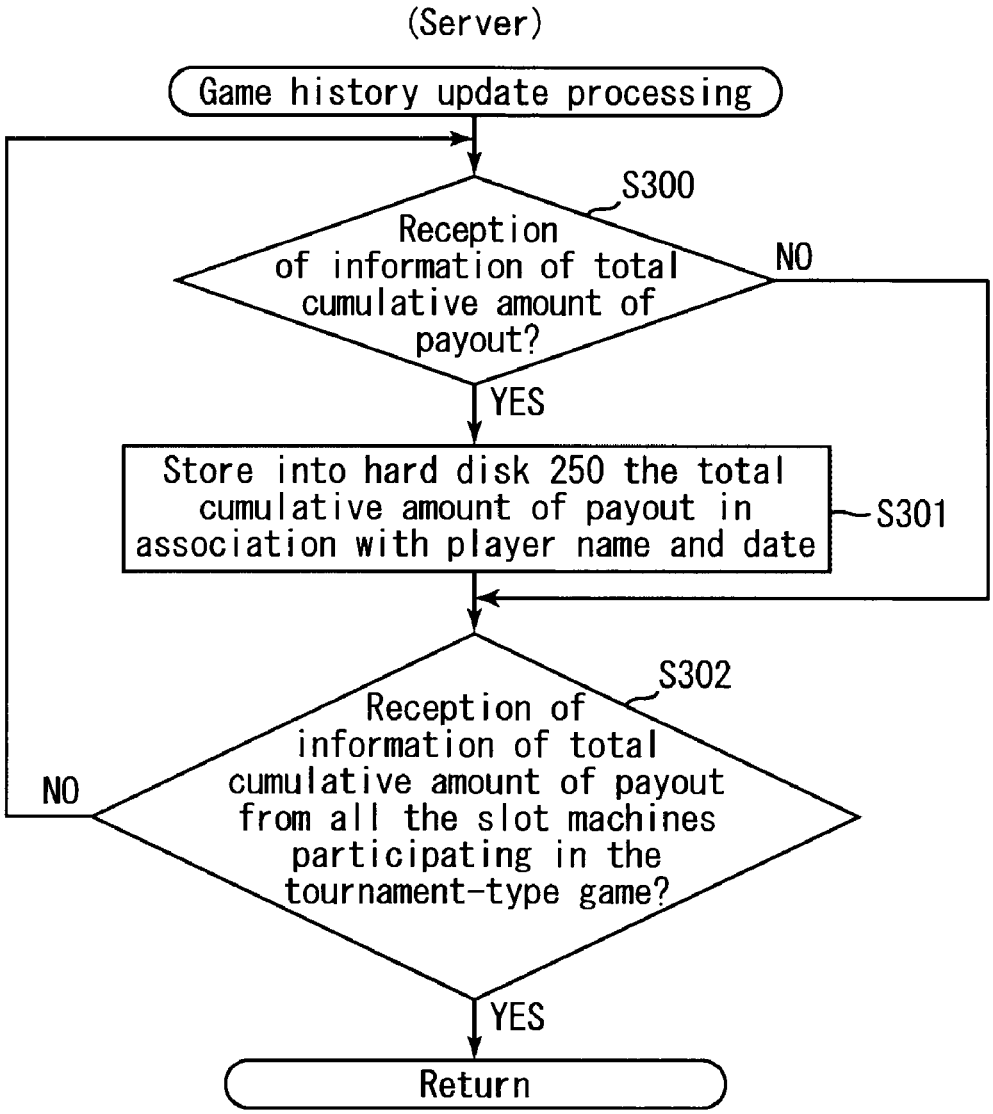
FIG. 17 is a flowchart illustrating a subroutine of game-history update processing.

FIG. 17 is a flowchart illustrating a subroutine of the game-history update processing.

First, the CPU 241 determines whether or not the CPU 241 has received total-cumulative-amount-of-payout information (step S300). When the CPU 241 determines that the CPU 241 has received total-cumulative-amount-of-payout information, the CPU 241 stores the total cumulative amount of payout shown by the total-cumulative-amount-of-payout information into the hard disk 250 in association with the player name and today's date which are included in the total-cumulative-amount-payout information (step S301).

When the CPU 241 determines in step S300 that the CPU 241 has not received total-cumulative-amount-of-payout information, or when the CPU 241 has executed the processing of step S301, the CPU 241 determines whether or not the CPU 241 has received total-cumulative-amount-of-payout information from every slot machine 10 participating in the tournament-type game (step S302). When the CPU 241 determines that the CPU 241 has not received total-cumulative-amount-of-payout information from every slot machine 10 participating in the tournament-type game, the CPU 241 returns the processing to step S300. On the other hand, when the CPU 241 determines that the CPU 241 has received total-cumulative-amount-of-payout information from every slot machine 10, the CPU 241 ends the present subroutine.

Figure 18:
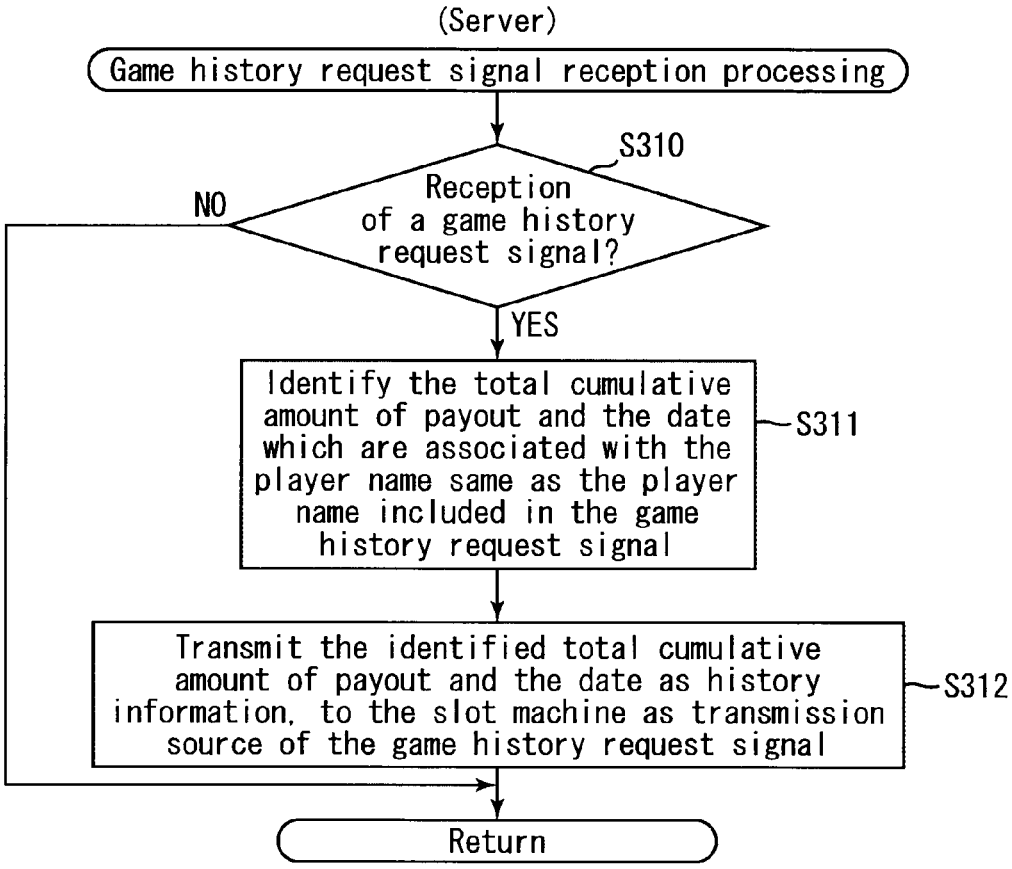
FIG. 18 is a flowchart illustrating a subroutine of game-history request signal reception processing.

FIG. 18 is a flowchart illustrating a subroutine of game-history request signal reception processing.

First, the CPU 241 determines whether or not the CPU 241 has received a game-history request signal from any of the slot machines 10 (step S310). When the CPU 241 determines that the CPU 241 has not received a game-history request signal from any of the slot machines 10, the CPU 241 ends the present subroutine.

On the other hand, when the CPU 241 determines in step S310 that the CPU 241 has received a game-history request signal from any of the slot machines 10, the CPU 241 identifies the total cumulative amount of payout and the date which are stored in the hard disk 250 in association with the player name that is same as the player name included in the received game-history request signal (step S311).

The CPU 241 then transmits as history information the total cumulative amount of payout and the date, which have been identified in step S311, to the slot machine 10 as the transmission source of the game-history request signal (step S312).

When the CPU 241 determines in step S310 that the CPU 241 has not received a game-history request signal from any one of the slot machines 10 or after the CPU 241 has executed the processing of step S312, the CPU 241 ends the present subroutine.

Figure 19:
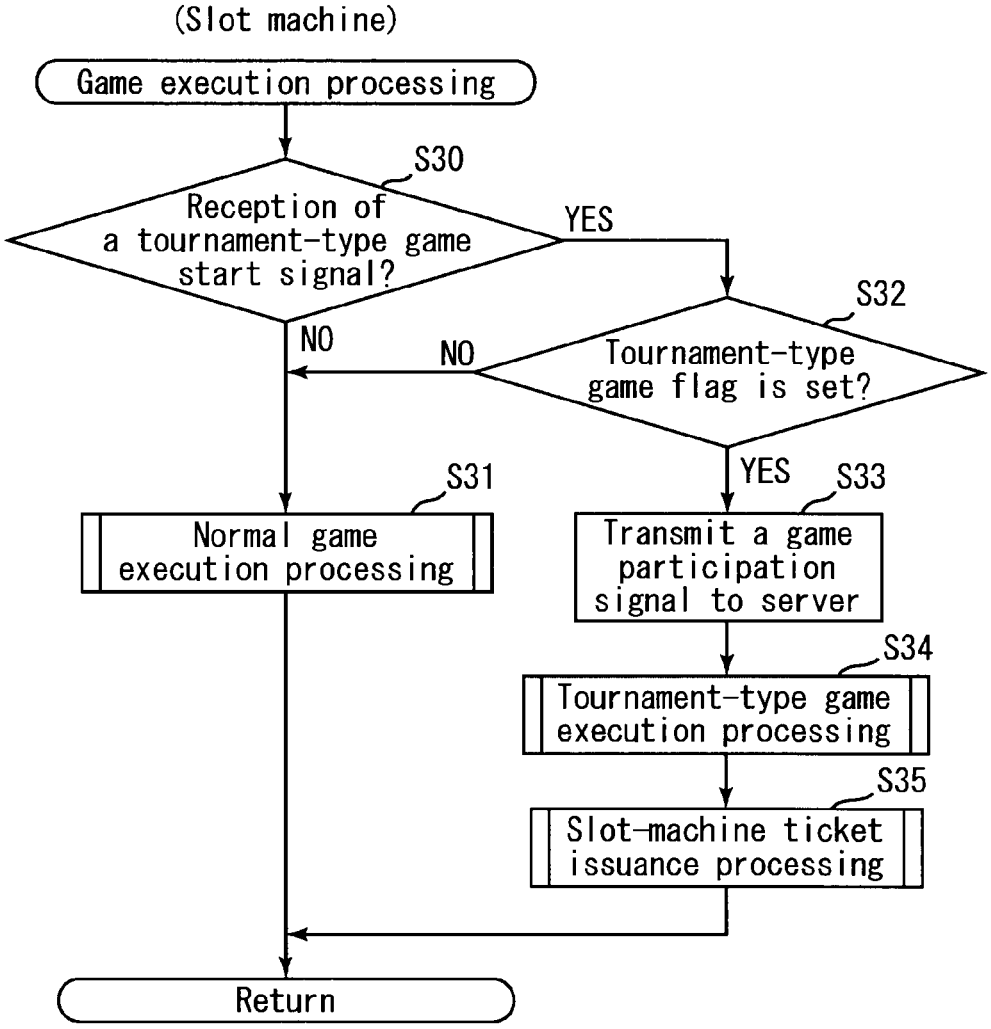
FIG. 19 is a flowchart illustrating game execution processing executed in each slot machine.

FIG. 19 is a flowchart illustrating game execution processing that is executed in each slot machine.

First, the main CPU 41 determines whether or not the main CPU 41 has received the tournament-type game start signal from the server 200, at a predetermined timing (step S30). When the main CPU 41 determines that the main CPU 41 has not received the tournament-type game start signal, the main CPU 41 executes normal-game execution processing (step S31). The normal-game execution processing will be described later in detail with reference to a drawing.

On the other hand, when the main CPU 41 determines in step S30 that the main CPU 41 has received the tournament-type game start signal, the main CPU 41 determines whether or not a tournament-type game flag is set (step S32). The tournament-type game flag is set in flag setting processing shown in FIG. 20 or participation check signal reception processing shown in FIG. 21.

When the main CPU 41 determines in step S32 that the tournament-type game flag is not set, the main CPU 41 executes the normal-game execution processing (step S31).

The normal-game execution processing will be described later in detail with reference to a drawing.

On the other hand, when the main CPU 41 determines in step S32 that the tournament-type game flag is set, the main CPU 41 transmits a game participation signal to the server 200 (step S33). The game participation signal includes the identification number of the slot machine 10.

The main CPU 41 executes tournament-type game execution processing (step S34). The tournament-type game execution processing will be described later with reference to drawings.

The main CPU 41 executes slot-machine ticket issuance processing (step S35). The slot-machine ticket issuance processing will be described later with reference to drawings.

When executing the processing of step S31 or step S35, the main CPU 41 ends the game execution processing.

Figure 20:
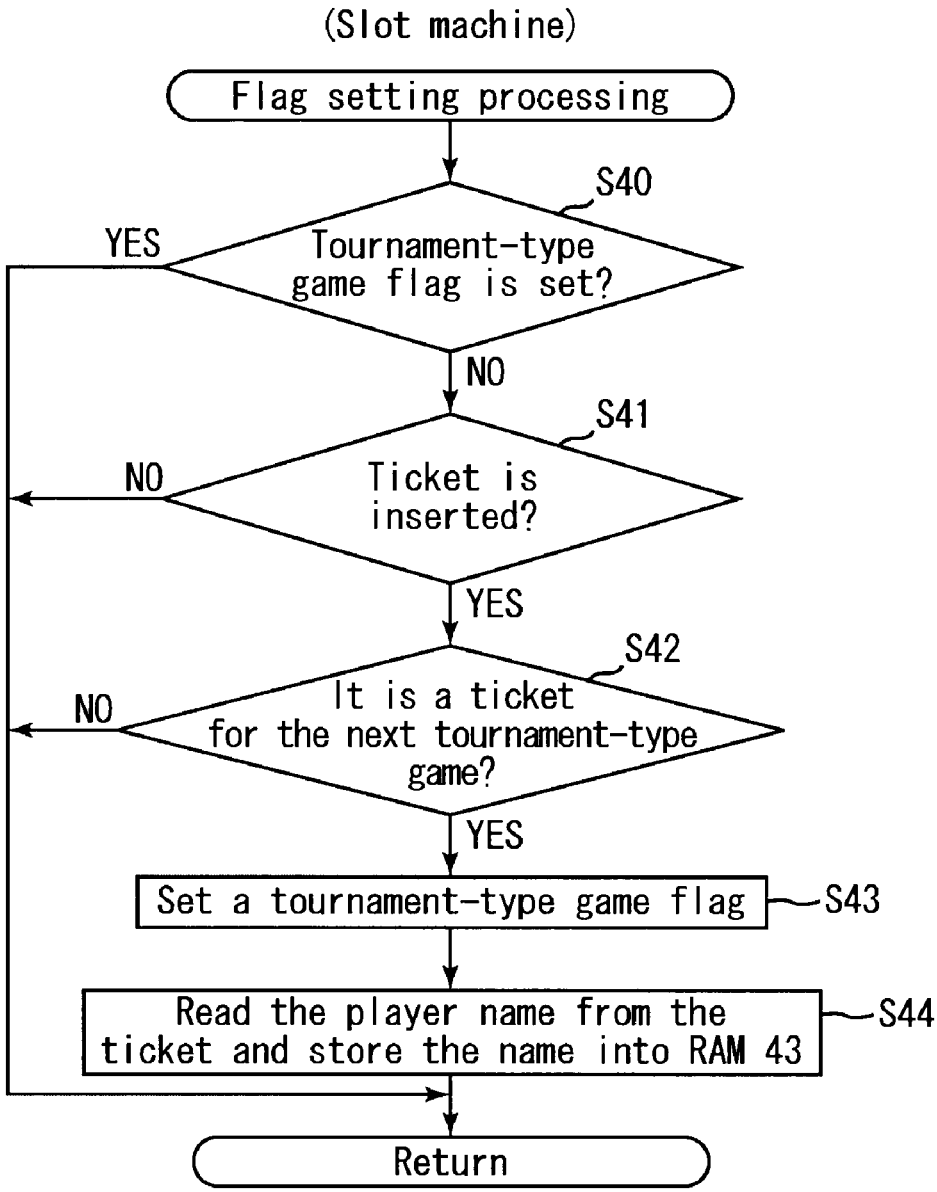
FIG. 20 is a flowchart illustrating a subroutine of flag setting processing.

FIG. 20 is a flowchart illustrating a subroutine of the flag setting processing.

The main CPU 41 first determines whether or not the tournament-type game flag is set, at a predetermined timing (step S40). When determining that the tournament-type game flag is set, the main CPU 41 ends the present subroutine.

On the other hand, when determining in step S40 that the tournament-type game flag is not set, the main CPU 41 determines whether or not a ticket 500 with a barcode is inserted into the bill validator 22 (step S41). When determining that a ticket 500 with a barcode is not inserted into the bill validator 22, the main CPU 41 ends the present subroutine.

On the other hand, when determining in step S41 that a ticket 500 with a barcode is inserted into the bill validator 22, the main CPU 41 determines whether or not the ticket 500 with a barcode that has been inserted into the bill validator 22 is a ticket 500 with a barcode for participating in the next tournament-type game (step S42). In the first embodiment, a tournament-type game is executed every two hours. Therefore, in the processing of step S42, the main CPU 41 determines whether or not the start time of the tournament-type game that the main CPU 41 has read from the ticket 500 with a barcode inserted into the bill validator 22 is within two hours from the time shown by the clock 62.

When determining in step S42 that the ticket 500 with a barcode inserted into the bill validator 22 is not a ticket 500 with a barcode for participating in the next tournament-type game, the main CPU 41 ends the present subroutine.

When determining in step S42 that the ticket 500 with a barcode inserted into the bill validator 22 is a ticket 500 with a barcode for participating in the next tournament-type game, the main CPU 41 sets the tournament-type game flag (step S43).

Next, the main CPU 41 reads the player name from the ticket 500 with a barcode inserted into the bill validator 22, and stores the read player name into the RAM 43 (step S44).

After executing the processing of step S44, the main CPU 41 ends the present subroutine.

Figure 21:
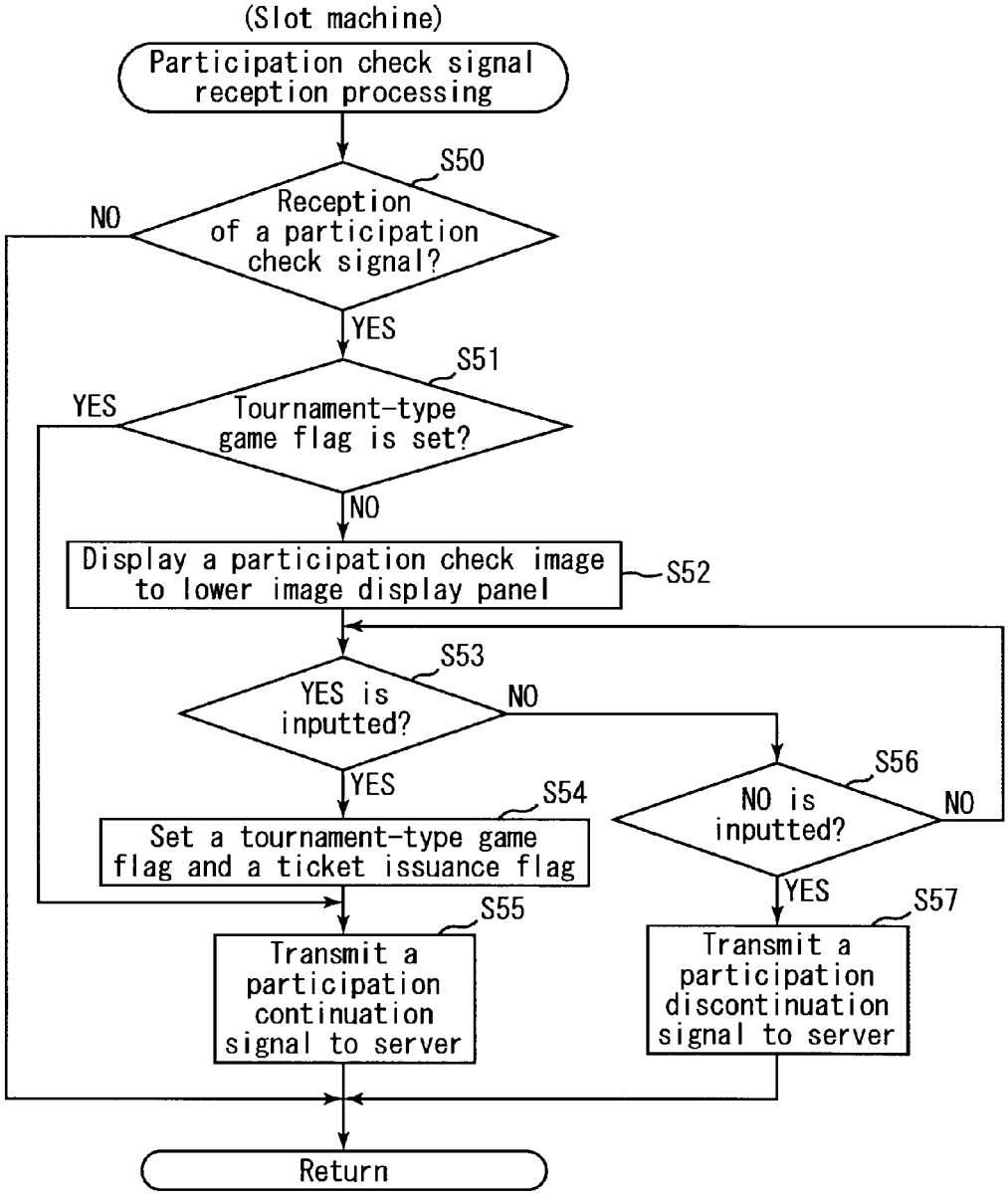
FIG. 21 is a flowchart illustrating a subroutine of participation check signal reception processing.

FIG. 21 is a flowchart illustrating a subroutine of the participation check signal reception processing.

First, the main CPU 41 determines whether or not the main CPU 41 has received the participation check signal from the server 200 (step S50). When the main CPU 41 determines that the main CPU 41 has not received the participation check signal, the main CPU 41 ends the present subroutine.

On the other hand, when the main CPU 41 determines in step S50 that the main CPU 41 has received the participation check signal, the main CPU 41 determines whether or not the tournament-type game flag is set (step S51). When determining that the tournament-type game flag is set, the main CPU 41 shifts the processing to step S55.

On the other hand, when determining in step S51 that the tournament-type game flag is not set, the main CPU 41 displays a participation check image to the lower image display panel 16 (step S52).

Figure 22:
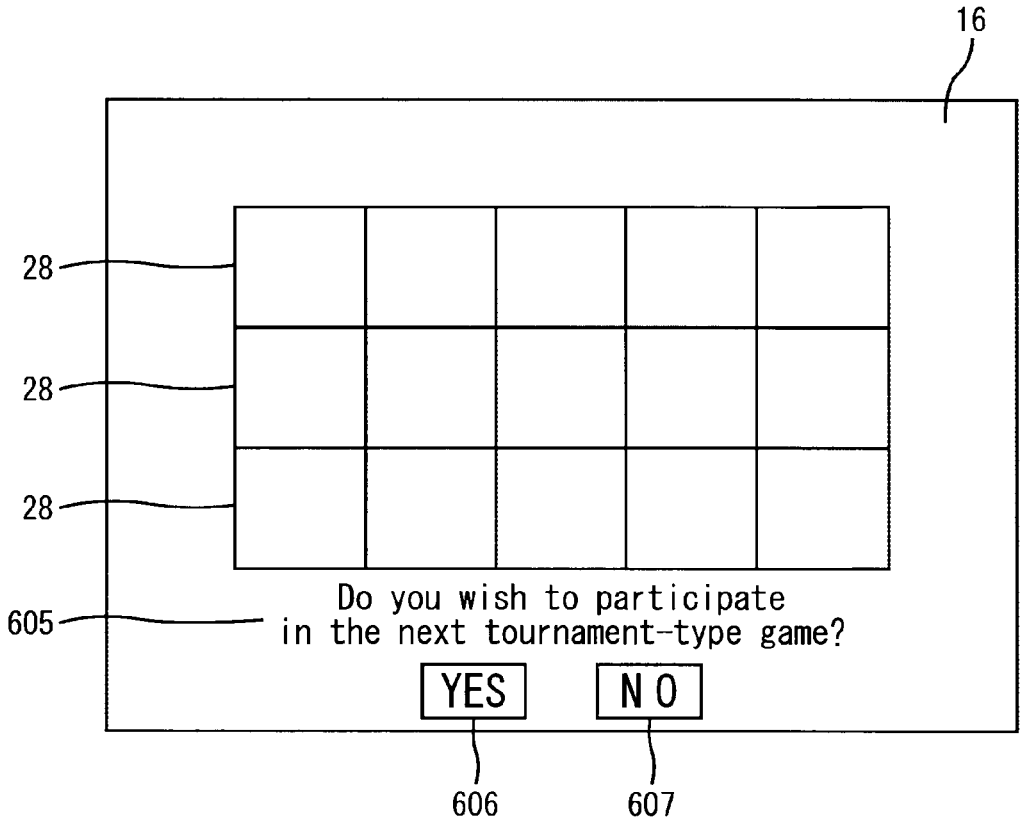
FIG. 22 is a view illustrating an exemplary image displayed to a lower image display panel provided in each slot machine constituting the ticket issuing system according to the first embodiment of the present invention.

FIG. 22 is a view illustrating an exemplary image that is displayed to the lower image display panel provided in each slot machine constituting the ticket issuing system according to the first embodiment of the present invention.

In FIG. 22, a participation check image 605 is displayed below the display blocks 28 that are displayed to the lower image display panel 16. Below the participation check image 605, a YES image 606 and a NO image 607 are displayed.

The participation check image 605 is an image that asks a player whether or not the player wishes to participate in the next tournament-type game. If the player wishes to participate in the next tournament-type game, the player can input "YES" via the touch panel 69 by touching the portion where the YES image 606 is displayed, with the finger or the like. On the other hand, if the player wishes not to participate in the next tournament-type game, the player can input "NO" via the touch panel 69 by touching the portion where the NO image 607 is displayed, with the finger or the like.

Referring back to FIG. 21, the main CPU 41 determines whether or not "YES" has been inputted (step S53). When determining that "YES" has been inputted, the main CPU 41 sets the tournament-type game flag and a ticket issuance flag (step S54).

When determining in step S51 that the tournament-type game flag is set, or when executing the processing of step S54, the main CPU 41 transmits a participation continuation signal to the server 200 (step S55).

On the other hand, when determining in step S53 that "YES" has not been inputted, the main CPU 41 determines whether or not "NO" has been inputted (step S56). When determining that "NO" has not been inputted, the main CPU 41 returns the processing to step S53.

On the other hand, when determining in step S56 that "NO" has been inputted, the main CPU 41 transmits a participation discontinuation signal to the server 200 (step S57).

When determining in step S50 that the main CPU 41 has not received the participation check signal or when executing the processing of step S55 or step S57, the main CPU 41 ends the present subroutine.

Figure 23:
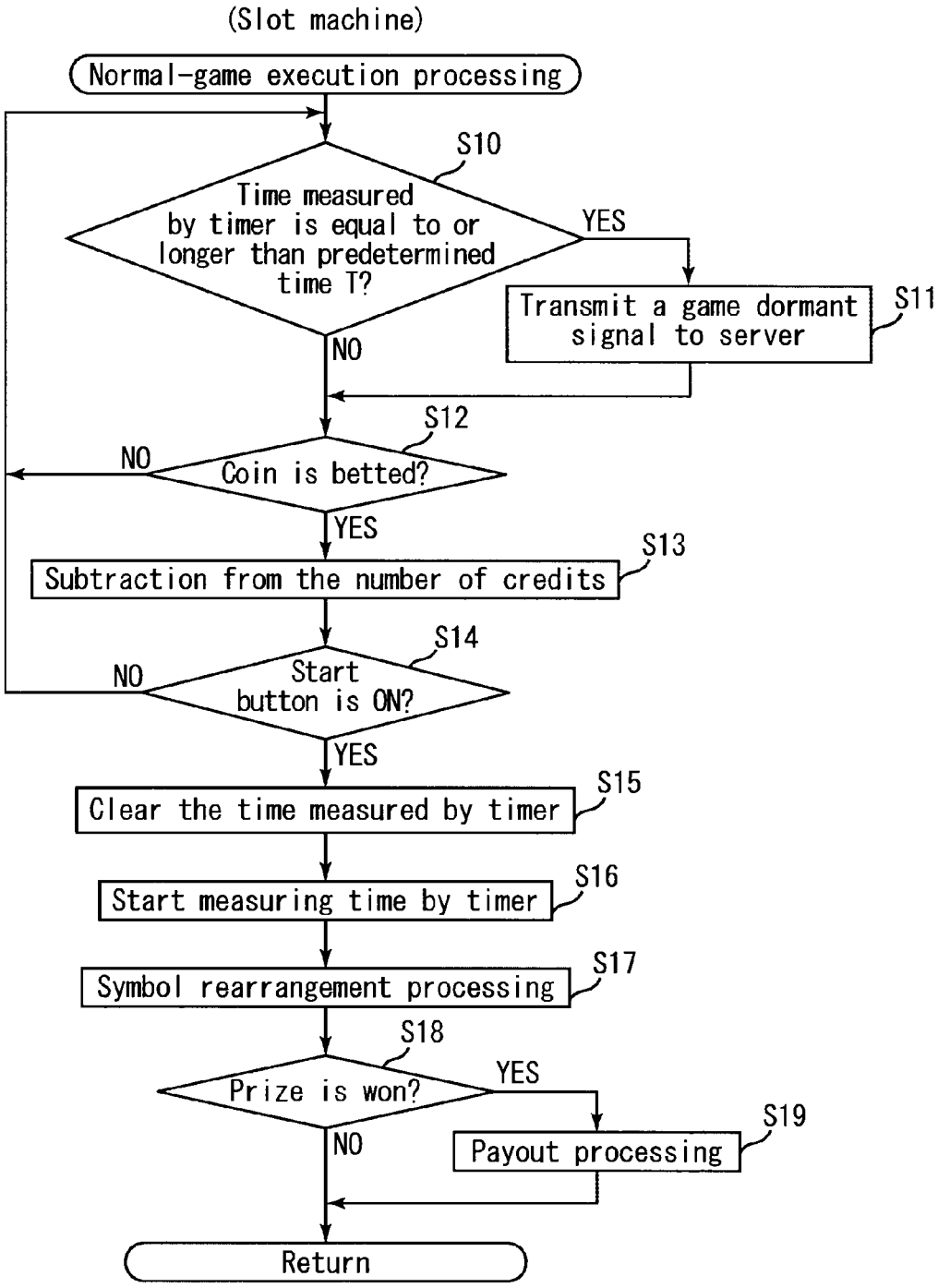
FIG. 23 is a flowchart illustrating a subroutine of normal-game execution processing.

FIG. 23 is a flowchart illustrating a subroutine of normal-game execution processing.

FIG. 24 is a view illustrating correspondence relationship between a type and the number of rearranged symbols and an amount of payout.

First, the main CPU 41 determines whether or not the time measured with the timer 61 is equal to or longer than predetermined time T (step S10).

When determining in step S10 that the measured time is not equal to or longer than the predetermined time T, the main CPU 41 shifts the processing to step S12. On the other hand, when determining in step S10 that the measured time is equal to or longer than the predetermined time T, the main CPU 41 transmits a game dormant signal to the server 200 (step S11). The game dormant signal includes the identification number of the slot machine 10.

The main CPU 41 determines whether or not a coin has been betted (step S12). In this processing, the main CPU 41 determines whether or not the main CPU 41 has received an input signal that is outputted from the 1-BET switch 26S when the 1-BET button 26 is operated, or an input signal that is outputted from the maximum BET switch 27S when the maximum BET button 27 is operated. When determining that a coin has not been betted, the main CPU 41 returns the processing to step S10.

On the other hand, when determining in step S12 that a coin has been betted, the main CPU 41 executes processing for making a subtraction from the number of credits stored in the RAM 43 according to the number of betted coins (step S13). It is to be noted that, when the number of coins to be betted is larger than the number of credits stored in the RAM. 43, the main CPU 41 does not execute the processing for making a subtraction from the number of credits stored in the RAM 43, and returns the processing to step S10. Further, when the number of coins to be betted exceeds the upper limit of the number of coins that can be betted in one game (50 coins in the first embodiment), the main CPU 41 does not execute the processing for making a subtraction from the number of credits stored in the RAM 43, and proceeds with the processing to step S14.

Next, the main CPU 41 determines whether or not the start button 23 has been turned ON (step S14). In this processing, the main CPU 41 determines whether or not the main CPU 41 has received an input signal that is outputted from the start switch 23S when the start button 23 is pressed.

When the main CPU 41 determines that the start button 23 has not been turned ON, the main CPU 41 returns the processing to step S10.

It is to be noted that, when the start button 23 is not turned ON (e.g. when the start button 23 is not turned ON and a command to end the game is inputted), the main CPU 41 cancels the subtraction result in step S13.

On the other hand, when determining in step S14 that the start button 23 is turned ON, the main CPU 41 clears the time measured with the timer 61 (step S15) and starts measurement of the time with the timer 61 (step S16).

Next, the main CPU 41 executes symbol rearrangement processing (step S17).

In this processing, the main CPU 41 first starts scroll-display of symbols in the display blocks 28. Then, the main CPU 41 executes the aforementioned symbol determination program, so as to determine the symbols to be rearranged, and then rearranges the symbols in the display blocks 28.

Next, the main CPU 41 determines whether or not a prize has been won (step S18). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 28 (see FIG. 24). In this processing, the main CPU 41 counts the number of symbols for each type of the symbols rearranged in step S17. Then, the main CPU 41 determines whether or not the counted number is three or more.

When determining that a prize has been won, the main CPU 41 executes processing relating to payout of coins (step S19). In the processing, the main CPU 41 determines the amount of payout based on the numbers of rearranged symbols with reference to the odds data stored in the RAM 43.

The odds data is data indicative of the correspondence relationship between the number of symbols rearranged in the display blocks 28 and the amount of payout (see FIG. 24).

For example, in the case where three symbols of "SUN" are rearranged after two coins have been betted, 20 (=2×10) coins are paid out.

In the case of accumulating coins, the main CPU 41 conducts processing for adding the number of credits corresponding to the determined amount of payout to the number of credits stored in the RAM 43. On the other hand, in the case of paying out coins, the main CPU 41 transmits a control signal to the hopper 66 in order to pay out coins in an amount corresponding to the determined amount of payout.

When determining in step S18 that no prize has been won or after executing the processing of step S19, the main CPU 41 ends the present subroutine.

Figure 25A:
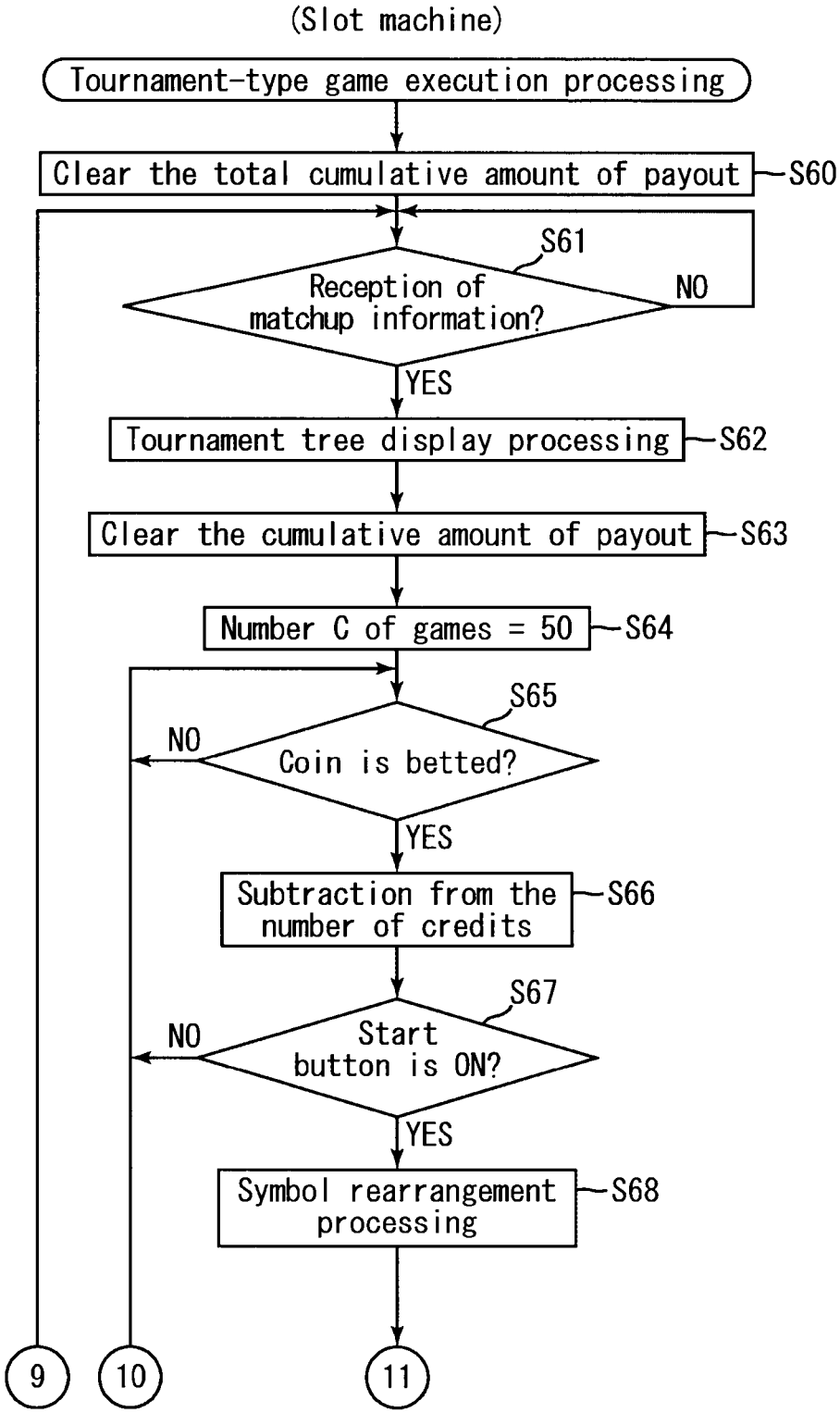
FIG. 25A is a flowchart illustrating a subroutine of tournament-type game execution processing.

FIG. 25A is a flowchart illustrating a subroutine of the tournament-type game execution processing.

Figure 25B:
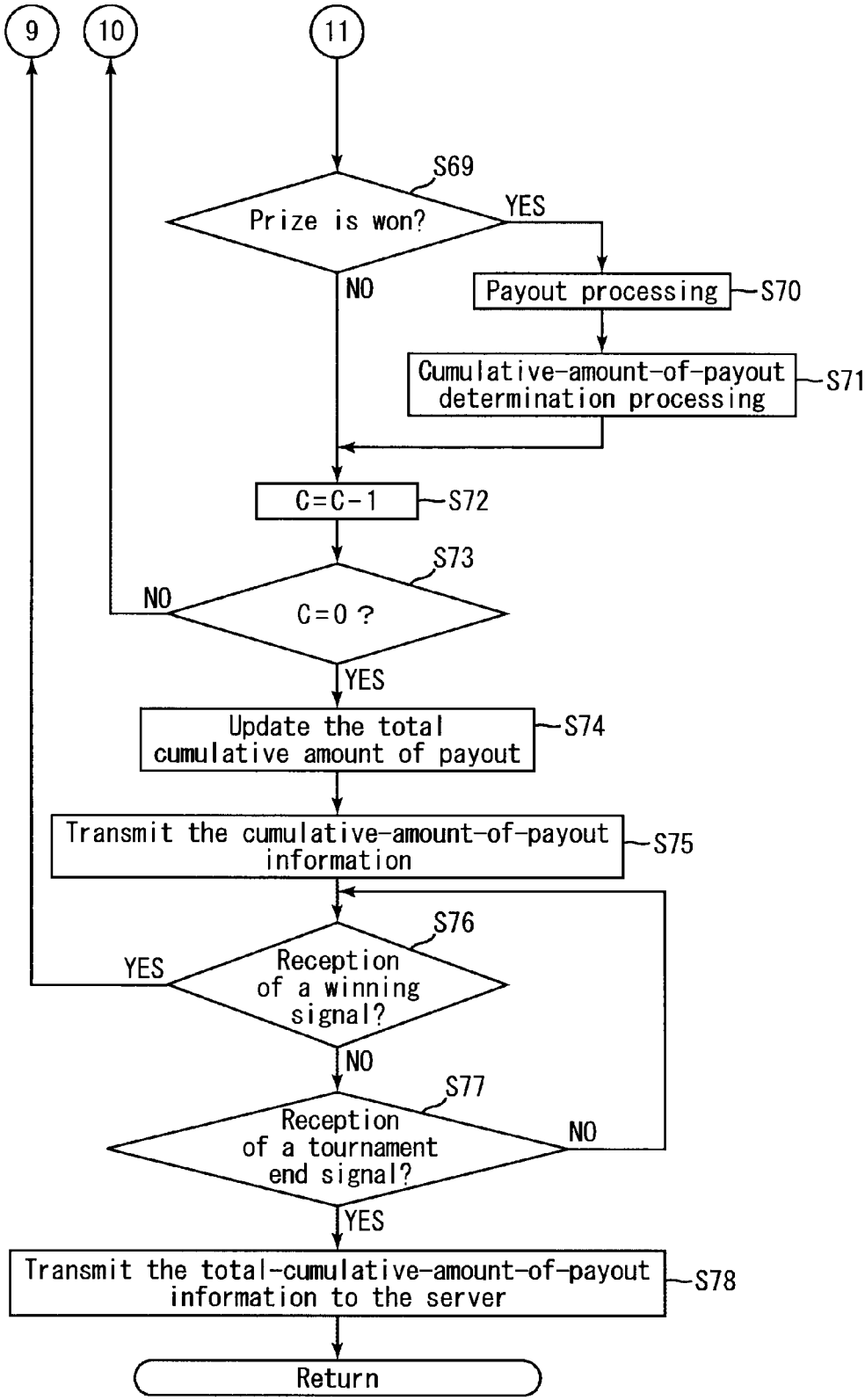
FIG. 25B is another flowchart illustrating the subroutine of the tournament-type game execution processing.

FIG. 25B is another flowchart illustrating the subroutine of the tournament-type game execution processing.

First, the main CPU 41 stores 0 into the RAM 43 as an updated total cumulative amount of payout (step S60).

The main CPU 41 determines whether or not the main CPU 41 has received matchup information from the server 200 (step S61). When the main CPU 41 determines that the main CPU 41 has not received matchup information, the main CPU 41 returns the processing to step S61.

On the other hand, when the main CPU 41 determines in step S61 that the main CPU 41 has received matchup information, the main CPU 41 executes tournament-tree display processing (step S62). In the processing, the main CPU 41 displays a tournament tree image to the upper image display panel 33, based on the received matchup information.

Figure 26:
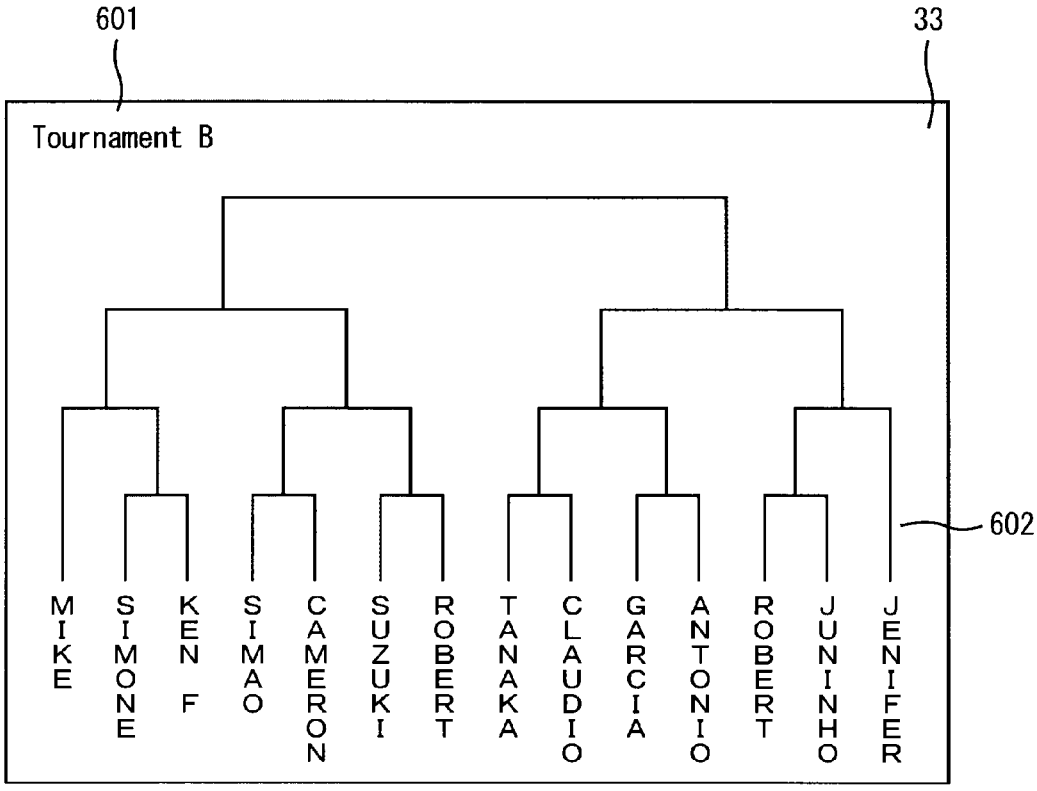
FIG. 26 is a view illustrating an exemplary image that is displayed to an upper image display panel provided in each slot machine constituting the ticket issuing system according to the first embodiment of the present invention.

FIG. 26 is a view illustrating an exemplary image displayed to the upper image display panel that is provided in each slot machine constituting the ticket issuing system according to the first embodiment of the present invention.

In FIG. 26, the upper image display panel 33 displays a tournament tree image 602. To the lower part of the tournament tree image 602, the player names of the players participating in the tournament-type game are displayed. Looking at the tournament tree image 602, each player gets to know the player name of the player against whom he or she is going to have a match. A tournament name image 601 shows the name of the tournament.

In the first embodiment, the number of tournaments in a tournament-type game changes within the range of 1 to 3 in accordance with the number S of participants. The name of the first tournament is Tournament A. The name of the second tournament is Tournament B. The name of the third tournament is Tournament C.

In FIG. 26, the tournament name image 601 says Tournament B. That is, the tournament name image 601 indicates that this tournament is the second tournament in the tournament-type game.

Referring back to FIG. 25A, the main CPU 41 stores 0 into the RAM 43 as an updated cumulative amount of payout (step S63).

The main CPU 41 stores 50 into the RAM 43 as an updated number C of games (step S64).

The main CPU 41 determines whether or not a coin has been betted (step S65). In the processing, the main CPU 41 determines whether or not the main CPU 41 has received an input signal outputted from the 1-BET switch 26S when the 1-BET button 26 is operated or an input signal outputted from the maximum BET switch 27S when the maximum BET button 27 is operated. When determining that a coin has not been betted, the main CPU 41 returns the processing to step S65.

On the other hand, when determining in step S65 that a coin has been betted, the main CPU 41 conducts processing of making a subtraction from the number of credits stored in the RAM 43 in accordance with the number of the betted coins (step S66). Here, in the case that the number of betted coins is larger than the number of credits stored in the RAM 43, the main CPU 41 returns the processing to step S65 without executing the processing of making a subtraction from the number of credits stored in the RAM 43. Further, in the case that the number of betted coins exceeds the upper limit value of the number of coins that can be betted in a single game (50 coins, in the first embodiment), the main CPU 41 proceeds with the processing to step S67 without executing the processing of making a subtraction from the number of credits stored in the RAM 43.

Next, the main CPU 41 determines whether or not the start button 23 has been turned ON (step S67). In the processing, the main CPU 41 determines whether or not the main CPU 41 has received an input signal that is outputted from the start switch 23S when the start button 23 is pressed.

When determining that the start button 23 has not been turned ON, the main CPU 41 returns the processing to step S65.

Here, in the case that the start button 23 is not turned ON (e.g. when the start button 23 is not turned ON and a command to end the game is inputted), the main CPU 41 cancels the subtraction result in step S66.

On the other hand, when determining in step S67 that the start button 23 has been turned ON, the main CPU 41 executes symbol rearrangement processing (step S68).

In this processing, the main CPU 41 first starts scroll-display of symbols in the display blocks 28. Then, the main CPU 41 executes the aforementioned symbol determination program, so as to determine the symbols to be rearranged, and then rearranges the symbols in the display blocks 28.

Next, the main CPU 41 determines whether or not a prize has been won (step S69). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 28 (see FIG. 24). In this processing, the main CPU 41 counts the number of symbols for each type of the symbols rearranged in step S68. Then, the main CPU 41 determines whether or not the counted number is three or more.

When determining that a prize has been won, the main CPU 41 executes processing relating to payout of coins (step S70). In the processing, the main CPU 41 determines the amount of payout based on the numbers of rearranged symbols with reference to the odds data stored in the RAM 43. The odds data is data indicative of the correspondence relationship between the number of symbols rearranged in the display blocks 28 and the amount of payout (see FIG. 24).

In the case of accumulating coins, the main CPU 41 conducts processing for adding the number of credits corresponding to the determined amount of payout to the number of credits stored in the RAM 43. On the other hand, in the case of paying out coins, the main CPU 41 transmits a control signal to the hopper 66 in order to pay out coins in an amount corresponding to the determined amount of payout.

The main CPU 41 executes cumulative-amount-of-payout determination processing (step S71). In the processing, the main CPU 41 stores into the RAM 43 a numeric value obtained by adding the amount of payout determined in step S70 to the cumulative amount of payout stored in the RAM 43, as an updated cumulative amount of payout.

When determining in step S69 that no prize has been won, or when executing the processing of step S71, the main CPU 41 stores into the RAM 43 a numeric value obtained by subtracting 1 from the number C of games stored in the RAM 43, as an updated number C of games (step S72).

The main CPU 41 determines whether or not the number C of games stored in the RAM 43 has reached 0 (step S73). When determining that the number C of games has not reached 0, the main CPU 41 returns the processing to step S65.

On the other hand, when determining that the number C of games has reached 0, the main CPU 41 updates the total cumulative amount of payout (step S74). In the processing, the main CPU 41 stores into the RAM 43 a numeric value obtained by adding the cumulative amount of payout stored in the RAM 43 to the total cumulative amount of payout stored in the RAM 43, as an updated total cumulative amount of payout.

The main CPU 41 transmits cumulative-amount-of-payout information to the server 200 (step S75). The cumulative-amount-of-payout information includes the identification number of the slot machine 10.

The main CPU 41 determines whether or not the main CPU 41 has received the winning signal from the server 200 (step S76). When the main CPU 41 determines that the main CPU 41 has received the winning signal, the main CPU 41 returns the processing to step S61.

On the other hand, when the main CPU 41 determines in step S76 that the main CPU 41 has not received the winning signal, the main CPU 41 determines whether or not the main CPU 41 has received the tournament end signal from the server 200 (step S77). When the main CPU 41 determines that the main CPU 41 has not received the tournament end signal, the main CPU 41 returns the processing to step S76.

On the other hand, when the main CPU 41 determines in step S77 that the main CPU 41 has received the tournament end signal, the main CPU 41 transmits total-cumulative-amount-of-payout information indicative of the total cumulative amount of payout, which is stored in the RAM 43, to the server 200 (step S78). The total-cumulative-amount-of-payout information includes the identification number of the slot machine 10 and the player name stored in the RAM 43.

It should be noted that, when no player name is stored in the RAM 43, the main CPU 41 displays alphabets to the lower image display panel and accepts input of the player name via the touch panel 69.

After executing the processing of step S78, the main CPU 41 ends the present subroutine.

Figure 27A:
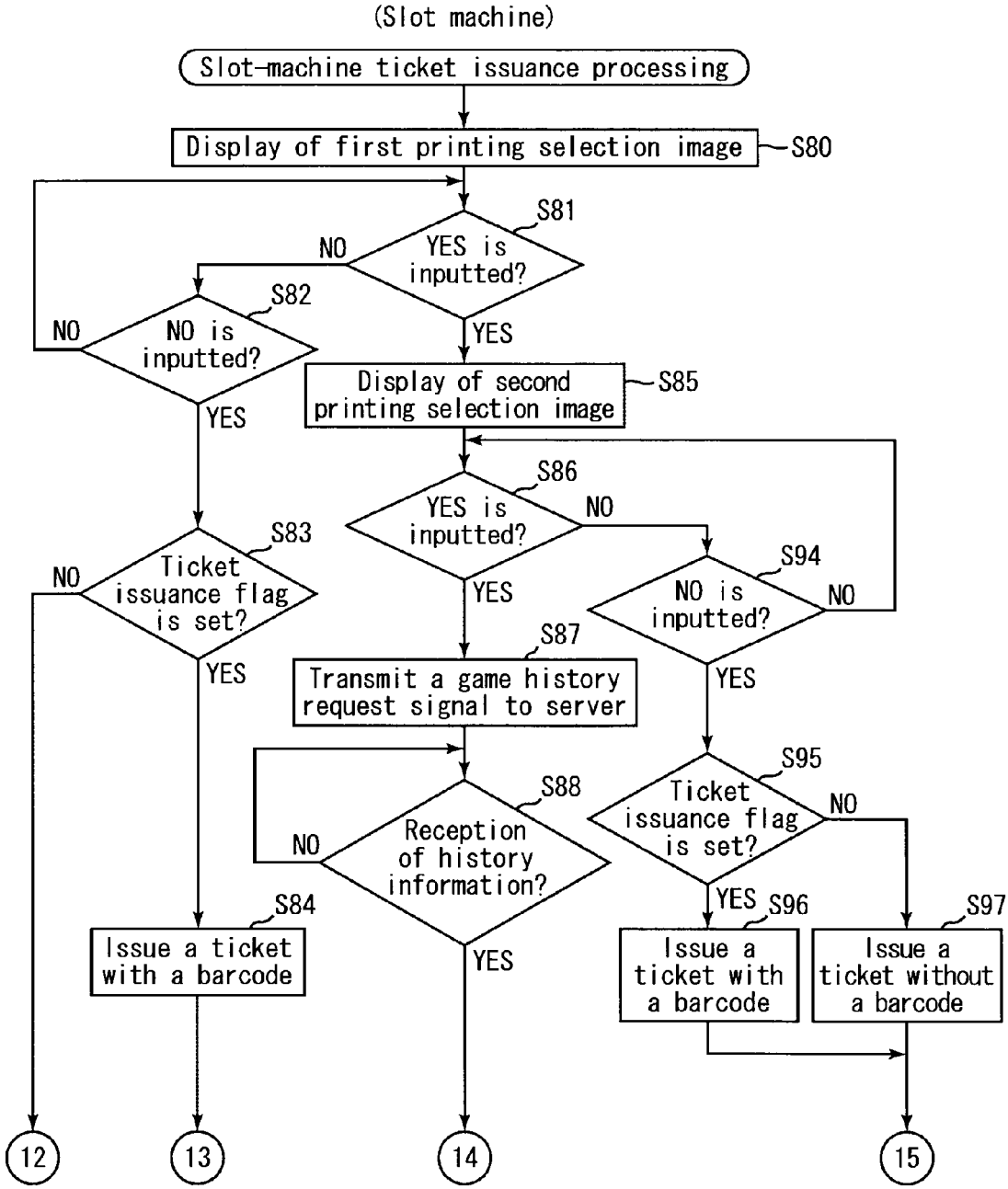
FIG. 27A is a flowchart illustrating a subroutine of slot-machine ticket issuance processing.

FIG. 27A is a flowchart illustrating a subroutine of the slot-machine ticket issuance processing.

Figure 27B:
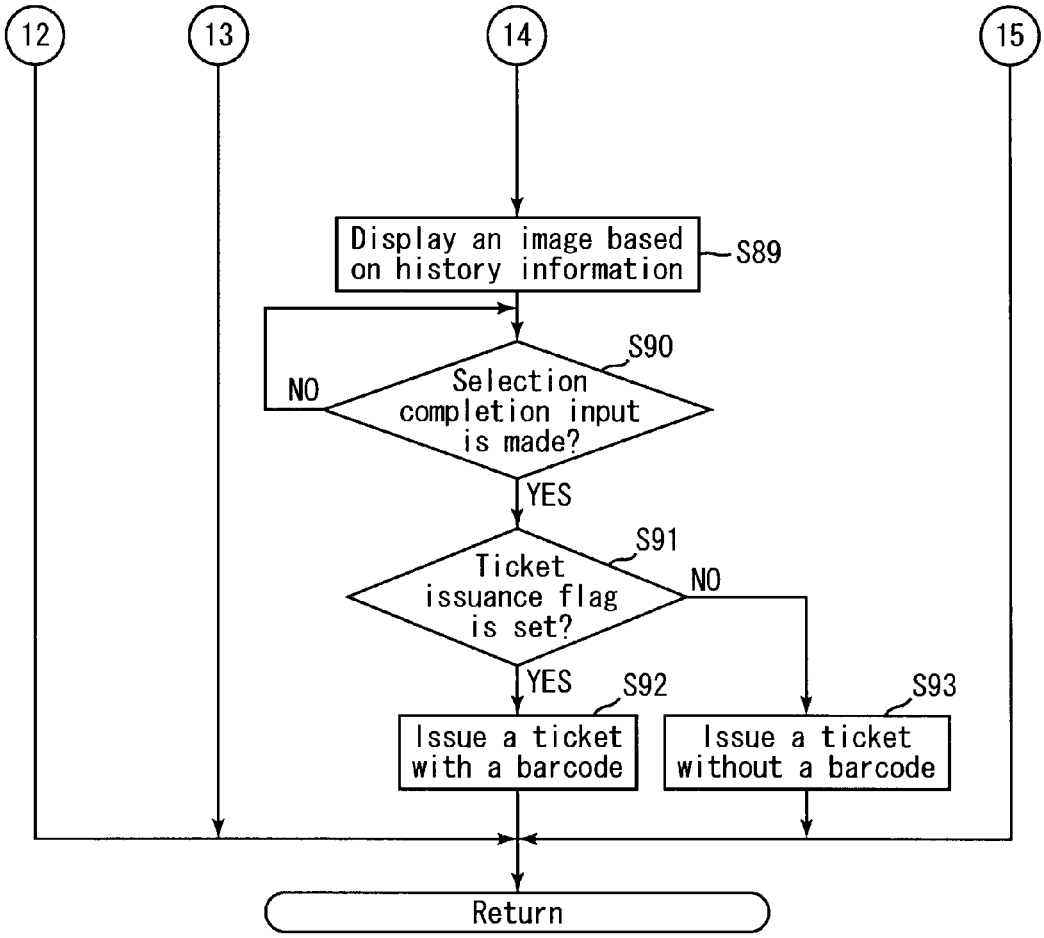
FIG. 27B is another flowchart illustrating the subroutine of the slot-machine ticket issuance processing.

FIG. 27B is another flowchart illustrating the subroutine of the slot-machine ticket issuance processing.

Figure 28A:
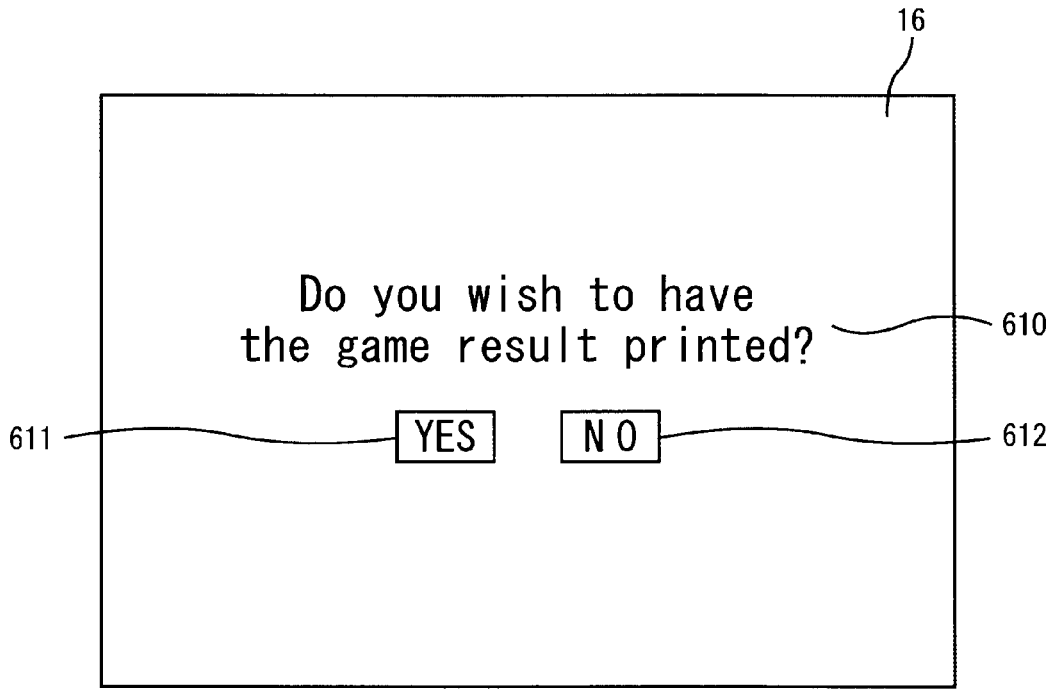
FIG. 28A is a view illustrating an exemplary image that is displayed to the lower image display panel provided in each slot machine constituting the ticket issuing system according to the first embodiment of the present invention.
Figure 28B:
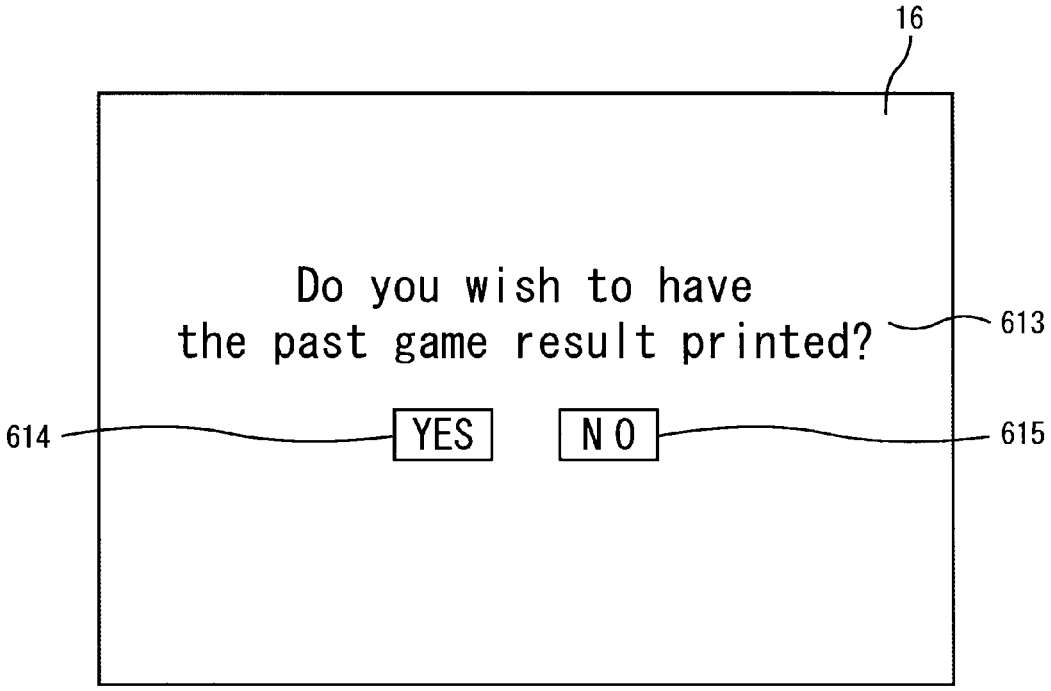
FIG. 28B is a view illustrating another exemplary image that is displayed to the lower image display panel provided in each slot machine constituting the ticket issuing system according to the first embodiment of the present invention.
Figure 28C:
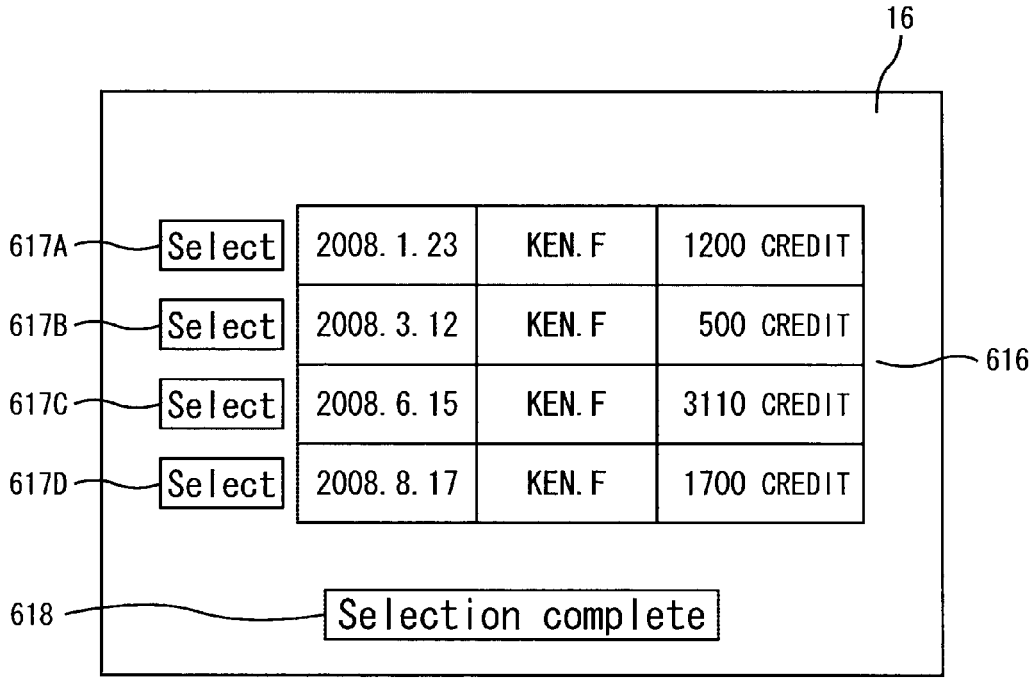
FIG. 28C is a view illustrating a yet another exemplary image that is displayed to the lower image display panel provided in each slot machine constituting the ticket issuing system according to the first embodiment of the present invention.

FIGS. 28A to 28C are views each illustrating an exemplary image displayed to the lower image display panel that is provided in the slot machine constituting the ticket issuing system according to the first embodiment of the present invention.

Figure 29A:
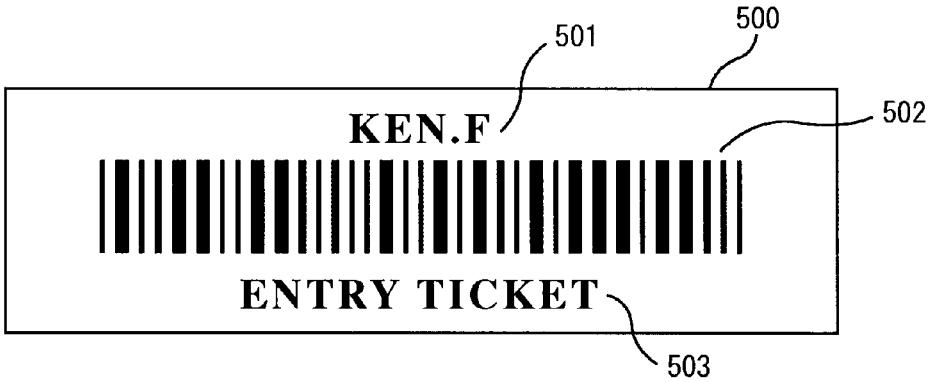
FIG. 29A is a view illustrating an exemplary ticket with a barcode issued from a ticket issuing device of the first embodiment.
Figure 29B:
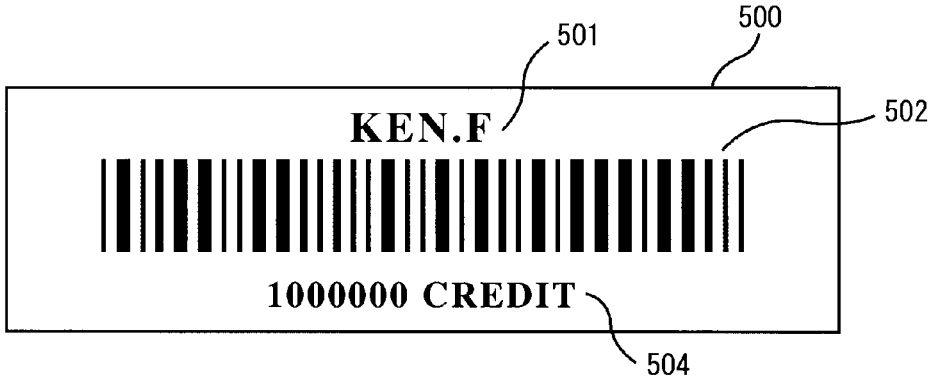
FIG. 29B is a view illustrating another exemplary ticket with a barcode issued from a ticket issuing device of the first embodiment.
Figure 29C:
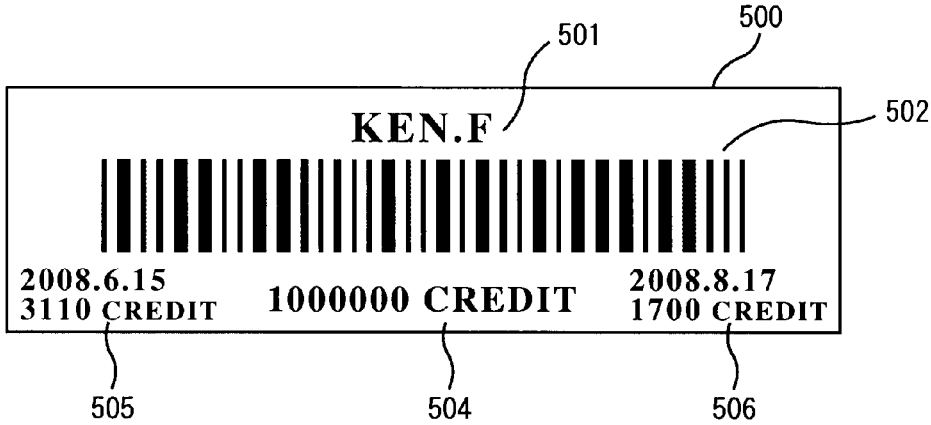
FIG. 29C is a view illustrating yet another exemplary ticket with a barcode issued from a ticket issuing device of the first embodiment.

FIGS. 29A to 29C are views each illustrating an exemplary ticket with a barcode that is issued from the ticket issuing device of the first embodiment.

The main CPU 41 displays a first printing selection image to the lower image display panel 16 (see FIG. 28A) (step S80).

In FIG. 28A, a first printing selection image 610 is displayed near the center of the lower image display panel 16. The first printing selection image 610 is an image that asks the player whether or not the player wishes to have the game result of the tournament-type game printed. Below the first printing selection image 610, a YES image 611 and a NO image 612 are displayed.

If the player wishes to have the game result of the tournament-type game printed, the player can input "YES" via the touch panel 69 by touching the portion where the YES image 611 is displayed, with the finger or the like. On the other hand, if the player does not wish to have the game result of the tournament-type game printed, the player can input "NO" via the touch panel 69 by touching the portion where the NO image 612 is displayed, with the finger or the like.

Referring back to FIG. 27A, the main CPU 41 determines whether or not "YES" has been inputted (step S81). When determining that "YES" has not been inputted, the main CPU 41 determines whether or not "NO" has been inputted (step S82). When determining that "NO" has not been inputted, the main CPU 41 returns the processing to step S81.

On the other hand, when determining in step S82 that "NO" has been inputted, the main CPU 41 determines whether or not the ticket issuance flag is set (step S83). When determining that the ticket issuance flag is not set, the main CPU 41 ends the present subroutine.

On the other hand, when determining in step S83 that the ticket issuance flag is set, the main CPU 41 issues a ticket 500 with a barcode from the ticket printer 35 (see FIG. 29A) (step S84). In the processing, the main CPU 41 prints on a ticket a barcode that represents encoded data of the player name and the like; the player name stored in the RAM 43; and text that indicates that the ticket is used for participation in a tournament-type game. Then, the main CPU 41 issues the ticket as a ticket 500 with a barcode.

In FIG. 29A, the player name 501 is printed on the upper portion of the ticket 500 with a barcode.

At the central portion of the ticket 500 with a barcode, the barcode 502 is printed which represents encoded data of the player name and the tournament-type game start time.

At the lower portion of the ticket 500 with a barcode, the text 503 is printed which indicates that the ticket is used for participation in a tournament-type game.

Referring back to FIG. 27A, when the main CPU 41 determines in step S81 that "YES" has been inputted, the main CPU 41 displays a second printing selection image to the lower image display panel 16 (see FIG. 28B) (step S85).

In FIG. 28B, a second printing selection image 613 is displayed near the center of the lower image display panel 16. The second printing selection image 613 is an image that asks the player whether or not the player wishes to have the past game result of the tournament-type game printed. Below the second printing selection image 613, a YES image 614 and a NO image 615 are displayed.

If the player wishes to have the past game result of the tournament-type game printed, the player can input "YES" via the touch panel 69 by touching the portion where the YES image 614 is displayed, with the finger or the like. On the other hand, if the player does not wish to have the past game result of the tournament-type game printed, the player can input "NO" via the touch panel 69 by touching the portion where the NO image 615 is displayed, with the finger or the like.

Referring back to FIG. 27A, the main CPU 41 determines whether or not "YES" has been inputted (step S86). When determining that "YES" has been inputted, the main CPU 41 transmits a game-history request signal to the server 200 (step S87). The game-history request signal includes the player name that is stored in the RAM 43.

The main CPU 41 determines whether or not the main CPU 41 has received history information from the server 200 (step S88). When the main CPU 41 determines that the main CPU 41 has not received history information, the main CPU 41 returns the processing to step S88.

On the other hand, when the main CPU 41 determines in step S88 that the main CPU 41 has received history information, the main CPU 41 displays an image based on the received history information to the lower image display panel 16 (see FIG. 28C) (step S89).

In FIG. 28C, a history information image 616 based on the received history information is displayed near the center of the lower image display panel 16. The history information image 616 is an image that shows the past game history that is associated with the same player name as the player name of the player who is playing a game in the slot machine 10. The history information image 616 shows the date on which the game has been played; the player name; and the number of obtained coins.

The date on which the game has been played, the player name, and the number of acquired coins correspond to the game history in the present invention.

On the left side of the history information image 616, selection images 617 (selection image 617A, selection image 617B, selection image 617C, selection image 617D) are displayed which correspond to respective game histories that are shown by the history information image 616. For example, the selection image 617A is a selection image 617 that corresponds to the game history of Jan. 23, 2008. If the player wishes to have the game history of Jan. 23, 2008 printed, the player can input "selection image 617A" via the touch panel 69 by touching the portion where the selection image 617A is displayed, with the finger or the like.

Below the history information image 616, a selection completion image 618 is displayed. The player can input completion of selection via the touch panel 69 by touching the portion where the selection completion image 618 is displayed, with the finger or the like, after inputting a single or plurality of selection images 617.

Referring back to FIG. 27B, the main CPU 41 determines whether or not completion of selection has been inputted (step S90). When determining that completion of selection has not been inputted, the main CPU 41 returns the processing to step S90

On the other hand, when determining in step S90 that completion of selection has been inputted, the main CPU 41 determines whether or not the ticket issuance flag is set (step S91). When determining that the ticket issuance flag is set, the main CPU 41 issues a ticket 500 with a barcode from the ticket printer 35 (see FIG. 29C) (step S92).

In the processing, the main CPU 41 prints on a ticket a barcode that represents encoded data of the next tournament-type game start time, the player name stored in the RAM 43, and the like; the player name stored in the RAM 43; the number of coins obtained by the player in the tournament-type game that the player has participated this time; and the past game history selected by the player. Then, the main CPU 41 issues the ticket as a ticket 500 with a barcode.

In FIG. 29C, the player name 501 is printed on the upper portion of the ticket 500 with a barcode.

At the central portion of the ticket 500 with a barcode, the barcode 502 is printed which represents encoded data of the player name and the tournament-type game start time.

At the lower portion at the center of the ticket 500 with a barcode, text 504 is printed which shows the number of coins that are obtained by the player in the tournament-type game that the player has participated this time.

At the lower portion on the left side of the ticket 500 with a barcode, text 505 is printed which indicates that the game history is of Jun. 15, 2008.

At the lower portion on the right side of the ticket 500 with a barcode, text 506 is printed which indicates the game history of Aug. 17, 2008.

Referring back to FIG. 27B, when the main CPU 41 determines in step S91 that the ticket issuance flag is not set, the main CPU 41 issues a ticket without a barcode from the ticket printer 35 (step S93).

In the processing, the main CPU 41 prints on a ticket the player name stored in the RAM 43; the number of coins obtained by the player in the tournament-type game that the player has participated this time; and the past game history selected by the player. Then, the main CPU 41 issues the ticket as a ticket without a barcode.

Referring back to FIG. 27A, the main CPU 41 determines in step S86 that "YES" has not been inputted, the main CPU 41 determines whether or not "NO" has been inputted (step S94). When determining that "NO" has not been inputted, the main CPU 41 returns the processing to step S86.

On the other hand, when determining in step S94 that "NO" has been inputted, the main CPU 41 determines whether or not the ticket issuance flag is set (step S95). When determining that the ticket issuance flag is set, the main CPU 41 issues a ticket 500 with a barcode from the ticket printer 35 (see FIG. 29B) (step S96).

In the processing, the main CPU 41 prints on a ticket a barcode that represents encoded data of the next tournament-type game start time, the player name stored in the RAM 43, and the like; the player name stored in the RAM 43; and the number of coins obtained by the player in the tournament-type game that the player has participated this time. Then, the main CPU 41 issues the ticket as a ticket 500 with a barcode.

In FIG. 29B, the player name 501 is printed on the upper portion of the ticket 500 with a barcode.

At the central portion of the ticket 500 with a barcode, the barcode 502 is printed which represents encoded data of the player name and the tournament-type game start time.

At the lower portion at the center of the ticket 500 with a barcode, the text 504 is printed which indicates the number of coins obtained by the player in the tournament-type game that the player has participated this time.

Referring back to FIG. 27A, when the main CPU 41 determines in step S95 that the ticket issuance flag is not set, the main CPU 41 issues a ticket without a barcode from the ticket printer 35 (step S97).

In the processing, the main CPU 41 prints on a ticket the player name stored in the RAM 43; and the number of coins obtained by the player in the tournament-type game that the player has participated this time. Then, the main CPU 41 issues the ticket as a ticket without a barcode.

When determining in step S83 that the ticket issuance flag is not set, or when executing the processing of step S84, step S92, step S93, step S96, or step S97, the main CPU 41 ends the present subroutine.

As described above, according to the ticket issuance system 1 relating to the first embodiment and the control method thereof, each of the ticket issuing devices 300 transmits to the server 200 a participation request signal, when the ticket issuing device 300 has received a participation input signal from the keyboard 345. When the server 200 upon reception of the participation request signal determines that the number of participation-accepted players in the RAM 243 does not exceed the number-of-players upper limit value in the RAM 243, the server 200 stores into the RAM 243 a numeric value obtained by adding 1 to the number of participation-accepted players in the RAM 243 as an updated number of participation-accepted players and also transmits a ticket issuance permission signal to the ticket issuing device 300 as the transmission source of the received participation request signal. The ticket issuing device 300 issues from the ticket printer 346 a ticket 500 with a barcode that enables participation in the game upon being put into a slot machine 10, when the ticket issuing device 300 has received the ticket issuance permission signal.

The ticket issuing system having the plurality of ticket issuing devices 300 can prevent players wishing to obtain a ticket 500 with a barcode from queuing up. Hence, the system can issue tickets 500 with a barcode without irritating the players who wish to participate in a game played against another slot machine 10.

Further, a ticket 500 with a barcode is issued only when the number of participation-accepted players, which indicates the number of players who have been accepted to participate in the game, does not exceed the number-of-players upper limit value, which indicates the upper limit value of the number of players who can be accepted to participate in the game. This makes it possible to prevent issuance of tickets 500 with a barcode in number more than the number of players who can be accepted to participate in the game, even when the plurality of ticket issuing device 300 are provided.

According to the ticket issuing system 1 relating to the first embodiment and the control method thereof, the number-of-players upper limit value is determined based on the number of slot machines 10 on which a game is played out of the slot machines 10 connected to the network. That is, the maximum number of to-be issued tickets 500 with a barcode changes in accordance with the operational status of the slot machines 10. For example, a large number of tickets 500 with a barcode are issued when the operational status is low, and only a small number of tickets 500 with a barcode are issued when the operational status is high. This can avoid a situation in which there are players who cannot participate in the game because of existence of no slot machine 10 on which no game is played even though the players have a ticket 500 with a barcode.

According to the ticket issuing system 1 relating to the first embodiment and the control method thereof, the ticket 500 with a barcode has printed thereon the barcode 502 representing encoded data of the start time of a tournament-type game which identifies a game for which the ticket 500 with a barcode enables participation. Accordingly, for example, the ticket 500 with a barcode, when being put into a slot machine 10, enables participation in a game played against another slot machine 10. According to the ticket issuing system 1 relating to the first embodiment and the control method thereof, such a configuration realizes not only smooth issuance of a ticket 500 with a barcode but also smooth participation in a game played against another slot machine 10. As a result, it is possible to let a player play a game in comfort.

Further, in the present invention, participation in a game (in the first embodiment, a tournament-type game) that is played against another gaming machine (in the first embodiment, a slot machine 10) is enabled by putting a ticket (in the first embodiment, a ticket 500 with a barcode) into a gaming machine. This configuration allows a player to smoothly participate in a game (in the first embodiment, a tournament-type game) that is played against another gaming machine.

In the first embodiment, the case has been described in which the gaming machine is a slot machine 10. However, the gaming machine is not particularly limited in the present invention, and can execute, for example, a horse racing game or a card game.

Further, in the first embodiment, the case has been described in which the game played against another gaming machine is a tournament-type game that is a knockout competition. However, in the present invention, the game played against another gaming machine may be a league game that is a round-robin competition.

Furthermore, in the first embodiment, the case has been described in which the input device is the keyboard 345. However, in the present invention, the input device may be a card reader.

A card reader is for reading data from a smart card and for writing data into a smart card. A smart card is a card owned by a player, and the smart card stores, for example, data showing the player name, and data relating to the history of games played by the player.

Insertion of a smart card into a card reader provided in each ticket issuing device 300 allows the card reader to read the player name from the smart card, and to transmit a participation input signal including the player name to the CPU 341.

Player identification information (for example, the player name) is read by a card reader from a card owned by the player. This makes it possible to issue a ticket quickly without causing discomfort for players.

In the first embodiment, the case has been described in which the code information is the barcode 502. However, in the present invention, the code information is not limited to one-dimensional information, and may be two-dimensional information. Employment of two-dimensional code information makes it possible for code information to include more data than in the case of employing one-dimensional code information.

In the first embodiment, the case has been described in which a ticket 500 with a barcode has printed thereon a barcode 502 that represents encoded data of start time of a tournament-type game. However, in the present invention, the data of code information (in the first embodiment, a barcode 502) that is to be printed on a ticket (in the first embodiment, a ticket 500 with a barcode) may be data showing how many games (in the first embodiment, tournament-type games), which are played against another gaming machine, have been played before the game (in the first embodiment, a tournament-type game) that is played against another gaming machine. Code information (in the first embodiment, a barcode) to be printed on a ticket (in the first embodiment, a ticket 500 with a barcode) is not limited so long as the information at least includes code information (in the first embodiment, a barcode) that represents encoded player identification information such as a player name.

In the first embodiment, the case has been described in which the game group consists of two slot machines that have a match against each other. However, the number of gaming machines to be included in the game group is not particularly limited, and can be, for example, four. In this case, one winning gaming machine may be determined from among the four gaming machines. For example, among the four gaming machines, a gaming machine on which the largest number of coins has been obtained may be determined as the winning gaming machine.

In the first embodiment, the case has been described in which the number of coins obtained by the player in the tournament-type game that the player has participated this time is printed on a ticket without a barcode or on a ticket 500 with a barcode. However, in the present invention, the rank of the player in the tournament-type game that the player has participated this time may be printed on a ticket without a barcode or on a ticket 500 with a barcode.

In the first embodiment, the case has been described in which each game history selected via the touch panel 69 is printed on a ticket without a barcode or on a ticket 500 with a barcode. However, in the present invention, the total number of coins of the numbers of coins shown by the respective game histories selected via the touch panel 69 may be printed on a ticket.

In the first embodiment, the case has been described in which the two slot machines having a match against each other execute the game separately, and then the numbers of coins obtained by the respective players on the respective slot machines are compared, so that the winning slot machine is determined. However, in the present invention, the two gaming machines having a match against each other may execute a directly competing game such as a fighting game, with synchronizing with each other. This makes it possible to encourage competition between the players and to make the players further immersed in the common game.

In the first embodiment, there has been described the case where the symbols rearranged in the display blocks 28 are all scatter symbols. However, symbols in the present invention are not limited to the scatter symbols. For example, a pay line may be provided, and a prize may be won or a point value may be offered when a plurality of symbols in a specific combination are rearranged on the pay line. Further, for example, the symbol leading to winning of a prize upon being rearranged on the pay line and the scatter symbol may be used in combination.

Further, in the first embodiment, there has been described the case where the number of the slot machines 10 is 50. However, the number of the gaming machines is not particularly limited, and it may be 100, for example.

Furthermore, in the first embodiment, there has been described the case where the number of the ticket issuing devices 300 is three. However, the number of the ticket issuing devices is not particularly limited, and it may be ten, for example.

[Second Embodiment]

An embodiment of the present invention is described based on the drawings.

The following embodiment describes a case where a gaming machine is a slot machine.

First, a general description of the second embodiment will be given with reference to FIG. 30.

Figure 30:
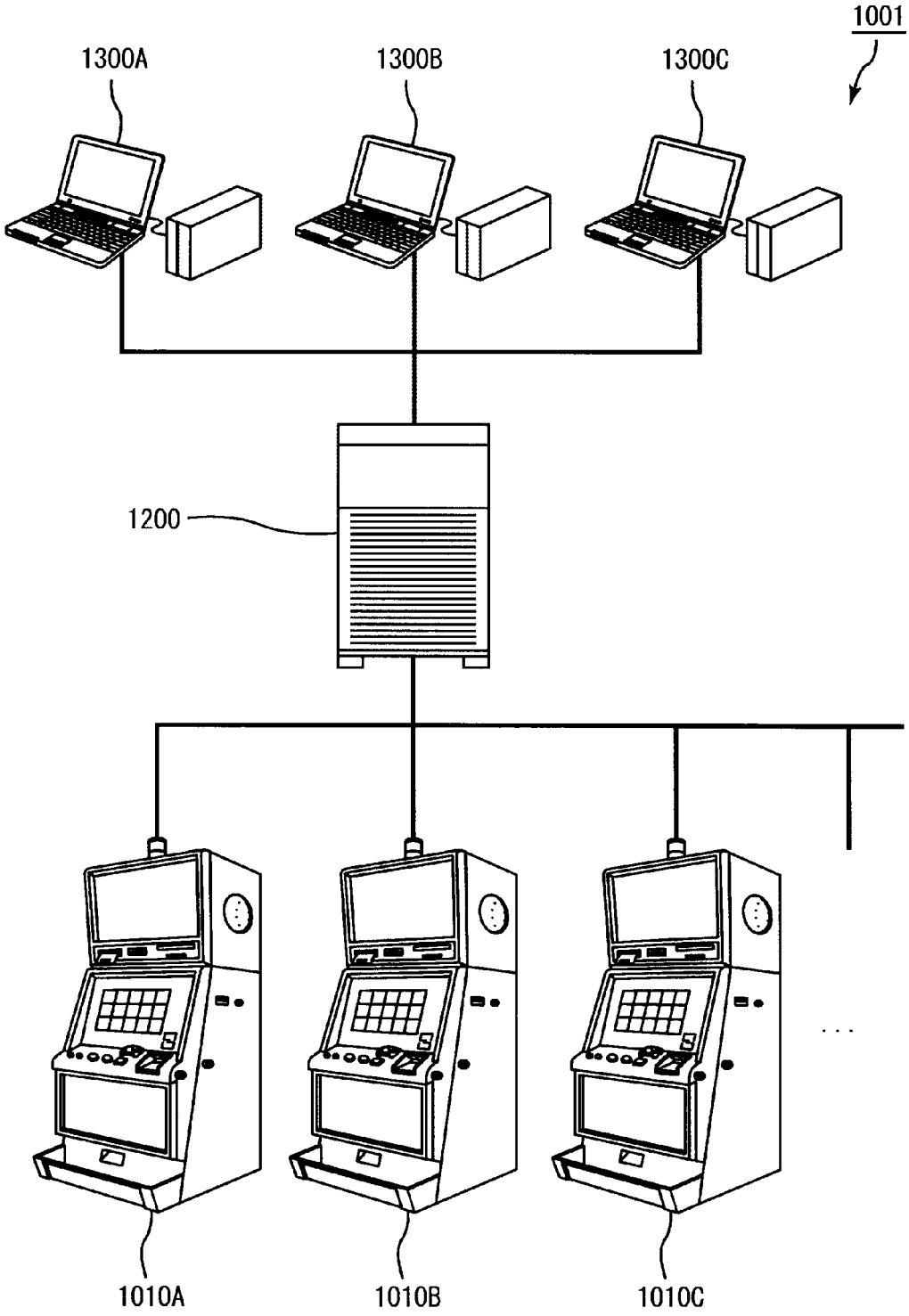
FIG. 30 is a schematic view illustrating an entire configuration of a gaming system according to a second embodiment.

FIG. 30 is a schematic view illustrating an entire configuration of a gaming system according to a second embodiment.

A gaming system 1001 is provided with a plurality of (3 in the second embodiment) ticket issuing devices 1300 (ticket issuing device 1300A, ticket issuing device 1300B, ticket issuing device 1300C); a server 1200; and a plurality of (50 in the second embodiment) slot machines 1010. These devices in the system are connected to one another by a network.

Each ticket issuing device 1300 transmits a participation request signal to the server 1200 when receiving a participation input signal from a keyboard 1345 thereof. When the server 1200 upon reception of the participation request signal determines that the number P of participation-accepted players, which is stored in a RAM 1243 (see FIG. 34), does not exceed a number-of-players upper limit value stored in the RAM 1243, the server 1200 stores into the RAM 1243 a numeric value obtained by adding 1 to the number P of participation-accepted players in the RAM 1243 as an updated number P of participation-accepted players and also transmits a ticket issuance permission signal to the ticket issuing device 1300 as the transmission source of the received participation request signal. When receiving the ticket issuance permission signal, the ticket issuing device 1300 issues from a ticket printer 1346 a ticket 1500 with a barcode (see FIG. 36) that enables participation in a tournament-type game upon being inserted into a bill validator 1022 (see FIG. 32) that is provided in each slot machine 1010.

A player participates in a tournament-type game by inserting a ticket 1500 with a barcode into the bill validator 1022 (see FIG. 32) that is provided in each slot machine 1010.

Figure 32:
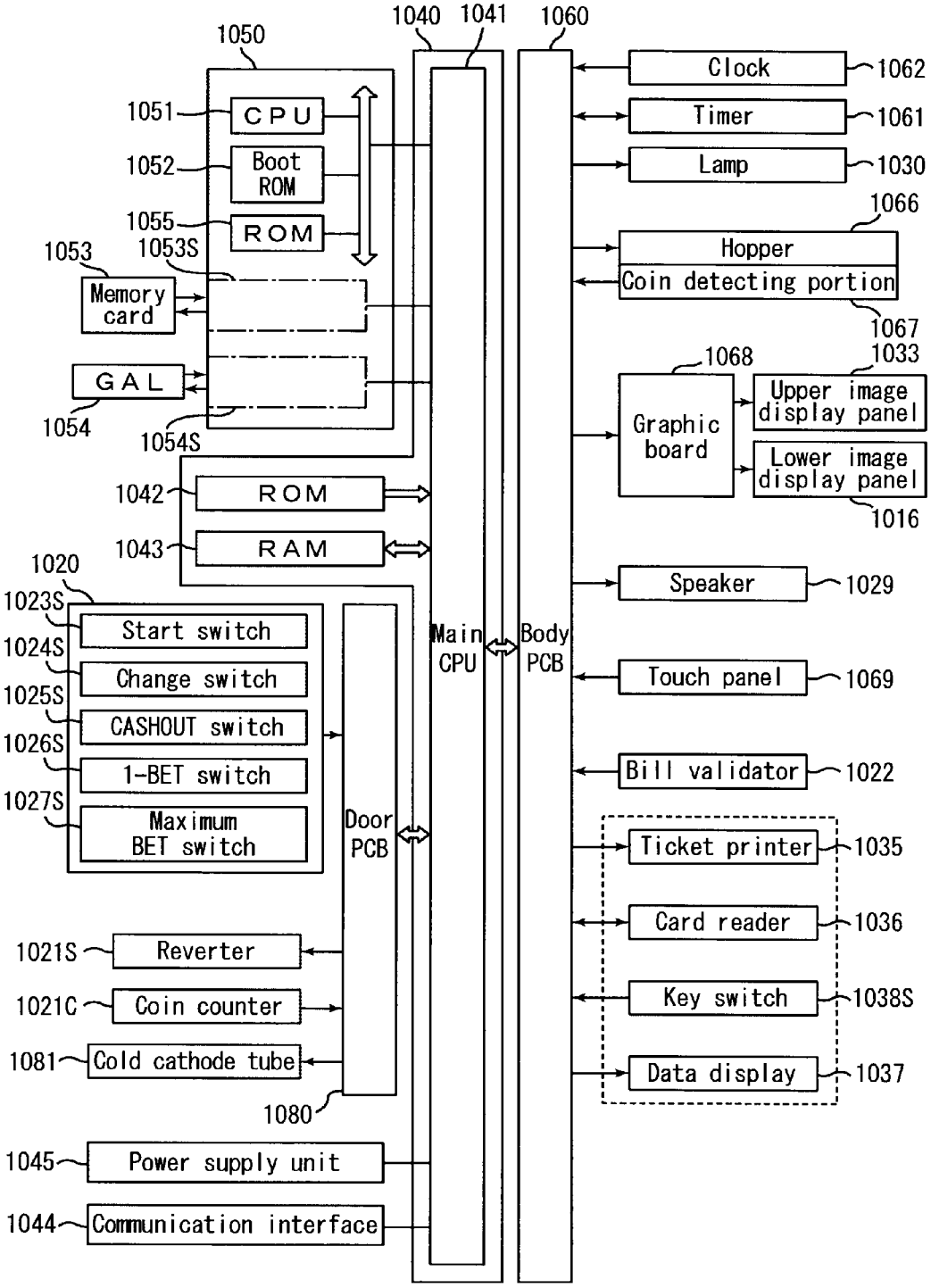
FIG. 32 is a block diagram illustrating an internal configuration of the slot machine shown in FIG. 31.

The slot machine 1010 sets a tournament-type game flag when a ticket 1500 with a barcode is inserted into the bill validator 1022 (see FIG. 32). The slot machine in which the tournament-type game flag is set transmits a game participation signal to the server 1200, upon reception of a tournament-type game start signal from the server 1200. The server 1200 determines the number D of tournaments indicating the number of tournaments in the tournament-type game, based on the number of game participation signals received from respective slot machines 1010 (the number S of participants). Then, assignment of each slot machine 1010 participating in the tournament-type game to the tournament is determined.

In a tournament-type game, each player competes with another player based on the number of coins obtained after playing a predetermined number of (50 in the second embodiment) games are played on each slot machine 1010. More specifically, matches each involving two slot machines 1010 are held, and one of the two slot machines 1010 with a larger number of obtained coins in each match becomes a winning slot machine of the match. The matches are held until the overall winning slot machine is determined based on a tournament tree (see FIG. 55).

When a tournament-type game is over, each slot machine 1010 displays an image (see FIG. 57A) that asks a player whether or not the player wishes to print the number of coins that the player has obtained in the tournament-type game, on a ticket to be issued from a ticket printer 1035 of the slot machine 1010. When the player makes an input that indicates the player's wish to print, the slot machine 1010 issues from the ticket printer 1035 a ticket that has printed thereon the number of coins obtained by the player in the tournament-type game. A tournament-type game corresponds to the game played against an other gaming machine in the present invention.

The bill validator 1022 corresponds to the ticket reader in the present invention.

As above, the second embodiment has been briefly described based on FIG. 30.

Hereinafter, the second embodiment is described in more detail.

Next, a configuration of each slot machine 1010 is described.

Figure 31:
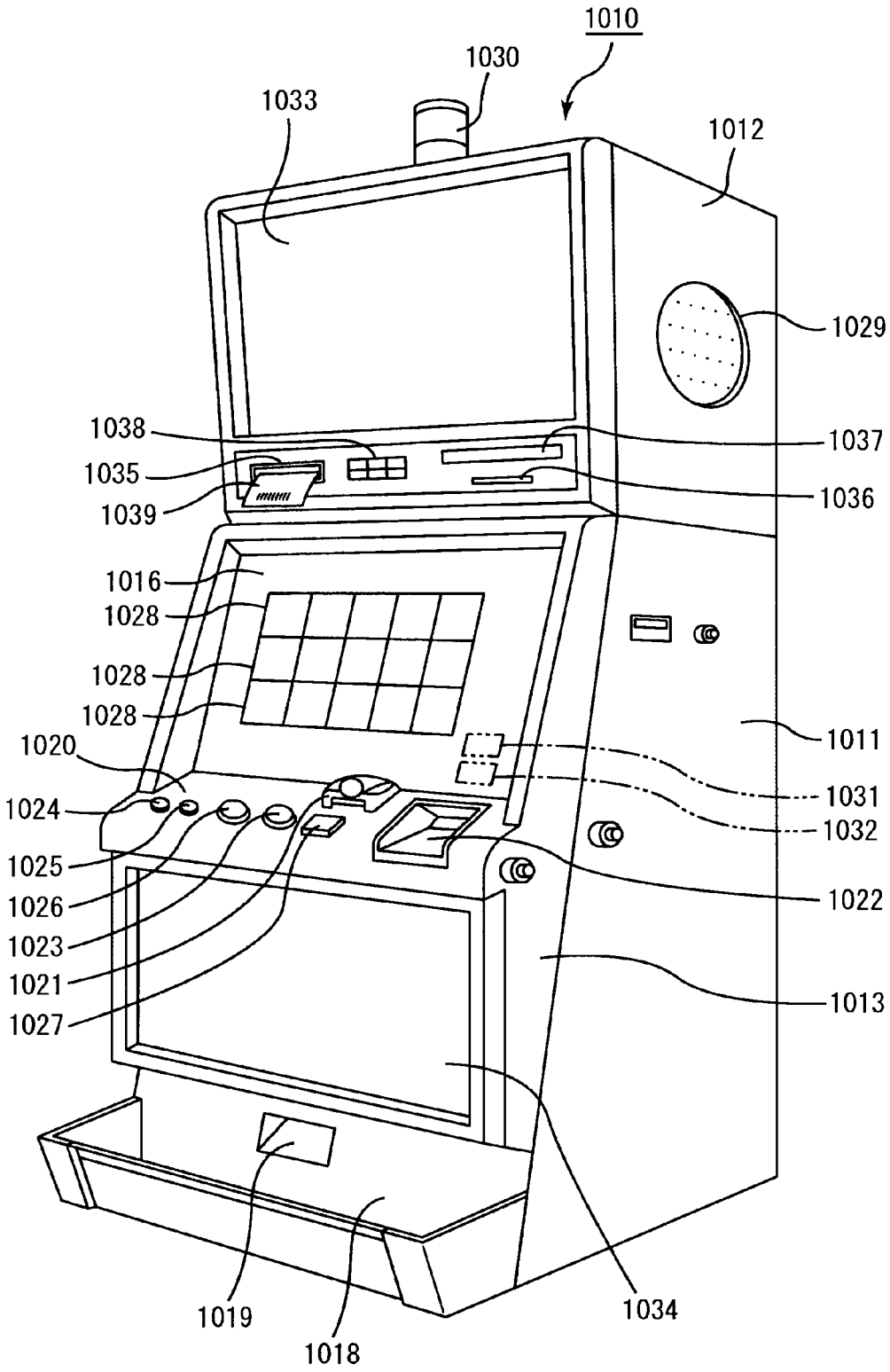
FIG. 31 is a perspective view illustrating an external view of a slot machine constituting a gaming system according to the second embodiment.

FIG. 31 is a perspective view illustrating an external view of a slot machine constituting the gaming system according to the second embodiment.

In the slot machine 1010, a coin, a bill, or electronic valuable information corresponding to those is used as a game medium. However, in the present invention, the game medium is not particularly limited. Examples of the game medium may include a medal, a token, electronic money and a ticket.

The slot machine 1010 comprises a cabinet 1011, a top box 12 installed on the upper side of the cabinet 1011, and a main door 1013 provided at the front face of the cabinet 1011.

On the main door 1013, there is provided a lower image display panel 1016 as a display. The lower image display panel 1016 includes a transparent liquid crystal panel which displays fifteen display blocks 1028 along five columns and three rows. A single symbol is displayed in each display block 28. Further, although not illustrated, various types of images relating to an effect, as well as the aforementioned images, are displayed to the lower image display panel 1016.

Further, a number-of-credits display portion 1031 and a number-of-payouts display portion 1032 are provided on the lower image display panel 1016. The number-of-credits display portion 1031 displays an image indicative of the number of credited coins. The number-of-payouts display portion 1032 displays an image indicative of the number of coins to be paid out.

Moreover, although not shown, a touch panel 1069 is provided at the front face of the lower image display panel 1016. A player can operate the touch panel 1069 to input a variety of commands.

Below the lower image display panel 1016, there are provided a control panel 1020 including a plurality of buttons 1023 to 1027 with each of which a command according to game progress is inputted by the player, a coin receiving slot 1021 through which a coin is accepted into the cabinet 1011, and a bill validator 1022.

The control panel 1020 is provided with a start button 1023, a change button 1024, a CASHOUT button 1025, a 1-BET button 1026 and a maximum BET button 1027. The start button 1023 is for inputting a command to start scrolling of symbols. The change button 1024 is used for making a request of staff in the recreation facility for exchange. The CASHOUT button 1025 is used for inputting a command to pay out credited coins to a coin tray 1018.

The 1-BET button 1026 is used for inputting a command to bet one coin on a game out of credited coins. The maximum BET button 1027 is used for inputting a command to bet the maximum number of coins that can be bet on one game (50 coins in the second embodiment) out of credited coins.

The bill validator 1022 not only discriminates a regular bill from a false bill, but also accepts the regular bill into the cabinet 1011. It is to be noted that the bill validator 1022 can read information from a barcode printed on a ticket 1500 with a barcode. At the lower front of the main door 1013, namely, below the control panel 1020, there is provided a belly glass 1034 on which a character or the like of the slot machine 1010 is drawn.

On the front surface of the top box 1012, there is provided an upper image display panel 1033. The upper image display panel 1033 includes a liquid crystal panel, which displays, for example, images indicative of introductions of the contents of a game, explanations about the rules of the game, and a later-described tournament tree (see FIG. 55).

Further, a speaker 1029 is provided in the top box 1012. Under the upper image display panel 1033, there are provided a ticket printer 1035, a card reader 1036, a data display 1037, and a key pad 1038. The ticket printer 1035 prints on a ticket a barcode that represents encoded data of the player name, tournament-type game start time, and the like; the number of coins obtained by the player in the tournament-type game; and the like. The ticket is outputted as a ticket 1500 with a barcode. A player can participate in a tournament-type game by making a slot machine read the ticket 1500 with a barcode.

The card reader 1036 reads data from a smart card and writes data into the smart card. The smart card is a card owned by the player, and for example, data for identifying the player and data on a history of games played by the player are stored therein. Data corresponding to a coin, a bill or a credit may be stored in the smart card. Further, a magnetic stripe card may be adopted in place of the smart card. The data display 1037 includes a fluorescent display and the like, and displays, for example, data read by the card reader 1036 or data inputted by the player via the key pad 1038. The key pad 1038 is used for inputting a command and data concerning issuing of a ticket, and the like.

FIG. 32 is a block diagram illustrating an internal configuration of the slot machine shown in FIG. 31.

A gaming board 1050 is provided with a CPU (Central Processing Unit) 1051, a ROM 1055, and a boot ROM 1052 which are interconnected to one another by an internal bus, a card slot 1053S corresponding to a memory card 1053, and an IC socket 1054S corresponding to a GAL (Generic Array Logic) 1054.

The memory card 1053 includes a nonvolatile memory such as CompactFlash (registered trade mark), and stores a game program. The game program includes a symbol determination program. The symbol determination program is a program for determining symbols to be rearranged in the display blocks 1028.

The symbols to be determined by the symbol determination program include 8 types of symbols including "RIBBON", "HEART", "STAR", "MOON", "SUN", "JEWEL", "CROWN", and "SMILE".

Further, the card slot 1053S is configured so as to allow the memory card 1053 to be inserted thereinto or removed therefrom, and is connected to the mother board 1040 by an IDE bus. Therefore, the type and contents of a game played on the slot machine 1010 can be changed by removing the memory card 1053 from the card slot 1053S, writing another game program into the memory card 1053, and inserting the memory card 1053 into the card slot 1053S. The game program includes a program relating to progress of the game. Further, the game program includes image data and sound data to be outputted during the game. The game program also includes odds data showing a correspondence relationship between a type and the number of rearranged symbols and an amount of payout (see FIG. 53), and the like. In addition, the game program includes data showing predetermined time T.

The CPU 1051, the ROM 1055 and the boot ROM 1052 interconnected to one another by an internal bus are connected to the mother board 1040 through a PCI bus. The PCI bus not only conducts signal transmission between the mother board 1040 and the gaming board 1050, but also supplies power from the mother board 1040 to the gaming board 1050.

The mother board 1040 is configured using a commercially available general-purpose mother board (a print wiring board on which fundamental components of a personal computer are mounted), and provided with a main CPU 1041, a ROM (Read Only Memory) 1042, a RAM (Random Access Memory) 1043, and a communication interface 1044. The mother board 1040 corresponds to the controller of the present invention.

The ROM 1042 comprises a memory device such as a flash memory, and stores a program such as a BIOS (Basic Input/Output System) executed by the main CPU 1041, and permanent data. When the BIOS is executed by the main CPU 1041, processing for initializing a predetermined peripheral device is conducted, concurrently with start of processing for loading the game program stored in the memory card 1053 via the gaming board 1050. It is to be noted that, in the present invention, the ROM 1042 may or may not be data rewritable one.

The RAM 1043 stores data and a program to be used at the time of operation of the main CPU 1041. Further, the RAM 1043 is capable of storing a game program.

Moreover, the RAM 1043 stores data of the number of credits, the numbers of coin-ins and coin-outs in one game, and the like.

The mother board 1040 is connected with a later-described body PCB (Printed Circuit Board) 1060 and a door PCB 1080 through respective USBs. Further, the mother board 1040 is connected with a power supply unit 1045 and the communication interface 1044.

The body PCB 1060 and the door PCB 1080 are connected with an instrument and a device that generate an input signal to be inputted into the main CPU 1041 and an instrument and a device operations of which are controlled by a control signal outputted from the main CPU 1041. The main CPU 1041 executes the game program stored in the RAM 1043 based on the input signal inputted into the main CPU 1041, and thereby executes the predetermined arithmetic processing, stores the result thereof into the RAM 1043, or transmits a control signal to each instrument and device as processing for controlling each instrument and device.

The body PCB 1060 is connected with a lamp 1030, a hopper 1066, a coin detecting portion 1067, a graphic board 1068, the speaker 1029, the touch panel 1069, the bill validator 1022, the ticket printer 1035, the card reader 1036, a key switch 1038S, the data display 1037, a timer 1061, and a clock 1062. The lamp 1030 is lighted in a predetermined pattern based on control signals outputted from the main CPU 1041.

The hopper 1066 is installed inside the cabinet 1011, and pays out a predetermined number of coins based on a control signal outputted from the main CPU 1041, from a coin payout exit 1019 to the coin tray 1018. The coin detecting portion 1067 is provided inside the coin payout exit 1019, and outputs an input signal to the main CPU 1041 in the case of detecting payout of the predetermined number of coins from the coin payout exit 1019.

The timer 1061 is used for measuring the time.

The clock 1062 is used for timekeeping.

The clock 1062 sets its time every time a predetermined period elapses. The clock 1062 sets its time by getting time data from a clock 1249 (see FIG. 34) that is provided in the server 1200.

The graphic board 1068 controls image display to the upper image display panel 1033 and the lower image display panel 1016 based on a control signal outputted from the main CPU 1041. In the respective display blocks 1028 on the lower image display panel 1016, symbols are displayed in a scrolling manner or in a stopped state. The number of credits stored in the RAM 1043 is displayed to the number-of-credits display portion 1031 of the lower image display panel 1016. Further, the number of coin-outs is displayed to the number-of-payouts display portion 1032 of the lower image display panel 1016.

The graphic board 1068 comprises a VDP (Video Display Processor) for generating image data based on a control signal outputted from the main CPU 1041, a video RAM for temporarily storing image data generated by the VDP, and the like. It is to be noted that image data used in generation of the image data by the VDP is included in the game program read from the memory card 1053 and stored into the RAM 1043.

The bill validator 1022 not only discriminates a regular bill from a false bill, but also accepts the regular bill into the cabinet 1011. Upon acceptance of the regular bill, the bill validator 1022 outputs an input signal to the main CPU 1041 based on a face amount of the bill. The main CPU 1041 stores in the RAM 1043 the number of credits corresponding to the face amount of the bill transmitted with the input signal.

Further, when receiving a ticket 1500 with a barcode, the bill validator 1022 reads the data of the player name, the tournament-type game start time, and the like from the barcode printed on the ticket 1500 with a barcode, and then outputs the read information to the main CPU 1041.

The ticket printer 1035 is for printing on a ticket a barcode that represents encoded data of the player name, the tournament-type game start time, and the like; the number of coins obtained by the player in the tournament-type game; and the like. Then, the ticket printer 1035 outputs the ticket as a ticket 1500 with a barcode.

The card reader 1036 reads data from the smart card and transmits the read data to the main CPU 1041, and writes data onto the smart card based on a control signal from the main CPU 1041. The key switch 1038S is provided on the key pad 1038, and outputs a predetermined input signal to the main CPU 1041 when the key pad 1038 is operated by the player. The data display 1037 displays data read by the card reader 1036 and data inputted by the player via the key pad 1038, based on a control signal outputted from the main CPU 1041.

The door PCB 1080 is connected with the control panel 1020, a reverter 1021S, a coin counter 1021C, and a cold cathode tube 1081. The control panel 1020 is provided with a start switch 1023S corresponding to the start button 1023, a change switch 1024S corresponding to the change button 1024, a CASHOUT switch 1025S corresponding to the CASHOUT button 1025, a 1-BET switch 1026S corresponding to the 1-BET button 1026, and a maximum BET switch 1027S corresponding to the maximum BET button 1027. Each of the switches 1023S to 1027S outputs an input signal to the main CPU 1041 when each of the buttons 1023 to 1027 corresponding thereto is operated by the player.

The coin counter 1021C is provided inside the coin receiving slot 1021, and discriminates a regular coin from a false coin when a coin is inserted into the coin receiving slot 1021 by the player. Coins other than the regular coin are discharged from the coin payout exit 1019. Further, the coin counter 1021C outputs an input signal to the main CPU 1041 in detection of the regular coin.

The reverter 1021S operates based on the control signal outputted from the main CPU 1041, and distributes a coin recognized by the coin counter 1021C as the regular coin into a cash box (not shown) or the hopper 1066, which are disposed in the slot machine 1010. Namely, when the hopper 1066 is filled with coins, the regular coin is distributed into the cash box by the reverter 10215. On the other hand, when the hopper 1066 is not filled with coins, the regular coin is distributed into the hopper 1066. The cold cathode tube 1081 functions as a back light installed on the rear face side of the lower image display panel 1016 and the upper image display panel 1033, and lighted up based on the control signal outputted from the main CPU 1041.

Figure 33:
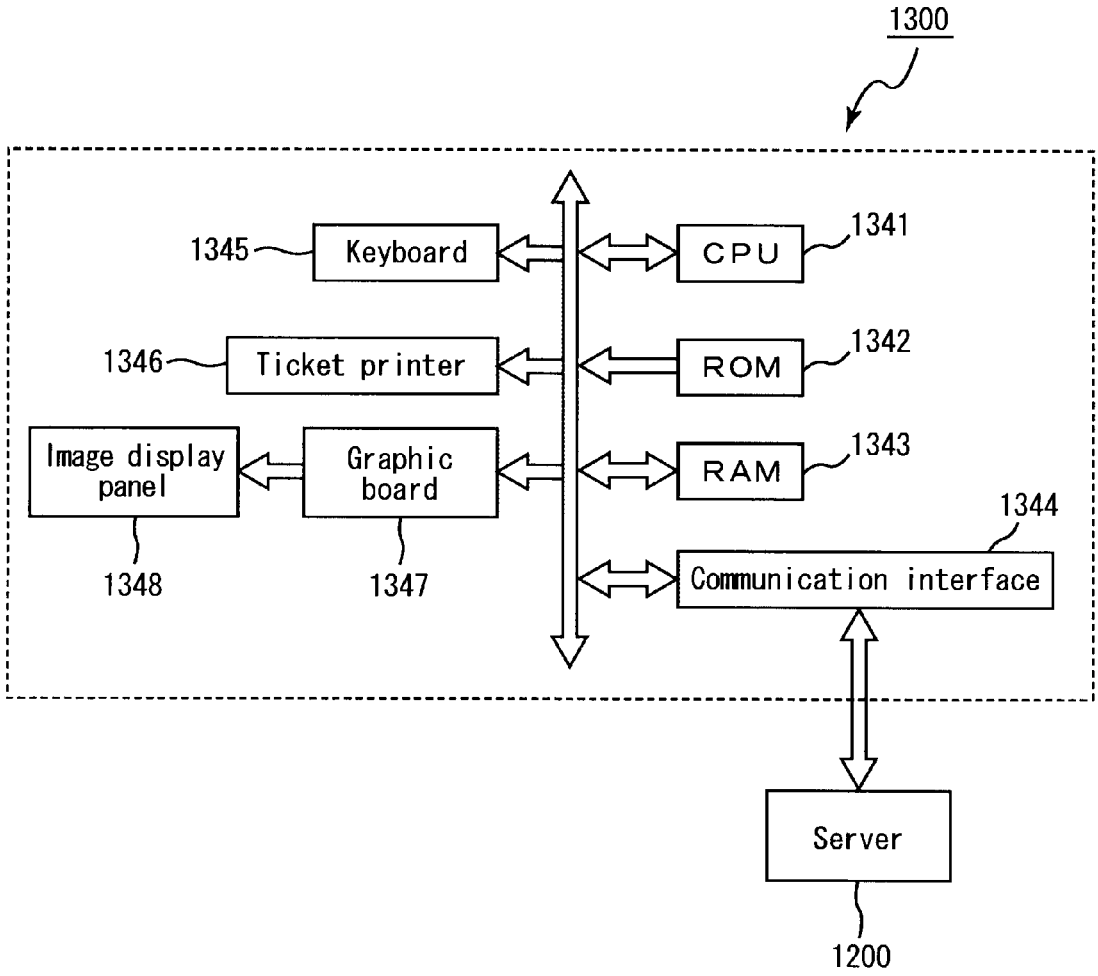
FIG. 33 is a block diagram illustrating an internal configuration of a ticket issuing device constituting the gaming system according to the second embodiment of the present invention.

FIG. 33 is a block diagram illustrating an internal configuration of a ticket issuing device that constitutes the gaming system according to the second embodiment of the present invention.

Each ticket issuing device 1300 is provided with a CPU 1341, a ROM 1342, a RAM 1343, a communication interface 1344, a keyboard 1345, a ticket printer 1346, a graphic board 1347, and an image display panel 1348.

The keyboard 1345 is used for inputting letters and numerals. The ticket printer 1346 is for printing on a ticket a barcode that represents encoded data of the player name, the tournament-type game start time, and the like, and then outputting the ticket as a ticket 1500 with a barcode. The graphic board 1347 controls image display on the image display panel 1348 based on a control signal outputted from the CPU 1341. The image display panel 1348 displays an input screen (not shown) for the player name, and the like.

The communication interface 1344 is connected through a communication line to a communication interface 1244 that is provided in the server 1200. The ROM 1342 stores a system program for controlling operation of the processor, permanent data, and the like. The RAM 1343 temporarily stores data received from the server 1200, and the like.

The keyboard 1345 corresponds to the input device in the present invention.

The ticket printer 1346 corresponds to the ticket issuing terminal in the present invention.

The CPU 1341 corresponds to the processor in the present invention.

Figure 34:
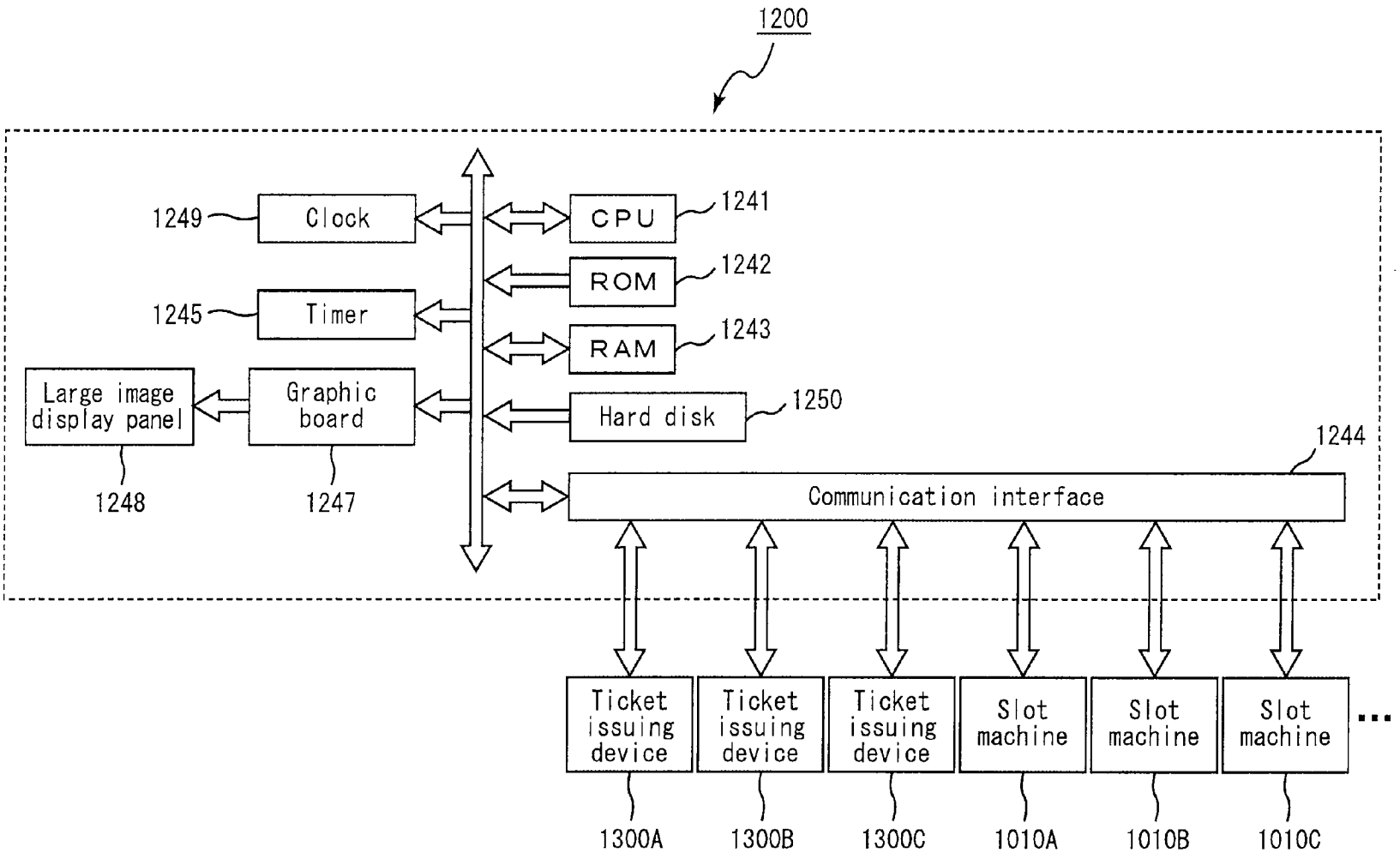
FIG. 34 is a block diagram illustrating an internal configuration of a server constituting the gaming system according to the second embodiment of the present invention.

FIG. 34 is a block diagram illustrating an internal configuration of the server that constitutes the gaming system according to the second embodiment of the present invention.

The server 1200 is provided with a CPU 1241, a ROM 1242, a RAM 1243, the communication interface 1244, a timer 1245, a graphic board 1247, a large image display panel 1248, the clock 1249, and a hard disk 1250.

The graphic board 1247 controls image display on the large image display panel 1248 based on a control signal outputted from the CPU 1241. The large image display panel 1248 displays a result (ranking) of a tournament-type game, and the like. The timer 1245 is used for measuring time. The clock 1249 is used for time keeping.

The communication interface 1244 is connected through each communication line to the communication interface 1344 of each ticket issuing device 1300 and to a communication interface 1044 of each slot machine 1010. The ROM 1242 stores a system program for controlling operation of the CPU 1241, permanent data, and the like. The ROM 1242 also stores data showing predetermined start time, predetermined first end time, predetermined second end time, and predetermined time. The RAM 1243 temporarily stores data received from the slot machines 1010 and the ticket issuing devices 1300, and the like. The hard disk 1250 stores a total cumulative amount of payout in association with the player name and the date.

The RAM 1243 corresponds to the memory in the present invention.

The CPU 1241 corresponds to the control portion in the present invention.

Figure 35:
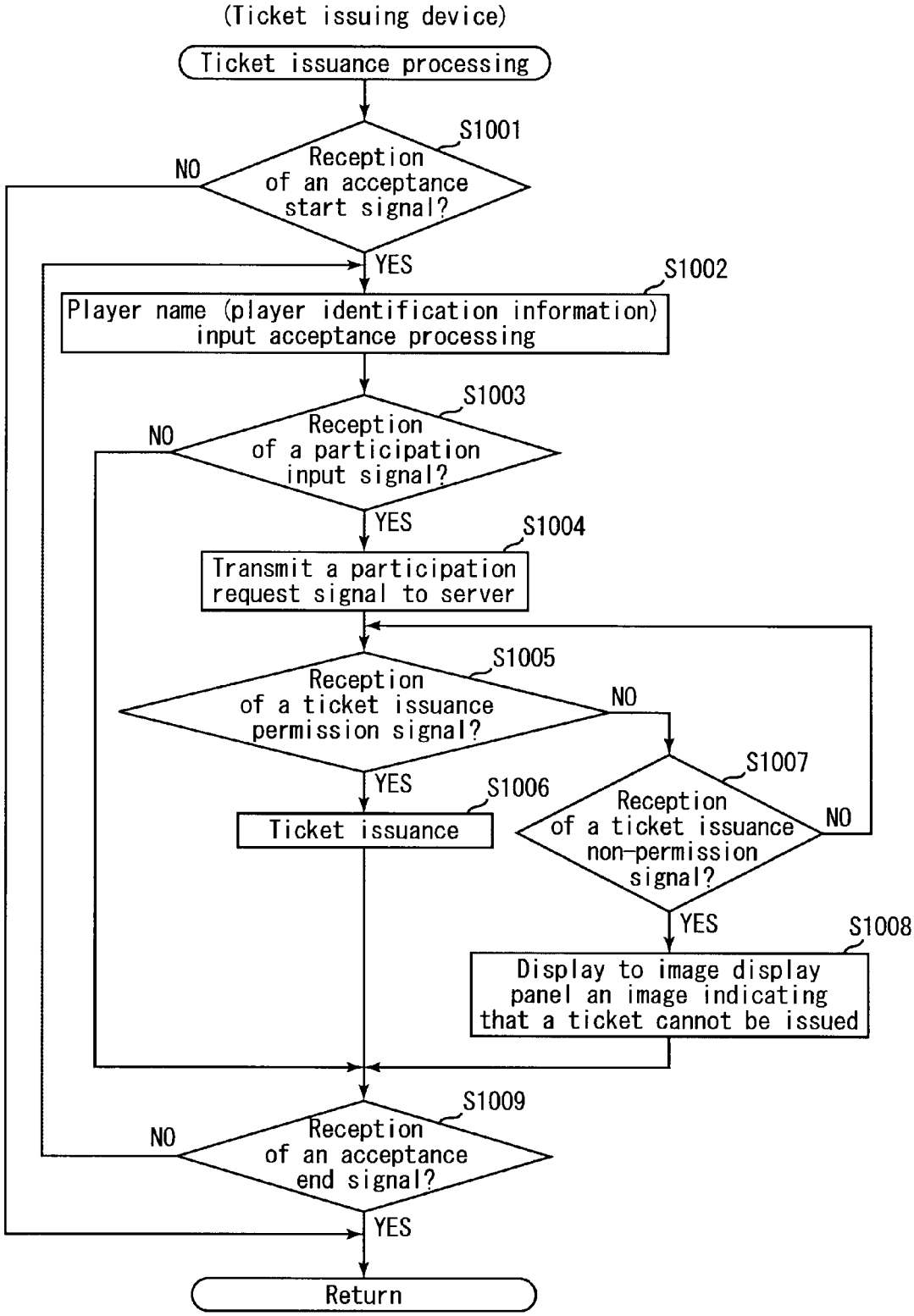
FIG. 35 is a flowchart illustrating ticket issuance processing executed in each ticket issuing device.

FIG. 35 is a flowchart illustrating ticket issuance processing executed in each ticket issuing device.

First, the CPU 1341 determines whether or not the CPU 1341 has received acceptance start signal from the server 1200 at a predetermined timing (step s1001). When the CPU 1341 determines that the CPU 1341 has not received the acceptance start signal, the CPU 1341 ends the ticket issuance processing.

On the other hand, when the CPU 1341 determines that the CPU 1341 has received the acceptance start signal, the CPU 1341 executes player-name input acceptance processing (step s1002). In the player-name input acceptance processing, the CPU 1341 accepts input of a player name through the keyboard 1345. In the second embodiment, the keyboard 1345 is operated by an operator, not a player. The operator inputs a player name of the player who wishes to participate in a tournament-type game. Completion of input of the player name leads to display of a confirmation screen for checking if the inputted player name is correct, to the image display panel 1348 (not shown). The operator inputs "Y" via the keyboard 1345 when there is no error. Input of "Y" via the keyboard 1345 at the time of display of the confirmation screen to the image display panel 1348 leads to transmission of a participation input signal from the keyboard 1345 to the CPU 1341. The participation input signal includes the player name that has been inputted via the keyboard 1345. On the other hand, when the operator inputs "N" via the keyboard 1345, input of a player name is enabled again.

The player name inputted via the keyboard 1345 corresponds to the player identification information in the present invention.

In the second embodiment, a description has been given in which the operator who operates the keyboard 1345 is not a player. However, in the present invention, a player may be an operator. If this is the case, the player operates the input device.

Next, the CPU 1341 determines whether or not the CPU 1341 has received the participation input signal from the keyboard 1345 (step s1003). When the CPU 1341 determines that the CPU 1341 has not received the participation input signal, the CPU 1341 shifts the processing to step s1009.

On the other hand, when the CPU 1341 determines that the CPU 1341 has received the participation input signal, the CPU 1341 transmits a participation request signal to the server 1200 (step s1004). The participation request signal includes the identification number of the ticket issuing device 1300.

Now, the CPU 1341 determines whether or not the CPU 1341 has received a ticket issuance permission signal from the server 1200 (step s1005). When the CPU 1341 determines that the CPU 1341 has received the ticket issuance permission signal, the CPU 1341 issues a ticket 1500 with a barcode (step s1006). In the processing, the CPU 1341 prints on a ticket a barcode that represents encoded data of the player name and the next tournament-type game start time, and then issues the ticket as a ticket 1500 with a barcode.

Figure 36:
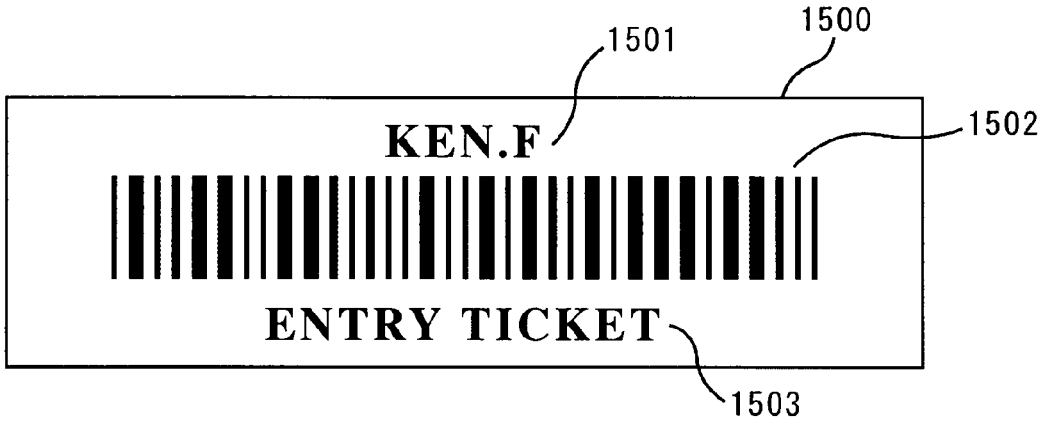
FIG. 36 is a view illustrating an exemplary ticket with a barcode which is issued from a ticket issuing device of the second embodiment.

FIG. 36 is a view illustrating an exemplary ticket with a barcode issued from a ticket issuing device of the second embodiment.

At the upper portion of the ticket 1500 with a barcode, a player name 1501 is printed.

At the central portion of the ticket 1500 with a barcode, a barcode 1502 is printed which represents encoded data of the player name and the tournament-type game start time.

At the lower portion of the ticket 1500 with a barcode, text 1503 is printed which indicates that the ticket is used for participation in a tournament-type game.

The data showing the tournament-type game start time corresponds to the game identification information in the present invention.

The barcode 1502 corresponds to the code information in the present invention.

Referring back to FIG. 35, when the CPU 1341 determines in step s1005 that the CPU 1341 has not received a ticket issuance permission signal, the CPU 1341 determines whether or not the CPU 1341 has received a ticket issuance non-permission signal from the server 1200 (step s1007). When the CPU 1341 determines that the CPU 1341 has not received the ticket issuance non-permission signal, the CPU 1341 returns the processing to step s1005. On the other hand, when the CPU 1341 determines that the CPU 1341 has received the ticket issuance non-permission signal, the CPU 1341 displays to the image display panel 1348 an image that indicates that a ticket cannot be issued (not shown). When the image display panel 1348 displays the image that indicates that a ticket cannot be issued, the operator tells the player, who wishes to participate in a tournament-type game, that the player cannot participate in the tournament-type game.

When the CPU 1341 determines in step s1003 that the CPU 1341 has not received a participation input signal or when the CPU 1341 has executed the processing of step s1006 or step s1008, the CPU 1341 determines whether or not the CPU 1341 has received an acceptance end signal from the server 1200 (step s1009). When the CPU 1341 determines that the CPU 1341 has not received the acceptance end signal, the CPU 1341 returns the processing to step s1002. On the other hand, when the CPU 1341 determines that the CPU 1341 has received the acceptance end signal, the CPU 1341 ends the ticket issuance processing.

Figure 37:
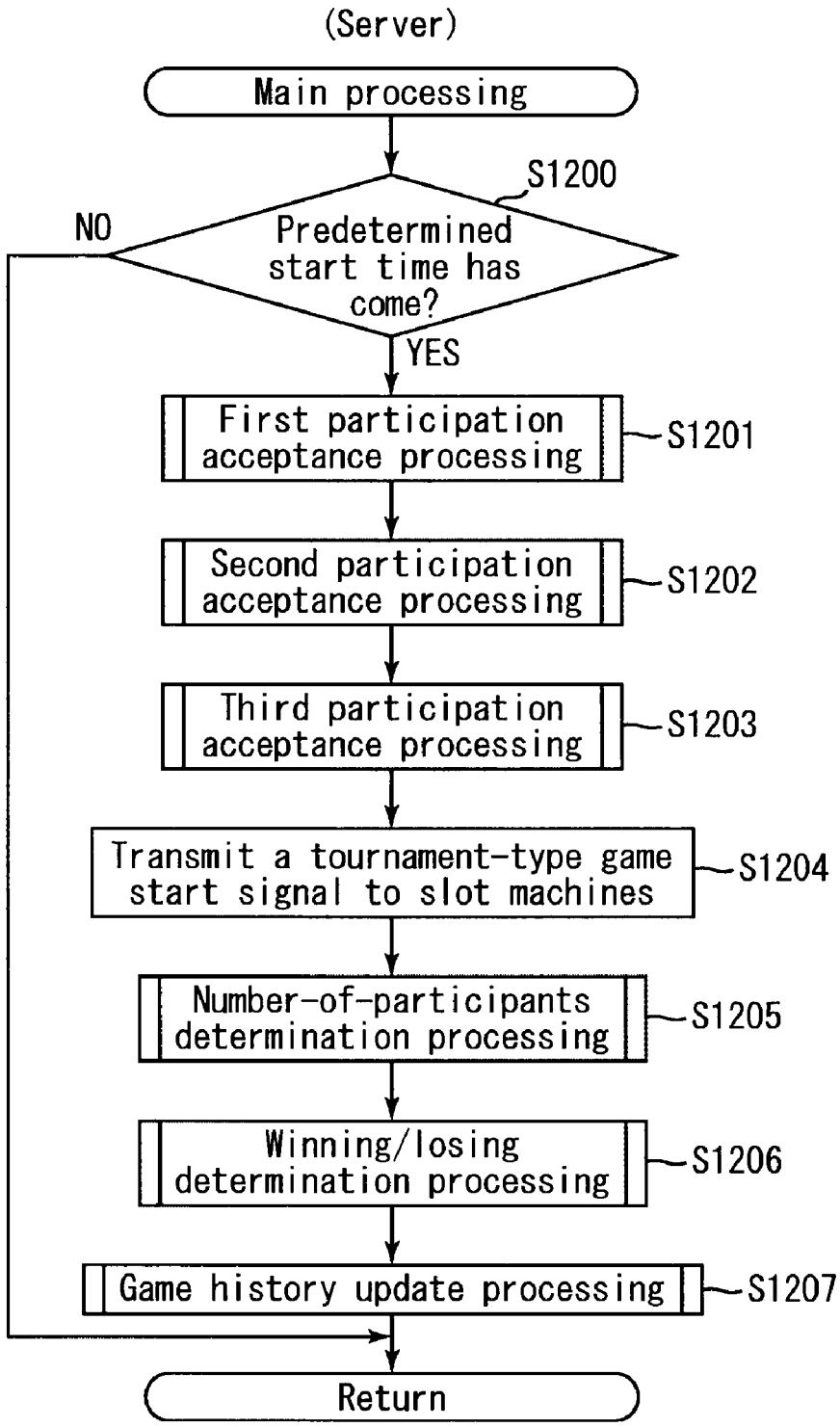
FIG. 37 is a flowchart illustrating main processing that is executed in the server.

FIG. 37 is a flowchart illustrating main processing executed in the server.

First, the CPU 1241 determines whether or not the predetermined start time has come, at a predetermined timing (step s1200). In the processing, the CPU 1241 determines whether or not the time shown by the clock 1249 is the predetermined start time. When determining that the predetermined start time has not come yet, the CPU 1241 ends the main processing.

On the other hand, when determining in step s1200 that the predetermined start time has come, the CPU 1241 executes first participation acceptance processing (step s1201). In the processing, the CPU 1241 controls issuance of tickets 1500 with a barcode to players who wish to participate in the tournament-type game. The first participation acceptance processing will be described later with reference to drawings.

The CPU 1241 executes second participation acceptance processing (step s1202). In the processing, the CPU 1241 checks whether or not the players who are currently playing a game wish to participate in the next game to be held. The second participation acceptance processing will be described later with reference to a drawing.

The CPU 1241 executes third participation acceptance processing (step s1203). In the processing, the CPU 1241 controls issuance of tickets 1500 with a barcode to players who wish to participate in the tournament-type game. The third participation acceptance processing will be described later with reference to drawings.

The CPU 1241 transmits a tournament-type game start signal to the slot machines 1010 (step s1204).

The CPU 1241 executes number-of-participants determination processing (step s1205). In the processing, the CPU 1241 determines the number of players who participate in the tournament-type game; the number of tournaments; and assignment of the slot machines 1010 participating in the tournament-type game to the tournaments. The number-of-participants determination processing will be described later with reference to a drawing.

The CPU 1241 executes winning/losing determination processing (step s1206). In the processing, the CPU 1241 determines the winning slot machine of each match in each tournament. The winning/losing determination processing will be described later with reference to drawings.

The CPU 1241 executes game-history update processing (step s1207). In the processing, the CPU 1241 stores the number of coins obtained by each player in the tournament-type game.

The game-history update processing will be described later with reference to a drawing.

After executing the processing of step s1207, the CPU 1241 ends the main processing.

Figure 38:
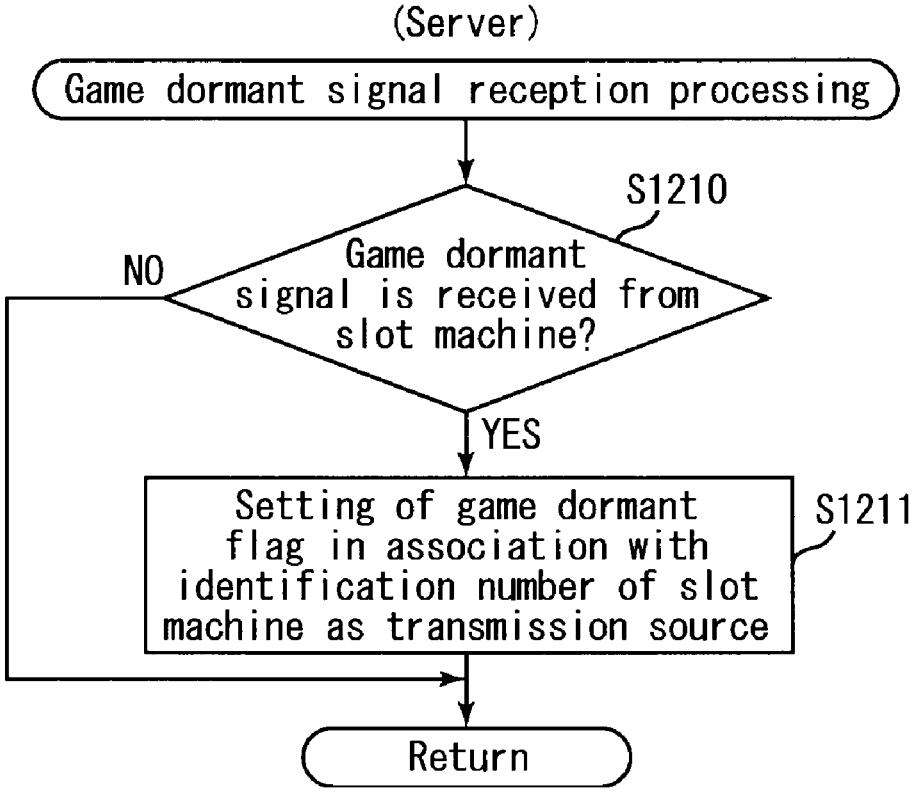
FIG. 38 is a flowchart illustrating a subroutine of game dormant signal reception processing.

FIG. 38 is a flowchart illustrating a subroutine of game dormant signal reception processing.

First, the CPU 1241 determines whether or not the CPU 1241 has received a game dormant signal from any of the slot machines 1010, at a predetermined timing (step s1210).

When the CPU 1241 determines that the CPU 1241 has not received a game dormant signal, the CPU 1241 ends the present subroutine. On the other hand, when the CPU 1241 determines that the CPU 1241 has received a game dormant signal, the CPU 1241 sets a game dormant flag in association with the identification number of the slot machine 1010 which is included in the received game dormant signal (step s1211).

After executing the processing of step s1211, the CPU 1241 ends the present subroutine.

Figure 39A:
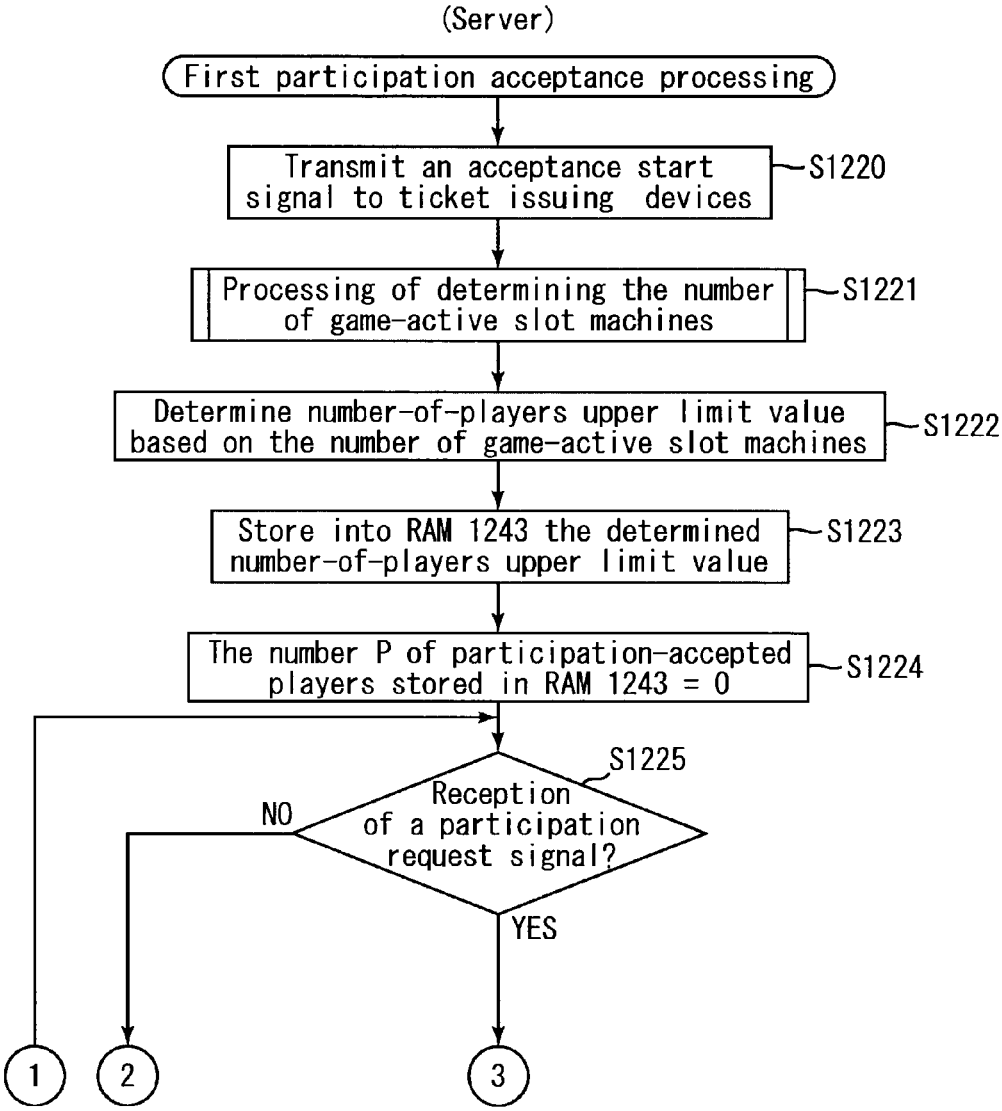
FIG. 39A is a flowchart illustrating a subroutine of first participation acceptance processing.

FIG. 39A is a flowchart illustrating a subroutine of the first participation acceptance processing.

Figure 39B:
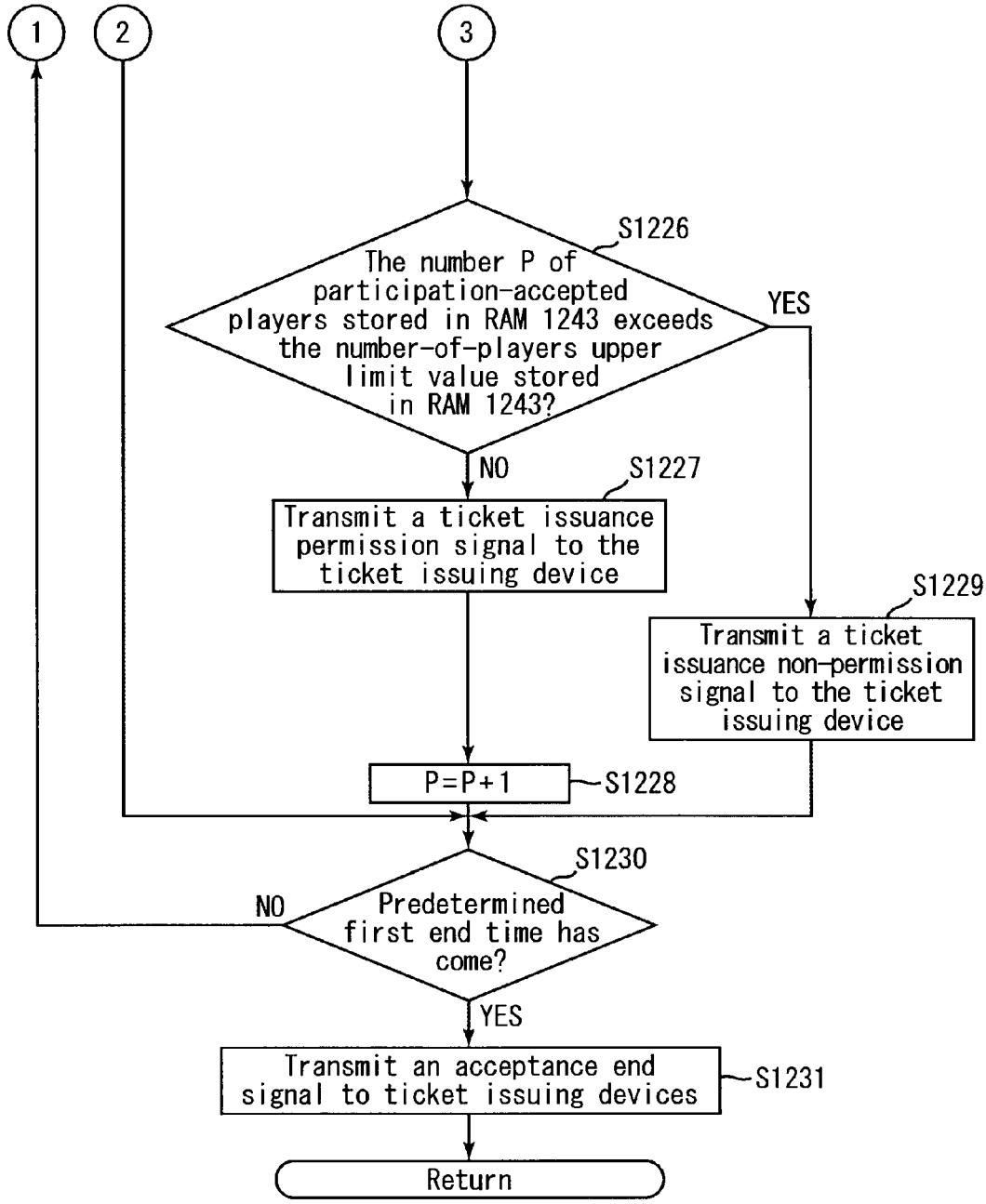
FIG. 39B is another flowchart illustrating the subroutine of the first participation acceptance processing.

FIG. 39B is another flowchart illustrating the subroutine of the first participation acceptance processing.

First, the CPU 1241 transmits a participation start signal to the ticket issuing devices 1300 (step s1220).

The CPU 1241 then executes processing of determining the number of game-active slot machines (step s1221). In the processing, the CPU 1241 determines the number of game-active slot machines which indicates the number of slot machines where a game is played. The processing of determining the number of game-active slot machines will be described later with reference to a drawing.

The CPU 1241 then determines a number-of-players upper limit value, based on the number of game-active slot machines which has been determined in step s1221 (step s1222). In the second embodiment, the CPU 1241 first subtracts the number of game-active slot machines from 50, which is the total number of the slot machines 1010. That is, the CPU 1241 determines the number of slot machines 1010 on which no game is played. Next, the CPU 1241 obtains a numeric value by multiplying the number of slot machines 1010 on which no game is played by 0.7 and truncating the digits after the decimal point, and then determines the obtained value as the number-of-players upper limit value. The number-of-players upper limit value indicates the maximum number of tickets 1500 with a barcode to be issued. That is, tickets 1500 with a barcode only in number not more than the number-of-players upper limit value can be issued.

In the second embodiment, the number of slot machine 1010 on which no game is played is multiplied by 0.7. The number of slot machines 1010 on which no game is played is multiplied by 0.7 so as to prevent a situation where a player cannot participate in a tournament-type game because there is no slot machine 1010 on which a game is played even though the player has a ticket 1500 with a barcode.

Further, multiplying the number of slot machines 1010 on which no game is played by 0.7 makes it possible to offer a chance for players, who do not participate in a tournament-type game, to play a game in a slot machine.

Next, the CPU 1241 stores the number-of-players upper limit value determined in step s1222 into the RAM 1243 (step s1223). The CPU 1241 further stores 0 into the RAM 1243 as an updated number P of participation-accepted players (step s1224).

The CPU 1241 determines whether or not the CPU 1241 has received a participation request signal from any of the ticket issuing devices 1300 (step s1225). When the CPU 1241 determines that the CPU 1241 has not received a participation request signal, the CPU 1241 shifts the processing to step s1230.

On the other hand, when the CPU 1241 determines in step s1225 that the CPU 1241 has received a participation request signal, the CPU 1241 determines whether or not the number P of participation-accepted players stored in the RAM 1243 exceeds the number-of-players upper limit value stored in the RAM 1243 (step s1226). When determining that the number P of participation-accepted players does not exceed the number-of-players upper limit value, the CPU 1241 transmits a ticket issuance permission signal to the ticket issuing device 1300 as the transmission source of the participation request signal (step s1227). Then, the CPU 1241 stores into the RAM 1243 a value obtained by adding 1 to the number P of participation-accepted players stored in the RAM 1243 as an updated number P of participation-accepted players (step s1228).

On the other hand, when the CPU 1241 determines in step s1226 that the number P of participation-accepted players exceeds the number-of-players upper limit value, the CPU 1241 transmits a ticket issuance non-permission signal to the ticket issuing device 1300 as the transmission source of the participation request signal (step s1229).

When the CPU 1241 determines in step s1225 that the CPU 1241 has not received a participation request signal, or when the CPU 1241 has executed the processing of step s1228 or step s1229, the CPU 1241 determines whether or not predetermined first end time has come (step s1230). In the processing, the CPU 1241 determines whether or not the time shown by the clock 1249 is the predetermined first end time. When determining that the predetermined first end time has not come yet, the CPU 1241 returns the processing to step s1225.

On the other hand, when determining in step s1230 that the predetermined first end time has come, the CPU 1241 transmits an acceptance end signal to the ticket issuing devices 1300 (step s1231).

After executing the processing of step s1231, the CPU 1241 ends the present subroutine.

Figure 40:
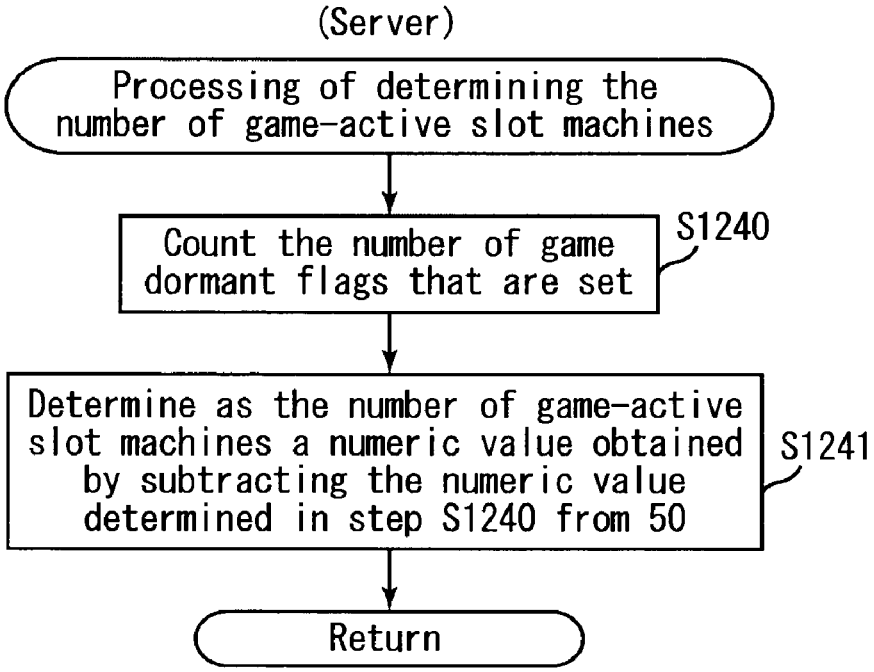
FIG. 40 is a flowchart illustrating a subroutine of processing of determining the number of game-active slot machines.

FIG. 40 is a flowchart illustrating a subroutine of the processing of determining the number of game-active slot machines.

First, the CPU 1241 counts the number of game dormant flags that are set, at a predetermined timing (step s1240).

The CPU 1241 subtracts the numeric value counted in step s1240 from 50, and determines the obtained numeric value as the number of game-active slot machines (step s1241). The CPU 1241 then stores the determined number of game-active slot machines into the RAM 1243.

After executing the processing of step s1241, the CPU 1241 ends the present subroutine.

Figure 41:
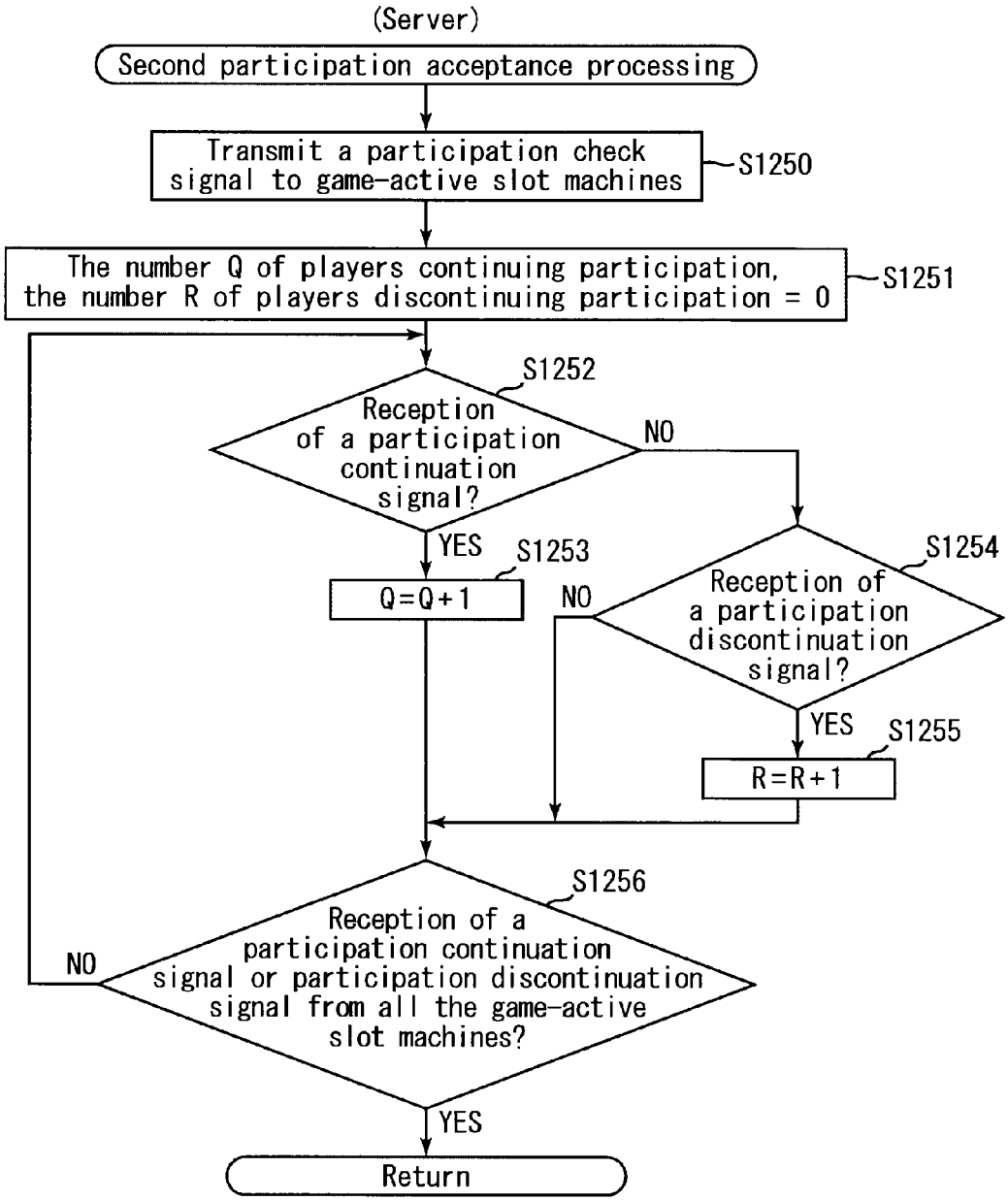
FIG. 41 is a flowchart illustrating a subroutine of second participation acceptance processing.

FIG. 41 is a flowchart illustrating a subroutine of the second participation acceptance processing.

First, the CPU 1241 transmits a participation check signal to the slot machines 1010 on which a game is played (step s1250). In the processing, the CPU 1241 transmits the participation check signal to each slot machine 1010 for which a game dormant flag is not set in association with the identification number.

The CPU 1241 stores 0 into the RAM 1243 as an updated number Q of players continuing participation, and stores 0 into the RAM 1243 as an updated number R of players discontinuing participation (step s1251).

The CPU 1241 determines whether or not the CPU 1241 has received a participation continuation signal from each slot machine 1010 (step s1252). When the CPU 1241 determines that the CPU 1241 has received a participation continuation signal, the CPU 1241 stores into the RAM 1243 a numeric value obtained by adding 1 to the number Q of players continuing participation in the RAM 1243 as an updated number Q of players continuing participation (step s1253).

On the other hand, when the CPU 1241 determines in step s1252 that the CPU 1241 has not received a participation continuation signal, the CPU 1241 determines whether or not a participation discontinuation signal from each slot machine 1010 (step s1254). When the CPU 1241 determines that the CPU 1241 has received a participation discontinuation signal, the CPU 1241 stores into the RAM 1243 a numeric value obtained by adding 1 to the number R of players discontinuing participation in the RAM 1243 as an updated number R of players discontinuing participation (step s1255).

When the CPU 1241 determines in step s1254 that the CPU 1241 has not received a participation discontinuation signal, or when the CPU 1241 has executed the processing of step s1253 or step s1255, the CPU 1241 determines whether or not the CPU 1241 has received either a participation continuation signal or a participation discontinuation signal from every slot machine on which a game is played (step s1256). In the processing, the CPU 1241 determines whether or not the total number of the number Q of players continuing participation stored in the RAM 1243 and the number R of players discontinuing participation stored in the RAM 1243 matches the number of participation check signals transmitted in the processing of step s1250. When the CPU 1241 determines that the CPU 1241 has not received either a participation continuation signal or a participation discontinuation signal from every slot machine on which a game is played, the CPU 1241 returns the processing to step s1252. On the other hand, when the CPU 1241 determines that the CPU 1241 has received either a participation continuation signal or a participation discontinuation signal from every slot machine on which a game is played, the CPU 1241 ends the present subroutine.

Figure 42A:
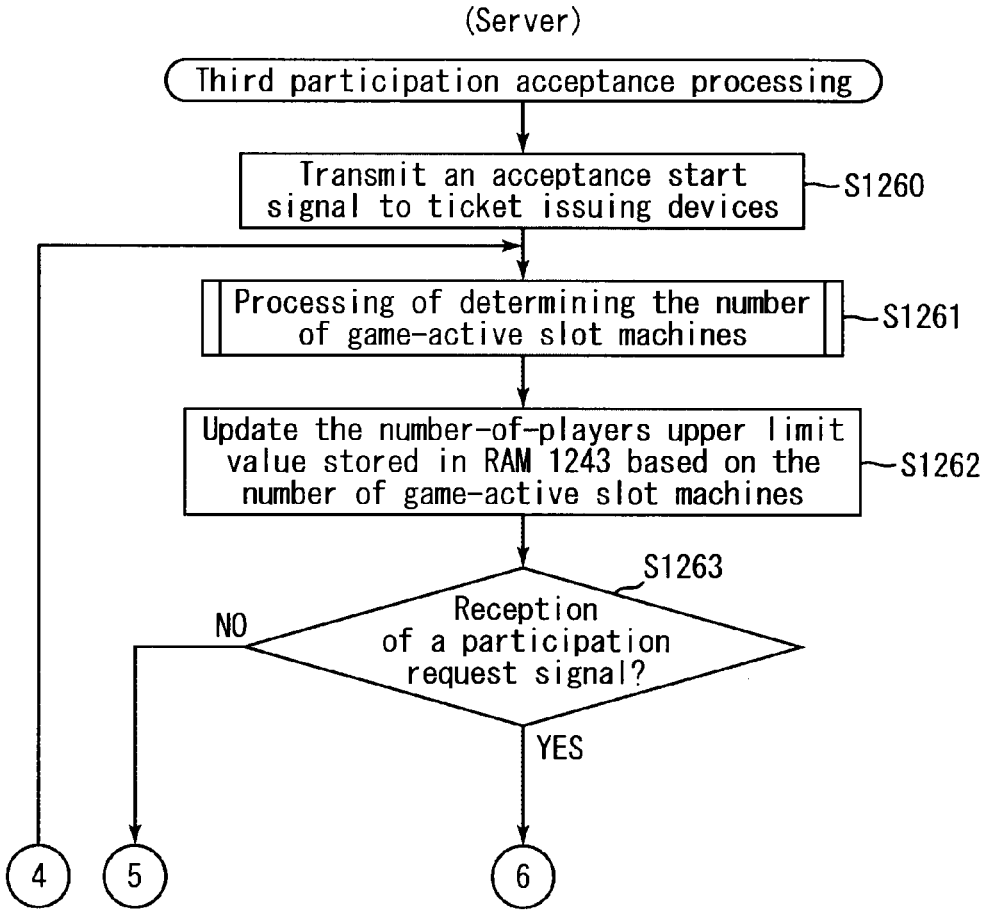
FIG. 42A is a flowchart illustrating a subroutine of third participation acceptance processing.

FIG. 42A is a flowchart illustrating a subroutine of the third participation acceptance processing.

Figure 42B:
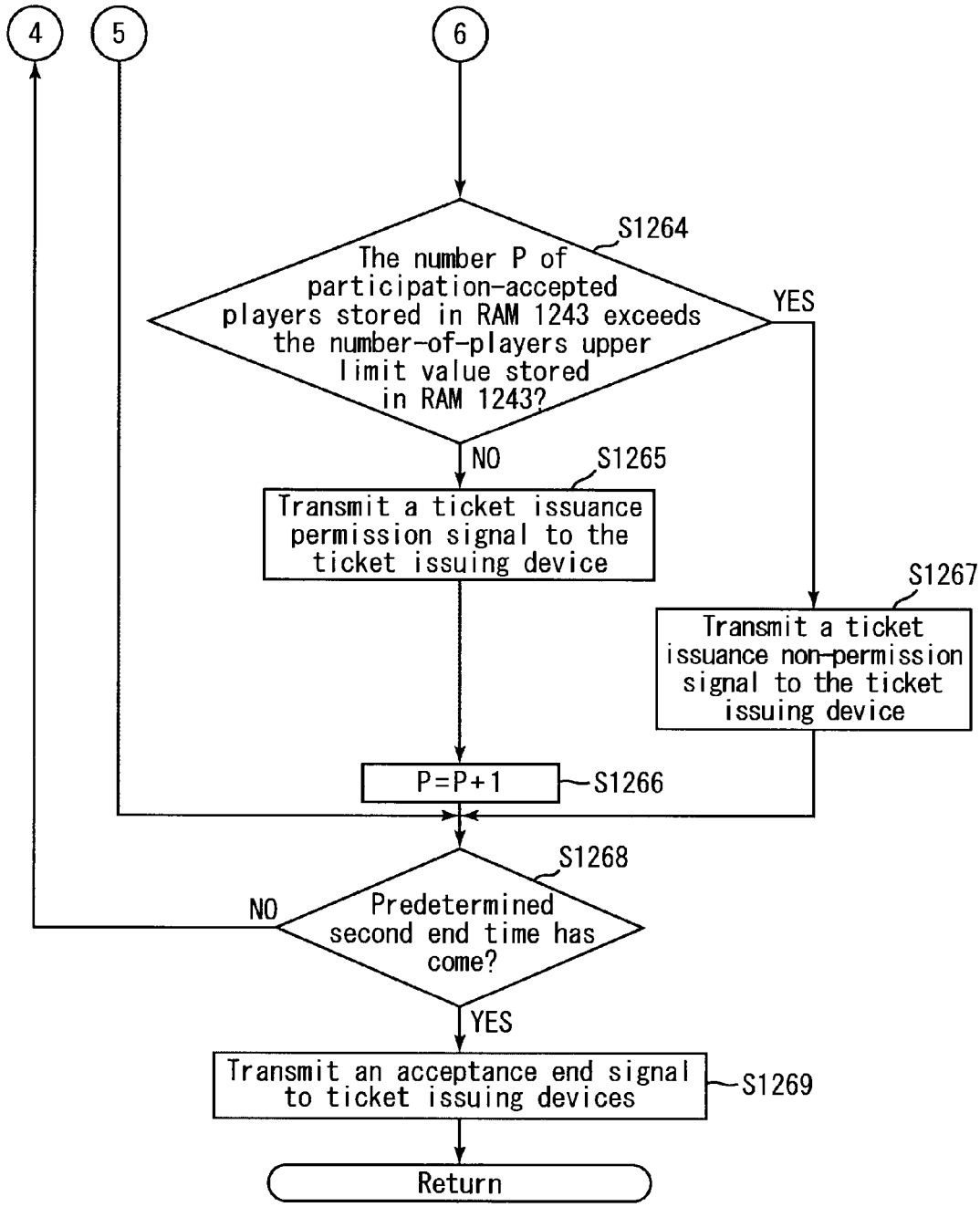
FIG. 42B is another flowchart illustrating the subroutine of the third participation acceptance processing.

FIG. 42B is another flowchart illustrating the subroutine of the third participation acceptance processing.

First, the CPU 1241 transmits an acceptance start signal to the ticket issuing devices 1300 (step s1260).

The CPU 1241 then executes the processing of determining the number of game-active slot machines (step s1261). In the processing, the CPU 1241 determines the number of game-active slot machines which indicates the number of slot machines where a game is played. The processing of determining the number of game-active slot machines will be described later with reference to a drawing.

The CPU 1241 updates the number-of-players upper limit value stored in the RAM 1243, based on the number of game-active slot machines determined in step s1261 (step s1262). In the second embodiment, as described above, the CPU 1241 subtracts the number of game-active slot machines from 50, which is the total number of the slot machines 1010. That is, the CPU 1241 determines the number of slot machines 1010 on which no game is played. Thereafter, the CPU 1241 obtains a numeric value by multiplying the number of slot machines 1010 on which no game is played by 0.7 and truncating the digits after the decimal point, and then determines the obtained value as the number-of-players upper limit value. After that, the CPU 1241 stores into the RAM 1243 the determined number-of-players upper limit value as an updated number-of-players upper limit value.

The CPU 1241 determines whether or not the CPU 1241 has received a participation request signal from any of the ticket issuing devices 1300 (step s1263). When the CPU 1241 determines that the CPU 1241 has not received a participation request signal, the CPU 1241 shifts the processing to step s1268.

On the other hand, when the CPU 1241 determines in step s1263 that the CPU 1241 has received a participation request signal, the CPU 1241 determines whether or not the number P of participation-accepted players in the RAM 1243 exceeds the number-of-players upper limit value in the RAM 1243 (step s1264). When determining that the number P of participation-accepted players does not exceed the number-of-players upper limit value, the CPU 1241 transmits a ticket issuance permission signal to the ticket issuing device 1300 as the transmission source of the participation request signal (step s1265). Then, the CPU 1241 stores into the RAM 1243 a numeric value obtained by adding 1 to the number P of participation-accepted players in the RAM 1243 as an updated number P of participation-accepted players (step s1266).

On the other hand, when determining in step s1264 that the number P of participation-accepted players exceeds the number-of-players upper limit value, the CPU 1241 transmits a ticket issuance non-permission signal to the ticket issuing device 1300 as the transmission source of the participation request signal (step s1267).

When the CPU 1241 determines in step s1263 that the CPU 1241 has not received a participation request signal, or when the CPU 1241 has executed the processing of step s1266 or step s1267, the CPU 1241 determines whether or not the predetermined second end time has come (step s1268). In the processing, the CPU 1241 determines whether or not the time shown by the clock 1249 is the predetermined second end time. When determining that the predetermined second end time has not come yet, the CPU 1241 returns the processing to step s1261.

On the other hand, when determining in step s1268 that the predetermined second end time has come, the CPU 1241 transmits an acceptance end signal to the ticket issuing devices 1300 (step s1269).

After executing the processing of step s1269, the CPU 1241 ends the present subroutine.

Execution of the third participation acceptance processing makes it possible to issue a ticket 1500 with a barcode based on the operational status of the gaming machines, until just before the tournament-type game starts.

Figure 43:
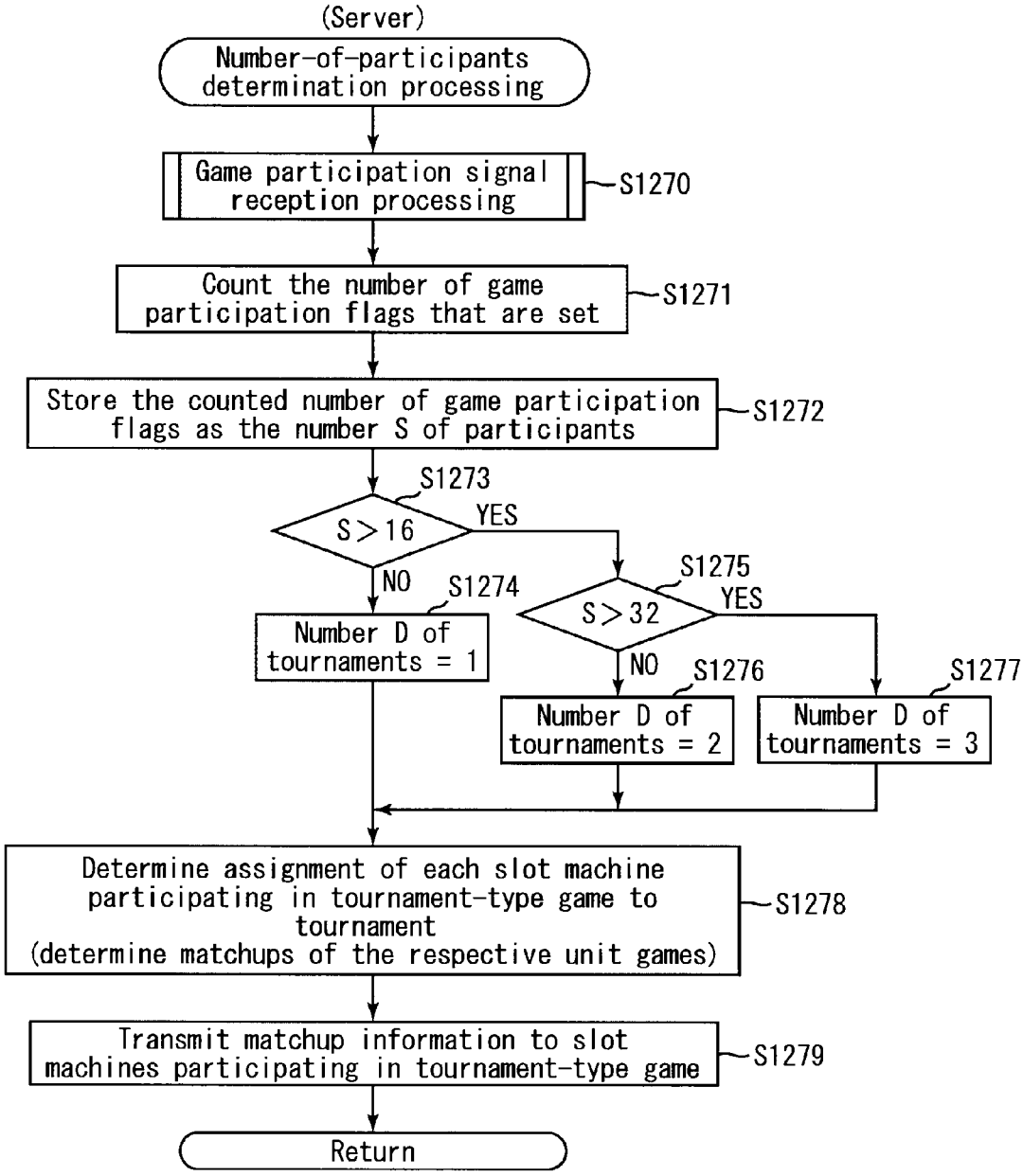
FIG. 43 is a flowchart illustrating a subroutine of number-of-participants determination processing.

FIG. 43 is a flowchart illustrating a subroutine of the number-of-participants determination processing.

First, the CPU 1241 executes game participation signal reception processing (step s1270). In the processing, when receiving a game participation signal, the CPU 1241 sets a game participation flag in association with the identification number of the slot machine 1010 as the transmission source. The game participation signal reception processing will be described later with reference to a drawing.

The CPU 1241 counts the number of game participation flags that are set (step s1271). Then, the CPU 1241 stores the counted number of game participation flags into the RAM 1243 as the number S of participants (step s1272).

The CPU 1241 determines whether or not the number S of participants in the RAM 1243 is more than 16 (step s1273). When determining that the number S of participants is not more than 16, the CPU 1241 determines 1 as the number D of tournaments which indicates the number of tournaments in a tournament-type game (step s1274). The CPU 1241 then stores 1 into the RAM 1243 as the number D of tournaments.

On the other hand, when determining in step s1273 that the number S of participants is more than 16, the CPU 1241 determines whether or not the number S of participants in the RAM 1243 is more than 32 (step s1275). When determining that the number S of participants is not more than 32, the CPU 1241 determines 2 as the number D of tournaments which indicates the number of tournaments in a tournament-type game (step s1276). The CPU 1241 then stores 2 into the RAM 1243 as the number D of tournaments.

On the other hand, when determining in step s1275 that the number S of participants is more than 32, the CPU 1241 determines 3 as the number D of tournaments which indicates the number of tournaments in a tournament-type game (step s1277). The CPU 1241 then stores 3 into the RAM 1243 as the number D of tournaments.

In the second embodiment, the number of tournaments in a tournament-type game is changed in accordance with the number S of participants. This will avoid a situation in which the time it takes from beginning to end of a tournament-type game is long because one tournament includes too many participating players; as a result, it is possible to prevent players from getting tired of the game.

Further, when a tournament-type game starts, matches are held in respective tournaments. That is, matches in the respective tournaments are simultaneously held. In the second embodiment, the maximum number of tournaments is 3. Increasing the number of tournaments makes it possible to increase the number of players who can be accepted to participate in the tournament-type game.

When executing the processing of step s1274, step s1276, or step s1277, the CPU 1241 determines assignment of the slot machines 1010 participating in the tournament-type game to the tournaments (step s1278). In the processing, the CPU 1241 first identifies the number D of tournaments which has been determined in the processing of step s1274, step s1276, or step s1277. Next, the CPU 1241 determines the number of tournament participants which indicates the number of players who participate in one tournament, based on the identified number D of tournaments and the number S of participants. For example, when the number D of tournaments is 2 and the number S of participants is 30, the number of tournament participants is 15.

Then, the CPU 1241 assigns the slot machines 1010 to a tournament tree from the left in the ascending order of the identification numbers of the slot machines 1010 such that a slot machine 1010 with the smallest identification number among the participating slot machines 1010 is assigned to the leftmost position. When the CPU 1241 has filled the tournament tree (when assignment of the slot machines 1010 in number equal to the number of tournament participants has been completed), the CPU 1241 starts assigning the slot machines 1010 to the next tournament tree in the same way.

The tournament corresponds to the game in the present invention.

In a tournament, matches each involving two slot machines are held. A group consisting of two slot machines competing with each other in a match corresponds to a game group in the present invention.

A match held for each two slot machines (a game executed in each slot machine 1010 by executing the processing of step s1064 to step s1075 (see FIG. 54A and FIG. 54B)) corresponds to a unit game in the present invention.

In the processing of step s1278, matchups for the respective unit games (matches) in the respective tournaments are determined.

The CPU 1241 transmits as matchup information the assignment of the slot machines 1010 participating in the tournament-type game to the tournaments (the assignments determined in step s1278) to the slot machines 1010 participating in the tournament-type game (step s1279).

After executing the processing of step s1279, the CPU 1241 ends the present subroutine.

The matchup information corresponds to the participation determined game information in the present invention.

Figure 44:
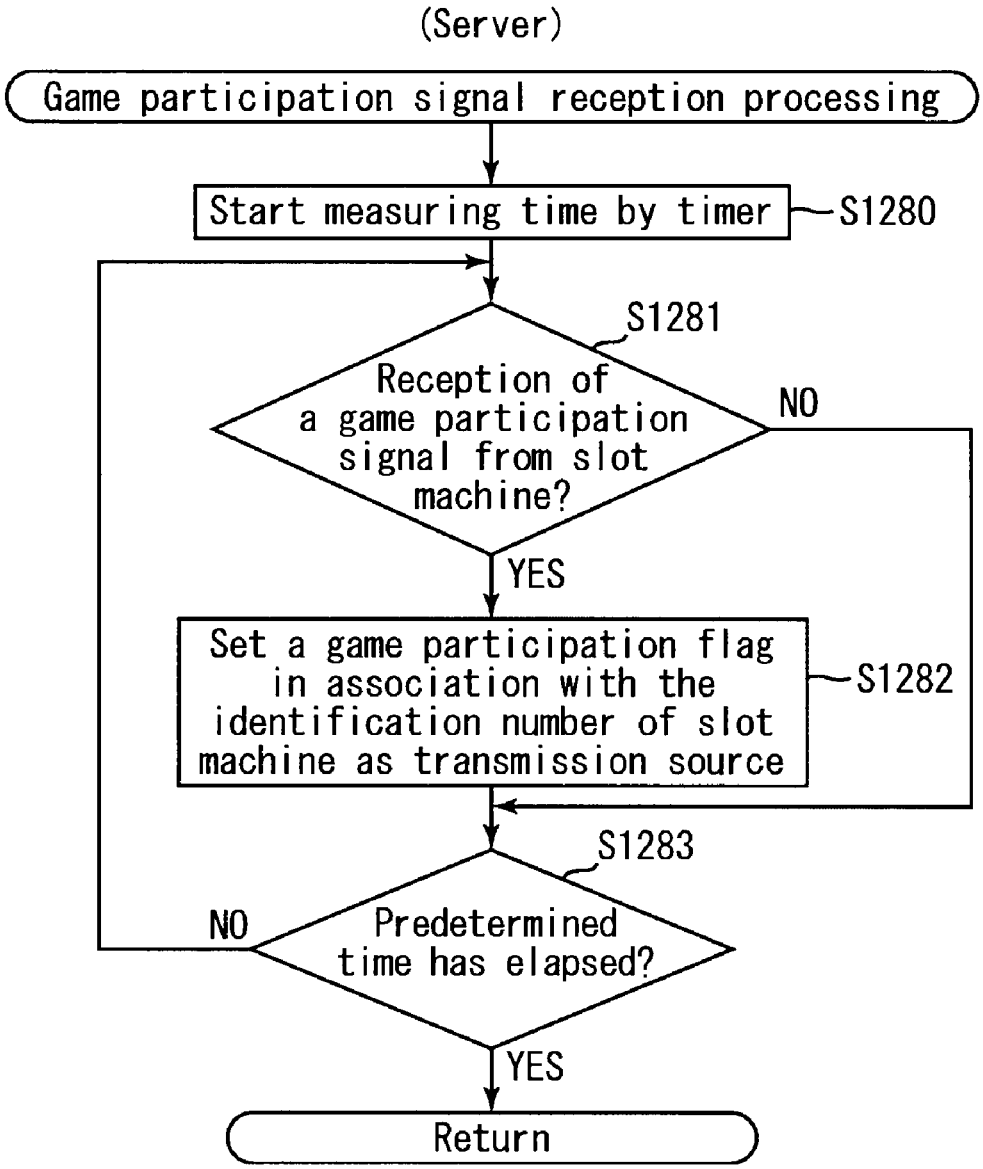
FIG. 44 is a flowchart illustrating a subroutine of game participation signal reception processing.

FIG. 44 is a flowchart illustrating a subroutine of game participation signal reception processing.

First, the CPU 1241 starts measuring time with the timer 1245, at a predetermined timing (step s1280).

Next, the CPU 1241 determines whether or not the CPU 1241 has received a game participation signal from any of the slot machines 1010 (step s1281). When the CPU 1241 determines that the CPU 1241 has received a game participation signal, the CPU 1241 sets a game participation flag in association with the identification number of the slot machine 1010 as the transmission source of the game participation signal (step s1282).

When the CPU 1241 determines in step s1281 that the CPU 1241 has not received a game participation signal, or after the CPU 1241 has executed the processing of step s1282, the CPU 1241 determines whether or not the predetermined time has elapsed (step s1283). In the processing, the CPU 1241 determines whether or not the time measured with the timer 1245 has reached the predetermined time. When determining that the predetermined time has not elapsed, the CPU 1241 returns the processing to step s1281.

On the other hand, when determining in step s1283 that the predetermined time has elapsed, the CPU 1241 ends the present subroutine.

Figure 45A:
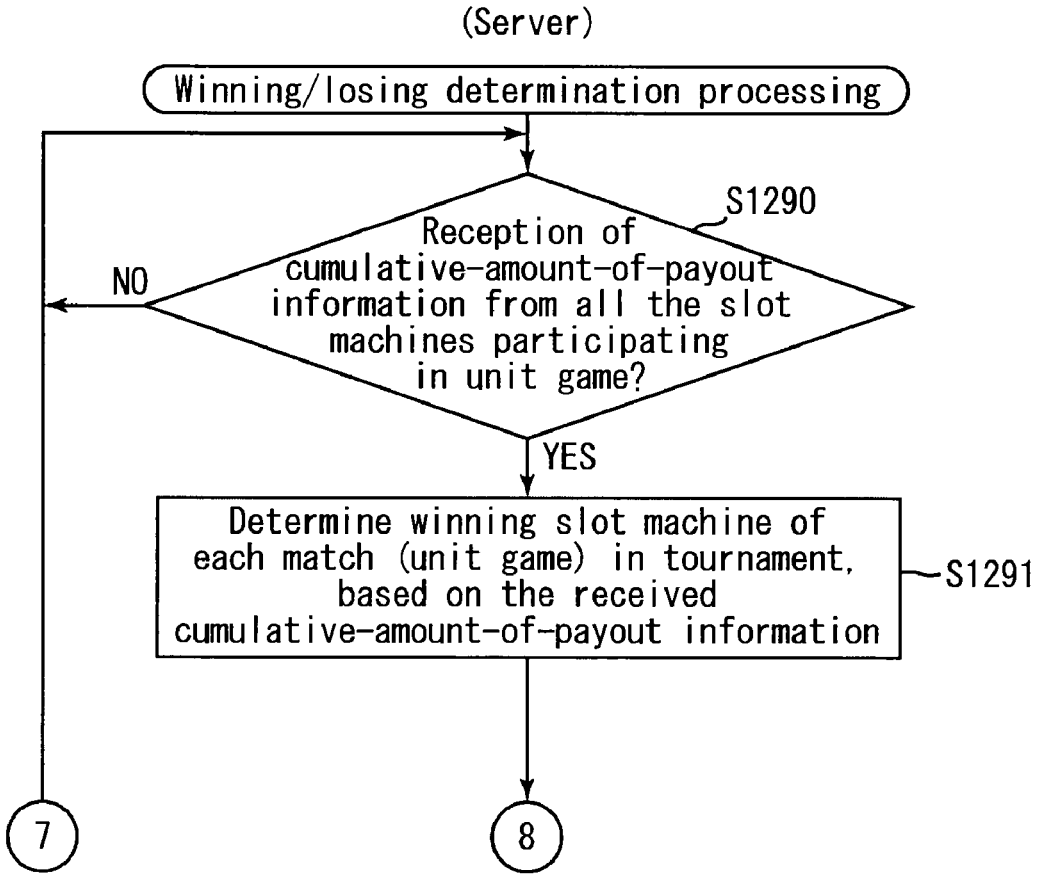
FIG. 45A is a flowchart illustrating a subroutine of winning/losing determination processing.

FIG. 45A is a flowchart illustrating a subroutine of the winning/losing determination processing.

Figure 45B:
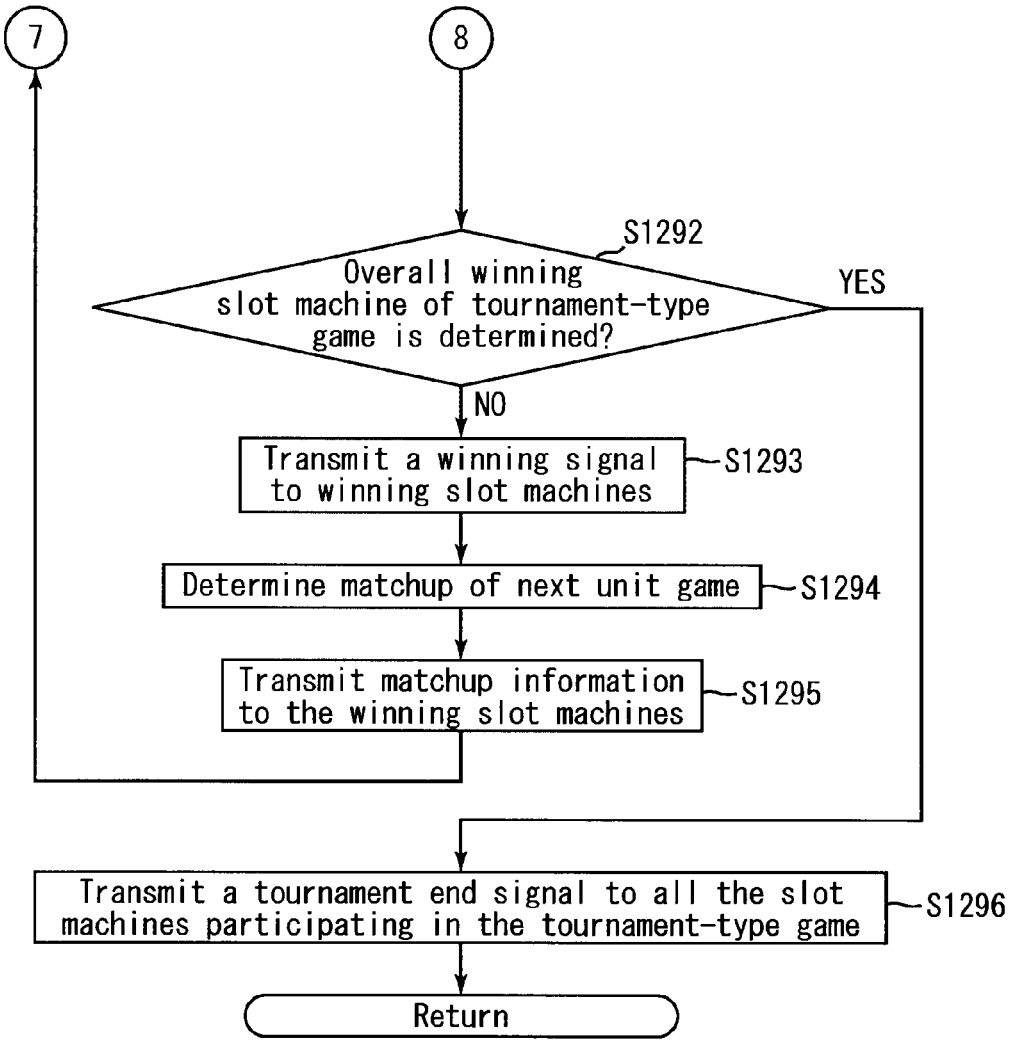
FIG. 45B is another flowchart illustrating the subroutine of the winning/losing determination processing.

FIG. 45B is another flowchart illustrating the subroutine of the winning/losing determination processing.

First, the CPU 1241 determines whether or not the CPU 1241 has received cumulative-amount-of-payout information from every slot machine participating in a unit game (step s1290). When the CPU 1241 determines that the CPU 1241 has not received cumulative-amount-of-payout information from every slot machine participating in a unit game, the CPU 1241 returns the processing to step s1290.

On the other hand, when the CPU 1241 determines that the CPU 1241 has received cumulative-amount-of-payout information from every slot machine participating in a unit game, the CPU 1241 determines the winning slot machine of each match (unit game) in the tournaments (step s1291). In the processing, the CPU 1241 determines for each match the slot machine 1010 with the cumulative-amount-of-payout information which shows a cumulative amount of payout larger than that of the cumulative-amount-of-payout information of the other slot machine 1010 as the winning slot machine of the match. The determination is made based on the received pieces of cumulative-amount-of-payout information; the identification number of the slot machine 1010 included in each piece of cumulative-amount-of-payout information; and the matchups of the respective unit games (matches) in the respective tournaments which have been determined in step s1278.

The CPU 1241 then determines whether or not the overall winning slot machine of the tournament-type game has been determined (step s1292). In the processing, the CPU 1241 determines whether or not only one slot machine 1010 has been determined as the winning slot machine in every tournament. That is, in step s1292, whether or not the overall winning slot machine 1010 in every tournament is determined.

When the CPU 1241 determines in step s1292 that the overall winning slot machine of the tournament-type game has not been determined, the CPU 1241 transmits a winning signal to the slot machines 1010 that have been determined as the winning slot machines (step s1293). It should be noted that when only one slot machine 1010 has been determined as the winning slot machine in a tournament, the CPU 1241 does not transmit the winning signal to the slot machine that has been determined as the winning slot machine in this tournament. That is, the CPU 1241 does not transmit the winning signal to the slot machine 1010 that has been determined as the overall winner.

The CPU 1241 determines matchups for the next unit games (matches) (step s1294). In the processing, the CPU 1241 determines the matchups of the next unit games (matches), based on the winning slot machines determined in step s1291 and assignment of the slot machines 1010 to the tournaments which has been determined in step s1278.

The CPU 1241 transmits as matchup information the matchups of the unit games (matches) determined in step s1294 to the slot machines 1010 that have been determined as the winning slot machines (step s1295).

After executing the processing of step s1295, the CPU 1241 returns the processing to step s1290.

When determining in step s1292 that the overall winning slot machine of the tournament-type game has been determined, the CPU 1241 transmits a tournament end signal to all the slot machines 1010 that participate in the tournament-type game (step s1296). In the processing, the CPU 1241 transmits the tournament end signal to the slot machines 1010 for each of which a game participation flag is set in association with the identification number. The tournament end signal includes information on the ranking for each tournament in the executed tournament-type game. That is, the ranking of the respective slot machines is determined before the tournament end signal is transmitted. The slot machine 1010 that has been determined as the overall winner takes first place, and the ranks of the respective other slot machines 1010 are determined in order.

Figure 46:
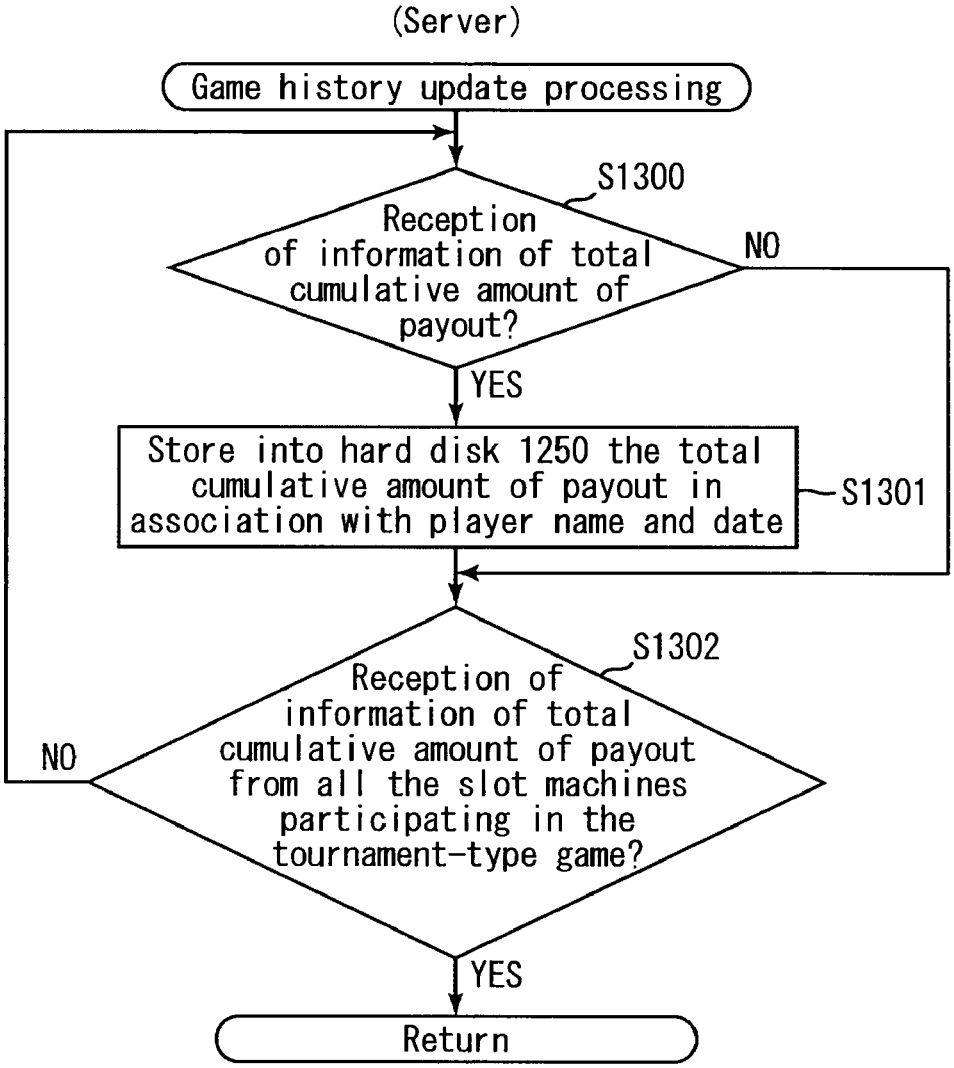
FIG. 46 is a flowchart illustrating a subroutine of game-history update processing.

FIG. 46 is a flowchart illustrating a subroutine of the game-history update processing.

First, the CPU 1241 determines whether or not the CPU 1241 has received total-cumulative-amount-of-payout information (step s1300). When the CPU 1241 determines that the CPU 1241 has received total-cumulative-amount-of-payout information, the CPU 1241 stores the total cumulative amount of payout shown by the total-cumulative-amount-of-payout information into the hard disk 1250 in association with the player name and today's date which are included in the total-cumulative-amount-payout information (step s1301).

When the CPU 1241 determines in step s1300 that the CPU 1241 has not received total-cumulative-amount-of-payout information, or when the CPU 1241 has executed the processing of step s1301, the CPU 1241 determines whether or not the CPU 1241 has received total-cumulative-amount-of-payout information from every slot machine 1010 participating in the tournament-type game (step s1302). When the CPU 1241 determines that the CPU 1241 has not received total-cumulative-amount-of-payout information from every slot machine 1010 participating in the tournament-type game, the CPU 1241 returns the processing to step s1300. On the other hand, when the CPU 1241 determines that the CPU 1241 has received total-cumulative-amount-of-payout information from every slot machine 1010, the CPU 1241 ends the present subroutine.

Figure 47:
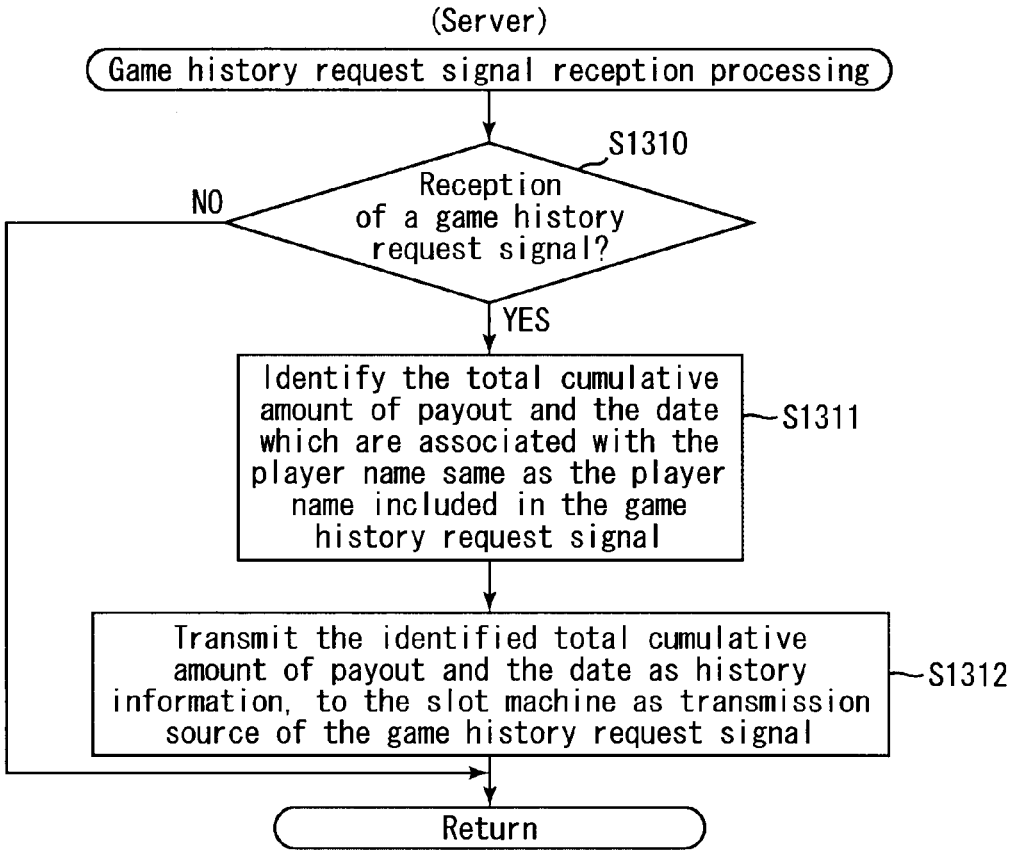
FIG. 47 is a flowchart illustrating a subroutine of game-history request signal reception processing.

FIG. 47 is a flowchart illustrating a subroutine of game-history request signal reception processing.

First, the CPU 1241 determines whether or not the CPU 1241 has received a game-history request signal from any of the slot machines 1010 (step s1310). When the CPU 1241 determines that the CPU 1241 has not received a game-history request signal from any of the slot machines 1010, the CPU 1241 ends the present subroutine.

On the other hand, when the CPU 1241 determines in step s1310 that the CPU 1241 has received a game-history request signal from any of the slot machines 1010, the CPU 1241 identifies the total cumulative amount of payout and the date which are stored in the hard disk 1250 in association with the player name that is same as the player name included in the received game-history request signal (step s1311).

The CPU 1241 then transmits as history information the total cumulative amount of payout and the date, which have been identified in step s1311, to the slot machine 1010 as the transmission source of the game-history request signal (step s1312).

When the CPU 1241 determines in step s1310 that the CPU 1241 has not received a game-history request signal from any one of the slot machines 1010 or after the CPU 1241 has executed the processing of step s1312, the CPU 1241 ends the present subroutine.

Figure 48:
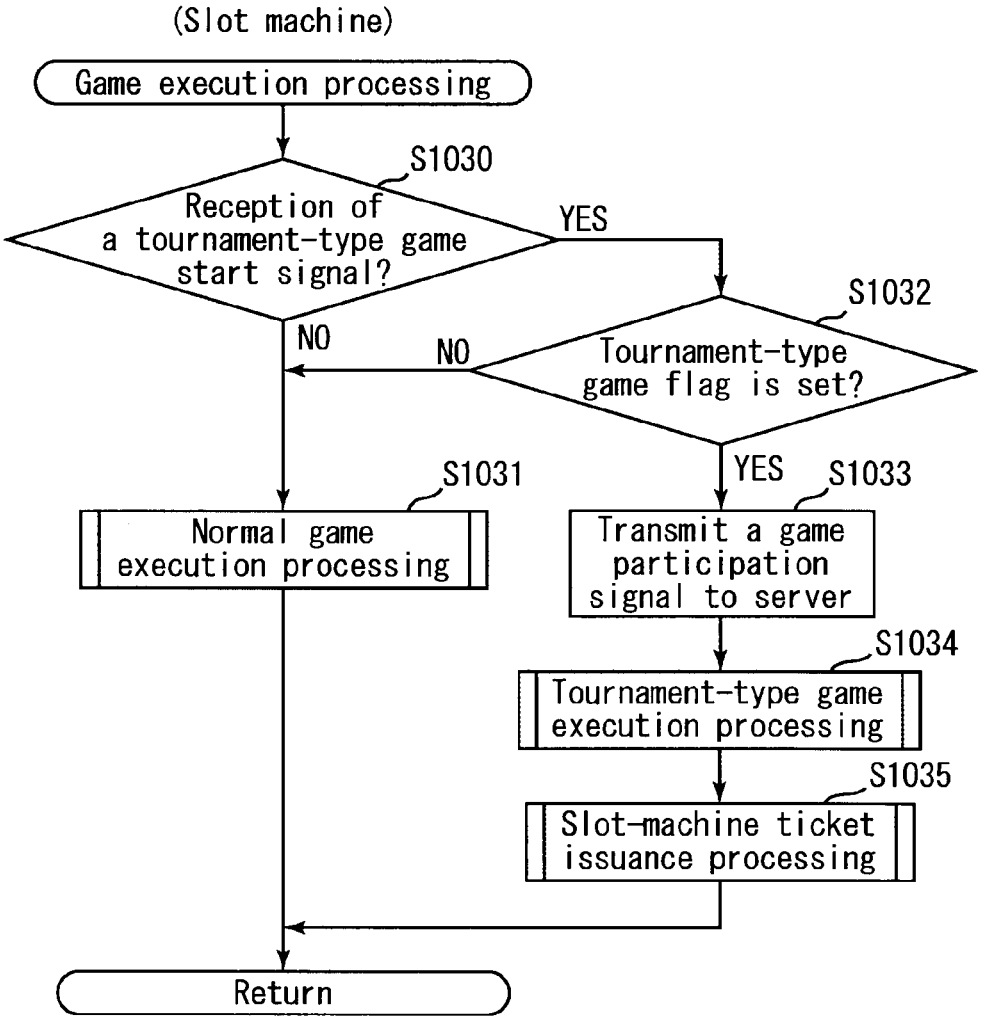
FIG. 48 is a flowchart illustrating game execution processing executed in each slot machine.

FIG. 48 is a flowchart illustrating game execution processing that is executed in each slot machine.

First, the main CPU 1041 determines whether or not the main CPU 1041 has received the tournament-type game start signal from the server 1200, at a predetermined timing (step s1030). When the main CPU 1041 determines that the main CPU 1041 has not received the tournament-type game start signal, the main CPU 1041 executes normal-game execution processing (step s1031). The normal-game execution processing will be described later in detail with reference to a drawing.

On the other hand, when the main CPU 1041 determines in step s1030 that the main CPU 1041 has received the tournament-type game start signal, the main CPU 1041 determines whether or not a tournament-type game flag is set (step s1032). The tournament-type game flag is set in flag setting processing shown in FIG. 49 or participation check signal reception processing shown in FIG. 50.

When the main CPU 1041 determines in step s1032 that the tournament-type game flag is not set, the main CPU 1041 executes the normal-game execution processing (step s1031). The normal-game execution processing will be described later in detail with reference to a drawing.

On the other hand, when the main CPU 1041 determines in step s1032 that the tournament-type game flag is set, the main CPU 1041 transmits a game participation signal to the server 1200 (step s1033). The game participation signal includes the identification number of the slot machine 1010.

The main CPU 1041 executes tournament-type game execution processing (step s1034). The tournament-type game execution processing will be described later with reference to drawings.

The main CPU 1041 executes slot-machine ticket issuance processing (step s1035). The slot-machine ticket issuance processing will be described later with reference to drawings.

When executing the processing of step s1031 or step s1035, the main CPU 1041 ends the game execution processing.

Figure 49:
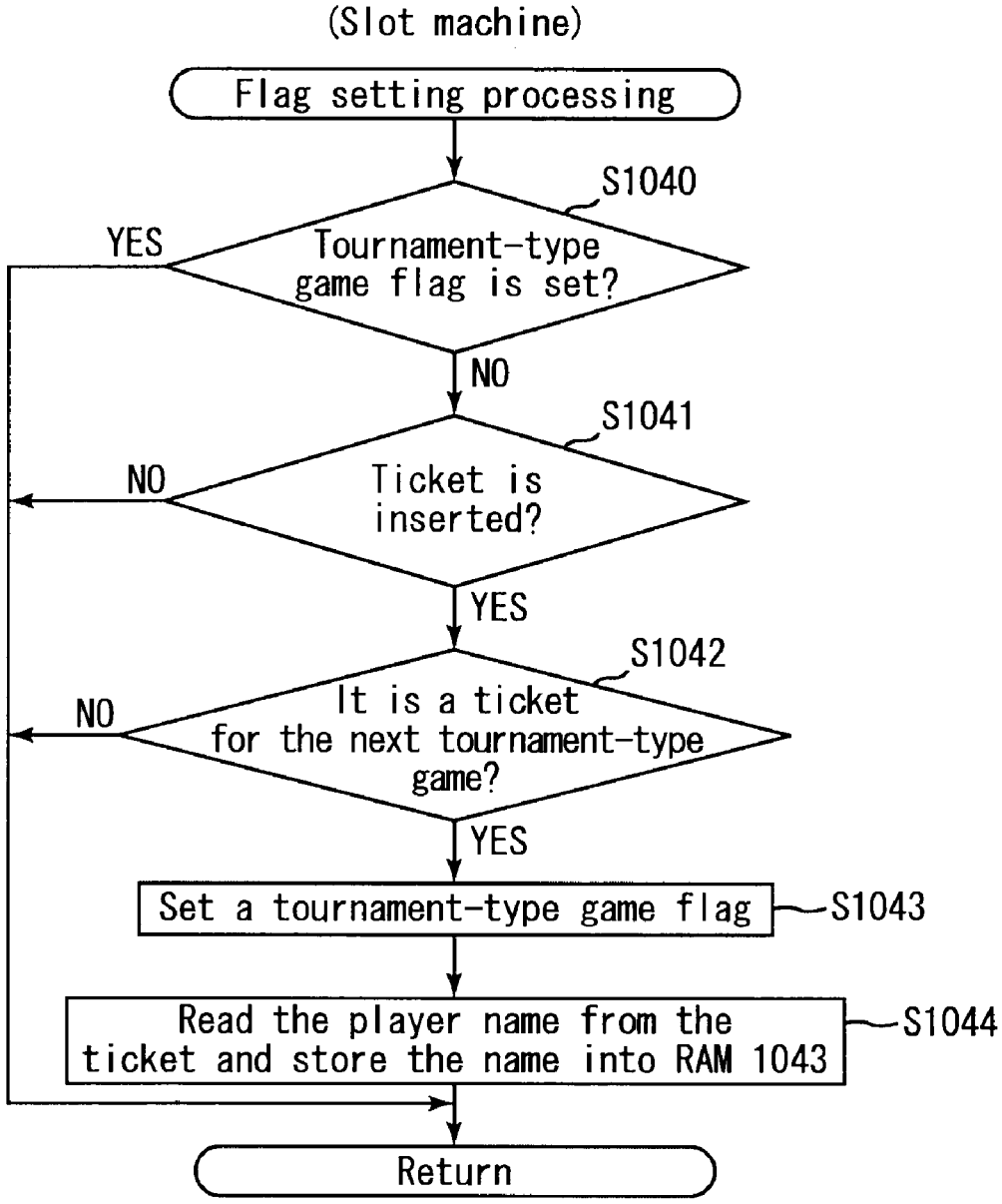
FIG. 49 is a flowchart illustrating a subroutine of flag setting processing.

FIG. 49 is a flowchart illustrating a subroutine of the flag setting processing.

The main CPU 1041 first determines whether or not the tournament-type game flag is set, at a predetermined timing (step s1040). When determining that the tournament-type game flag is set, the main CPU 1041 ends the present subroutine.

On the other hand, when determining in step s1040 that the tournament-type game flag is not set, the main CPU 1041 determines whether or not a ticket 1500 with a barcode is inserted into the bill validator 1022 (step s1041). When determining that a ticket 1500 with a barcode is not inserted into the bill validator 1022, the main CPU 1041 ends the present subroutine.

On the other hand, when determining in step s1041 that a ticket 1500 with a barcode is inserted into the bill validator 1022, the main CPU 1041 determines whether or not the ticket 1500 with a barcode that has been inserted into the bill validator 1022 is a ticket 1500 with a barcode for participating in the next tournament-type game (step s1042). In the second embodiment, a tournament-type game is executed every two hours. Therefore, in the processing of step s1042, the main CPU 1041 determines whether or not the start time of the tournament-type game that the main CPU 1041 has read from the ticket 1500 with a barcode inserted into the bill validator 1022 is within two hours from the time shown by the clock 1062.

When determining in step s1042 that the ticket 1500 with a barcode inserted into the bill validator 1022 is not a ticket 1500 with a barcode for participating in the next tournament-type game, the main CPU 1041 ends the present subroutine.

When determining in step s1042 that the ticket 1500 with a barcode inserted into the bill validator 1022 is a ticket 1500 with a barcode for participating in the next tournament-type game, the main CPU 1041 sets the tournament-type game flag (step s1043).

Next, the main CPU 1041 reads the player name from the ticket 1500 with a barcode inserted into the bill validator 1022, and stores the read player name into the RAM 1043 (step s1044).

After executing the processing of step s1044, the main CPU 1041 ends the present subroutine.

Figure 50:
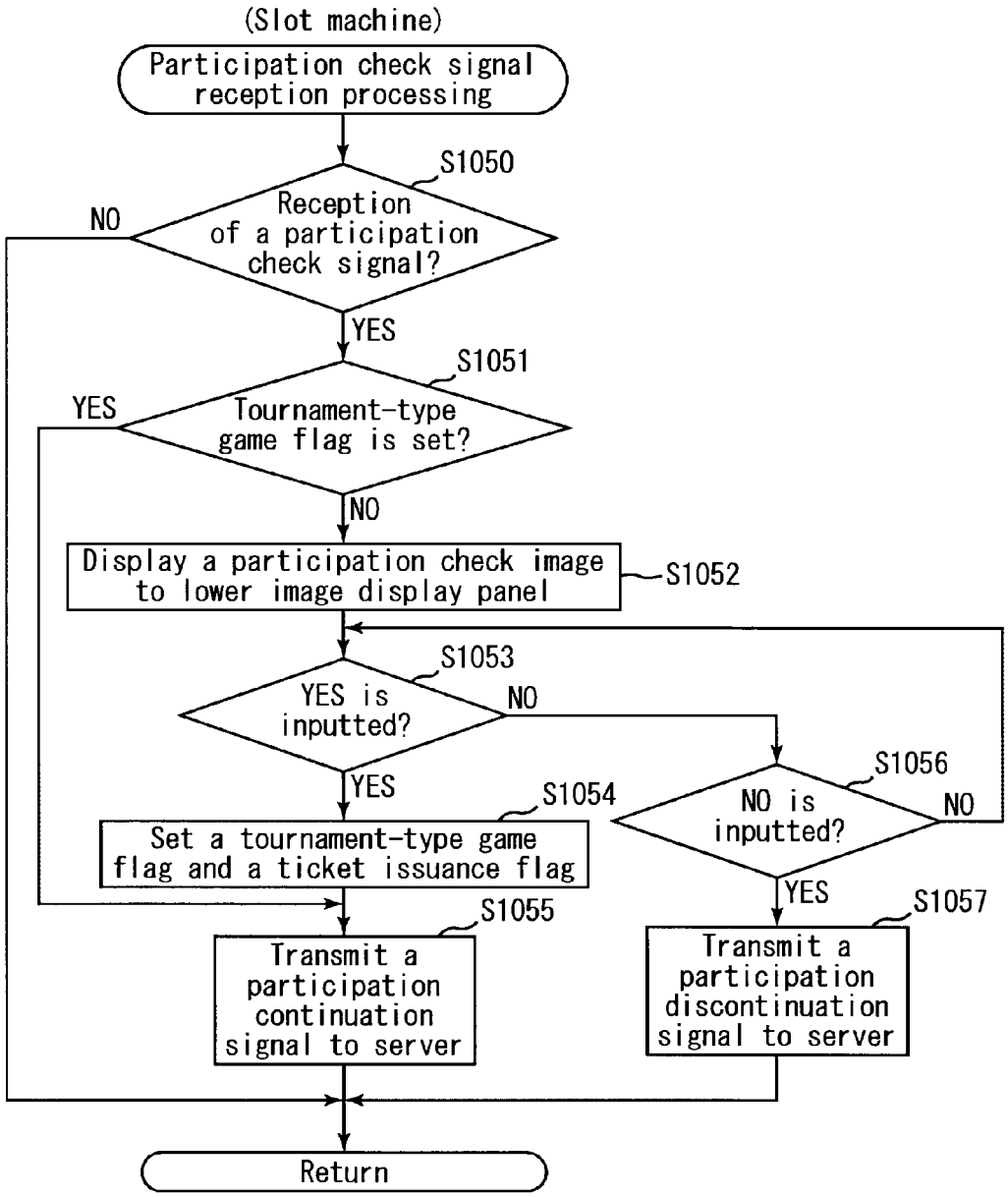
FIG. 50 is a flowchart illustrating a subroutine of participation check signal reception processing.

FIG. 50 is a flowchart illustrating a subroutine of the participation check signal reception processing.

First, the main CPU 1041 determines whether or not the main CPU 1041 has received the participation check signal from the server 1200 (step s1050). When the main CPU 1041 determines that the main CPU 1041 has not received the participation check signal, the main CPU 1041 ends the present subroutine.

On the other hand, when the main CPU 1041 determines in step s1050 that the main CPU 1041 has received the participation check signal, the main CPU 1041 determines whether or not the tournament-type game flag is set (step s1051). When determining that the tournament-type game flag is set, the main CPU 1041 shifts the processing to step s1055.

On the other hand, when determining in step s1051 that the tournament-type game flag is not set, the main CPU 1041 displays a participation check image to the lower image display panel 1016 (step s1052).

Figure 51:
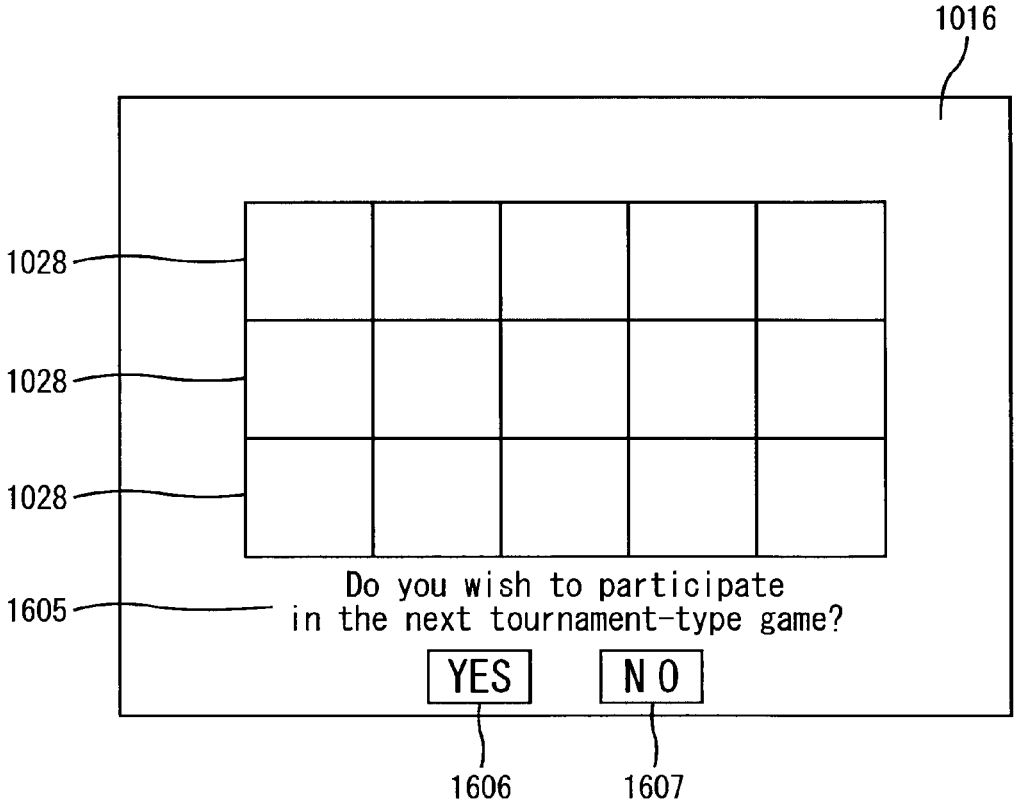
FIG. 51 is a view illustrating an exemplary image displayed to a lower image display panel provided in each slot machine constituting the gaming system according to the second embodiment of the present invention.

FIG. 51 is a view illustrating an exemplary image that is displayed to the lower image display panel provided in each slot machine constituting the gaming system according to the second embodiment of the present invention.

In FIG. 51, a participation check image 1605 is displayed below the display blocks 1028 that are displayed to the lower image display panel 1016. Below the participation check image 1605, a YES image 1606 and a NO image 1607 are displayed.

The participation check image 1605 is an image that asks a player whether or not the player wishes to participate in the next tournament-type game. If the player wishes to participate in the next tournament-type game, the player can input "YES" via the touch panel 1069 by touching the portion where the YES image 1606 is displayed, with the finger or the like. On the other hand, if the player wishes not to participate in the next tournament-type game, the player can input "NO" via the touch panel 1069 by touching the portion where the NO image 1607 is displayed, with the finger or the like.

Referring back to FIG. 50, the main CPU 1041 determines whether or not "YES" has been inputted (step s1053). When determining that "YES" has been inputted, the main CPU 1041 sets the tournament-type game flag and a ticket issuance flag (step s1054).

When determining in step s1051 that the tournament-type game flag is set, or when executing the processing of step s1054, the main CPU 1041 transmits a participation continuation signal to the server 1200 (step s1055).

On the other hand, when determining in step s1053 that "YES" has not been inputted, the main CPU 1041 determines whether or not "NO" has been inputted (step s1056). When determining that "NO" has not been inputted, the main CPU 1041 returns the processing to step s1053.

On the other hand, when determining in step s1056 that "NO" has been inputted, the main CPU 1041 transmits a participation discontinuation signal to the server 1200 (step s1057).

When determining in step s1050 that the main CPU 1041 has not received the participation check signal or when executing the processing of step s1055 or step s1057, the main CPU 1041 ends the present subroutine.

Figure 52:
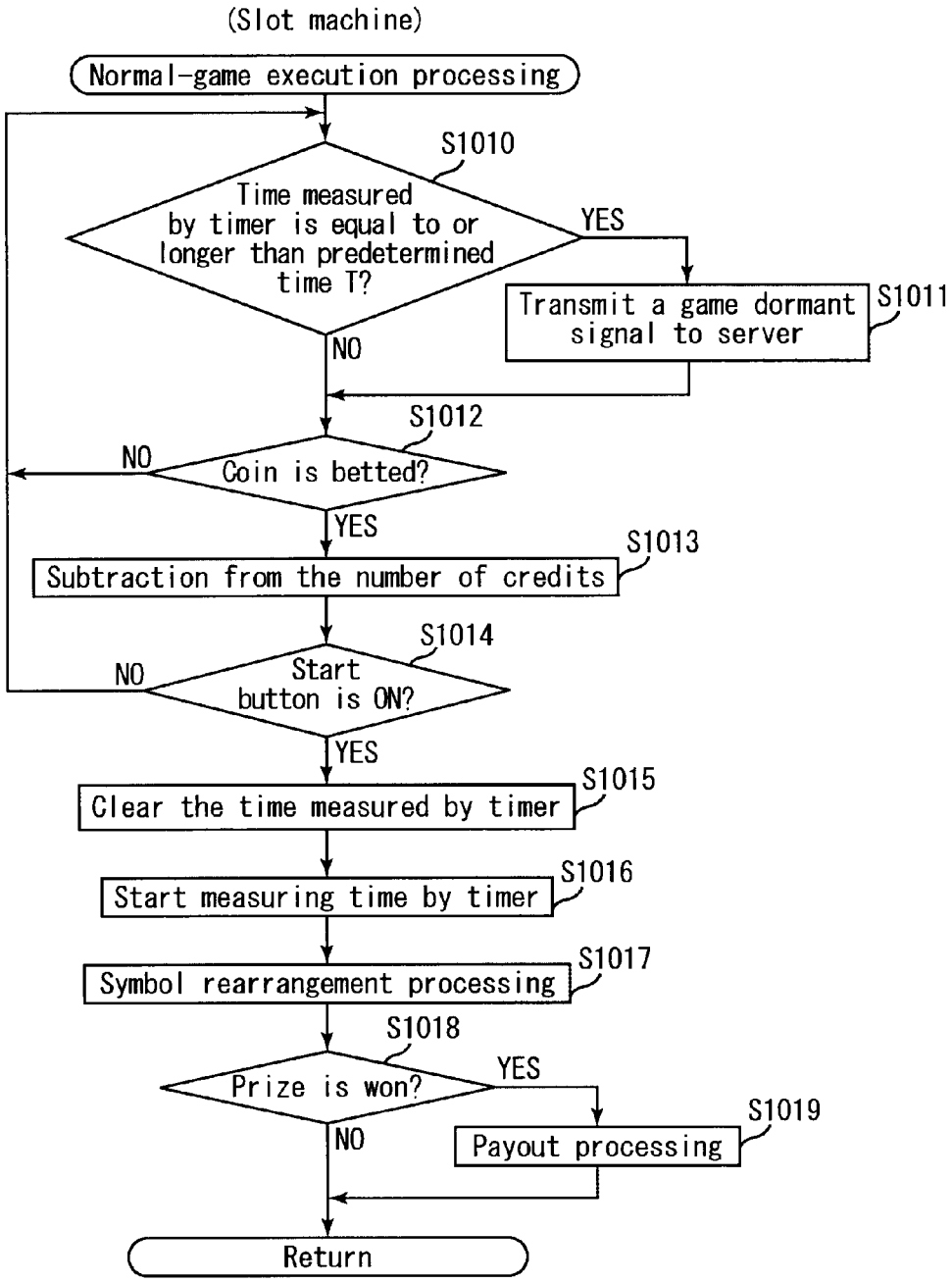
FIG. 52 is a flowchart illustrating a subroutine of normal-game execution processing.

FIG. 52 is a flowchart illustrating a subroutine of normal-game execution processing.

FIG. 53 is a view illustrating correspondence relationship between a type and the number of rearranged symbols and an amount of payout.

First, the main CPU 1041 determines whether or not the time measured with the timer 1061 is equal to or longer than predetermined time T (step s1010).

When determining in step s1010 that the measured time is not equal to or longer than the predetermined time T, the main CPU 1041 shifts the processing to step s1012. On the other hand, when determining in step s1010 that the measured time is equal to or longer than the predetermined time T, the main CPU 1041 transmits a game dormant signal to the server 1200 (step s1011). The game dormant signal includes the identification number of the slot machine 1010.

The main CPU 1041 determines whether or not a coin has been betted (step s1012). In this processing, the main CPU 1041 determines whether or not the main CPU 1041 has received an input signal that is outputted from the 1-BET switch 1026S when the 1-BET button 1026 is operated, or an input signal that is outputted from the maximum BET switch 1027S when the maximum BET button 1027 is operated. When determining that a coin has not been betted, the main CPU 1041 returns the processing to step s1010.

On the other hand, when determining in step s1012 that a coin has been betted, the main CPU 1041 executes processing for making a subtraction from the number of credits stored in the RAM 1043 according to the number of betted coins (step s1013). It is to be noted that, when the number of coins to be betted is larger than the number of credits stored in the RAM 1043, the main CPU 1041 does not execute the processing for making a subtraction from the number of credits stored in the RAM 1043, and returns the processing to step s1010. Further, when the number of coins to be betted exceeds the upper limit of the number of coins that can be betted in one game (50 coins in the second embodiment), the main CPU 1041 does not execute the processing for making a subtraction from the number of credits stored in the RAM 1043, and proceeds with the processing to step s1014.

Next, the main CPU 1041 determines whether or not the start button 1023 has been turned ON (step s1014). In this processing, the main CPU 1041 determines whether or not the main CPU 1041 has received an input signal that is outputted from the start switch 1023S when the start button 1023 is pressed.

When the main CPU 1041 determines that the start button 1023 has not been turned ON, the main CPU 1041 returns the processing to step s1010.

It is to be noted that, when the start button 1023 is not turned ON (e.g. when the start button 1023 is not turned ON and a command to end the game is inputted), the main CPU 1041 cancels the subtraction result in step s1013.

On the other hand, when determining in step s1014 that the start button 1023 is turned ON, the main CPU 1041 clears the time measured with the timer 1061 (step s1015) and starts measurement of the time with the timer 1061 (step s1016).

Next, the main CPU 1041 executes symbol rearrangement processing (step s1017).

In this processing, the main CPU 1041 first starts scroll-display of symbols in the display blocks 1028. Then, the main CPU 1041 executes the aforementioned symbol determination program, so as to determine the symbols to be rearranged, and then rearranges the symbols in the display blocks 1028.

Next, the main CPU 1041 determines whether or not a prize has been won (step s1018). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 1028 (see FIG. 53). In this processing, the main CPU 1041 counts the number of symbols for each type of the symbols rearranged in step s1017. Then, the main CPU 1041 determines whether or not the counted number is three or more.

When determining that a prize has been won, the main CPU 1041 executes processing relating to payout of coins (step s1019). In the processing, the main CPU 1041 determines the amount of payout based on the numbers of rearranged symbols with reference to the odds data stored in the RAM 1043. The odds data is data indicative of the correspondence relationship between the number of symbols rearranged in the display blocks 1028 and the amount of payout (see FIG. 53).

For example, in the case where three symbols of "SUN" are rearranged after two coins have been betted, 20 (=2×10) coins are paid out.

In the case of accumulating coins, the main CPU 1041 conducts processing for adding the number of credits corresponding to the determined amount of payout to the number of credits stored in the RAM 1043. On the other hand, in the case of paying out coins, the main CPU 1041 transmits a control signal to the hopper 1066 in order to pay out coins in an amount corresponding to the determined amount of payout.

When determining in step s1018 that no prize has been won or after executing the processing of step s1019, the main CPU 1041 ends the present subroutine.

Figure 54A:
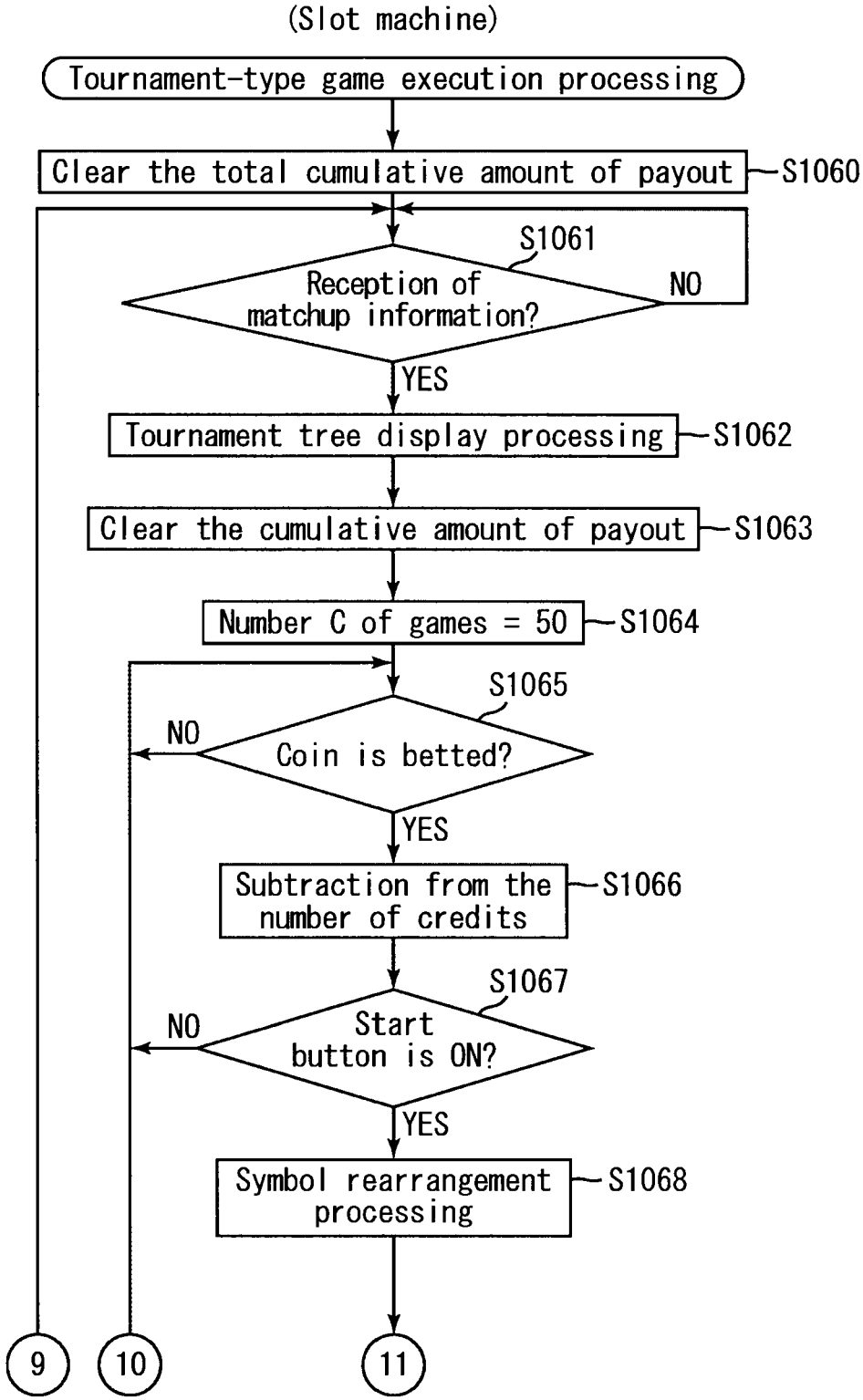
FIG. 54A is a flowchart illustrating a subroutine of tournament-type game execution processing.

FIG. 54A is a flowchart illustrating a subroutine of the tournament-type game execution processing.

Figure 54B:
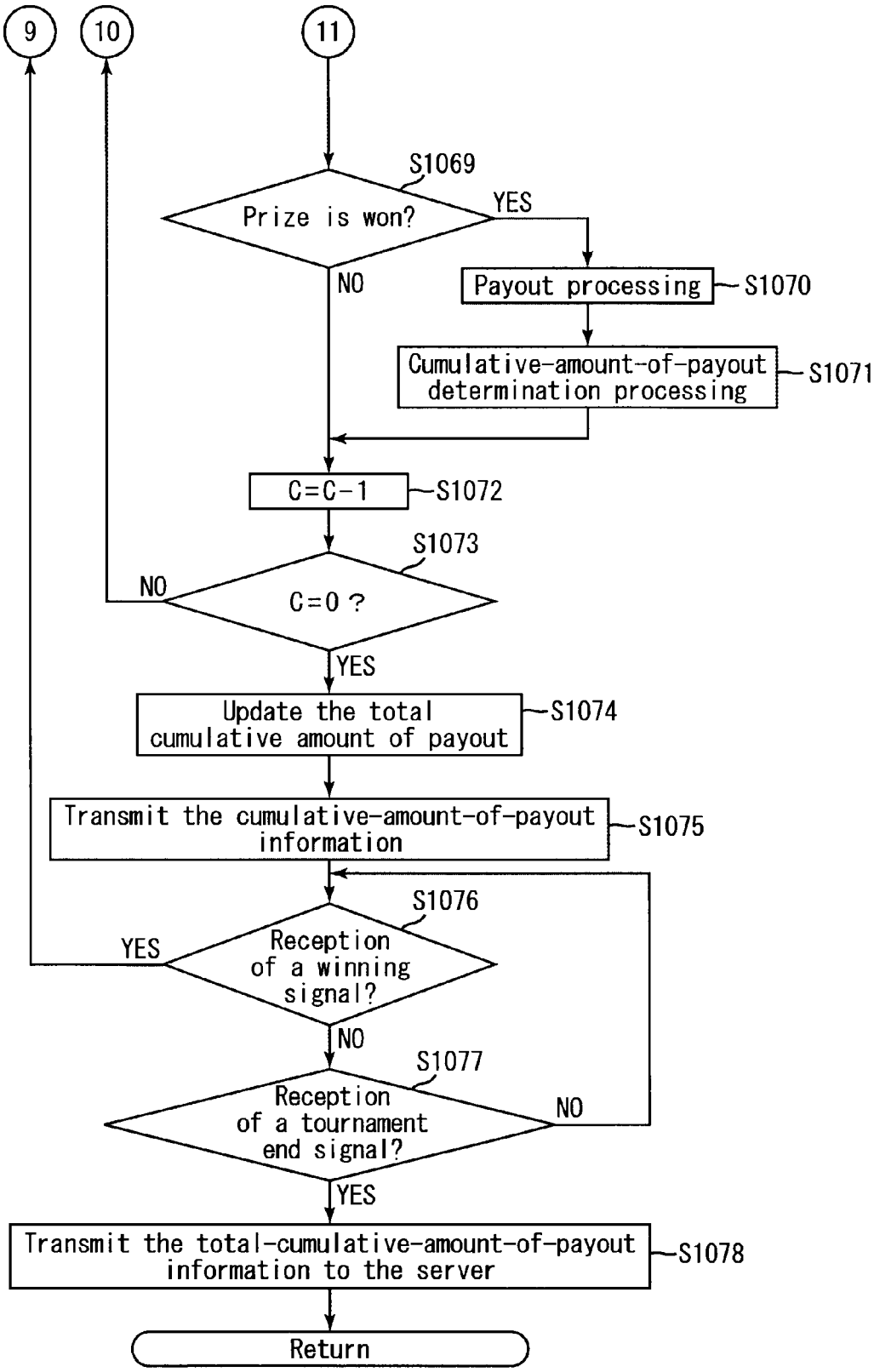
FIG. 54B is another flowchart illustrating the subroutine of the tournament-type game execution processing.

FIG. 54B is another flowchart illustrating the subroutine of the tournament-type game execution processing.

First, the main CPU 1041 stores 0 into the RAM 1043 as an updated total cumulative amount of payout (step s1060).

The main CPU 1041 determines whether or not the main CPU 1041 has received matchup information from the server 1200 (step s1061). When the main CPU 1041 determines that the main CPU 1041 has not received matchup information, the main CPU 1041 returns the processing to step s1061.

On the other hand, when the main CPU 1041 determines in step s1061 that the main CPU 1041 has received matchup information, the main CPU 1041 executes tournament-tree display processing (step s1062). In the processing, the main CPU 1041 displays a tournament tree image to the upper image display panel 1033, based on the received matchup information.

Figure 55:
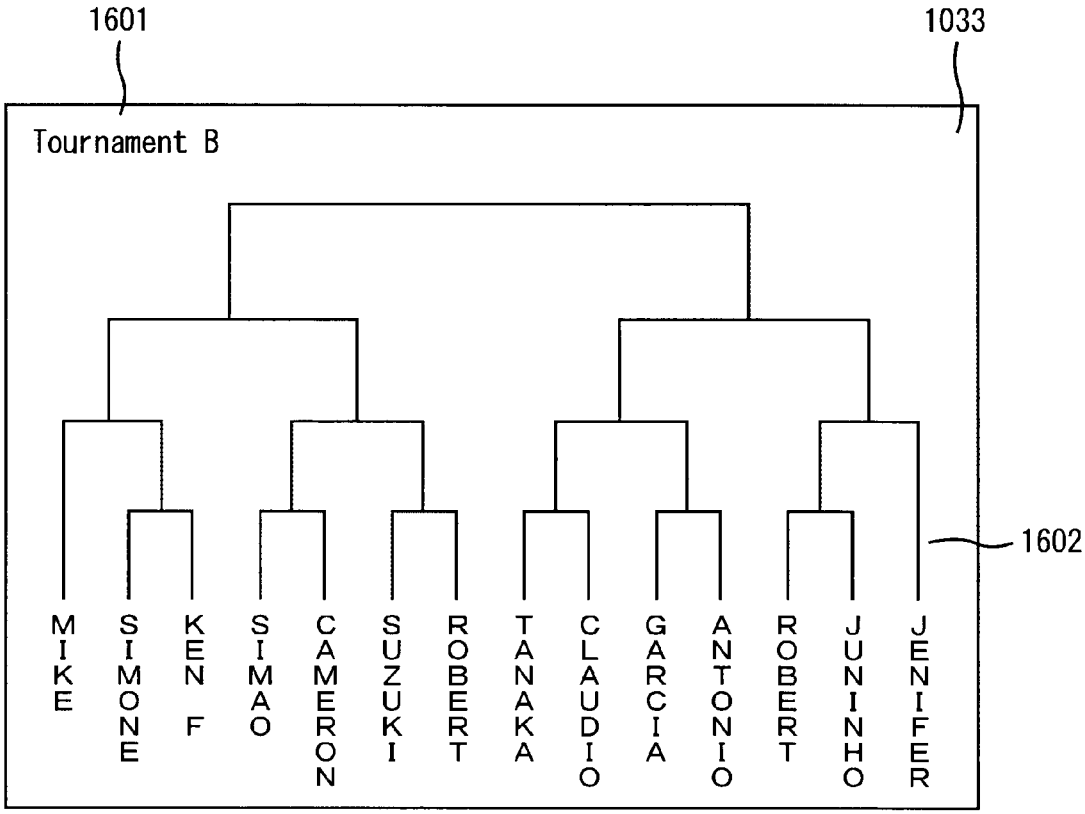
FIG. 55 is a view illustrating an exemplary image that is displayed to an upper image display panel provided in each slot machine constituting the gaming system according to the second embodiment of the present invention.

FIG. 55 is a view illustrating an exemplary image displayed to the upper image display panel that is provided in each slot machine constituting the gaming system according to the second embodiment of the present invention.

In FIG. 55, the upper image display panel 1033 displays a tournament tree image 1602. To the lower part of the tournament tree image 1602, the player names of the players participating in the tournament-type game are displayed. Looking at the tournament tree image 1602, each player gets to know the player name of the player against whom he or she is going to have a match. A tournament name image 1601 shows the name of the tournament.

In the second embodiment, the number of tournaments in a tournament-type game changes within the range of 1 to 3 in accordance with the number S of participants. The name of the first tournament is Tournament A. The name of the second tournament is Tournament B. The name of the third tournament is Tournament C.

In FIG. 55, the tournament name image 1601 says Tournament B. That is, the tournament name image 1601 indicates that this tournament is the second tournament in the tournament-type game.

Referring back to FIG. 54A, the main CPU 1041 stores 0 into the RAM 1043 as an updated cumulative amount of payout (step s1063).

The main CPU 1041 stores 50 into the RAM 1043 as an updated number C of games (step s1064).

The main CPU 1041 determines whether or not a coin has been betted (step s1065). In the processing, the main CPU 1041 determines whether or not the main CPU 1041 has received an input signal outputted from the 1-BET switch 1026S when the 1-BET button 1026 is operated or an input signal outputted from the maximum BET switch 1027S when the maximum BET button 1027 is operated. When determining that a coin has not been betted, the main CPU 1041 returns the processing to step s1065.

On the other hand, when determining in step s1065 that a coin has been betted, the main CPU 1041 conducts processing of making a subtraction from the number of credits stored in the RAM 1043 in accordance with the number of the betted coins (step s1066). Here, in the case that the number of betted coins is larger than the number of credits stored in the RAM 1043, the main CPU 1041 returns the processing to step s1065 without executing the processing of making a subtraction from the number of credits stored in the RAM 1043. Further, in the case that the number of betted coins exceeds the upper limit value that can be betted in a single game (50 coins, in the second embodiment), the main CPU 1041 proceeds with the processing to step s1067 without conducting the processing of making a subtraction from the number of credits stored in the RAM 1043.

Next, the main CPU 1041 determines whether or not the start button 1023 has been turned ON (step s1067). In the processing, the main CPU 1041 determines whether or not the main CPU 1041 has received an input signal that is outputted from the start switch 1023S when the start button 1023 is pressed.

When determining that the start button 1023 has not been turned ON, the main CPU 1041 returns the processing to step s1065.

Here, in the case that the start button 1023 is not turned ON (e.g. when the start button 1023 is not turned ON and a command to end the game is inputted), the main CPU 1041 cancels the subtraction result in step s1066.

On the other hand, when determining in step s1067 that the start button 1023 has been turned ON, the main CPU 1041 executes symbol rearrangement processing (step s1068).

In this processing, the main CPU 1041 first starts scroll-display of symbols in the display blocks 1028. Then, the main CPU 1041 executes the aforementioned symbol determination program, so as to determine the symbols to be rearranged, and then rearranges the symbols in the display blocks 1028.

Next, the main CPU 1041 determines whether or not a prize has been won (step s1069). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 1028 (see FIG. 53). In this processing, the main CPU 1041 counts the number of symbols for each type of the symbols rearranged in step s1068. Then, the main CPU 1041 determines whether or not the counted number is three or more.

When determining that a prize has been won, the main CPU 1041 executes processing relating to payout of coins (step s1070). In the processing, the main CPU 1041 determines the amount of payout based on the numbers of rearranged symbols with reference to the odds data stored in the RAM 1043. The odds data is data indicative of the correspondence relationship between the number of symbols rearranged in the display blocks 1028 and the amount of payout (see FIG. 53).

In the case of accumulating coins, the main CPU 1041 conducts processing for adding the number of credits corresponding to the determined amount of payout to the number of credits stored in the RAM 1043. On the other hand, in the case of paying out coins, the main CPU 1041 transmits a control signal to the hopper 1066 in order to pay out coins in an amount corresponding to the determined amount of payout.

The main CPU 1041 executes cumulative-amount-of-payout determination processing (step s1071). In the processing, the main CPU 1041 stores into the RAM 1043 a numeric value obtained by adding the amount of payout determined in step s1070 to the cumulative amount of payout stored in the RAM 1043, as an updated cumulative amount of payout.

When determining in step s1069 that no prize has been won, or when executing the processing of step s1071, the main CPU 1041 stores into the RAM 1043 a numeric value obtained by subtracting 1 from the number C of games stored in the RAM 1043, as an updated number C of games (step s1072).

The main CPU 1041 determines whether or not the number C of games stored in the RAM 1043 has reached 0 (step s1073). When determining that the number C of games has not reached 0, the main CPU 1041 returns the processing to step s1065.

On the other hand, when determining that the number C of games has reached 0, the main CPU 1041 updates the total cumulative amount of payout (step s1074). In the processing, the main CPU 1041 stores into the RAM 1043 a numeric value obtained by adding the cumulative amount of payout stored in the RAM 1043 to the total cumulative amount of payout stored in the RAM 1043, as an updated total cumulative amount of payout.

The main CPU 1041 transmits cumulative-amount-of-payout information to the server 1200 (step s1075). The cumulative-amount-of-payout information includes the identification number of the slot machine 1010.

The main CPU 1041 determines whether or not the main CPU 1041 has received the winning signal from the server 1200 (step s1076). When the main CPU 1041 determines that the main CPU 1041 has received the winning signal, the main CPU 1041 returns the processing to step s1061.

On the other hand, when the main CPU 1041 determines in step s1076 that the main CPU 1041 has not received the winning signal, the main CPU 1041 determines whether or not the main CPU 1041 has received the tournament end signal from the server 1200 (step s1077). When the main CPU 1041 determines that the main CPU 1041 has not received the tournament end signal, the main CPU 1041 returns the processing to step s1076.

On the other hand, when the main CPU 1041 determines in step s1077 that the main CPU 1041 has received the tournament end signal, the main CPU 1041 transmits total-cumulative-amount-of-payout information indicative of the total cumulative amount of payout, which is stored in the RAM 1043, to the server 1200 (step s1078). The total-cumulative-amount-of-payout information includes the identification number of the slot machine 1010 and the player name stored in the RAM 1043.

It should be noted that, when no player name is stored in the RAM 1043, the main CPU 1041 displays alphabets to the lower image display panel and accepts input of the player name via the touch panel 1069.

After executing the processing of step s1078, the main CPU 1041 ends the present subroutine.

Figure 56A:
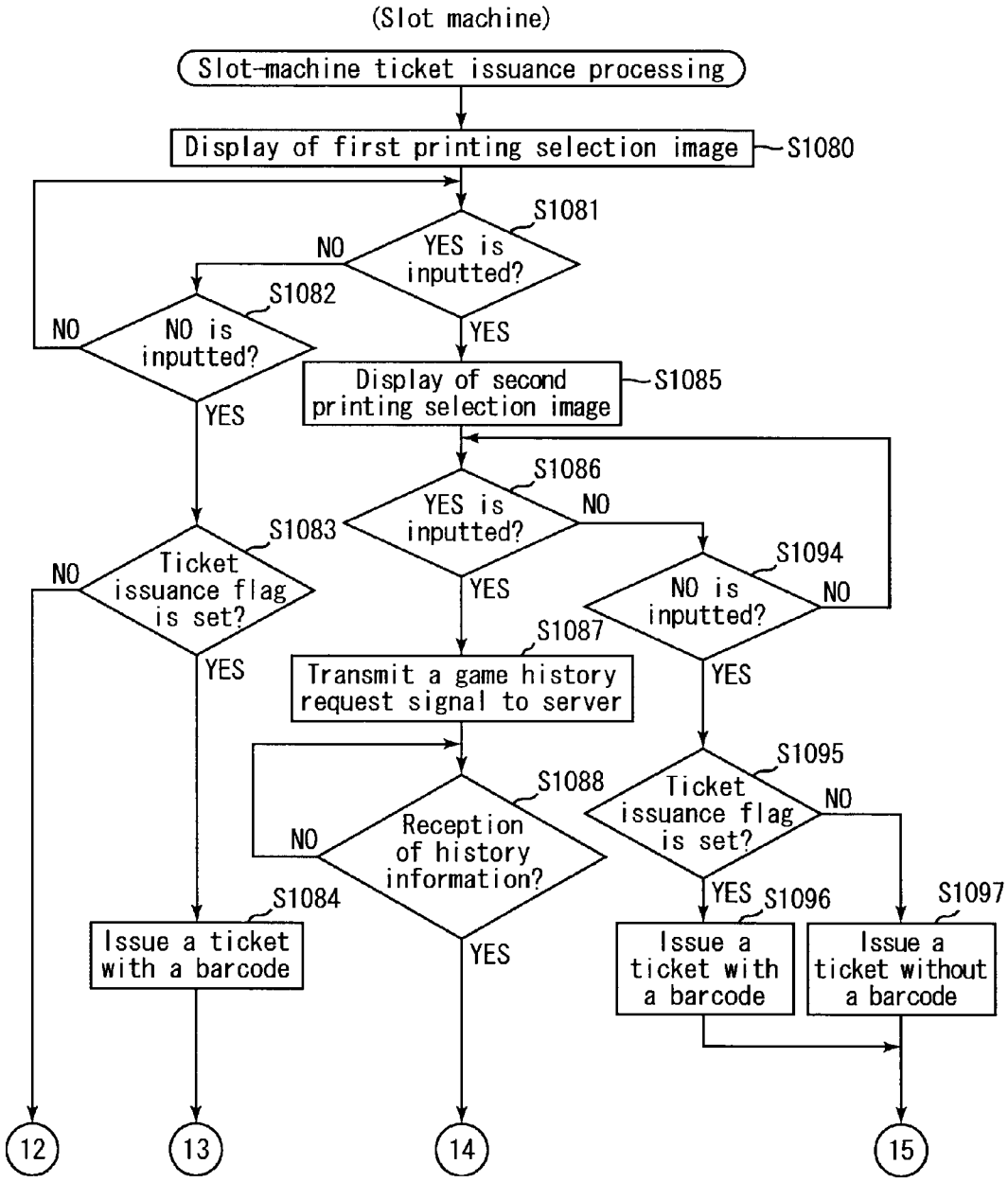
FIG. 56A is a flowchart illustrating a subroutine of slot-machine ticket issuance processing.

FIG. 56A is a flowchart illustrating a subroutine of the slot-machine ticket issuance processing.

Figure 56B:
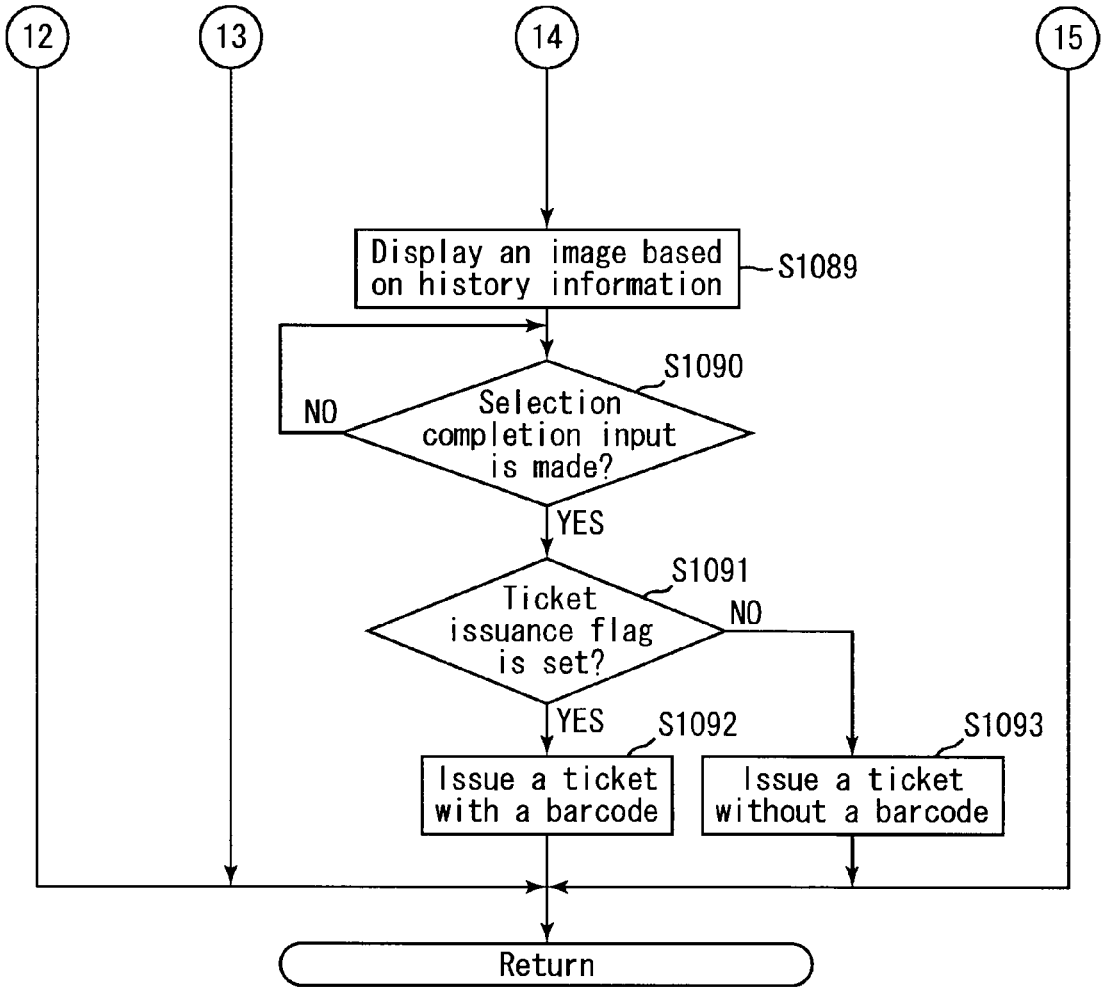
FIG. 56B is another flowchart illustrating the subroutine of the slot-machine ticket issuance processing.

FIG. 56B is another flowchart illustrating the subroutine of the slot-machine ticket issuance processing.

FIGS. 28A to 28C are views each illustrating an exemplary image displayed to the lower image display panel that is provided in the slot machine constituting the gaming system according to the second embodiment of the present invention.

FIGS. 29A to 29C are views each illustrating an exemplary ticket with a barcode that is issued from the ticket issuing device of the second embodiment.

The main CPU 1041 displays a first printing selection image to the lower image display panel 1016 (see FIG. 57A) (step s1080).

Figure 57A:
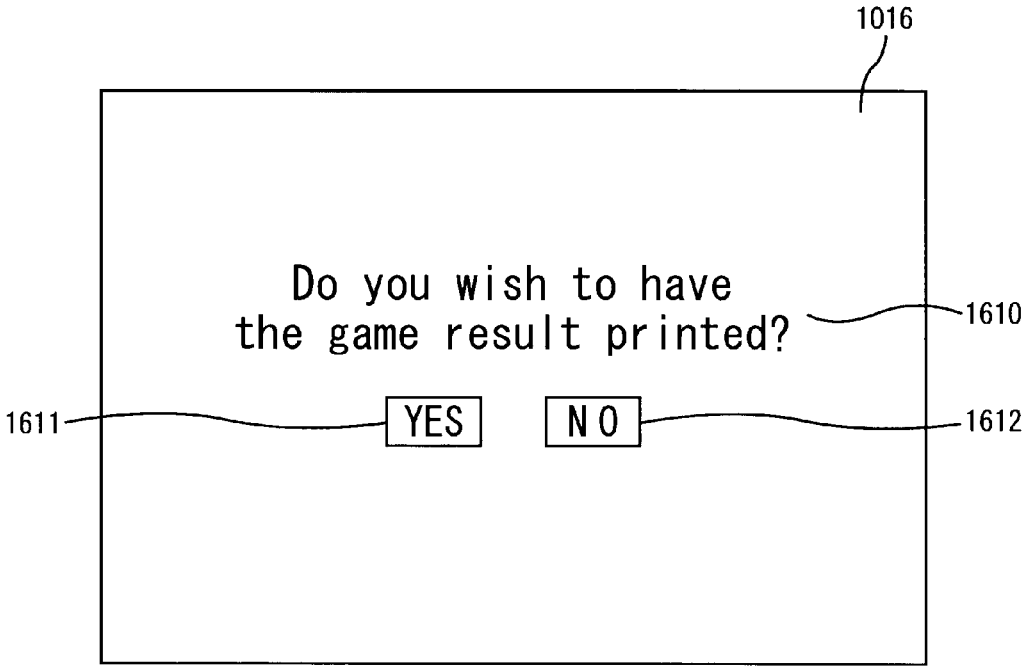
FIG. 57A is a view illustrating an exemplary image that is displayed to the lower image display panel provided in each slot machine constituting the gaming system according to the second embodiment of the present invention.

In FIG. 57A, a first printing selection image 1610 is displayed near the center of the lower image display panel 1016. The first printing selection image 1610 is an image that asks the player whether or not the player wishes to have the game result of the tournament-type game printed. Below the first printing selection image 1610, a YES image 1611 and a NO image 1612 are displayed.

If the player wishes to have the game result of the tournament-type game printed, the player can input "YES" via the touch panel 1069 by touching the portion where the YES image 1611 is displayed, with the finger or the like. On the other hand, if the player does not wish to have the game result of the tournament-type game printed, the player can input "NO" via the touch panel 1069 by touching the portion where the NO image 1612 is displayed, with the finger or the like.

Referring back to FIG. 56A, the main CPU 1041 determines whether or not "YES" has been inputted (step s1081). When determining that "YES" has not been inputted, the main CPU 1041 determines whether or not "NO" has been inputted (step s1082). When determining that "NO" has not been inputted, the main CPU 1041 returns the processing to step s1081.

On the other hand, when determining in step s1082 that "NO" has been inputted, the main CPU 1041 determines whether or not the ticket issuance flag is set (step s1083). When determining that the ticket issuance flag is not set, the main CPU 1041 ends the present subroutine.

On the other hand, when determining in step s1083 that the ticket issuance flag is set, the main CPU 1041 issues a ticket 1500 with a barcode from the ticket printer 1035 (see FIG. 58A) (step s1084). In the processing, the main CPU 1041 prints on a ticket a barcode that represents encoded data of the player name and the like; the player name stored in the RAM 1043; and text that indicates that the ticket is used for participation in a tournament-type game. Then, the main CPU 1041 issues the ticket as a ticket 1500 with a barcode.

Figure 58A:
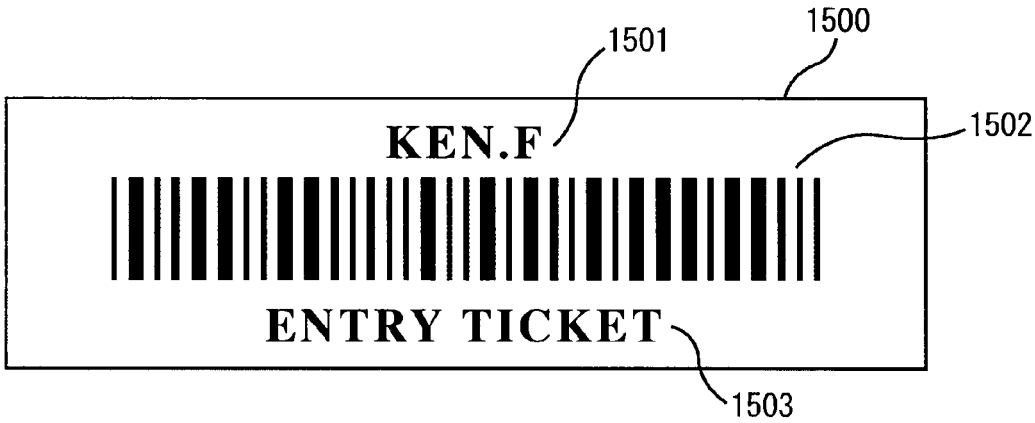
FIG. 58A is a view illustrating an exemplary ticket with a barcode issued from a ticket issuing device of the second embodiment.

In FIG. 58A, the player name 1501 is printed on the upper portion of the ticket 1500 with a barcode.

At the central portion of the ticket 1500 with a barcode, the barcode 1502 is printed which represents encoded data of the player name and the tournament-type game start time.

At the lower portion of the ticket 1500 with a barcode, the text 1503 is printed which indicates that the ticket is used for participation in a tournament-type game.

Referring back to FIG. 56A, when the main CPU 1041 determines in step s1081 that "YES" has been inputted, the main CPU 1041 displays a second printing selection image to the lower image display panel 1016 (see FIG. 57B) (step s1085).

Figure 57B:
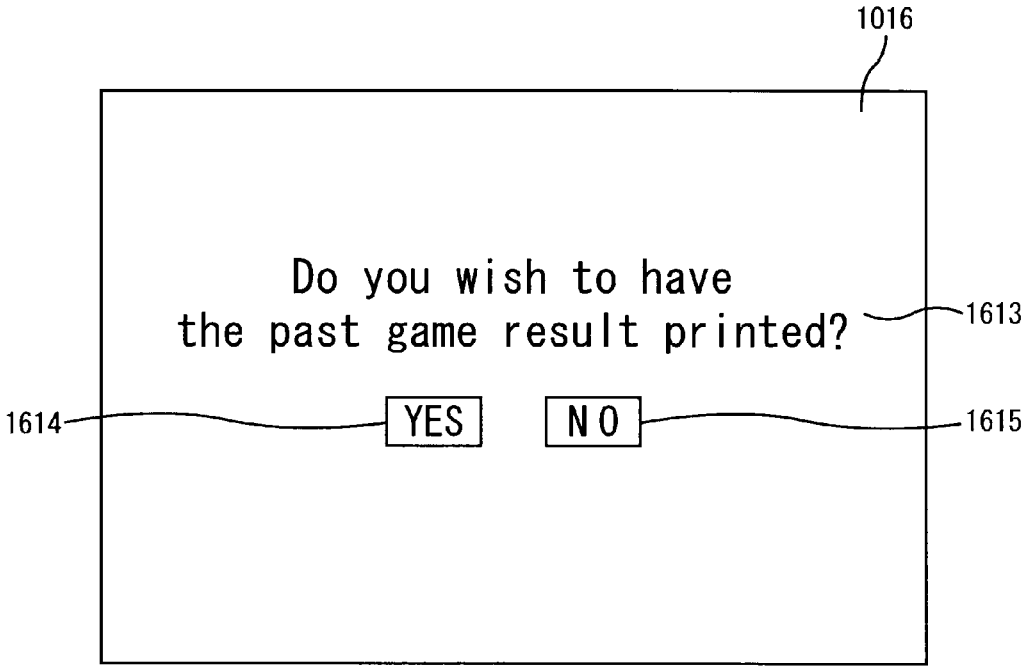
FIG. 57B is a view illustrating another exemplary image that is displayed to the lower image display panel provided in each slot machine constituting the gaming system according to the second embodiment of the present invention.

In FIG. 57B, a second printing selection image 1613 is displayed near the center of the lower image display panel 1016. The second printing selection image 1613 is an image that asks the player whether or not the player wishes to have the past game result of the tournament-type game printed. Below the second printing selection image 1613, a YES image 1614 and a NO image 1615 are displayed.

If the player wishes to have the past game result of the tournament-type game printed, the player can input "YES" via the touch panel 1069 by touching the portion where the YES image 1614 is displayed, with the finger or the like. On the other hand, if the player does not wish to have the past game result of the tournament-type game printed, the player can input "NO" via the touch panel 1069 by touching the portion where the NO image 1615 is displayed, with the finger or the like.

Referring back to FIG. 56A, the main CPU 1041 determines whether or not "YES" has been inputted (step s1086). When determining that "YES" has been inputted, the main CPU 1041 transmits a game-history request signal to the server 1200 (step s1087). The game-history request signal includes the player name that is stored in the RAM 1043.

The main CPU 1041 determines whether or not the main CPU 1041 has received history information from the server 1200 (step s1088). When the main CPU 1041 determines that the main CPU 1041 has not received history information, the main CPU 1041 returns the processing to step s1088.

On the other hand, when the main CPU 1041 determines in step s1088 that the main CPU 1041 has received history information, the main CPU 1041 displays an image based on the received history information to the lower image display panel 1016 (see FIG. 57C) (step s1089).

Figure 57C:
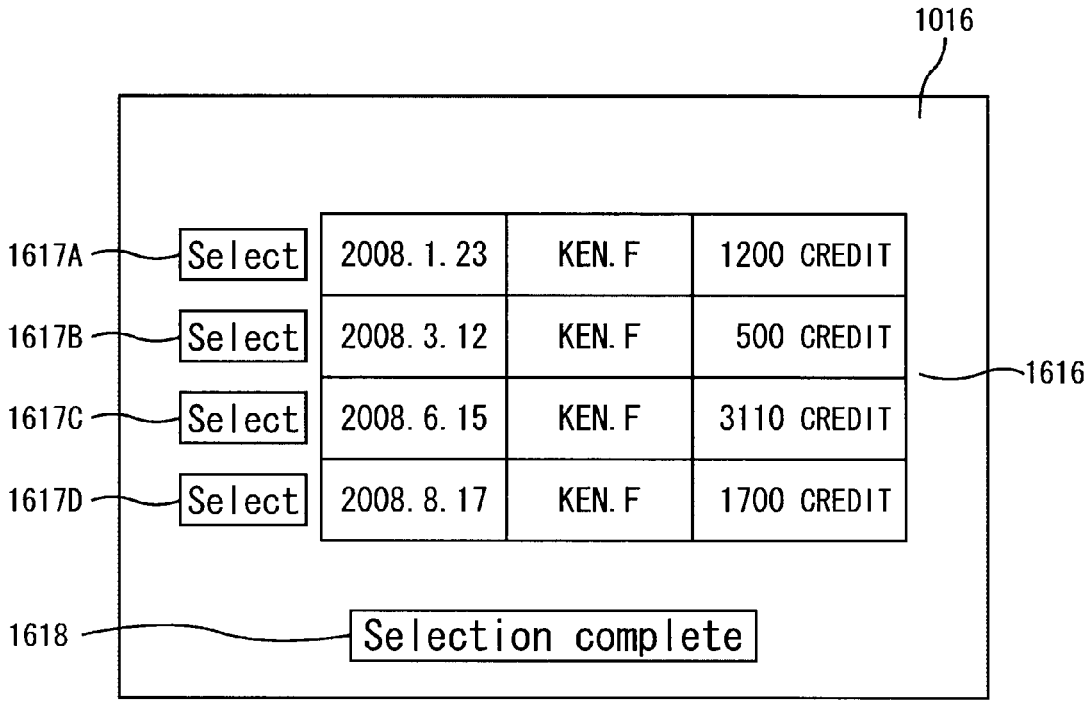
FIG. 57C is a view illustrating a yet another exemplary image that is displayed to the lower image display panel provided in each slot machine constituting the gaming system according to the second embodiment of the present invention.

In FIG. 57C, a history information image 1616 based on the received history information is displayed near the center of the lower image display panel 1016. The history information image 1616 is an image that shows the past game history that is associated with the same player name as the player name of the player who is playing a game on the slot machine 1010. The history information image 1616 shows the date on which the game has been played; the player name; and the number of obtained coins.

The date on which the game has been played, the player name, and the number of acquired coins correspond to the game history in the present invention.

On the left side of the history information image 1616, selection images 1617 (selection image 1617A, selection image 1617B, selection image 1617C, selection image 1617D) are displayed which correspond to respective game histories that are shown by the history information image 1616. For example, the selection image 1617A is a selection image 1617 that corresponds to the game history of Jan. 23, 2008. If the player wishes to have the game history of Jan. 23, 2008 printed, the player can input "selection image 1617A" via the touch panel 1069 by touching the portion where the selection image 1617A is displayed, with the finger or the like.

Below the history information image 1616, a selection completion image 1618 is displayed. The player can input completion of selection via the touch panel 1069 by touching the portion where the selection completion image 1618 is displayed, with the finger or the like, after inputting a single or plurality of selection images 1617.

Referring back to FIG. 56B, the main CPU 1041 determines whether or not completion of selection has been inputted (step s1090). When determining that completion of selection has not been inputted, the main CPU 1041 returns the processing to step s1090.

On the other hand, when determining in step s1090 that completion of selection has been inputted, the main CPU 1041 determines whether or not the ticket issuance flag is set (step s1091). When determining that the ticket issuance flag is set, the main CPU 1041 issues a ticket 1500 with a barcode from the ticket printer 1035 (see FIG. 58C) (step s1092).

In the processing, the main CPU 1041 prints on a ticket a barcode that represents encoded data of the next tournament-type game start time, the player name stored in the RAM 1043, and the like; the player name stored in the RAM 1043; the number of coins obtained by the player in the tournament-type game that the player has participated this time; and the past game history selected by the player. Then, the main CPU 1041 issues the ticket as a ticket 1500 with a barcode.

Figure 58B:
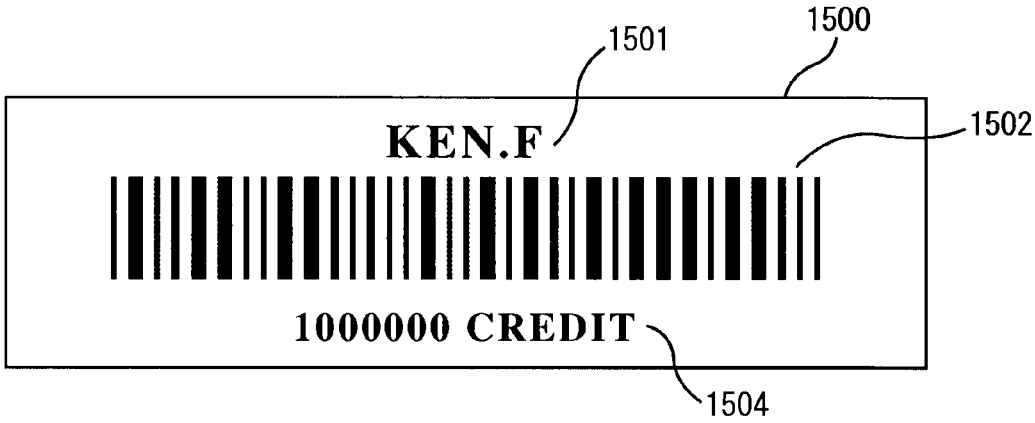
FIG. 58B is a view illustrating another exemplary ticket with a barcode issued from a ticket issuing device of the second embodiment.
Figure 58C:
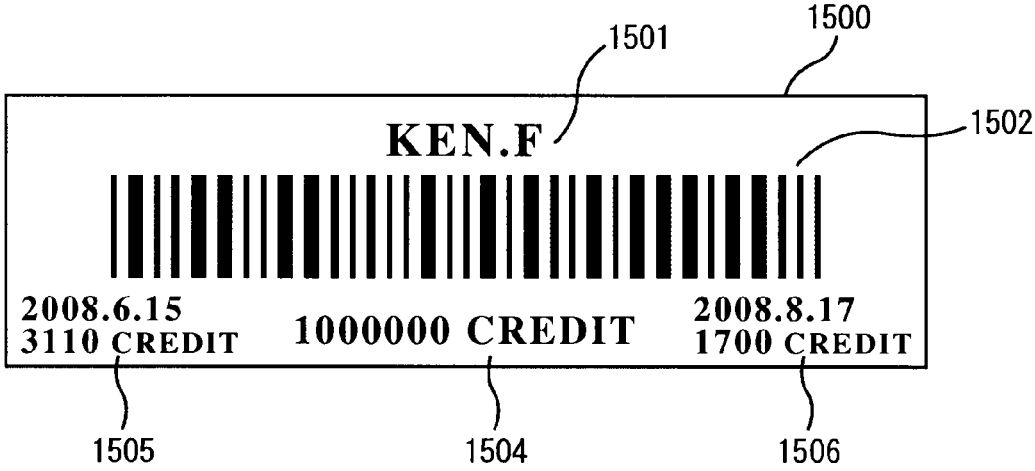
FIG. 58C is a view illustrating yet another exemplary ticket with a barcode issued from a ticket issuing device of the second embodiment.

In FIG. 58C, the player name 1501 is printed on the upper portion of the ticket 1500 with a barcode.

At the central portion of the ticket 1500 with a barcode, the barcode 1502 is printed which represents encoded data of the player name and the tournament-type game start time.

At the lower portion at the center of the ticket 1500 with a barcode, text 1504 is printed which shows the number of coins that are obtained by the player in the tournament-type game that the player has participated this time.

At the lower portion on the left side of the ticket 1500 with a barcode, text 505 is printed which indicates that the game history is of Jun. 15, 2008.

At the lower portion on the right side of the ticket 1500 with a barcode, text 1506 is printed which indicates the game history of Aug. 17, 2008.

Referring back to FIG. 56B, when the main CPU 1041 determines in step s1091 that the ticket issuance flag is not set, the main CPU 1041 issues a ticket without a barcode from the ticket printer 1035 (step s1093).

In the processing, the main CPU 1041 prints on a ticket the player name stored in the RAM 1043; the number of coins obtained by the player in the tournament-type game that the player has participated this time; and the past game history selected by the player. Then, the main CPU 1041 issues the ticket as a ticket without a barcode.

Referring back to FIG. 56A, the main CPU 1041 determines in step s1086 that "YES" has not been inputted, the main CPU 1041 determines whether or not "NO" has been inputted (step s1094). When determining that "NO" has not been inputted, the main CPU 1041 returns the processing to step s1086.

On the other hand, when determining in step s1094 that "NO" has been inputted, the main CPU 1041 determines whether or not the ticket issuance flag is set (step s1095). When determining that the ticket issuance flag is set, the main CPU 1041 issues a ticket 1500 with a barcode from the ticket printer 1035 (see FIG. 58B) (step s1096).

In the processing, the main CPU 1041 prints on a ticket a barcode that represents encoded data of the next tournament-type game start time, the player name stored in the RAM 1043, and the like; the player name stored in the RAM 1043; and the number of coins obtained by the player in the tournament-type game that the player has participated this time. Then, the main CPU 1041 issues the ticket as a ticket 1500 with a barcode.

In FIG. 58B, the player name 1501 is printed on the upper portion of the ticket 1500 with a barcode.

At the central portion of the ticket 1500 with a barcode, the barcode 1502 is printed which represents encoded data of the player name and the tournament-type game start time.

At the lower portion at the center of the ticket 1500 with a barcode, the text 1504 is printed which indicates the number of coins obtained by the player in the tournament-type game that the player has participated this time.

Referring back to FIG. 56A, when the main CPU 1041 determines in step s1095 that the ticket issuance flag is not set, the main CPU 1041 issues a ticket without a barcode from the ticket printer 1035 (step s1097).

In the processing, the main CPU 1041 prints on a ticket the player name stored in the RAM 1043; and the number of coins obtained by the player in the tournament-type game that the player has participated this time. Then, the main CPU 1041 issues the ticket as a ticket without a barcode.

When determining in step s1083 that the ticket issuance flag is not set, or when executing the processing of step s1084, step s1092, step s1093, step s1096, or step s1097, the main CPU 1041 ends the present subroutine.

As above, according to the slot machine 1010, the gaming system 1, and the control methods of these of the second embodiment, the slot machine 1010 transmits a game participation signal to the server 1200, when the bill validator 1022 reads a ticket 1500 with a barcode issued from the ticket printer 1346. On receiving the game participation signal, the server 1200 determines the number D of tournaments based on the number of the received game participation signals. Then, the tournament in which the slot machine 1010 as the transmission source of the game participation signal is to participate is determined out of the tournaments of the determined number. The server 1200 transmits matchup information identifying the determined tournament to the slot machine 1010 as the transmission source of the game participation signal. The slot machine 1010 executes the game played against another slot machine 1010 participating in the tournament identified by the received matchup information.

Since the tournament in which the slot machine 1010 is to participate is identified out of a plurality of tournaments, it is possible to excite the player about knowing which slot machine 1010 is going to participate in the same tournament.

The game played against another slot machine 1010 includes a plurality of unit games executed for each of a plurality of game groups comprising two or more slot machines 1010. When the bill validator 1022 reads a ticket 1500 with a barcode issued from the ticket issuing device 1300, the game group to which the slot machine 1010 is belonging is identified and the unit game played against another slot machine 1010 included in the identified game group is executed.

The game played against another slot machine 1010 is executed for each of a plurality of game groups. Therefore, the player is more likely to see clearly the competing slot machine 1010, which may stir up the player's fighting spirit.

Further, in the present invention, participation in a game (in the second embodiment, a tournament-type game) that is played against another gaming machine (in the second embodiment, a slot machine 1010) is enabled by putting a ticket (in the second embodiment, a ticket 1500 with a barcode) into a gaming machine. This configuration allows a player to smoothly participate in a game (in the second embodiment, a tournament-type game) that is played against another gaming machine.

In the second embodiment, the case has been described in which the gaming machine is a slot machine 1010. However, the gaming machine is not particularly limited in the present invention, and can execute, for example, a horse racing game or a card game.

Further, in the second embodiment, the case has been described in which the game played against another gaming machine is a tournament-type game that is a knockout competition. However, in the present invention, the game played against another gaming machine may be a league game that is a round-robin competition.

Furthermore, in the second embodiment, the case has been described in which the input device is the keyboard 1345. However, in the present invention, the input device may be a card reader.

A card reader is for reading data from a smart card and for writing data into a smart card. A smart card is a card owned by a player, and the smart card stores, for example, data showing the player name, and data relating to the history of games played by the player.

Insertion of a smart card into a card reader provided in each ticket issuing device 1300 allows the card reader to read the player name from the smart card, and to transmit a participation input signal including the player name to the CPU 1341.

In the second embodiment, the case has been described in which the code information is the barcode 1502. However, in the present invention, the code information is not limited to one-dimensional information, and may be two-dimensional information. Employment of two-dimensional code information makes it possible for code information to include more data than in the case of employing one-dimensional code information.

In the second embodiment, the case has been described in which a ticket 1500 with a barcode has printed thereon a barcode 1502 that represents encoded data of start time of a tournament-type game. However, in the present invention, the data of code information (in the second embodiment, a barcode 1502) that is to be printed on a ticket (in the second embodiment, a ticket 1500 with a barcode) may be data showing how many games (in the second embodiment, tournament-type games), which are played against another gaming machine, have been played before the game (in the second embodiment, a tournament-type game) that is played against another gaming machine. Code information (in the second embodiment, a barcode) to be printed on a ticket (in the second embodiment, a ticket 1500 with a barcode) is not limited so long as the information at least includes code information (in the second embodiment, a barcode) that represents encoded player identification information such as a player name.

In the second embodiment, the case has been described in which the game group consists of two slot machines that have a match against each other. However, the number of gaming machines to be included in the game group is not particularly limited, and can be, for example, four. In this case, one winning gaming machine may be determined from among the four gaming machines. For example, among the four gaming machines, a gaming machine on which the largest number of coins has been obtained may be determined as the winning gaming machine.

In the second embodiment, the case has been described in which the number of coins obtained by the player in the tournament-type game that the player has participated this time is printed on a ticket without a barcode or on a ticket 1500 with a barcode. However, in the present invention, the rank of the player in the tournament-type game that the player has participated this time may be printed on a ticket without a barcode or on a ticket 1500 with a barcode.

In the second embodiment, the case has been described in which each game history selected via the touch panel 1069 is printed on a ticket without a barcode or on a ticket 1500 with a barcode. However, in the present invention, the total number of coins of the numbers of coins shown by the respective game histories selected via the touch panel 1069 may be printed on a ticket.

In the second embodiment, the case has been described in which the two slot machines having a match against each other execute the game separately, and then the numbers of coins obtained by the respective players on the respective slot machines are compared, so that the winning slot machine is determined. However, in the present invention, the two gaming machines having a match against each other may execute a directly competing game such as a fighting game, with synchronizing with each other. This makes it possible to encourage competition between the players and to make the players further immersed in the common game.

In the second embodiment, there has been described the case where the symbols rearranged in the display blocks 1028 are all scatter symbols. However, symbols in the present invention are not limited to the scatter symbols. For example, a pay line may be provided, and a prize may be won or a point value may be offered when a plurality of symbols in a specific combination are rearranged on the pay line. Further, for example, the symbol leading to winning of a prize upon being rearranged on the pay line and the scatter symbol may be used in combination.

Further, in the second embodiment, there has been described the case where the number of the slot machines 1010 is 50. However, the number of the gaming machines is not particularly limited, and it may be 100, for example.

Furthermore, in the second embodiment, there has been described the case where the number of the ticket issuing devices 1300 is three. However, the number of the ticket issuing devices is not particularly limited, and it may be ten, for example.

[Third Embodiment]

An embodiment of the present invention is described based on the drawings.

The following embodiment describes a case where a gaming machine is a slot machine.

First, a general description of the third embodiment will be given with reference to FIG. 59.

Figure 59:
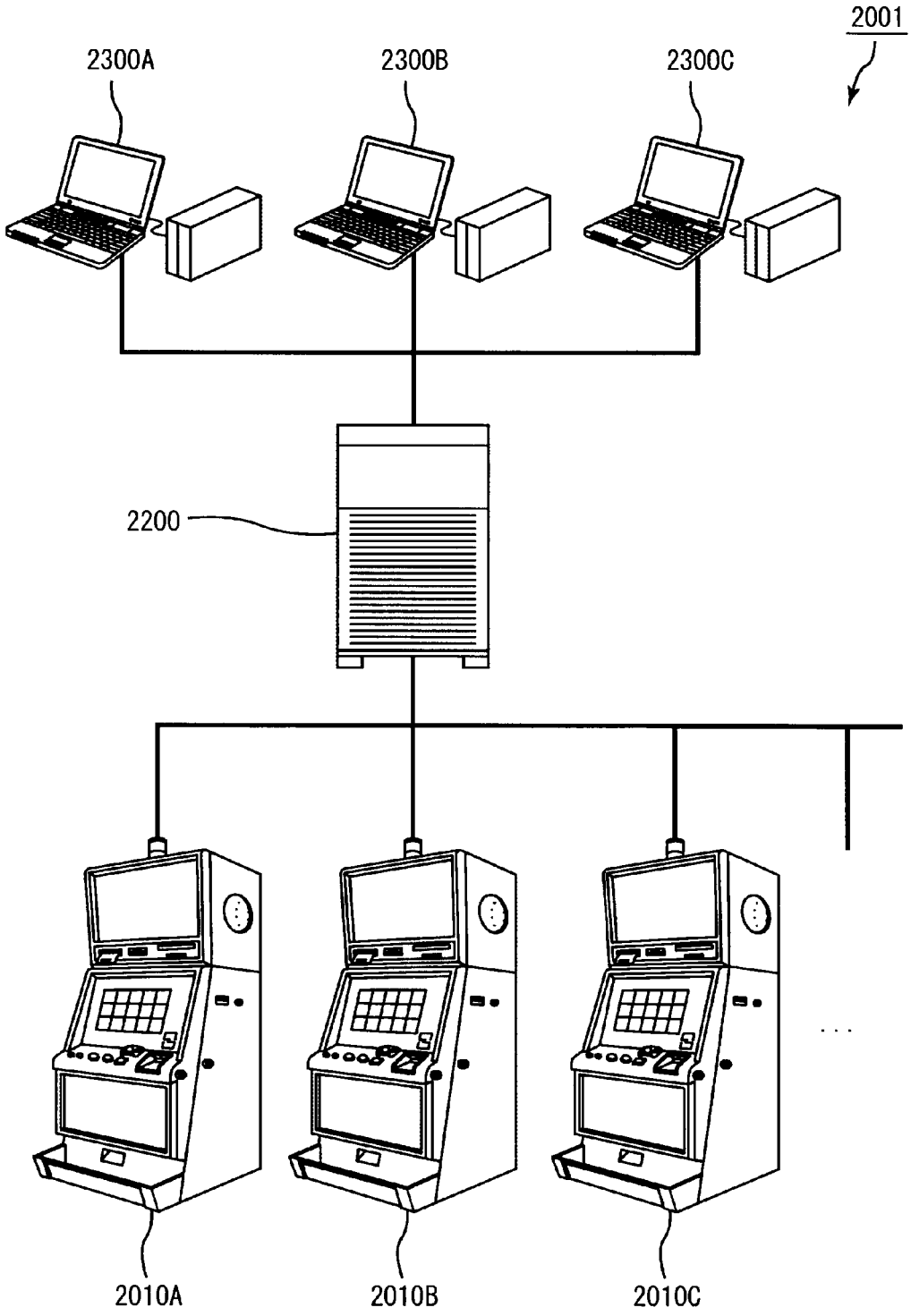
FIG. 59 is a schematic view illustrating an entire configuration of a gaming system according to a third embodiment.

FIG. 59 is a schematic view illustrating an entire configuration of a gaming system according to a third embodiment.

A gaming system 2001 is provided with a plurality of (3 in the third embodiment) ticket issuing devices 2300 (ticket issuing device 2300A, ticket issuing device 2300B, ticket issuing device 2300C); a server 2200; and a plurality of (50 in the third embodiment) slot machines 2010. These devices in the system are connected to one another by a network.

Each ticket issuing device 2300 transmits a participation request signal to the server 2200 when receiving a participation input signal from a keyboard 2345 thereof. When the server 2200 upon reception of the participation request signal determines that the number P of participation-accepted players, which is stored in a RAM 2243 (see FIG. 63), does not exceed a number-of-players upper limit value stored in the RAM 2243, the server 2200 stores into the RAM 2243 a numeric value obtained by adding 1 to the number P of participation-accepted players in the RAM 2243 as an updated number P of participation-accepted players and also transmits a ticket issuance permission signal to the ticket issuing device 2300 as the transmission source of the received participation request signal. When receiving the ticket issuance permission signal, the ticket issuing device 2300 issues from a ticket printer 2346 a ticket 2500 with a barcode (see FIG. 65) that enables participation in a tournament-type game upon being inserted into a bill validator 2022 (see FIG. 61) that is provided in each slot machine 2010.

A player participates in a tournament-type game by inserting a ticket 2500 with a barcode into the bill validator 2022 (see FIG. 61) that is provided in each slot machine 2010.

When a ticket 2500 with a barcode for participating in the next tournament-type game is inserted into the bill validator 2022 (see FIG. 61), the slot machine 2010 sets a tournament-type game flag. On receiving from the server 2200 a tournament-type game start signal, the slot machine 2010 in which the tournament-type game flag is set transmits a game participation signal to the server 2200. The server 2200 determines the number D of tournaments indicating the number of the tournaments in the tournament-type game, based on the number of game participation signals (the number S of participants) received from the respective slot machines 2010. Then, the server 2200 determines assignment of respective slot machines 2010 participating in the tournament-type game to the tournaments.

In a tournament-type game, each player competes with another player based on the number of coins obtained after a predetermined number of (50 in the third embodiment) games are played in each slot machine 2010. More specifically, matches each involving two slot machines 2010 are held, and one of the two slot machines 2010 with a larger number of obtained coins in each match becomes a winning slot machine of the match. The matches are held until the overall winning slot machine is determined based on a tournament tree (see FIG. 84).

When a tournament-type game is over, each slot machine 2010 displays an image (see FIG. 86A) that asks a player whether or not the player wishes to print the number of coins that the player has obtained in the tournament-type game, on a ticket to be issued from a ticket printer 2035 of the slot machine 2010. When the player makes an input that indicates the player's wish to print, the slot machine 2010 issues from the ticket printer 2035 a ticket that has printed thereon the number of coins obtained by the player in the tournament-type game.

The slot machine 2010 displays an image (see FIG. 86B) prompting a selection of whether or not to print the past game result in the tournament-type game on the ticket issued from the ticket printer 2035 provided in the slot machine 2010. When the player has inputted a command of printing, an image (see FIG. 86C) indicating past game histories associated with the player name same as that of the player playing a game on that slot machine 2010. When the player has made a selection input of the game history (when any of selection images 2617 and a selection completion image 2618 are inputted), the slot machine 2010 issues from the ticket printer 2035 a ticket on which the past game history selected by the player is printed.

A tournament-type game corresponds to the game played against an other gaming machine in the present invention.

The bill validator 2022 corresponds to the ticket reader in the present invention.

As above, the third embodiment has been briefly described based on FIG. 59.

Hereinafter, the third embodiment is described in more detail.

Next, a configuration of each slot machine 2010 is described.

Figure 60:
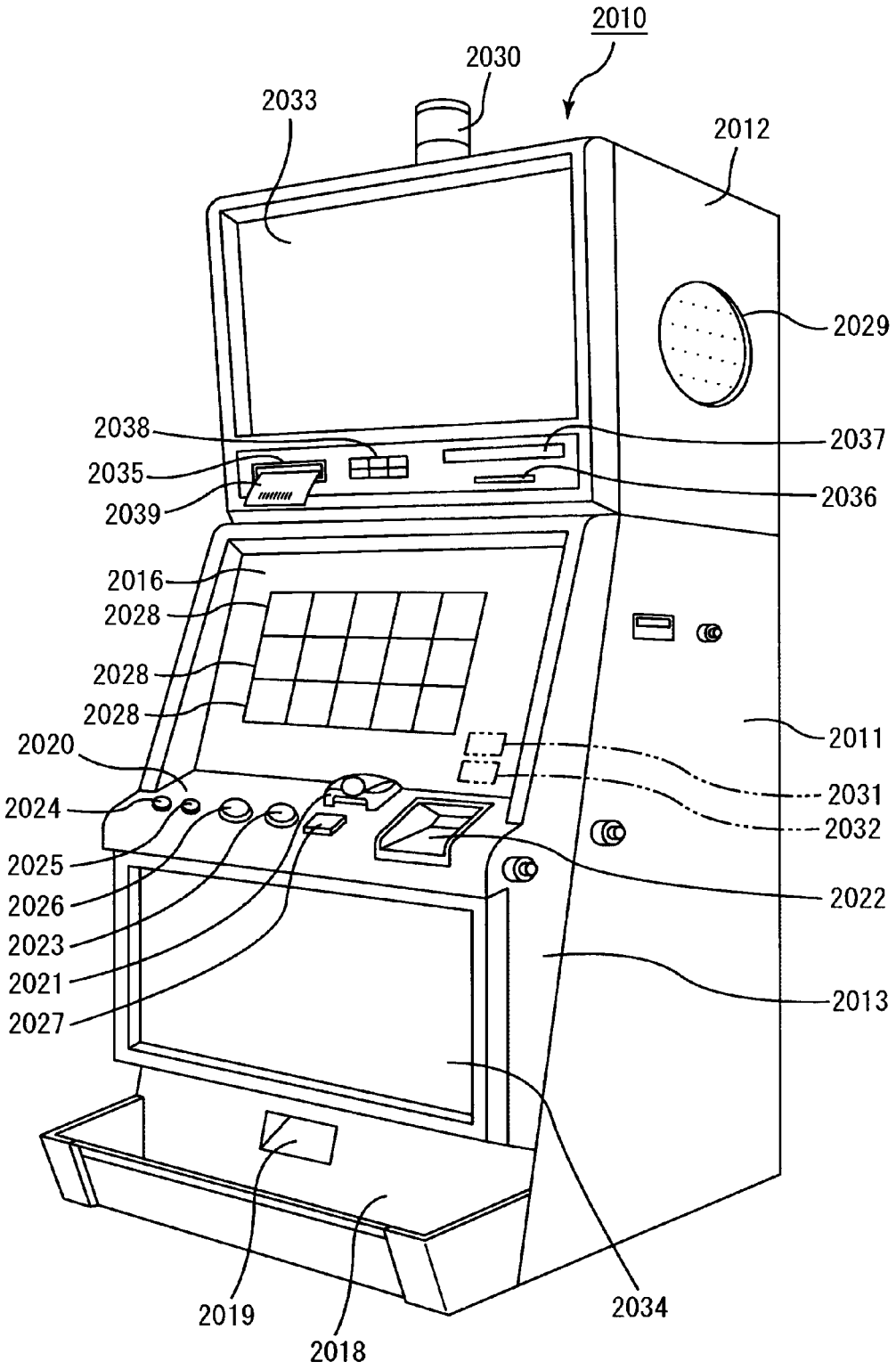
FIG. 60 is a perspective view illustrating an external view of a slot machine constituting a gaming system according to the third embodiment.

FIG. 60 is a perspective view illustrating an external view of a slot machine constituting the gaming system according to the third embodiment.

In the slot machine 2010, a coin, a bill, or electronic valuable information corresponding to those is used as a game medium. However, in the present invention, the game medium is not particularly limited. Examples of the game medium may include a medal, a token, electronic money and a ticket.

The slot machine 2010 comprises a cabinet 2011, a top box 2012 installed on the upper side of the cabinet 2011, and a main door 2013 provided at the front face of the cabinet 2011.

On the main door 2013, there is provided a lower image display panel 2016 as a display. The lower image display panel 2016 includes a transparent liquid crystal panel which displays fifteen display blocks 2028 along five columns and three rows. A single symbol is displayed in each display block 2028. Further, although not illustrated, various types of images relating to an effect, as well as the aforementioned images, are displayed to the lower image display panel 2016.

The lower image display panel 2016 corresponds to the image display in the present invention.

Further, a number-of-credits display portion 2031 and a number-of-payouts display portion 2032 are provided on the lower image display panel 2016. The number-of-credits display portion 2031 displays an image indicative of the number of credited coins. The number-of-payouts display portion 2032 displays an image indicative of the number of coins to be paid out.

Moreover, although not shown, a touch panel 2069 is provided at the front face of the lower image display panel 2016. A player can operate the touch panel 2069 to input a variety of commands.

Below the lower image display panel 2016, there are provided a control panel 2020 including a plurality of buttons 2023 to 2027 with each of which a command according to game progress is inputted by the player, a coin receiving slot 2021 through which a coin is accepted into the cabinet 2011, and a bill validator 2022.

The control panel 2020 is provided with a start button 2023, a change button 2024, a CASHOUT button 2025, a 1-BET button 2026 and a maximum BET button 2027. The start button 2023 is for inputting a command to start scrolling of symbols. The change button 2024 is used for making a request of staff in the recreation facility for exchange. The CASHOUT button 2025 is used for inputting a command to pay out credited coins to a coin tray 2018.

The 1-BET button 2026 is used for inputting a command to bet one coin on a game out of credited coins. The maximum BET button 2027 is used for inputting a command to bet the maximum number of coins that can be bet on one game (50 coins in the third embodiment) out of credited coins.

The bill validator 2022 not only discriminates a regular bill from a false bill, but also accepts the regular bill into the cabinet 2011. It is to be noted that the bill validator 2022 can read information from a barcode printed on a ticket 2500 with a barcode. At the lower front of the main door 2013, namely, below the control panel 2020, there is provided a belly glass 2034 on which a character or the like of the slot machine 2010 is drawn.

On the front surface of the top box 2012, there is provided an upper image display panel 2033. The upper image display panel 2033 includes a liquid crystal panel, which displays, for example, images indicative of introductions of the contents of a game, explanations about the rules of the game, and a later-described tournament tree (see FIG. 84).

Further, a speaker 2029 is provided in the top box 2012. Under the upper image display panel 2033, there are provided a ticket printer 2035, a card reader 2036, a data display 2037, and a key pad 2038. The ticket printer 2035 prints on a ticket a barcode that represents encoded data of the player name, tournament-type game start time, and the like; the number of coins obtained by the player in the tournament-type game; and the like. The ticket is outputted as a ticket 2500 with a barcode. A player can participate in a tournament-type game by making a slot machine read the ticket 2500 with a barcode.

The card reader 2036 reads data from a smart card and writes data into the smart card. The smart card is a card owned by the player, and for example, data for identifying the player and data on a history of games played by the player are stored therein. Data corresponding to a coin, a bill or a credit may be stored in the smart card. Further, a magnetic stripe card may be adopted in place of the smart card. The data display 2037 includes a fluorescent display and the like, and displays, for example, data read by the card reader 2036 or data inputted by the player via the key pad 2038. The key pad 2038 is used for inputting a command and data concerning issuing of a ticket, and the like.

Figure 61:
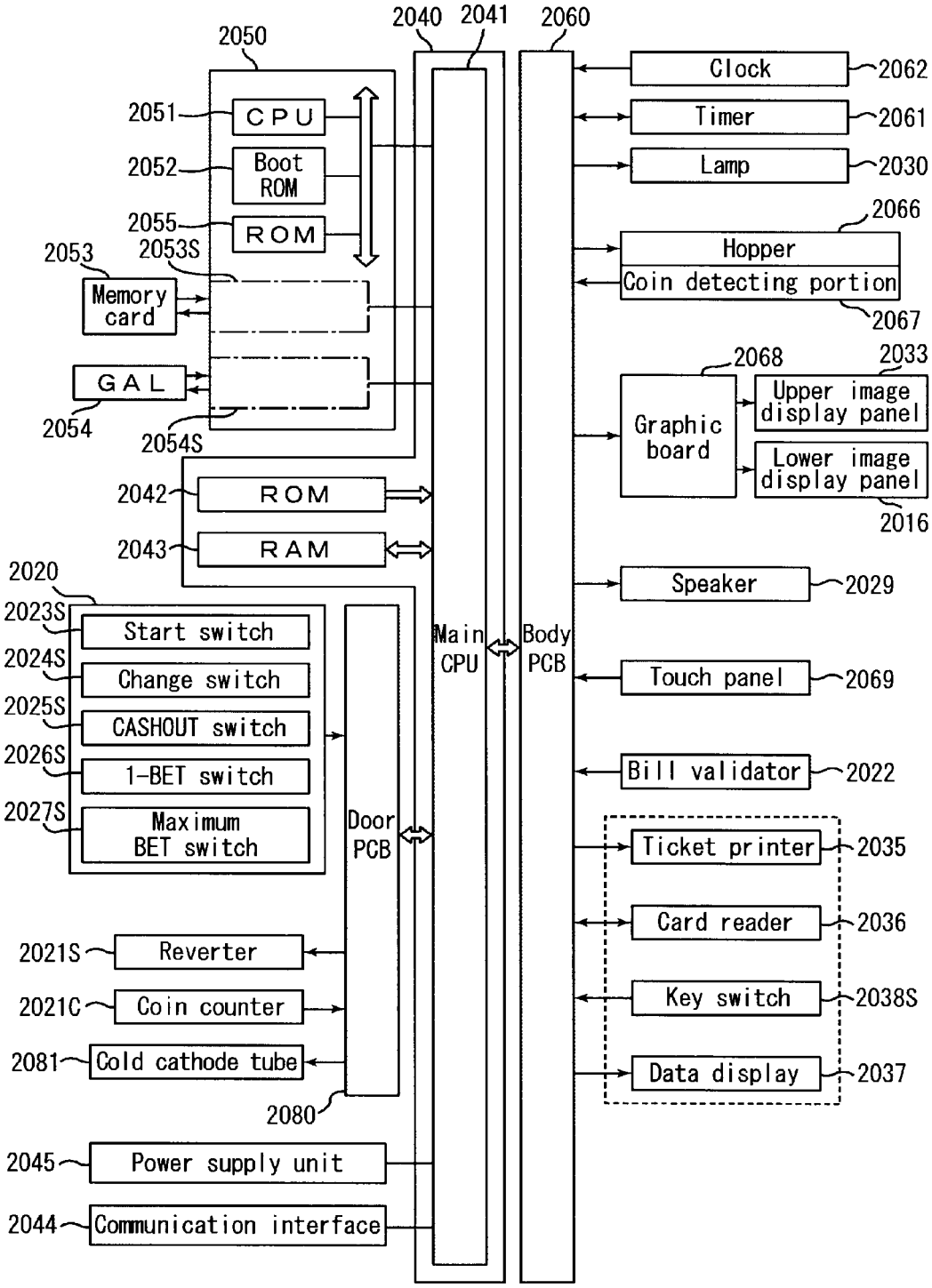
FIG. 61 is a block diagram illustrating an internal configuration of the slot machine shown in FIG. 60.

FIG. 61 is a block diagram illustrating an internal configuration of the slot machine shown in FIG. 60.

A gaming board 2050 is provided with a CPU (Central Processing Unit) 51, a ROM 2055, and a boot ROM 2052 which are interconnected to one another by an internal bus, a card slot 2053S corresponding to a memory card 2053, and an IC socket 2054S corresponding to a GAL (Generic Array Logic) 2054.

The memory card 2053 includes a nonvolatile memory such as CompactFlash (registered trade mark), and stores a game program. The game program includes a symbol determination program. The symbol determination program is a program for determining symbols to be rearranged in the display blocks 2028.

The symbols to be determined by the symbol determination program include 8 types of symbols including "RIBBON", "HEART", "STAR", "MOON", "SUN", "JEWEL", "CROWN", and "SMILE".

Further, the card slot 2053S is configured so as to allow the memory card 2053 to be inserted thereinto or removed therefrom, and is connected to the mother board 2040 by an IDE bus. Therefore, the type and contents of a game played on the slot machine 2010 can be changed by removing the memory card 2053 from the card slot 2053S, writing another game program into the memory card 2053, and inserting the memory card 2053 into the card slot 2053S. The game program includes a program relating to progress of the game. Further, the game program includes image data and sound data to be outputted during the game. The game program also includes odds data showing a correspondence relationship between a type and the number of rearranged symbols and an amount of payout (see FIG. 82), and the like. In addition, the game program includes data showing predetermined time T.

The CPU 2051, the ROM 2055 and the boot ROM 2052 interconnected to one another by an internal bus are connected to the mother board 2040 through a PCI bus. The PCI bus not only conducts signal transmission between the mother board 2040 and the gaming board 2050, but also supplies power from the mother board 2040 to the gaming board 2050.

The mother board 2040 is configured using a commercially available general-purpose mother board (a print wiring board on which fundamental components of a personal computer are mounted), and provided with a main CPU 2041, a ROM (Read Only Memory) 2042, a RAM (Random Access Memory) 2043, and a communication interface 2044. The mother board 2040 corresponds to a controller of the present invention.

The ROM 2042 comprises a memory device such as a flash memory, and stores a program such as a BIOS (Basic Input/Output System) executed by the main CPU 2041, and permanent data. When the BIOS is executed by the main CPU 2041, processing for initializing a predetermined peripheral device is conducted, concurrently with start of processing for loading the game program stored in the memory card 2053 via the gaming board 2050. It is to be noted that, in the present invention, the ROM 2042 may or may not be data rewritable one.

The RAM 2043 stores data and a program to be used at the time of operation of the main CPU 2041. Further, the RAM 2043 is capable of storing a game program.

Moreover, the RAM 2043 stores data of the number of credits, the numbers of coin-ins and coin-outs in one game, and the like.

The mother board 2040 is connected with a later-described body PCB (Printed Circuit Board) 2060 and a door PCB 2080 through respective USBs. Further, the mother board 2040 is connected with a power supply unit 2045 and the communication interface 2044.

The body PCB 2060 and the door PCB 2080 are connected with an instrument and a device that generate an input signal to be inputted into the main CPU 2041 and an instrument and a device operations of which are controlled by a control signal outputted from the main CPU 2041. The main CPU 2041 executes the game program stored in the RAM 2043 based on the input signal inputted into the main CPU 2041, and thereby executes the predetermined arithmetic processing, stores the result thereof into the RAM 2043, or transmits a control signal to each instrument and device as processing for controlling each instrument and device.

The body PCB 2060 is connected with a lamp 2030, a hopper 2066, a coin detecting portion 2067, a graphic board 2068, the speaker 2029, the touch panel 2069, the bill validator 2022, the ticket printer 2035, the card reader 2036, a key switch 20385, the data display 2037, a timer 2061, and a clock 2062. The lamp 2030 is lighted in a predetermined pattern based on control signals outputted from the main CPU 2041.

The hopper 2066 is installed inside the cabinet 2011, and pays out a predetermined number of coins based on a control signal outputted from the main CPU 2041, from a coin payout exit 2019 to the coin tray 2018. The coin detecting portion 2067 is provided inside the coin payout exit 2019, and outputs an input signal to the main CPU 2041 in the case of detecting payout of the predetermined number of coins from the coin payout exit 2019.

The timer 2061 is used for measuring the time.

The clock 2062 is used for timekeeping.

The clock 2062 sets its time every time a predetermined period elapses. The clock 2062 sets its time by getting time data from a clock 2249 (see FIG. 63) that is provided in the server 2200.

The graphic board 2068 controls image display to the upper image display panel 2033 and the lower image display panel 2016 based on a control signal outputted from the main CPU 2041. In the respective display blocks 2028 on the lower image display panel 2016, symbols are displayed in a scrolling manner or in a stopped state. The number of credits stored in the RAM 2043 is displayed to the number-of-credits display portion 2031 of the lower image display panel 2016. Further, the number of coin-outs is displayed to the number-of-payouts display portion 2032 of the lower image display panel 2016.

The graphic board 2068 comprises a VDP (Video Display Processor) for generating image data based on a control signal outputted from the main CPU 2041, a video RAM for temporarily storing image data generated by the VDP, and the like. It is to be noted that image data used in generation of the image data by the VDP is included in the game program read from the memory card 2053 and stored into the RAM 2043.

The bill validator 2022 not only discriminates a regular bill from a false bill, but also accepts the regular bill into the cabinet 2011. Upon acceptance of the regular bill, the bill validator 2022 outputs an input signal to the main CPU 2041 based on a face amount of the bill. The main CPU 2041 stores in the RAM 2043 the number of credits corresponding to the face amount of the bill transmitted with the input signal.

Further, when receiving a ticket 2500 with a barcode, the bill validator 2022 reads the data of the player name, the tournament-type game start time, and the like from the barcode printed on the ticket 2500 with a barcode, and then outputs the read information to the main CPU 2041.

The ticket printer 2035 is for printing on a ticket a barcode that represents encoded data of the player name, the tournament-type game start time, and the like; the number of coins obtained by the player in the tournament-type game; and the like. Then, the ticket printer 2035 outputs the ticket as a ticket 2500 with a barcode.

The card reader 2036 reads data from the smart card and transmits the read data to the main CPU 2041, and writes data onto the smart card based on a control signal from the main CPU 2041. The key switch 2038S is provided on the key pad 2038, and outputs a predetermined input signal to the main CPU 2041 when the key pad 2038 is operated by the player. The data display 2037 displays data read by the card reader 2036 and data inputted by the player via the key pad 2038, based on a control signal outputted from the main CPU 2041.

The ticket printer 2035 corresponds to the recording medium issuing device in the present invention.

The door PCB 2080 is connected with the control panel 2020, a reverter 20215, a coin counter 2021C, and a cold cathode tube 2081. The control panel 2020 is provided with a start switch 2023S corresponding to the start button 2023, a change switch 2024S corresponding to the change button 2024, a CASHOUT switch 2025S corresponding to the CASHOUT button 2025, a 1-BET switch 2026S corresponding to the 1-BET button 2026, and a maximum BET switch 2027S corresponding to the maximum BET button 2027. Each of the switches 2023S to 2027S outputs an input signal to the main CPU 2041 when each of the buttons 2023 to 2027 corresponding thereto is operated by the player.

The coin counter 2021C is provided inside the coin receiving slot 2021, and discriminates a regular coin from a false coin when a coin is inserted into the coin receiving slot 2021 by the player. Coins other than the regular coin are discharged from the coin payout exit 2019. Further, the coin counter 2021C outputs an input signal to the main CPU 2041 in detection of the regular coin.

The reverter 2021S operates based on the control signal outputted from the main CPU 2041, and distributes a coin recognized by the coin counter 2021C as the regular coin into a cash box (not shown) or the hopper 2066, which are disposed in the slot machine 2010. Namely, when the hopper 2066 is filled with coins, the regular coin is distributed into the cash box by the reverter 2021S. On the other hand, when the hopper 2066 is not filled with coins, the regular coin is distributed into the hopper 2066. The cold cathode tube 2081 functions as aback light installed on the rear face side of the lower image display panel 2016 and the upper image display panel 2033, and lighted up based on the control signal outputted from the main CPU 2041.

Figure 62:
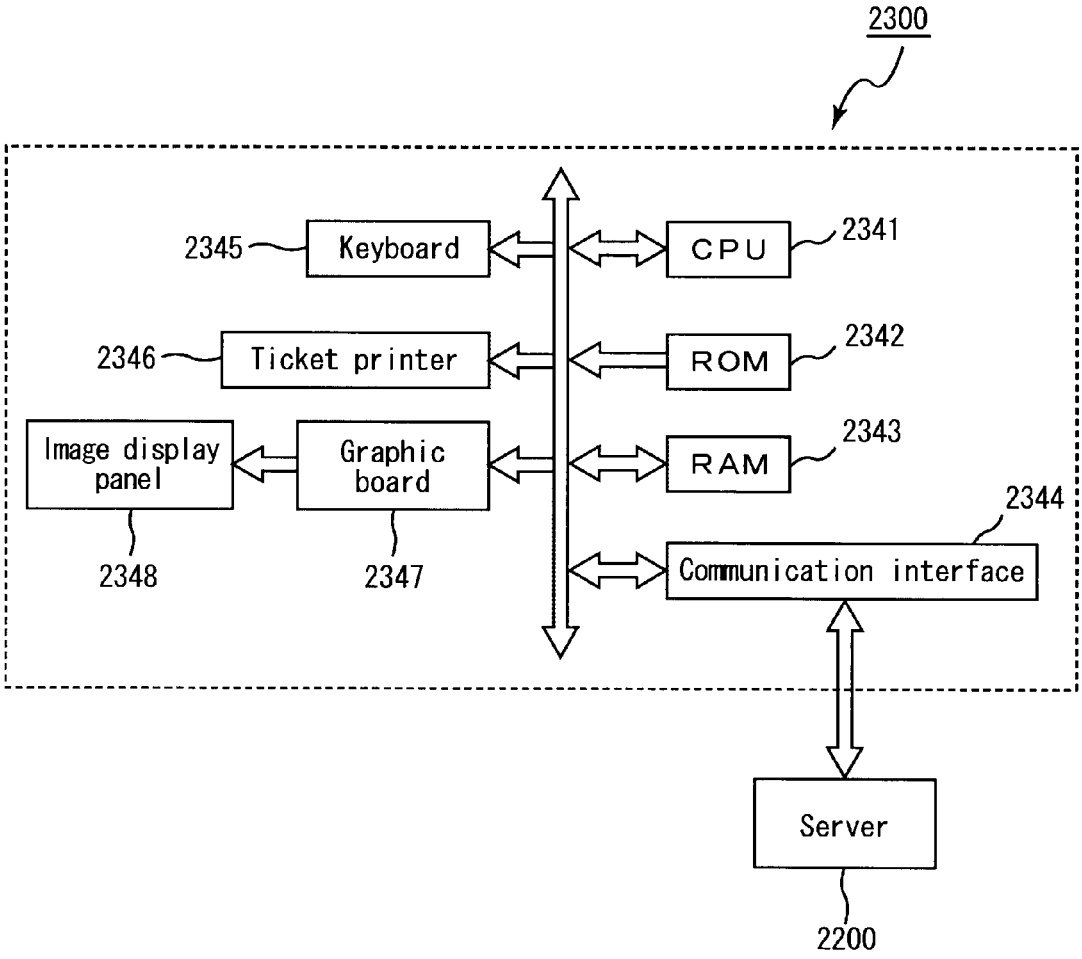
FIG. 62 is a block diagram illustrating an internal configuration of a ticket issuing device constituting the gaming system according to the third embodiment of the present invention.

FIG. 62 is a block diagram illustrating an internal configuration of a ticket issuing device that constitutes the gaming system according to the third embodiment of the present invention.

Each ticket issuing device 2300 is provided with a CPU 2341, a ROM 2342, a RAM 2343, a communication interface 2344, a keyboard 2345, a ticket printer 2346, a graphic board 2347, and an image display panel 2348.

The keyboard 2345 is used for inputting letters and numerals. The ticket printer 2346 is for printing on a ticket a barcode that represents encoded data of the player name, the tournament-type game start time, and the like, and then outputting the ticket as a ticket 2500 with a barcode. The graphic board 2347 controls image display on the image display panel 2348 based on a control signal outputted from the CPU 2341. The image display panel 2348 displays an input screen (not shown) for the player name, and the like.

The communication interface 2344 is connected through a communication line to a communication interface 2244 that is provided in the server 2200. The ROM 2342 stores a system program for controlling operation of the processor, permanent data, and the like. The RAM 2343 temporarily stores data received from the server 2200, and the like.

The keyboard 2345 corresponds to the input device in the present invention.

The ticket printer 2346 corresponds to the ticket issuing terminal in the present invention.

The CPU 2341 corresponds to the processor in the present invention.

Figure 63:
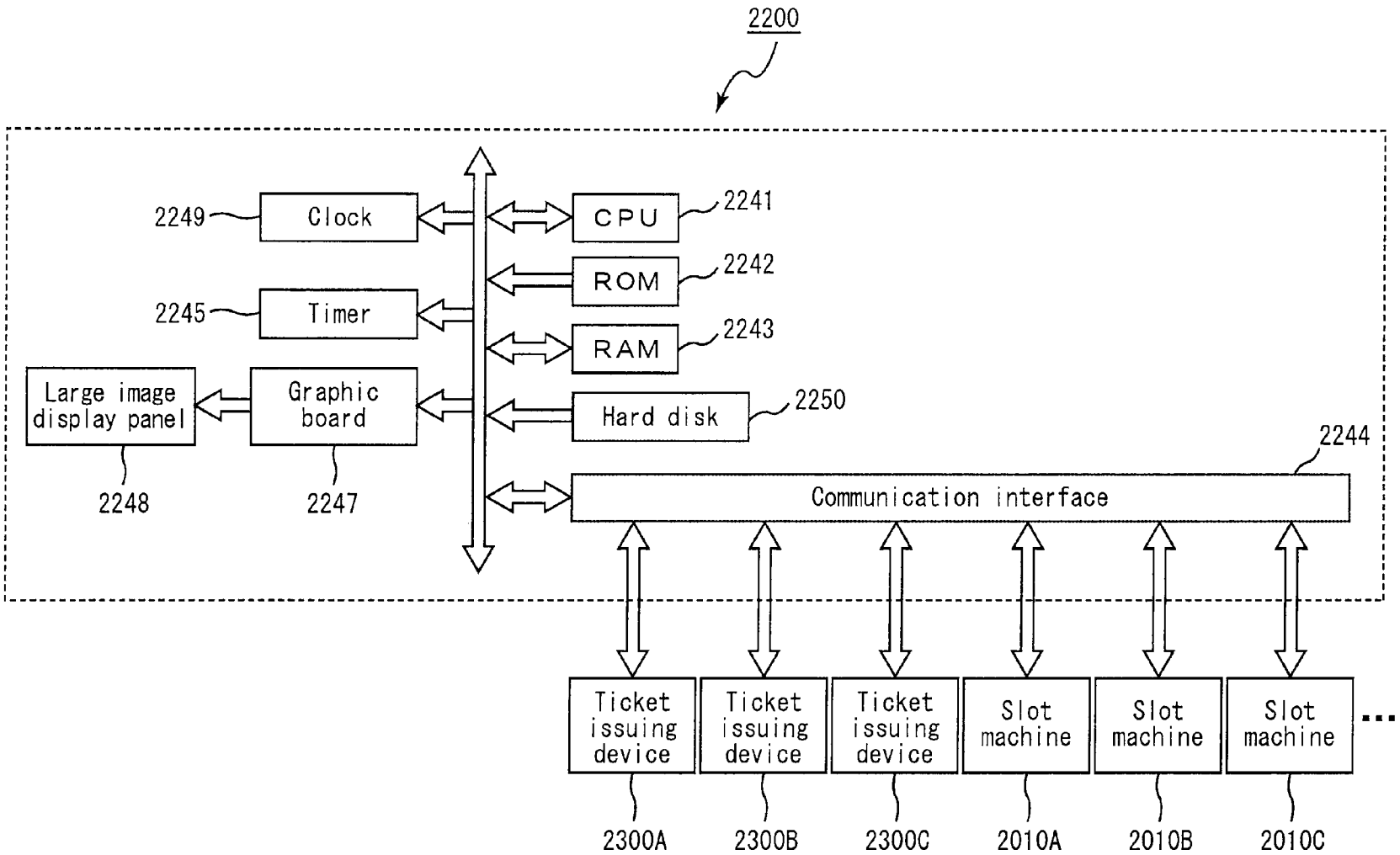
FIG. 63 is a block diagram illustrating an internal configuration of a server constituting the gaming system according to the third embodiment of the present invention.

FIG. 63 is a block diagram illustrating an internal configuration of the server that constitutes the gaming system according to the third embodiment of the present invention.

The server 2200 is provided with a CPU 2241, a ROM 2242, a RAM 2243, the communication interface 2244, a timer 2245, a graphic board 2247, a large image display panel 2248, the clock 2249, and a hard disk 2250.

The graphic board 2247 controls image display on the large image display panel 2248 based on a control signal outputted from the CPU 2241. The large image display panel 2248 displays a result (ranking) of a tournament-type game, and the like. The timer 2245 is used for measuring time. The clock 2249 is used for time keeping.

The communication interface 2244 is connected through each communication line to the communication interface 2344 of each ticket issuing device 2300 and to a communication interface 2044 of each slot machine 2010. The ROM 2242 stores a system program for controlling operation of the CPU 2241, permanent data, and the like. The ROM 2242 also stores data showing predetermined start time, predetermined first end time, predetermined second end time, and predetermined time. The RAM 2243 temporarily stores data received from the slot machines 2010 and the ticket issuing devices 2300, and the like. The hard disk 2250 stores a total cumulative amount of payout in association with the player name and the date.

The RAM 2243 corresponds to the memory in the present invention.

The CPU 2241 corresponds to the control portion in the present invention.

Figure 64:
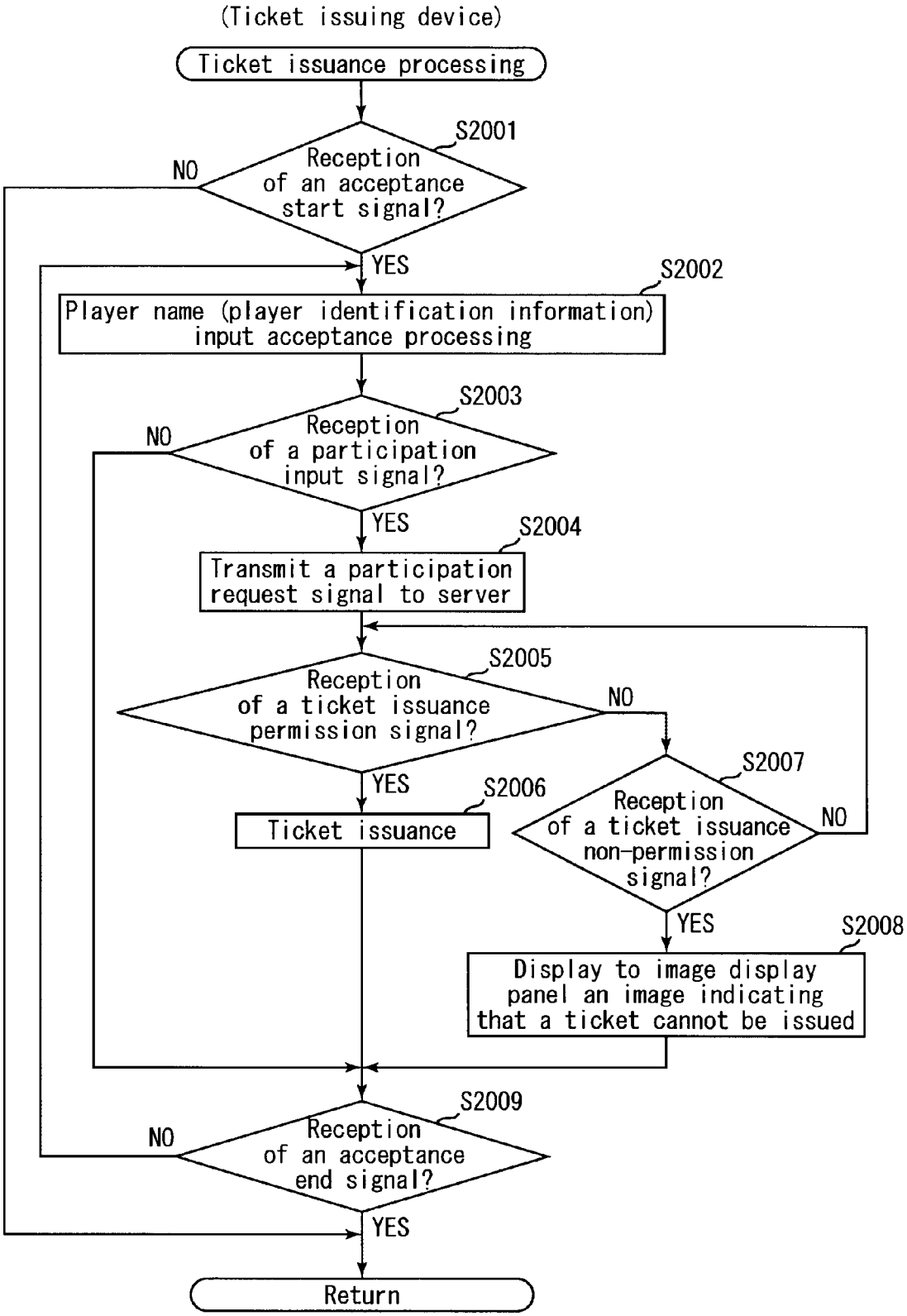
FIG. 64 is a flowchart illustrating ticket issuance processing executed in each ticket issuing device.

FIG. 64 is a flowchart illustrating ticket issuance processing executed in each ticket issuing device.

First, the CPU 2341 determines whether or not the CPU 2341 has received acceptance start signal from the server 2200 at a predetermined timing (step S2001). When the CPU 2341 determines that the CPU 2341 has not received the acceptance start signal, the CPU 2341 ends the ticket issuance processing.

On the other hand, when the CPU 2341 determines that the CPU 2341 has received the acceptance start signal, the CPU 2341 executes player-name input acceptance processing (step S2002). In the player-name input acceptance processing, the CPU 2341 accepts input of a player name through the keyboard 2345. In the third embodiment, the keyboard 2345 is operated by an operator, not a player. The operator inputs a player name of the player who wishes to participate in a tournament-type game. Completion of input of the player name leads to display of a confirmation screen for checking if the inputted player name is correct, to the image display panel 2348 (not shown). The operator inputs "Y" via the keyboard 2345 when there is no error. Input of "Y" via the keyboard 2345 at the time of display of the confirmation screen to the image display panel 2348 leads to transmission of a participation input signal from the keyboard 2345 to the CPU 2341. The participation input signal includes the player name that has been inputted via the keyboard 2345. On the other hand, when the operator inputs "N" via the keyboard 2345, input of a player name is enabled again.

The player name inputted via the keyboard 2345 corresponds to the player identification information in the present invention.

In the third embodiment, a description has been given in which the operator who operates the keyboard 2345 is not a player. However, in the present invention, a player may be an operator. If this is the case, the player operates the input device.

Next, the CPU 2341 determines whether or not the CPU 2341 has received the participation input signal from the keyboard 2345 (step S2003). When the CPU 2341 determines that the CPU 2341 has not received the participation input signal, the CPU 2341 shifts the processing to step S2009.

On the other hand, when the CPU 2341 determines that the CPU 2341 has received the participation input signal, the CPU 2341 transmits a participation request signal to the server 2200 (step S2004). The participation request signal includes the identification number of the ticket issuing device 2300.

Now, the CPU 2341 determines whether or not the CPU 2341 has received a ticket issuance permission signal from the server 2200 (step S2005). When the CPU 2341 determines that the CPU 2341 has received the ticket issuance permission signal, the CPU 2341 issues a ticket 2500 with a barcode (step S2006). In the processing, the CPU 2341 prints on a ticket a barcode that represents encoded data of the player name and the next tournament-type game start time, and then issues the ticket as a ticket 2500 with a barcode.

Figure 65:
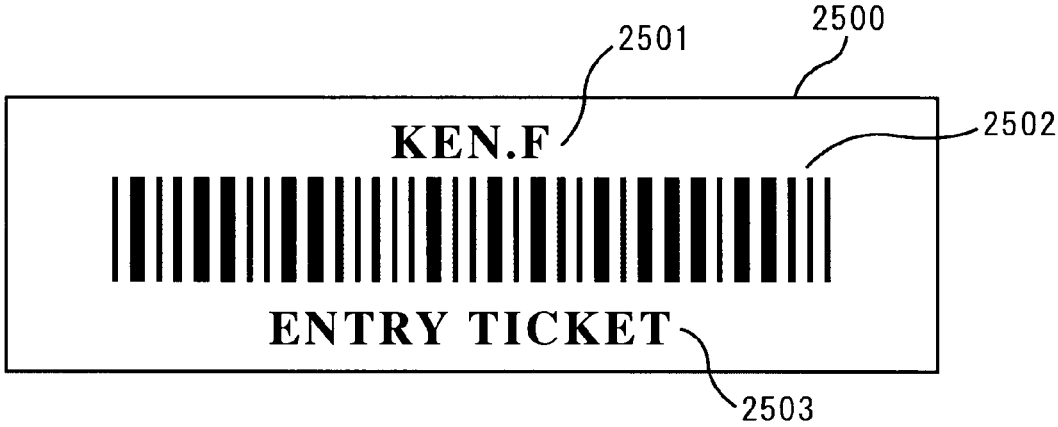
FIG. 65 is a view illustrating an exemplary ticket with a barcode which is issued from a ticket issuing device of the third embodiment.

FIG. 65 is a view illustrating an exemplary ticket with a barcode issued from a ticket issuing device of the third embodiment.

At the upper portion of the ticket 2500 with a barcode, a player name 2501 is printed.

At the central portion of the ticket 2500 with a barcode, a barcode 2502 is printed which represents encoded data of the player name and the tournament-type game start time.

At the lower portion of the ticket 2500 with a barcode, text 2503 is printed which indicates that the ticket is used for participation in a tournament-type game.

The data showing the tournament-type game start time corresponds to the game identification information in the present invention.

The barcode 2502 corresponds to the code information in the present invention.

Referring back to FIG. 64, when the CPU 2341 determines in step S2005 that the CPU 2341 has not received a ticket issuance permission signal, the CPU 2341 determines whether or not the CPU 2341 has received a ticket issuance non-permission signal from the server 2200 (step S2007). When the CPU 2341 determines that the CPU 2341 has not received the ticket issuance non-permission signal, the CPU 2341 returns the processing to step S2005. On the other hand, when the CPU 2341 determines that the CPU 2341 has received the ticket issuance non-permission signal, the CPU 2341 displays to the image display panel 2348 an image that indicates that a ticket cannot be issued (not shown). When the image display panel 2348 displays the image that indicates that a ticket cannot be issued, the operator tells the player, who wishes to participate in a tournament-type game, that the player cannot participate in the tournament-type game.

When the CPU 2341 determines in step S2003 that the CPU 2341 has not received a participation input signal or when the CPU 2341 has executed the processing of step S2006 or step S2008, the CPU 2341 determines whether or not the CPU 2341 has received an acceptance end signal from the server 2200 (step S2009). When the CPU 2341 determines that the CPU 2341 has not received the acceptance end signal, the CPU 2341 returns the processing to step S2002. On the other hand, when the CPU 2341 determines that the CPU 2341 has received the acceptance end signal, the CPU 2341 ends the ticket issuance processing.

Figure 66:
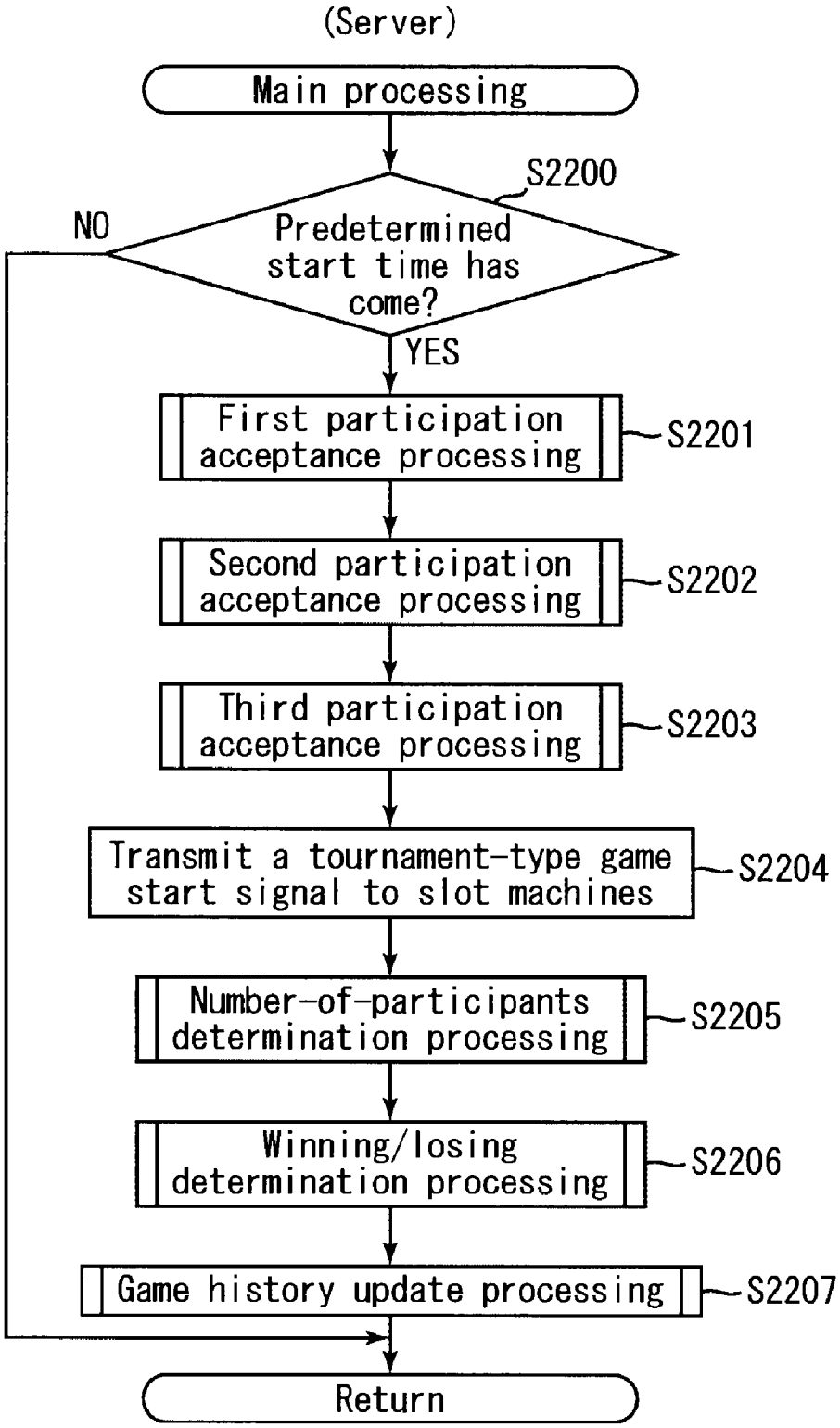
FIG. 66 is a flowchart illustrating main processing that is executed in the server.

FIG. 66 is a flowchart illustrating main processing executed in the server.

First, the CPU 2241 determines whether or not the predetermined start time has come, at a predetermined timing (step S2200). In the processing, the CPU 2241 determines whether or not the time shown by the clock 2249 is the predetermined start time. When determining that the predetermined start time has not come yet, the CPU 2241 ends the main processing.

On the other hand, when determining in step S2200 that the predetermined start time has come, the CPU 2241 executes first participation acceptance processing (step S2201). In the processing, the CPU 2241 controls issuance of tickets 2500 with a barcode to players who wish to participate in the tournament-type game. The first participation acceptance processing will be described later with reference to drawings.

The CPU 2241 executes second participation acceptance processing (step S2202). In the processing, the CPU 2241 checks whether or not the players who are currently playing a game wish to participate in the next game to be held. The second participation acceptance processing will be described later with reference to a drawing.

The CPU 2241 executes third participation acceptance processing (step S2203). In the processing, the CPU 2241 controls issuance of tickets 2500 with a barcode to players who wish to participate in the tournament-type game. The third participation acceptance processing will be described later with reference to drawings.

The CPU 2241 transmits a tournament-type game start signal to the slot machines 2010 (step S2204).

The CPU 2241 executes number-of-participants determination processing (step S2205). In the processing, the CPU 2241 determines the number of players who participate in the tournament-type game; the number of tournaments; and assignment of the slot machines 2010 participating in the tournament-type game to the tournaments. The number-of-participants determination processing will be described later with reference to a drawing.

The CPU 2241 executes winning/losing determination processing (step S2206). In the processing, the CPU 2241 determines the winning slot machine of each match in each tournament. The winning/losing determination processing will be described later with reference to drawings.

The CPU 2241 executes game-history update processing (step S2207). In the processing, the CPU 2241 stores the number of coins obtained by each player in the tournament-type game. The game-history update processing will be described later with reference to a drawing.

After executing the processing of step S2207, the CPU 2241 ends the main processing.

Figure 67:
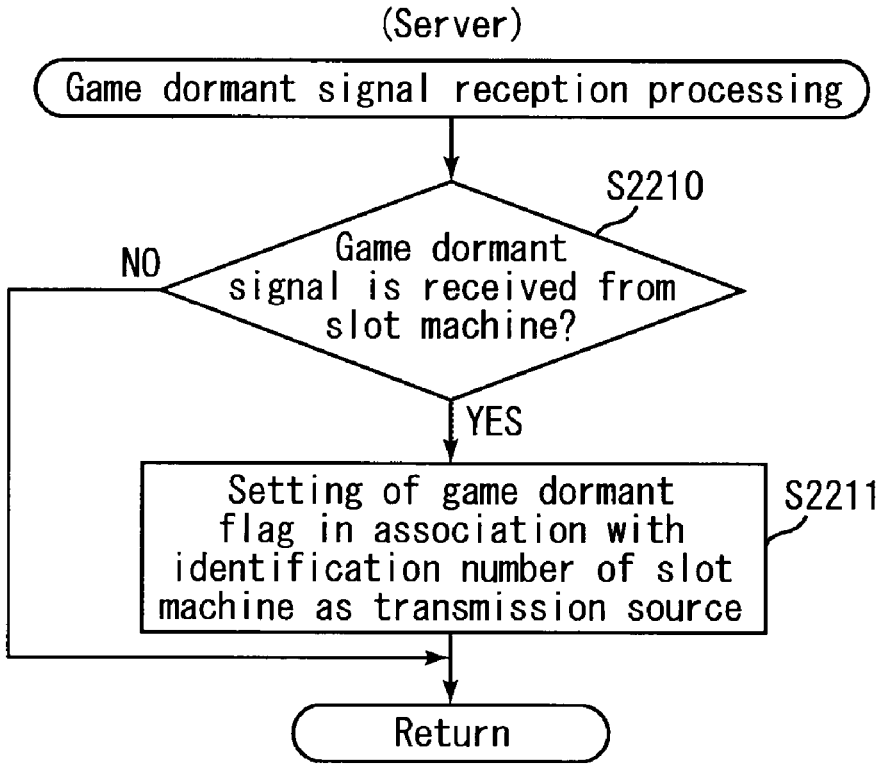
FIG. 67 is a flowchart illustrating a subroutine of game dormant signal reception processing.

FIG. 67 is a flowchart illustrating a subroutine of game dormant signal reception processing.

First, the CPU 2241 determines whether or not the CPU 2241 has received a game dormant signal from any of the slot machines 2010, at a predetermined timing (step S2210).

When the CPU 2241 determines that the CPU 2241 has not received a game dormant signal, the CPU 2241 ends the present subroutine. On the other hand, when the CPU 2241 determines that the CPU 2241 has received a game dormant signal, the CPU 2241 sets a game dormant flag in association with the identification number of the slot machine 2010 which is included in the received game dormant signal (step S2211).

After executing the processing of step S2211, the CPU 2241 ends the present subroutine.

Figure 68A:
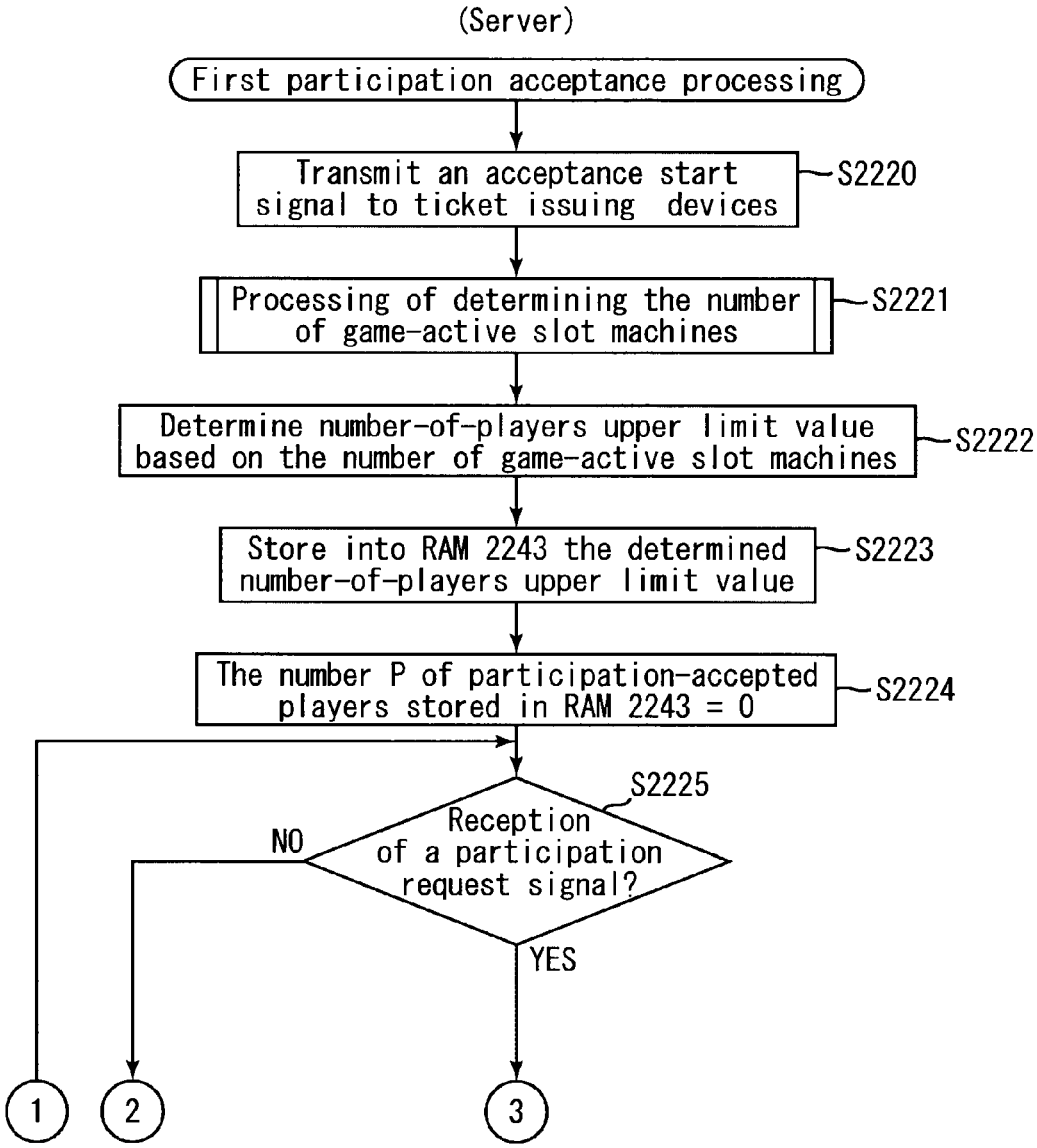
FIG. 68A is a flowchart illustrating a subroutine of first participation acceptance processing.

FIG. 68A is a flowchart illustrating a subroutine of the first participation acceptance processing.

Figure 68B:
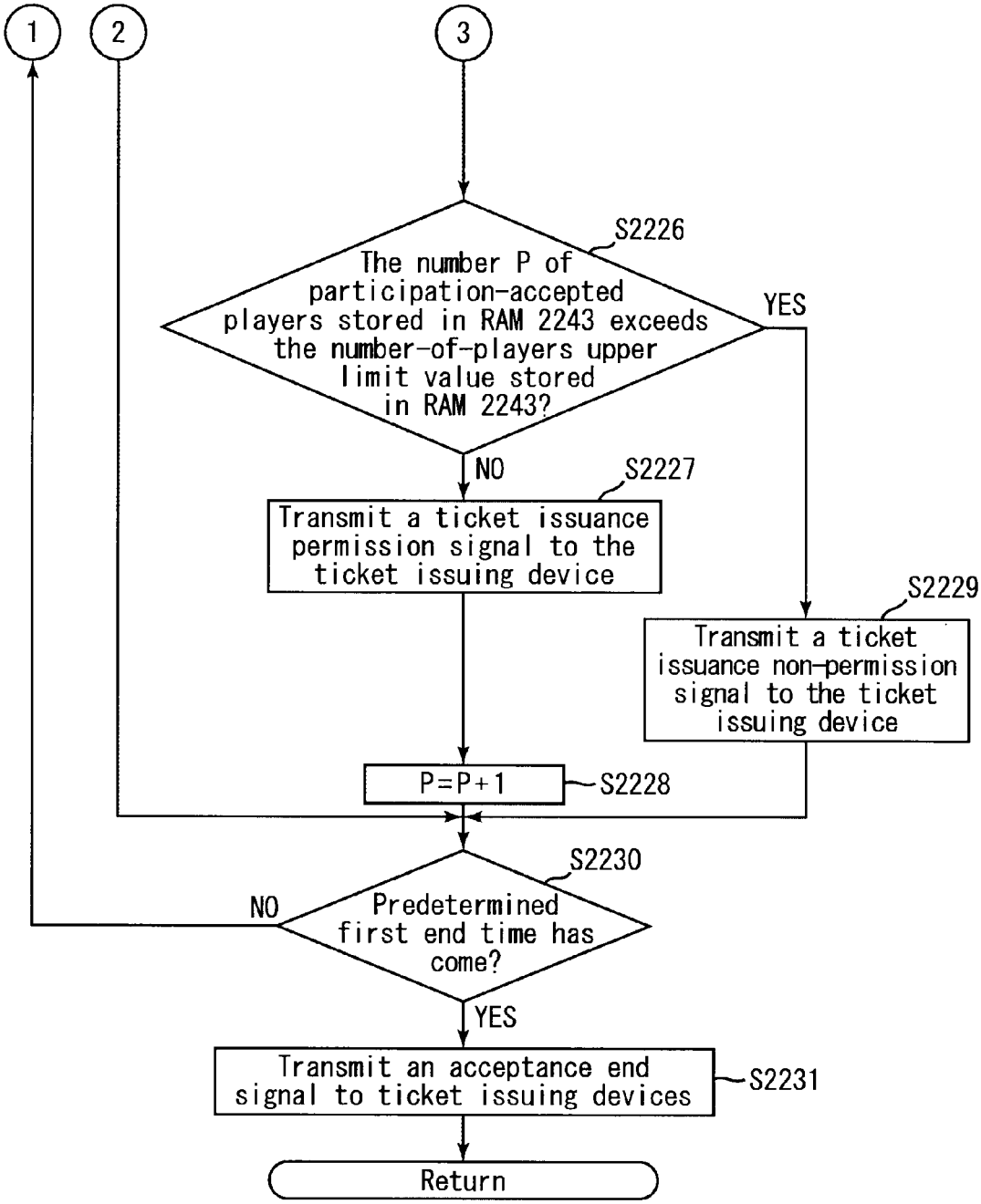
FIG. 68B is another flowchart illustrating the subroutine of the first participation acceptance processing.

FIG. 68B is another flowchart illustrating the subroutine of the first participation acceptance processing.

First, the CPU 2241 transmits a participation start signal to the ticket issuing devices 2300 (step S2220).

The CPU 2241 then executes processing of determining the number of game-active slot machines (step S2221). In the processing, the CPU 2241 determines the number of game-active slot machines which indicates the number of slot machines where a game is played. The processing of determining the number of game-active slot machines will be described later with reference to a drawing.

The CPU 2241 then determines a number-of-players upper limit value, based on the number of game-active slot machines which has been determined in step S2221 (step S2222). In the third embodiment, the CPU 2241 first subtracts the number of game-active slot machines from 50, which is the total number of the slot machines 2010. That is, the CPU 2241 determines the number of slot machines 2010 on which no game is played. Next, the CPU 2241 obtains a numeric value by multiplying the number of slot machines 2010 on which no game is played by 0.7 and truncating the digits after the decimal point, and then determines the obtained value as the number-of-players upper limit value. The number-of-players upper limit value indicates the maximum number of tickets 2500 with a barcode to be issued. That is, tickets 2500 with a barcode only in number not more than the number-of-players upper limit value can be issued.

In the third embodiment, the number of slot machine 2010 on which no game is played is multiplied by 0.7. The number of slot machines 2010 on which no game is played is multiplied by 0.7 so as to prevent a situation where a player cannot participate in a tournament-type game because there is no slot machine 2010 on which a game is played even though the player has a ticket 2500 with a barcode.

Further, multiplying the number of slot machines 2010 on which no game is played by 0.7 makes it possible to offer a chance for players, who do not participate in a tournament-type game, to play a game in a slot machine.

Next, the CPU 2241 stores the number-of-players upper limit value determined in step S2222 into the RAM 2243 (step S2223). The CPU 2241 further stores 0 into the RAM 2243 as an updated number P of participation-accepted players (step S2224).

The CPU 2241 determines whether or not the CPU 2241 has received a participation request signal from any of the ticket issuing devices 2300 (step S2225). When the CPU 2241 determines that the CPU 2241 has not received a participation request signal, the CPU 2241 shifts the processing to step S2230.

On the other hand, when the CPU 2241 determines in step S2225 that the CPU 2241 has received a participation request signal, the CPU 2241 determines whether or not the number P of participation-accepted players stored in the RAM 2243 exceeds the number-of-players upper limit value stored in the RAM 2243 (step S2226). When determining that the number P of participation-accepted players does not exceed the number-of-players upper limit value, the CPU 2241 transmits a ticket issuance permission signal to the ticket issuing device 2300 as the transmission source of the participation request signal (step S2227). Then, the CPU 2241 stores into the RAM 2243 a value obtained by adding 1 to the number P of participation-accepted players stored in the RAM 2243 as an updated number P of participation-accepted players (step S2228).

On the other hand, when the CPU 2241 determines in step S2226 that the number P of participation-accepted players exceeds the number-of-players upper limit value, the CPU 2241 transmits a ticket issuance non-permission signal to the ticket issuing device 2300 as the transmission source of the participation request signal (step S2229).

When the CPU 2241 determines in step S2225 that the CPU 2241 has not received a participation request signal, or when the CPU 2241 has executed the processing of step S2228 or step S2229, the CPU 2241 determines whether or not predetermined first end time has come (step S2230). In the processing, the CPU 2241 determines whether or not the time shown by the clock 2249 is the predetermined first end time. When determining that the predetermined first end time has not come yet, the CPU 2241 returns the processing to step S2225.

On the other hand, when determining in step S2230 that the predetermined first end time has come, the CPU 2241 transmits an acceptance end signal to the ticket issuing devices 2300 (step S2231).

After executing the processing of step S2231, the CPU 2241 ends the present subroutine.

Figure 69:
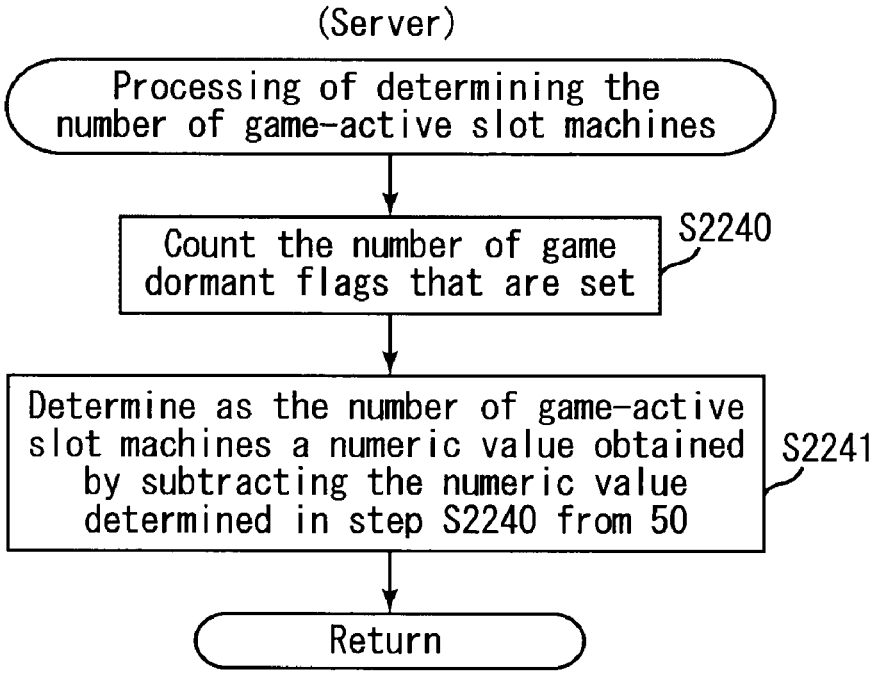
FIG. 69 is a flowchart illustrating a subroutine of processing of determining the number of game-active slot machines.

FIG. 69 is a flowchart illustrating a subroutine of the processing of determining the number of game-active slot machines.

First, the CPU 2241 counts the number of game dormant flags that are set, at a predetermined timing (step S2240).

The CPU 2241 subtracts the numeric value counted in step S2240 from 50, and determines the obtained numeric value as the number of game-active slot machines (step S2241). The CPU 2241 then stores the determined number of game-active slot machines into the RAM 2243.

After executing the processing of step S2241, the CPU 2241 ends the present subroutine.

Figure 70:
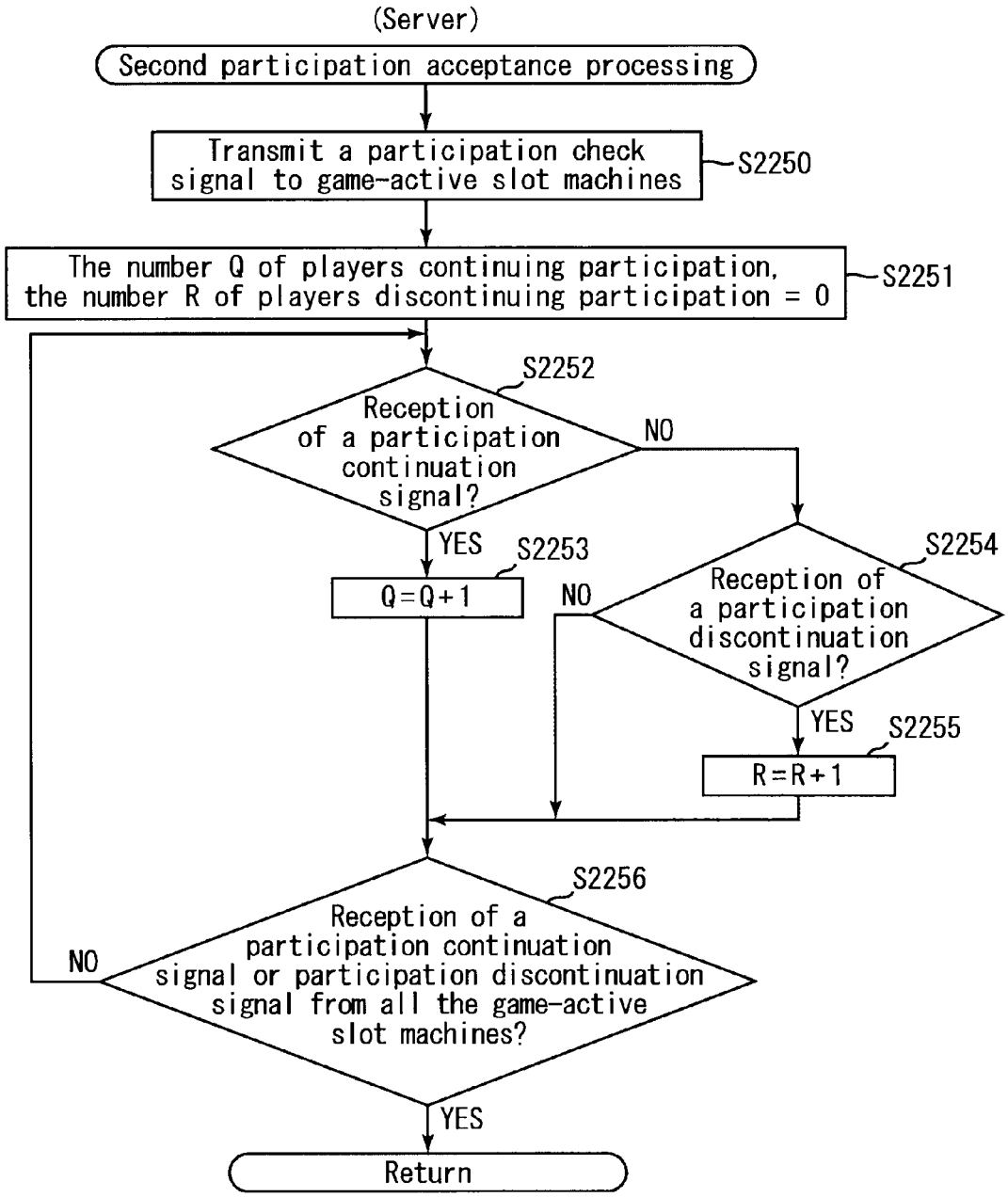
FIG. 70 is a flowchart illustrating a subroutine of second participation acceptance processing.

FIG. 70 is a flowchart illustrating a subroutine of the second participation acceptance processing.

First, the CPU 2241 transmits a participation check signal to the slot machines 2010 on which a game is played (step S2250). In the processing, the CPU 2241 transmits the participation check signal to each slot machine 2010 for which a game dormant flag is not set in association with the identification number.

The CPU 2241 stores 0 into the RAM 2243 as an updated number Q of players continuing participation, and stores 0 into the RAM 2243 as an updated number R of players discontinuing participation (step S2251).

The CPU 2241 determines whether or not the CPU 2241 has received a participation continuation signal from each slot machine 2010 (step S2252). When the CPU 2241 determines that the CPU 2241 has received a participation continuation signal, the CPU 2241 stores into the RAM 2243 a numeric value obtained by adding 1 to the number Q of players continuing participation in the RAM 2243 as an updated number Q of players continuing participation (step S2253).

On the other hand, when the CPU 2241 determines in step S2252 that the CPU 2241 has not received a participation continuation signal, the CPU 2241 determines whether or not a participation discontinuation signal from each slot machine 2010 (step S2254). When the CPU 2241 determines that the CPU 2241 has received a participation discontinuation signal, the CPU 2241 stores into the RAM 2243 a numeric value obtained by adding 1 to the number R of players discontinuing participation in the RAM 2243 as an updated number R of players discontinuing participation (step S2255).

When the CPU 2241 determines in step S2254 that the CPU 2241 has not received a participation discontinuation signal, or when the CPU 2241 has executed the processing of step S2253 or step S2255, the CPU 2241 determines whether or not the CPU 2241 has received either a participation continuation signal or a participation discontinuation signal from every slot machine on which a game is played (step S2256). In the processing, the CPU 2241 determines whether or not the total number of the number Q of players continuing participation stored in the RAM 2243 and the number R of players discontinuing participation stored in the RAM 2243 matches the number of participation check signals transmitted in the processing of step S2250. When the CPU 2241 determines that the CPU 2241 has not received either a participation continuation signal or a participation discontinuation signal from every slot machine on which a game is played, the CPU 2241 returns the processing to step S2252. On the other hand, when the CPU 2241 determines that the CPU 2241 has received either a participation continuation signal or a participation discontinuation signal from every slot machine on which a game is played, the CPU 2241 ends the present subroutine.

Figure 71A:
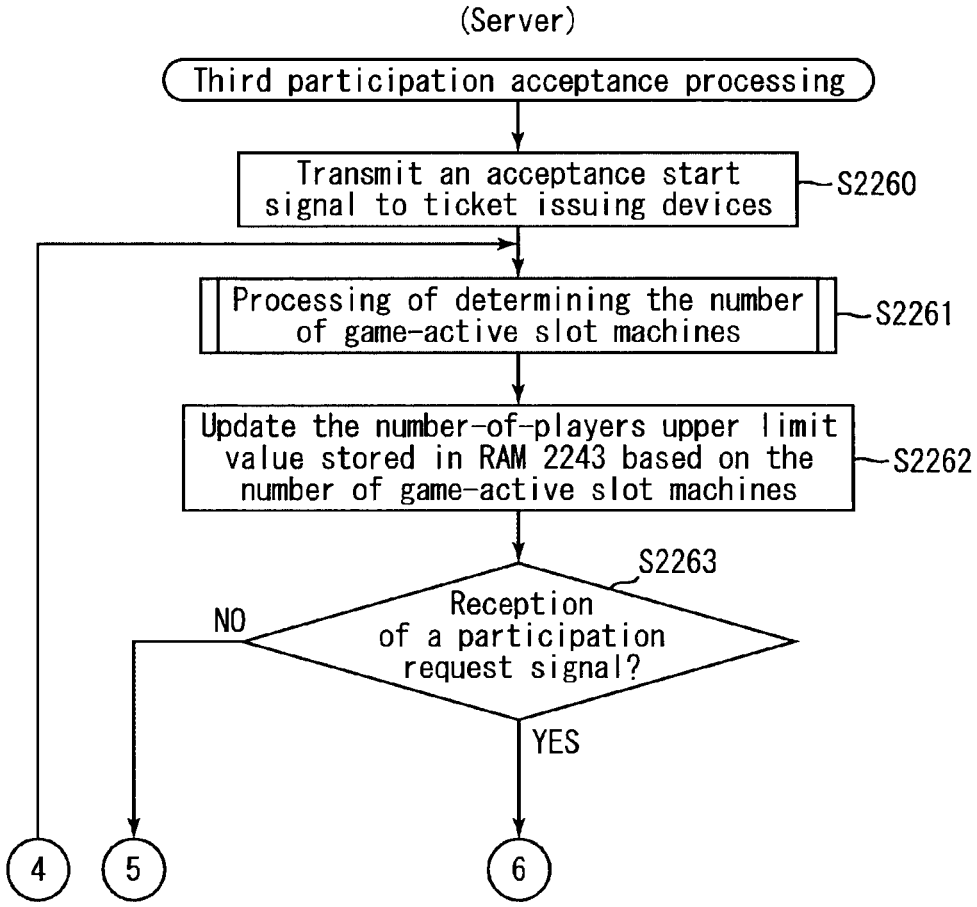
FIG. 71A is a flowchart illustrating a subroutine of third participation acceptance processing.

FIG. 71A is a flowchart illustrating a subroutine of the third participation acceptance processing.

Figure 71B:
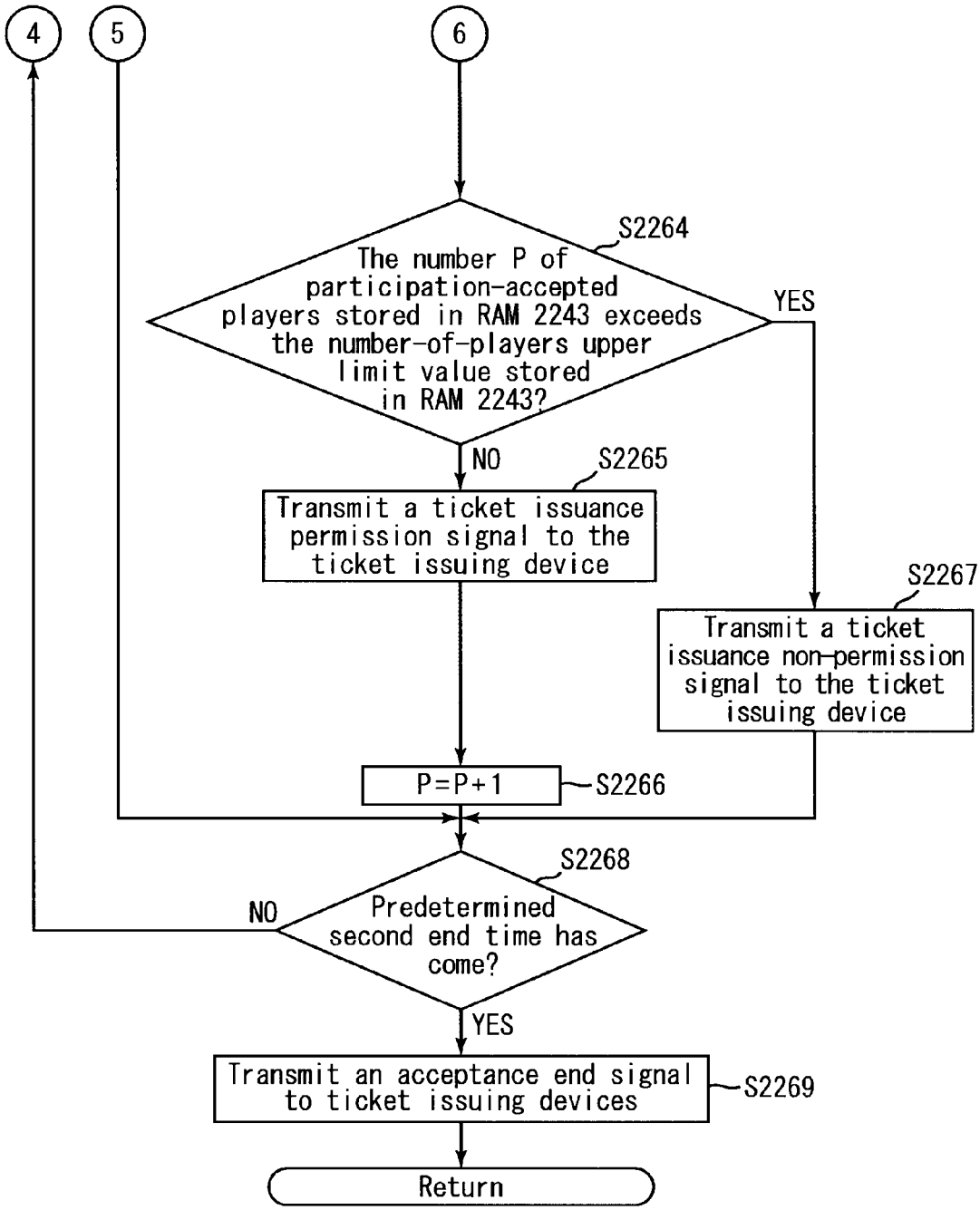
FIG. 71B is another flowchart illustrating the subroutine of the third participation acceptance processing.

FIG. 71B is another flowchart illustrating the subroutine of the third participation acceptance processing.

First, the CPU 2241 transmits an acceptance start signal to the ticket issuing devices 2300 (step S2260).

The CPU 2241 then executes the processing of determining the number of game-active slot machines (step S2261). In the processing, the CPU 2241 determines the number of game-active slot machines which indicates the number of slot machines where a game is played. The processing of determining the number of game-active slot machines will be described later with reference to a drawing.

The CPU 2241 updates the number-of-players upper limit value stored in the RAM 2243, based on the number of game-active slot machines determined in step S2261 (step S2262). In the third embodiment, as described above, the CPU 2241 subtracts the number of game-active slot machines from 50, which is the total number of the slot machines 2010. That is, the CPU 2241 determines the number of slot machines 2010 on which no game is played. Thereafter, the CPU 2241 obtains a numeric value by multiplying the number of slot machines 2010 on which no game is played by 0.7 and truncating the digits after the decimal point, and then determines the obtained value as the number-of-players upper limit value. After that, the CPU 2241 stores into the RAM 2243 the determined number-of-players upper limit value as an updated number-of-players upper limit value.

The CPU 2241 determines whether or not the CPU 2241 has received a participation request signal from any of the ticket issuing devices 2300 (step S2263). When the CPU 2241 determines that the CPU 2241 has not received a participation request signal, the CPU 2241 shifts the processing to step S2268.

On the other hand, when the CPU 2241 determines in step S2263 that the CPU 2241 has received a participation request signal, the CPU 2241 determines whether or not the number P of participation-accepted players in the RAM 2243 exceeds the number-of-players upper limit value in the RAM 2243 (step S2264). When determining that the number P of participation-accepted players does not exceed the number-of-players upper limit value, the CPU 2241 transmits a ticket issuance permission signal to the ticket issuing device 2300 as the transmission source of the participation request signal (step S2265). Then, the CPU 2241 stores into the RAM 2243 a numeric value obtained by adding 1 to the number P of participation-accepted players in the RAM 2243 as an updated number P of participation-accepted players (step S2266).

On the other hand, when determining in step S2264 that the number P of participation-accepted players exceeds the number-of-players upper limit value, the CPU 2241 transmits a ticket issuance non-permission signal to the ticket issuing device 2300 as the transmission source of the participation request signal (step S2267).

When the CPU 2241 determines in step S2263 that the CPU 2241 has not received a participation request signal, or when the CPU 2241 has executed the processing of step S2266 or step S2267, the CPU 2241 determines whether or not the predetermined second end time has come (step S2268). In the processing, the CPU 2241 determines whether or not the time shown by the clock 2249 is the predetermined second end time. When determining that the predetermined second end time has not come yet, the CPU 2241 returns the processing to step S2261.

On the other hand, when determining in step S2268 that the predetermined second end time has come, the CPU 2241 transmits an acceptance end signal to the ticket issuing devices 2300 (step S2269).

After executing the processing of step S2269, the CPU 2241 ends the present subroutine.

Execution of the third participation acceptance processing makes it possible to issue a ticket 2500 with a barcode based on the operational status of the gaming machines, until just before the tournament-type game starts.

Figure 72:
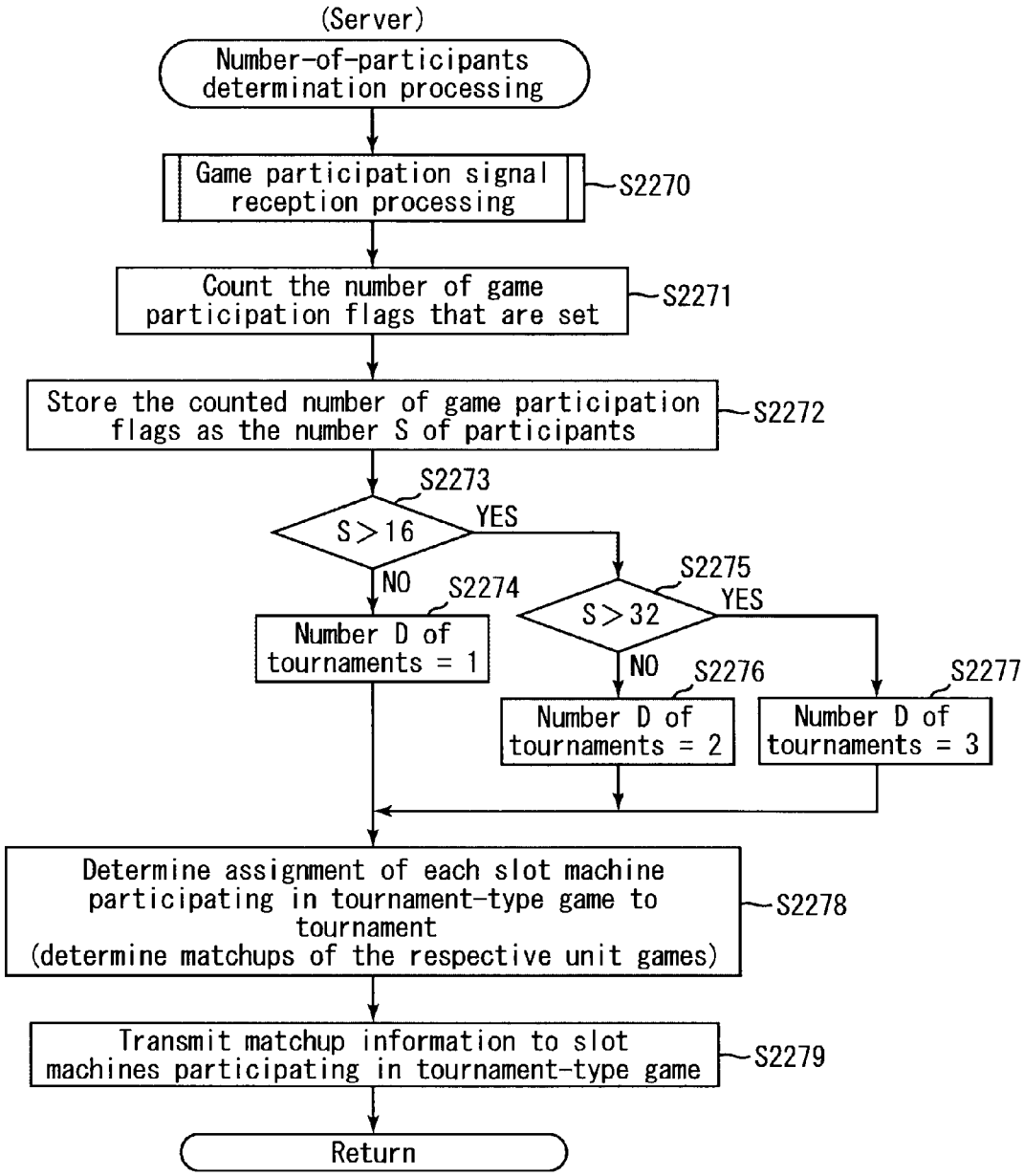
FIG. 72 is a flowchart illustrating a subroutine of number-of-participants determination processing.

FIG. 72 is a flowchart illustrating a subroutine of the number-of-participants determination processing.

First, the CPU 2241 executes game participation signal reception processing (step S2270). In the processing, when receiving a game participation signal, the CPU 2241 sets a game participation flag in association with the identification number of the slot machine 2010 as the transmission source. The game participation signal reception processing will be described later with reference to a drawing.

The CPU 2241 counts the number of game participation flags that are set (step S2271). Then, the CPU 2241 stores the counted number of game participation flags into the RAM 2243 as the number S of participants (step S2272).

The CPU 2241 determines whether or not the number S of participants in the RAM 2243 is more than 16 (step S2273). When determining that the number S of participants is not more than 16, the CPU 2241 determines 1 as the number D of tournaments which indicates the number of tournaments in a tournament-type game (step S2274). The CPU 2241 then stores 1 into the RAM 2243 as the number D of tournaments.

On the other hand, when determining in step S2273 that the number S of participants is more than 16, the CPU 2241 determines whether or not the number S of participants in the RAM 2243 is more than 32 (step S2275). When determining that the number S of participants is not more than 32, the CPU 2241 determines 2 as the number D of tournaments which indicates the number of tournaments in a tournament-type game (step S2276). The CPU 2241 then stores 2 into the RAM 2243 as the number D of tournaments.

On the other hand, when determining in step S2275 that the number S of participants is more than 32, the CPU 2241 determines 3 as the number D of tournaments which indicates the number of tournaments in a tournament-type game (step S2277). The CPU 2241 then stores 3 into the RAM 2243 as the number D of tournaments.

In the third embodiment, the number of tournaments in a tournament-type game is changed in accordance with the number S of participants. This will avoid a situation in which the time it takes from beginning to end of a tournament-type game is long because one tournament includes too many participating players; as a result, it is possible to prevent players from getting tired of the game.

Further, when a tournament-type game starts, matches are held in respective tournaments. That is, matches in the respective tournaments are simultaneously held. In the third embodiment, the maximum number of tournaments is 3. Increasing the number of tournaments makes it possible to increase the number of players who can be accepted to participate in the tournament-type game.

When executing the processing of step S2274, step S2276, or step S2277, the CPU 2241 determines assignment of the slot machines 2010 participating in the tournament-type game to the tournaments (step S2278). In the processing, the CPU 2241 first identifies the number D of tournaments which has been determined in the processing of step S2274, step S2276, or step S2277. Next, the CPU 2241 determines the number of tournament participants which indicates the number of players who participate in one tournament, based on the identified number D of tournaments and the number S of participants. For example, when the number D of tournaments is 2 and the number S of participants is 30, the number of tournament participants is 15.

Then, the CPU 2241 assigns the slot machines 2010 to a tournament tree from the left in the ascending order of the identification numbers of the slot machines 2010 such that a slot machine 2010 with the smallest identification number among the participating slot machines 2010 is assigned to the leftmost position. When the CPU 2241 has filled the tournament tree (when assignment of the slot machines 2010 in number equal to the number of tournament participants has been completed), the CPU 2241 starts assigning the slot machines 2010 to the next tournament tree in the same way.

In a tournament, matches each involving two slot machines are held. A group consisting of two slot machines competing with each other in a match corresponds to a game group in the present invention.

A match held for each two slot machines (a game executed in each slot machine 2010 by executing the processing of step S2064 to step S2075 (see FIG. 83A and FIG. 83B)) corresponds to a unit game in the present invention.

In the processing of step S2278, matchups for the respective unit games (matches) in the respective tournaments are determined.

The CPU 2241 transmits as matchup information the assignment of the slot machines 2010 participating in the tournament-type game to the tournaments (the assignments determined in step S2278) to the slot machines 2010 participating in the tournament-type game (step S2279).

After executing the processing of step S2279, the CPU 2241 ends the present subroutine.

The matchup information corresponds to participation determined game information.

Figure 73:
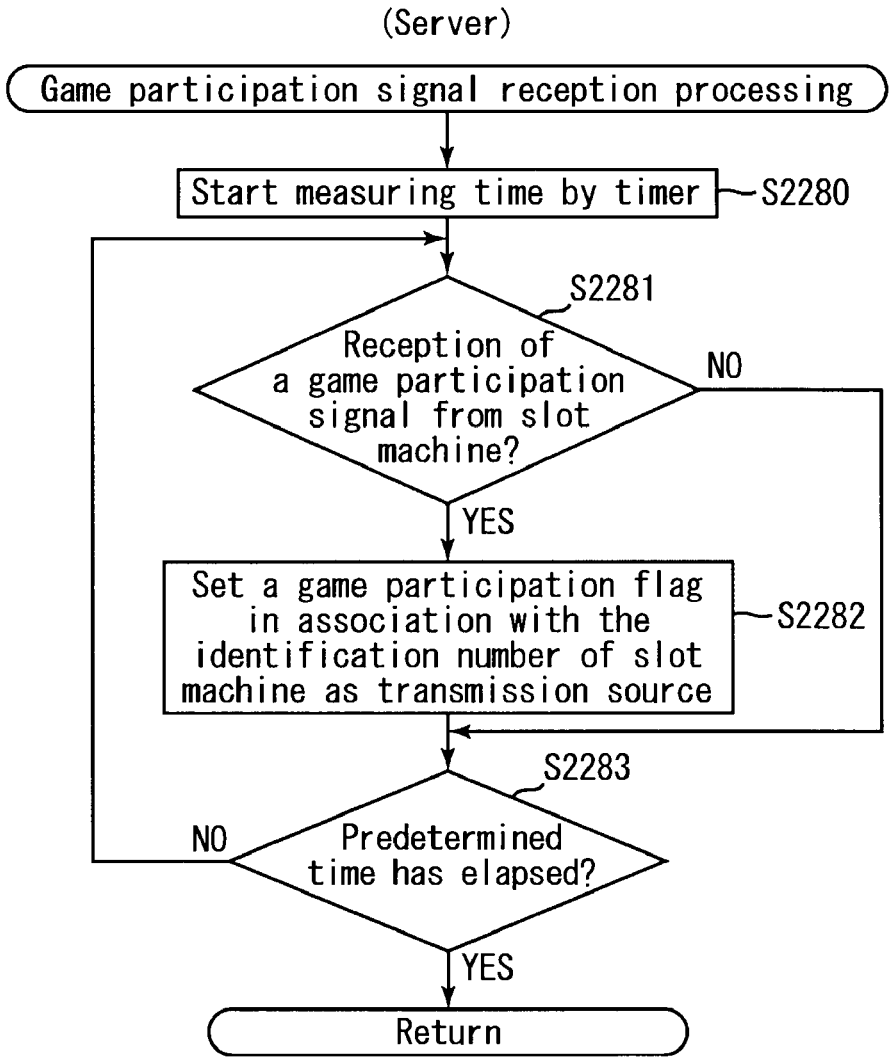
FIG. 73 is a flowchart illustrating a subroutine of game participation signal reception processing.

FIG. 73 is a flowchart illustrating a subroutine of game participation signal reception processing.

First, the CPU 2241 starts measuring time with the timer 2245, at a predetermined timing (step S2280).

Next, the CPU 2241 determines whether or not the CPU 2241 has received a game participation signal from any of the slot machines 2010 (step S2281). When the CPU 2241 determines that the CPU 2241 has received a game participation signal, the CPU 2241 sets a game participation flag in association with the identification number of the slot machine 2010 as the transmission source of the game participation signal (step S2282).

When the CPU 2241 determines in step S2281 that the CPU 2241 has not received a game participation signal, or after the CPU 2241 has executed the processing of step S2282, the CPU 2241 determines whether or not the predetermined time has elapsed (step S2283). In the processing, the CPU 2241 determines whether or not the time measured with the timer 2245 has reached the predetermined time. When determining that the predetermined time has not elapsed, the CPU 2241 returns the processing to step S2281.

On the other hand, when determining in step S2283 that the predetermined time has elapsed, the CPU 2241 ends the present subroutine.

Figure 74A:
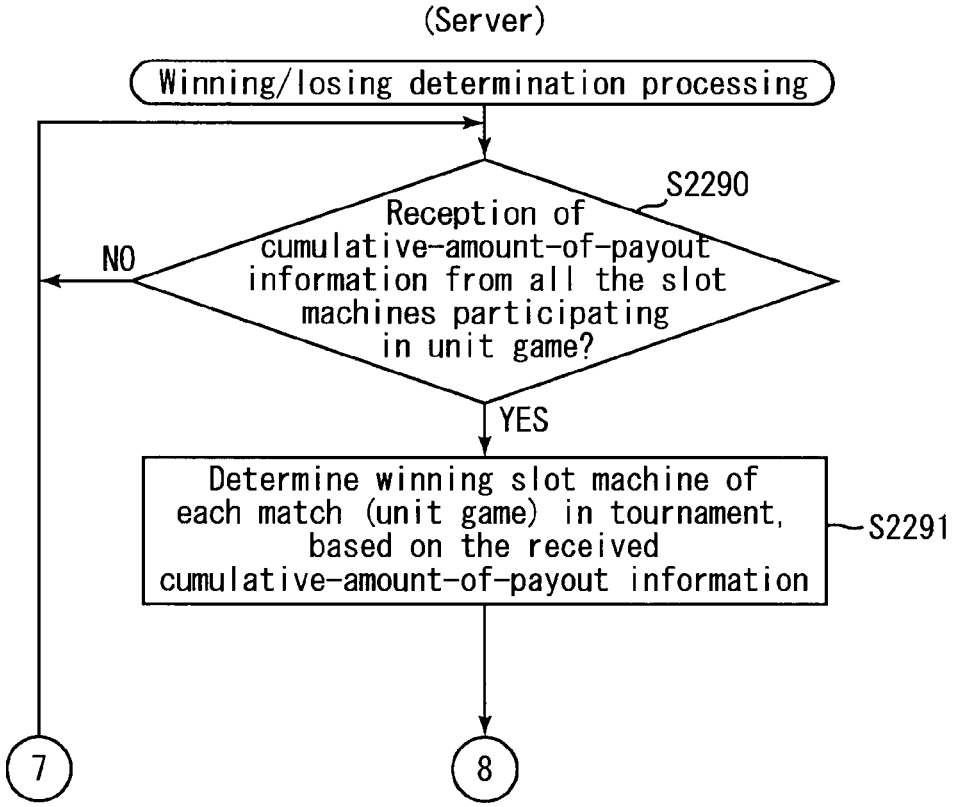
FIG. 74A is a flowchart illustrating a subroutine of winning/losing determination processing.

FIG. 74A is a flowchart illustrating a subroutine of the winning/losing determination processing.

Figure 74B:
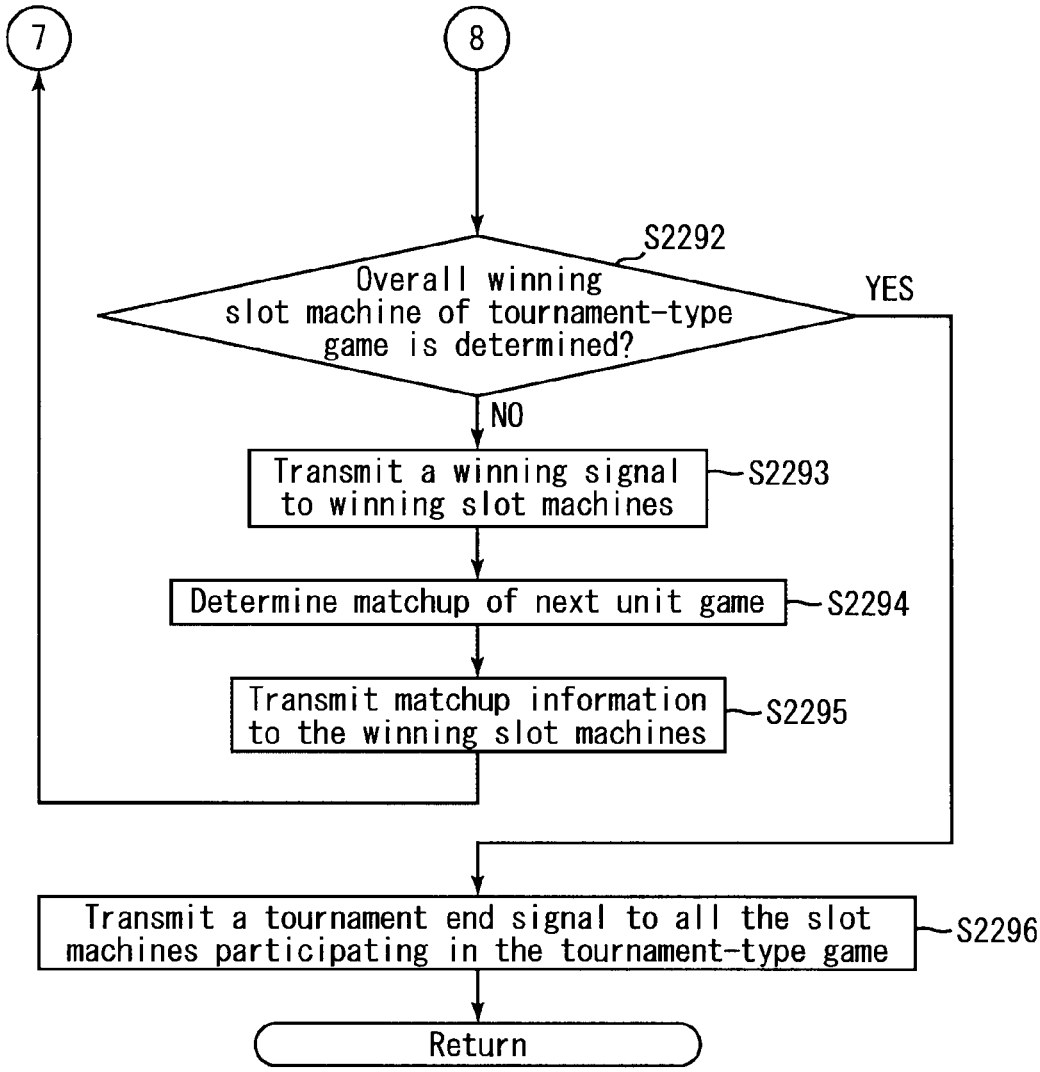
FIG. 74B is another flowchart illustrating the subroutine of the winning/losing determination processing.

FIG. 74B is another flowchart illustrating the subroutine of the winning/losing determination processing.

First, the CPU 2241 determines whether or not the CPU 2241 has received cumulative-amount-of-payout information from every slot machine participating in a unit game (step S2290). When the CPU 2241 determines that the CPU 2241 has not received cumulative-amount-of-payout information from every slot machine participating in a unit game, the CPU 2241 returns the processing to step S2290.

On the other hand, when the CPU 2241 determines that the CPU 2241 has received cumulative-amount-of-payout information from every slot machine participating in a unit game, the CPU 2241 determines the winning slot machine of each match (unit game) in the tournaments (step S2291). In the processing, the CPU 2241 determines for each match the slot machine 2010 with the cumulative-amount-of-payout information which shows a cumulative amount of payout larger than that of the cumulative-amount-of-payout information of the other slot machine 2010 as the winning slot machine of the match. The determination is made based on the received pieces of cumulative-amount-of-payout information; the identification number of the slot machine 2010 included in each piece of cumulative-amount-of-payout information; and the matchups of the respective unit games (matches) in the respective tournaments which have been determined in step S2278.

The CPU 2241 then determines whether or not the overall winning slot machine of the tournament-type game has been determined (step S2292). In the processing, the CPU 2241 determines whether or not only one slot machine 2010 has been determined as the winning slot machine in every tournament. That is, in step S2292, whether or not the overall winning slot machine 2010 in every tournament is determined.

When the CPU 2241 determines in step S2292 that the overall winning slot machine of the tournament-type game has not been determined, the CPU 2241 transmits a winning signal to the slot machines 2010 that have been determined as the winning slot machines (step S2293). It should be noted that when only one slot machine 2010 has been determined as the winning slot machine in a tournament, the CPU 2241 does not transmit the winning signal to the slot machine that has been determined as the winning slot machine in this tournament. That is, the CPU 2241 does not transmit the winning signal to the slot machine 2010 that has been determined as the overall winner.

The CPU 2241 determines matchups for the next unit games (matches) (step S2294). In the processing, the CPU 2241 determines the matchups of the next unit games (matches), based on the winning slot machines determined in step S2291 and assignment of the slot machines 2010 to the tournaments which has been determined in step S2278.

The CPU 2241 transmits as matchup information the matchups of the unit games (matches) determined in step S2294 to the slot machines 2010 that have been determined as the winning slot machines (step S2295).

After executing the processing of step S2295, the CPU 2241 returns the processing to step S2290.

When determining in step S2292 that the overall winning slot machine of the tournament-type game has been determined, the CPU 2241 transmits a tournament end signal to all the slot machines 2010 that participate in the tournament-type game (step S2296). In the processing, the CPU 2241 transmits the tournament end signal to the slot machines 2010 for each of which a game participation flag is set in association with the identification number. The tournament end signal includes information on the ranking for each tournament in the executed tournament-type game. That is, the ranking of the respective slot machines is determined before the tournament end signal is transmitted. The slot machine 2010 that has been determined as the overall winner takes first place, and the ranks of the respective other slot machines 2010 are determined in order.

Figure 75:
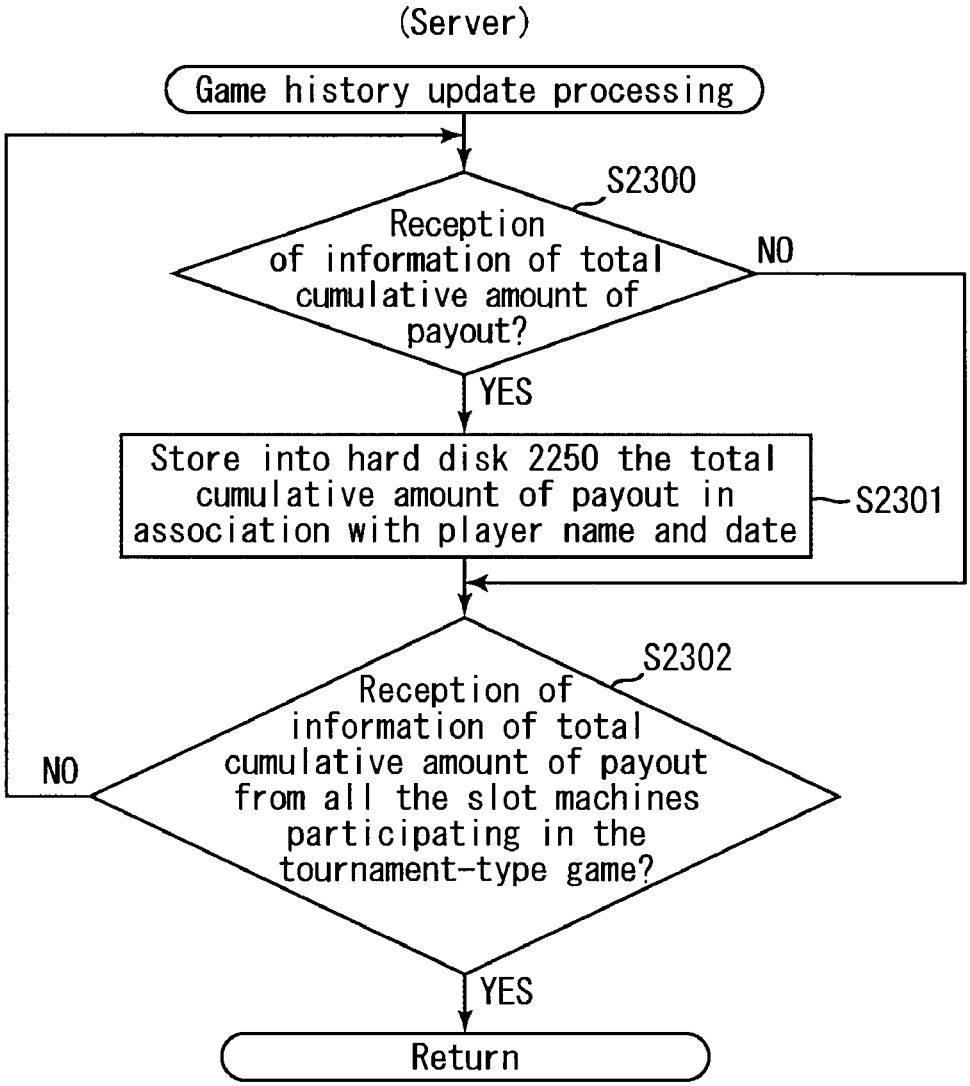
FIG. 75 is a flowchart illustrating a subroutine of game-history update processing.

FIG. 75 is a flowchart illustrating a subroutine of the game-history update processing.

First, the CPU 2241 determines whether or not the CPU 2241 has received total-cumulative-amount-of-payout information (step S2300). When the CPU 2241 determines that the CPU 2241 has received total-cumulative-amount-of-payout information, the CPU 2241 stores the total cumulative amount of payout shown by the total-cumulative-amount-of-payout information into the hard disk 2250 in association with the player name and today's date which are included in the total-cumulative-amount-payout information (step S2301).

When the CPU 2241 determines in step S2300 that the CPU 2241 has not received total-cumulative-amount-of-payout information, or when the CPU 2241 has executed the processing of step S2301, the CPU 2241 determines whether or not the CPU 2241 has received total-cumulative-amount-of-payout information from every slot machine 2010 participating in the tournament-type game (step S2302). When the CPU 2241 determines that the CPU 2241 has not received total-cumulative-amount-of-payout information from every slot machine 2010 participating in the tournament-type game, the CPU 2241 returns the processing to step S2300. On the other hand, when the CPU 2241 determines that the CPU 2241 has received total-cumulative-amount-of-payout information from every slot machine 2010, the CPU 2241 ends the present subroutine.

Figure 76:
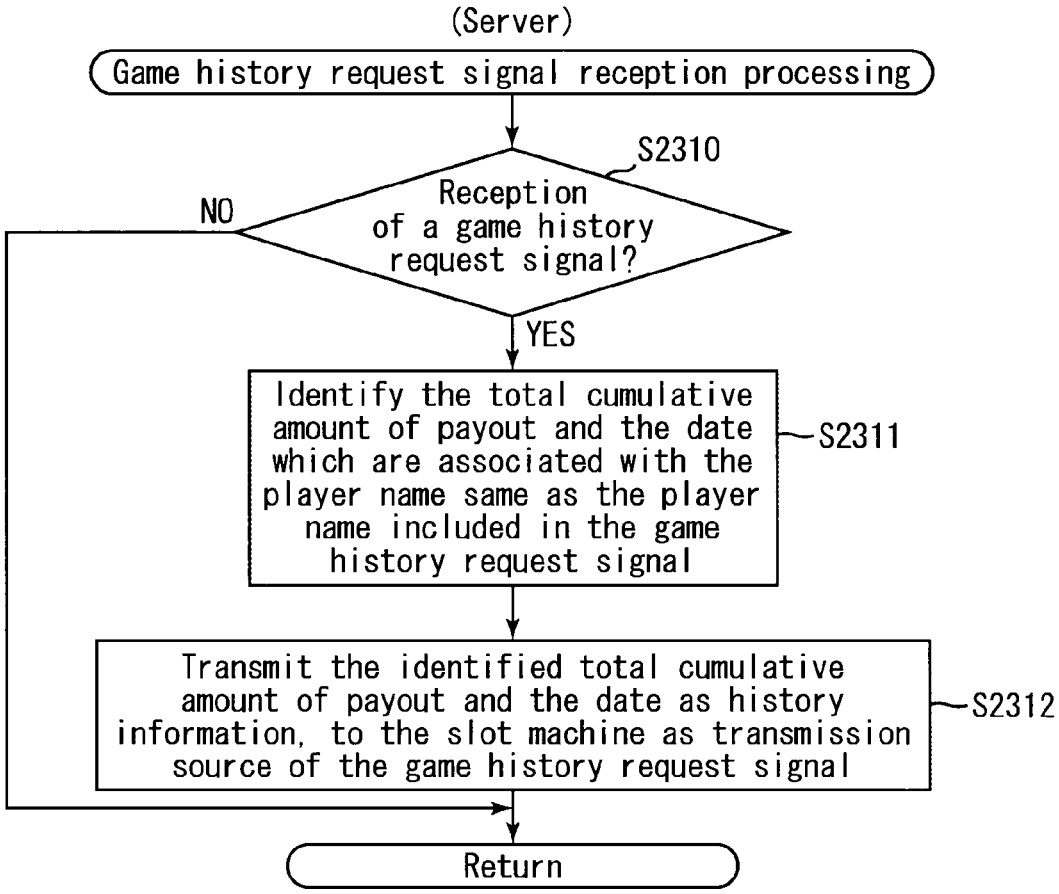
FIG. 76 is a flowchart illustrating a subroutine of game-history request signal reception processing.

FIG. 76 is a flowchart illustrating a subroutine of game-history request signal reception processing.

First, the CPU 2241 determines whether or not the CPU 2241 has received a game-history request signal from any of the slot machines 2010 (step S2310). When the CPU 2241 determines that the CPU 2241 has not received a game-history request signal from any of the slot machines 2010, the CPU 2241 ends the present subroutine.

On the other hand, when the CPU 2241 determines in step S2310 that the CPU 2241 has received a game-history request signal from any of the slot machines 2010, the CPU 2241 identifies the total cumulative amount of payout and the date which are stored in the hard disk 2250 in association with the player name that is same as the player name included in the received game-history request signal (step S2311).

The CPU 2241 then transmits as history information the total cumulative amount of payout and the date, which have been identified in step S2311, to the slot machine 2010 as the transmission source of the game-history request signal (step S2312).

When the CPU 2241 determines in step S2310 that the CPU 2241 has not received a game-history request signal from any one of the slot machines 2010 or after the CPU 2241 has executed the processing of step S2312, the CPU 2241 ends the present subroutine.

Figure 77:
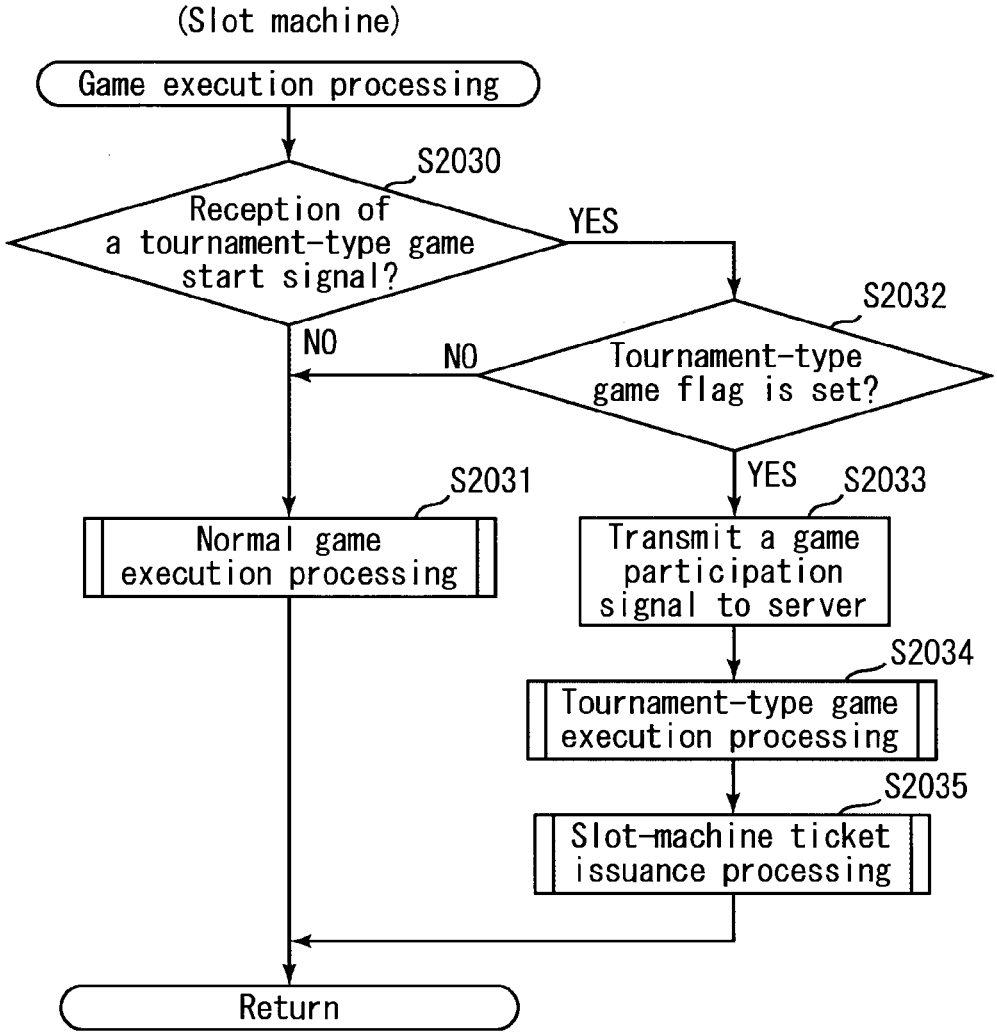
FIG. 77 is a flowchart illustrating game execution processing executed in each slot machine.

FIG. 77 is a flowchart illustrating game execution processing that is executed in each slot machine.

First, the main CPU 2041 determines whether or not the main CPU 2041 has received the tournament-type game start signal from the server 2200, at a predetermined timing (step S2030). When the main CPU 2041 determines that the main CPU 2041 has not received the tournament-type game start signal, the main CPU 2041 executes normal-game execution processing (step S2031). The normal-game execution processing will be described later in detail with reference to a drawing.

On the other hand, when the main CPU 2041 determines in step S2030 that the main CPU 2041 has received a tournament-type game start signal, the main CPU 2041 determines whether or not the tournament-type game flag is set (step S2032). The tournament-type game flag is set in flag setting processing shown in FIG. 78 or participation check signal reception processing shown in FIG. 79.

When the main CPU 2041 determines in step S2032 that the tournament-type game flag is not set, the main CPU 2041 executes the normal-game execution processing (step S2031). The normal-game execution processing will be described later in detail with reference to a drawing.

On the other hand, when the main CPU 2041 determines in step S2032 that the tournament-type game flag is set, the main CPU 2041 transmits a game participation signal to the server 2200 (step S2033). The game participation signal includes the identification number of the slot machine 2010.

The main CPU 2041 executes tournament-type game execution processing (step S2034). The tournament-type game execution processing will be described later with reference to drawings.

The main CPU 2041 executes slot-machine ticket issuance processing (step S2035). The slot-machine ticket issuance processing will be described later with reference to drawings.

When executing the processing of step S2031 or step S2035, the main CPU 2041 ends the game execution processing.

Figure 78:
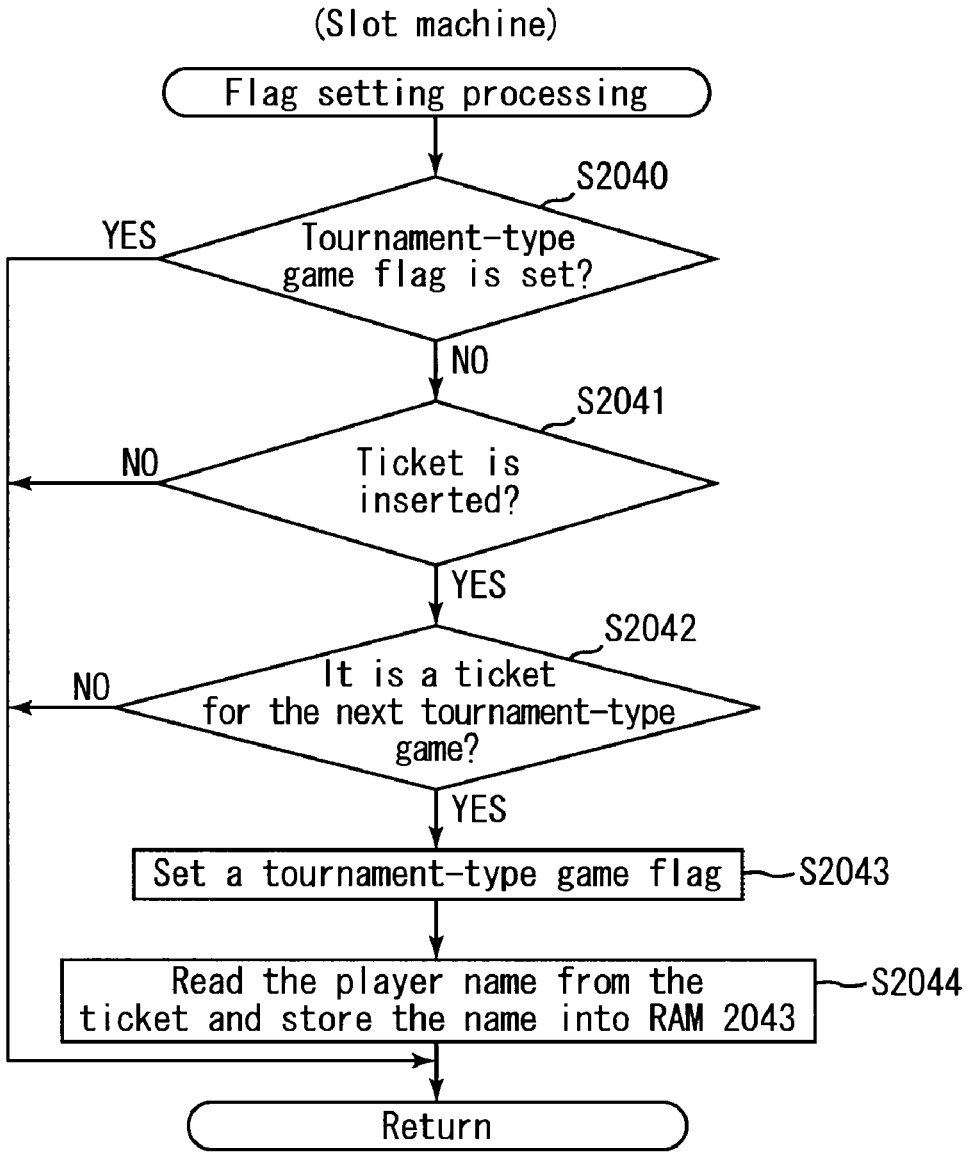
FIG. 78 is a flowchart illustrating a subroutine of flag setting processing.

FIG. 78 is a flowchart illustrating a subroutine of the flag setting processing.

The main CPU 2041 first determines whether or not the tournament-type game flag is set, at a predetermined timing (step S2040). When determining that the tournament-type game flag is set, the main CPU 2041 ends the present subroutine.

On the other hand, when determining in step S2040 that the tournament-type game flag is not set, the main CPU 2041 determines whether or not a ticket 2500 with a barcode is inserted into the bill validator 2022 (step S2041). When determining that a ticket 2500 with a barcode is not inserted into the bill validator 2022, the main CPU 2041 ends the present subroutine.

On the other hand, when determining in step S2041 that a ticket 2500 with a barcode is inserted into the bill validator 2022, the main CPU 2041 determines whether or not the ticket 2500 with a barcode that has been inserted into the bill validator 2022 is a ticket 2500 with a barcode for participating in the next tournament-type game (step S2042). In the third embodiment, a tournament-type game is executed every two hours. Therefore, in the processing of step S2042, the main CPU 2041 determines whether or not the start time of the tournament-type game that the main CPU 2041 has read from the ticket 2500 with a barcode inserted into the bill validator 2022 is within two hours from the time shown by the clock 2062.

When determining in step S2042 that the ticket 2500 with a barcode inserted into the bill validator 2022 is not a ticket 2500 with a barcode for participating in the next tournament-type game, the main CPU 2041 ends the present subroutine.

When determining in step S2042 that the ticket 2500 with a barcode inserted into the bill validator 2022 is a ticket 2500 with a barcode for participating in the next tournament-type game, the main CPU 2041 sets the tournament-type game flag (step S2043).

Next, the main CPU 2041 reads the player name from the ticket 2500 with a barcode inserted into the bill validator 2022, and stores the read player name into the RAM 2043 (step S2044).

The player name corresponds to the identification information in the present invention.

After executing the processing of step S2044, the main CPU 2041 ends the present subroutine.

Figure 79:
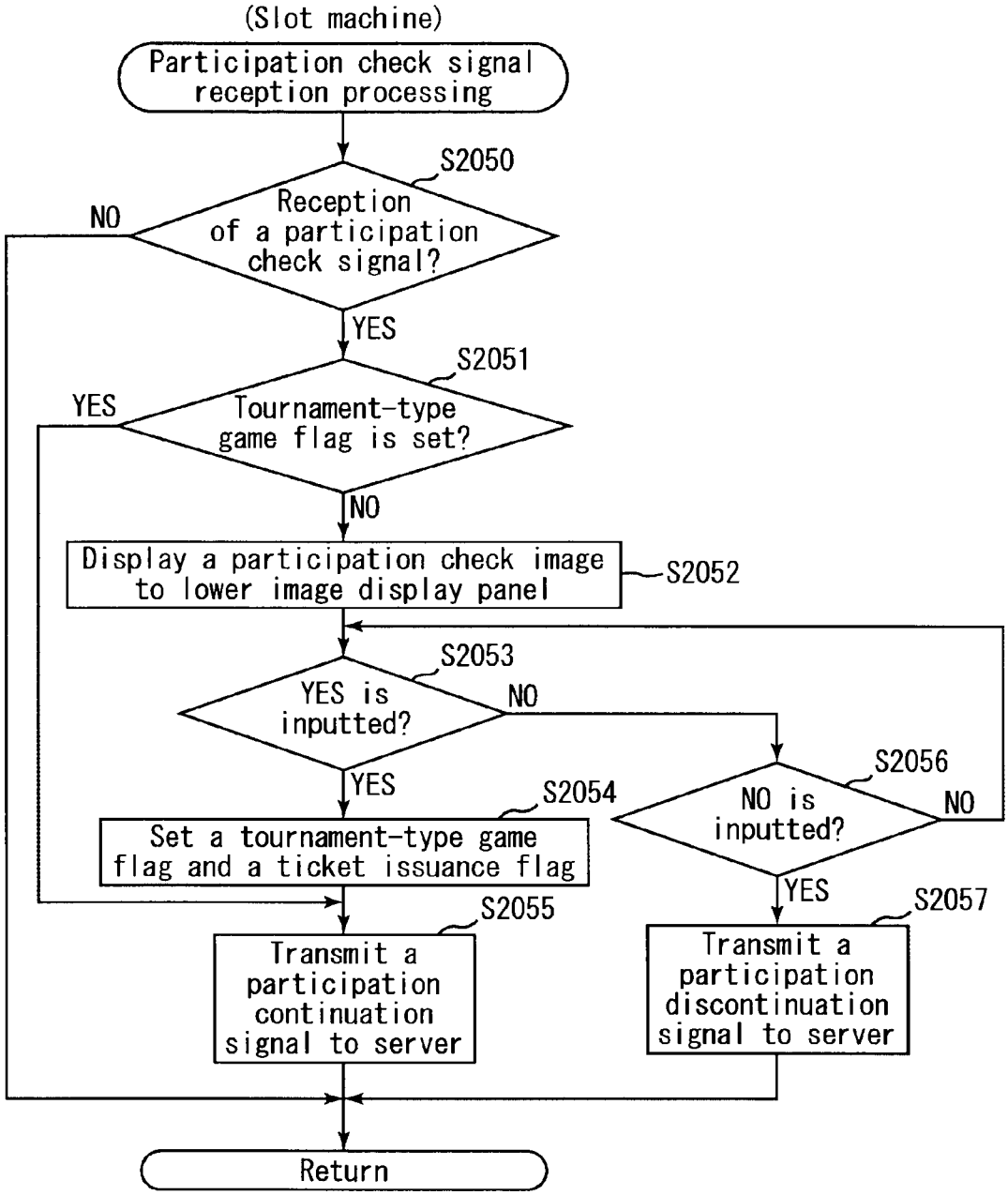
FIG. 79 is a flowchart illustrating a subroutine of participation check signal reception processing.

FIG. 79 is a flowchart illustrating a subroutine of the participation check signal reception processing.

First, the main CPU 2041 determines whether or not the main CPU 2041 has received the participation check signal from the server 2200 (step S2050). When the main CPU 2041 determines that the main CPU 2041 has not received the participation check signal, the main CPU 2041 ends the present subroutine.

On the other hand, when the main CPU 2041 determines in step S2050 that the main CPU 2041 has received the participation check signal, the main CPU 2041 determines whether or not the tournament-type game flag is set (step S2051). When determining that the tournament-type game flag is set, the main CPU 2041 shifts the processing to step S2055.

On the other hand, when determining in step S2051 that the tournament-type game flag is not set, the main CPU 2041 displays a participation check image to the lower image display panel 2016 (step S2052).

Figure 80:
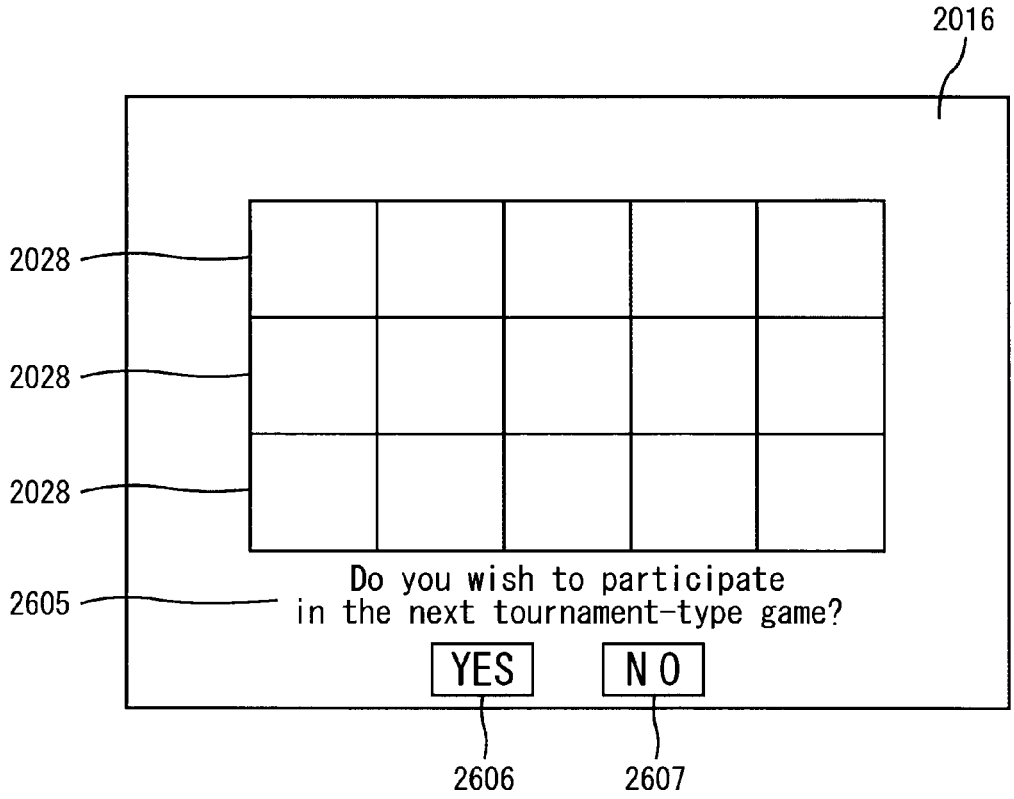
FIG. 80 is a view illustrating an exemplary image displayed to a lower image display panel provided in each slot machine constituting the gaming system according to the third embodiment of the present invention.

FIG. 80 is a view illustrating an exemplary image that is displayed to the lower image display panel provided in each slot machine constituting the gaming system according to the third embodiment of the present invention.

In FIG. 80, a participation check image 2605 is displayed below the display blocks 2028 that are displayed to the lower image display panel 2016. Below the participation check image 2605, a YES image 2606 and a NO image 2607 are displayed.

The participation check image 2605 is an image that asks a player whether or not the player wishes to participate in the next tournament-type game. If the player wishes to participate in the next tournament-type game, the player can input "YES" via the touch panel 2069 by touching the portion where the YES image 2606 is displayed, with the finger or the like. On the other hand, if the player wishes not to participate in the next tournament-type game, the player can input "NO" via the touch panel 2069 by touching the portion where the NO image 2607 is displayed, with the finger or the like.

The touch panel 2069 corresponds to the selection input device in the present invention.

Referring back to FIG. 79, the main CPU 2041 determines whether or not "YES" has been inputted (step S2053). When determining that "YES" has been inputted, the main CPU 2041 sets the tournament-type game flag and a ticket issuance flag (step S2054).

When determining in step S2051 that the tournament-type game flag is set, or when executing the processing of step S2054, the main CPU 2041 transmits a participation continuation signal to the server 2200 (step S2055).

On the other hand, when determining in step S2053 that "YES" has not been inputted, the main CPU 2041 determines whether or not "NO" has been inputted (step S2056). When determining that "NO" has not been inputted, the main CPU 2041 returns the processing to step S2053.

On the other hand, when determining in step S2056 that "NO" has been inputted, the main CPU 2041 transmits a participation discontinuation signal to the server 2200 (step S2057).

When determining in step S2050 that the main CPU 2041 has not received the participation check signal or when executing the processing of step S2055 or step S2057, the main CPU 2041 ends the present subroutine.

Figure 81:
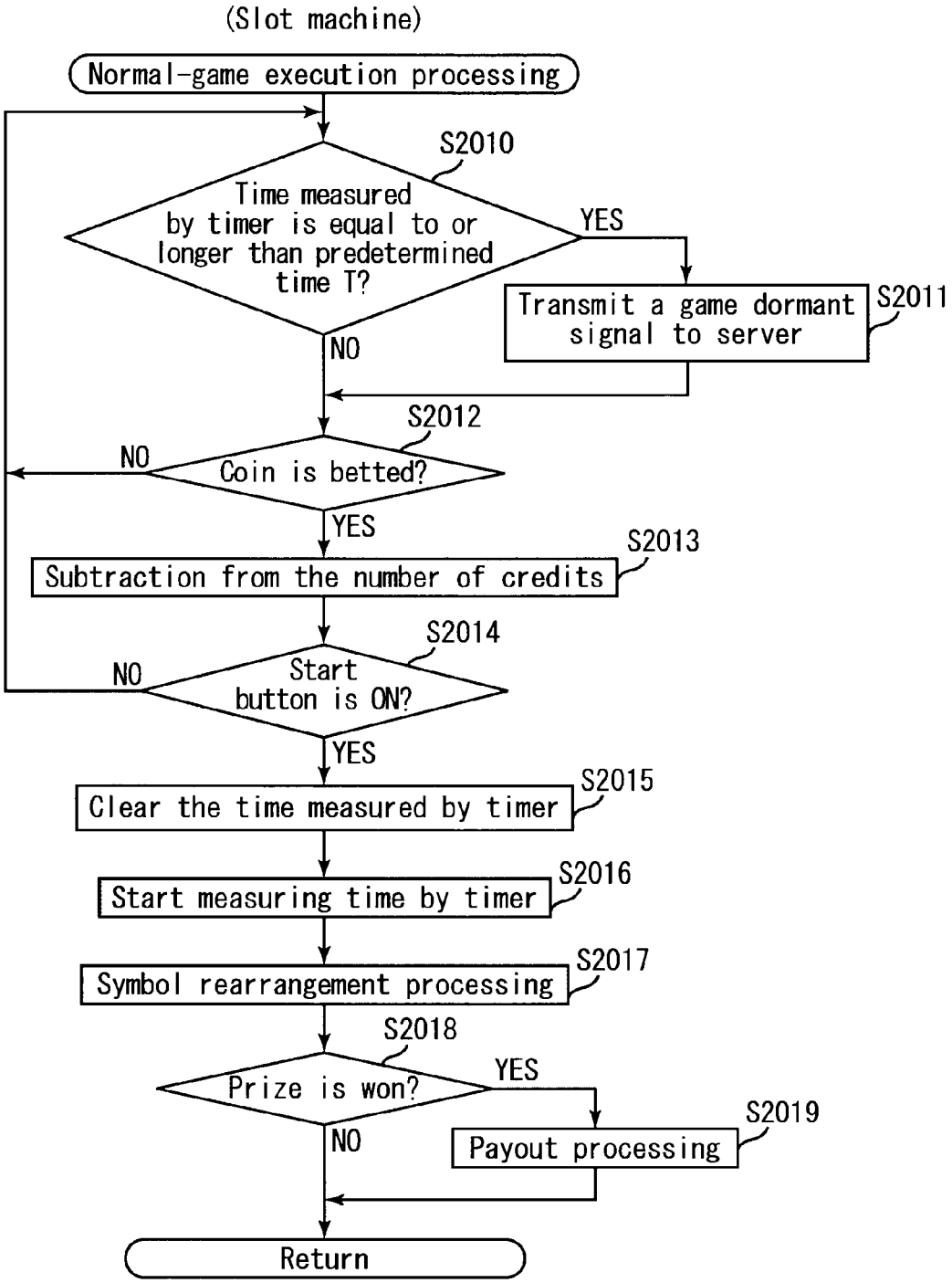
FIG. 81 is a flowchart illustrating a subroutine of normal-game execution processing.

FIG. 81 is a flowchart illustrating a subroutine of normal-game execution processing.

FIG. 82 is a view illustrating correspondence relationship between a type and the number of rearranged symbols and an amount of payout.

First, the main CPU 2041 determines whether or not the time measured with the timer 2061 is equal to or longer than predetermined time T (step S2010).

When determining in step S2010 that the measured time is not equal to or longer than the predetermined time T, the main CPU 2041 shifts the processing to step S2012. On the other hand, when determining in step S2010 that the measured time is equal to or longer than the predetermined time T, the main CPU 2041 transmits a game dormant signal to the server 2200 (step S2011). The game dormant signal includes the identification number of the slot machine 2010.

The main CPU 2041 determines whether or not a coin has been betted (step S2012). In this processing, the main CPU 2041 determines whether or not the main CPU 2041 has received an input signal that is outputted from the 1-BET switch 2026S when the 1-BET button 2026 is operated, or an input signal that is outputted from the maximum BET switch 2027S when the maximum BET button 2027 is operated. When determining that a coin has not been betted, the main CPU 2041 returns the processing to step S2010.

On the other hand, when determining in step S2012 that a coin has been betted, the main CPU 2041 executes processing for making a subtraction from the number of credits stored in the RAM 2043 according to the number of betted coins (step S2013). It is to be noted that, when the number of coins to be betted is larger than the number of credits stored in the RAM 2043, the main CPU 2041 does not execute the processing for making a subtraction from the number of credits stored in the RAM 2043, and returns the processing to step S2010. Further, when the number of coins to be betted exceeds the upper limit of the number of coins that can be betted in one game (50 coins in the third embodiment), the main CPU 2041 does not execute the processing for making a subtraction from the number of credits stored in the RAM 2043, and proceeds with the processing to step S2014.

Next, the main CPU 2041 determines whether or not the start button 2023 has been turned ON (step S2014). In this processing, the main CPU 2041 determines whether or not the main CPU 2041 has received an input signal that is outputted from the start switch 2023S when the start button 2023 is pressed.

When the main CPU 2041 determines that the start button 2023 has not been turned ON, the main CPU 2041 returns the processing to step S2010.

It is to be noted that, when the start button 2023 is not turned ON (e.g. when the start button 2023 is not turned ON and a command to end the game is inputted), the main CPU 2041 cancels the subtraction result in step S2013.

On the other hand, when determining in step S2014 that the start button 2023 is turned ON, the main CPU 2041 clears the time measured with the timer 2061 (step S2015) and starts measurement of the time with the timer 2061 (step S2016).

Next, the main CPU 2041 executes symbol rearrangement processing (step S2017).

In this processing, the main CPU 2041 first starts scroll-display of symbols in the display blocks 2028. Then, the main CPU 2041 executes the aforementioned symbol determination program, so as to determine the symbols to be rearranged, and then rearranges the symbols in the display blocks 2028.

Next, the main CPU 2041 determines whether or not a prize has been won (step S2018). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 2028 (see FIG. 82). In this processing, the main CPU 2041 counts the number of symbols for each type of the symbols rearranged in step S2017. Then, the main CPU 2041 determines whether or not the counted number is three or more.

When determining that a prize has been won, the main CPU 2041 executes processing relating to payout of coins (step S2019). In the processing, the main CPU 2041 determines the amount of payout based on the numbers of rearranged symbols with reference to the odds data stored in the RAM 2043.

The odds data is data indicative of the correspondence relationship between the number of symbols rearranged in the display blocks 2028 and the amount of payout (see FIG. 82).

For example, in the case where three symbols of "SUN" are rearranged after two coins have been betted, 20 (=2×10) coins are paid out.

In the case of accumulating coins, the main CPU 2041 conducts processing for adding the number of credits corresponding to the determined amount of payout to the number of credits stored in the RAM 2043. On the other hand, in the case of paying out coins, the main CPU 2041 transmits a control signal to the hopper 2066 in order to pay out coins in an amount corresponding to the determined amount of payout.

When determining in step S2018 that no prize has been won or after executing the processing of step S2019, the main CPU 2041 ends the present subroutine.

Figure 83A:
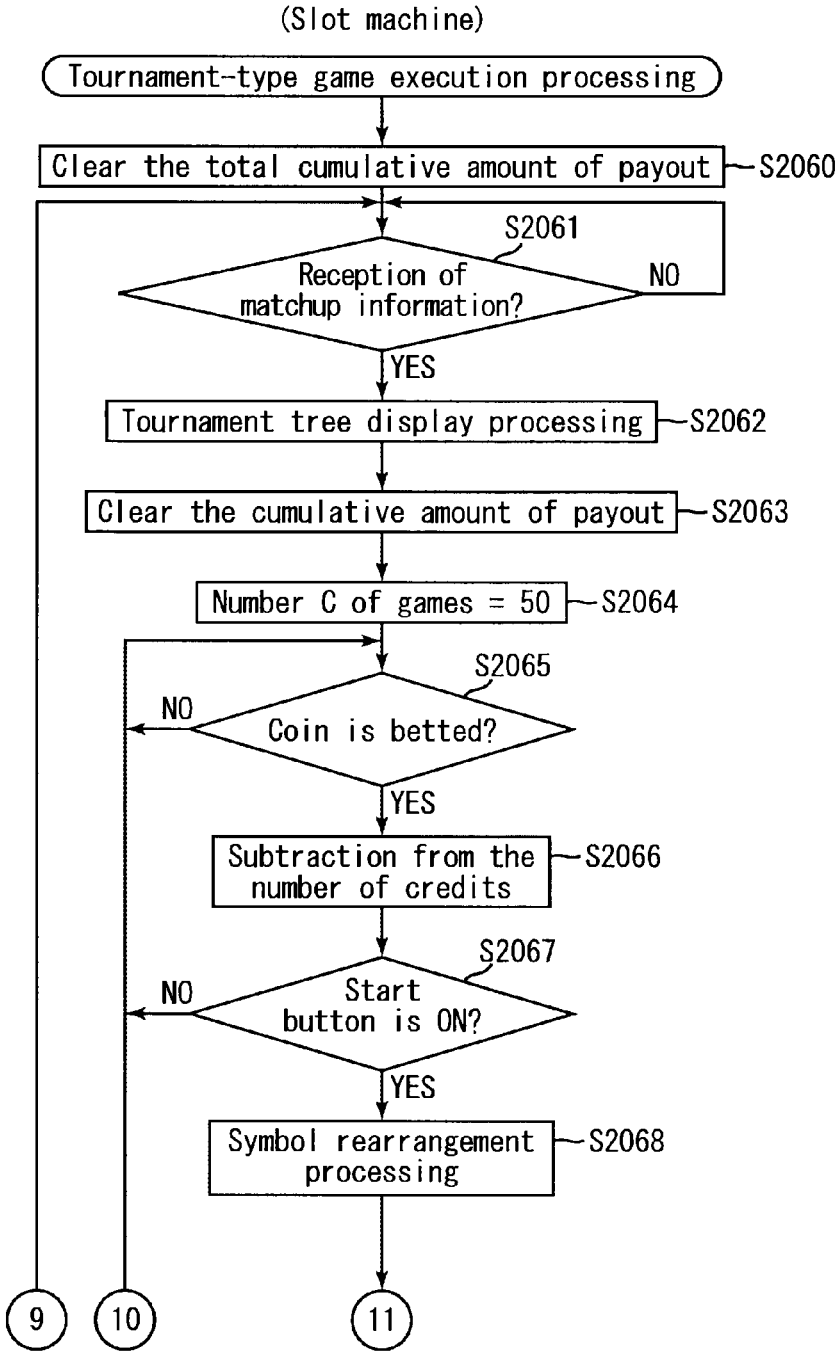
FIG. 83A is a flowchart illustrating a subroutine of tournament-type game execution processing.

FIG. 83A is a flowchart illustrating a subroutine of the tournament-type game execution processing.

Figure 83B:
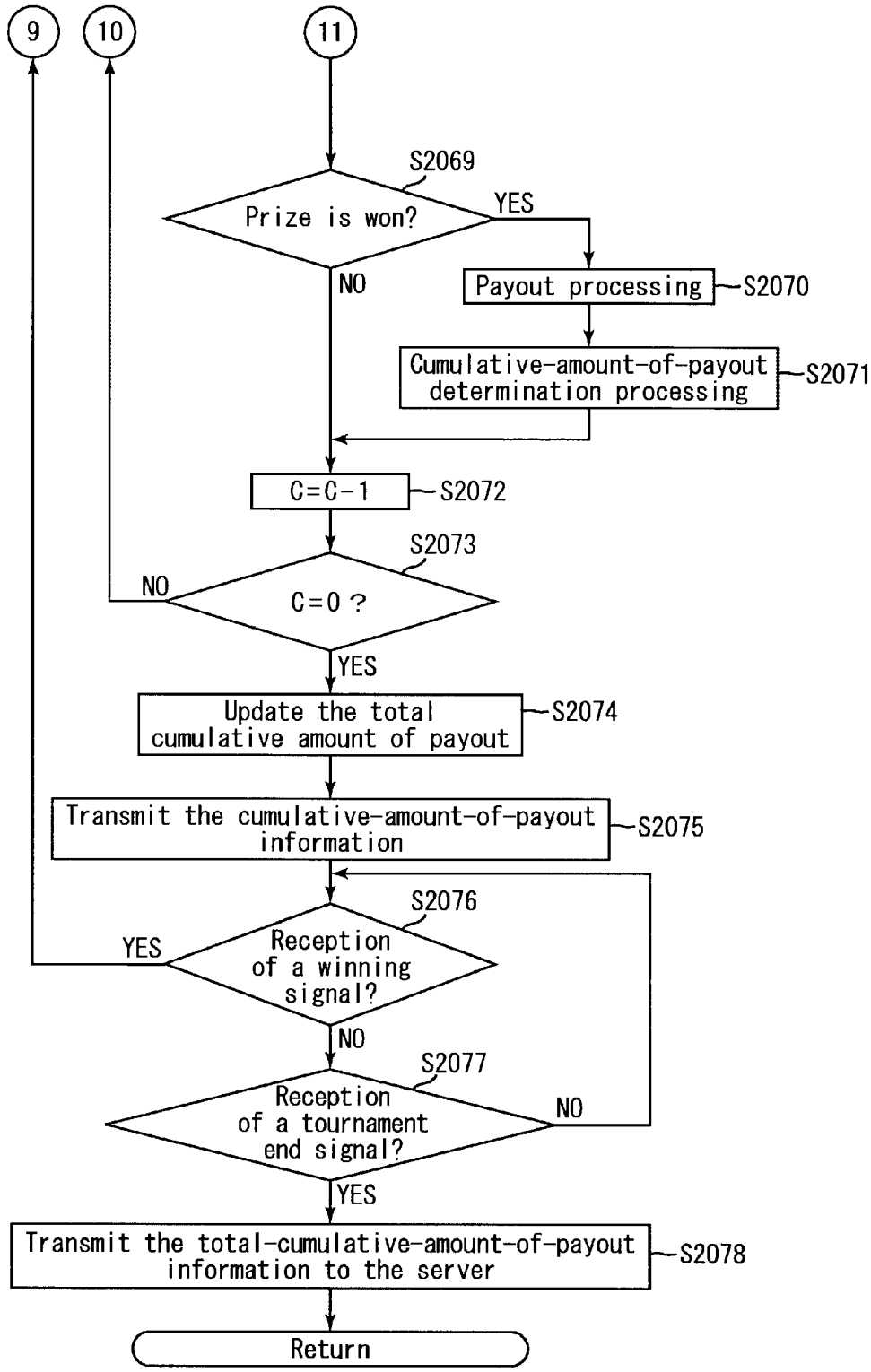
FIG. 83B is another flowchart illustrating the subroutine of the tournament-type game execution processing.

FIG. 83B is another flowchart illustrating the subroutine of the tournament-type game execution processing.

First, the main CPU 2041 stores 0 into the RAM 2043 as an updated total cumulative amount of payout (step S2060).

The main CPU 2041 determines whether or not the main CPU 2041 has received matchup information from the server 2200 (step S2061). When the main CPU 2041 determines that the main CPU 2041 has not received matchup information, the main CPU 2041 returns the processing to step S2061.

On the other hand, when the main CPU 2041 determines in step S2061 that the main CPU 2041 has received matchup information, the main CPU 2041 executes tournament-tree display processing (step S2062). In the processing, the main CPU 2041 displays a tournament tree image to the upper image display panel 2033, based on the received matchup information.

Figure 84:
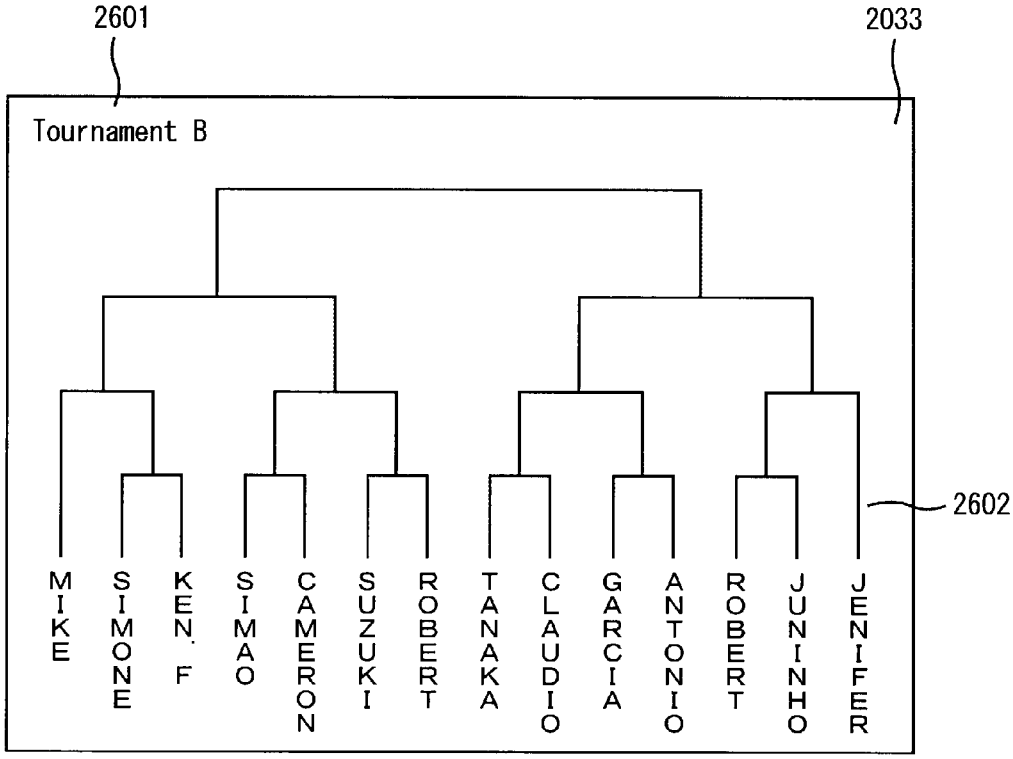
FIG. 84 is a view illustrating an exemplary image that is displayed to an upper image display panel provided in each slot machine constituting the gaming system according to the third embodiment of the present invention.

FIG. 84 is a view illustrating an exemplary image displayed to the upper image display panel that is provided in each slot machine constituting the gaming system according to the third embodiment of the present invention.

In FIG. 84, the upper image display panel 2033 displays a tournament tree image 2602. To the lower part of the tournament tree image 2602, the player names of the players participating in the tournament-type game are displayed. Looking at the tournament tree image 2602, each player gets to know the player name of the player against whom he or she is going to have a match. A tournament name image 2601 shows the name of the tournament.

In the third embodiment, the number of tournaments in a tournament-type game changes within the range of 1 to 3 in accordance with the number S of participants. The name of the first tournament is Tournament A. The name of the second tournament is Tournament B. The name of the third tournament is Tournament C.

In FIG. 84, the tournament name image 2601 says Tournament B. That is, the tournament name image 2601 indicates that this tournament is the second tournament in the tournament-type game.

Referring back to FIG. 83A, the main CPU 2041 stores 0 into the RAM 2043 as an updated cumulative amount of payout (step S2063).

The main CPU 2041 stores 50 into the RAM 2043 as an updated number C of games (step S2064).

The main CPU 2041 determines whether or not a coin has been betted (step S2065). In the processing, the main CPU 2041 determines whether or not the main CPU 2041 has received an input signal outputted from the 1-BET switch 2026S when the 1-BET button 2026 is operated or an input signal outputted from the maximum BET switch 2027S when the maximum BET button 2027 is operated. When determining that a coin has not been betted, the main CPU 2041 returns the processing to step S2065.

On the other hand, when determining in step S2065 that a coin has been betted, the main CPU 2041 conducts processing of making a subtraction from the number of credits stored in the RAM 2043 in accordance with the number of the betted coins (step S2066). Here, in the case that the number of betted coins is larger than the number of credits stored in the RAM 2043, the main CPU 2041 returns the processing to step S2065 without executing the processing of making a subtraction from the number of credits stored in the RAM 2043. Further, in the case that the number of betted coins exceeds the upper limit value that can be betted in a single game (50 coins, in the third embodiment), the main CPU 2041 proceeds with the processing to step S2067 without conducting the processing of making a subtraction from the number of credits stored in the RAM 2043.

Next, the main CPU 2041 determines whether or not the start button 2023 has been turned ON (step S2067). In the processing, the main CPU 2041 determines whether or not the main CPU 2041 has received an input signal that is outputted from the start switch 2023S when the start button 2023 is pressed.

When determining that the start button 2023 has not been turned ON, the main CPU 2041 returns the processing to step S2065.

Here, in the case that the start button 2023 is not turned ON (e.g. when the start button 2023 is not turned ON and a command to end the game is inputted), the main CPU 2041 cancels the subtraction result in step S2066.

On the other hand, when determining in step S2067 that the start button 2023 has been turned ON, the main CPU 2041 executes symbol rearrangement processing (step S2068).

In this processing, the main CPU 2041 first starts scroll-display of symbols in the display blocks 2028. Then, the main CPU 2041 executes the aforementioned symbol determination program, so as to determine the symbols to be rearranged, and then rearranges the symbols in the display blocks 2028.

Next, the main CPU 2041 determines whether or not a prize has been won (step S2069). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 2028 (see FIG. 82). In this processing, the main CPU 2041 counts the number of symbols for each type of the symbols rearranged in step S2068. Then, the main CPU 2041 determines whether or not the counted number is three or more.

When determining that a prize has been won, the main CPU 2041 executes processing relating to payout of coins (step S2070). In the processing, the main CPU 2041 determines the amount of payout based on the numbers of rearranged symbols with reference to the odds data stored in the RAM 2043. The odds data is data indicative of the correspondence relationship between the number of symbols rearranged in the display blocks 2028 and the amount of payout (see FIG. 82).

In the case of accumulating coins, the main CPU 2041 conducts processing for adding the number of credits corresponding to the determined amount of payout to the number of credits stored in the RAM 2043. On the other hand, in the case of paying out coins, the main CPU 2041 transmits a control signal to the hopper 2066 in order to pay out coins in an amount corresponding to the determined amount of payout.

The main CPU 2041 executes cumulative-amount-of-payout determination processing (step S2071). In the processing, the main CPU 2041 stores into the RAM 2043 a numeric value obtained by adding the amount of payout determined in step S2070 to the cumulative amount of payout stored in the RAM 2043, as an updated cumulative amount of payout.

When determining in step S2069 that no prize has been won, or when executing the processing of step S2071, the main CPU 2041 stores into the RAM 2043 a numeric value obtained by subtracting 1 from the number C of games stored in the RAM 2043, as an updated number C of games (step S2072).

The main CPU 2041 determines whether or not the number C of games stored in the RAM 2043 has reached 0 (step S2073). When determining that the number C of games has not reached 0, the main CPU 2041 returns the processing to step S2065.

On the other hand, when determining that the number C of games has reached 0, the main CPU 2041 updates the total cumulative amount of payout (step S2074). In the processing, the main CPU 2041 stores into the RAM 2043 a numeric value obtained by adding the cumulative amount of payout stored in the RAM 2043 to the total cumulative amount of payout stored in the RAM 2043, as an updated total cumulative amount of payout.

The main CPU 2041 transmits cumulative-amount-of-payout information to the server 2200 (step S2075). The cumulative-amount-of-payout information includes the identification number of the slot machine 2010.

The main CPU 2041 determines whether or not the main CPU 2041 has received the winning signal from the server 2200 (step S2076). When the main CPU 2041 determines that the main CPU 2041 has received the winning signal, the main CPU 2041 returns the processing to step S2061.

On the other hand, when the main CPU 2041 determines in step S2076 that the main CPU 2041 has not received the winning signal, the main CPU 2041 determines whether or not the main CPU 2041 has received the tournament end signal from the server 2200 (step S2077). When the main CPU 2041 determines that the main CPU 2041 has not received the tournament end signal, the main CPU 2041 returns the processing to step S2076.

On the other hand, when the main CPU 2041 determines in step S2077 that the main CPU 2041 has received the tournament end signal, the main CPU 2041 transmits total-cumulative-amount-of-payout information indicative of the total cumulative amount of payout, which is stored in the RAM 2043, to the server 2200 (step S2078). The total-cumulative-amount-of-payout information includes the identification number of the slot machine 2010 and the player name stored in the RAM 2043.

It should be noted that, when no player name is stored in the RAM 2043, the main CPU 2041 displays alphabets to the lower image display panel and accepts input of the player name via the touch panel 2069.

After executing the processing of step S2078, the main CPU 2041 ends the present subroutine.

Figure 85A:
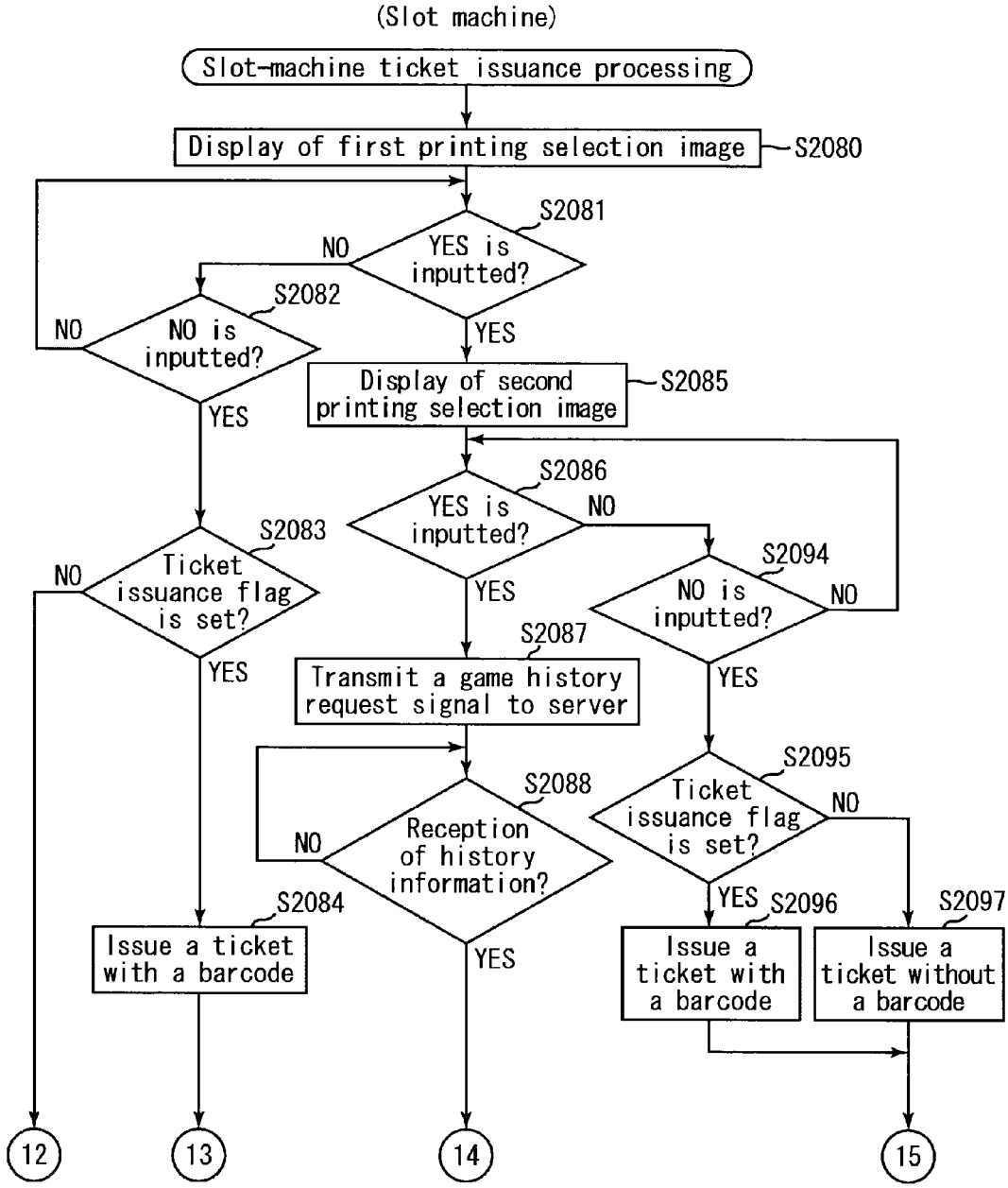
FIG. 85A is a flowchart illustrating a subroutine of slot-machine ticket issuance processing.

FIG. 85A is a flowchart illustrating a subroutine of the slot-machine ticket issuance processing.

Figure 85B:
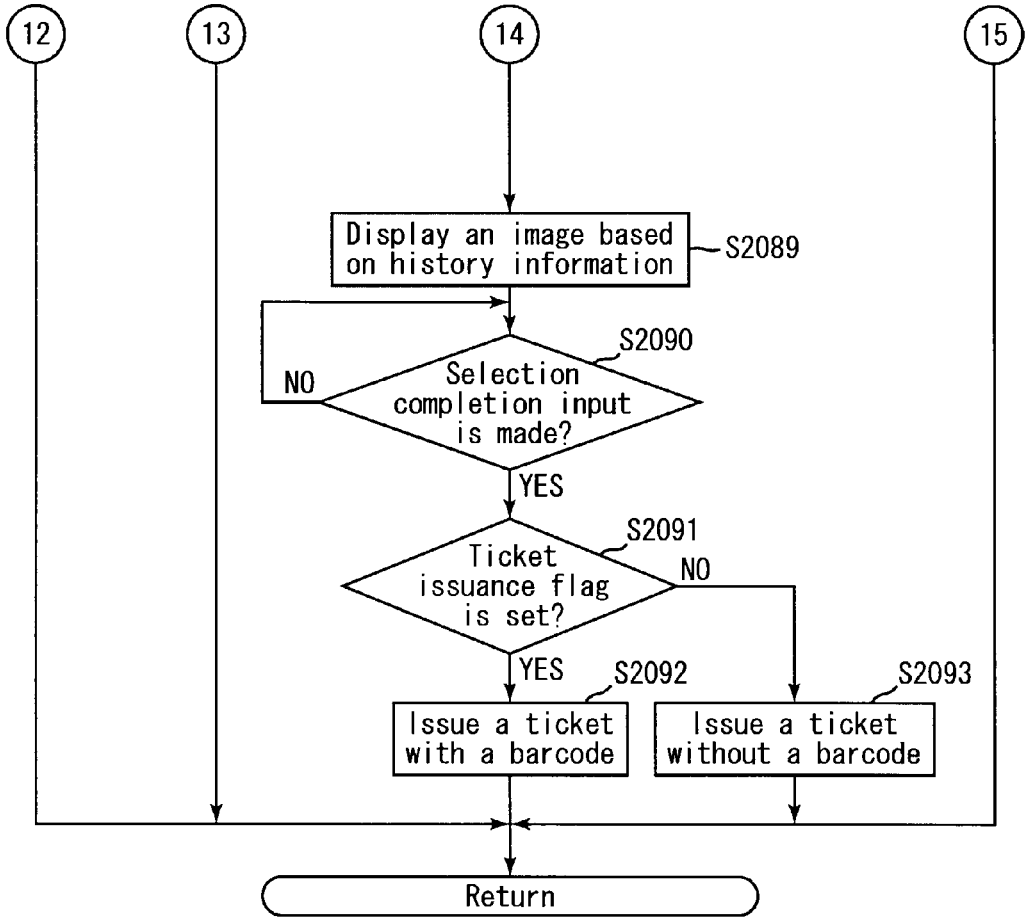
FIG. 85B is another flowchart illustrating the subroutine of the slot-machine ticket issuance processing.

FIG. 85B is another flowchart illustrating the subroutine of the slot-machine ticket issuance processing.

FIGS. 28A to 28C are views each illustrating an exemplary image displayed to the lower image display panel that is provided in the slot machine constituting the gaming system according to the third embodiment of the present invention.

FIGS. 29A to 29C are views each illustrating an exemplary ticket with a barcode that is issued from the ticket issuing device of the third embodiment.

The main CPU 2041 displays a first printing selection image to the lower image display panel 2016 (see FIG. 86A) (step S2080).

Figure 86A:
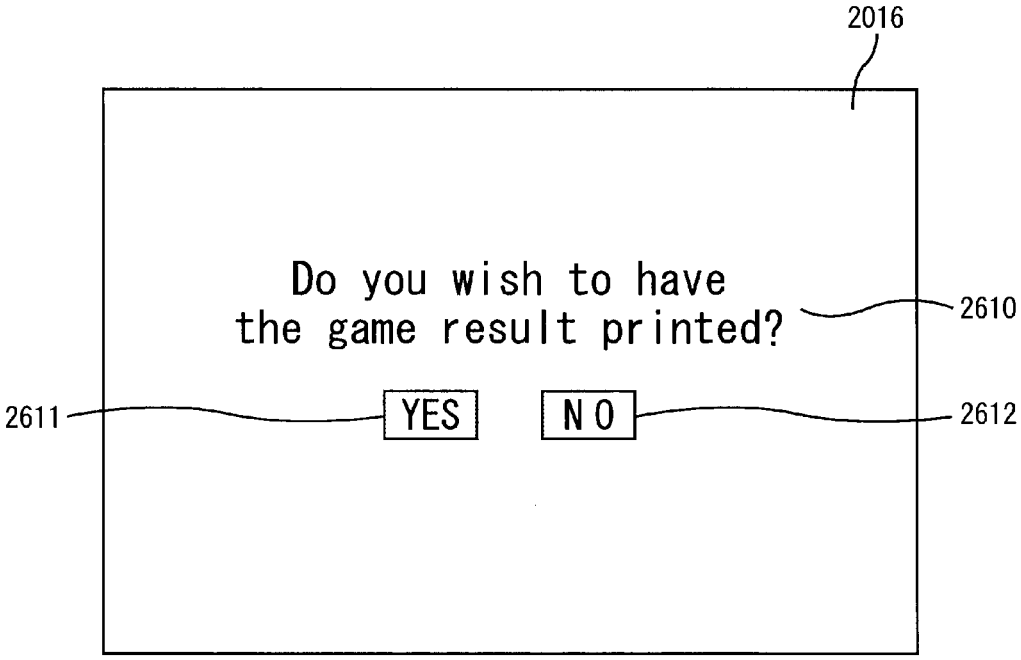
FIG. 86A is a view illustrating an exemplary image that is displayed to the lower image display panel provided in each slot machine constituting the gaming system according to the third embodiment of the present invention.

In FIG. 86A, a first printing selection image 2610 is displayed near the center of the lower image display panel 2016. The first printing selection image 2610 is an image that asks the player whether or not the player wishes to have the game result of the tournament-type game printed. Below the first printing selection image 2610, a YES image 2611 and a NO image 2612 are displayed.

If the player wishes to have the game result of the tournament-type game printed, the player can input "YES" via the touch panel 2069 by touching the portion where the YES image 2611 is displayed, with the finger or the like. On the other hand, if the player does not wish to have the game result of the tournament-type game printed, the player can input "NO" via the touch panel 2069 by touching the portion where the NO image 2612 is displayed, with the finger or the like.

Referring back to FIG. 85A, the main CPU 2041 determines whether or not "YES" has been inputted (step S2081). When determining that "YES" has not been inputted, the main CPU 2041 determines whether or not "NO" has been inputted (step S2082). When determining that "NO" has not been inputted, the main CPU 2041 returns the processing to step S2081.

The input of "YES" in step S2081 corresponds to the selection input signal in the present invention.

On the other hand, when determining in step S2082 that "NO" has been inputted, the main CPU 2041 determines whether or not the ticket issuance flag is set (step S2083). When determining that the ticket issuance flag is not set, the main CPU 2041 ends the present subroutine.

On the other hand, when determining in step S2083 that the ticket issuance flag is set, the main CPU 2041 issues a ticket 2500 with a barcode from the ticket printer 2035 (see FIG. 87A) (step S2084). In the processing, the main CPU 2041 prints on a ticket a barcode that represents encoded data of the player name and the like; the player name stored in the RAM 2043; and text that indicates that the ticket is used for participation in a tournament-type game. Then, the main CPU 2041 issues the ticket as a ticket 2500 with a barcode.

Figure 87A:
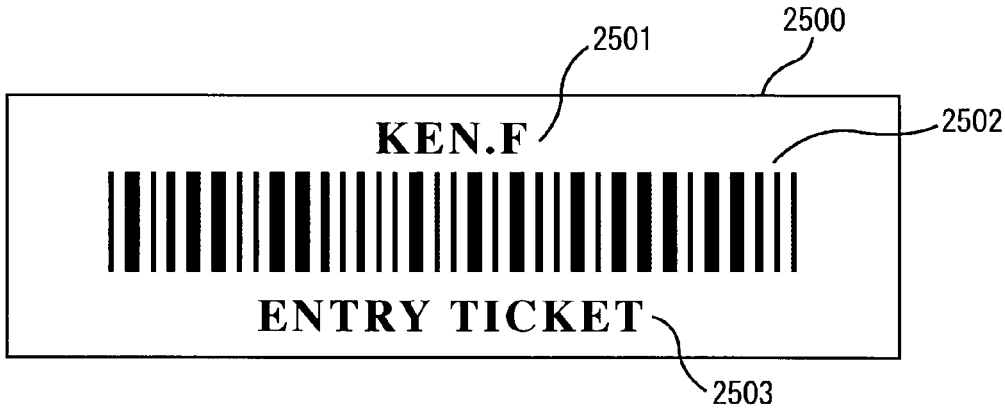
FIG. 87A is a view illustrating an exemplary ticket with a barcode issued from a ticket issuing device of the third embodiment.

In FIG. 87A, the player name 2501 is printed on the upper portion of the ticket 2500 with a barcode.

At the central portion of the ticket 2500 with a barcode, the barcode 2502 is printed which represents encoded data of the player name and the tournament-type game start time.

At the lower portion of the ticket 2500 with a barcode, the text 2503 is printed which indicates that the ticket is used for participation in a tournament-type game.

Referring back to FIG. 85A, when the main CPU 2041 determines in step S2081 that "YES" has been inputted, the main CPU 2041 displays a second printing selection image to the lower image display panel 2016 (see FIG. 86B) (step S2085).

Figure 86B:
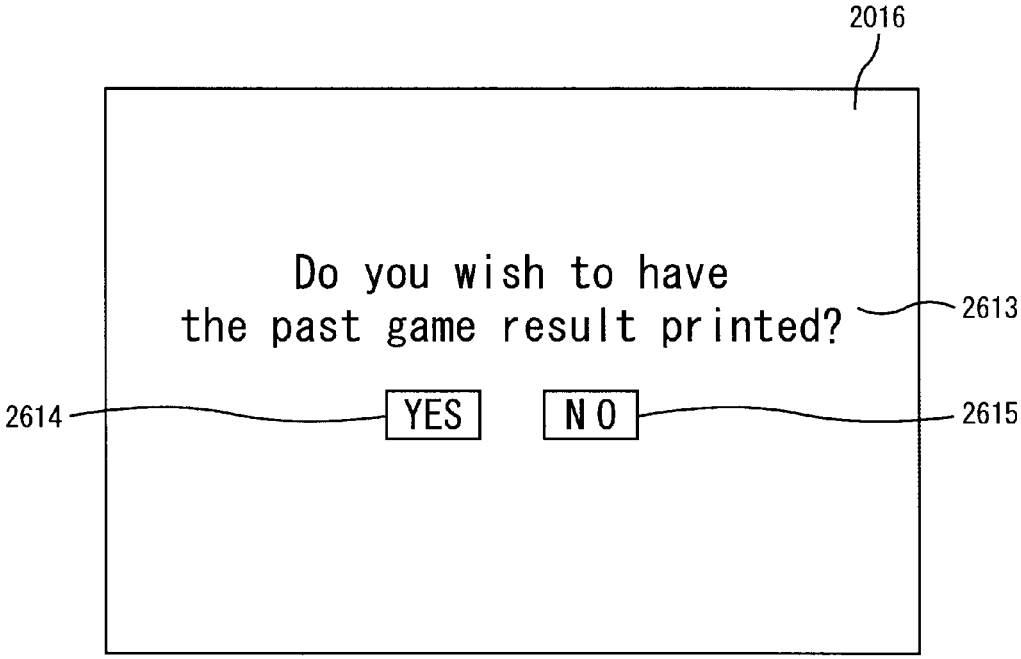
FIG. 86B is a view illustrating another exemplary image that is displayed to the lower image display panel provided in each slot machine constituting the gaming system according to the third embodiment of the present invention.

In FIG. 86B, a second printing selection image 2613 is displayed near the center of the lower image display panel 2016. The second printing selection image 2613 is an image that asks the player whether or not the player wishes to have the past game result of the tournament-type game printed. Below the second printing selection image 2613, a YES image 2614 and a NO image 2615 are displayed.

If the player wishes to have the past game result of the tournament-type game printed, the player can input "YES" via the touch panel 2069 by touching the portion where the YES image 2614 is displayed, with the finger or the like. On the other hand, if the player does not wish to have the past game result of the tournament-type game printed, the player can input "NO" via the touch panel 2069 by touching the portion where the NO image 2615 is displayed, with the finger or the like.

Referring back to FIG. 85A, the main CPU 2041 determines whether or not "YES" has been inputted (step S2086). When determining that "YES" has been inputted, the main CPU 2041 transmits a game-history request signal to the server 2200 (step S2087). The game-history request signal includes the player name that is stored in the RAM 2043.

The input of "YES" in step S2086 corresponds to the print selection input signal in the present invention.

The main CPU 2041 determines whether or not the main CPU 2041 has received history information from the server 2200 (step S2088). When the main CPU 2041 determines that the main CPU 2041 has not received history information, the main CPU 2041 returns the processing to step S2088.

On the other hand, when the main CPU 2041 determines in step S2088 that the main CPU 2041 has received history information, the main CPU 2041 displays an image based on the received history information to the lower image display panel 2016 (see FIG. 86C) (step S2089).

Figure 86C:
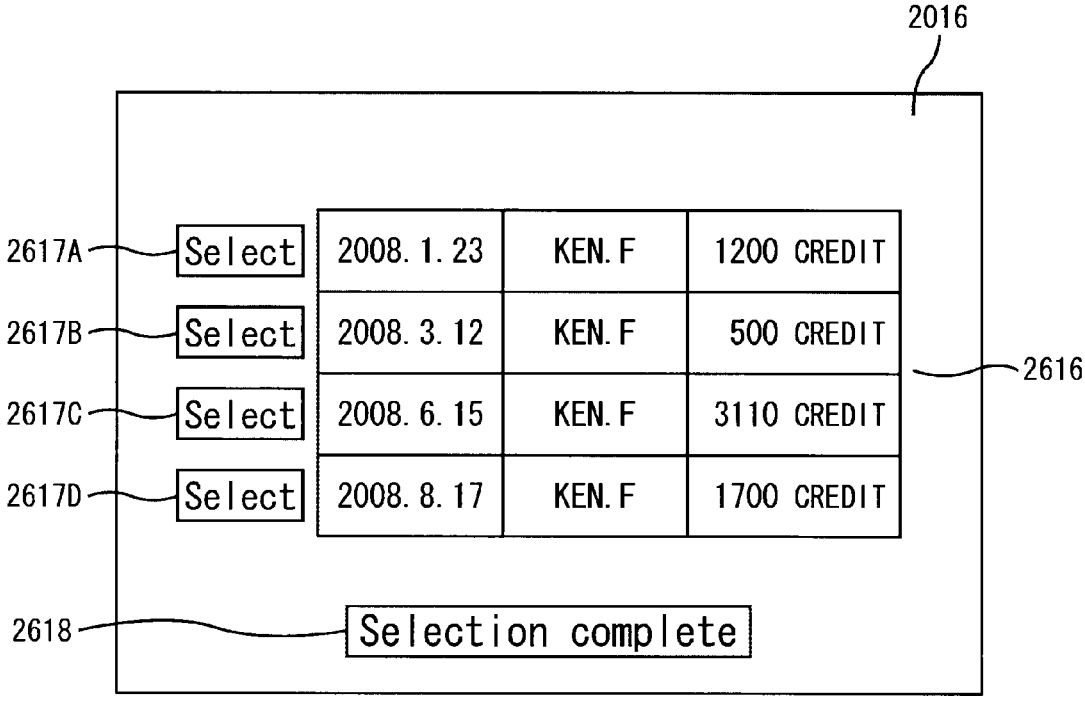
FIG. 86C is a view illustrating a yet another exemplary image that is displayed to the lower image display panel provided in each slot machine constituting the gaming system according to the third embodiment of the present invention.

In FIG. 86C, a history information image 2616 based on the received history information is displayed near the center of the lower image display panel 2016. The history information image 2616 is an image that shows the past game history that is associated with the same player name as the player name of the player who is playing a game in the slot machine 2010. The history information image 2616 shows the date on which the game has been played; the player name; and the number of obtained coins.

The date on which the game has been played, the player name, and the number of acquired coins correspond to the game history in the present invention.

On the left side of the history information image 2616, selection images 2617 (selection image 2617A, selection image 2617B, selection image 2617C, selection image 2617D) are displayed which correspond to respective game histories that are shown by the history information image 2616. For example, the selection image 2617A is a selection image 2617 that corresponds to the game history of Jan. 23, 2008. If the player wishes to have the game history of Jan. 23, 2008 printed, the player can input "selection image 2617A" via the touch panel 2069 by touching the portion where the selection image 2617A is displayed, with the finger or the like.

Below the history information image 2616, a selection completion image 2618 is displayed. The player can input completion of selection via the touch panel 2069 by touching the portion where the selection completion image 2618 is displayed, with the finger or the like, after inputting a single or plurality of selection images 2617. The input indicating completion of selection includes information on the inputted selection image 2617.

The input indicating completion of selection corresponds to the game history selection input signal in the present invention.

Referring back to FIG. 85B, the main CPU 2041 determines whether or not completion of selection has been inputted (step S2090). When determining that completion of selection has not been inputted, the main CPU 2041 returns the processing to step S2090.

On the other hand, when determining in step S2090 that completion of selection has been inputted, the main CPU 2041 determines whether or not the ticket issuance flag is set (step S2091). When determining that the ticket issuance flag is set, the main CPU 2041 issues a ticket 2500 with a barcode from the ticket printer 2035 (see FIG. 87C) (step S2092).

In the processing, the main CPU 2041 prints on a ticket a barcode that represents encoded data of the next tournament-type game start time, the player name stored in the RAM 2043, and the like; the player name stored in the RAM 2043; the number of coins obtained by the player in the tournament-type game that the player has participated this time; and the past game history selected by the player. Then, the main CPU 2041 issues the ticket as a ticket 2500 with a barcode.

Figure 87B:
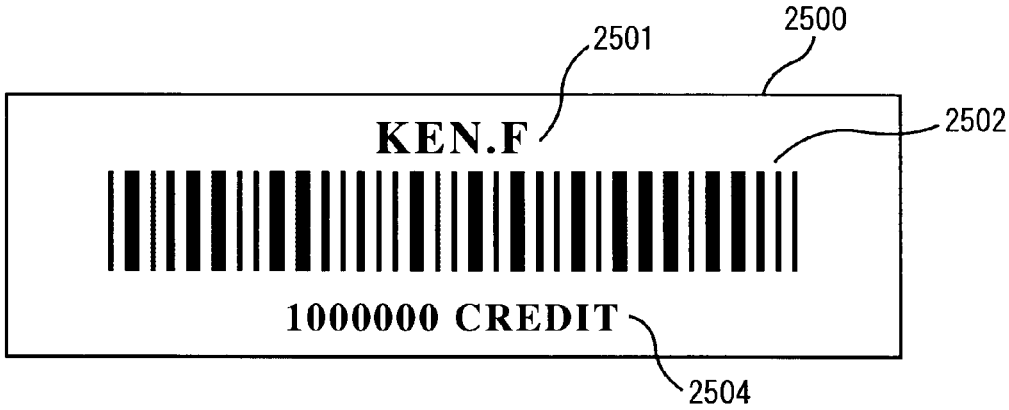
FIG. 87B is a view illustrating another exemplary ticket with a barcode issued from a ticket issuing device of the third embodiment.
Figure 87C:
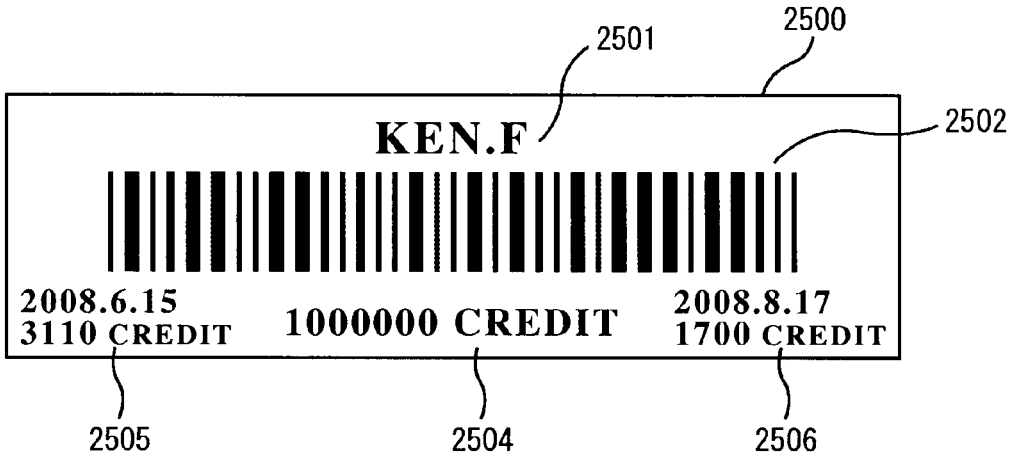
FIG. 87C is a view illustrating yet another exemplary ticket with a barcode issued from a ticket issuing device of the third embodiment.

In FIG. 87C, the player name 2501 is printed on the upper portion of the ticket 2500 with a barcode.

At the central portion of the ticket 2500 with a barcode, the barcode 2502 is printed which represents encoded data of the player name and the tournament-type game start time.

At the lower portion at the center of the ticket 2500 with a barcode, text 2504 is printed which shows the number of coins that are obtained by the player in the tournament-type game that the player has participated this time.

At the lower portion on the left side of the ticket 2500 with a barcode, text 2505 is printed which indicates that the game history is of Jun. 15, 2008.

At the lower portion on the right side of the ticket 2500 with a barcode, text 2506 is printed which indicates the game history of Aug. 17, 2008.

The number of coins obtained by the player in the tournament-type game that the player has participated this time corresponds to the score obtained in the game in the present invention.

Referring back to FIG. 85B, when the main CPU 2041 determines in step S2091 that the ticket issuance flag is not set, the main CPU 2041 issues a ticket without a barcode from the ticket printer 2035 (step S2093).

In the processing, the main CPU 2041 prints on a ticket the player name stored in the RAM 2043; the number of coins obtained by the player in the tournament-type game that the player has participated this time; and the past game history selected by the player. Then, the main CPU 2041 issues the ticket as a ticket without a barcode.

Referring back to FIG. 85A, the main CPU 2041 determines in step S2086 that "YES" has not been inputted, the main CPU 2041 determines whether or not "NO" has been inputted (step S2094). When determining that "NO" has not been inputted, the main CPU 2041 returns the processing to step S2086.

On the other hand, when determining in step S2094 that "NO" has been inputted, the main CPU 2041 determines whether or not the ticket issuance flag is set (step S2095). When determining that the ticket issuance flag is set, the main CPU 2041 issues a ticket 2500 with a barcode from the ticket printer 2035 (see FIG. 87B) (step S2096).

In the processing, the main CPU 2041 prints on a ticket a barcode that represents encoded data of the next tournament-type game start time, the player name stored in the RAM 2043, and the like; the player name stored in the RAM 2043; and the number of coins obtained by the player in the tournament-type game that the player has participated this time. Then, the main CPU 2041 issues the ticket as a ticket 2500 with a barcode.

The ticket without a barcode and the ticket 2500 with a barcode correspond to the recording medium in the present invention.

In FIG. 87B, the player name 2501 is printed on the upper portion of the ticket 2500 with a barcode.

At the central portion of the ticket 2500 with a barcode, the barcode 2502 is printed which represents encoded data of the player name and the tournament-type game start time.

At the lower portion at the center of the ticket 2500 with a barcode, the text 2504 is printed which indicates the number of coins obtained by the player in the tournament-type game that the player has participated this time.

Referring back to FIG. 85A, when the main CPU 2041 determines in step S2095 that the ticket issuance flag is not set, the main CPU 2041 issues a ticket without a barcode from the ticket printer 2035 (step S2097).

In the processing, the main CPU 2041 prints on a ticket the player name stored in the RAM 2043; and the number of coins obtained by the player in the tournament-type game that the player has participated this time. Then, the main CPU 2041 issues the ticket as a ticket without a barcode.

When determining in step S2083 that the ticket issuance flag is not set, or when executing the processing of step S2084, step S2092, step S2093, step S2096, or step S2097, the main CPU 2041 ends the present subroutine.

As above, according to the slot machine 2010, the gaming system 2001, and the control methods of those according to the third embodiment, when the bill validator 2022 has read a ticket 2500 with a barcode issued from the ticket printer 2346, a tournament-type game is executed. Accordingly, a player having received a ticket 2500 with a barcode can participate in the tournament-type game smoothly by having the ticket 2500 with a barcode read by the bill validator 2022 provided in the slot machine 2010. As a result, the player is allowed to play games comfortably.

In addition, since a plurality of ticket printers 346 are provided, issuance of the ticket 2500 with a barcode is conducted also smoothly, and therefore, the player is allowed to play games comfortably.

A ticket 2500 with a barcode or a ticket without a barcode, on which the result of the tournament-type game is printed, is issued from the ticket printer 2035. Accordingly, the player can take out the ticket 2500 with a barcode or the ticket without a barcode, on which the result of the tournament-type game is printed.

The unfavorable result printed thereon may motivate the player to achieve the better result in the next game.

On the other hand, the favorable result printed thereon may have the player wish to participate in the tournament-type game again.

The tournament-type game is executed, not only in a case where the bill validator 2022 has read a ticket 2500 with a barcode issued from the ticket printer 2346 provided in a place other than the inside of the slot machine 2010, but also in a case where the bill validator 2022 has read a ticket 2500 with a barcode issued from the ticket printer 2035.

That is, a ticket 2500 with a barcode can be issued not only from the ticket issuing device 2300, but also from the slot machine 2010, and therefore, issuance of a ticket 2500 with a barcode can be conducted more smoothly.

In a case where a ticket 2500 with a barcode is issued from the slot machine 2010, the player can participate in the tournament-type game on the slot machine 2010 from which the ticket 2500 with a barcode has been issued, without moving. Accordingly, the player is not required to move to the ticket issuing device 2300 and is allowed to participate in the game played against another slot machine 2010 smoothly. As a result, the player is allowed to play games comfortably.

A ticket 2500 with a barcode or a ticket without a barcode, on which the score obtained in the tournament-type game is printed, is issued from the ticket printer 2035. Accordingly, the player can take out the ticket 2500 with a barcode or the ticket without a barcode, on which the score obtained in the tournament-type game is printed.

Since the score, the absolute evaluation, is printed thereon, the player can see their improvement in the game by comparing the score with the previous one.

After executing the tournament-type game, the slot machine 2010 prompts a selection of whether or not to issue from the ticket printer 2035 a ticket 2500 with a barcode or a ticket without a barcode, on which the result of the tournament-type game is printed. When receiving from the touch panel 2069 a selection input signal indicating that the ticket 2500 with a barcode or the ticket without a barcode is to be issued from the ticket printer 2035, the slot machine 2010 issues from the ticket printer 2035 the ticket 2500 with a barcode or the ticket without a barcode, on which the result of the tournament-type game is printed.

That is, the player is allowed to select whether or not to print out the result of the tournament-type game. Accordingly, the result of the game is not printed out to the player who does not wish to have it, and therefore, it is possible to prevent the player from feeling uncomfortable.

The slot machine 2010 prompts a selection of whether or not to print information based on the past game result on the ticket 2500 with a barcode or the ticket without a barcode, after executing the tournament-type game. On receiving from the touch panel 2069 a print selection input signal indicating that the information based on the past game result is to be printed on the ticket 2500 with a barcode or the ticket without a barcode, the slot machine 2010 issues from the ticket printer 2035 the ticket 2500 with a barcode or the ticket without a barcode, on which the information based on the past game result is printed.

That is, the player is allowed to select whether or not to print out the information based on the past game result.

Accordingly, the information based on the result of the game is not printed out to the player who does not wish to have it, and therefore, it is possible to prevent the player from feeling uncomfortable.

Since the information based on the past game result is printed out, the player can easily see their improvement in the game.

When the bill validator 2022 has read a ticket 2500 with a barcode, the gaming machine reads out the player name of the player from that ticket. On receiving from the touch panel 2069 a print selection input signal indicating that the information based on the past game result is to be printed on the ticket 2500 with a barcode or the ticket without a barcode, the slot machine 2010 displays to the lower image display panel 2016 an image prompting a selection of a single or plurality of game histories from a plurality of game histories associated with the player name same as the read player name. On receiving from the touch panel 2069 a game history selection input signal specifying the game history, the slot machine 2010 issues from the ticket printer 2035 the ticket 2500 with a barcode or the ticket without a barcode, on which information based on the game history specified by the game history selection input signal is printed. That is, it is possible to select a single or plurality of game histories to be printed on the recording medium, from game histories associated with the player name same as that of the player playing a game on the slot machine 2010. Accordingly, for example, it is possible to print on the ticket 2500 with a barcode or the ticket without a barcode information based only on the good game histories in the past, which enables printing of information in a manner that meets the player' s various needs on the ticket 2500 with a barcode or the ticket without a barcode.

Further, in the present invention, participation in a game (in the third embodiment, a tournament-type game) that is played against another gaming machine (in the third embodiment, a slot machine 2010) is enabled by putting a ticket (in the third embodiment, a ticket 2500 with a barcode) into a gaming machine. This configuration allows a player to smoothly participate in a game (in the third embodiment, a tournament-type game) that is played against another gaming machine.

In the third embodiment, the case has been described in which the gaming machine is a slot machine 2010. However, the gaming machine is not particularly limited in the present invention, and can execute, for example, a horse racing game or a card game.

Further, in the third embodiment, the case has been described in which the game played against another gaming machine is a tournament-type game that is a knockout competition. However, in the present invention, the game played against another gaming machine may be a league game that is a round-robin competition.

Furthermore, in the third embodiment, the case has been described in which the input device is the keyboard 2345. However, in the present invention, the input device may be a card reader.

A card reader is for reading data from a smart card and for writing data into a smart card. A smart card is a card owned by a player, and the smart card stores, for example, data showing the player name, and data relating to the history of games played by the player.

Insertion of a smart card into a card reader provided in each ticket issuing device 2300 allows the card reader to read the player name from the smart card, and to transmit a participation input signal including the player name to the CPU 2341.

In the third embodiment, the case has been described in which the code information is the barcode 2502. However, in the present invention, the code information is not limited to one-dimensional information, and may be two-dimensional information. Employment of two-dimensional code information makes it possible for code information to include more data than in the case of employing one-dimensional code information.

In the third embodiment, the case has been described in which a ticket 2500 with a barcode has printed thereon a barcode 2502 that represents encoded data of start time of a tournament-type game. However, in the present invention, the data of code information (in the third embodiment, a barcode 2502) that is to be printed on a ticket (in the third embodiment, a ticket 2500 with a barcode) may be data showing how many games (in the third embodiment, tournament-type games), which are played against another gaming machine, have been played before the game (in the third embodiment, a tournament-type game) that is played against another gaming machine. Code information (in the third embodiment, a barcode) to be printed on a ticket (in the third embodiment, a ticket 2500 with a barcode) is not limited so long as the information at least includes code information (in the third embodiment, a barcode) that represents encoded player identification information such as a player name.

In the third embodiment, the case has been described in which the game group consists of two slot machines that have a match against each other. However, the number of gaming machines to be included in the game group is not particularly limited, and can be, for example, four. In this case, one winning gaming machine may be determined from among the four gaming machines. For example, among the four gaming machines, a gaming machine on which the largest number of coins has been obtained may be determined as the winning gaming machine.

In the third embodiment, the case has been described in which the number of coins obtained by the player in the tournament-type game that the player has participated this time is printed on a ticket without a barcode or on a ticket 2500 with a barcode. However, in the present invention, the rank of the player in the tournament-type game that the player has participated this time may be printed on a ticket without a barcode or on a ticket 2500 with a barcode.

Since the rank, the relative evaluation, is printed thereon, the player can seethe change of the level of the players participating in the game by comparing the rank with the previous one.

In the third embodiment, the case has been described in which each game history selected via the touch panel 2069 is printed on a ticket without a barcode or on a ticket 2500 with a barcode. However, in the present invention, the total number of coins of the numbers of coins shown by the respective game histories selected via the touch panel 2069 may be printed on a ticket.

In the third embodiment, the case has been described in which the two slot machines having a match against each other execute the game separately, and then the numbers of coins obtained by the respective players on the respective slot machines are compared, so that the winning slot machine is determined. However, in the present invention, the two gaming machines having a match against each other may execute a directly competing game such as a fighting game, with synchronizing with each other. This makes it possible to encourage competition between the players and to make the players further immersed in the common game.

In the third embodiment, there has been described the case where the symbols rearranged in the display blocks 2028 are all scatter symbols. However, symbols in the present invention are not limited to the scatter symbols. For example, a pay line may be provided, and a prize may be won or a point value may be offered when a plurality of symbols in a specific combination are rearranged on the pay line. Further, for example, the symbol leading to winning of a prize upon being rearranged on the pay line and the scatter symbol may be used in combination.

Further, in the third embodiment, there has been described the case where the number of the slot machines 2010 is 50. However, the number of the gaming machines is not particularly limited, and it may be 100, for example.

Furthermore, in the third embodiment, there has been described the case where the number of the ticket issuing devices 2300 is three. However, the number of the ticket issuing devices is not particularly limited, and it may be ten, for example.

[Fourth Embodiment]

An embodiment of the present invention is described based on the drawings.

Figure 88A:
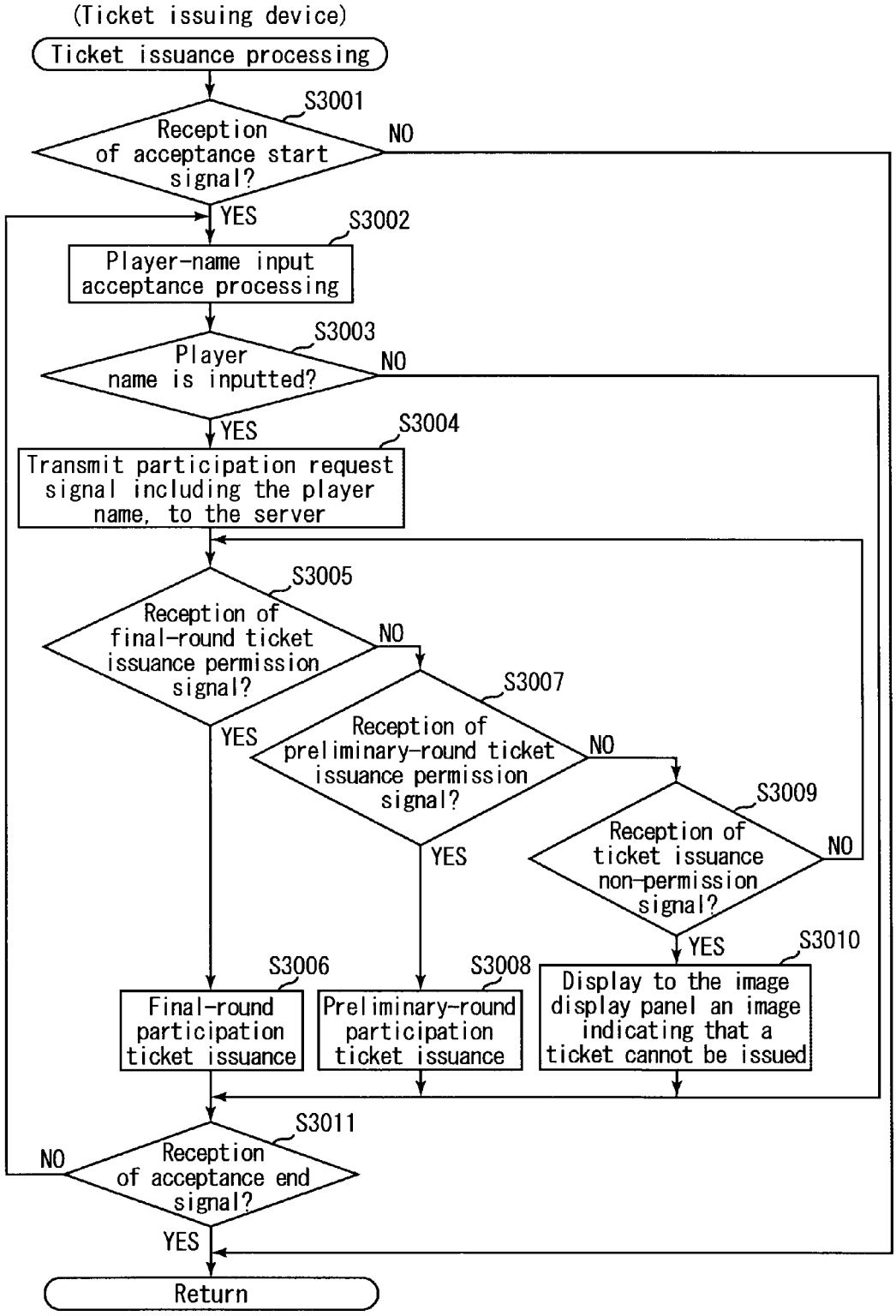
FIG. 88A is a flowchart illustrating ticket issuance processing executed in each ticket issuing device according to one embodiment of a fourth embodiment.

FIG. 88A is a flowchart illustrating ticket issuance processing that is executed in each ticket issuing device according to a fourth embodiment of the present invention.

Figure 89:
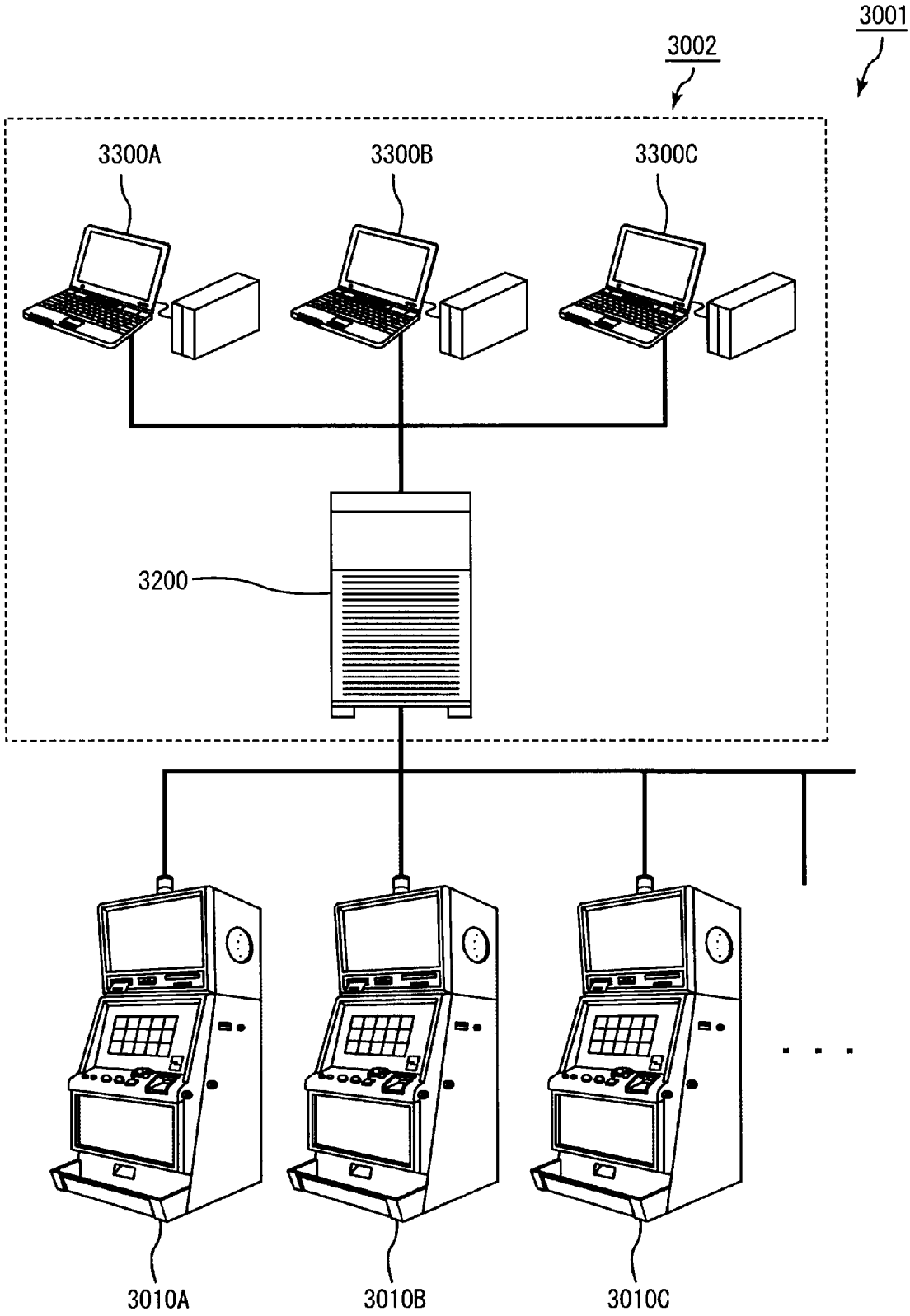
FIG. 89 is a schematic view illustrating an entire configuration of a gaming system according to the fourth embodiment of the present invention.

A ticket issuing system 2 (see FIG. 89) according to the fourth embodiment has three ticket issuing devices 3300 (see FIG. 89) and a server 3200 (see FIG. 89).

The ticket issuing devices 3300 each are operated by a staff member of a casino. As illustrated in FIG. 88A, a CPU 3341 (see FIG. 92) provided in each ticket issuing device 3300 first determines whether or not the CPU 3341 has received an acceptance start signal from the server 3200 (step S3001). The acceptance start signal is transmitted from the server 3200 when predetermined time (e.g. 14:00) comes. When the CPU 3341 determines that the CPU 3341 has not received the acceptance start signal, the CPU 3341 ends the present subroutine. On the other hand, when the CPU 3341 determines that the CPU 3341 has received the acceptance start signal, the CPU 3341 shifts the processing to step S3002.

In step S3002, the CPU 3341 starts accepting an input of a player name.

Next in step S3003, the CPU 3341 determines whether or not a player name is inputted via a keyboard 3345 (see FIG.

92). When determining that a player name is inputted via the keyboard 3345, the CPU 3341 shifts the processing to step S3004.

In step S3004, the CPU 3341 transmits a participation request signal for a tournament-type game, which includes information showing the inputted player name, to the server 3200. Thereafter, the CPU 3341 shifts the processing to step S3005. In a tournament-type game, each player competes with another player based on the number of coins obtained after playing a predetermined number of (50 in the fourth embodiment) games on each slot machine 3010. A tournament-type game is a knockout competition in which two slot machines compete with each other to determine winning and losing. More specifically, one of the two slot machines with a larger number of obtained coins in the match becomes a winning slot machine. A tournament-type game is defined as a preliminary tournament or a final tournament. The final tournament corresponds to the special game of the present invention. The preliminary tournament corresponds to the normal game of the present invention.

The server 3200 stores game-history data (see FIG. 94) of a player who has played a game on a slot machine 3010 in the past, in association with player identification information. In the fourth embodiment, the server 3200 stores game-history data of 500 players from the previous tournament-type game. In the server 3200, it is first determined whether or not the number P of players who have been accepted to participate in a game (hereinafter also referred to as "the number P of participation-accepted players") exceeds a predetermined number-of-players upper limit value, when a participation request signal transmitted from one of the ticket issuing devices 3300 is received in the server 3200. When it is determined that the number P of participation-accepted players exceeds the number-of-players upper limit value, a ticket issuance non-permission signal is transmitted to the ticket issuing device 3300. On the other hand, when the number P of participation-accepted players does not exceed the number-of-players upper limit value, it is determined whether or not the result of a preliminary tournament, which has been played by the player in the past, is overall winning with reference to a piece of the game-history data corresponding to the player name included in the received participation request signal. When it is determined that the result of the preliminary tournament is overall winning, a final-round ticket issuance permission signal is transmitted from the server 3200 to the ticket issuing device 3300. On the other hand, when it is determined that the result of the preliminary tournament is not overall winning, a preliminary-round ticket issuance permission signal is transmitted from the server 3200 to the ticket issuing device 3300.

In step S3005, the CPU 3341 determines whether or not the CPU 3341 has received the final-round ticket issuance permission signal from the server 3200. When the CPU 3341 determines that the CPU 3341 has received the ticket issuance permission signal, the CPU 3341 issues a final-round participation ticket 3500 from a ticket printer 3346 (see FIG. 92) (step S3006).

Figure 88B:
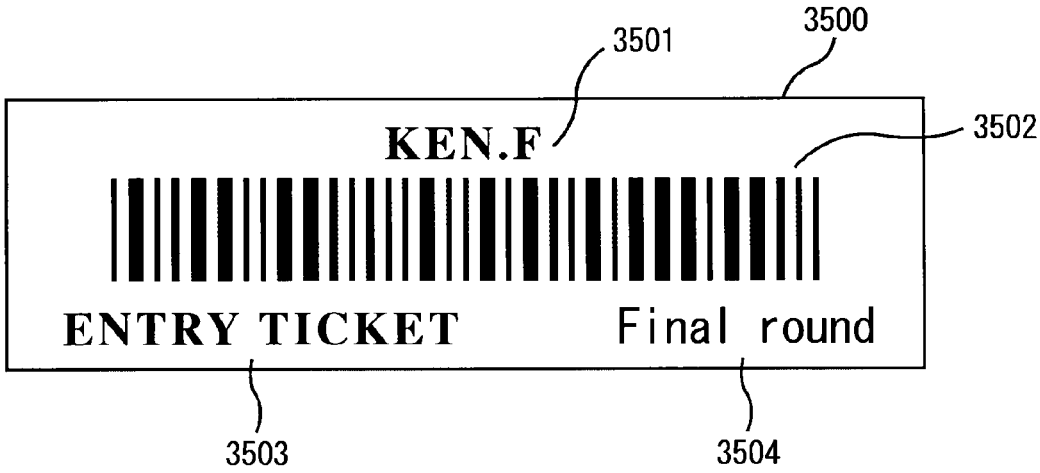
FIG. 88B is a view illustrating an exemplary final-round participation ticket which is issued from a ticket issuing device according to one embodiment of the fourth embodiment.

FIG. 88B is a view illustrating an exemplary participation ticket that is issued from a ticket issuing device according to the fourth embodiment of the present invention.

As shown in FIG. 88B, at the upper portion of the final-round participation ticket 3500, a player name 3501 is printed. At the lower portion, text 3503 showing "ENTRY TICKET" and text 3504 showing that the ticket is a participation ticket for a final tournament are printed. At the center of the final-round participation ticket 3500, a barcode 3502 is printed which represents encoded information for identifying a tournament-type game (hereinafter also referred to as "tournament identification information") (in the fourth embodiment, the information showing that the final-round participation ticket 3500 is a participation ticket for the final tournament).

When the CPU 3341 determines that the CPU 3341 has not received the final-round ticket issuance permission signal (step S3005: NO), the CPU 3341 determines whether or not the CPU 3341 has received the preliminary-round ticket issuance permission signal (step S3007). When the CPU 3341 determines that the CPU 3341 has received the preliminary-round ticket issuance permission signal, the CPU 3341 issues a preliminary-round participation ticket 3580 from the ticket printer 3346 (step S3008).

Figure 88C:
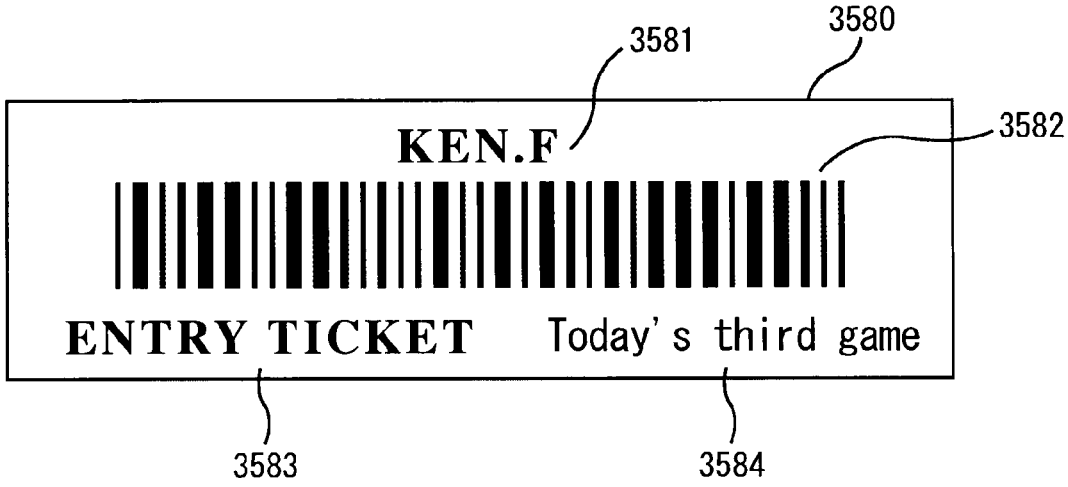
FIG. 88C is a view illustrating an exemplary preliminary-round participation ticket which is issued from a ticket issuing device according to the fourth embodiment of the present invention.

FIG. 88C is a view illustrating an exemplary preliminary-round participation ticket that is issued from a ticket issuing device according to the fourth embodiment of the present invention.

As shown in FIG. 88C, at the upper portion of the preliminary-round participation ticket 3580, a player name 581 is printed. At the lower portion, text 583 showing "ENTRY TICKET" and text 584 showing that the ticket is a participation ticket for a preliminary tournament are printed. The text "today's 3rd game" shown on the preliminary-round participation ticket 3580 means that the game is the third tournament of a plurality of preliminary tournaments that are held on the day on which the preliminary-round participation ticket 3580 has been issued. Further, at the center of the preliminary-round participation ticket 3580, a barcode 3582 is printed which represents encoded tournament identification information (information showing how many preliminary tournaments have been held on the day before the participation of this time).

On the other hand, when the CPU 3341 determines in step S3007 that the CPU 3341 has not received the preliminary-round ticket issuance permission signal from the server 3200, the CPU 3341 determines whether or not the CPU 3341 has received the ticket issuance non-permission signal (step S3009). When the CPU 3341 determines that the CPU 3341 has not received the ticket issuance non-permission signal, the CPU 3341 returns the processing to step S3005. On the other hand, when the CPU 3341 determines that the CPU 3341 has received the ticket issuance non-permission signal, the CPU 3341 displays an image that indicates that a ticket cannot be issued, to an image display panel 3348 (see FIG. 92).

After the processing of step S3006, step S3008, or step S3010, or when determining in step S3003 that a player name is not inputted via the keyboard 3345, the CPU 3341 determines whether or not the CPU 3341 has received an acceptance end signal from the server 3200 (step S3011). The acceptance end signal is transmitted from the server 3200 to the ticket issuing devices 3300 when it is determined in the server 3200 that predetermined end time to end acceptance (e.g. 14:45) has come. When the CPU 3341 determines that the CPU 3341 has not received the acceptance end signal, the CPU 3341 returns the processing to step S3002. On the other hand, when the CPU 3341 determines that the CPU 3341 has received the acceptance end signal, the CPU 3341 ends the present subroutine.

Figure 88D:
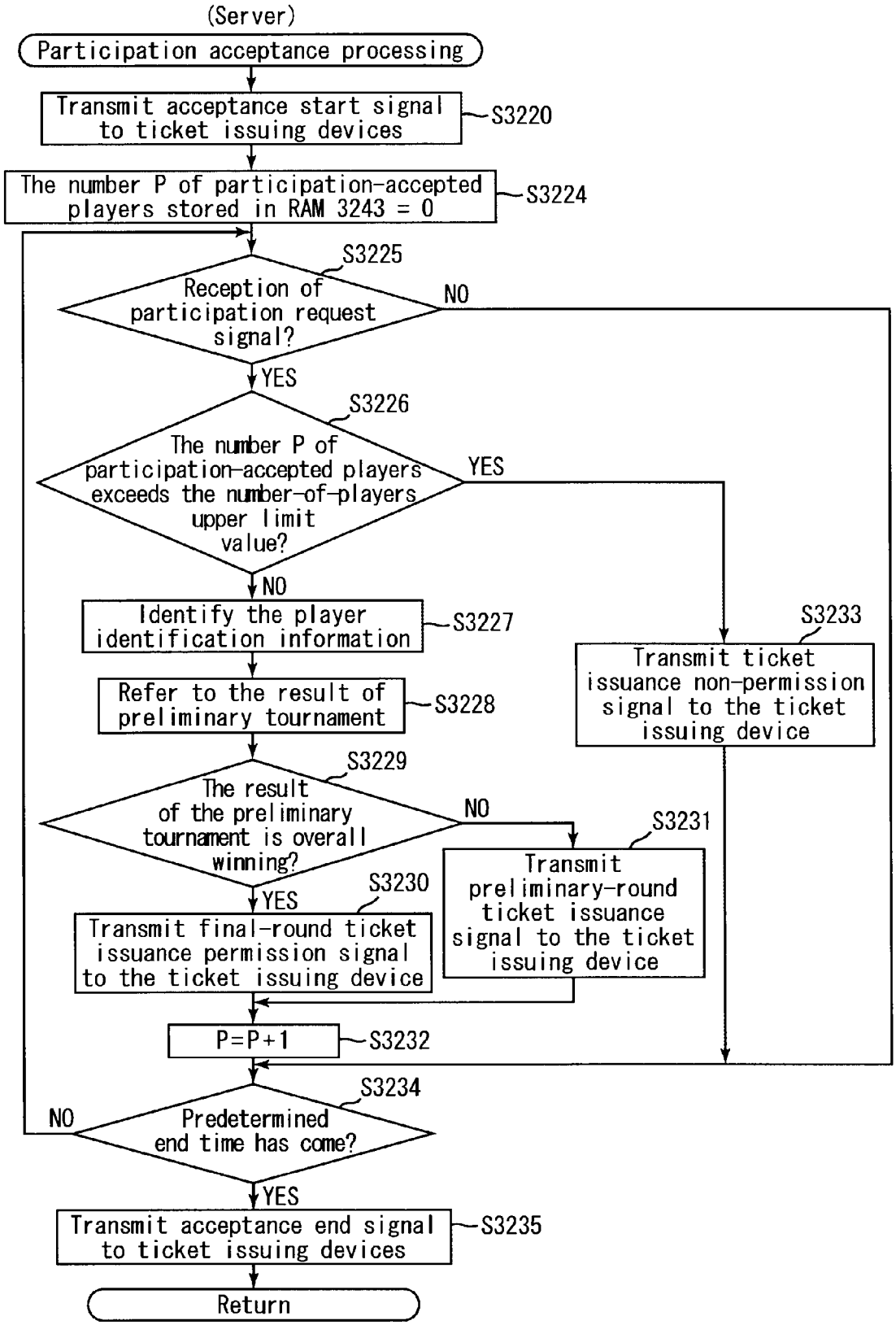
FIG. 88D is a flowchart illustrating participation acceptance processing executed in a server according to the fourth embodiment of the present invention.

FIG. 88D is a flowchart illustrating participation acceptance processing that is executed in the server according to the fourth embodiment of the present invention.

A CPU 3241 (see FIG. 93) provided in the server 3200 first transmits the acceptance start signal to the three ticket issuing devices 3300 (ticket issuing device 3300A, ticket issuing device 3300B, ticket issuing device 3300C) which are connected to a network, when the predetermined time (e.g. 14:00) comes (step S3220).

Next, in step S3224, the CPU 3241 stores 0 into a RAM 3243 as an updated number P of participation-accepted players (step S3224).

Then, the CPU 3241 determines whether or not the CPU 3241 has received a participation request signal from any of the ticket issuing devices 3300 (step S3225). When the CPU 3241 determines that the CPU 3241 has received a participation request signal from any of the ticket issuing devices 3300, the CPU 3241 determines whether or not the number P of participating players exceeds the number-of-players upper limit value (step S3226). In the fourth embodiment, the number-of-players upper limit value is set to 40.

When determining that the number P of participating players does not exceed the number-of-players upper limit value, the CPU 3241 identifies a piece of the player identification information that corresponds to the player name included in the participation request signal (step S3227). For example, when "KEN. F" is inputted as the player name, the CPU 3241 identifies a piece of the player identification information of "KEN. F" (see FIG. 94).

The CPU 3241 then refers to a piece of the game-history data (see FIG. 94) that corresponds to the player name included in the received participation request signal (step S3228) so as to determine whether or not the result of the preliminary tournament, which has been played by the player in the past, is overall winning (step S3229). When determining that the result of the preliminary tournament is overall winning, the CPU 3241 transmits the final-round ticket issuance permission signal to the ticket issuing device 3300 (step S3230).

On the other hand, when determining that the result of the preliminary tournament is not overall winning, the CPU 3241 transmits a preliminary-round ticket issuance permission signal to the ticket issuing device 3300 (step S3231).

After the processing of step S3230 or step S3231, the CPU 3241 adds 1 to the number P of participating players (step S3232).

When determining in step S3226 that the number P of participating players exceeds the number-of-players upper limit value, or when determining in step S3229 that the result of the preliminary tournament is not overall winning, the CPU 3241 transmits the ticket issuance non-permission signal to the ticket issuing device 3300 (step S3233).

After the processing of step S3232 or step S3233, or when the CPU 3241 determines in step S3225 that the CPU 3241 has not received a participation request signal from any of the ticket issuing devices 3300, the CPU 3241 determines whether or not the predetermined end time (e.g. 14:45) has come (step S3234). When determining that the predetermined end time has not come, the CPU 3241 returns the processing to step S3225. On the other hand, when determining that the predetermined end time has come, the CPU 3241 transmits the acceptance end signal to the ticket issuing devices 3300 (step S3235). After that, the CPU 3241 ends the present subroutine.

According to the ticket issuing system 2, the server 3200 stores apiece of the game-history data of a player who has played a game on a slot machine 3010 in the past, in association with a piece of the player identification information. The server 3200 determines whether or not the result of a preliminary tournament played by the player in the past is overall winning, with reference to a piece of the game-history data corresponding to the player name that has been inputted via the keyboard 3345 of the ticket issuing device 3300. When it is determined that the result of the preliminary tournament is overall winning, the ticket issuing device 3300 issues a final-round participation ticket 3500 from the ticket printer 3346.

A final-round participation ticket 3500 is not issued to every player, but is issued only to a player whose result of the preliminary tournament which is stored in the server 3200 is overall winning. Accordingly, it is possible to give a player a sense of superiority when a final-round participation ticket 3500 is issued to the player, and further entertain the player with the game. In addition, with regard to a player whose result of the preliminary tournament is not overall winning, it is possible to motivate the player for issuance of a final-round participation ticket 3500, that is, for achieving a result of overall winning in the preliminary tournament, and thereby it is possible to get the player engrossed in the game.

Further, since being provided with three ticket issuing devices 3300, the ticket issuing system 2 can simultaneously execute issuance of final-round participation tickets 3500 from the three devices. Therefore, it is possible to avoid a situation in which issuance of a final-round participation ticket 3500 takes long time, and thus to smoothly start a tournament-type game.

As above, the fourth embodiment has been briefly described based on FIGS. 1A to 1D.

Hereinafter, the fourth embodiment is described in more detail.

FIG. 89 is a schematic view illustrating an entire configuration of the gaming system according to the fourth embodiment of the present invention.

A gaming system 1 has a plurality of (50 in the fourth embodiment) slot machines 3010 (slot machine 3010A, slot machine 3010B, slot machine 3010C, and so forth) and the ticket issuing system 2. The ticket issuing system 2 has the plurality of (three in the fourth embodiment) ticket issuing devices 3300 (ticket issuing device 3300A, ticket issuing device 3300B, ticket issuing device 33000) and the server 3200. The slot machines 3010, the server 3200 and the ticket issuing devices 3300 are connected to one another by a network.

Each slot machine 3010 is provided with a unique identification number. The server 3200 uses the identification numbers to identify the source of data that is transmitted from each slot machine 3010. Further, the server 3200 uses the identification numbers to specify the destination when the server 3200 transmits data to the ticket issuing devices 3300.

The gaming system in the present invention may be constructed inside one gaming facility where a variety of games can be played, such as a casino (i.e. inside the casino), or may be constructed between a plurality of such gaming facilities. When the gaming system is to be constructed inside one gaming facility, the gaming system may be constructed on each floor or section of the gaming facility. A communication network may be wired or wireless one, and can adopt a circuit such as a dedicated circuit or a switched circuit.

Next, a configuration of each slot machine 3010 is described.

Figure 90:
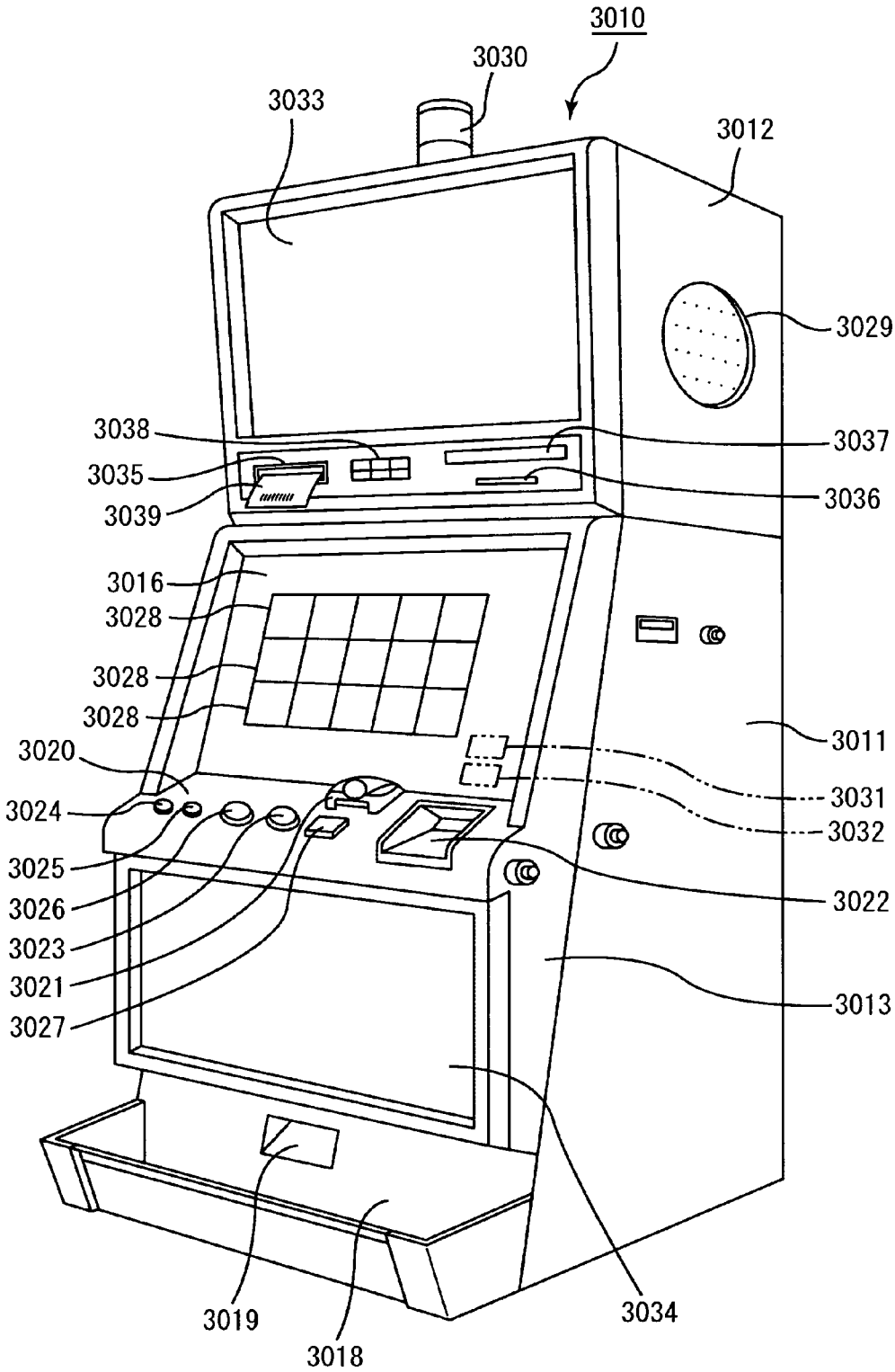

FIG. 90 is a perspective view illustrating an external view of a slot machine according to the fourth embodiment of the present invention.

In the slot machine 3010, a coin, a bill, or electronic valuable information corresponding to those is used as a game medium. However, in the present invention, the game medium is not particularly limited. Examples of the game medium may include a medal, a token, electronic money and a ticket.

The slot machine 3010 comprises a cabinet 3011, a top box 3012 installed on the upper side of the cabinet 3011, and amain door 3013 provided at the front face of the cabinet 3011.

On the main door 3013, there is provided a lower image display panel 3016 as a display. The lower image display panel 3016 includes a transparent liquid crystal panel which displays fifteen display blocks 3028 along five columns and three rows. A single symbol is displayed in each display block 28. Further, although not illustrated, various types of images relating to an effect, as well as the aforementioned images, are displayed to the lower image display panel 3016.

Further, a number-of-credits display portion 3031 and a number-of-payouts display portion 3032 are provided on the lower image display panel 3016. The number-of-credits display portion 3031 displays an image indicative of the number of credited coins. The number-of-payouts display portion 3032 displays an image indicative of the number of coins to be paid out.

Moreover, although not shown, a touch panel 3069 is provided at the front face of the lower image display panel 3016. A player can operate the touch panel 3069 to input a variety of commands.

Below the lower image display panel 3016, there are provided a control panel 3020 including a plurality of buttons 3023 to 3027 with each of which a command according to game progress is inputted by the player, a coin receiving slot 3021 through which a coin is accepted into the cabinet 3011, and a bill validator 3022.

The control panel 3020 is provided with a start button 3023, a change button 3024, a CASHOUT button 3025, a 1-BET button 3026 and a maximum BET button 3027. The start button 3023 is for inputting a command to start scrolling of symbols. The change button 3024 is used for making a request of staff in the recreation facility for exchange. The CASHOUT button 3025 is used for inputting a command to pay out credited coins to a coin tray 3018.

The 1-BET button 3026 is used for inputting a command to bet one coin on a game out of credited coins. The maximum BET button 3027 is used for inputting a command to bet the maximum number of coins that can be bet on one game (50 coins in the fourth embodiment) out of credited coins.

The bill validator 3022 not only discriminates a regular bill from a false bill, but also accepts the regular bill into the cabinet 3011. It is to be noted that the bill validator 3022 can read a barcode 3502 printed on a final-round participation ticket 3500 and a barcode 3582 printed on a preliminary-round participation ticket 3580. A player can participate in a final tournament by making the bill validator 3022 read a final-round participation ticket 3500. Further, a player can participate in a preliminary tournament by making the bill validator 3022 read a preliminary-round participation ticket 3580. At the lower front of the main door 3013, namely, below the control panel 3020, there is provided a belly glass 3034 on which a character or the like of the slot machine 3010 is drawn.

On the front surface of the top box 3012, there is provided an upper image display panel 3033. The upper image display panel 3033 includes a liquid crystal panel, which displays, for example, images indicative of introductions of the contents of a game, explanations about the rules of the game, and a later-described tournament tree (see FIG. 105).

Further, a speaker 3029 is provided in the top box 3012. Under the upper image display panel 3033, there are provided a ticket printer 3035, a card reader 3036, a data display 3037, and a key pad 3038. The ticket printer 3035 prints on a ticket a barcode that represents encoded data of the number of credits, date, the identification number of the slot machine 3010, and the like, and produces the ticket as a ticket 3039 with a barcode.

The card reader 3036 reads data from a smart card and writes data into the smart card. The smart card is a card owned by the player, and for example, data for identifying the player (player identification information) and data on a history of games played by the player are stored therein. Data corresponding to a coin, a bill or a credit may be stored in the smart card. Further, a magnetic stripe card may be adopted in place of the smart card. The data display 3037 includes a fluorescent display and the like, and displays, for example, data read by the card reader 3036 or data inputted by the player via the key pad 3038. The key pad 3038 is used for inputting a command and data concerning issuing of a ticket, and the like.

Figure 91:
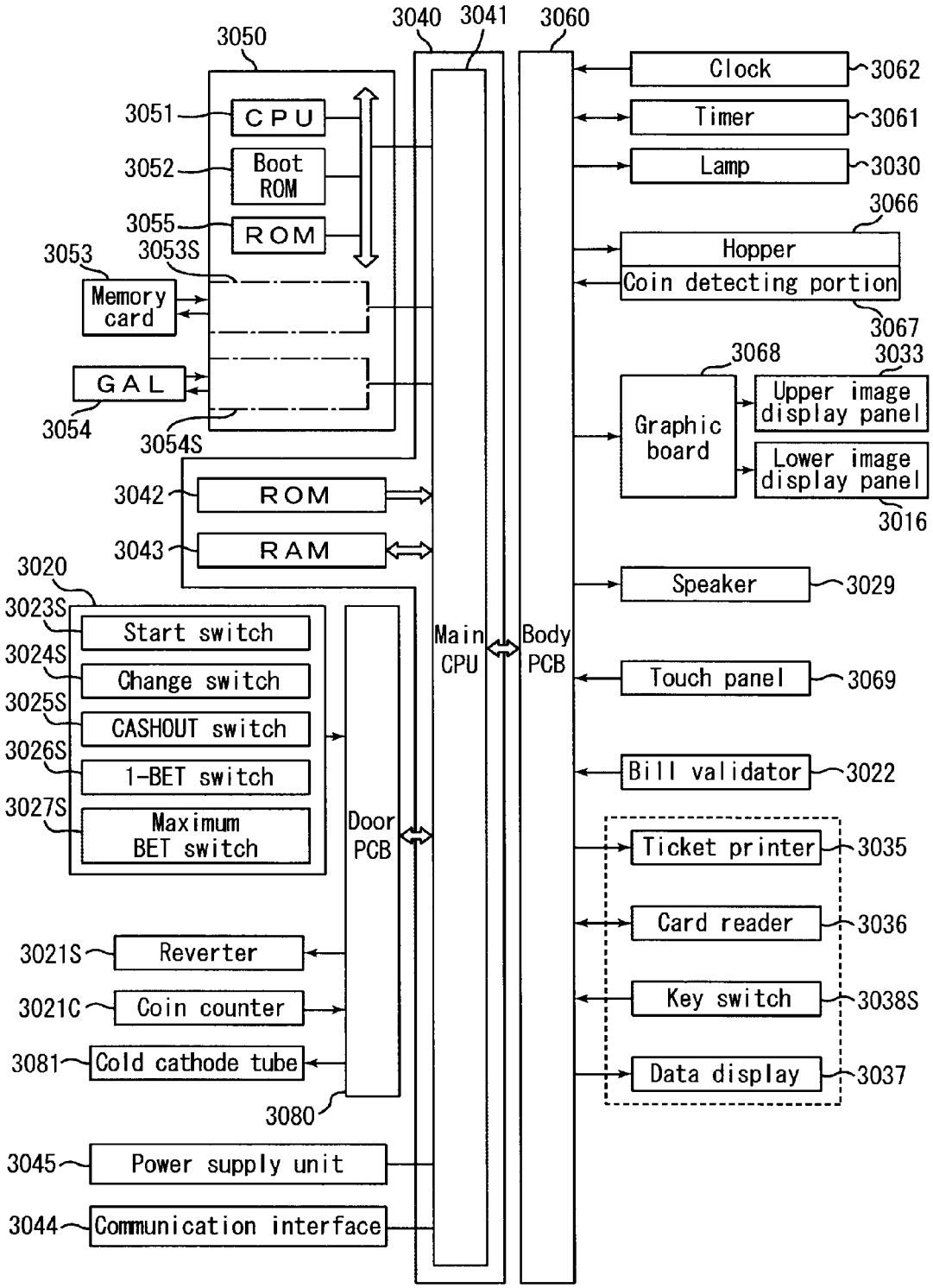

FIG. 91 is a block diagram illustrating an internal configuration of the slot machine shown in FIG. 90.

A gaming board 3050 is provided with a CPU (Central Processing Unit) 51, a ROM 3055, and a boot ROM 3052 which are interconnected to one another by an internal bus, a card slot 30535 corresponding to a memory card 3053, and an IC socket 3054S corresponding to a GAL (Generic Array Logic) 3054.

The memory card 3053 includes a nonvolatile memory such as CompactFlash (registered trade mark), and stores a game program. The game program includes a symbol determination program. The symbol determination program is a program for determining symbols to be rearranged in the display blocks 3028.

The symbols to be determined by the symbol determination program include 8 types of symbols including "RIBBON", "HEART", "STAR", "MOON", "SUN", "JEWEL", "CROWN", and "SMILE".

Further, the card slot 3053S is configured so as to allow the memory card 3053 to be inserted thereinto or removed therefrom, and is connected to the mother board 3040 by an IDE bus. Therefore, the type and contents of a game played on the slot machine 3010 can be changed by removing the memory card 3053 from the card slot 3053S, writing another game program into the memory card 3053, and inserting the memory card 3053 into the card slot 3053S. The game program includes a program relating to progress of the game. Further, the game program includes image data and sound data to be outputted during the game. The game program also includes odds data showing a correspondence relationship between a type and the number of rearranged symbols and an amount of payout (see FIG. 103), and the like.

The CPU 3051, the ROM 3055 and the boot ROM 3052 interconnected to one another by an internal bus are connected to the mother board 3040 through a PCI bus. The PCI bus not only conducts signal transmission between the mother board 3040 and the gaming board 3050, but also supplies power from the mother board 3040 to the gaming board 3050.

The mother board 3040 is configured using a commercially available general-purpose mother board (a print wiring board on which fundamental components of a personal computer are mounted), and provided with a main CPU 3041, a ROM (Read Only Memory) 42, a RAM (Random Access Memory) 43, and a communication interface 3044.

The ROM 3042 comprises a memory device such as a flash memory, and stores a program such as a BIOS (Basic Input/Output System) executed by the main CPU 3041, and permanent data. When the BIOS is executed by the main CPU 3041, processing for initializing a predetermined peripheral device is conducted, concurrently with start of processing for loading the game program stored in the memory card 3053 via the gaming board 3050. It is to be noted that, in the present invention, the ROM 3042 may or may not be data rewritable one.

The RAM 3043 stores data and a program to be used at the time of operation of the main CPU 3041. Further, the RAM 3043 is capable of storing a game program.

Moreover, the RAM 3043 stores data of the number of credits, the numbers of coin-ins and coin-outs in one game, and the like.

The mother board 3040 is connected with a later-described body PCB (Printed Circuit Board) 3060 and a door PCB 3080 through respective USBs. Further, the mother board 3040 is connected with a power supply unit 3045 and the communication interface 3044.

The body PCB 3060 and the door PCB 3080 are connected with an instrument and a device that generate an input signal to be inputted into the main CPU 3041 and an instrument and a device operations of which are controlled by a control signal outputted from the main CPU 3041. The main CPU 3041 executes the game program stored in the RAM 3043 based on the input signal inputted into the main CPU 3041, and thereby executes the predetermined arithmetic processing, stores the result thereof into the RAM 3043, or transmits a control signal to each instrument and device as processing for controlling each instrument and device.

The body PCB 3060 is connected with a lamp 3030, a hopper 3066, a coin detecting portion 3067, a graphic board 3068, the speaker 3029, the touch panel 3069, the bill validator 3022, the ticket printer 3035, the card reader 3036, a key switch 3038S, the data display 3037, a timer 3061, and a clock 3062. The lamp 3030 is lighted in a predetermined pattern based on control signals outputted from the main CPU 3041.

The hopper 3066 is installed inside the cabinet 3011, and pays out a predetermined number of coins based on a control signal outputted from the main CPU 3041, from a coin payout exit 3019 to the coin tray 3018. The coin detecting portion 3067 is provided inside the coin payout exit 3019, and outputs an input signal to the main CPU 3041 in the case of detecting payout of the predetermined number of coins from the coin payout exit 3019.

The timer 3061 is used for measuring the time. The clock 3062 is used for timekeeping. The clock 3062 sets its time every time a predetermined period elapses. The clock 3062 sets its time by getting time data from a clock 3249 that is provided in the server 3200.

The graphic board 3068 controls image display to the upper image display panel 3033 and the lower image display panel 3016 based on a control signal outputted from the main CPU 3041. In the respective display blocks 3028 on the lower image display panel 3016, symbols are displayed in a scrolling manner or in a stopped state. The number of credits stored in the RAM 3043 is displayed to the number-of-credits display portion 3031 of the lower image display panel 3016. Further, the number of coin-outs is displayed to the number-of-payouts display portion 3032 of the lower image display panel 3016.

The graphic board 3068 comprises a VDP (Video Display Processor) for generating image data based on a control signal outputted from the main CPU 3041, a video RAM for temporarily storing image data generated by the VDP, and the like. It is to be noted that image data used in generation of the image data by the VDP is included in the game program read from the memory card 3053 and stored into the RAM 3043.

The bill validator 3022 not only discriminates a regular bill from a false bill, but also accepts the regular bill into the cabinet 3011. Upon acceptance of the regular bill, the bill validator 3022 outputs an input signal to the main CPU 3041 based on a face amount of the bill. The main CPU 3041 stores in the RAM 3043 the number of credits corresponding to the face amount of the bill transmitted with the input signal.

Further, when receiving a final-round participation ticket 3500, the bill validator 3022 reads a barcode printed on the final-round participation ticket 3500 and obtains information such as the player name from the read barcode. Then, the bill validator 3022 outputs the obtained data to the main CPU 3041. Also, when receiving a preliminary-round participation ticket 3580, the bill validator 3022 reads a barcode printed on the preliminary-round participation ticket 3580 and obtains information such as the player name from the read barcode. Then, the bill validator 3022 outputs the obtained data to the main CPU 3041.

The ticket printer 3035 prints on a ticket a barcode that represents encoded data of the number of credits stored in the RAM 3043, date, the identification number of the slot machine 3010, and the like, based on a control signal outputted from the main CPU 3041. Then, the ticket printer 3035 provides the ticket as a ticket 3039 with a barcode.

The card reader 3036 reads data from the smart card and transmits the read data to the main CPU 3041, and writes data onto the smart card based on a control signal from the main CPU 3041. The key switch 3038S is provided on the key pad 3038, and outputs a predetermined input signal to the main CPU 3041 when the key pad 3038 is operated by the player. The data display 3037 displays data read by the card reader 3036 and data inputted by the player via the key pad 3038, based on a control signal outputted from the main CPU 3041.

The door PCB 3080 is connected with the control panel 3020, a reverter 30215, a coin counter 3021C, and a cold cathode tube 3081. The control panel 3020 is provided with a start switch 3023S corresponding to the start button 3023, a change switch 3024S corresponding to the change button 3024, a CASHOUT switch 3025S corresponding to the CASHOUT button 3025, a 1-BET switch 3026S corresponding to the 1-BET button 3026, and a maximum BET switch 3027S corresponding to the maximum BET button 3027. Each of the switches 3023S to 3027S outputs an input signal to the main CPU 3041 when each of the buttons 3023 to 3027 corresponding thereto is operated by the player.

The coin counter 3021C is provided inside the coin receiving slot 3021, and discriminates a regular coin from a false coin when a coin is inserted into the coin receiving slot 3021 by the player. Coins other than the regular coin are discharged from the coin payout exit 3019. Further, the coin counter 3021C outputs an input signal to the main CPU 3041 in detection of the regular coin.

The reverter 3021S operates based on the control signal outputted from the main CPU 3041, and distributes a coin recognized by the coin counter 3021C as the regular coin into a cash box (not shown) or the hopper 3066, which are disposed in the slot machine 3010. Namely, when the hopper 3066 is filled with coins, the regular coin is distributed into the cash box by the reverter 3021S. On the other hand, when the hopper 3066 is not filled with coins, the regular coin is distributed into the hopper 3066. The cold cathode tube 3081 functions as aback light installed on the rear face side of the lower image display panel 3016 and the upper image display panel 3033, and lighted up based on the control signal outputted from the main CPU 3041.

Figure 92:
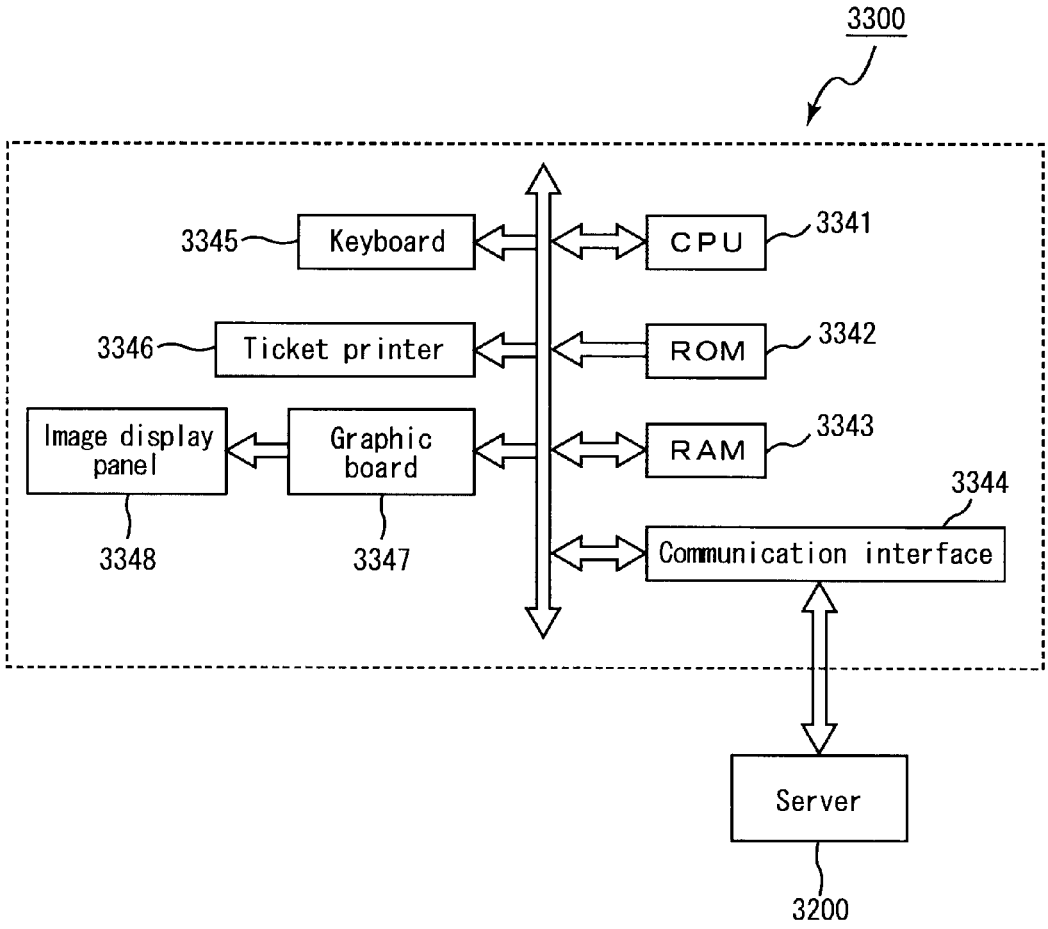

FIG. 92 is a block diagram illustrating an internal configuration of a ticket issuing device that constitutes the ticket issuing system according to the fourth embodiment of the present invention.

Each ticket issuing device 3300 is provided with the CPU 3341 as a processor, a ROM 3342, a RAM 3343, a communication interface 3344, the keyboard 3345, the ticket printer 3346, a graphic board 3347, and the image display panel 3348.

The keyboard 3345 is used for inputting letters and numerals. The keyboard 3345 corresponds to the input device of the present invention. The input device of the present invention is not limited to the keyboard 3345, and may be, for example, a touch panel. If this is the case, a keyboard image may be displayed to an image display (e.g. an image display provided in a ticket issuing device), and a letter or a numeral may be inputted when the touch panel detects a touch at a location corresponding to the keyboard image.

The ticket printer 3346 is for printing on a ticket a barcode that represents encoded information, such as information on the player name and information that shows that the ticket is a final-round participation ticket, and then providing the ticket as a final-round participation ticket 3500. The ticket printer 3346 corresponds to the ticket issuing terminal of the present invention. The ticket issuing terminal of the present invention is not particularly limited, and may use ink printing technology, or may use thermal printing technology with thermal paper.

The graphic board 3347 controls image display on the image display panel 3348 based on a control signal outputted from the CPU 3341. The image display panel 3348 displays an input screen for the player name, and the like.

The communication interface 3344 is connected through a communication line to a communication interface 3244 that is provided in the server 3200. The ROM 3342 stores a system program for controlling operation of the processor, permanent data, and the like. The RAM 3343 temporarily stores data received from the server 3200, and the like.

Figure 93:
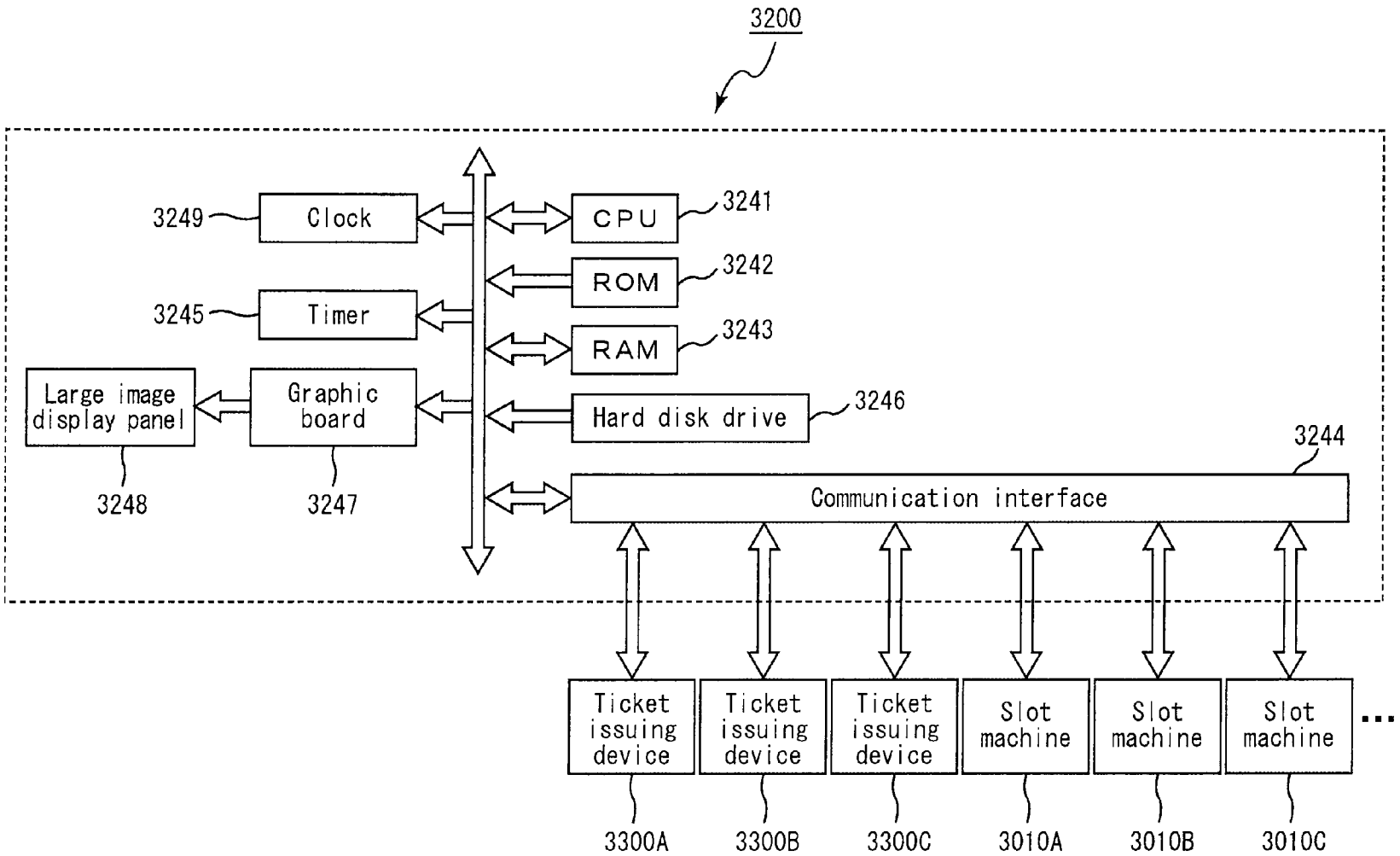

FIG. 93 is a block diagram illustrating an internal configuration of the server that constitutes the ticket issuing system according to the fourth embodiment of the present invention.

The server 3200 is provided with the CPU 3241, a ROM 3242, the RAM 3243, the communication interface 3244, a timer 3245, a hard disk 3246, a graphic board 3247, a large image display panel 3248, and the clock 3249.

The graphic board 3247 controls image display on the large image display panel 3248 based on a control signal outputted from the CPU 3241. The large image display panel 3248 displays a result (ranking) of a tournament-type game, and the like. The timer 3245 is used for measuring time. The clock 3249 is used for time keeping.

The communication interface 3244 is connected through each communication line to the communication interface 3344 of each ticket issuing device 3300 and to a communication interface 3044 of each slot machine 3010. The ROM 3242 stores a system program for controlling operation of the CPU 3241, permanent data, and the like. The ROM 3242 also stores data on the start time and the end time. The RAM 3243 temporarily stores data received from the slot machines 3010 and the like.

FIG. 94 is a view illustrating exemplary game-history data that is stored in the hard disk provided in the server.

As shown in FIG. 94, the hard disk 3246 stores player identification information showing a player name; the total number of normal games played by the player in the past; and the highest rank in a preliminary tournament (normal game) played by the player in the past. The hard disk 3246 corresponds to the storage device of the present invention. Further, the data showing the result of a preliminary tournament corresponds to the game result information of the present invention. In the fourth embodiment, a case is described in which a player name is used as the player identification information. However, in the present invention, the player identification information is not particularly limited so long as it is information used for identifying a player. For example, the player identification information may be a combination of numerals (e.g. a 6-digit numeral). In the fourth embodiment, pieces of the player identification information are different from each other. That is, players with the same player name do not exist. However, in the present invention, the same piece of the player information may be provided to different players so long as it is possible to identify the players. For example, a piece of the player identification information used in a ticket issuing system and a piece of the player identification information used in another ticket issuing system may be the same so long as the same pieces of the player identification information do not exist in one ticket issuing system.

Figure 95:
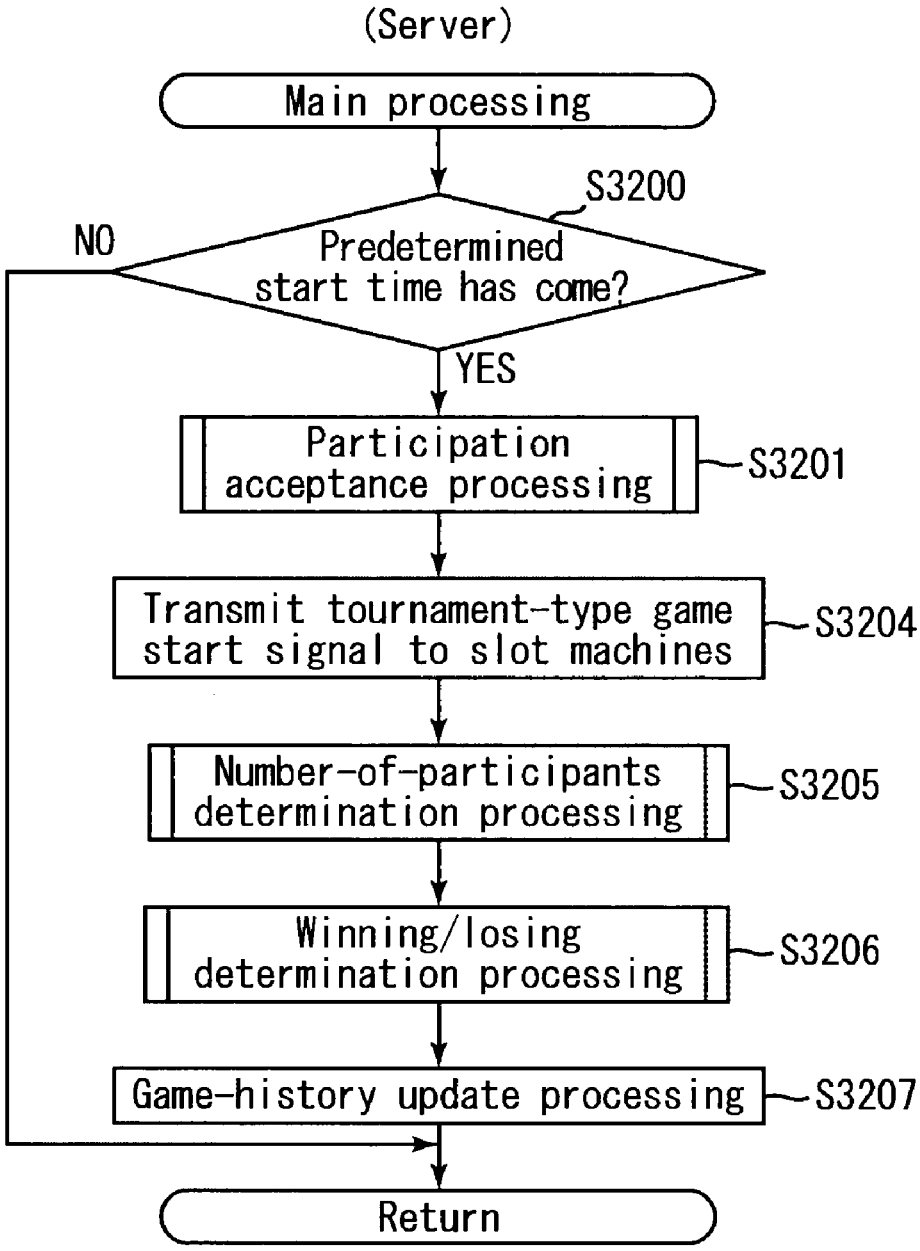

FIG. 95 is a flowchart illustrating main processing executed in the server.

First, the CPU 3241 determines whether or not the predetermined start time (e.g. 14:00) has come, at a predetermined timing (step S3200). In the processing, the CPU 3241 determines whether or not the time shown by the clock 3249 is the predetermined start time. When determining that the predetermined start time has not come yet, the CPU 3241 ends the main processing.

On the other hand, when determining in step S3200 that the predetermined start time has come, the CPU 3241 executes participation acceptance processing (step S3201). In the processing, the CPU 3241 controls issuance of a final-round participation ticket 3500 or a preliminary-round participation ticket 3580 to players who wish to participate in a tournament-type game. The participation acceptance processing has already been described based on FIG. 88D, and thus descriptions thereof are omitted here.

The CPU 3241 then transmits a tournament-type game start signal to the slot machines 3010 (step S3204).

Thereafter, the CPU 3241 executes number-of-participants determination processing (step S3205). In the processing, the CPU 3241 determines the number of players who participate in the tournament-type game; the number of tournaments; and assignment of the slot machines 3010 participating in the tournament-type game to the tournaments. The number-of-participants determination processing will be described later with reference to a drawing.

The CPU 3241 executes winning/losing determination processing (step S3206). In the processing, the CPU 3241 determines the winning slot machine of each match in each tournament. The winning/losing determination processing will be described later with reference to drawings.

The CPU 3241 executes game-history update processing (step S3207). In the processing, the CPU 3241 stores ranks achieved by respective players in a preliminary tournament into the hard disk 3246 as pieces of the game-history data (see FIG. 94). At this time, when information of a rank is already included in a piece of the game-history data, the CPU 3241 compares the already included rank with the present rank to store the better rank (higher rank) of the two. After executing the processing of step S3207, the CPU 3241 ends the main processing.

Figure 96:
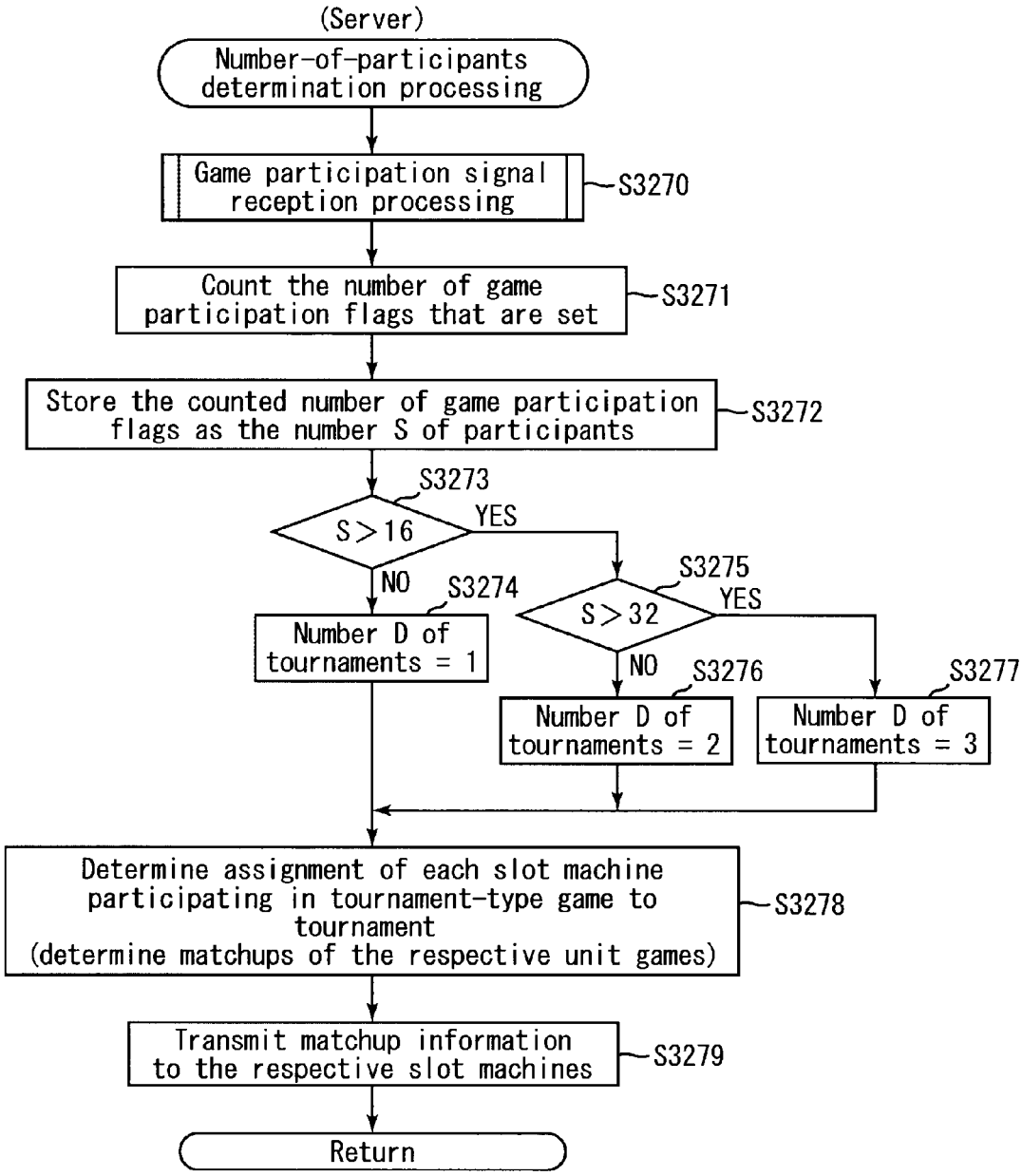

FIG. 96 is a flowchart illustrating a subroutine of the number-of-participants determination processing.

First, the CPU 3241 executes game participation signal reception processing (step S3270). In the processing, when receiving a game participation signal, the CPU 3241 sets a game participation flag in association with the identification number of the slot machine 3010 as the transmission source. The game participation signal reception processing will be described later with reference to a drawing.

The CPU 3241 counts the number of game participation flags that are set (step S3271). Then, the CPU 3241 stores the counted number of game participation flags into the RAM 3243 as the number S of participants (step S3272).

The CPU 3241 determines whether or not the number S of participants in the RAM 3243 is more than 16 (step S3273). When determining that the number S of participants is not more than 16, the CPU 3241 determines 1 as the number D of tournaments which indicates the number of tournaments in a tournament-type game (step S3274). The CPU 3241 then stores 1 into the RAM 3243 as the number D of tournaments.

On the other hand, when determining in step S3273 that the number S of participants is more than 16, the CPU 3241 determines whether or not the number S of participants in the RAM 3243 is more than 32 (step S3275). When determining that the number S of participants is not more than 32, the CPU 3241 determines 2 as the number D of tournaments which indicates the number of tournaments in a tournament-type game (step S3276). The CPU 3241 then stores 2 into the RAM 3243 as the number D of tournaments.

On the other hand, when determining in step S3275 that the number S of participants is more than 32, the CPU 3241 determines 3 as the number D of tournaments which indicates the number of tournaments in a tournament-type game (step S3277). The CPU 3241 then stores 3 into the RAM 3243 as the number D of tournaments.

In the fourth embodiment, the number of tournaments in a tournament-type game is changed in accordance with the number S of participants. This will avoid a situation in which the time it takes from beginning to end of a tournament-type game is long because one tournament includes too many participating players; as a result, it is possible to prevent players from getting tired of the game.

Further, when a tournament-type game starts, matches are held in respective tournaments. That is, matches in the respective tournaments are simultaneously held. In the fourth embodiment, the maximum number of tournaments is 3. Increasing the number of tournaments makes it possible to increase the number of players who can be accepted to participate in the tournament-type game.

When executing the processing of step S3274, step S3276, or step S3277, the CPU 3241 determines assignment of the slot machines 3010 participating in the tournament-type game to the tournaments (step S3278). In the processing, the CPU 3241 first identifies the number D of tournaments which has been determined in the processing of step S3274, step S3276, or step S3277. Next, the CPU 3241 determines the number of tournament participants which indicates the number of players who participate in one tournament, based on the identified number D of tournaments and the number S of participants. For example, when the number D of tournaments is 2 and the number S of participants is 30, the number of tournament participants is 15.

Then, the CPU 3241 assigns the slot machines 3010 to a tournament tree from the left in the ascending order of the identification numbers of the slot machines 3010 such that a slot machine 3010 with the smallest identification number among the participating slot machines 3010 is assigned to the leftmost position. When the CPU 3241 has filled the tournament tree (when assignment of the slot machines 3010 in number equal to the number of tournament participants has been completed), the CPU 3241 starts assigning the slot machines 3010 to the next tournament tree in the same way.

In the processing of step S3278, a matchup for each unit game (each match in a tournament) in the respective tournaments is determined.

The CPU 3241 transmits as matchup information the assignment of the slot machines 3010 participating in the tournament-type game to the tournaments (the assignments determined in step S3278) to the slot machines 3010 participating in the tournament-type game (step S3279).

After executing the processing of step S3279, the CPU 3241 ends the present subroutine.

Figure 97:
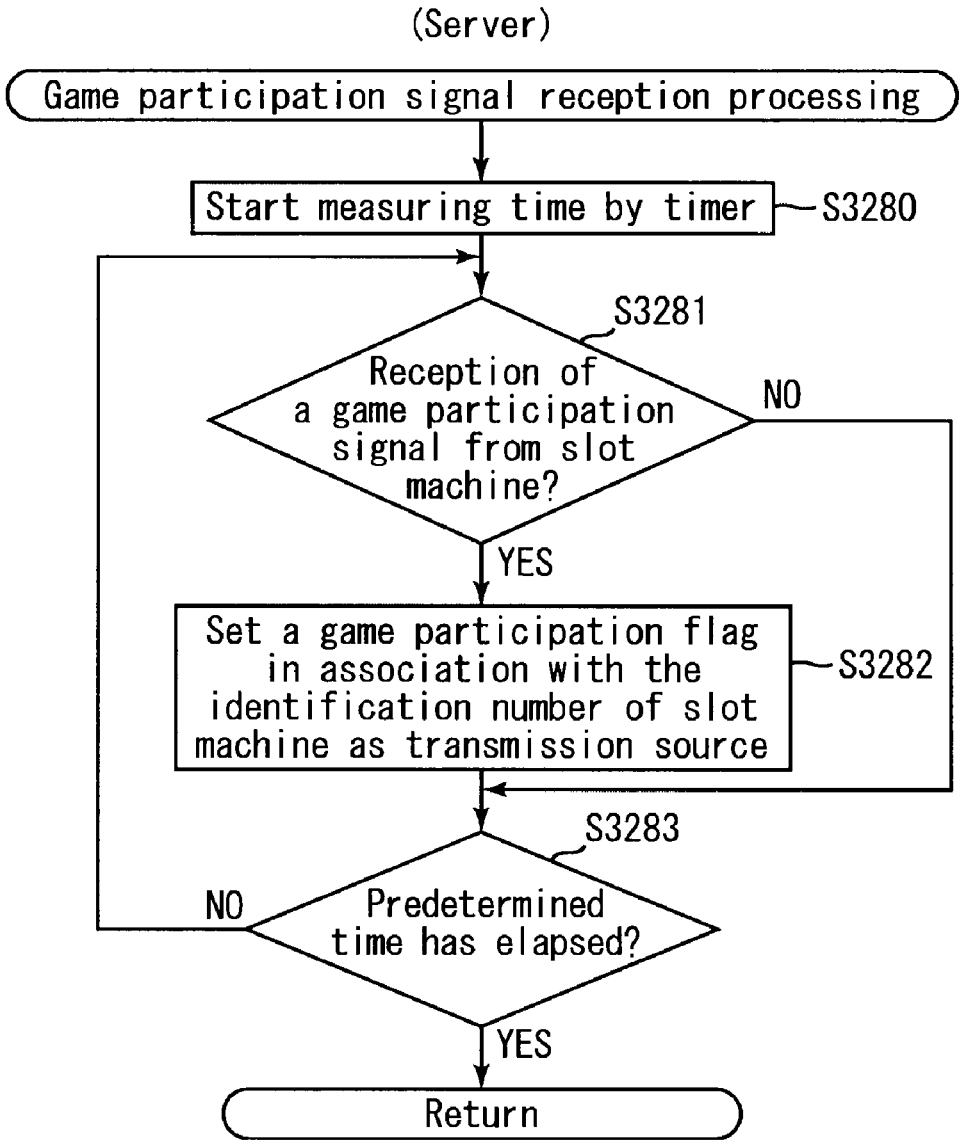

FIG. 97 is a flowchart illustrating a subroutine of the game participation signal reception processing.

First, the CPU 3241 starts measuring time with the timer 3245 (step S3280).

Next, the CPU 3241 determines whether or not the CPU 3241 has received a game participation signal from any of the slot machines 3010 (step S3281). When the CPU 3241 determines that the CPU 3241 has received a game participation signal, the CPU 3241 sets a game participation flag in association with the identification number of the slot machine 3010 as the transmission source of the game participation signal (step S3282).

When the CPU 3241 determines in step S3281 that the CPU 3241 has not received a game participation signal, or when the CPU 3241 has executed the processing of step S3282, the CPU 3241 determines whether or not the predetermined time has elapsed (step S3283). In the processing, the CPU 3241 determines whether or not the time measured with the timer 3245 has reached the predetermined time. When determining that the predetermined time has not elapsed, the CPU 3241 returns the processing to step S3281.

On the other hand, when determining in step S3283 that the predetermined time has elapsed, the CPU 3241 ends the present subroutine.

Figure 98A:
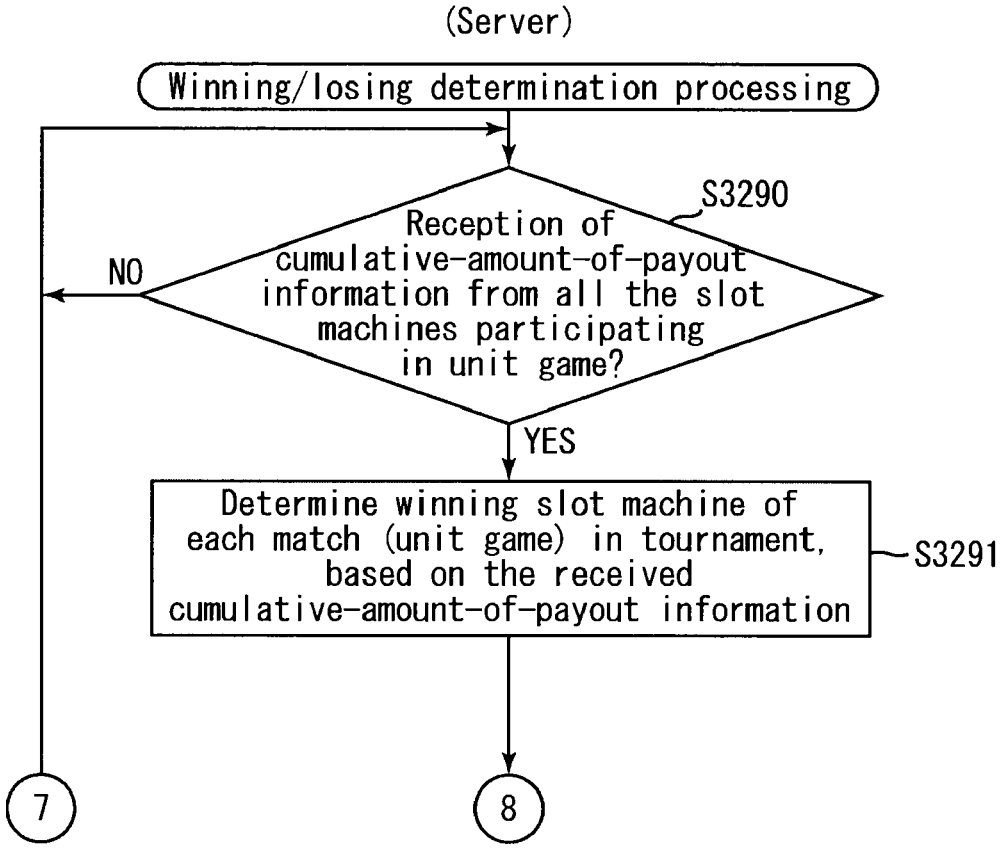
Figure 98B:
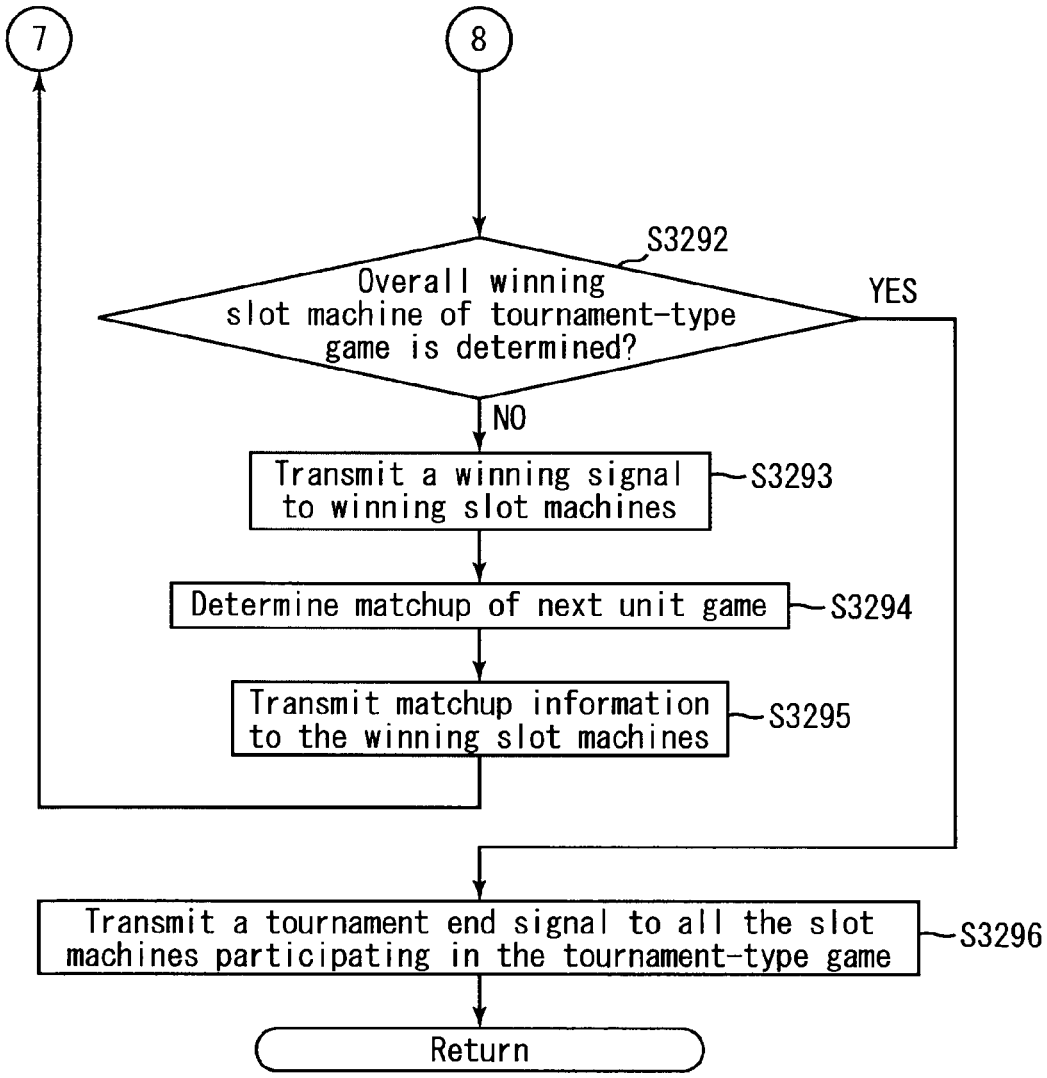

FIG. 98A and FIG. 98B are flowcharts each illustrating a subroutine of the winning/losing determination processing.

First, the CPU 3241 determines whether or not the CPU 3241 has received cumulative-amount-of-payout information from every slot machine participating in a unit game (step S3290). The cumulative amount of payout is the amount of payout of coins obtained in a unit game. The cumulative-amount-of-payout information is information showing the cumulative amount of payout. When the CPU 3241 determines that the CPU 3241 has not received cumulative-amount-of-payout information from every slot machine participating in a unit game, the CPU 3241 returns the processing to step S3290.

On the other hand, when the CPU 3241 determines that the CPU 3241 has received cumulative-amount-of-payout information from every slot machine participating in a unit game, the CPU 3241 determines the winning slot machine of each match (unit game) in the tournaments based on the received pieces of cumulative-amount-of-payout information (step S3291). In the processing, the CPU 3241 determines for each match the slot machine 3010 with the cumulative-amount-of-payout information which shows a cumulative amount of payout larger than that of the cumulative-amount-of-payout information of the other slot machine 3010 as the winning slot machine of the match. The determination is made based on the received pieces of cumulative-amount-of-payout information; the identification number of the slot machine 3010 included in each piece of cumulative-amount-of-payout information; and the matchups of the respective unit games (matches) in the respective tournaments which have been determined in step S3278.

The CPU 3241 then determines whether or not the winning slot machine of the tournament-type game has been determined (step S3292). In the processing, the CPU 3241 determines whether or not only one slot machine 3010 has been determined as the winning slot machine in every tournament.

That is, in step S3292, whether or not the overall winning slot machine 3010 in every tournament is determined.

When the CPU 3241 determines that the winning slot machine of the tournament-type game has not been determined, the CPU 3241 transmits a winning signal to the slot machines 3010 that have been determined as the winning slot machines (step S3293). It should be noted that when only one slot machine 3010 has been determined as the winning slot machine in a tournament, the CPU 3241 does not transmit the winning signal to the slot machine that has been determined as the winning slot machine in this tournament. That is, the CPU 3241 does not transmit the winning signal to the slot machine 3010 that has been determined as the overall winner.

The CPU 3241 determines matchups for the next unit games (matches) (step S3294). In the processing, the CPU 3241 determines the matchups of the next unit games (matches), based on the winning slot machines determined in step S3291 and assignment of the slot machines 3010 to the tournaments which has been determined in step S3278.

The CPU 3241 transmits as matchup information the matchups of the unit games (matches) determined in step S3294 to the slot machines 3010 that have been determined as the winning slot machines (step S3295).

After executing the processing of step S3295, the CPU 3241 shifts the processing to step S3290.

When determining in step S3292 that the winning slot machine of the tournament-type game has been determined, the CPU 3241 transmits a tournament end signal to all the slot machines 3010 that participate in the tournament-type game (step S3296). In the processing, the CPU 3241 transmits the tournament end signal to the slot machines 3010 for each of which a game participation flag is set in association with the identification number. The tournament end signal includes information on the ranking for each tournament in the executed tournament-type game. That is, the ranking of the respective slot machines is determined before the tournament end signal is transmitted. The slot machine 3010 that has been determined as the overall winner takes first place, and the ranks of the respective other slot machines 3010 are determined in order. When a tournament is of a preliminary round, the ranks in the tournament-type game are stored in the hard disk 3246 of the server 3200 as pieces of the game-history data (see FIG. 94) (see step S3207 in FIG. 95).

Figure 99:
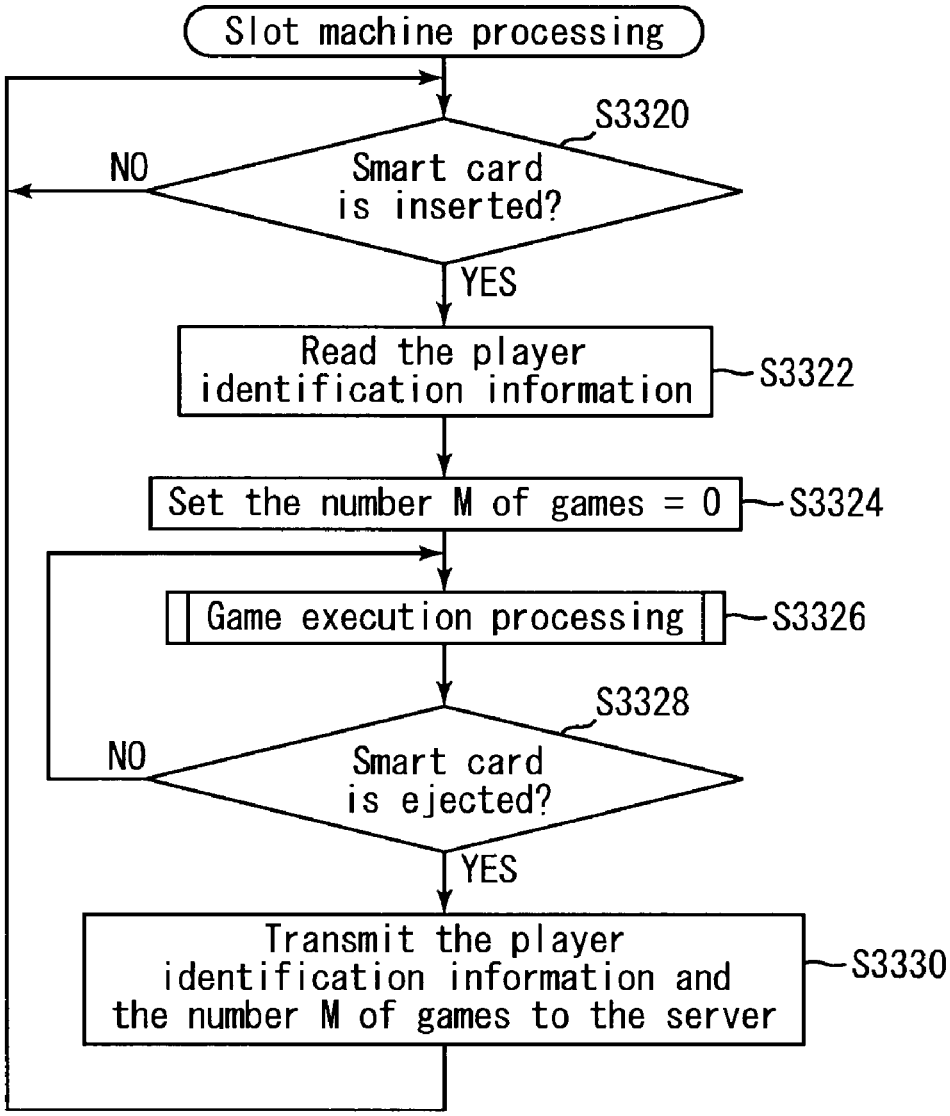

FIG. 99 is a flowchart illustrating slot machine processing that is executed in each slot machine.

First, in step S3320, the main CPU 3041 determines whether or not a smart card is inserted into the card reader 3036. When determining that a smart card is inserted into the card reader 3036, the main CPU 3041 reads player identification information from the smart card (step S3322).

Next, in step S3324, the main CPU 3041 sets the number M of games to 0 in a predetermined area in the main RAM 3043. The number M of games is the number of normal games which is described later.

Then, in step S3326, the main CPU 3041 executes game execution processing. The game execution processing will be described later with reference to FIG. 100.

After that, in step S3328, the main CPU 3041 determines whether or not the smart card is ejected from the card reader 3036. When determining that the smart card is not ejected from the card reader 3036, the main CPU 3041 returns the processing to step S3326. On the other hand, when determining that the smart card is ejected from the card reader 3036, the main CPU 3041 transmits to the server 3200 the player identification information read in step S3322 and the number M of games, and then returns the processing to step S3320.

Figure 100:
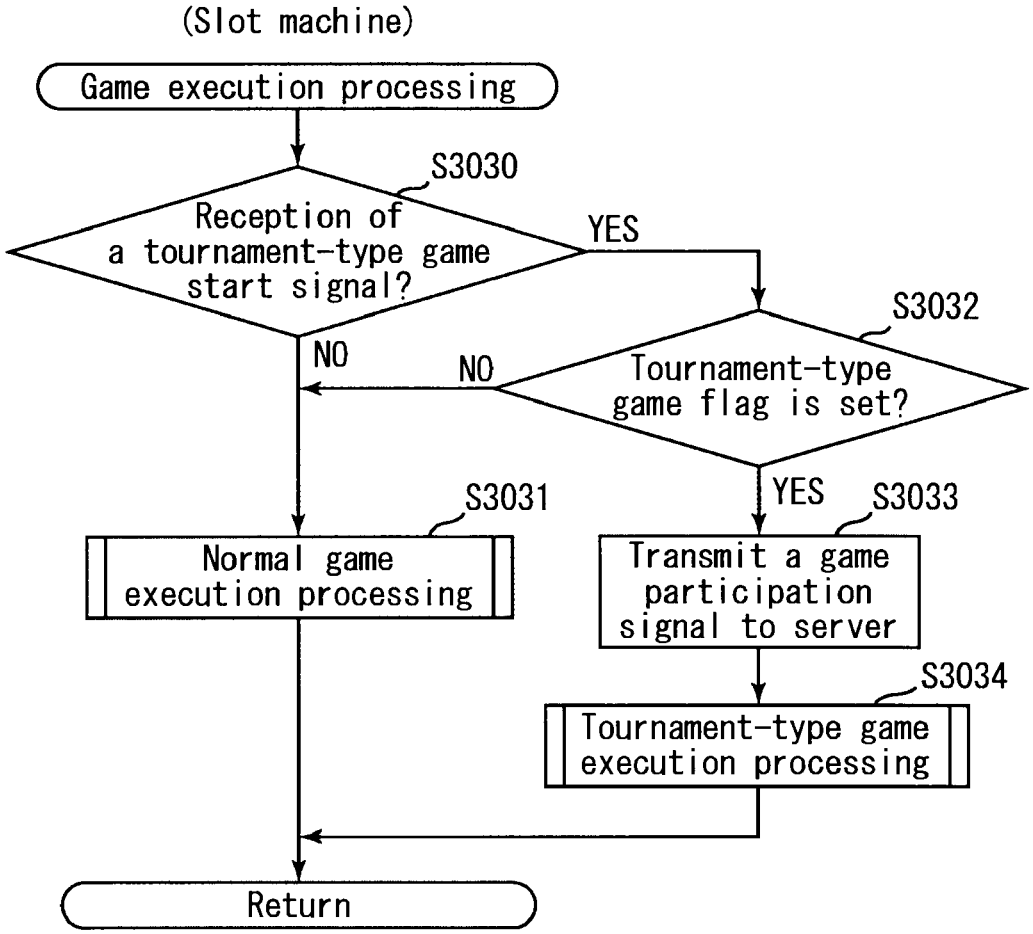

FIG. 100 is a flowchart illustrating the game execution processing that is executed in each slot machine.

First, the main CPU 3041 determines whether or not the main CPU 3041 has received the tournament-type game start signal from the server 3200 (step S3030).

When the main CPU 3041 determines in step S3030 that the main CPU 3041 has received the tournament-type game start signal, the main CPU 3041 determines whether or not a tournament-type game flag is set (step S3032). The tournament-type game flag is set in flag setting processing shown in FIG. 101.

When the main CPU 3041 determines in step S3030 that the main CPU 3041 has not received the tournament-type game start signal or when the main CPU 3041 determines in step S3032 that the tournament-type game flag is not set, the main CPU 3041 executes the normal-game execution processing (step S3031). The normal-game execution processing will be described later in detail with reference to a drawing.

When the main CPU 3041 determines in step S3032 that the tournament-type game flag is set, the main CPU 3041 transmits a game participation signal to the server 3200 (step S3033). The game participation signal includes the identification number of the slot machine 3010.

Next, the main CPU 3041 executes tournament-type game execution processing (step S3034), and then ends the present subroutine. The tournament-type game execution processing will be described later with reference to drawings.

FIG. 101 is a flowchart illustrating a subroutine of the flag setting processing.

The main CPU 3041 first determines whether or not the tournament-type game flag is set, at a predetermined timing (step S3040). When determining that the tournament-type game flag is set, the main CPU 3041 ends the present subroutine.

On the other hand, when determining in step S3040 that the tournament-type game flag is not set, the main CPU 3041 determines whether or not a final-round participation ticket 3500 or a preliminary-round participation ticket 3580 is inserted into the bill validator 3022 (step S3041). When determining that a final-round participation ticket 3500 or a preliminary-round participation ticket 3580 is not inserted into the bill validator 3022, the main CPU 3041 ends the present subroutine.

On the other hand, when determining in step S3041 that a final-round participation ticket 3500 or a preliminary-round participation ticket 3580 is inserted into the bill validator 3022, the main CPU 3041 determines whether or not the final-round participation ticket 3500 or the preliminary-round participation ticket 3580, which has been inserted into the bill validator 3022, is a final-round participation ticket 3500 or a preliminary-round participation ticket 3580 which is for participating in the next tournament-type game (step S3042). In the fourth embodiment, a tournament-type game is executed every two hours. Therefore, in the processing of step S3042, the main CPU 3041 determines whether or not the start time of the tournament-type game associated with the tournament identification information, which has been read from the final-round participation ticket 3500 or the preliminary-round participation ticket 3580 inserted into the bill validator 3022, is within the acceptance period corresponding to the start time (the period from 1 hour before the start time to 15 minutes before the start time), by referring to the time shown by the clock 3062.

When determining in step S3042 that the final-round participation ticket 3500 or the preliminary-round participation ticket 3580 inserted into the bill validator 3022 is not a final-round participation ticket 3500 or preliminary-round participation ticket 3580 which is for participating in the next tournament-type game, the main CPU 3041 ends the present subroutine.

When determining in step S3042 that the final-round participation ticket 3500 or the preliminary-round participation ticket 3580 inserted into the bill validator 3022 is a final-round participation ticket 3500 or a preliminary-round participation ticket 3580 for participating in the next tournament-type game, the main CPU 3041 sets the tournament-type game flag (step S3043).

Next, the main CPU 3041 reads the player name from the final-round participation ticket 3500 or the preliminary-round participation ticket 3580 inserted into the bill validator 3022, and stores the read player name into the RAM 3043 (step S3044).

After executing the processing of step S3044, the main CPU 3041 ends the present subroutine.

FIG. 102 is a flowchart illustrating a subroutine of normal-game execution processing.

First, the main CPU 3041 determines whether or not a coin has been betted (step S3012). In this processing, the main CPU 3041 determines whether or not the main CPU 3041 has received an input signal that is outputted from the 1-BET switch 3026S when the 1-BET button 3026 is operated, or an input signal that is outputted from the maximum BET switch 3027S when the maximum BET button 3027 is operated. When determining that a coin has not been betted, the main CPU 3041 returns the processing to step S3012.

On the other hand, when determining in step S3012 that a coin has been betted, the main CPU 3041 executes processing for making a subtraction from the number of credits stored in the RAM 3043 according to the number of betted coins (step S3013). It is to be noted that, when the number of coins to be betted is larger than the number of credits stored in the RAM 3043, the main CPU 3041 does not execute the processing for making a subtraction from the number of credits stored in the RAM 3043, and returns the processing to step S3012. Further, when the number of coins to be betted exceeds the upper limit of the number of coins that can be betted in one game (50 coins in the fourth embodiment), the main CPU 3041 does not execute the processing for making a subtraction from the number of credits stored in the RAM 3043, and proceeds with the processing to step S3014.

Next, the main CPU 3041 determines whether or not the start button 3023 has been turned ON (step S3014). In this processing, the main CPU 3041 determines whether or not the main CPU 3041 has received an input signal that is outputted from the start switch 3023S when the start button 3023 is pressed.

When the main CPU 3041 determines that the start button 3023 has not been turned ON, the main CPU 3041 returns the processing to step S3012.

It is to be noted that, when the start button 3023 is not turned ON (e.g. when the start button 3023 is not turned ON and a command to end the game is inputted), the main CPU 3041 cancels the subtraction result in step S3013.

On the other hand, when determining in step S3014 that the start button 3023 is turned ON, the main CPU 3041 executes symbol rearrangement processing (step S3015). In this processing, the main CPU 3041 first starts scroll-display of symbols in the display blocks 3028. Then, the main CPU 3041 executes the aforementioned symbol determination program, so as to determine the symbols to be rearranged, and then rearranges the symbols in the display blocks 3028.

Next, the main CPU 3041 determines whether or not a prize has been won (step S3016).

FIG. 103 is a view illustrating correspondence relationship between a type and the number of rearranged symbols and an amount of payout.

As shown in FIG. 103, an amount of payout is determined according to the type and number of the rearranged symbols. Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 3028 (see FIG. 103). In this processing, the main CPU 3041 counts the number of symbols for each type of the symbols rearranged in step S3017. Then, the main CPU 3041 determines whether or not the counted number is three or more.

When determining that a prize has been won, the main CPU 3041 executes processing relating to payout of coins (step S3017). In the processing, the main CPU 3041 determines the amount of payout based on the numbers of rearranged symbols with reference to the odds data stored in the ROM 3042. The odds data is data indicative of the correspondence relationship between the number of symbols rearranged in the display blocks 3028 and the amount of payout (see FIG. 103).

For example, in the case where three symbols of "SUN" are rearranged after two coins have been betted, 20 (=2×10) coins are paid out.

In the case of accumulating coins, the main CPU 3041 conducts processing for adding the number of credits corresponding to the determined amount of payout to the number of credits stored in the RAM 3043. On the other hand, in the case of paying out coins, the main CPU 3041 transmits a control signal to the hopper 3066 in order to pay out coins in an amount corresponding to the determined amount of payout.

When determining in step S3016 that no prize has been won or after executing the processing of step S3017, the main CPU 3041 adds 1 to the number M of games (step S3018), and then ends the present subroutine.

FIGS. 17A and 17B are flowcharts each illustrating a subroutine of the tournament-type game execution processing.

First, the main CPU 3041 stores 0 into the RAM 3043 as an updated total cumulative amount of payout (step S3060).

The main CPU 3041 determines whether or not the main CPU 3041 has received matchup information from the server 3200 (step S3061). When the main CPU 3041 determines that the main CPU 3041 has not received matchup information, the main CPU 3041 returns the processing to step S3061.

On the other hand, when the main CPU 3041 determines in step S3061 that the main CPU 3041 has received matchup information, the main CPU 3041 executes tournament-tree display processing (step S3062). In the processing, the main CPU 3041 displays a tournament tree image to the upper image display panel 3033, based on the received matchup information.

FIG. 105 is a view illustrating an exemplary image displayed to the upper image display panel that is provided in each slot machine constituting the ticket issuing system according to the fourth embodiment of the present invention.

In FIG. 105, the upper image display panel 3033 displays a tournament tree image 3602. To the lower part of the tournament tree image 3602, the player names of the players participating in the tournament-type game are displayed. Looking at the tournament tree image 3602, each player gets to know the player name of the player against whom he or she is going to have a match. A tournament name image 3601 shows the name of the tournament.

In the fourth embodiment, the number of tournaments in a tournament-type game changes within the range of 1 to 3 in accordance with the number S of participants. The name of the first tournament is Tournament A. The name of the second tournament is Tournament B. The name of the third tournament is Tournament C.

In FIG. 105, the tournament name image 3601 says Tournament B. That is, the tournament name image 3601 indicates that this tournament is the second tournament in the tournament-type game.

Referring back to FIG. 104A, the main CPU 3041 stores 0 into the RAM 3043 as an updated cumulative amount of payout (step S3063).

The main CPU 3041 stores 50 into the RAM 3043 as an updated number C of games (step S3064).

The main CPU 3041 determines whether or not a coin has been betted (step S3065). In the processing, the main CPU 3041 determines whether or not the main CPU 3041 has received an input signal outputted from the 1-BET switch 3026S when the 1-BET button 3026 is operated or an input signal outputted from the maximum BET switch 3027S when the maximum BET button 3027 is operated. When determining that a coin has not been betted, the main CPU 3041 returns the processing to step S3065.

On the other hand, when determining in step S3065 that a coin has been betted, the main CPU 3041 conducts processing of making a subtraction from the number of credits stored in the RAM 3043 in accordance with the number of the betted coins (step S3066). Here, in the case that the number of betted coins is larger than the number of credits stored in the RAM 3043, the main CPU 3041 returns the processing to step S3065 without executing the processing of making a subtraction from the number of credits stored in the RAM 3043. Further, in the case that the number of betted coins exceeds the upper limit value of the number of coins that can be betted in a single game (50 coins, in the fourth embodiment), the main CPU 3041 proceeds with the processing to step S3067 without executing the processing of making a subtraction from the number of credits stored in the RAM 3043.

Next, the main CPU 3041 determines whether or not the start button 3023 has been turned ON (step S3067). In the processing, the main CPU 3041 determines whether or not the main CPU 3041 has received an input signal that is outputted from the start switch 3023S when the start button 3023 is pressed.

When determining that the start button 3023 has not been turned ON, the main CPU 3041 returns the processing to step S3065.

Here, in the case that the start button 3023 is not turned ON (e.g. when the start button 3023 is not turned ON and a command to end the game is inputted), the main CPU 3041 cancels the subtraction result in step S3066.

On the other hand, when determining in step S3067 that the start button 3023 has been turned ON, the main CPU 3041 executes symbol rearrangement processing (step S3068).

In this processing, the main CPU 3041 first starts scroll-display of symbols in the display blocks 3028. Then, the main CPU 3041 executes the aforementioned symbol determination program, so as to determine the symbols to be rearranged, and then rearranges the symbols in the display blocks 3028.

Next, the main CPU 3041 determines whether or not a prize has been won (step S3069). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 3028 (see FIG. 103). In this processing, the main CPU 3041 counts the number of symbols for each type of the symbols rearranged in step S3068. Then, the main CPU 3041 determines whether or not the counted number is three or more.

When determining that a prize has been won, the main CPU 3041 executes processing relating to payout of coins (step S3070). In the processing, the main CPU 3041 determines the amount of payout based on the numbers of rearranged symbols with reference to the odds data stored in the ROM 3042. The odds data is data indicative of the correspondence relationship between the number of symbols rearranged in the display blocks 3028 and the amount of payout (see FIG. 103).

In the case of accumulating coins, the main CPU 3041 conducts processing for adding the number of credits corresponding to the determined amount of payout to the number of credits stored in the RAM 3043. On the other hand, in the case of paying out coins, the main CPU 3041 transmits a control signal to the hopper 3066 in order to pay out coins in an amount corresponding to the determined amount of payout.

The main CPU 3041 executes cumulative-amount-of-payout determination processing (step S3071). In the processing, the main CPU 3041 stores into the RAM 3043 a numeric value obtained by adding the amount of payout determined in step S3070 to the cumulative amount of payout stored in the RAM 3043, as an updated cumulative amount of payout.

When determining in step S3069 that no prize has been won, or when executing the processing of step S3071, the main CPU 3041 stores into the RAM 3043 a numeric value obtained by subtracting 1 from the number C of games stored in the RAM 3043, as an updated number C of games (step S3072).

The main CPU 3041 determines whether or not the number C of games stored in the RAM 3043 has reached 0 (step S3073). When determining that the number C of games has not reached 0, the main CPU 3041 returns the processing to step S3065.

On the other hand, when determining that the number C of games has reached 0, the main CPU 3041 updates the total cumulative amount of payout (step S3074). In the processing, the main CPU 3041 stores into the RAM 3043 a numeric value obtained by adding the cumulative amount of payout stored in the RAM 3043 to the total cumulative amount of payout stored in the RAM 3043, as an updated total cumulative amount of payout.

The main CPU 3041 transmits cumulative-amount-of-payout information to the server 3200 (step S3075). The cumulative-amount-of-payout information includes the identification number of the slot machine 3010.

The main CPU 3041 determines whether or not the main CPU 3041 has received the winning signal from the server 3200 (step S3076). When the main CPU 3041 determines that the main CPU 3041 has received the winning signal, the main CPU 3041 returns the processing to step S3061.

On the other hand, when the main CPU 3041 determines in step S3076 that the main CPU 3041 has not received the winning signal, the main CPU 3041 determines whether or not the main CPU 3041 has received the tournament end signal from the server 3200 (step S3077). When the main CPU 3041 determines that the main CPU 3041 has not received the tournament end signal, the main CPU 3041 returns the processing to step S3076.

On the other hand, when the main CPU 3041 determines in step S3077 that the main CPU 3041 has received the tournament end signal, the main CPU 3041 transmits total-cumulative-amount-of-payout information indicative of the total cumulative amount of payout, which is stored in the RAM 3043, to the server 3200 (step S3078). The total-cumulative-amount-of-payout information includes the identification number of the slot machine 3010 and the player name.

After executing the processing of step S3078, the main CPU 3041 ends the present subroutine.

As described above, according to the ticket issuing system 2 and the control method of the ticket issuing system 2, the server 3200 stores a piece of the game-history data of a player who has played a game on a slot machine 3010 in the past, in association with a piece of the player identification information. The server 3200 determines whether or not the result of a preliminary tournament played by the player in the past is overall winning, with reference to a piece of the game-history data corresponding to the player name that has been inputted via the keyboard 3345 of the ticket issuing device 3300. When it is determined that the result of the preliminary tournament is overall winning, the ticket issuing device 3300 issues a final-round participation ticket 3500 from the ticket printer 3346.

A final-round participation ticket 3500 is not issued to every player, but is issued only to a player whose result of the preliminary tournament which is stored in the server 3200 is overall winning. Accordingly, it is possible to give a player a sense of superiority when a final-round participation ticket 3500 is issued to the player, and further entertain the player with the game. In addition, with regard to a player whose result of the preliminary tournament is not overall winning, it is possible to motivate the player for issuance of a final-round participation ticket 3500, that is, for achieving a result of overall winning in the preliminary tournament, and thereby it is possible to get the player engrossed in the game.

Further, since being provided with three ticket issuing devices 3300, the ticket issuing system 2 can simultaneously execute issuance of final-round participation tickets 3500 from the three devices. Therefore, it is possible to avoid a situation in which issuance of a final-round participation ticket 3500 takes long time, and thus to smoothly start a tournament-type game.

In the present invention, insertion of a ticket (in the fourth embodiment, final-round participation ticket 3500) into a gaming machine (in the fourth embodiment, slot machine 3010) allows a player to participate in a special game (in the fourth embodiment, final tournament). This makes it possible for the player to smoothly participate in the special game.

In the fourth embodiment, the case has been described in which a knockout tournament is employed as the special game. However, the special game in the present invention is not limited to this example. The special game in the present invention may be a round-robin tournament.

In the fourth embodiment, the case has been described in which the special game is a competition of the numbers of coins obtained in a game relating to slot machines. However, the special game in the present invention is not limited to this example, and may be, for example, a game that determines winning or losing based on the number of coins or the points which is obtained in a card game such as a poker game or Blackjack.

In the fourth embodiment, the case has been described in which a preliminary tournament is held. However, the normal game in the present invention is not limited to this, and may be, for example, the normal game described in step S3031. In the case where the normal game described in step S3031 is adopted as the normal game in the present invention, the game result data in the present invention may be the number of normal games that the player has played in the past (total number of games). In this case, the data showing the total number of games corresponds to the number-of-games data in the present invention. Here, the total number of games in the above embodiment is obtained by cumulatively adding up the numbers M of games which are received from the slot machines 3010.

In the fourth embodiment, the case has been described in which the gaming machines in the present invention are the slot machines 3010. However, the gaming machine in the present invention is not limited to this, and may be, for example, a gaming machine that can execute a card game such as a poker game or Blackjack.

In the fourth embodiment, the case has been described in which the game-history data is stored in the hard disk 3246 provided in the server 3200. However, storage mechanism in the present invention is not limited to this example, and the ticket issuing devices each may have the storage device of the present invention.

In the fourth embodiment, the case has been described in which a final-round participation ticket 3500 is issued when the result of the preliminary tournament is overall winning. That is, the given condition in the present invention is that the result of a preliminary tournament is overall winning. However, the given condition in the present invention is not limited to this, and may be, for example, that the number of times shown by the number-of-games data is a predetermined number of times (e.g. 100 times) or larger. Even in this case, it is possible to encourage a player whose number of games is not equal to or larger than the predetermined number of times for issuance of a participation ticket, i.e. making the number of games reach the predetermined number of times or larger, and thus it is possible to get the player engrossed in the game.

In the fourth embodiment, the case has been described in which the game result information in the present invention is data showing the result of the preliminary tournament. However, in the present invention, the game result information in the present invention is not limited to this, and may be, for example, data that shows the total number of normal games. The game result information can be appropriately set according to the given condition.

In the fourth embodiment, the case has been described in which the barcode 3502 is printed on a final-round participation ticket 3500. However, in the present invention, the barcode is not limited to a one-dimensional code (barcode 3502), and a two-dimensional code (e.g. QR code (registered trademark)) may be printed.

In the fourth embodiment, the case has been described in which a final-round participation ticket 3500 (see FIG. 88B) has printed thereon the player name 3501; the barcode 3502; the text 3503 "ENTRY TICKET" that indicates that the ticket is a participation ticket for a tournament-type game; and the text 3504 that shows that the ticket is a participation ticket for a final tournament. However, in the present invention, the information to be printed is not particularly limited to this example so long as a participation ticket has printed thereon information that enables participation in the special game when the ticket is put into a gaming machine.

[Fifth Embodiment]

An embodiment of the present invention is described based on the drawings.

FIG. 106A is a flowchart illustrating flag setting processing that is executed in each slot machine according to a fifth embodiment of the present invention.

A main CPU 4041 (see FIG. 109) provided in a slot machine 4010 (see FIG. 107) first determines whether or not a tournament-type game flag is set in a main RAM 4043 (see FIG. 109), at a predetermined timing (step S4040). A tournament-type game flag is a flag for determining whether or not a tournament-type game should be executed; a tournament-type game is executed when the tournament-type game flag is set in the main RAM 4043, whereas not a tournament-type game but a normal game is executed when the tournament-type game flag is not set in the main RAM 4043 (see FIG. 117). When determining that the tournament-type game flag is set, the main CPU 4041 ends the present subroutine. It should be noted that a tournament-type game is defined as a preliminary tournament or a final tournament. The final tournament corresponds to the special game of the present invention. The preliminary tournament corresponds to the normal game of the present invention.

On the other hand, when determining in step S4040 that the tournament-type game flag is not set, the main CPU 4041 determines whether or not a ticket is inserted into a bill validator 4022 (see FIG. 108) (step S4041).

When determining that a ticket is inserted into the bill validator 4022, the main CPU 4041 determines whether or not the inserted ticket is a preliminary-round overall winning ticket 4580 (step S4042).

FIG. 106B is a view illustrating an exemplary preliminary-round overall winning ticket according to the fifth embodiment of the present invention.

As shown in FIG. 106B, at the upper portion of the preliminary-round overall winning ticket 4580, a player name 4581 is printed. At the lower portion, text 4583 showing "Preliminary Tournament Winner" is printed. At the center of the preliminary-round overall winning ticket 4580, a barcode 4582 is printed which represents encoded information for identifying a tournament-type game (hereinafter also referred to as "tournament identification information") (in the present embodiment, the information showing that the preliminary-round overall winning ticket 4580 is a participation ticket for the final tournament). A preliminary-round overall winning ticket 4580 is provided from a ticket printer 4035 (see FIG. 109) in each slot machine 4010 when a player has become the overall winner of a preliminary tournament that has been executed in the past.

When determining that the ticket inserted in step S4041 is a preliminary-round overall winning ticket 4580, the main CPU 4041 returns the processing to step S4044. On the other hand, when determining that the ticket inserted in step S4041 is not a preliminary-round overall winning ticket 4580, the main CPU 4041 shifts the processing to step S4043.

In step S4043, the main CPU 4041 determines whether or not the number of games read from the ticket inserted into the bill validator 4022 is 100 or larger. That is, the main CPU 4041 determines the following: whether or not the ticket inserted into the bill validator 4022 is a game-result ticket 4560 (see FIG. 116); and whether or not the number of normal games played in the past, which is recorded on the game-result ticket 4560, is 100 or larger. A game-result ticket 4560 has recorded thereon the number of normal games played in the past, and is provided from the ticket printer 4035 (see FIG. 109) in each slot machine 4010. The game-result ticket 4560 is described in detail later. When determining that the number of games read from the ticket inserted into the bill validator 4022 is not 100 or larger, the main CPU 4041 ends the present subroutine. On the other hand, when determining that the number of games read from the ticket inserted into the bill validator 4022 is 100 or larger, the main CPU 4041 shifts the processing to step S4044.

In step S4044, the main CPU 4041 sets the tournament-type game flag.

Next, the main CPU 4041 reads a player name from the preliminary-round overall winning ticket 4580 or game-result ticket 4560 inserted into the bill validator 4022, and stores the read player name into the main RAM 4043 (step S4044). After executing the processing of step S4044, the main CPU 4041 ends the present subroutine. When the tournament-type game flag is set, the slot machine 4010 executes a tournament-type game (see FIG. 118).

When a preliminary-round overall winning ticket 4580 is inserted into the bill validator 4022, the slot machine 4010 determines whether or not the ticket is a preliminary-round overall winning ticket 4580. When determining that the ticket is a preliminary-round overall winning ticket 4580, the slot machine 4010 sets the tournament-type game flag. As a result, the slot machine 4010 executes a final tournament.

Not everyone, but only a player whose tournament identification information recorded on the ticket is the information enabling participation in the final tournament, that is, a player whose ticket is a preliminary-round overall winning ticket 4580, can participate in the final tournament. Accordingly, it is possible to give a sense of superiority to a player who has achieved a result sufficient enough for participation in the special game, and to further entertain the player with the game. In addition, with regard to a player who has not received a preliminary-round overall winning ticket 4580, it is possible to motivate the player for becoming the overall winner of a preliminary tournament, and thereby it is possible to get the player engrossed in the game.

Further, since a preliminary-round overall winning ticket 4580 provided from a slot machine 4010 enables participation in a final tournament, a new ticket for gaining entry to the final tournament needs not to be issued. Therefore, it is possible to smoothly start the final tournament.

As above, the fifth embodiment has been briefly described based on FIG. 106.

Hereinafter, the fifth embodiment is described in more detail.

FIG. 107 is a schematic view illustrating an entire configuration of the gaming system according to the fifth embodiment of the present invention.

A gaming system 4001 has a plurality of (50 in the present embodiment) slot machines 4010 (slot machine 4010A, slot machine 4010B, slot machine 4010C, and so forth) and a server 4200. The slot machines 4010 and the server 4200 are connected to one another by a network.

Each slot machine 4010 is provided with a unique identification number. The server 4200 uses the identification numbers to identify the source of data that is transmitted from each slot machine 4010. Further, the server 4200 uses the identification numbers to specify the destination when the server 4200 transmits data to the slot machines 4010.

The gaming system in the present invention may be constructed inside one gaming facility where a variety of games can be played, such as a casino (i.e. inside the casino), or may be constructed between a plurality of such gaming facilities. When the gaming system is to be constructed inside one gaming facility, the gaming system may be constructed on each floor or section of the gaming facility. A communication network may be wired or wireless one, and can adopt a circuit such as a dedicated circuit or a switched circuit.

Next, a configuration of each slot machine 4010 is described.

FIG. 108 is a perspective view illustrating an external view of a slot machine according to the fifth embodiment of the present invention.

In the slot machine 4010, a coin, a bill, or electronic valuable information corresponding to those is used as a game medium. However, in the present invention, the game medium is not particularly limited. Examples of the game medium may include a medal, a token, electronic money and a ticket.

The slot machine 4010 comprises a cabinet 4011, a top box 4012 installed on the upper side of the cabinet 4011, and a main door 4013 provided at the front face of the cabinet 4011.

On the main door 4013, there is provided a lower image display panel 4016 as a display. The lower image display panel 4016 includes a transparent liquid crystal panel which displays fifteen display blocks 4028 along five columns and three rows. A single symbol is displayed in each display block 4028. Further, although not illustrated, various types of images relating to an effect, as well as the aforementioned images, are displayed to the lower image display panel 4016.

Further, a number-of-credits display portion 4031 and a number-of-payouts display portion 4032 are provided on the lower image display panel 4016. The number-of-credits display portion 4031 displays an image indicative of the number of credited coins. The number-of-payouts display portion 4032 displays an image indicative of the number of coins to be paid out.

Moreover, although not shown, a touch panel 4069 is provided at the front face of the lower image display panel 4016. A player can operate the touch panel 4069 to input a variety of commands.

Below the lower image display panel 4016, there are provided a control panel 4020 including a plurality of buttons 4023 to 4027 with each of which a command according to game progress is inputted by the player, a coin receiving slot 4021 through which a coin is accepted into the cabinet 4011, and a bill validator 4022.

The control panel 4020 is provided with a start button 4023, a change button 4024, a CASHOUT button 4025, a 1-BET button 4026 and a maximum BET button 4027. The start button 4023 is for inputting a command to start scrolling of symbols. The change button 4024 is used for making a request of staff in the recreation facility for exchange. The CASHOUT button 4025 is used for inputting a command to pay out credited coins to a coin tray 4018.

The 1-BET button 4026 is used for inputting a command to bet one coin on a game out of credited coins. The maximum BET button 4027 is used for inputting a command to bet the maximum number of coins that can be bet on one game (50 coins in the present embodiment) out of credited coins.

The bill validator 4022 not only discriminates a regular bill from a false bill, but also accepts the regular bill into the cabinet 4011.

It is to be noted that the bill validator 4022 can read a barcode 4582 printed on a preliminary-round overall winning ticket 4580. A player can participate in a final tournament by making the bill validator 4022 read a preliminary-round overall winning ticket 4580. The bill validator 4022 also can read a barcode 4562 printed on a game-result ticket 4560. Further, a player can participate in a preliminary tournament by making the bill validator 4022 read a game-result ticket 4560. The bill validator 4022 corresponds to the ticket reader of the present invention. The ticket reader of the present invention may additionally have a function to discriminate a regular bill from a false bill as in the present embodiment, or may be a reader dedicated to reading a participation ticket and a standby ticket.

At the lower front of the main door 4013, namely, below the control panel 4020, there is provided a belly glass 4034 on which a character or the like of the slot machine 4010 is drawn.

On the front surface of the top box 4012, there is provided an upper image display panel 4033. The upper image display panel 4033 includes a liquid crystal panel, which displays, for example, images indicative of introductions of the contents of a game, explanations about the rules of the game, and a later-described tournament tree (see FIG. 121).

Further, a speaker 4029 is provided in the top box 4012. Under the upper image display panel 4033, there are provided a ticket printer 4035, a card reader 4036, a data display 4037, and a key pad 4038. The ticket printer 4035 prints on a ticket a barcode that represents encoded data of the number of credits, date, the identification number of the slot machine 4010, and the like, and provides the ticket as a ticket with a barcode.

The ticket printer 4035 also provides a preliminary-round overall winning ticket 4580. The ticket printer 4035 corresponds to the ticket printer in the present invention. Further, the ticket printer 4035 prints on a ticket a barcode that represents coded data of the number of normal games, and then provides the ticket as a game-result ticket 4560. The ticket printer in the present invention is not particularly limited, and may use ink printing technology, or may use thermal printing technology with thermal paper.

The card reader 4036 reads data from a smart card and writes data into the smart card. The smart card is a card owned by the player, and for example, data for identifying the player (player identification information) and data on a history of games played by the player are stored therein. Data corresponding to a coin, a bill or a credit may be stored in the smart card. Further, a magnetic stripe card may be adopted in place of the smart card. The data display 4037 includes a fluorescent display and the like, and displays, for example, data read by the card reader 4036 or data inputted by the player via the key pad 4038. The key pad 4038 is used for inputting a command and data concerning issuing of a ticket, and the like.

FIG. 109 is a block diagram illustrating an internal configuration of the slot machine shown in FIG. 108.

A gaming board 4050 is provided with a CPU (Central Processing Unit) 51, a ROM 4055, and a boot ROM 4052 which are interconnected to one another by an internal bus, a card slot 4053S corresponding to a memory card 4053, and an IC socket 4054S corresponding to a GAL (Generic Array Logic) 4054.

The memory card 4053 includes a nonvolatile memory such as CompactFlash (registered trade mark), and stores a game program. The game program includes a symbol determination program. The symbol determination program is a program for determining symbols to be rearranged in the display blocks 4028.

The symbols to be determined by the symbol determination program include 8 types of symbols including "RIBBON", "HEART", "STAR", "MOON", "SUN", "JEWEL", "CROWN", and "SMILE".

Further, the card slot 4053S is configured so as to allow the memory card 4053 to be inserted thereinto or removed therefrom, and is connected to the mother board 4040 by an IDE bus. Therefore, the type and contents of a game played on the slot machine 4010 can be changed by removing the memory card 4053 from the card slot 4053S, writing another game program into the memory card 4053, and inserting the memory card 4053 into the card slot 4053S. The game program includes a program relating to progress of the game. Further, the game program includes image data and sound data to be outputted during the game. The game program also includes odds data showing a correspondence relationship between a type and the number of rearranged symbols and an amount of payout (see FIG. 119), and the like.

The CPU 4051, the ROM 4055 and the boot ROM 4052 interconnected to one another by an internal bus are connected to the mother board 4040 through a PCI bus. The PCI bus not only conducts signal transmission between the mother board 4040 and the gaming board 4050, but also supplies power from the mother board 4040 to the gaming board 4050.

The mother board 4040 is configured using a commercially available general-purpose mother board (a print wiring board on which fundamental components of a personal computer are mounted), and provided with a main CPU 4041, a ROM (Read Only Memory) 42, a RAM (Random Access Memory) 4043, and a communication interface 4044. The mother board 4040 corresponds to the controller in the present invention.

The ROM 4042 comprises a memory device such as a flash memory, and stores a program such as a BIOS (Basic Input/Output System) executed by the main CPU 4041, and permanent data. When the BIOS is executed by the main CPU 4041, processing for initializing a predetermined peripheral device is conducted, concurrently with start of processing for loading the game program stored in the memory card 4053 via the gaming board 4050. It is to be noted that, in the present invention, the ROM 4042 may or may not be data rewritable one.

The RAM 4043 stores data and a program to be used at the time of operation of the main CPU 4041. Further, the RAM 4043 is capable of storing a game program.

Moreover, the RAM 4043 stores data of the number of credits, the numbers of coin-ins and coin-outs in one game, and the like.

The mother board 4040 is connected with a later-described body PCB (Printed Circuit Board) 4060 and a door PCB 4080 through respective USBs. Further, the mother board 4040 is connected with a power supply unit 4045 and the communication interface 4044.

The body PCB 4060 and the door PCB 4080 are connected with an instrument and a device that generate an input signal to be inputted into the main CPU 4041 and an instrument and a device operations of which are controlled by a control signal outputted from the main CPU 4041. The main CPU 4041 executes the game program stored in the RAM 4043 based on the input signal inputted into the main CPU 4041, and thereby executes the predetermined arithmetic processing, stores the result thereof into the RAM 4043, or transmits a control signal to each instrument and device as processing for controlling each instrument and device.

The body PCB 4060 is connected with a lamp 4030, a hopper 4066, a coin detecting portion 4067, a graphic board 4068, the speaker 4029, the touch panel 4069, the bill validator 4022, the ticket printer 4035, the card reader 4036, a key switch 4038S, the data display 4037, a timer 4061, and a clock 4062. The lamp 4030 is lighted in a predetermined pattern based on control signals outputted from the main CPU 4041.

The hopper 4066 is installed inside the cabinet 4011, and pays out a predetermined number of coins based on a control signal outputted from the main CPU 4041, from a coin payout exit 4019 to the coin tray 4018. The coin detecting portion 4067 is provided inside the coin payout exit 4019, and outputs an input signal to the main CPU 4041 in the case of detecting payout of the predetermined number of coins from the coin payout exit 4019.

The timer 4061 is used for measuring the time. The clock 4062 is used for timekeeping. The clock 4062 sets its time every time a predetermined period elapses. The clock 4062 sets its time by getting time data from a clock 4249 that is provided in the server 4200.

The graphic board 4068 controls image display to the upper image display panel 4033 and the lower image display panel 4016 based on a control signal outputted from the main CPU 4041. In the respective display blocks 4028 on the lower image display panel 4016, symbols are displayed in a scrolling manner or in a stopped state. The number of credits stored in the RAM 4043 is displayed to the number-of-credits display portion 4031 of the lower image display panel 4016. Further, the number of coin-outs is displayed to the number-of-payouts display portion 4032 of the lower image display panel 4016.

The graphic board 4068 comprises a VDP (Video Display Processor) for generating image data based on a control signal outputted from the main CPU 4041, a video RAM for temporarily storing image data generated by the VDP, and the like. It is to be noted that image data used in generation of the image data by the VDP is included in the game program read from the memory card 4053 and stored into the RAM 4043.

The bill validator 4022 not only discriminates a regular bill from a false bill, but also accepts the regular bill into the cabinet 4011. Upon acceptance of the regular bill, the bill validator 4022 outputs an input signal to the main CPU 4041 based on a face amount of the bill. The main CPU 4041 stores in the RAM 4043 the number of credits corresponding to the face amount of the bill transmitted with the input signal.

Further, when receiving a preliminary-round overall winning ticket 4580, the bill validator 4022 reads a barcode printed on the preliminary-round overall winning ticket 4580 and obtains data relating to the player name or game identification information from the read barcode. Also, when receiving a game-result ticket 4560, the bill validator 4022 reads a barcode printed on the game-result ticket 4560 and obtains data such as the player name and the number of games from the read barcode. Then, the bill validator 4022 outputs the obtained data to the main CPU 4041.

The ticket printer 4035 prints on a ticket a barcode that represents encoded data of the number of credits stored in the RAM 4043, date, the identification number of the slot machine 4010, and the like, based on a control signal outputted from the main CPU 4041. Then, the ticket printer 4035 provides the ticket as a ticket with a barcode.

Also, the ticket printer 4035 prints on a ticket a barcode that represents coded information (tournament identification information) that shows that the ticket is a participation ticket for the final tournament. Then, the ticket printer 4035 provides the ticket as a preliminary-round overall winning ticket 4580. The ticket printer 4035 also prints on a ticket a barcode that represents coded data of the number of normal games, based on a control signal that is outputted from the main CPU 4041. Then, the ticket printer provides a ticket as a game-result ticket 4560.

The card reader 4036 reads data from the smart card and transmits the read data to the main CPU 4041, and writes data onto the smart card based on a control signal from the main CPU 4041. The key switch 4038S is provided on the key pad 4038, and outputs a predetermined input signal to the main CPU 4041 when the key pad 4038 is operated by the player. The data display 4037 displays data read by the card reader 4036 and data inputted by the player via the key pad 4038, based on a control signal outputted from the main CPU 4041.

The door PCB 4080 is connected with the control panel 4020, a reverter 4021S, a coin counter 4021C, and a cold cathode tube 4081. The control panel 4020 is provided with a start switch 4023S corresponding to the start button 4023, a change switch 4024S corresponding to the change button 4024, a CASHOUT switch 4025S corresponding to the CASHOUT button 4025, a 1-BET switch 4026S corresponding to the 1-BET button 4026, and a maximum BET switch 4027S corresponding to the maximum BET button 4027. Each of the switches 4023S to 4027S outputs an input signal to the main CPU 4041 when each of the buttons 4023 to 4027 corresponding thereto is operated by the player.

The coin counter 4021C is provided inside the coin receiving slot 4021, and discriminates a regular coin from a false coin when a coin is inserted into the coin receiving slot 4021 by the player. Coins other than the regular coin are discharged from the coin payout exit 4019. Further, the coin counter 4021C outputs an input signal to the main CPU 4041 in detection of the regular coin.

The reverter 4021S operates based on the control signal outputted from the main CPU 4041, and distributes a coin recognized by the coin counter 4021C as the regular coin into a cash box (not shown) or the hopper 4066, which are disposed in the slot machine 4010. Namely, when the hopper 4066 is filled with coins, the regular coin is distributed into the cash box by the reverter 40215. On the other hand, when the hopper 4066 is not filled with coins, the regular coin is distributed into the hopper 4066. The cold cathode tube 4081 functions as aback light installed on the rear face side of the lower image display panel 4016 and the upper image display panel 4033, and lighted up based on the control signal outputted from the main CPU 4041.

FIG. 110 is a block diagram illustrating an internal configuration of the server that constitutes the gaming system according to the fifth embodiment of the present invention.

The server 4200 is provided with a CPU 4241, a ROM 4242, a RAM 4243, a communication interface 4244, a timer 4245, a hard disk 4246, a graphic board 4247, a large image display panel 4248, and the clock 4249.

The graphic board 4247 controls image display on the large image display panel 4248 based on a control signal outputted from the CPU 4241. The large image display panel 4248 displays a result (ranking) of a tournament-type game, and the like. The timer 4245 is used for measuring time. The clock 4249 is used for time keeping.

The communication interface 4244 is connected through each communication line to a communication interface 4344 of each ticket issuing device 4300 and to a communication interface 4044 of each slot machine 4010. The ROM 4242 stores a system program for controlling operation of the CPU 4241, permanent data, and the like. The ROM 4242 also stores data on the start time and the end time. The RAM 4243 temporarily stores data used in operation of the CPU 4241. The hard disk 4246 stores data that is received from the slot machines 4010.

FIG. 111 is a flowchart illustrating main processing executed in the server.

First, the CPU 4241 determines whether or not the predetermined start time (e.g. 14:00) has come, at a predetermined timing (step S4200). In the processing, the CPU 4241 determines whether or not the time shown by the clock 4249 is the predetermined start time. When determining that the predetermined start time has not come yet, the CPU 4241 ends the main processing.

On the other hand, when determining in step S4200 that the predetermined start time has come, the CPU 4241 transmits a tournament-type game start signal to the slot machines 4010 (step S4204).

Thereafter, the CPU 4241 executes number-of-participants determination processing (step S4205). In the processing, the CPU 4241 determines the number of players who participate in the tournament-type game; the number of tournaments; and assignment of the slot machines 4010 participating in the tournament-type game to the tournaments. The number-of-participants determination processing will be described later with reference to a drawing.

The CPU 4241 executes winning/losing determination processing (step S4206). In the processing, the CPU 4241 determines the winning slot machine of each match in each tournament. The winning/losing determination processing will be described later with reference to drawings.

The CPU 4241 executes game-history update processing (step S4207). In the processing, the CPU 4241 stores ranks achieved by respective players in a tournament-type game into the hard disk 4246 as pieces of game-history data. At this time, when information of a rank is already included in a piece of the game-history data, the CPU 4241 compares the already included rank with the present rank to store the better rank (higher rank) of the two. After executing the processing of step S4207, the CPU 4241 ends the main processing.

FIG. 112 is a flowchart illustrating a subroutine of the number-of-participants determination processing.

First, the CPU 4241 executes game participation signal reception processing (step S4270). In the processing, when receiving a game participation signal, the CPU 4241 sets a game participation flag in association with the identification number of the slot machine 4010 as the transmission source. The game participation signal reception processing will be described later with reference to a drawing.

The CPU 4241 counts the number of game participation flags that are set (step S4271). Then, the CPU 4241 stores the counted number of game participation flags into the RAM 4243 as the number S of participants (step S4272).

The CPU 4241 determines whether or not the number S of participants in the RAM 4243 is more than 16 (step S4273). When determining that the number S of participants is not more than 16, the CPU 4241 determines 1 as the number D of tournaments which indicates the number of tournaments in a tournament-type game (step S4274). The CPU 4241 then stores 1 into the RAM 4243 as the number D of tournaments.

On the other hand, when determining in step S4273 that the number S of participants is more than 16, the CPU 4241 determines whether or not the number S of participants in the RAM 4243 is more than 32 (step S4275). When determining that the number S of participants is not more than 32, the CPU 4241 determines 2 as the number D of tournaments which indicates the number of tournaments in a tournament-type game (step S4276). The CPU 4241 then stores 2 into the RAM 4243 as the number D of tournaments.

On the other hand, when determining in step S4275 that the number S of participants is more than 32, the CPU 4241 determines 3 as the number D of tournaments which indicates the number of tournaments in a tournament-type game (step S4277). The CPU 4241 then stores 3 into the RAM 4243 as the number D of tournaments.

In the present embodiment, the number of tournaments in a tournament-type game is changed in accordance with the number S of participants. This will avoid a situation in which the time it takes from beginning to end of a tournament-type game is long because one tournament includes too many participating players; as a result, it is possible to prevent players from getting tired of the game.

Further, when a tournament-type game starts, matches are held in respective tournaments. That is, matches in the respective tournaments are simultaneously held. In the present embodiment, the maximum number of tournaments is 3. Increasing the number of tournaments makes it possible to increase the number of players who can be accepted to participate in the tournament-type game.

When executing the processing of step S4274, step S4276, or step S4277, the CPU 4241 determines assignment of the slot machines 4010 participating in the tournament-type game to the tournaments (step S4278). In the processing, the CPU 4241 first identifies the number D of tournaments which has been determined in the processing of step S4274, step S4276, or step S4277. Next, the CPU 4241 determines the number of tournament participants which indicates the number of players who participate in one tournament, based on the identified number D of tournaments and the number S of participants. For example, when the number D of tournaments is 2 and the number S of participants is 30, the number of tournament participants is 15.

Then, the CPU 4241 assigns the slot machines 4010 to a tournament tree from the left in the ascending order of the identification numbers of the slot machines 4010 such that a slot machine 4010 with the smallest identification number among the participating slot machines 4010 is assigned to the leftmost position. When the CPU 4241 has filled the tournament tree (when assignment of the slot machines 4010 in number equal to the number of tournament participants has been completed), the CPU 4241 starts assigning the slot machines 4010 to the next tournament tree in the same way.

In the processing of step S4278, a matchup for each unit game (each match in a tournament) in the respective tournaments is determined.

The CPU 4241 transmits as matchup information the assignment of the slot machines 4010 participating in the tournament-type game to the tournaments (the assignments determined in step S4278) to the slot machines 4010 participating in the tournament-type game (step S4279).

After executing the processing of step S4279, the CPU 4241 ends the present subroutine.

FIG. 113 is a flowchart illustrating a subroutine of the game participation signal reception processing.

First, the CPU 4241 starts measuring time with the timer 4245 (step S4280).

Next, the CPU 4241 determines whether or not the CPU 4241 has received a game participation signal from any of the slot machines 4010 (step S4281). When the CPU 4241 determines that the CPU 4241 has received a game participation signal, the CPU 4241 sets a game participation flag in association with the identification number of the slot machine 4010 as the transmission source of the game participation signal (step S4282).

When the CPU 4241 determines in step S4281 that the CPU 4241 has not received a game participation signal, or when the CPU 4241 has executed the processing of step S4282, the CPU 4241 determines whether or not the predetermined time has elapsed (step S4283). In the processing, the CPU 4241 determines whether or not the time measured with the timer 4245 has reached the predetermined time. When determining that the predetermined time has not elapsed, the CPU 4241 returns the processing to step S4281.

On the other hand, when determining in step S4283 that the predetermined time has elapsed, the CPU 4241 ends the present subroutine.

FIG. 114A and FIG. 114B are flowcharts each illustrating a subroutine of the winning/losing determination processing.

First, the CPU 4241 determines whether or not the CPU 4241 has received cumulative-amount-of-payout information from every slot machine participating in a unit game (step S4290). The cumulative amount of payout is the amount of payout of coins obtained in a unit game. The cumulative-amount-of-payout information is information showing the cumulative amount of payout. When the CPU 4241 determines that the CPU 4241 has not received cumulative-amount-of-payout information from every slot machine participating in a unit game, the CPU 4241 returns the processing to step S4290.

On the other hand, when the CPU 4241 determines that the CPU 4241 has received cumulative-amount-of-payout information from every slot machine participating in a unit game, the CPU 4241 determines the winning slot machine of each match (unit game) in the tournaments based on the received pieces of cumulative-amount-of-payout information (step S4291). In the processing, the CPU 4241 determines for each match the slot machine 4010 with the cumulative-amount-of-payout information which shows a cumulative amount of payout larger than that of the cumulative-amount-of-payout information of the other slot machine 4010 as the winning slot machine of the match. The determination is made based on the received pieces of cumulative-amount-of-payout information; the identification number of the slot machine 4010 included in each piece of cumulative-amount-of-payout information; and the matchups of the respective unit games (matches) in the respective tournaments which have been determined in step S4278.

The CPU 4241 then determines whether or not the winning slot machine of the tournament-type game has been determined (step S4292). In the processing, the CPU 4241 determines whether or not only one slot machine 4010 has been determined as the winning slot machine in every tournament. That is, in step S4292, whether or not the overall winning slot machine 4010 in every tournament is determined.

When the CPU 4241 determines that the winning slot machine of the tournament-type game has not been determined, the CPU 4241 transmits a winning signal to the slot machines 4010 that have been determined as the winning slot machines (step S4293). It should be noted that when only one slot machine 4010 has been determined as the winning slot machine in a tournament, the CPU 4241 does not transmit the winning signal to the slot machine that has been determined as the winning slot machine in this tournament. That is, the CPU 4241 does not transmit the winning signal to the slot machine 4010 that has been determined as the overall winner.

The CPU 4241 determines matchups for the next unit games (matches) (step S4294). In the processing, the CPU 4241 determines the matchups of the next unit games (matches), based on the winning slot machines determined in step S4291 and assignment of the slot machines 4010 to the tournaments which has been determined in step S4278.

The CPU 4241 transmits as matchup information the matchups of the unit games (matches) determined in step S4294 to the slot machines 4010 that have been determined as the winning slot machines (step S4295).

After executing the processing of step S4295, the CPU 4241 shifts the processing to step S4290.

When determining in step S4292 that the winning slot machine of the tournament-type game has been determined, the CPU 4241 transmits a tournament end signal to all the slot machines 4010 that participate in the tournament-type game (step S4296). In the processing, the CPU 4241 transmits the tournament end signal to the slot machines 4010 for each of which a game participation flag is set in association with the identification number. The tournament end signal includes information on the ranking for each tournament in the executed tournament-type game. That is, the ranking of the respective slot machines is determined before the tournament end signal is transmitted. The slot machine 4010 that has been determined as the overall winner takes first place, and the ranks of the respective other slot machines 4010 are determined in order. The ranks in the tournament-type game are stored in the hard disk 4246 of the server 4200 as pieces of the game-history data (see step S4207 in FIG. 111).

FIG. 115 is a flowchart illustrating slot machine processing that is executed in each slot machine.

First, in step S4320, the main CPU 4041 determines whether or not a smart card is inserted into the card reader 4036. When determining that a smart card is inserted into the card reader 4036, the main CPU 4041 reads player identification information from the smart card (step S4322).

Next, in step S4324, the main CPU 4041 sets the number M of games to 0 in a predetermined area in the main RAM 4043. The number M of games is the number of normal games which is described later.

Then, in step S4326, the main CPU 4041 executes game execution processing. The game execution processing will be described later with reference to FIG. 117.

After that, in step S4328, the main CPU 4041 determines whether or not the smart card is ejected from the card reader 4036. When determining that the smart card is not ejected from the card reader 4036, the main CPU 4041 returns the processing to step S4326. On the other hand, when determining that the smart card is ejected from the card reader 4036, the main CPU 4041 transmits to the server 4200 the player identification information read in step S4322 and the number M of games, and then returns the processing to step S4332. The number M of games gets stored in the hard disk 4246 provided in the server 4200 as the game-history data, in association with the player identification information.

Next, in step S4332, the main CPU 4041 encodes the player identification information and the number M of games so as to generate a barcode thereof.

Next in step S4334, the main CPU 4041 issues a game-result ticket 4560 with the generated barcode printed thereon from the ticket printer 4035.

FIG. 116 is a view illustrating an exemplary game-result ticket that is issued from a slot machine.

As shown in FIG. 116, at the upper portion of the game-result ticket 4560, a player name 4561 is printed. At the lower portion, a number-of-normal-games 4563 (number of games) is printed. At the center of the game-result ticket 4560, a barcode 4562 is printed which represents encoded data of the player identification information and the number of games.

In step S4334, for example, a game-result ticket 4560 as shown in FIG. 116 is issued. After the processing of step S4334, the main CPU 4041 returns the processing to step S4320.

FIG. 117 is a flowchart illustrating the game execution processing that is executed in each slot machine.

First, the main CPU 4041 determines whether or not the main CPU 4041 has received the tournament-type game start signal from the server 4200 (step S4030).

When the main CPU 4041 determines in step S4030 that the main CPU 4041 has received the tournament-type game start signal, the main CPU 4041 determines whether or not a tournament-type game flag is set (step S4032). The tournament-type game flag is set in the flag setting processing shown in FIG. 106.

When the main CPU 4041 determines in step S4030 that the main CPU 4041 has not received the tournament-type game start signal or when the main CPU 4041 determines in step S4032 that the tournament-type game flag is not set, the main CPU 4041 executes the normal-game execution processing (step S4031). The normal-game execution processing will be described later in detail with reference to a drawing. The game executed in the normal-game execution processing corresponds to the normal game in the present invention.

When the main CPU 4041 determines in step S4032 that the tournament-type game flag is set, the main CPU 4041 transmits a game participation signal to the server 4200 (step S4033). The game participation signal includes the identification number of the slot machine 4010.

Next, the main CPU 4041 executes tournament-type game execution processing (step S4034), and then ends the present subroutine. The tournament-type game execution processing will be described later with reference to drawings.

FIG. 118 is a flowchart illustrating a subroutine of normal-game execution processing.

First, the main CPU 4041 determines whether or not a coin has been betted (step S4012). In this processing, the main CPU 4041 determines whether or not the main CPU 4041 has received an input signal that is outputted from the 1-BET switch 4026S when the 1-BET button 4026 is operated, or an input signal that is outputted from the maximum BET switch 4027S when the maximum BET button 4027 is operated. When determining that a coin has not been betted, the main CPU 4041 returns the processing to step S4012.

On the other hand, when determining in step S4012 that a coin has been betted, the main CPU 4041 executes processing for making a subtraction from the number of credits stored in the RAM 4043 according to the number of betted coins (step S4013). It is to be noted that, when the number of coins to be betted is larger than the number of credits stored in the RAM 4043, the main CPU 4041 does not execute the processing for making a subtraction from the number of credits stored in the RAM 4043, and returns the processing to step S4012. Further, when the number of coins to be betted exceeds the upper limit of the number of coins that can be betted in one game (50 coins in the present embodiment), the main CPU 4041 does not execute the processing for making a subtraction from the number of credits stored in the RAM 4043, and proceeds with the processing to step S4014.

Next, the main CPU 4041 determines whether or not the start button 4023 has been turned ON (step S4014). In this processing, the main CPU 4041 determines whether or not the main CPU 4041 has received an input signal that is outputted from the start switch 4023S when the start button 4023 is pressed.

When the main CPU 4041 determines that the start button 4023 has not been turned ON, the main CPU 4041 returns the processing to step S4012.

It is to be noted that, when the start button 4023 is not turned ON (e.g. when the start button 4023 is not turned ON and a command to end the game is inputted), the main CPU 4041 cancels the subtraction result in step S4013.

On the other hand, when determining in step S4014 that the start button 4023 is turned ON, the main CPU 4041 executes symbol rearrangement processing (step S4015). In this processing, the main CPU 4041 first starts scroll-display of symbols in the display blocks 4028. Then, the main CPU 4041 executes the aforementioned symbol determination program, so as to determine the symbols to be rearranged, and then rearranges the symbols in the display blocks 4028.

Next, the main CPU 4041 determines whether or not a prize has been won (step S4016).

FIG. 119 is a view illustrating correspondence relationship between a type and the number of rearranged symbols and an amount of payout.

As shown in FIG. 119, an amount of payout is determined according to the type and number of the rearranged symbols. Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 4028 (see FIG. 119). In this processing, the main CPU 4041 counts the number of symbols for each type of the symbols rearranged in step S4017. Then, the main CPU 4041 determines whether or not the counted number is three or more.

When determining that a prize has been won, the main CPU 4041 executes processing relating to payout of coins (step S4017). In the processing, the main CPU 4041 determines the amount of payout based on the numbers of rearranged symbols with reference to the odds data stored in the ROM 4042. The odds data is data indicative of the correspondence relationship between the number of symbols rearranged in the display blocks 4028 and the amount of payout (see FIG. 119).

For example, in the case where three symbols of "SUN" are rearranged after two coins have been betted, 20 (=2×10) coins are paid out.

In the case of accumulating coins, the main CPU 4041 conducts processing for adding the number of credits corresponding to the determined amount of payout to the number of credits stored in the RAM 4043. On the other hand, in the case of paying out coins, the main CPU 4041 transmits a control signal to the hopper 4066 in order to pay out coins in an amount corresponding to the determined amount of payout.

When determining in step S4016 that no prize has been won or after executing the processing of step S4017, the main CPU 4041 adds 1 to the number M of games (step S4018), and then ends the present subroutine.

FIGS. 120A and 120B are flowcharts each illustrating a subroutine of the tournament-type game execution processing.

First, the main CPU 4041 stores 0 into the RAM 4043 as an updated total cumulative amount of payout (step S4060).

The main CPU 4041 determines whether or not the main CPU 4041 has received matchup information from the server 4200 (step S4061). When the main CPU 4041 determines that the main CPU 4041 has not received matchup information, the main CPU 4041 returns the processing to step S4061.

On the other hand, when the main CPU 4041 determines in step S4061 that the main CPU 4041 has received matchup information, the main CPU 4041 executes tournament-tree display processing (step S4062). In the processing, the main CPU 4041 displays a tournament tree image to the upper image display panel 4033, based on the received matchup information.

FIG. 121 is a view illustrating an exemplary image displayed to the upper image display panel that is provided in each slot machine constituting the ticket issuing system according to the fifth embodiment of the present invention.

In FIG. 121, the upper image display panel 4033 displays a tournament tree image 4602. To the lower part of the tournament tree image 4602, the player names of the players participating in the tournament-type game are displayed. Looking at the tournament tree image 4602, each player gets to know the player name of the player against whom he or she is going to have a match. A tournament name image 4601 shows the name of the tournament.

In the present embodiment, the number of tournaments in a tournament-type game changes within the range of 1 to 3 in accordance with the number S of participants. The name of the first tournament is Tournament A. The name of the second tournament is Tournament B. The name of the third tournament is Tournament C.

In FIG. 121, the tournament name image 4601 says Tournament B. That is, the tournament name image 4601 indicates that this tournament is the second tournament in the tournament-type game.

Referring back to FIG. 120A, the main CPU 4041 stores 0 into the RAM 4043 as an updated cumulative amount of payout (step S4063).

The main CPU 4041 stores 50 into the RAM 4043 as an updated number C of games (step S4064).

The main CPU 4041 determines whether or not a coin has been betted (step S4065). In the processing, the main CPU 4041 determines whether or not the main CPU 4041 has received an input signal outputted from the 1-BET switch 4026S when the 1-BET button 4026 is operated or an input signal outputted from the maximum BET switch 4027S when the maximum BET button 4027 is operated. When determining that a coin has not been betted, the main CPU 4041 returns the processing to step S4065.

On the other hand, when determining in step S4065 that a coin has been betted, the main CPU 4041 conducts processing of making a subtraction from the number of credits stored in the RAM 4043 in accordance with the number of the betted coins (step S4066). Here, in the case that the number of betted coins is larger than the number of credits stored in the RAM 4043, the main CPU 4041 returns the processing to step S4065 without executing the processing of making a subtraction from the number of credits stored in the RAM 4043. Further, in the case that the number of betted coins exceeds the upper limit value of the number of coins that can be betted in a single game (50 coins, in the present embodiment), the main CPU 4041 proceeds with the processing to step S4067 without executing the processing of making a subtraction from the number of credits stored in the RAM 4043.

Next, the main CPU 4041 determines whether or not the start button 4023 has been turned ON (step S4067). In the processing, the main CPU 4041 determines whether or not the main CPU 4041 has received an input signal that is outputted from the start switch 4023S when the start button 4023 is pressed.

When determining that the start button 4023 has not been turned ON, the main CPU 4041 returns the processing to step S4065.

Here, in the case that the start button 4023 is not turned ON (e.g. when the start button 4023 is not turned ON and a command to end the game is inputted), the main CPU 4041 cancels the subtraction result in step S4066.

On the other hand, when determining in step S4067 that the start button 4023 has been turned ON, the main CPU 4041 executes symbol rearrangement processing (step S4068).

In this processing, the main CPU 4041 first starts scroll-display of symbols in the display blocks 4028. Then, the main CPU 4041 executes the aforementioned symbol determination program, so as to determine the symbols to be rearranged, and then rearranges the symbols in the display blocks 4028.

Next, the main CPU 4041 determines whether or not a prize has been won (step S4069). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 4028 (see FIG. 119). In this processing, the main CPU 4041 counts the number of symbols for each type of the symbols rearranged in step S4068. Then, the main CPU 4041 determines whether or not the counted number is three or more.

When determining that a prize has been won, the main CPU 4041 executes processing relating to payout of coins (step S4070). In the processing, the main CPU 4041 determines the amount of payout based on the numbers of rearranged symbols with reference to the odds data stored in the ROM 4042. The odds data is data indicative of the correspondence relationship between the number of symbols rearranged in the display blocks 4028 and the amount of payout (see FIG. 119).

In the case of accumulating coins, the main CPU 4041 conducts processing for adding the number of credits corresponding to the determined amount of payout to the number of credits stored in the RAM 4043. On the other hand, in the case of paying out coins, the main CPU 4041 transmits a control signal to the hopper 4066 in order to pay out coins in an amount corresponding to the determined amount of payout.

The main CPU 4041 executes cumulative-amount-of-payout determination processing (step S4071). In the processing, the main CPU 4041 stores into the RAM 4043 a numeric value obtained by adding the amount of payout determined in step S4070 to the cumulative amount of payout stored in the RAM 4043, as an updated cumulative amount of payout.

When determining in step S4069 that no prize has been won, or when executing the processing of step S4071, the main CPU 4041 stores into the RAM 4043 a numeric value obtained by subtracting 1 from the number C of games stored in the RAM 4043, as an updated number C of games (step S4072).

The main CPU 4041 determines whether or not the number C of games stored in the RAM 4043 has reached 0 (step S4073). When determining that the number C of games has not reached 0, the main CPU 4041 returns the processing to step S4065.

On the other hand, when determining that the number C of games has reached 0, the main CPU 4041 updates the total cumulative amount of payout (step S4074). In the processing, the main CPU 4041 stores into the RAM 4043 a numeric value obtained by adding the cumulative amount of payout stored in the RAM 4043 to the total cumulative amount of payout stored in the RAM 4043, as an updated total cumulative amount of payout.

The main CPU 4041 transmits cumulative-amount-of-payout information to the server 4200 (step S4075). The cumulative-amount-of-payout information includes the identification number of the slot machine 4010.

The main CPU 4041 determines whether or not the main CPU 4041 has received the winning signal from the server 4200 (step S4076). When the main CPU 4041 determines that the main CPU 4041 has received the winning signal, the main CPU 4041 returns the processing to step S4061.

On the other hand, when the main CPU 4041 determines in step S4076 that the main CPU 4041 has not received the winning signal, the main CPU 4041 determines whether or not the main CPU 4041 has received the tournament end signal from the server 4200 (step S4077). When the main CPU 4041 determines that the main CPU 4041 has not received the tournament end signal, the main CPU 4041 returns the processing to step S4076.

On the other hand, when the main CPU 4041 determines in step S4077 that the main CPU 4041 has received the tournament end signal, the main CPU 4041 transmits total-cumulative-amount-of-payout information indicative of the total cumulative amount of payout, which is stored in the RAM 4043, to the server 4200 (step S4078). The total-cumulative-amount-of-payout information includes the identification number of the slot machine 4010 and the player name.

Next, in step S4079, the main CPU 4041 determines whether or not the tournament currently executed is a preliminary tournament and whether or not the player has become the overall winner of the tournament (step S4079). When determining that the tournament currently executed is a preliminary tournament and that the player has become the overall winner of the tournament, the main CPU 4041 drives the ticket printer 4035; then, the main CPU 4041 prints on a ticket a barcode that represents encoded information showing that the ticket is a participation ticket for a final tournament (tournament identification information) so as to issue the ticket as a preliminary-round overall winning ticket 4580. On the other hand, when determining that the tournament currently executed is not a preliminary tournament or that the player has not become the overall winner of the tournament (step S4079: NO), or after the processing of step S4080, the main CPU 4041 ends the present subroutine.

As above, according to the slot machine 4010 and the control method of a slot machine 4010 relating to the fifth embodiment, a preliminary tournament is executed and then a preliminary-round overall winning ticket 4580 is provided when the player has become the overall winner of the preliminary tournament. Thereafter, when the preliminary-round overall winning ticket 4580 is put into any of the slot machines 4010, the tournament-type game flag is set.

Not everyone, but only a player whose tournament identification information recorded on the ticket enables participation in the final tournament, that is, a player whose ticket is a preliminary-round overall winning ticket 4580, can participate in the final tournament. Accordingly, it is possible to give a sense of superiority to a player who has achieved a result sufficient enough for participation in the special game, and to further entertain the player with the game. In addition, with regard to a player who has not received a preliminary-round overall winning ticket 4580, it is possible to motivate the player for becoming the overall winner of a preliminary tournament, and thereby it is possible to get the player engrossed in the game.

Further, since a preliminary-round overall winning ticket 4580 provided from a slot machine 4010 enables participation in a final tournament, a new ticket for gaining entry to the final tournament needs not to be issued. Therefore, it is possible to smoothly start the final tournament.

In the fifth embodiment, the case has been described in which a final tournament, which is a knockout tournament, corresponds to the special game. However, the special game in the present invention is not limited to this example. The special game in the present invention may be a round-robin tournament.

In the fifth embodiment, the case has been described in which the special game is a competition of the numbers of coins obtained in a game relating to slot machines. However, the special game in the present invention is not limited to this example, and may be, for example, a game that determines winning or losing based on the number of coins or the points which is obtained in a card game such as a poker game or Blackjack.

In the fifth embodiment, the case has been described in which the normal game of the present invention corresponds to the preliminary tournament. However, the normal game in the present invention is not limited to this example. For example, the normal game shown in step S4031 may be the normal game in the present invention.

Further, in the fifth embodiment, the case has been described in which the gaming machine in the present invention is a slot machine 4010. However, the gaming machine in the present invention is not limited to this, and may be, for example, a gaming machine that can execute a card game such as a poker game or Blackjack.

In the fifth embodiment, the case has been described in which participation in a final tournament is enabled when the ticket put into any of the slot machines 4010 is a preliminary-round overall winning ticket 4580. That is, the case has been described in which the given condition in the present invention is that the data recorded on a preliminary-round overall winning ticket 4580 as a game-result ticket is information that shows that the ticket is a participation ticket for a final tournament. However, the given condition in the present invention is not limited to this, and for example, participation in a final tournament may be enabled when the number of normal games shown in step S4031 is equal to or larger than a predetermined number (e.g. 100). That is, the given condition in the present invention may be that the number of normal games recorded on a game-result ticket is equal to or larger than the predetermined number.

In the fifth embodiment, the case has been described in which the game result in the present invention is the rank in a preliminary tournament. However, the game result in the present invention is not limited to this, and may be, for example, the number of normal games. Here, the game result can be appropriately set according to the given condition.

In the fifth embodiment, the case has been described in which the barcode 4582 is printed on a preliminary-round overall winning ticket 4580. However, in the present invention, the barcode is not limited to a one-dimensional code (barcode 4582), and a two-dimensional code (e.g. QR code (registered trademark)) may be printed.

In the fifth embodiment, the case has been described in which a preliminary-round overall winning ticket 4580 (see FIG. 106B) has printed thereon the player name 4581; the barcode 4582; and the text 4583 "Preliminary Tournament Winner". However, in the present invention, the information to be printed is not particularly limited to this example so long as a ticket has printed thereon information that enables determination of whether or not participation in the special game should be enabled when the ticket is put into a gaming machine.

In the fifth embodiment, the case has been described in which a final tournament is executed when the ticket put into the slot machine 4010 is a preliminary-round overall winning ticket 4580.

In a sixth embodiment, a case will be described in which each ticket issuing device issues a final-round participation ticket upon reception of a preliminary-round overall winning ticket 4580, and each slot machine 4010 executes a final tournament upon reception of the final-round participation ticket. It should be noted that the descriptions relating to the sixth embodiment below do not include the descriptions of the configuration common with that of the fifth embodiment. Further, for the configuration same as that in the fifth embodiment, the same notations as those in the fifth embodiment are used.

[Sixth Embodiment]

FIG. 122 is a schematic view illustrating an entire configuration of a gaming system according to the sixth embodiment of the present invention.

The gaming system 4001 according to the sixth embodiment has the plurality of (50 in the present embodiment) slot machines 4010 (slot machine 4010A, slot machine 4010B, slot machine 4010C, and so forth) and a ticket issuing system 4002. The ticket issuing system 4002 has the plurality of (3 in the present embodiment) ticket issuing devices 4300 (ticket issuing device 4300A, ticket issuing device 4300B, ticket issuing device 4300C) and the server 4200. The slot machines 4010, the server 4200, and the ticket issuing devices 4300 are connected to each other by a network.

Each slot machine 4010 is provided with a unique identification number. The server 4200 uses the identification numbers to identify the source of data that is transmitted from each slot machine 4010. Further, the server 4200 uses the identification numbers to specify the destination when the server 4200 transmits data to the slot machines 4010.

Further, each ticket issuing device 4300 is also provided with a unique identification number. The server 4200 uses the identification numbers to identify the source of data that is transmitted from each ticket issuing device 4300. Also, the server 4200 uses the identification numbers to specify the destination when the server 4200 transmits data to the ticket issuing devices 4300.

FIG. 123 is a block diagram illustrating an internal configuration of a ticket issuing device that constitutes the ticket issuing system according to the sixth embodiment of the present invention.

Each ticket issuing device 4300 is provided with a CPU 4341 as a processor, a ROM 4342, a RAM 4343, a communication interface 4344, a keyboard 4345, a ticket printer 4346, a graphic board 4347, an image display panel 4348, and a barcode reader 4349.

The keyboard 4345 is used for inputting letters and numerals. The keyboard 4345 corresponds to the input device of the present invention. The input device of the present invention is not limited to the keyboard 4345, and may be, for example, a touch panel. If this is the case, a keyboard image may be displayed to an image display (e.g. an image display provided in a ticket issuing device), and a letter or a numeral may be inputted when the touch panel detects a touch at a location corresponding to the keyboard image.

The ticket printer 4346 is for printing on a ticket a barcode that represents encoded data of the player name and the tournament-type game start time, and then providing the ticket as a participation ticket 4500. The ticket printer 4346 corresponds to the ticket issuing terminal of the present invention. The ticket issuing terminal of the present invention is not particularly limited, and may use ink printing technology, or may use thermal printing technology with thermal paper.

The graphic board 4347 controls image display on the image display panel 4348 based on a control signal outputted from the CPU 4341. The image display panel 4348 displays an input screen for the player name, and the like.

The communication interface 4344 is connected through a communication line to a communication interface 4244 that is provided in the server 4200. The ROM 4342 stores a system program for controlling operation of the processor, permanent data, and the like. The RAM 4343 temporarily stores data received from the server 4200, and the like.

The barcode reader 4349 can read a barcode 4582 that is printed on a preliminary-round overall winning ticket 4580. The barcode reader 4349 corresponds to the ticket reading terminal of the present invention.

FIG. 124 is a flowchart illustrating ticket issuance processing that is executed in each ticket issuing device according to the sixth embodiment of the present invention.

The CPU 4341 provided in each ticket issuing device 4300 first determines whether or not the CPU 4341 has received an acceptance start signal from the server 4200 (step S4001). The acceptance start signal is transmitted from the server 4200 when predetermined time (e.g. 14:00) comes. When the CPU 4341 determines that the CPU 4341 has not received the acceptance start signal, the CPU 4341 ends the present subroutine. On the other hand, when the CPU 4341 determines that the CPU 4341 has received the acceptance start signal, the CPU 4341 shifts the processing to step S4002.

In step S4002, the CPU 4341 starts to accept reading of a preliminary-round overall winning ticket 4580 with the barcode reader 4349.

Next, in step S4003, the CPU 4341 determines whether or not a preliminary-round overall winning ticket 4580 has been put into the barcode reader 4349. In the sixth embodiment, a staff member receives a preliminary-round overall winning ticket 4580 from a player and puts the preliminary-round overall winning ticket 4580 into the barcode reader 4349. When determining that a preliminary-round overall winning ticket 4580 has been put into the barcode reader 4349, the CPU 4341 shifts the processing to step S4005.

In step S4005, the CPU 4341 transmits to the server 4200 a participation request signal for a final tournament, which includes the player identification information that has been encoded as a barcode 4562. After that, the CPU 4341 shifts the processing to step S4006.

In the server 4200, when a participation request signal transmitted from any of the ticket issuing devices 4300 is received, it is first determined whether or not the number P of players who have been accepted to participate in the game (hereinafter also referred to as "the number P of participation-accepted players") exceeds a predetermined number-of-players upper limit value. When the number P of participation-accepted players does not exceed the predetermined number-of-players upper limit value, a participation ticket issuance permission signal is transmitted to the ticket issuing device 4300. On the other hand, when it is determined that the number P of participation-accepted players exceeds the number-of-players upper limit value, a ticket issuance non-permission signal is transmitted to the ticket issuing device 4300.

In step S4006, the CPU 4341 determines whether or not the CPU 4341 has received the ticket issuance permission signal from the server 4200. When the CPU 4341 determines that the CPU 4341 has received the ticket issuance permission signal, the CPU 4341 issues a final-round participation ticket 4500 from the ticket printer 4346 (see FIG. 110) (step S4006).

FIG. 125 is a view illustrating an exemplary final-round participation ticket that is issued from a ticket issuing device according to the sixth embodiment of the present invention.

As shown in FIG. 125, at the upper portion of the final-round participation ticket 4500, a player name 4501 is printed. At the lower portion, text 4503 showing "ENTRY TICKET"and text 4504 showing "Final round" are printed. At the center of the final-round participation ticket 4500, a barcode 4502 is printed which represents encoded information for identifying a tournament-type game (in the present embodiment, the information showing that the final-round participation ticket 4500 is a participation ticket for the final tournament).

When the CPU 4341 determines that the CPU 4341 has not received the ticket issuance permission signal (step S4006: NO), the CPU 4341 determines whether or not the CPU 4341 has received the ticket issuance non-permission signal (step S4008). When the CPU 4341 determines that the CPU 4341 has not received the ticket issuance non-permission signal, the CPU 4341 returns the processing to step S4006. On the other hand, when the CPU 4341 determines that the CPU 4341 has received the ticket issuance non-permission signal, the CPU 4341 displays an image that indicates that a ticket cannot be issued, to the image display panel 4348 (see FIG. 110) (step S4009).

After the processing of step S4007 or step S4009, or when determining in step S4003 that a game-result ticket 4560 is not put into the barcode reader 4349, the CPU 4341 determines whether or not the CPU 4341 has received an acceptance end signal from the server 4200 (step S4010). The acceptance end signal is transmitted from the server 4200 to the ticket issuing devices 4300 when it is determined in the server 4200 that predetermined end time to end acceptance (e.g. 14:45) has come. When the CPU 4341 determines that the CPU 4341 has not received the acceptance end signal, the CPU 4341 returns the processing to step S4003. On the other hand, when the CPU 4341 determines that the CPU 4341 has received the acceptance end signal, the CPU 4341 ends the present subroutine.

FIG. 126 is a flowchart illustrating main processing that is executed in the server according to the sixth embodiment of the present invention.

The CPU 4241 provided in the server 4200 determines whether or not the predetermined start time (e.g. 14:00) has come, at a predetermined timing (step S4200).

When determining in step S4200 that the predetermined start time has come, the CPU 4241 executes participation acceptance processing (step S4201). The participation acceptance processing according to the sixth embodiment will be described later based on FIG. 127. After the processing of step S4201, the CPU 4241 shifts the processing to step S4204. The processing following step S4204 has already been described based on FIG. 111, and thus the descriptions thereof are omitted here.

FIG. 127 is a flowchart illustrating the participation acceptance processing that is executed in the server according to the sixth embodiment of the present invention.

The CPU 4241 first transmits the acceptance start signal to the three ticket issuing devices 4300 (ticket issuing device 4300A, ticket issuing device 4300B, ticket issuing device 4300C) which are connected to a network, when the predetermined time (e.g. 14:00) comes (step S4220).

Next, in step S4224, the CPU 4241 stores 0 into the RAM 4243 as an updated number P of participation-accepted players (step S4224).

Then, the CPU 4241 determines whether or not the CPU 4241 has received a participation request signal from any of the ticket issuing devices 4300 (step S4225). When the CPU 4241 determines that the CPU 4241 has received a participation request signal from any of the ticket issuing devices 4300, the CPU 4241 determines whether or not the number P of participating players exceeds the number-of-players upper limit value (step S4226). In the present embodiment, the number-of-players upper limit value is set to 40.

When determining that the number P of participating players does not exceed the number-of-players upper limit value, the CPU 4241 transmits the participation ticket issuance permission signal to the ticket issuing device 4300 (step S4227). Then, in step S4228, the CPU 4241 adds 1 to the number P of participating players.

When determining in step S4226 that the number P of participating players exceeds the number-of-players upper limit value, the CPU 4241 transmits the ticket issuance non-permission signal to the ticket issuing device 4300 (step S4229).

After the processing of step S4228 or step S4229, or when the CPU 4241 determines in step S4225 that the CPU 4241 has not received a participation request signal from any of the ticket issuing devices 4300, the CPU 4241 determines whether or not the predetermined end time (e.g. 14:45) has come (step S4233). When determining that the predetermined end time has not come yet, the CPU 4241 returns the processing to step S4225. On the other hand, when determining that the predetermined end time has come, the CPU 4241 transmits the acceptance end signal to the ticket issuing devices 4300 (step S4234). After that, the CPU 4241 ends the present subroutine.

FIG. 128 is a flowchart illustrating a subroutine of flag setting processing that is executed in each slot machine according to the sixth embodiment of the present invention.

The processing of step S4040, step S4044, and step S4045 has already been described based on FIG. 111, and thus the descriptions thereof are omitted here.

In step S4041, the main CPU 4041 determines whether or not a final-round participation ticket 4500 or a game-result ticket 4560 is inserted into the bill validator 4022. When determining that a final-round participation ticket 4500 or a game-result ticket 4560 is not inserted into the bill validator 4022, the main CPU 4041 ends the present subroutine.

When determining in step S4041 that a final-round participation ticket 4500 or a game-result ticket 4560 is inserted into the bill validator 4022, the main CPU 4041 determines whether or not the final-round participation ticket 4500 or game-result ticket 4560 inserted into the bill validator 4022 is a final-round participation ticket 4500 or game-result ticket 4560 for participating in the next tournament-type game (step S4042). In the present embodiment, a preliminary tournament is executed every 2 hours. Also, a final tournament is executed once (e.g. at 19:00) a day. Therefore, in the processing of step S4042, the main CPU 4041 determines whether or not the start time of the tournament-type game associated with the tournament identification information, which has been read from the final-round participation ticket 4500 or game-result ticket 4560 inserted into the bill validator 4022, is within the acceptance period corresponding to the start time (the period from 1 hour before the start time to 15 minutes before the start time), by referring to the time shown by the clock 4062.

When determining in step S4042 that the final-round participation ticket 4500 or the game-result ticket 4560 inserted into the bill validator 4022 is not a final-round participation ticket 4500 or game-result ticket 4560 which is for participating in the next tournament-type game, the main CPU 4041 ends the present subroutine.

On the other hand, when determining in step S4042 that the final-round participation ticket 4500 or the game-result ticket 4560 inserted into the bill validator 4022 is a final-round participation ticket 4500 or game-result ticket 4560 which is for participating in the next tournament-type game, the main CPU 4041 shifts the processing to step S4043.

According to the gaming system 4001 and the control method of a gaming system 4001 relating to the sixth embodiment, in each slot machine 4010, a preliminary tournament is executed, and a preliminary-round overall winning ticket 4580 is provided when the player has become the overall winner of the preliminary tournament. When the preliminary-round overall winning ticket 4580 provided from the slot machine 4010 is put into any of the ticket issuing devices 4300, a final-round participation ticket 4500 is issued. When the final-round participation ticket 4500 is put into any of the slot machines 4010, a tournament-type game is executed.

Not everyone, but only a player who has received a final-round participation ticket 4500, that is, a player who has become the overall winner of a preliminary tournament, can participate in the final tournament. Accordingly, it is possible to give a sense of superiority to a player who can participate in the final tournament, and to further entertain the player with the game. In addition, with regard to a player who has not received a preliminary-round overall winning ticket 4580, it is possible to motivate the player for becoming the overall winner of a preliminary tournament, and thereby it is possible to get the player engrossed in the game.

Further, according to the gaming system 4001 and the control method of a gaming system 4001 relating to the sixth embodiment, since three ticket issuing devices 4300 are provided, it is possible to simultaneously execute issuance of final-round participation tickets 4500 from the three devices. Therefore, it is possible to avoid a situation in which issuance of a final-round participation ticket 4500 takes long time, and thus to smoothly start a tournament-type game.

In the present invention, insertion of a ticket (in the present embodiment, final-round participation ticket 4500) into a gaming machine (in the present embodiment, slot machine 4010) allows a player to participate in a special game (in the present embodiment, final tournament). This makes it possible for the player to smoothly participate in the special game.

[Seventh Embodiment]

An embodiment of the present invention is described based on the drawings.

FIG. 129A is a flowchart illustrating ticket issuance processing that is executed in each ticket issuing device according to a seventh embodiment of the present invention.

A gaming system 5001 (see FIG. 130) according to the present embodiment has a plurality of (50 in the present embodiment) slot machines 5010 (slot machine 5010A, slot machine 5010B, slot machine 5010C, and so forth) and a ticket issuing system 5002. The ticket issuing system 5002 (see FIG. 130) has a plurality of (three in the present embodiment) ticket issuing devices 5300 (ticket issuing device 5300A, ticket issuing device 5300B, ticket issuing device 5300C) and a server 5200. The slot machines 5010, the server 5200, and the ticket issuing devices 5300 are connected to one another by a network.

The ticket issuing devices 5300 each are operated by a staff member of a casino. As illustrated in FIG. 129A, a CPU 5341 (see FIG. 133) provided in each ticket issuing device 5300 first determines whether or not the CPU 5341 has received an acceptance start signal from the server 5200 (step S5001). The acceptance start signal is transmitted from the server 5200 when predetermined time (e.g. 14:00) comes. When the CPU 5341 determines that the CPU 5341 has not received the acceptance start signal, the CPU 5341 ends the present subroutine. On the other hand, when the CPU 5341 determines that the CPU 5341 has received the acceptance start signal, the CPU 5341 shifts the processing to step S5002.

In step S5002, the CPU 5341 starts accepting an input of a player name.

Next in step S5003, the CPU 5341 determines whether or not a player name is inputted via a keyboard 5345 (see FIG. 133). When determining that a player name is inputted via the keyboard 5345, the CPU 5341 shifts the processing to step S5004.

In step S5004, the CPU 5341 transmits a participation request signal for a tournament-type game, which includes information showing the inputted player name, to the server 5200. Thereafter, the CPU 5341 shifts the processing to step S5005. In a tournament-type game, each player competes with another player based on the number of coins obtained after playing a predetermined number of (50 in the present embodiment) games on each slot machine 5010. A tournament-type game is a knockout competition in which two slot machines compete with each other to determine winning and losing. More specifically, one of the two slot machines with a larger number of obtained coins in the match becomes a winning slot machine. The tournament-type game corresponds to the special game of the present invention.

In the server 5200, it is first determined whether or not the number P of players who have been accepted to participate in a game (hereinafter also referred to as "the number P of participation-accepted players") exceeds a predetermined number-of-players upper limit value, when a participation request signal transmitted from one of the ticket issuing devices 5300 is received in the server 5200. When the number P of participation-accepted players does not exceed the predetermined number-of-players upper limit value, a participation ticket issuance permission signal is transmitted to the ticket issuing device 5300. On the other hand, when the number P of participation-accepted players exceeds the predetermined number-of-players upper limit value, a standby ticket issuance permission signal is transmitted to the ticket issuing device 5300. The number-of-players upper limit value corresponds to the upper limit value in the present invention.

In step S5005, the CPU 5341 determines whether or not the CPU 5341 has received the participation ticket issuance permission signal from the server 5200. When the CPU 5341 determines that the CPU 5341 has received the participation ticket issuance permission signal, the CPU 5341 issues a participation ticket 500 from a ticket printer 5346 (see FIG. 133) (step S5006).

FIG. 129B is a view illustrating an exemplary participation ticket that is issued from a ticket issuing device according to one embodiment of the present invention.

As shown in FIG. 129B, at the upper portion of the participation ticket 500, a player name 501 is printed. At the lower portion, text 503 "ENTRY TICKET", which indicates that the ticket is a participation ticket for a tournament-type game, and start time 504 of the tournament-type game are printed. At the center of the participation ticket 500, a barcode 502 is printed which represents encoded information for identifying a tournament-type game (in the present embodiment, the information showing that the participation ticket 500 is a participation ticket for the tournament-type game, and the information showing the start time thereof).

When the CPU 5341 determines that the CPU 5341 has not received the participation ticket issuance permission signal (step S5005: NO), the CPU 5341 receives the standby ticket issuance permission signal from the server 5200 (step S5007).

Next, the CPU 5341 issues a standby ticket 500 from the ticket printer 5346 (step S5008).

FIG. 129C is a view illustrating an exemplary standby ticket that is issued from a ticket issuing device according to one embodiment of the present invention.

As shown in FIG. 129C, at the upper portion of the standby ticket 5540, a player name 5541 is printed. At the lower portion, text 5543 "STANDBY TICKET", which indicates that the player is waiting for a cancellation of participation in the tournament-type game, and start time 5544 of the tournament-type game are printed. Further, at the center of the standby ticket 5540, a barcode 5542 is printed which represents encoded information for identifying a tournament-type game (in the present embodiment, the information showing that the standby ticket 5540 is a standby ticket for the tournament-type game, and the information showing the start time).

After the processing of step S5006 or step S5008, or when determining in step S5003 that a player name is not inputted via the keyboard 5345, the CPU 5341 determines whether or not the CPU 5341 has received an acceptance end signal from the server 5200 (step S5009). The acceptance end signal is transmitted from the server 5200 to the ticket issuing devices 5300 when it is determined in the server 5200 that predetermined end time to end acceptance (e.g. 14:45) has come. When the CPU 5341 determines that the CPU 5341 has not received the acceptance end signal, the CPU 5341 returns the processing to step S5002. On the other hand, when the CPU 5341 determines that the CPU 5341 has received the acceptance end signal, the CPU 5341 ends the present subroutine.

FIG. 129D is a flowchart illustrating participation acceptance processing that is executed in the server according to one embodiment of the present invention.

A CPU 5241 (see FIG. 134) provided in the server 5200 first transmits the acceptance start signal to the three ticket issuing devices 5300 (ticket issuing device 5300A, ticket issuing device 5300B, ticket issuing device 5300C) which are connected to a network, when the predetermined time (e.g. 14:00) comes (step S5220).

Next, in step S5224, the CPU 5241 stores 0 into a RAM 5243 as an updated number P of participation-accepted players (step S5224).

Then, the CPU 5241 determines whether or not the CPU 5241 has received a participation request signal from any of the ticket issuing devices 5300 (step S5225). When the CPU 5241 determines that the CPU 5241 has received a participation request signal from any of the ticket issuing devices 5300, the CPU 5241 determines whether or not the number P of participating players exceeds the number-of-players upper limit value (step S5226). In the present embodiment, the number-of-players upper limit value is set to 40.

When determining that the number P of participating players does not exceed the number-of-players upper limit value, the CPU 5241 transmits the participation ticket issuance permission signal to the ticket issuing device 5300 (step S5227). Then, in step S5228, the CPU 5241 adds 1 to the number P of participating players.

When determining in step S5226 that the number P of participating players exceeds the number-of-players upper limit value, the CPU 5241 transmits the standby ticket issuance permission signal to the ticket issuing device 5300 (step S5229).

After the processing of step S5228 or step S5229, or when the CPU 5241 determines in step S5225 that the CPU 5241 has not received a participation request signal from any of the ticket issuing devices 5300, the CPU 5241 determines whether or not the predetermined end time (e.g. 14:45) has come (step S5233). When determining that the predetermined end time has not come, the CPU 5241 returns the processing to step S5225. On the other hand, when determining that the predetermined end time has come, the CPU 5241 transmits the acceptance end signal to the ticket issuing devices 5300 (step S5234). After that, the CPU 5241 ends the present subroutine.

FIG. 129E is a flowchart illustrating a subroutine of flag setting processing that is executed in each slot machine according to one embodiment of the present embodiment.

First, a main CPU 5041 determines whether or not a tournament-type game flag is set, at a predetermined timing (step S5040). The tournament-type game flag is a flag for starting a tournament-type game, and the tournament-type game flag being set enables the slot machine 5010 to execute the tournament-type game (see step S5034 in FIG. 141). When determining that the tournament-type game flag is set, the main CPU 5041 ends the present subroutine.

On the other hand, when determining in step S5040 that the tournament-type game flag is not set, the main CPU 5041 determines whether or not a ticket (participation ticket, standby ticket, or another ticket) is inserted into a bill validator 5022 (step S5041). When determining that a ticket is not inserted into the bill validator 5022, the main CPU 5041 ends the present subroutine.

On the other hand, when determining in step S5041 that a ticket is inserted into the bill validator 5022, the main CPU 5041 determines whether or not the ticket inserted into the bill validator 5022 is a participation ticket 500 (step S5042). When determining that the ticket is a participation ticket 500, the main CPU 5041 shifts the processing to step S5043. On the other hand, when determining that the ticket is not a participation ticket 500, the main CPU 5041 shifts the processing to step S5044.

In step S5043, the main CPU 5041 determines whether or not the start time of the tournament-type game read from the participation ticket 500 inserted into the bill validator 5022 is within the acceptance period for the start time (period from 1 hour before the start time to more than 15 minutes before the start time), by referring to the time shown by a clock 5062 (step S5043). When determining that the start time of the tournament-type game read from the participation ticket 500 inserted into the bill validator 5022 is within the acceptance period for the start time, the main CPU 5041 shifts the processing to step S5046. On the other hand, when determining that the start time of the tournament-type game read from the participation ticket 500 inserted into the bill validator 5022 is not within the acceptance period, the main CPU 5041 ends the present subroutine.

In step S5044, the main CPU 5041 determines whether or not the ticket inserted into the bill validator 5022 is a standby ticket 5540. When determining that the ticket inserted into the bill validator 5022 is not a standby ticket 5540, the main CPU 5041 ends the present subroutine. On the other hand, when determining that the ticket inserted into the bill validator 5022 is a standby ticket 5540, the main CPU 5041 determines whether or not the start time of the tournament-type game read from the standby ticket 5540 inserted into the bill validator 5022 is within the predetermined period for the start time (a period from less than 15 minutes before the start time to more than 5 minutes before the start time), by referring to the time shown by the clock 5062 (step S5045). When determining that the start time of the tournament-type game read from the standby ticket 5540 is within the predetermined period for the start time, the main CPU 5041 shifts the processing to step S5046. On the other hand, when determining that the start time of the tournament-type game read from the standby ticket 5540 is not within the predetermined period for the start time, the main CPU 5041 ends the present subroutine.

In step S5046, the main CPU 5041 sets the tournament-type game flag in a predetermined area of a RAM 5043. Setting the tournament-type game flag corresponds to the processing of making a participation registration in a special game in the present invention.

Next, the main CPU 5041 reads a player name from the participation ticket 500 or standby ticket 5540 inserted into the bill validator 5022, and stores the read player name into the RAM 5043 (step S5047). After executing the processing of step S5047, the main CPU 5041 ends the present subroutine.

According to the gaming system 5001, in each ticket issuing device 5300, a participation ticket 500 with a start time recorded thereon is issued from the ticket printer 5346 based on an input from the keyboard 5345 until the number of issued participation tickets 500 reaches the predetermined upper limit value. Also, in each ticket issuing device 5300, a standby ticket 5540 is issued from the ticket printer 5346 when a command to issue a participation ticket 500 is inputted from the keyboard 5345 after the number of issued participation tickets 500 has reached the upper limit value. In each slot machine 5010, when it is determined that the time at which the slot machine 5010 has received a participation ticket 500 with a start time recorded thereon is within the acceptance period for the start time recorded on the participation ticket 500, a participation registration in the tournament-type game is made. Further, in each slot machine 5010, when a participation registration in the tournament-type game has not been made, a standby ticket 5540 is accepted during a predetermined period from after the end of the acceptance period to the start time. Then, in each slot machine 5010, the tournament-type game is executed after the start time when a participation registration in the tournament-type game has been made.

A participation ticket 500 with a start time recorded thereon allows a player to know the start time of the tournament-type game. Therefore, the player can wait to put the participation ticket 500 in a slot machine 5010 until a few minutes before the start time. It is thus possible to prevent players from having to wait in front of slot machines 5010 until the tournament-type game starts, and thereby players are allowed to smoothly participate in the tournament-type game. Further, it is possible to prevent players from not being able to participate in the tournament-type game because of reasons such as that the player has got the start time wrong and cannot put his or her participation ticket 500 in a slot machine 5010 before the start time.

Further, when a participation registration in the tournament-type game has not been made, a standby ticket 5540 is accepted during the predetermined period from after the end of the acceptance period to the start time. A standby ticket 5540 being put into a slot machine 5010 during the predetermined period enables a player to participate in the tournament-type game. Therefore, it is possible to give more players the chance to participate in the tournament-type game when there are players who do not participate in the tournament-type game even though they have a participation ticket 500.

Furthermore, since being provided with the plurality of ticket issuing devices 5300, the gaming system 5001 can simultaneously execute issuance of participation tickets 500 or standby tickets 5540 from the plurality of ticket issuing devices 5300. Therefore, it is possible to avoid a situation in which issuance of a participation ticket 500 or a standby ticket 5540 takes long time, and thus to smoothly start the tournament-type game.

As above, the present embodiment has been briefly described based on FIGS. 1A to 1E.

Hereinafter, the present embodiment is described in more detail.

FIG. 130 is a schematic view illustrating an entire configuration of the gaming system according to one embodiment of the present invention.

The gaming system 5001 has the plurality of (50 in the present embodiment) slot machines 5010 (slot machine 5010A, slot machine 5010B, slot machine 5010C, and so forth) and the ticket issuing system 5002. The ticket issuing system 5002 has the plurality of (three in the present embodiment) ticket issuing devices 5300 (ticket issuing device 5300A, ticket issuing device 5300B, ticket issuing device 5300C) and the server 5200. The slot machines 5010, the server 5200 and the ticket issuing devices 5300 are connected to one another by the network.

Each slot machine 5010 is provided with a unique identification number. The server 5200 uses the identification numbers to identify the source of data that is transmitted from each slot machine 5010. Further, the server 5200 uses the identification numbers to specify the destination when the server 5200 transmits data to the ticket issuing devices 5300.

Further, each ticket issuing device 5300 is provided with a unique identification number. The server 5200 uses the identification numbers to identify the source of data that is transmitted from each ticket issuing device 5300. Also, the server 5200 uses the identification numbers to specify the destination when the server 5200 transmits data to the ticket issuing devices 5300.

The gaming system in the present invention may be constructed inside one gaming facility where a variety of games can be played, such as a casino (i.e. inside the casino), or may be constructed between a plurality of such gaming facilities. When the gaming system is to be constructed inside one gaming facility, the gaming system may be constructed on each floor or section of the gaming facility. A communication network may be wired or wireless one, and can adopt a circuit such as a dedicated circuit or a switched circuit.

Next, a configuration of each slot machine 5010 is described.

FIG. 131 is a perspective view illustrating an external view of a slot machine according to one embodiment of the present invention.

In the slot machine 5010, a coin, a bill, or electronic valuable information corresponding to those is used as a game medium. However, in the present invention, the game medium is not particularly limited. Examples of the game medium may include a medal, a token, electronic money and a ticket.

The slot machine 5010 comprises a cabinet 5011, a top box 5012 installed on the upper side of the cabinet 5011, and a main door 5013 provided at the front face of the cabinet 5011.

On the main door 5013, there is provided a lower image display panel 5016 as a display. The lower image display panel 5016 includes a transparent liquid crystal panel which displays fifteen display blocks 5028 along five columns and three rows. A single symbol is displayed in each display block 28. Further, although not illustrated, various types of images relating to an effect, as well as the aforementioned images, are displayed to the lower image display panel 5016.

Further, a number-of-credits display portion 5031 and a number-of-payouts display portion 5032 are provided on the lower image display panel 5016. The number-of-credits display portion 5031 displays an image indicative of the number of credited coins. The number-of-payouts display portion 5032 displays an image indicative of the number of coins to be paid out.

Moreover, although not shown, a touch panel 5069 is provided at the front face of the lower image display panel 5016. A player can operate the touch panel 5069 to input a variety of commands.

Below the lower image display panel 5016, there are provided a control panel 5020 including a plurality of buttons 5023 to 5027 with each of which a command according to game progress is inputted by the player, a coin receiving slot 5021 through which a coin is accepted into the cabinet 5011, and a bill validator 5022.

The control panel 5020 is provided with a start button 5023, a change button 5024, a CASHOUT button 5025, a 1-BET button 5026 and a maximum BET button 5027. The start button 5023 is for inputting a command to start scrolling of symbols. The change button 5024 is used for making a request of staff in the recreation facility for exchange. The CASHOUT button 5025 is used for inputting a command to pay out credited coins to a coin tray 5018.

The 1-BET button 5026 is used for inputting a command to bet one coin on a game out of credited coins. The maximum BET button 5027 is used for inputting a command to bet the maximum number of coins that can be bet on one game (50 coins in the present embodiment) out of credited coins.

The bill validator 5022 not only discriminates a regular bill from a false bill, but also accepts the regular bill into the cabinet 5011. It is to be noted that the bill validator 5022 can read a barcode 502 printed on a participation ticket 500 and a barcode 5542 printed on a standby ticket 5540. A player can participate in a tournament-type game by making the bill validator 5022 read a participation ticket 500 or a standby ticket 5540.

The bill validator 5022 corresponds to the ticket reader of the present invention. The ticket reader of the present invention may additionally have a function to discriminate a regular bill from a false bill as in the present embodiment, or may be a reader dedicated to reading a participation ticket and a standby ticket.

At the lower front of the main door 5013, namely, below the control panel 5020, there is provided a belly glass 5034 on which a character or the like of the slot machine 5010 is drawn.

On the front surface of the top box 5012, there is provided an upper image display panel 5033. The upper image display panel 5033 includes a liquid crystal panel, which displays, for example, images indicative of introductions of the contents of a game, explanations about the rules of the game, and a later-described tournament tree (see FIG. 145).

Further, a speaker 5029 is provided in the top box 5012. Under the upper image display panel 5033, there are provided a ticket printer 5035, a card reader 5036, a data display 5037, and a keypad 5038. The ticket printer 5035 prints on a ticket a barcode that represents encoded data of the number of credits, date, the identification number of the slot machine 5010, and the like, and provides the ticket as a ticket 5039 with a barcode.

The card reader 5036 reads data from a smart card and writes data into the smart card. The smart card is a card owned by the player, and for example, data for identifying the player (player identification information) and data on a history of games played by the player are stored therein. Data corresponding to a coin, a bill or a credit may be stored in the smart card. Further, a magnetic stripe card may be adopted in place of the smart card. The data display 5037 includes a fluorescent display and the like, and displays, for example, data read by the card reader 5036 or data inputted by the player via the key pad 5038. The key pad 5038 is used for inputting a command and data concerning issuing of a ticket, and the like.

FIG. 132 is a block diagram illustrating an internal configuration of the slot machine shown in FIG. 131.

A gaming board 5050 is provided with a CPU (Central Processing Unit) 51, a ROM 5055, and a boot ROM 5052 which are interconnected to one another by an internal bus, a card slot 53S corresponding to a memory card 5053, and an IC socket 5054S corresponding to a GAL (Generic Array Logic) 5054.

The memory card 5053 includes a nonvolatile memory such as CompactFlash (registered trade mark), and stores a game program. The game program includes a symbol determination program. The symbol determination program is a program for determining symbols to be rearranged in the display blocks 5028.

The symbols to be determined by the symbol determination program include 8 types of symbols including "RIBBON", "HEART", "STAR", "MOON", "SUN", "JEWEL", "CROWN", and "SMILE".

Further, the card slot 53S is configured so as to allow the memory card 5053 to be inserted thereinto or removed therefrom, and is connected to the mother board 5040 by an IDE bus. Therefore, the type and contents of a game played on the slot machine 5010 can be changed by removing the memory card 5053 from the card slot 53S, writing another game program into the memory card 5053, and inserting the memory card 5053 into the card slot 53S. The game program includes a program relating to progress of the game. Further, the game program includes image data and sound data to be outputted during the game. The game program also includes odds data showing a correspondence relationship between a type and the number of rearranged symbols and an amount of payout (see FIG. 143), and the like.

The CPU 5051, the ROM 5055 and the boot ROM 5052 interconnected to one another by an internal bus are connected to the mother board 5040 through a PCI bus. The PCI bus not only conducts signal transmission between the mother board 5040 and the gaming board 5050, but also supplies power from the mother board 5040 to the gaming board 5050.

The mother board 5040 is configured using a commercially available general-purpose mother board (a print wiring board on which fundamental components of a personal computer are mounted), and provided with the main CPU 5041, a ROM (Read Only Memory) 42, the RAM (Random Access Memory) 5043, and a communication interface 5044. The mother board 5040 corresponds to the controller in the present invention.

The ROM 5042 comprises a memory device such as a flash memory, and stores a program such as a BIOS (Basic Input/Output System) executed by the main CPU 5041, and permanent data. When the BIOS is executed by the main CPU 5041, processing for initializing a predetermined peripheral device is conducted, concurrently with start of processing for loading the game program stored in the memory card 5053 via the gaming board 5050. It is to be noted that, in the present invention, the ROM 5042 may or may not be data rewritable one.

The RAM 5043 stores data and a program to be used at the time of operation of the main CPU 5041. Further, the RAM 5043 is capable of storing a game program.

Moreover, the RAM 5043 stores data of the number of credits, the numbers of coin-ins and coin-outs in one game, and the like.

The mother board 5040 is connected with a later-described body PCB (Printed Circuit Board) 5060 and a door PCB 5080 through respective USBs. Further, the mother board 5040 is connected with a power supply unit 5045 and the communication interface 5044.

The body PCB 5060 and the door PCB 5080 are connected with an instrument and a device that generate an input signal to be inputted into the main CPU 5041 and an instrument and a device operations of which are controlled by a control signal outputted from the main CPU 5041. The main CPU 5041 executes the game program stored in the RAM 5043 based on the input signal inputted into the main CPU 5041, and thereby executes the predetermined arithmetic processing, stores the result thereof into the RAM 5043, or transmits a control signal to each instrument and device as processing for controlling each instrument and device.

The body PCB 5060 is connected with a lamp 5030, a hopper 5066, a coin detecting portion 5067, a graphic board 5068, the speaker 5029, the touch panel 5069, the bill validator 5022, the ticket printer 5035, the card reader 5036, a key switch 5038S, the data display 5037, a timer 5061, and the clock 5062. The lamp 5030 is lighted in a predetermined pattern based on control signals outputted from the main CPU 5041.

The hopper 5066 is installed inside the cabinet 5011, and pays out a predetermined number of coins based on a control signal outputted from the main CPU 5041, from a coin payout exit 5019 to the coin tray 5018. The coin detecting portion 5067 is provided inside the coin payout exit 5019, and outputs an input signal to the main CPU 5041 in the case of detecting payout of the predetermined number of coins from the coin payout exit 5019.

The timer 5061 is used for measuring the time. The clock 5062 is used for timekeeping. The clock 5062 sets its time every time a predetermined period elapses. The clock 5062 sets its time by getting time data from a clock 5249 that is provided in the server 5200.

The graphic board 5068 controls image display to the upper image display panel 5033 and the lower image display panel 5016 based on a control signal outputted from the main CPU 5041. In the respective display blocks 5028 on the lower image display panel 5016, symbols are displayed in a scrolling manner or in a stopped state. The number of credits stored in the RAM 5043 is displayed to the number-of-credits display portion 5031 of the lower image display panel 5016. Further, the number of coin-outs is displayed to the number-of-payouts display portion 5032 of the lower image display panel 5016.

The graphic board 5068 comprises a VDP (Video Display Processor) for generating image data based on a control signal outputted from the main CPU 5041, a video RAM for temporarily storing image data generated by the VDP, and the like. It is to be noted that image data used in generation of the image data by the VDP is included in the game program read from the memory card 5053 and stored into the RAM 5043.

The bill validator 5022 not only discriminates a regular bill from a false bill, but also accepts the regular bill into the cabinet 5011. Upon acceptance of the regular bill, the bill validator 5022 outputs an input signal to the main CPU 5041 based on a face amount of the bill. The main CPU 5041 stores in the RAM 5043 the number of credits corresponding to the face amount of the bill transmitted with the input signal.

Further, when receiving a participation ticket 500, the bill validator 5022 reads a barcode printed on the participation ticket 500 and obtains data such as the player name and the start time of the tournament-type game from the read barcode. Also, when receiving a standby ticket 5540, the bill validator 5022 reads a barcode printed on the standby ticket 5540 and obtains data such as the player name and the start time of the tournament-type game from the read barcode. Then, the bill validator 5022 outputs the obtained data to the main CPU 5041.

The ticket printer 5035 prints on a ticket a barcode that represents encoded data of the number of credits stored in the RAM 5043, date, the identification number of the slot machine 5010, and the like, based on a control signal outputted from the main CPU 5041. Then, the ticket printer 5035 provides the ticket as a ticket 5039 with a barcode.

The card reader 5036 reads data from the smart card and transmits the read data to the main CPU 5041, and writes data onto the smart card based on a control signal from the main CPU 5041. The key switch 5038S is provided on the key pad 5038, and outputs a predetermined input signal to the main CPU 5041 when the key pad 5038 is operated by the player. The data display 5037 displays data read by the card reader 5036 and data inputted by the player via the key pad 5038, based on a control signal outputted from the main CPU 5041.

The door PCB 5080 is connected with the control panel 5020, a reverter 5021S, a coin counter 5021C, and a cold cathode tube 5081. The control panel 5020 is provided with a start switch 5023S corresponding to the start button 5023, a change switch 5024S corresponding to the change button 5024, a CASHOUT switch 5025S corresponding to the CASHOUT button 5025, a 1-BET switch 5026S corresponding to the 1-BET button 5026, and a maximum BET switch 5027S corresponding to the maximum BET button 5027. Each of the switches 5023S to 5027S outputs an input signal to the main CPU 5041 when each of the buttons 5023 to 5027 corresponding thereto is operated by the player.

The coin counter 5021C is provided inside the coin receiving slot 5021, and discriminates a regular coin from a false coin when a coin is inserted into the coin receiving slot 5021 by the player. Coins other than the regular coin are discharged from the coin payout exit 5019. Further, the coin counter 5021C outputs an input signal to the main CPU 5041 in detection of the regular coin.

The reverter 5021S operates based on the control signal outputted from the main CPU 5041, and distributes a coin recognized by the coin counter 5021C as the regular coin into a cash box (not shown) or the hopper 5066, which are disposed in the slot machine 5010. Namely, when the hopper 5066 is filled with coins, the regular coin is distributed into the cash box by the reverter 5021S. On the other hand, when the hopper 5066 is not filled with coins, the regular coin is distributed into the hopper 5066. The cold cathode tube 5081 functions as a back light installed on the rear face side of the lower image display panel 5016 and the upper image display panel 5033, and lighted up based on the control signal outputted from the main CPU 5041.

FIG. 133 is a block diagram illustrating an internal configuration of a ticket issuing device that constitutes the ticket issuing system according to one embodiment of the present invention.

Each ticket issuing device 5300 is provided with the CPU 5341 as a processor, a ROM 5342, a RAM 5343, a communication interface 5344, the keyboard 5345, the ticket printer 5346, a graphic board 5347, and an image display panel 5348.

The keyboard 5345 is used for inputting letters and numerals. The keyboard 5345 corresponds to the input device of the present invention. The input device of the present invention is not limited to the keyboard 5345, and may be, for example, a touch panel. If this is the case, a keyboard image may be displayed to an image display (e.g. an image display provided in a ticket issuing device), and a letter or a numeral may be inputted when the touch panel detects a touch at a location corresponding to the keyboard image.

The ticket printer 5346 is for printing on a ticket a barcode that represents encoded information, such as data on the player name and the start time of the tournament-type game, and then providing the ticket as a participation ticket 500. The ticket printer 5346 corresponds to the ticket issuing terminal of the present invention. The ticket issuing terminal of the present invention is not particularly limited, and may use ink printing technology, or may use thermal printing technology with thermal paper.

The graphic board 5347 controls image display on the image display panel 5348 based on a control signal outputted from the CPU 5341. The image display panel 5348 displays an input screen for the player name, and the like.

The communication interface 5344 is connected through a communication line to a communication interface 5244 that is provided in the server 5200. The ROM 5342 stores a system program for controlling operation of the processor, permanent data, and the like. The RAM 5343 temporarily stores data received from the server 5200, and the like.

FIG. 134 is a block diagram illustrating an internal configuration of the server that constitutes the ticket issuing system according to one embodiment of the present invention.

The server 5200 is provided with the CPU 5241, a ROM 5242, the RAM 5243, the communication interface 5244, a timer 5245, a hard disk 5246, a graphic board 5247, a large image display panel 5248, and the clock 5249.

The graphic board 5247 controls image display on the large image display panel 5248 based on a control signal outputted from the CPU 5241. The large image display panel 5248 displays a result (ranking) of a tournament-type game, and the like. The timer 5245 is used for measuring time. The clock 5249 is used for time keeping.

The communication interface 5244 is connected through each communication line to the communication interface 5344 of each ticket issuing device 5300 and to a communication interface 5044 of each slot machine 5010. The ROM 5242 stores a system program for controlling operation of the CPU 5241, permanent data, and the like. The ROM 5242 also stores data on the start time and the end time. The RAM 5243 temporarily stores data received from the slot machines 5010 and the like.

FIG. 135 is a view illustrating exemplary game-history data that is stored in the hard disk provided in the server.

As shown in FIG. 135, the hard disk 5246 stores player identification information showing a player name; the total number of normal games played by the player in the past; and the highest rank in a tournament-type game (special game) played by the player in the past. The total number of normal games is a number resulting from cumulatively adding the numbers M of games received from the slot machine 5010.

FIG. 136 is a flowchart illustrating main processing executed in the server.

First, the CPU 5241 determines whether or not the predetermined start time (e.g. 14:00) has come, at a predetermined timing (step S5200). In the processing, the CPU 5241 determines whether or not the time shown by the clock 5249 is the predetermined start time. When determining that the predetermined start time has not come yet, the CPU 5241 ends the main processing.

On the other hand, when determining in step S5200 that the predetermined start time has come, the CPU 5241 executes participation acceptance processing (step S5201). In the processing, the CPU 5241 controls issuance of a participation ticket 500 to players who wish to participate in a tournament-type game. The participation acceptance processing has already been described based on FIG. 129D, and thus descriptions thereof are omitted here.

The CPU 5241 then transmits a tournament-type game start signal to the slot machines 5010 (step S5204).

Thereafter, the CPU 5241 executes number-of-participants determination processing (step S5205). In the processing, the CPU 5241 determines the number of players who participate in the tournament-type game; the number of tournaments; and assignment of the slot machines 5010 participating in the tournament-type game to the tournaments. The number-of-participants determination processing will be described later with reference to a drawing.

The CPU 5241 executes winning/losing determination processing (step S5206). In the processing, the CPU 5241 determines the winning slot machine of each match in each tournament. The winning/losing determination processing will be described later with reference to drawings.

The CPU 5241 executes game-history update processing (step S5207). In the processing, the CPU 5241 stores ranks achieved by respective players in a tournament-type game into the hard disk 5246 as pieces of the game-history data (see FIG. 135). At this time, when information of a rank is already included in a piece of the game-history data, the CPU 5241 compares the already included rank with the present rank to store the better rank (higher rank) of the two. After executing the processing of step S5207, the CPU 5241 ends the main processing.

FIG. 137 is a flowchart illustrating a subroutine of the number-of-participants determination processing.

First, the CPU 5241 executes game participation signal reception processing (step S5270). In the processing, when receiving a game participation signal, the CPU 5241 sets a game participation flag in association with the identification number of the slot machine 5010 as the transmission source. The game participation signal reception processing will be described later with reference to a drawing.

The CPU 5241 counts the number of game participation flags that are set (step S5271). Then, the CPU 5241 stores the counted number of game participation flags into the RAM 5243 as the number S of participants (step S5272).

The CPU 5241 determines whether or not the number S of participants in the RAM 5243 is more than 16 (step S5273). When determining that the number S of participants is not more than 16, the CPU 5241 determines 1 as the number D of tournaments which indicates the number of tournaments in a tournament-type game (step S5274). The CPU 5241 then stores 1 into the RAM 5243 as the number D of tournaments.

On the other hand, when determining in step S5273 that the number S of participants is more than 16, the CPU 5241 determines whether or not the number S of participants in the RAM 5243 is more than 32 (step S5275). When determining that the number S of participants is not more than 32, the CPU 5241 determines 2 as the number D of tournaments which indicates the number of tournaments in a tournament-type game (step S5276). The CPU 5241 then stores 2 into the RAM 5243 as the number D of tournaments.

On the other hand, when determining in step S5275 that the number S of participants is more than 32, the CPU 5241 determines 3 as the number D of tournaments which indicates the number of tournaments in a tournament-type game (step S5277). The CPU 5241 then stores 3 into the RAM 5243 as the number D of tournaments.

In the present embodiment, the number of tournaments in a tournament-type game is changed in accordance with the number S of participants. This will avoid a situation in which the time it takes from beginning to end of a tournament-type game is long because one tournament includes too many participating players; as a result, it is possible to prevent players from getting tired of the game.

Further, when a tournament-type game starts, matches are held in respective tournaments. That is, matches in the respective tournaments are simultaneously held. In the present embodiment, the maximum number of tournaments is 3. Increasing the number of tournaments makes it possible to increase the number of players who can be accepted to participate in the tournament-type game.

When executing the processing of step S5274, step S5276, or step S5277, the CPU 5241 determines assignment of the slot machines 5010 participating in the tournament-type game to the tournaments (step S5278). In the processing, the CPU 5241 first identifies the number D of tournaments which has been determined in the processing of step S5274, step S5276, or step S5277. Next, the CPU 5241 determines the number of tournament participants which indicates the number of players who participate in one tournament, based on the identified number D of tournaments and the number S of participants. For example, when the number D of tournaments is 2 and the number S of participants is 30, the number of tournament participants is 15.

Then, the CPU 5241 assigns the slot machines 5010 to a tournament tree from the left in the ascending order of the identification numbers of the slot machines 5010 such that a slot machine 5010 with the smallest identification number among the participating slot machines 5010 is assigned to the leftmost position. When the CPU 5241 has filled the tournament tree (when assignment of the slot machines 5010 in number equal to the number of tournament participants has been completed), the CPU 5241 starts assigning the slot machines 5010 to the next tournament tree in the same way.

In the processing of step S5278, a matchup for each unit game (each match in a tournament) in the respective tournaments is determined.

The CPU 5241 transmits as matchup information the assignment of the slot machines 5010 participating in the tournament-type game to the tournaments (the assignments determined in step S5278) to the slot machines 5010 participating in the tournament-type game (step S5279).

After executing the processing of step S5279, the CPU 5241 ends the present subroutine.

FIG. 138 is a flowchart illustrating a subroutine of the game participation signal reception processing.

First, the CPU 5241 starts measuring time with the timer 5245 (step S5280).

Next, the CPU 5241 determines whether or not the CPU 5241 has received a game participation signal from any of the slot machines 5010 (step S5281). When the CPU 5241 determines that the CPU 5241 has received a game participation signal, the CPU 5241 sets a game participation flag in association with the identification number of the slot machine 5010 as the transmission source of the game participation signal (step S5282).

When the CPU 5241 determines in step S5281 that the CPU 5241 has not received a game participation signal, or when the CPU 5241 has executed the processing of step S5282, the CPU 5241 determines whether or not the predetermined time has elapsed (step S5283). In the processing, the CPU 5241 determines whether or not the time measured with the timer 5245 has reached the predetermined time. When determining that the predetermined time has not elapsed, the CPU 5241 returns the processing to step S5281.

On the other hand, when determining in step S5283 that the predetermined time has elapsed, the CPU 5241 ends the present subroutine.

FIG. 139A and FIG. 139B are flowcharts each illustrating a subroutine of the winning/losing determination processing.

First, the CPU 5241 determines whether or not the CPU 5241 has received cumulative-amount-of-payout information from every slot machine participating in a unit game (step S5290). The cumulative amount of payout is the amount of payout of coins obtained in a unit game. The cumulative-amount-of-payout information is information showing the cumulative amount of payout. When the CPU 5241 determines that the CPU 5241 has not received cumulative-amount-of-payout information from every slot machine participating in a unit game, the CPU 5241 returns the processing to step S5290.

On the other hand, when the CPU 5241 determines that the CPU 5241 has received cumulative-amount-of-payout information from every slot machine participating in a unit game, the CPU 5241 determines the winning slot machine of each match (unit game) in the tournaments based on the received pieces of cumulative-amount-of-payout information (step S5291). In the processing, the CPU 5241 determines for each match the slot machine 5010 with the cumulative-amount-of-payout information which shows a cumulative amount of payout larger than that of the cumulative-amount-of-payout information of the other slot machine 5010 as the winning slot machine of the match. The determination is made based on the received pieces of cumulative-amount-of-payout information; the identification number of the slot machine 5010 included in each piece of cumulative-amount-of-payout information; and the matchups of the respective unit games (matches) in the respective tournaments which have been determined in step S5278.

The CPU 5241 then determines whether or not the winning slot machine of the tournament-type game has been determined (step S5292). In the processing, the CPU 5241 determines whether or not only one slot machine 5010 has been determined as the winning slot machine in every tournament. That is, in step S5292, whether or not the overall winning slot machine 5010 in every tournament is determined.

When the CPU 5241 determines that the winning slot machine of the tournament-type game has not been determined, the CPU 5241 transmits a winning signal to the slot machines 5010 that have been determined as the winning slot machines (step S5293). It should be noted that when only one slot machine 5010 has been determined as the winning slot machine in a tournament, the CPU 5241 does not transmit the winning signal to the slot machine that has been determined as the winning slot machine in this tournament. That is, the CPU 5241 does not transmit the winning signal to the slot machine 5010 that has been determined as the overall winner.

The CPU 5241 determines matchups for the next unit games (matches) (step S5294). In the processing, the CPU 5241 determines the matchups of the next unit games (matches), based on the winning slot machines determined in step S5291 and assignment of the slot machines 5010 to the tournaments which has been determined in step S5278.

The CPU 5241 transmits as matchup information the matchups of the unit games (matches) determined in step S5294 to the slot machines 5010 that have been determined as the winning slot machines (step S5295).

After executing the processing of step S5295, the CPU 5241 shifts the processing to step S5290.

When determining in step S5292 that the winning slot machine of the tournament-type game has been determined, the CPU 5241 transmits a tournament end signal to all the slot machines 5010 that participate in the tournament-type game (step S5296). In the processing, the CPU 5241 transmits the tournament end signal to the slot machines 5010 for each of which a game participation flag is set in association with the identification number. The tournament end signal includes information on the ranking for each tournament in the executed tournament-type game. That is, the ranking of the respective slot machines is determined before the tournament end signal is transmitted. The slot machine 5010 that has been determined as the overall winner takes first place, and the ranks of the respective other slot machines 5010 are determined in order. The ranks in the tournament-type game are stored in the hard disk 5246 of the server 5200 as pieces of the game-history data (see FIG. 135) (see step S5207 in FIG. 136).

FIG. 140 is a flowchart illustrating slot machine processing that is executed in each slot machine.

First, in step S5320, the main CPU 5041 determines whether or not a smart card is inserted into the card reader 5036. When determining that a smart card is inserted into the card reader 5036, the main CPU 5041 reads player identification information from the smart card (step S5322).

Next, in step S5324, the main CPU 5041 sets the number M of games to 0 in a predetermined area in the main RAM 5043. The number M of games is the number of normal games which is described later.

Then, in step S5326, the main CPU 5041 executes game execution processing. The game execution processing will be described later with reference to FIG. 141.

After that, in step S5328, the main CPU 5041 determines whether or not the smart card is ejected from the card reader 5036. When determining that the smart card is not ejected from the card reader 5036, the main CPU 5041 returns the processing to step S5326. On the other hand, when determining that the smart card is ejected from the card reader 5036, the main CPU 5041 transmits to the server 5200 the player identification information read in step S5322 and the number M of games, and then returns the processing to step S5320.

FIG. 141 is a flowchart illustrating the game execution processing that is executed in each slot machine.

First, the main CPU 5041 determines whether or not the main CPU 5041 has received the tournament-type game start signal from the server 5200 (step S5030).

When the main CPU 5041 determines in step S5030 that the main CPU 5041 has received the tournament-type game start signal, the main CPU 5041 determines whether or not the tournament-type game flag is set (step S5032). The tournament-type game flag is set in flag setting processing shown in FIG. 129E.

When the main CPU 5041 determines in step S5030 that the main CPU 5041 has not received the tournament-type game start signal or when the main CPU 5041 determines in step S5032 that the tournament-type game flag is not set, the main CPU 5041 executes the normal-game execution processing (step S5031). The normal-game execution processing will be described later in detail with reference to a drawing. The game executed in the normal game execution processing corresponds to the normal game in the present invention.

When the main CPU 5041 determines in step S5032 that the tournament-type game flag is set, the main CPU 5041 transmits a game participation signal to the server 5200 (step S5033). The game participation signal includes the identification number of the slot machine 5010.

Next, the main CPU 5041 executes tournament-type game execution processing (step S5034), and then ends the present subroutine. The tournament-type game execution processing will be described later with reference to drawings.

FIG. 142 is a flowchart illustrating a subroutine of normal-game execution processing.

First, the main CPU 5041 determines whether or not a coin has been betted (step S5012). In this processing, the main CPU 5041 determines whether or not the main CPU 5041 has received an input signal that is outputted from the 1-BET switch 5026S when the 1-BET button 5026 is operated, or an input signal that is outputted from the maximum BET switch 5027S when the maximum BET button 5027 is operated. When determining that a coin has not been betted, the main CPU 5041 returns the processing to step S5012.

On the other hand, when determining in step S5012 that a coin has been betted, the main CPU 5041 executes processing for making a subtraction from the number of credits stored in the RAM 5043 according to the number of betted coins (step S5013). It is to be noted that, when the number of coins to be betted is larger than the number of credits stored in the RAM 5043, the main CPU 5041 does not execute the processing for making a subtraction from the number of credits stored in the RAM 5043, and returns the processing to step S5012. Further, when the number of coins to be betted exceeds the upper limit of the number of coins that can be betted in one game (50 coins in the present embodiment), the main CPU 5041 does not execute the processing for making a subtraction from the number of credits stored in the RAM 5043, and proceeds with the processing to step S5014.

Next, the main CPU 5041 determines whether or not the start button 5023 has been turned ON (step S5014). In this processing, the main CPU 5041 determines whether or not the main CPU 5041 has received an input signal that is outputted from the start switch 5023S when the start button 5023 is pressed.

When the main CPU 5041 determines that the start button 5023 has not been turned ON, the main CPU 5041 returns the processing to step S5012.

It is to be noted that, when the start button 5023 is not turned ON (e.g. when the start button 5023 is not turned ON and a command to end the game is inputted), the main CPU 5041 cancels the subtraction result in step S5013.

On the other hand, when determining in step S5014 that the start button 5023 is turned ON, the main CPU 5041 executes symbol rearrangement processing (step S5015). In this processing, the main CPU 5041 first starts scroll-display of symbols in the display blocks 5028. Then, the main CPU 5041 executes the aforementioned symbol determination program, so as to determine the symbols to be rearranged, and then rearranges the symbols in the display blocks 5028.

Next, the main CPU 5041 determines whether or not a prize has been won (step S5016).

FIG. 143 is a view illustrating correspondence relationship between a type and the number of rearranged symbols and an amount of payout.

As shown in FIG. 143, an amount of payout is determined according to the type and number of the rearranged symbols. Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 5028 (see FIG. 143). In this processing, the main CPU 5041 counts the number of symbols for each type of the symbols rearranged in step S5017. Then, the main CPU 5041 determines whether or not the counted number is three or more.

When determining that a prize has been won, the main CPU 5041 executes processing relating to payout of coins (step S5017). In the processing, the main CPU 5041 determines the amount of payout based on the numbers of rearranged symbols with reference to the odds data stored in the ROM 5042. The odds data is data indicative of the correspondence relationship between the number of symbols rearranged in the display blocks 5028 and the amount of payout (see FIG. 143).

For example, in the case where three symbols of "SUN" are rearranged after two coins have been betted, 20(=2×10) coins are paid out.

In the case of accumulating coins, the main CPU 5041 conducts processing for adding the number of credits corresponding to the determined amount of payout to the number of credits stored in the RAM 5043. On the other hand, in the case of paying out coins, the main CPU 5041 transmits a control signal to the hopper 5066 in order to pay out coins in an amount corresponding to the determined amount of payout.

When determining in step S5016 that no prize has been won or after executing the processing of step S5017, the main CPU 5041 adds 1 to the number M of games (step S5018), and then ends the present subroutine.

FIGS. 16A and 16B are flowcharts each illustrating a subroutine of the tournament-type game execution processing.

First, the main CPU 5041 stores 0 into the RAM 5043 as an updated total cumulative amount of payout (step S5060).

The main CPU 5041 determines whether or not the main CPU 5041 has received matchup information from the server 5200 (step S5061). When the main CPU 5041 determines that the main CPU 5041 has not received matchup information, the main CPU 5041 returns the processing to step S5061.

On the other hand, when the main CPU 5041 determines in step S5061 that the main CPU 5041 has received matchup information, the main CPU 5041 executes tournament-tree display processing (step S5062). In the processing, the main CPU 5041 displays a tournament tree image to the upper image display panel 5033, based on the received matchup information.

FIG. 145 is a view illustrating an exemplary image displayed to the upper image display panel that is provided in each slot machine constituting the ticket issuing system according to one embodiment of the present invention.

In FIG. 145, the upper image display panel 5033 displays a tournament tree image 5602. To the lower part of the tournament tree image 5602, the player names of the players participating in the tournament-type game are displayed. Looking at the tournament tree image 5602, each player gets to know the player name of the player against whom he or she is going to have a match. A tournament name image 5601 shows the name of the tournament.

In the present embodiment, the number of tournaments in a tournament-type game changes within the range of 1 to 3 in accordance with the number S of participants. The name of the first tournament is Tournament A. The name of the second tournament is Tournament B. The name of the third tournament is Tournament C.

In FIG. 145, the tournament name image 5601 says Tournament B. That is, the tournament name image 5601 indicates that this tournament is the second tournament in the tournament-type game.

Referring back to FIG. 144A, the main CPU 5041 stores 0 into the RAM 5043 as an updated cumulative amount of payout (step S5063).

The main CPU 5041 stores 50 into the RAM 5043 as an updated number C of games (step S5064).

The main CPU 5041 determines whether or not a coin has been betted (step S5065). In the processing, the main CPU 5041 determines whether or not the main CPU 5041 has received an input signal outputted from the 1-BET switch 5026S when the 1-BET button 5026 is operated or an input signal outputted from the maximum BET switch 5027S when the maximum BET button 5027 is operated. When determining that a coin has not been betted, the main CPU 5041 returns the processing to step S5065.

On the other hand, when determining in step S5065 that a coin has been betted, the main CPU 5041 conducts processing of making a subtraction from the number of credits stored in the RAM 5043 in accordance with the number of the betted coins (step S5066). Here, in the case that the number of betted coins is larger than the number of credits stored in the RAM 5043, the main CPU 5041 returns the processing to step S5065 without executing the processing of making a subtraction from the number of credits stored in the RAM 5043. Further, in the case that the number of betted coins exceeds the upper limit value of the number of coins that can be betted in a single game (50 coins, in the present embodiment), the main CPU 5041 proceeds with the processing to step S5067 without executing the processing of making a subtraction from the number of credits stored in the RAM 5043.

Next, the main CPU 5041 determines whether or not the start button 5023 has been turned ON (step S5067). In the processing, the main CPU 5041 determines whether or not the main CPU 5041 has received an input signal that is outputted from the start switch 5023S when the start button 5023 is pressed.

When determining that the start button 5023 has not been turned ON, the main CPU 5041 returns the processing to step S5065.

Here, in the case that the start button 5023 is not turned ON (e.g. when the start button 5023 is not turned ON and a command to end the game is inputted), the main CPU 5041 cancels the subtraction result in step S5066.

On the other hand, when determining in step S5067 that the start button 5023 has been turned ON, the main CPU 5041 executes symbol rearrangement processing (step S5068).

In this processing, the main CPU 5041 first starts scroll-display of symbols in the display blocks 5028. Then, the main CPU 5041 executes the aforementioned symbol determination program, so as to determine the symbols to be rearranged, and then rearranges the symbols in the display blocks 5028.

Next, the main CPU 5041 determines whether or not a prize has been won (step S5069). Here, winning of a prize refers to rearrangement of at least one combination of three or more symbols of the same type out of "RIBBON", "HEART", "STAR", "MOON", "SUN", "JEWEL", "CROWN", and "SMILE", in the display blocks 5028 (see FIG. 143). In this processing, the main CPU 5041 counts the number of symbols for each type of the symbols rearranged in step S5068. Then, the main CPU 5041 determines whether or not the counted number is three or more.

When determining that a prize has been won, the main CPU 5041 executes processing relating to payout of coins (step S5070). In the processing, the main CPU 5041 determines the amount of payout based on the numbers of rearranged symbols with reference to the odds data stored in the ROM 5042. The odds data is data indicative of the correspondence relationship between the number of symbols rearranged in the display blocks 5028 and the amount of payout (see FIG. 143).

In the case of accumulating coins, the main CPU 5041 conducts processing for adding the number of credits corresponding to the determined amount of payout to the number of credits stored in the RAM 5043. On the other hand, in the case of paying out coins, the main CPU 5041 transmits a control signal to the hopper 5066 in order to pay out coins in an amount corresponding to the determined amount of payout.

The main CPU 5041 executes cumulative-amount-of-payout determination processing (step S5071). In the processing, the main CPU 5041 stores into the RAM 5043 a numeric value obtained by adding the amount of payout determined in step S5070 to the cumulative amount of payout stored in the RAM 5043, as an updated cumulative amount of payout.

When determining in step S5069 that no prize has been won, or when executing the processing of step S5071, the main CPU 5041 stores into the RAM 5043 a numeric value obtained by subtracting 1 from the number C of games stored in the RAM 5043, as an updated number C of games (step S5072).

The main CPU 5041 determines whether or not the number C of games stored in the RAM 5043 has reached 0 (step S5073). When determining that the number C of games has not reached 0, the main CPU 5041 returns the processing to step S5065.

On the other hand, when determining that the number C of games has reached 0, the main CPU 5041 updates the total cumulative amount of payout (step S5074). In the processing, the main CPU 5041 stores into the RAM 5043 a numeric value obtained by adding the cumulative amount of payout stored in the RAM 5043 to the total cumulative amount of payout stored in the RAM 5043, as an updated total cumulative amount of payout.

The main CPU 5041 transmits cumulative-amount-of-payout information to the server 5200 (step S5075). The cumulative-amount-of-payout information includes the identification number of the slot machine 5010.

The main CPU 5041 determines whether or not the main CPU 5041 has received the winning signal from the server 5200 (step S5076). When the main CPU 5041 determines that the main CPU 5041 has received the winning signal, the main CPU 5041 returns the processing to step S5061.

On the other hand, when the main CPU 5041 determines in step S5076 that the main CPU 5041 has not received the winning signal, the main CPU 5041 determines whether or not the main CPU 5041 has received the tournament end signal from the server 5200 (step S5077). When the main CPU 5041 determines that the main CPU 5041 has not received the tournament end signal, the main CPU 5041 returns the processing to step S5076.

On the other hand, when the main CPU 5041 determines in step S5077 that the main CPU 5041 has received the tournament end signal, the main CPU 5041 transmits total-cumulative-amount-of-payout information indicative of the total cumulative amount of payout, which is stored in the RAM 5043, to the server 5200 (step S5078). The total-cumulative-amount-of-payout information includes the identification number of the slot machine 5010 and the player name.

After executing the processing of step S5078, the main CPU 5041 ends the present subroutine.

As described above, according to the slot machine 5010, the control method of a slot machine 5010, the gaming system 5001, and the control method of a gaming system 5001, in each ticket issuing device 5300, a participation ticket 500 with a start time recorded thereon is issued from the ticket printer 5346 based on an input from the keyboard 5345 until the number of issued participation tickets 500 reaches the predetermined upper limit value. Also, in each ticket issuing device 5300, a standby ticket 5540 is issued from the ticket printer 5346 when a command to issue a participation ticket 500 is inputted from the keyboard 5345 after the number of issued participation tickets 500 has reached the upper limit value. In each slot machine 5010, when it is determined that the time at which the slot machine 5010 has received a participation ticket 500 with a start time recorded thereon is within the acceptance period for the start time recorded on the participation ticket 500, a participation registration in the tournament-type game is made. Further, in each slot machine 5010, when a participation registration in the tournament-type game has not been made, a standby ticket 5540 is accepted during a predetermined period from after the end of the acceptance period to the start time. Then, in each slot machine 5010, the tournament-type game is executed after the start time when a participation registration in the tournament-type game has been made.

A participation ticket 500 with a start time recorded thereon allows a player to know the start time of the tournament-type game. Therefore, the player can wait to put the participation ticket 500 in a slot machine 5010 until a few minutes before the start time. It is thus possible to prevent players from having to wait in front of slot machines 5010 until the tournament-type game starts, and thereby players are allowed to smoothly participate in the tournament-type game. Further, it is possible to prevent players from not being able to participate in the tournament-type game because of reasons such as that the player has got the start time wrong and cannot put his or her participation ticket 500 in a slot machine 5010 before the start time.

Further, when a participation registration in the tournament-type game has not been made, a standby ticket 5540 is accepted during the predetermined period from after the end of the acceptance period to the start time. A standby ticket 5540 being put into a slot machine 5010 during the predetermined period enables a player to participate in the tournament-type game. Therefore, it is possible to give more players the chance to participate in the tournament-type game when there are players who do not participate in the tournament-type game even though they have a participation ticket 500.

Furthermore, since being provided with the plurality of ticket issuing devices 5300, the gaming system 5001 can simultaneously execute issuance of participation tickets 500 or standby tickets 5540 from the plurality of ticket issuing devices 5300. Therefore, it is possible to avoid a situation in which issuance of a participation ticket 500 or a standby ticket 5540 takes long time, and thus to smoothly start the tournament-type game.

In the present invention, insertion of a ticket (in the present embodiment, participation ticket 500) into a gaming machine (in the present embodiment, slot machine 5010) allows a player to participate in a special game (in the present embodiment, tournament-type game). This makes it possible for the player to smoothly participate in the special game.

In the present embodiment, the case has been described in which a knockout tournament is employed as the special game. However, the special game in the present invention is not limited to this example. The special game in the present invention may be a round-robin tournament.

In the present embodiment, the case has been described in which the special game is a competition of the numbers of coins obtained in a game relating to slot machines. However, the special game in the present invention is not limited to this example, and may be, for example, a game that determines winning or losing based on the number of coins or the points which is obtained in a card game such as a poker game or Blackjack.

In the present embodiment, the case has been described in which the normal game (game relating to the slot machine) as shown in step S5031 is executed. However, the normal game is not limited to this, and may be, for example, a card game such as a poker game or Blackjack.

In the present embodiment, the case has been described in which the gaming machines in the present invention are the slot machines 5010. However, the gaming machine in the present invention is not limited to this, and may be, for example, a gaming machine that can execute a card game such as a poker game or Blackjack.

In the present embodiment, the case has been described in which the number-of-players upper limit value is constant (the case in which the number-of-players upper limit value is 40). However, in the present invention, the upper limit value is not limited to this. The upper limit value in the present invention may be, for example, the number of gaming machines in which no game is executed (on which a player is not playing a game) out of the plurality of gaming machines provided in the gaming system. When such a configuration is to be adopted, examples of a way to determine whether or not a game is executed in a gaming machine include providing a human body sensor in a gaming machine so as to determine that a game is not executed when no human body is detected by the human body sensor. Another way thereof is to determine that a game is not executed when a signal relating to a BET has not been inputted for a period longer than a predetermined time period.

In the present embodiment, the case has been described in which the barcode 502 is printed on a participation ticket 500 and in which the barcode 5542 is printed on a standby ticket 5540. However, in the present invention, the barcode is not limited to a one-dimensional code (barcode 502, barcode 5542), and a two-dimensional code (e.g. QR code (registered trademark)) may be printed.

In the present embodiment, the case has been described in which a participation ticket 500 (see FIG. 129B) has printed thereon the player name 501; the barcode 502; the text 503 "ENTRY TICKET" that indicates that the ticket is a participation ticket for a tournament-type game; and the start time 504 of the tournament-type game. However, in the present invention, the information to be printed is not particularly limited to this example so long as a participation ticket has printed thereon information that enables participation in the special game when the ticket is put into a gaming machine.

In the present embodiment, the case has been described in which a participation ticket 540 (see FIG. 129C) has printed thereon the player name 5541; the barcode 5542; the text 5543 "STANDBY TICKET" that indicates that the ticket is a standby ticket for a tournament-type game; and the start time 5544 of the tournament-type game. However, in the present invention, the information to be printed is not particularly limited to this example so long as at least information is printed that enables participation in a special game when the ticket is put into a gaming machine during the predetermined period from after the end of the acceptance period for participation tickets to the start time.

In the present embodiment, the case has been described in which the date is printed on a participation ticket 540. However, the date and the day of the week may be printed on a participation ticket in the present invention. Further, in the case of adopting a configuration in which an issued participation ticket is valid only for the day, the participation ticket in the present invention may have printed thereon the time only.

Although the embodiments of the present invention were described above, they were just illustrations of specific examples, and hence do not particularly restrict the present invention. A specific configuration of each step and the like is appropriately changeable in terms of design. Further, the effects described in the embodiments of the present invention are just recitations of the most suitable effects generated from the present invention. The effects of the present invention are thus not limited to those described in the embodiments of the present invention.

Further, the foregoing detailed descriptions centered the characteristic parts of the present invention in order to facilitate understanding of the present invention. The present invention is not limited to the embodiments in the foregoing specific descriptions and applicable to other embodiments with a variety of application ranges. Further, terms and phrases in the present specification were used not for restricting interpretation of the present invention but for precisely describing the present invention. It is considered easy for the skilled in the art to conceive other configurations, systems, methods and the like included in the concept of the present invention from the concept of the invention described in the specification. Therefore, it should be considered that recitations of the claims include uniform configurations in a range not departing from the range of technical principles of the present invention. Moreover, an object of the abstract is to enable a patent office, a general public institution, an engineer belonging to the technical field who is unfamiliar with patent, technical jargon or legal jargon, and the like, to smoothly determine technical contents and an essence of the present application with simple investigation. Accordingly, the abstract is not intended to restrict the scope of the invention which should be evaluated by recitations of the claims. Furthermore, for thorough understanding of an object of the present invention and an effect specific to the present invention, it is desired to make interpretation in full consideration of documents already disclosed and the like.

The foregoing detailed descriptions include processing executed on a computer or a computer network. Explanations and expressions above are described with the aim of being most efficiently understood by a skilled person in the art. In the specification, each step for use in deriving one result should be understood as the self-consistent processing. Further, in each step, transmission/reception, recording or the like of an electrical or magnetic signal is performed. While such a signal is expressed by using a bit, a value, a symbol, a letter, a term, a number or the like in processing of each step, it should be noted that those are used simply for the sake of convenience in description. While there are cases where processing in each step may be described using an expression in common with that of action of a human, processing described in the specification is essentially executed by a variety of devices. Further, another configuration requested for performing each step should become apparent from the above descriptions.

What is claimed as new and desired to be secured by Letters Patent of the United States is:

1. A gaming machine comprising:

a ticket reader;

a controller;

a recording medium issuing device from which a recording medium can be issued; and, a selection input device with which a selection can be made from a plurality of choices, said controller programmed to execute the processing of (a) executing a game played against an other gaming machine, when said ticket reader has read a ticket issued from a ticket issuing terminal (b) issuing from said recording medium issuing device a recording medium on which the result of said game executed in said processing (a) is printed, (c) prompting, after executing said processing (a), a selection of whether or not to issue from said recording medium issuing device a recording medium on which the result of said game executed in said processing (a) is printed, and said processing (b) includes issuing from said recording medium issuing device a recording medium on which the result of said game executed in said processing (a)is printed, on receiving a selection input signal indicating that said recording medium is to be issued from said recording medium issuing device, wherein said ticket issuing terminal is provided in a place other than an inside of said gaming machine.

2. The gaming machine according to claim 1, wherein said processing (a) includes executing a game played against an other gaming machine, when said ticket reader has read a ticket issued from said ticket issuing terminal or a recording medium issued from said recording medium issuing device.

3. The gaming machine according to claim 1, wherein said processing (b) includes issuing from said recording medium issuing device a recording medium on which a score obtained by a player playing a game on that gaming machine in said game executed in said processing (a) is printed.

4. The gaming machine according to claim 1, wherein said processing (b) includes issuing from said recording medium issuing device a recording medium on which a rank of a player playing a game on that gaming machine in said game executed in said processing (a) is printed.

5. The gaming machine according to claim 1, wherein said gaming machine further comprises:

a recording medium issuing device from which a recording medium can be issued; and a selection input device with which a selection can be made from a plurality of choices, said ticket issuing terminal is provided in a place other than an inside of said gaming machine, and said controller further programmed to execute the processing of:

(b) prompting, after executing said processing (a), a selection of whether or not to print on a recording medium information based on a past game result; and (c) issuing from said recording medium issuing device a recording medium on which the information based on the past game result is printed, on receiving from said selection input device a print selection input signal indicating that the information based on the past game result is to be printed on a recording medium.

6. The gaming machine according to claim 5, wherein said gaming machine further comprises an image display to which an image can be displayed, said processing (a) includes:

(a-1) reading identification information of a player from a ticket, when the ticket read by said ticket reader is a ticket issued from said ticket issuing terminal; and (a-2) executing a game played against an other gaming machine after executing said processing (a-1), said controller is further programmed to execute the processing of (d) displaying to said image display an image prompting a selection of a single or plurality of game histories from a plurality of game histories associated with identification information same as said identification information read in said processing (a-1), on receiving from said selection input device a print selection input signal indicating that the information based on the past game result is to be printed on a recording medium, and said processing (c) includes issuing from said recording medium issuing device a recording medium on which information based on the game history specified by a game history selection input signal for specifying the game history is printed, on receiving from said selection input device said game history selection input signal.

7. The gaming machine according to claim 1, wherein said gaming machine further comprises a ticket printer, said controller further programmed to execute the processing of:

(b) executing a normal game; and (c) providing from said ticket printer a game-result ticket on which the game result of said normal game is recorded, and said processing (a) includes: (a-1) determining whether or not the game result recorded on said game-result ticket satisfies a given condition, when said game-result ticket provided in said processing (c) is put into said ticket reader; and (a-2) executing a special game in which winning or losing is determined based on a result of a game that is executed in a plurality of said gaming machines, when the controller determines in said processing (a-1) that the game result satisfies said given condition.

8. The gaming machine according to claim 1, wherein said ticket includes a participation ticket with a start time recorded thereon, and said processing (a) includes:

(a-1) determining whether or not the time at which said ticket reader has received said participation ticket is within an acceptance period for the start time recorded on the participation ticket;

(a-2) making a participation registration in a special game in which winning or losing is determined based on a result of a game executed in a plurality of said gaming machines, when the controller determines in said processing (a-1) that the time at which said ticket reader has received said participation ticket is within said acceptance period for the start time recorded on the participation ticket; and (a-3) executing said special game after said start time, when the controller has made a participation registration in said special game.

9. The gaming machine according to claim 1, wherein said processing (a) includes executing a game played against an other gaming machine participating that game identified out of a plurality of games, when said ticket reader has read a ticket issued from a ticket issuing terminal.

10. A gaming system comprising:

a ticket issuing device provided with a ticket issuing terminal from which a ticket can be issued, and a processor; and a plurality of gaming machines each provided with a ticket reader and a controller;

said processor programmed to execute the processing of (A) issuing from said ticket issuing terminal a ticket to be read by said ticket reader provided in said gaming machine so as to enable participation in a game played against an other gaming machine, and said controller programmed to execute the processing of (a) executing the game played against an other gaming machine participating in that game, when said ticket reader has read the ticket issued in said processing (A), and wherein said gaming system includes a plurality of said ticket issuing devices, said gaming machines each further includes a ticket printer, said ticket issuing devices each further includes an input device with which an operator can perform an input operation, and a ticket reading terminal that can read information recorded on a ticket, said controller executes the processing of:

(b) executing a normal game; and (c) providing from said ticket printer a game-result ticket on which the game result of said normal game is recorded, said processing (A) includes (A-1) determining whether or not the game result recorded on said game-result ticket satisfies a given condition, when said game-result ticket provided from said gaming machine is put into said ticket reading terminal; and (A-2) issuing a participation ticket from said ticket issuing terminal, when said processor determines in said processing (A-1) that the game result satisfies said given condition, and said processing (a) includes executing a special game in which winning or losing is determined based on a result of a game that is executed in said plurality of gaming machines, when said participation ticket issued from said ticket issuing device is put into said ticket reader.

11. The gaming system according to claim 10, wherein said gaming machines each further includes a recording medium issuing device from which a recording medium can be issued and said controller is further programmed to execute the processing of (b) issuing from said recording medium issuing device a recording medium on which the result of said game executed in said processing (a) is printed.

12. The gaming system according to claim 10, wherein said gaming system includes a plurality of said ticket issuing devices, said ticket issuing devices each includes an input device, said processing (A) includes (A-1) issuing from said ticket issuing terminal a participation ticket with a start time recorded thereon, based on an input from said input device, until the number of issued participation tickets reaches a predetermined upper limit value; and (A-2) issuing from said ticket issuing terminal a standby ticket, when a command to issue a participation ticket is inputted from said input device after the number of issued participation tickets has reached said predetermined upper limit value, and said processing (a) includes (a-1) making a participation registration in a special game in which winning or losing is determined based on a result of a game executed in said plurality of gaming machines, when the time at which said ticket reader has received said participation ticket is within an acceptance period for a start time that is recorded on the participation ticket;

(a-2) accepting a standby ticket during a predetermined period from after the end of said acceptance period to said start time, when said controller has not made a participation registration in said special game in said processing (a-1);

(a-3) making a participation registration in said special game, when said ticket reader has received a standby ticket during said predetermined period during which a standby ticket is accepted in said processing (a-2); and (a-4) executing said special game after said start time, when said controller has made a participation registration in said special game.

13. A ticket issuing system comprising:

a plurality of ticket issuing devices each including an input device, a ticket issuing terminal from which a ticket can be issued, and a processor;

and a plurality of gaming machines, said processor executing the processing of:

(A) receiving from said input device a participation input signal that indicates participation in a game played against an other gaming machine; and (B) issuing from said ticket issuing terminal a ticket that enables participation in said game upon being put into any of said gaming machines, when said processor has received said participation input signal in said processing (A), wherein said input device is operable by an operator, said ticket issuing system further includes a storage device storing game result information that shows a result of a game played on any of said gaming machines, in association with player identification information for identifying a player, and said processing (B) includes (B-1) identifying one piece of the player identification information out of pieces of the player identification information stored in said storage device, based on an input from said input device;

(B-2) determining whether or not a piece of the game result information associated with the one piece of the player identification information identified in said processing (B-1) satisfies a given condition; and (B-3) issuing from said ticket issuing terminal a participation ticket that enables participation in a special game upon being put into any of said gaming machines, when said processor determines in said processing (B-2) that the piece of the game result information satisfies the given condition, said special game being a game in which winning or losing is determined based on a result of a game played on said plurality of gaming machines.

* * * * *